US011020876B2

(12) United States Patent
Weick et al.

(10) Patent No.: US 11,020,876 B2
(45) Date of Patent: Jun. 1, 2021

(54) SYSTEM AND METHOD FOR CONVEYOR RACK AND ELEVATOR

(71) Applicant: Steven Howard Weick, Whitney, TX (US)

(72) Inventors: Steven Howard Weick, Whitney, TX (US); Justin D Strempke, North Richland Hills, TX (US); Jayton T Cagle, Milsap, TX (US); Troy Powledge, Hewitt, TX (US); William Steven Smith, Hewitt, TX (US)

(73) Assignee: Steven Howard Weick, Whitney, TX (US)

( * ) Notice: Subject to any disclaimer, the term of this patent is extended or adjusted under 35 U.S.C. 154(b) by 0 days.

(21) Appl. No.: 16/809,789

(22) Filed: Mar. 5, 2020

(65) Prior Publication Data

US 2020/0206973 A1 Jul. 2, 2020

Related U.S. Application Data

(62) Division of application No. 15/433,216, filed on Feb. 15, 2017, now Pat. No. 10,632,649.

(60) Provisional application No. 62/295,221, filed on Feb. 15, 2016.

(51) Int. Cl.

| | |
|---|---|
| ***B28B 17/00*** | (2006.01) |
| ***B28B 5/04*** | (2006.01) |
| ***B28B 15/00*** | (2006.01) |

(52) U.S. Cl.
CPC ..... *B28B 17/0081* (2013.01); *B28B 5/04* (2013.01); *B28B 15/00* (2013.01)

(58) Field of Classification Search
CPC ..... B28B 17/0081
See application file for complete search history.

(56) References Cited

U.S. PATENT DOCUMENTS

2014/0034838 A1 2/2014 Appleby et al.

FOREIGN PATENT DOCUMENTS

CN 1028419 C 5/1995

*Primary Examiner* — Larry W Thrower
(74) *Attorney, Agent, or Firm* — Katarzyna Brozynski; Antonio Devora

(57) ABSTRACT

A system and method for manufacturing a set of cast stones includes a set of spray stations, a set of fill stations, a set of vibration tables, a drying rack, and a demolder connected to the drying rack. A controller is connected to each of the set of spray stations, the set of fill stations, the set of vibration tables, the drying rack, and the demolder, each of which has a set of sensors connected to the controller. The set of spray stations include a set of release stations and a set of color stations. A mold is sprayed with a release product, a set of colors, and then filled with a cementitious material. Once vibrated, the cementitious material is dried to form the set of cast stones, which is then automatically released from the mold utilizing the demolder.

9 Claims, 242 Drawing Sheets

******* BITS ORGANIZED FOR COMMS WITH WET REMOTE CONTROLLER *******

DATA TO BE SENT TO THE WET REMOTE CONTROL CABINET

V2600-V2507 ARE WORDS THAT ARE READ FROM THE "MAN 205 PLC" INTO THE WET REMOTE PLC

V2620-V2527 ARE WORDS THAT ARE WRITTEN FROM THE WET REMOTE PLC TO THE "MAIN 205 PLC"

SYSTEM AND METHOD FOR CONVEYOR RACK AND ELEVATOR

CROSS-REFERENCE TO RELATED APPLICATIONS

This application is a divisional application of U.S. application Ser. No. 15/433,216, filed Feb. 15, 2017, which claims priority to U.S. Provisional Application No. 62/295,221, filed Feb. 15, 2016. Each of these patent applications is incorporated by reference herein in its entirety to provide continuity of disclosure.

FIELD OF THE INVENTION

The disclosed embodiments generally relate to creating cast stone. More particularly, the disclosed embodiments relate to a system and method for creating cast stone using reusable molds that works autonomously.

BACKGROUND OF THE INVENTION

Cast stone is a product that simulates natural cut stone used as an architectural feature, trim, ornament, or facing of buildings, walls, or other structures. Cast stone is made from a cementitious material, such as concrete, that includes fine and course aggregates, Portland cement, water, coloring, and optional chemical admixtures. Two methods to manufacture cast stone are the vibrant dry tamp method and the wet cast method.

Each method requires design mixes that must be carefully proportioned to form products having maximum density and texture resembling natural stone. White Portland cement is usually used to achieve lighter colors and color consistency. However, blending of grey Portland cement and coloring pigments together with white cement in order to achieve color is also common practice. Since the cement to aggregate ratio of 1:3 is normally used, a properly cured cast stone unit will have a high compressive strength of approximately 6,500 psi and a lower cold water absorption rate of approximately 6%, both of which are better than natural limestone or normal concrete. The vibrant dry tamp method, due to its inherent lower water-cement ratio typically yields higher compressive strengths than low slump concrete.

The vibrant dry tamp method typically involves the vibratory ramming of concrete against a rigid formwork until it is densely compacted and ready for immediate removal from the mold. This process enables as many as 100 pieces to be cast from a single mold in an eight hour day. However, the vibrant dry tamp method generally requires one flat, unexposed side to the stone design, thereby making complex multi-faced shapes, such as an "L" shape and similar shapes more costly to produce.

The wet cast process for manufacturing cast stone is similar to the manufacturing process used for making precast concrete, but produces a finish much more closely resembling natural stone. Mix designs in the wet cast process usually require graded sieve coarse aggregates typically one-half inch or smaller and are composed of an abundance of fine aggregates, which when combined with careful manual and vibratory concrete placement techniques, leaves little or no voids after finishing of exposed surfaces. The compression strength is approximately 6,500 psi with a lower cold water absorption factor than natural stone, making cast stone made from the wet cast process less permeable to water, weather, and dirt.

In some processes, surface finishing is employed to remove the cement "skin" from the outer surface of the stone. This removal exposes the fine aggregates and assures that the product will undergo minimal color and texture changes as a result of weathering. Muriatic (hydrochloric) acid etching is the most popular method of finishing cast stone because of the brilliance of the etched aggregates and the ability of the resulting finished surface to remain clean. A honed or polished finish which provides a glossy finish similar to granite or marble may also be employed. However, these processes for manufacturing cast stone are costly and labor intensive.

Therefore, there is a need in the art for a system and method of manufacturing cast stone where human intervention is minimized, thereby minimizing manufacturing costs and risk of injury.

SUMMARY

A system and method for manufacturing cast stones is disclosed. The system includes a set of spray stations, a set of fill stations connected to the set of spray stations, a set of vibration tables connected to the set of fill stations, a drying rack connected the set of vibration tables, and a demolder connected to the drying rack. A controller is connected to each of the set of spray stations, the set of fill stations, the set of vibration tables, the drying rack, and the demolder. A set of sensors is connected the controller and to each of the set of spray stations, the set of fill stations, the set of vibration tables, the drying rack, and the demolder. The set of spray stations include a set of release stations and a set of color stations.

The method includes the steps of applying a release product to a mold at the set of release stations, applying a set of color products to the mold at the set of color, filling the mold with a cementitious material at the set of fill stations, vibrating the mold and the cementitious material at the set of vibration tables, drying the cementitious material in the mold to form the set of cast stones as a dried mold in the drying rack, and deforming the dried mold in the demolder to release the set of cast stones from the dried mold.

BRIEF DESCRIPTION OF THE DRAWINGS

The below description will be made with references to following drawings.

DETAILED DESCRIPTION

Figure 1:
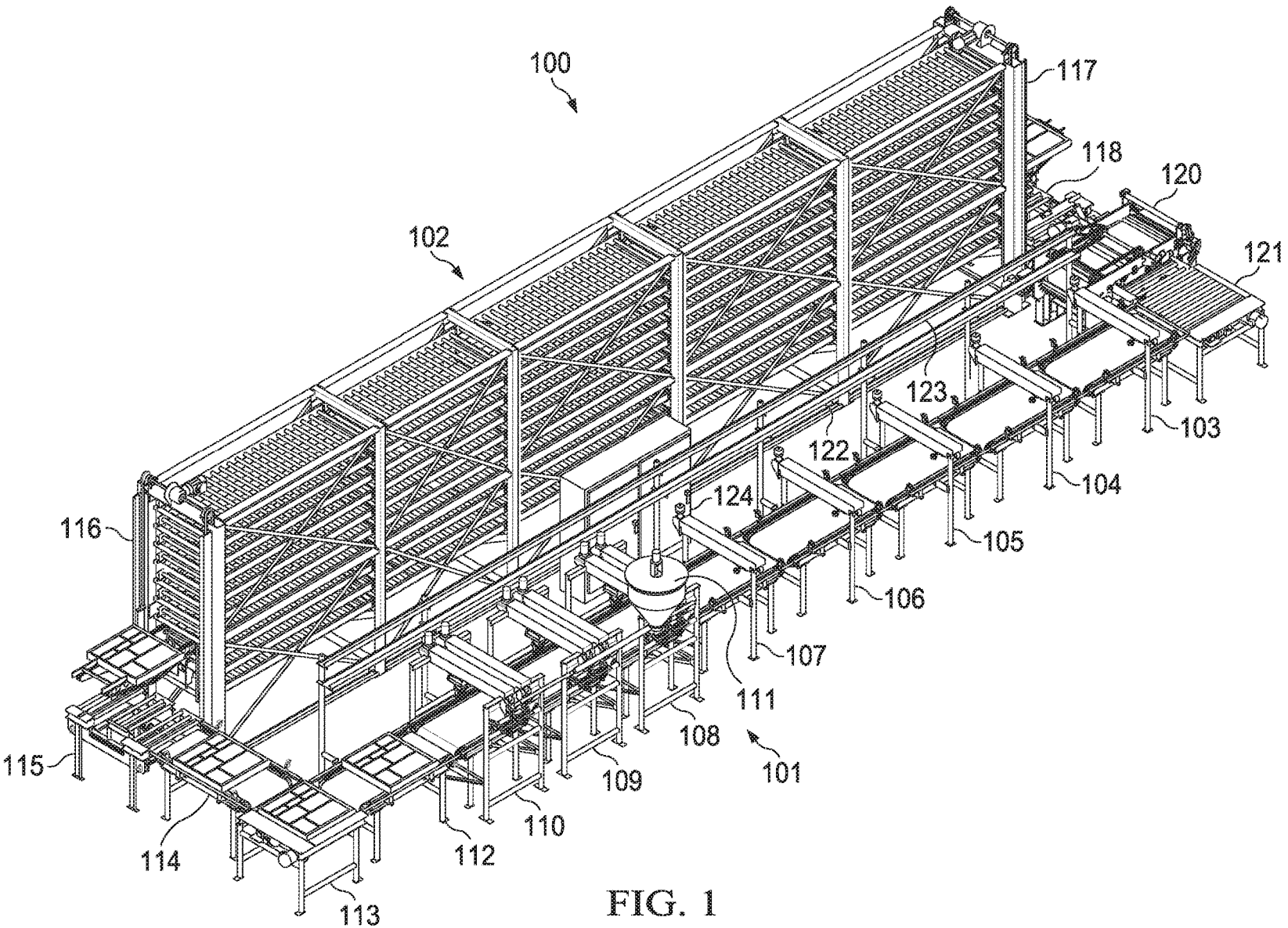
FIG. 1 is an isometric view of a conveyor rack and elevator system of a preferred embodiment.

Referring to FIG. 1, system 100 includes a set of conveyor stations 101 connected to a drying rack 102. Set of conveyor stations 101 includes spray stations 103, 104, 105, 106, and 107. Spray station 104 is connected to spray station 103, spray station 105 is connected the space station 104, spray station 106 is connected to spray station 105, and spray station 107 is connected to spray station 106. Fill station 108 is connected to spray station 107. Fill station 109 is connected to fill station 108. Fill station 110 is connected to fill station 109. Hopper 111 is connected to each of fill stations 108, 109, and 110. Vibration table 112 is connected to fill station 110. Right angle transition ("RAT") table 113 is connected to vibration table 112. Conveyor table 114 is connected to RAT table 113. Elevator entry table 115 is connected to vibration table 114 and entry elevator 116 of drying rack 102. Elevator 117 of drying rack 102 is connected to exit table 118. Demolder 120 is connected to exit table 118. RAT table 121 is connected to demolder 120 and spray station 103. Supply line 122 is connected to spray stations 103, 104, 105, 106, and 107. Supply line 123 is connected to fill stations 108, 109, and 110.

It will be appreciated by those skilled in the art that any number of conveyor tables, spray stations, fill stations, vibration tables, right angle transition tables, entry and exit elevator tables, elevators, drying racks, and demolders may be employed. It will be further appreciated that a linear arrangement or any other desired arrangement of conveyor tables, spray stations, fill stations, vibration tables, right angle transition tables, entry and exit elevator tables, elevators, drying racks, and demolders may be employed.

Controller 124 is connected to each of spray stations 103, 104, 105, 106, and 107. Controller 120 is further connected to fill stations 108, 109, 110, vibration table 112, RAT table 113, conveyor table 114, elevator entry table 115, entry elevator 116, drying rack 102, exit elevator 117, exit elevator table 118, demolder 120, and RAT table 121.

In a preferred embodiment, controller 124 is a programmable logic controller ("PLC"). Other suitable controllers may be employed.

In a preferred embodiment, each of spray stations 103, 104, 105, 106, and 107, fill stations 108, 109, 110, vibration table 112, RAT table 113, conveyor table 114, elevator entry table 115, entry elevator 116, drying rack 102, exit elevator 117, exit elevator table 118, demolder 120, and RAT table 121, is connected to a controller, preferably a PLC, each of which is connected to controller 124 and housed in a single cabinet. In other embodiments, a controller is connected directly to each of each of spray stations 103, 104, 105, 106, and 107, fill stations 108, 109, 110, vibration table 112, RAT table 113, conveyor table 114, elevator entry table 115, entry elevator 116, drying rack 102, exit elevator 117, exit elevator table 118, demolder 120, and RAT table 121.

In a preferred embodiment, controller 124 is programmed with a set of instructions that receives and examines data from a set of sensors connected to the system and a set of inputs, and responds with a set of instructions that is converted to a set of electrical signals that, for example, starts and stops a set of motors, opens and closes a set of gates, opens and closes a set of valves, operates a set of pneumatic cylinders, and operates other electro-mechanical components of the system as will be further described below.

In a preferred embodiment, controller 124 is programmed using ladder logic. Any type of suitable programming language known in the art may be employed.

In a preferred embodiment, an empty mold is positioned on a slaveboard and moves across belt conveyors through spray stations 103 and 104, where a release product is sprayed into the empty mold, coating a set of cavity surfaces of the empty mold. The empty mold moves across a set of belt conveyors through spray stations 105, 106, and 107 where a liquid color product is applied to the set of cavity surfaces of the empty mold. The sprayed mold then moves across the set of belt conveyors to fill stations 108, 109, and 110, where each cavity of the mold is filled by a hopper system, as will be further described below. The filled mold then moves across a vibration table 112, where bubbles in the filled mold are released. The mold moves across RAT table 113, across conveyor table 114 to elevator entry table 115. Entry elevator 116 lifts the filled mold and places the filled mold into drying rack 102 having a set of rows, as will be further described below. The filled molds are timed to remain in drying rack 102 for a predetermined period, after which the dried molds are lowered by exit elevator 117 to exit elevator table 118 and transferred to demolder 120. Demolder 120 removes a set of dried stones from the mold. The set of dried stones are then typically organized and processed for shipment. The now empty mold continues through RAT table 121 and returns to the set of conveyor stations 102 to repeat the process.

In a preferred embodiment, the time period at each station is approximately 80 seconds. Other times may be employed.

In a preferred embodiment, the entire cycle time depends on the drying rate in the drying rack and the type of material in the molds.

Figure 2A:
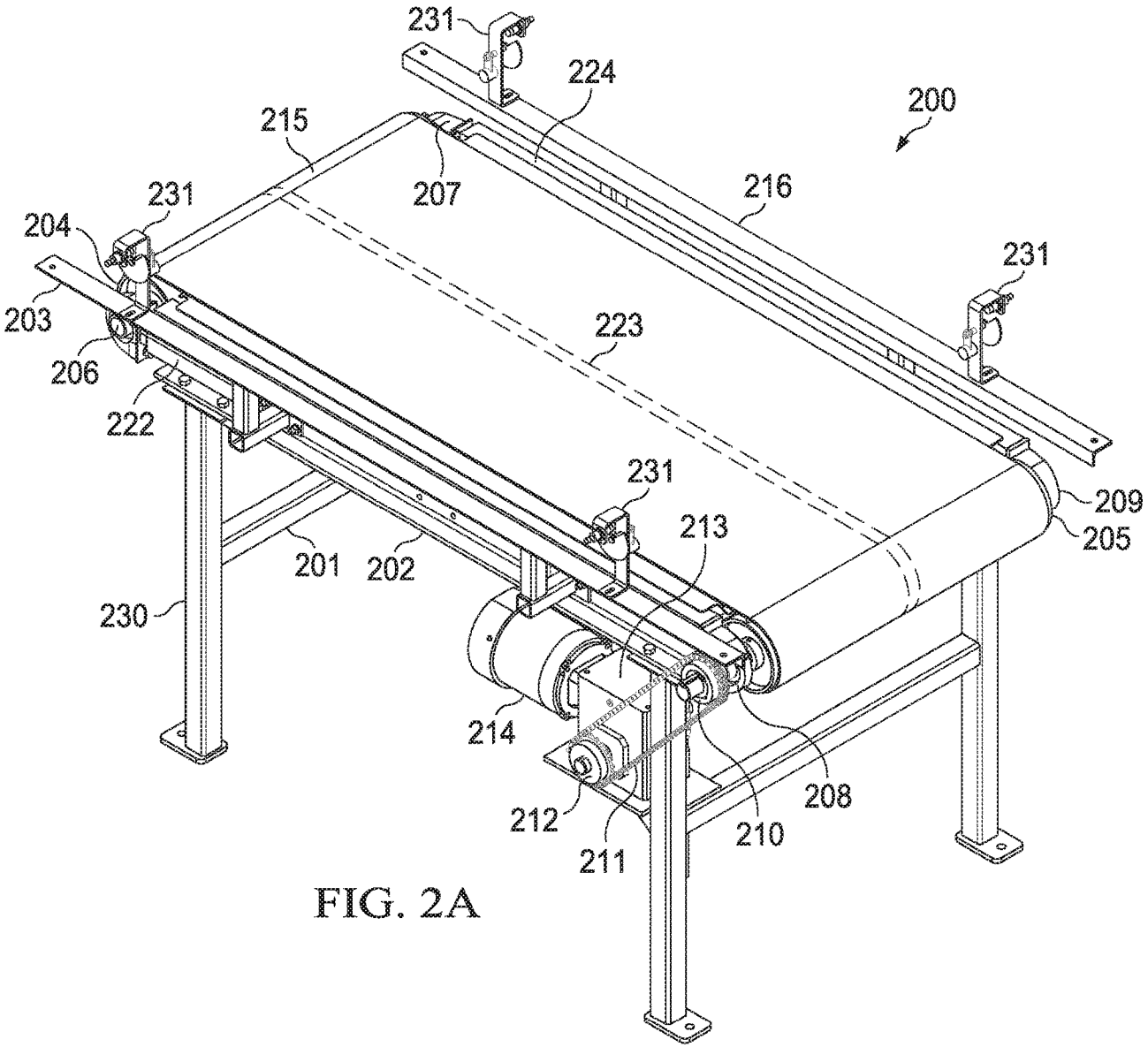
FIG. 2A is an isometric view of a conveyor table of a preferred embodiment.

Referring to FIG. 2A, conveyor table 200 includes frame 201. Frame 201 includes set of legs 230. Table support 202 is connected to frame 201. Table support 202 has guides 203 and 216. Roller 204 is rotatably attached to bearings 206 and 207. Tensioner 222 is attached to bearing 206 and to table support 202. Tensioner 224 is attached to bearing 207 and to table support 202. Roller 205 is rotatably attached to table support 202 with bearings 208 and 209. Sprocket 210 is connected to roller 205 and engaged with chain 211. Chain 211 is engaged with sprocket 212. Sprocket 212 is connected to gearbox 213. Gearbox 213 is connected to motor 214. Belt 215 is frictionally engaged with rollers 204 and 205. Belt 215 has guide 223 integrally formed thereon that further engages with rollers 204 and 205. Set of position sensors 231 is attached to guides 203 and 216. Set of position sensors 231 may be optionally positioned at any location on guide 203 and/or guide 216.

In one embodiment, conveyor table 200 is approximately six feet in length. In this embodiment, conveyor table 200 is employed in the set of spray stations. In another embodiment, conveyor table is approximately four feet in length. In this embodiment, conveyor table 200 is employed in the set of fill stations. Any length may be employed.

In a preferred embodiment, belt 215 is made of polyvinylchloride. Other suitable materials known in the art may be employed.

In a preferred embodiment, belt 215 has a surface speed of approximately 30 fps. Any speed may be employed.

In a preferred embodiment, each of rollers 204 and 205 is a hollow-tube steel roller. Other suitable rollers known in the art may be employed.

In a preferred embodiment, set of legs 230 is removable from table support 202 with a set of removable fasteners, such as a bolt and a nut. Other suitable means for removable and permanent attachment known in the art may be employed.

In a preferred embodiment, frame 201 and table support 202 are made of steel. Any suitable material known in the art may be employed.

In a preferred embodiment, each of bearings 206, 207, 208, and 209 is a pillow-block bearing. Other suitable bearings known in the art may be employed.

Figure 2C:
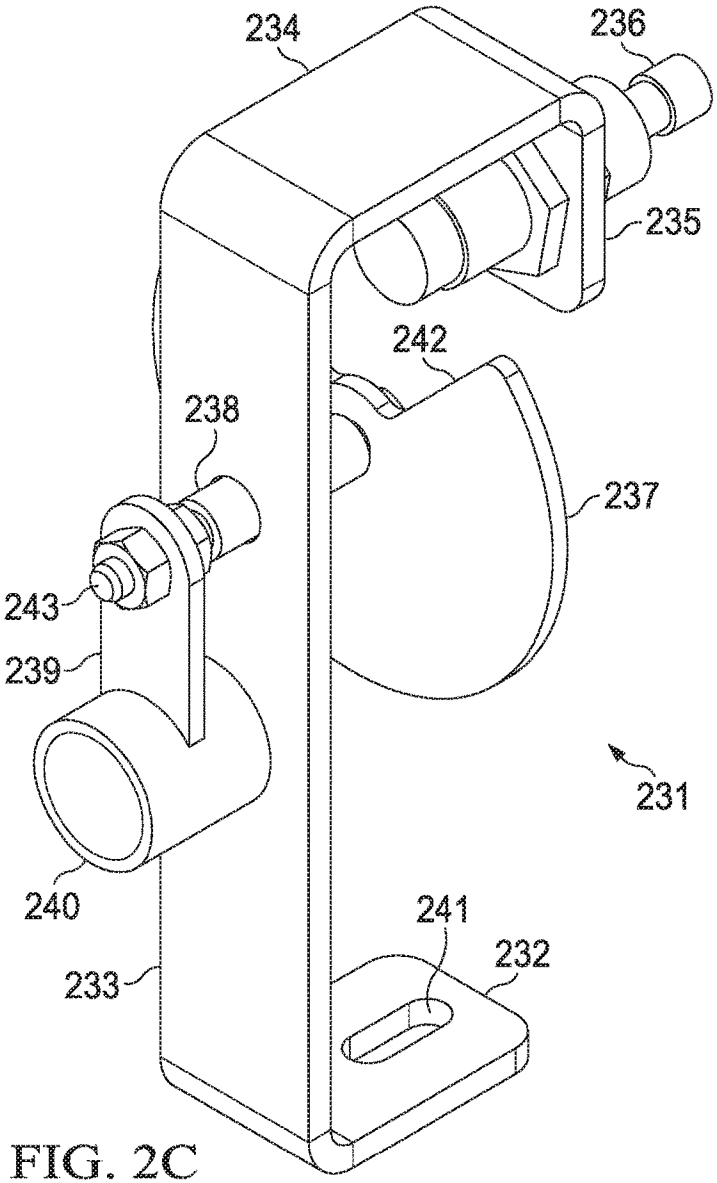
FIG. 2C is an isometric view of a position sensor of a preferred embodiment.
Figure 2B:
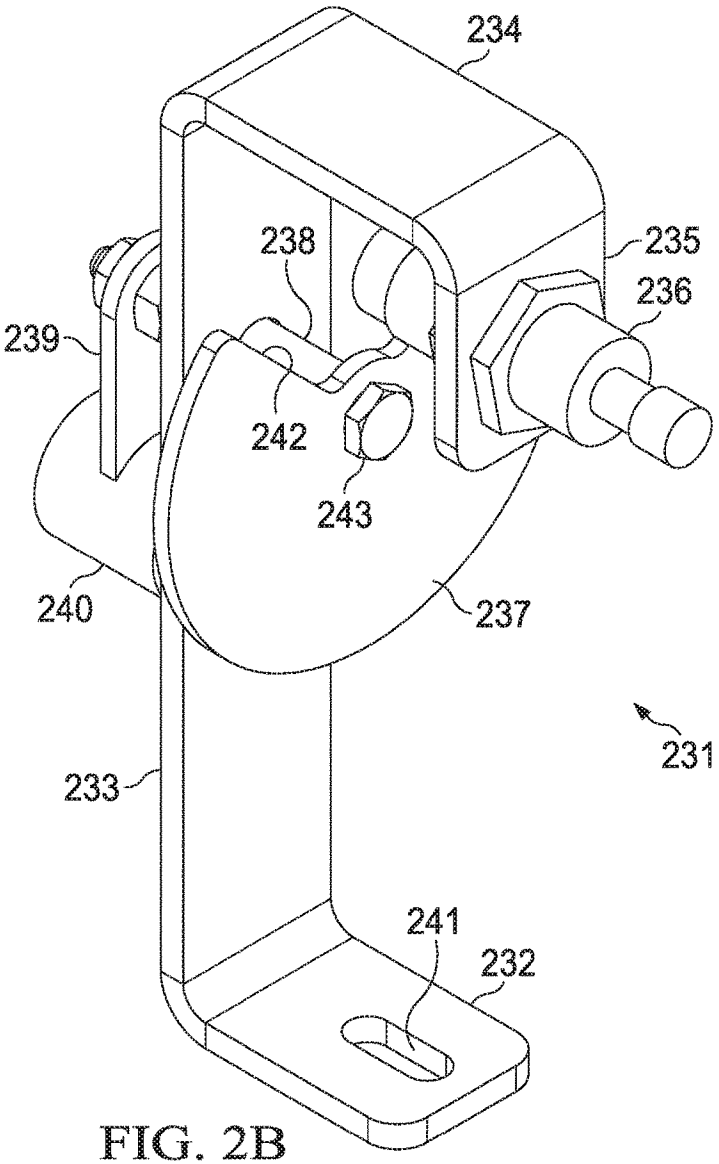
FIG. 2B is an isometric view of a position sensor of a preferred embodiment.

Referring to FIGS. 2B and 2C, each position sensor 231 will be further described. Position sensor 231 includes base 232, support 233 attached to base 232, extension 234 attached to support 233, and sensor support 235 attached to extension 234. Base 232 includes slot 241. Sensor 236 is secured to sensor support 235. Sensor 236 is further connected to a controller via a wired or wireless connection. Shaft 238 is attached to support 233. Shutter wheel 237 is rotatably connected to shaft 238 with fastener 243. Shutter wheel 237 includes cutout 242. Fastener 243 is inserted through shaft 238. Arm extension 239 is connected to fastener 243. Arm 240 is attached to arm extension 239.

In a preferred embodiment, sensor 236 is a non-contact proximity sensor, an AK Series M18 DC Inductive Proximity Sensor available from AutomationDirect.com. Other suitable sensors known in the art may be employed.

It will be appreciated by those skilled in the art that numerous variations can be made to position sensor 231 including numerous arrangements of sensor 236, shutter wheel 237, and arm 240.

In use, position sensor 231 senses the position of a mold. Cutout 242 enables shutter wheel 237 to be disengaged from sensor 236 when at rest in a non-tripped position. As a mold passes, the mold engages arm extension 240 and/or arm 239 and arm 240 rotates about an axis through fastener 243, causing cutout 242 to pass by sensor 236 and a solid surface of shutter wheel 237 to activate sensor 236, which sends a signal back to the controller.

Figure 3:
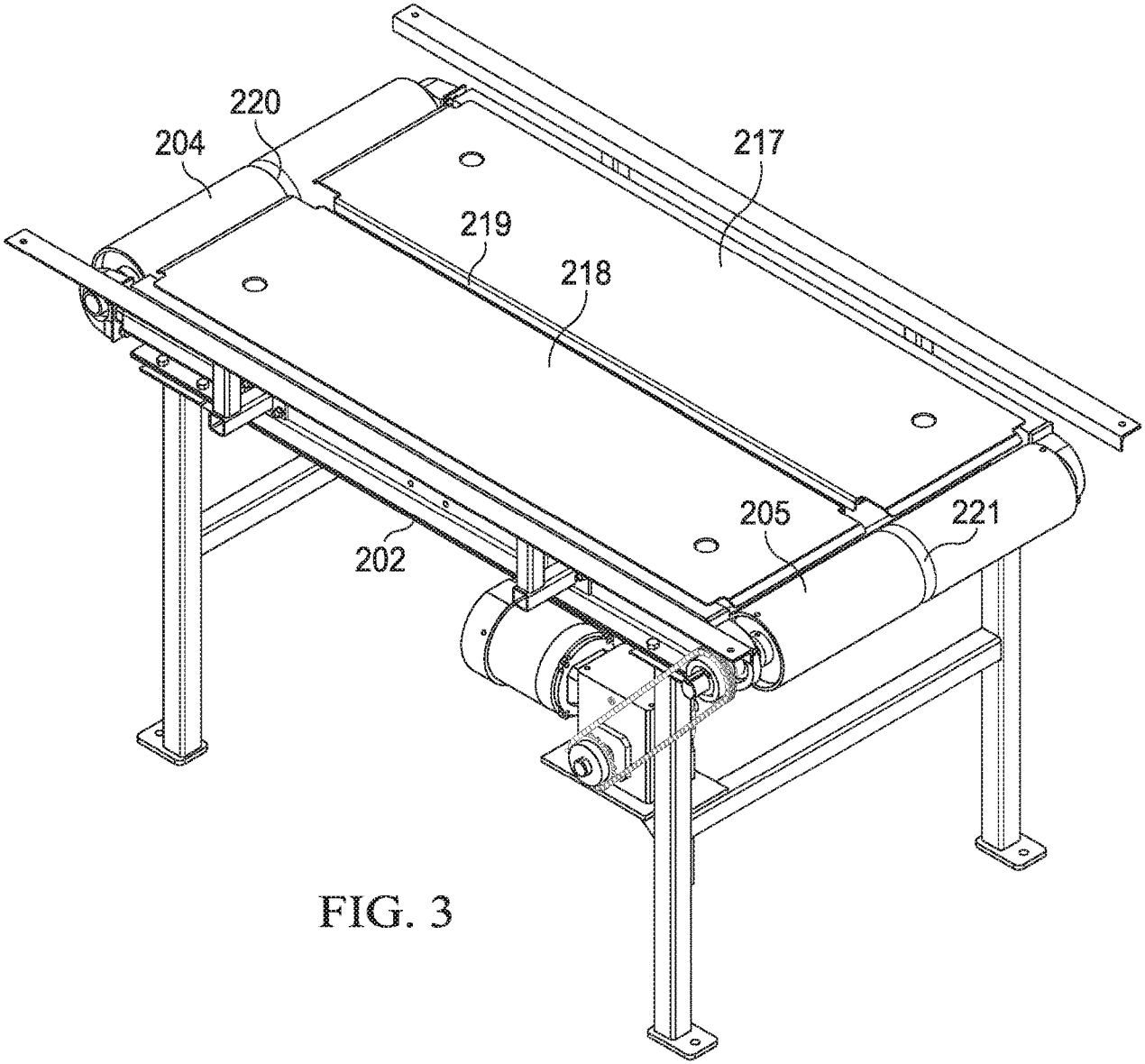
FIG. 3 is an isometric view of a conveyor table with no belt of a preferred embodiment.

Referring to FIG. 3, each of table surfaces 217 and 218 is attached to table support 202 and positioned between rollers 204 and 205. Table surfaces 217 and 218 form guide slot 219 through which guide 223 of belt 215 moves and with which guide 223 is optionally slidably engaged. Roller 204 has slot 220 integrally formed therein and approximately centered on roller 204. Slot 220 is frictionally engaged with guide 223 of belt 215. Roller 205 has slot 221 integrally formed therein and approximately centered on roller 205. Slot 221 is frictionally engaged with guide 223 of belt 215.

Figure 4:
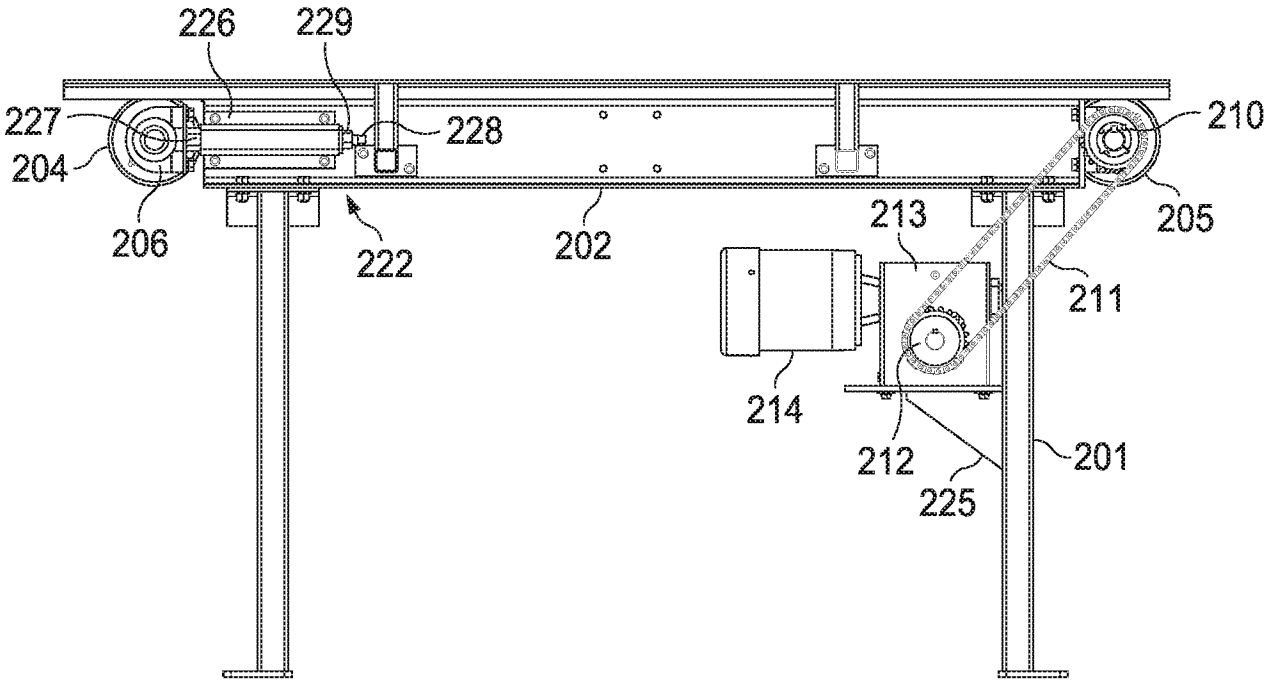
FIG. 4 is a side view of a conveyor table of a preferred embodiment.

Referring to FIG. 4, gearbox 213 is attached to support 225. Support 225 is attached to frame 201. By way of example, tensioner 222 includes bracket 226 attached to table support 202. Tube 227 includes threads 228 and is telescopically engaged with bracket 226. Nut 229 is rotatably attached to bracket 226 and threadably engaged with thread 228. Tensioner 224 is the same as tensioner 222.

Figure 5:
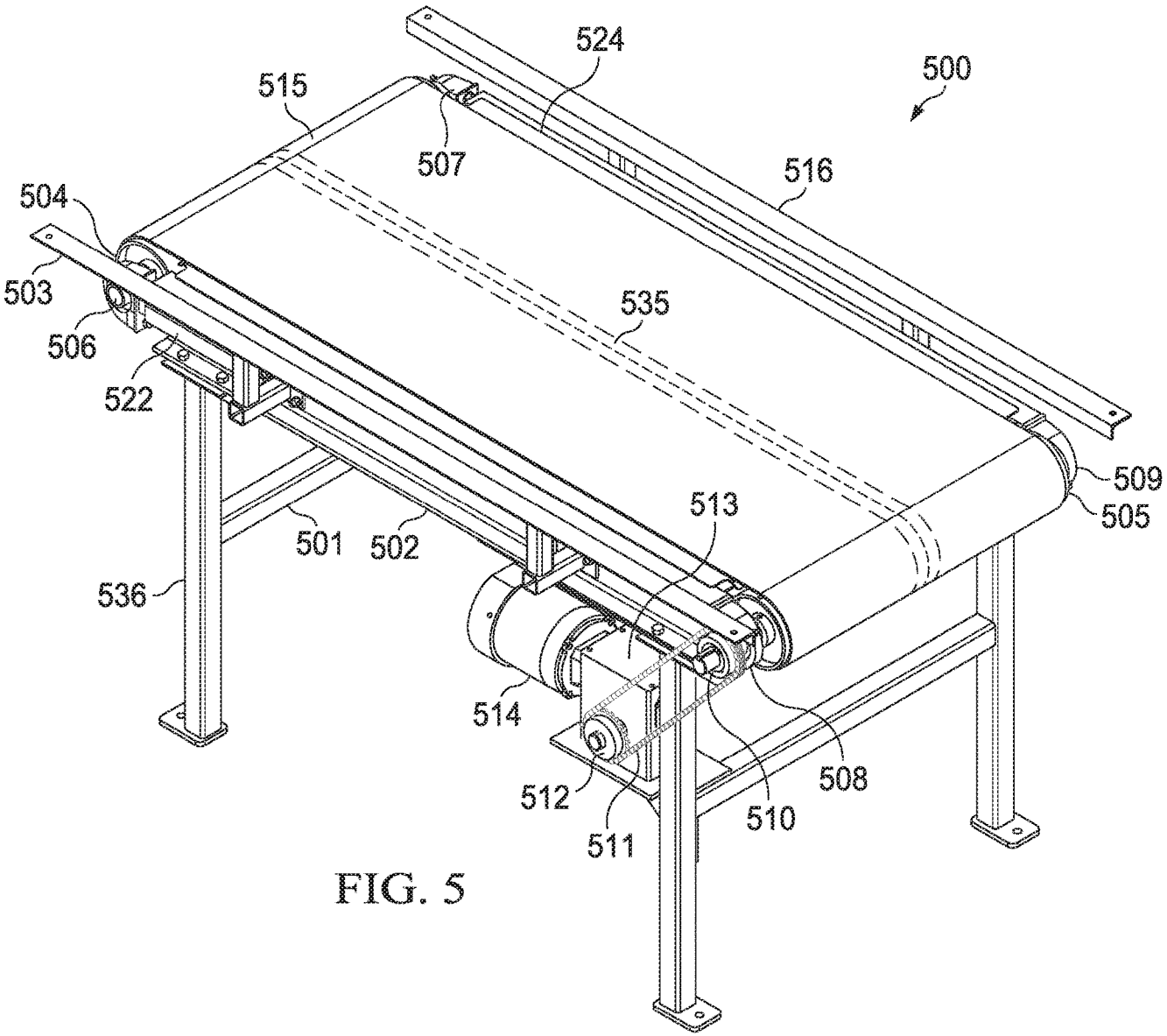
FIG. 5 is an isometric view of a vibration table of a preferred embodiment.

Referring to FIG. 5, vibration table 500 includes frame 501. Frame 501 includes set of legs 536. Table support 502 is connected to frame 501. Table support 502 has guides 503 and 516. Roller 504 is rotatably attached to bearings 506 and 507. Tensioner 522 is attached to bearing 506 and to table support 502. Tensioner 524 is attached to bearing 507 and to table support 502. Roller 505 is rotatably attached to table support 502 with bearings 508 and 509. Sprocket 510 is connected to roller 505 and engaged with chain 511. Chain 511 is engaged with sprocket 512. Sprocket 512 is connected to gearbox 513. Gearbox 513 is connected to motor 514. Belt 515 is frictionally engaged with rollers 504 and 505. Belt 515 has guide 535 integrally formed thereon that further engages with rollers 504 and 505.

In one embodiment, vibration table 500 is approximately six feet in length. Any length may be employed.

In a preferred embodiment, belt 515 is made of polyvinylchloride. Other suitable materials known in the art may be employed.

In a preferred embodiment, belt 515 has a surface speed of approximately 30 fps. Any speed may be employed.

In a preferred embodiment, each of rollers 504 and 505 is a hollow-tube steel roller. Other suitable rollers known in the art may be employed.

In a preferred embodiment, set of legs 536 is removable from table support 202 with a set of removable fasteners, such as a bolt and a nut. Other suitable means for removable and permanent attachment known in the art may be employed.

In a preferred embodiment, frame 501 and table support 502 are made of steel. Any suitable material known in the art may be employed.

In a preferred embodiment, each of bearings 506, 507, 508, and 509 is a pillow-block bearing. Other suitable bearings known in the art may be employed.

Figure 6:
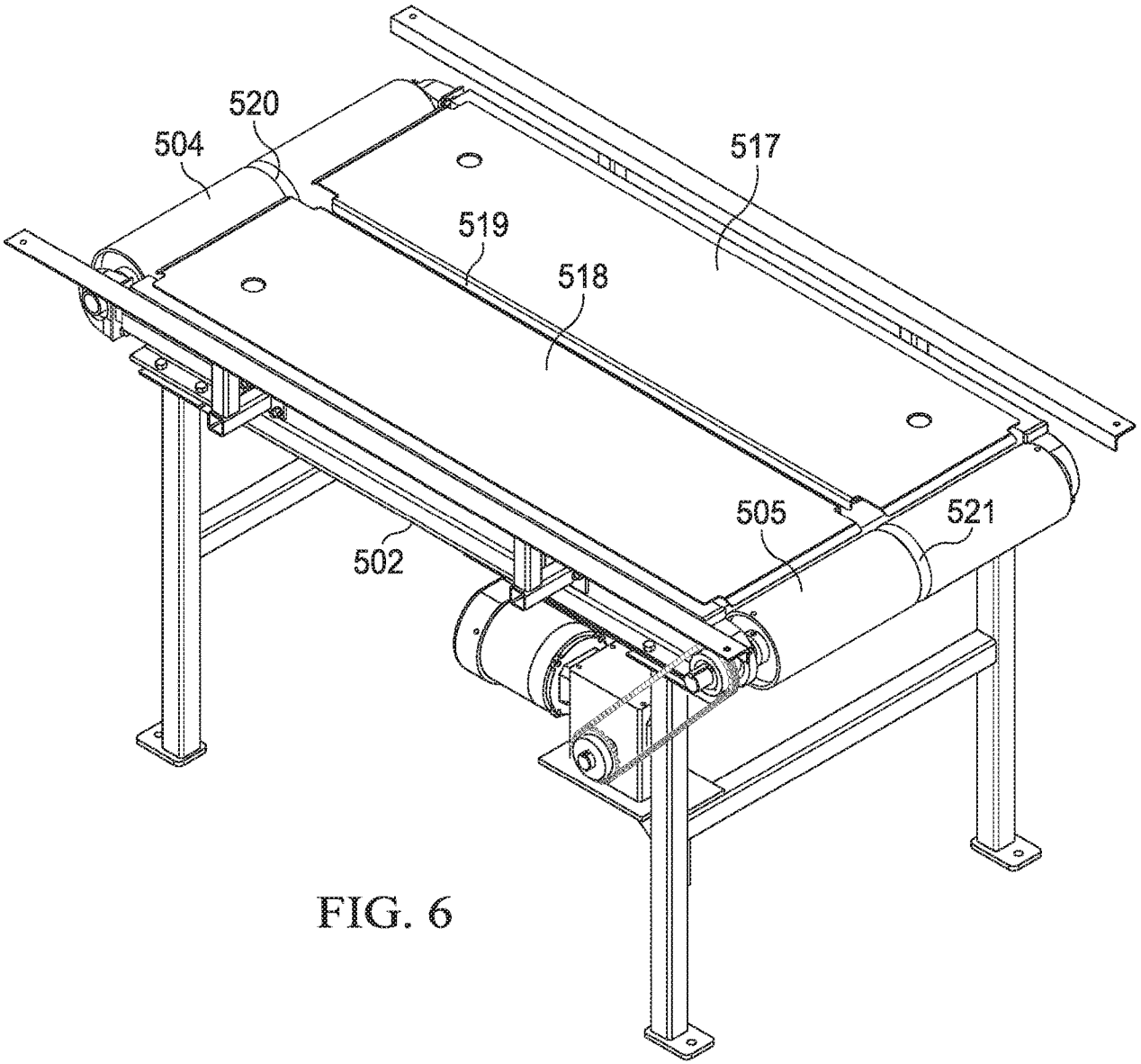
FIG. 6 is an isometric view of a vibration table with no belt of a preferred embodiment.

Referring to FIG. 6, each of table surfaces 517 and 518 is connected to table support 502 and positioned between rollers 504 and 505. Table surfaces 517 and 518 form guide slot 519 through which guide 535 of belt 515 moves and with which guide 535 is optionally slidably engaged. Roller 504 has slot 520 integrally formed therein and approximately centered on roller 504. Slot 520 is frictionally engaged with guide 535 of belt 515. Roller 505 has slot 521 integrally formed therein and approximately centered on roller 505. Slot 521 is frictionally engaged with guide 535 of belt 515.

Figure 7:
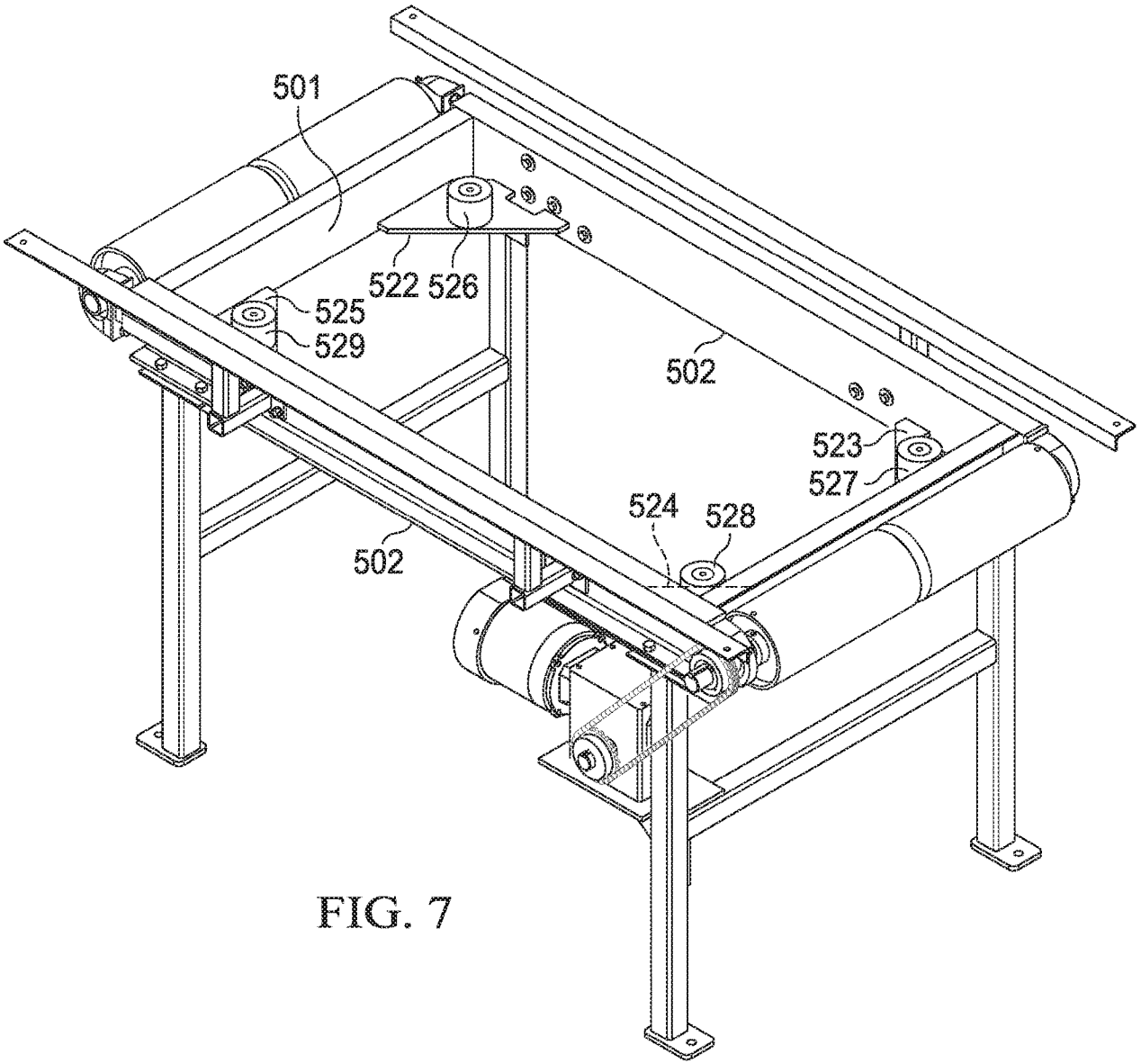
FIG. 7 is an isometric view of a frame of a vibration table of a preferred embodiment.

Referring to FIG. 7, each of supports 522, 523, 524, and 525 is attached to frame 501. Vibration isolator 526 is attached to support 522. Vibration isolator 527 is attached to support 523. Vibration isolator 528 is attached to support 524. Vibration isolator 529 is attached to support 525. Vibration isolators 526 and 527 support table surface 517. Vibration isolators 528 and 529 support table surface 518.

In a preferred embodiment, each of vibration isolators 526, 527, 528, and 529 is a rubber isolator. Any suitable material known in the art may be employed.

Figure 8A:
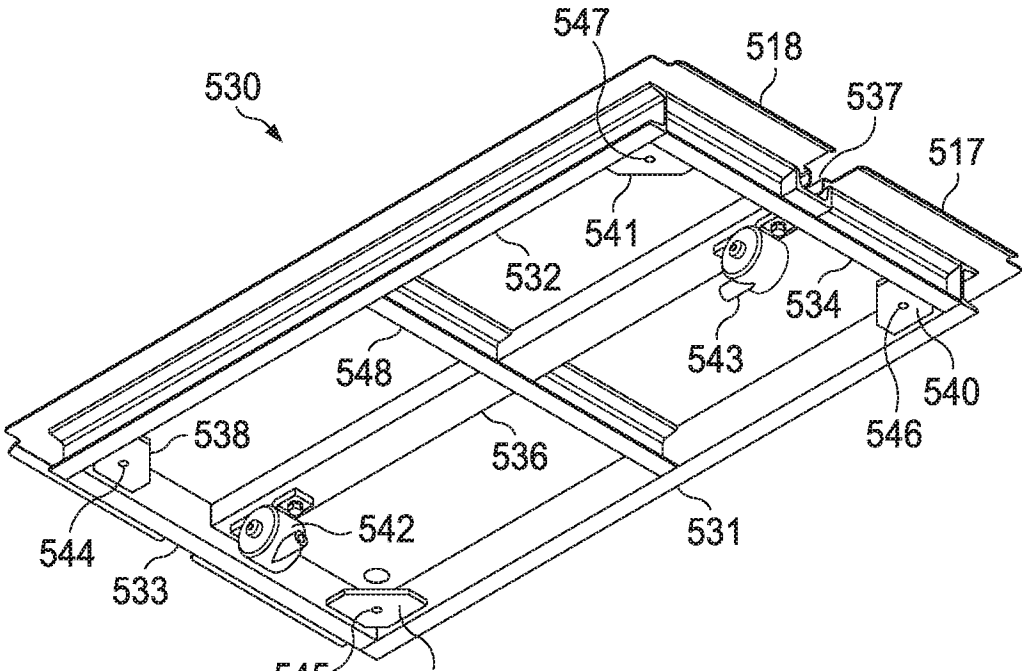
FIG. 8A is an isometric view of a sub frame of a vibration table of a preferred embodiment.

Referring to FIG. 8A, sub frame 530 includes beams 531 and 532, each of which is attached to cross-beams 534, 548, and 533. Beam 536 is attached to cross-beams 534, 548, and 533 and forms channel 537. Table surfaces 517 and 518 slidingly engage with channel 537. Isolator bracket 538 is attached to beams 532 and 533 and includes isolator mount 544. Isolator bracket 539 is attached to beams 533 and 531 and includes isolator mount 545. Isolator bracket 540 is attached to beams 531 and 534 and includes isolator mount 546. Isolator bracket 541 is attached to beams 534 and 532 and includes isolator mount 547. Vibrators 542 and 543 are attached to beam 536.

In a preferred embodiment, each of vibrators 533 and 534 is a pneumatic rotating ball type vibrator. Other vibrating mechanisms known in the art may be employed.

Figure 8B:
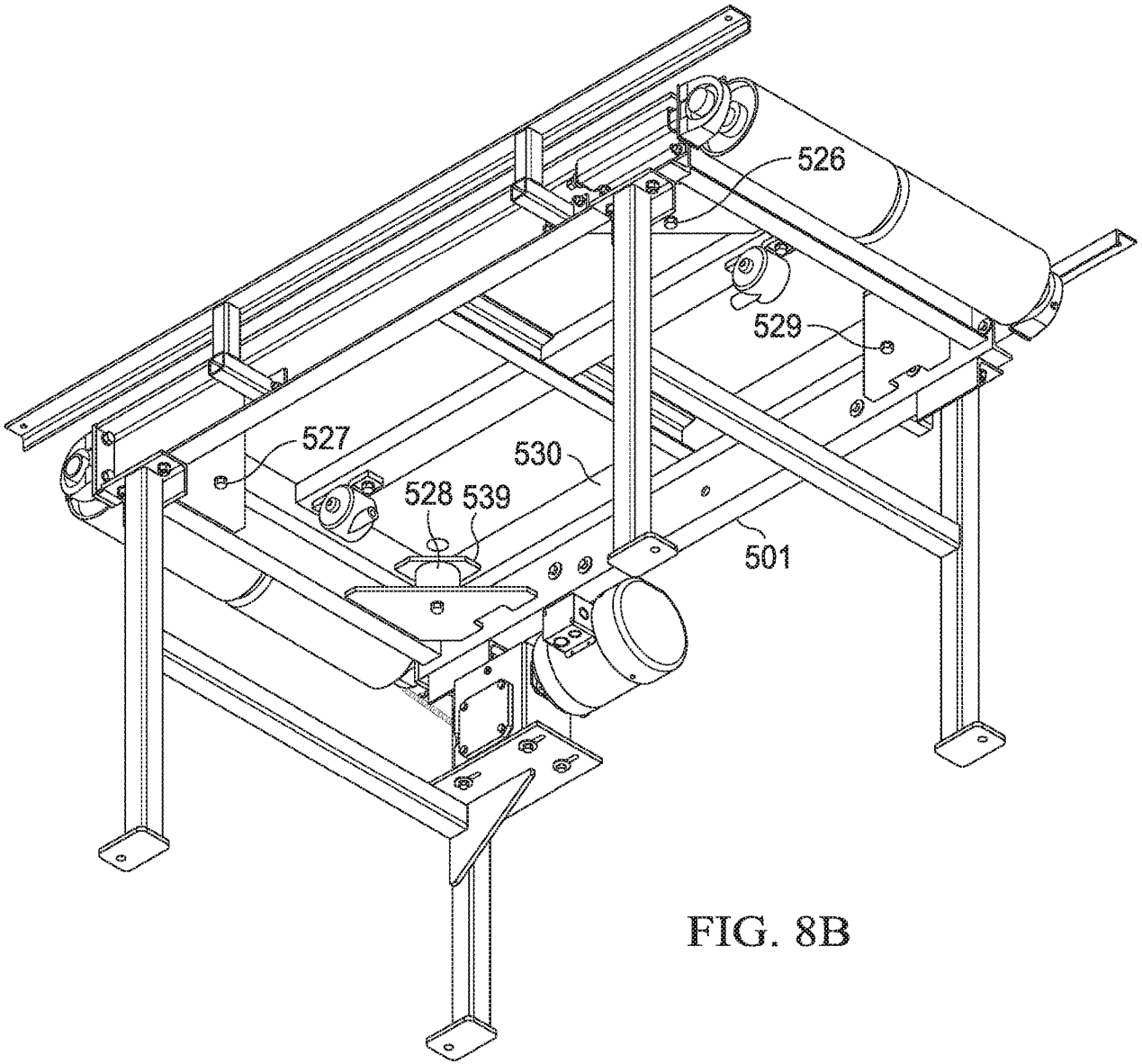
FIG. 8B is an isometric view of a vibration table of a preferred embodiment.

Referring to FIG. 8B, sub frame 531 is mounted to frame 501 by vibration isolators 526, 527, 528, and 529.

Figure 9:
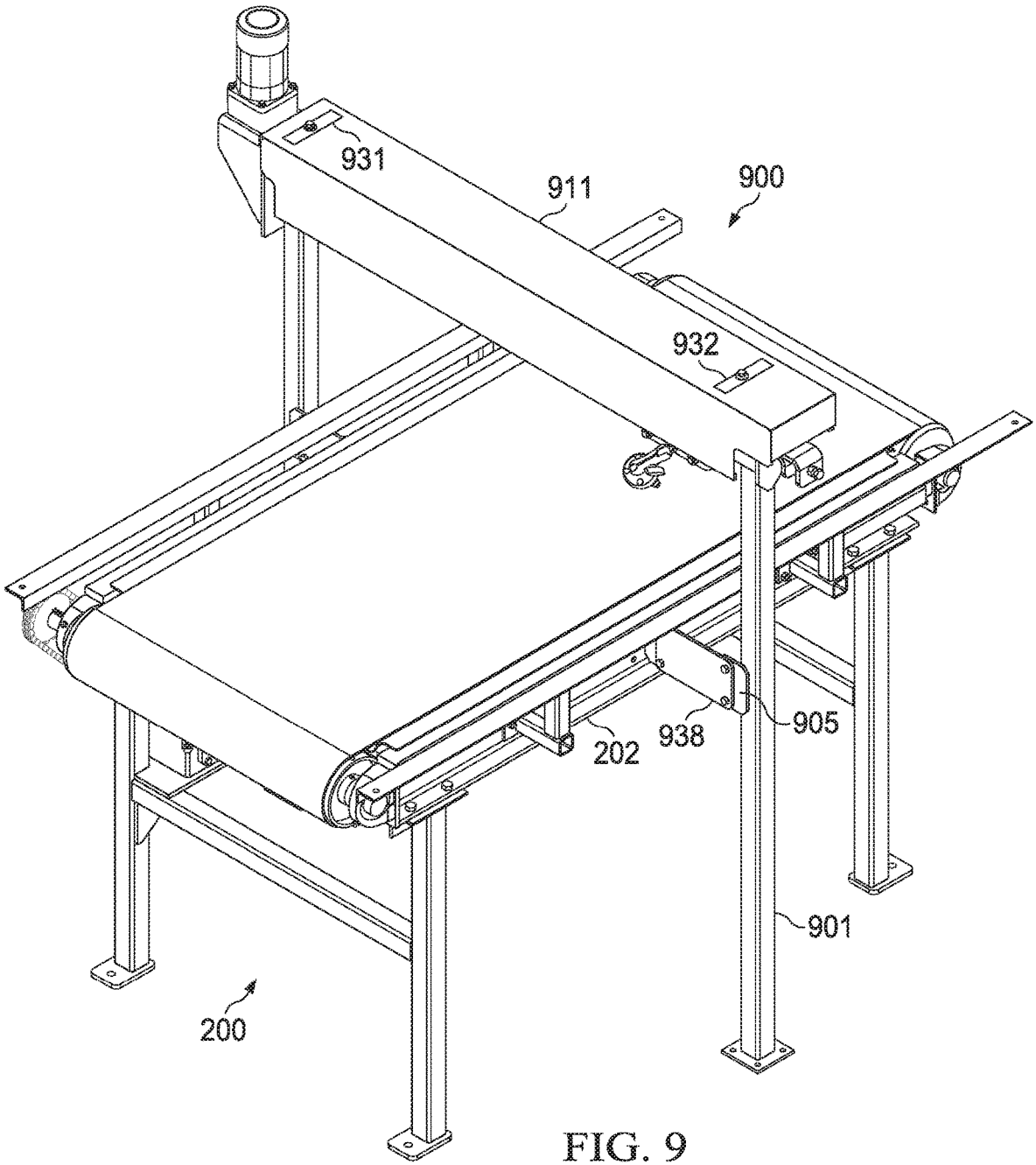
FIG. 9 is an isometric view of a spray station of a preferred embodiment.
Figure 10:
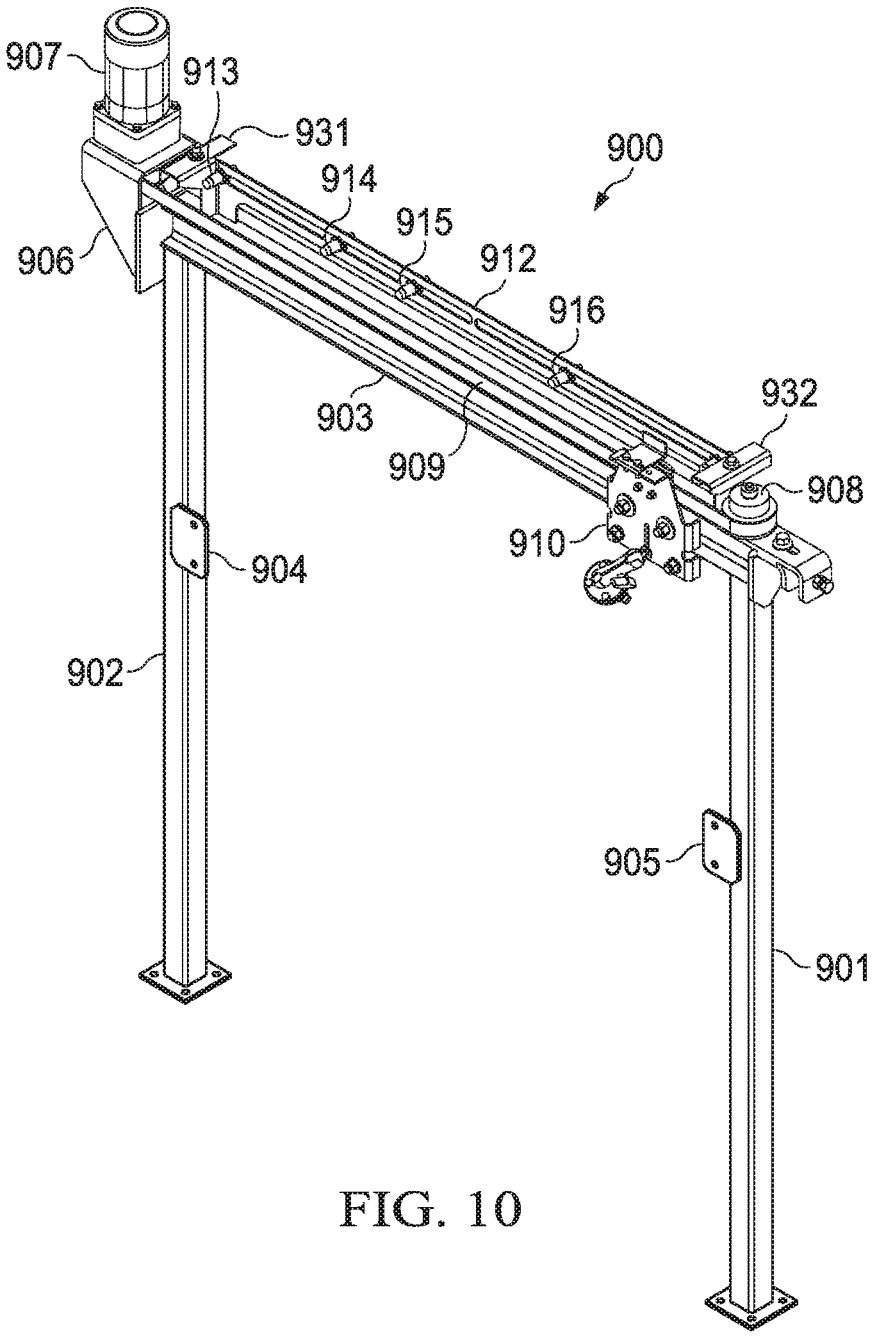
FIG. 10 is an isometric view of a trolley belt assembly of a preferred embodiment.

Referring to FIGS. 9 and 10, spray station 900 is attached to table support 202 of conveyor table 200. Spray station 900 includes legs 901 and 902 attached to member 903. Attachment plate 904 is attached to leg 902. Attachment plate 905 is attached to leg 901. By way of example, plate 938 is connected to attachment plate 905 and to table support 202. Motor support 906 is attached to leg 902 and member 903. Motor 907 is mounted to motor support 906. Pulley 908 is attached to member 903 opposite motor 907. Belt 909 is frictionally engaged with motor 907 and pulley 908. Trolley 910 is connected to belt 909 and slidably engaged with trolley guide 912 adjacent to belt 909. Sensors 913, 914, 915 and 916 are slidably and selectively frictionally engaged with sensor bracket 912 and are connected to a controller via a wired or wireless connection. Any of sensors 913, 914, 915 and 916 is adjustably positioned along sensor bracket 912 and engages trolley 910 to position trolley 910 along sensor bracket 912. Shroud supports 931 and 932 are attached to member 903. Shroud 911 is connected to shroud supports 931 and 932 and covers belt 909, pulley 908, sensor bracket 912, and a portion of trolley 910.

In a preferred embodiment, each of legs 901 and 902 is made of square tube steel. Other suitable materials known in the art may be employed.

In a preferred embodiment, member 903 is a steel I-beam. Other suitable materials may be employed.

In a preferred embodiment, motor 907 is an electric gear motor having a speed of approximately 40 RPM. Other suitable motors and speeds known in the art may be employed.

In a preferred embodiment, belt 909 is a urethane toothed timing belt. Other suitable belts and chains known in the art may be employed.

In a preferred embodiment, each of sensors 913, 914, 915 and 916 is a non-contact proximity sensor. In this embodiment, each of sensors 913, 914, 915 and 916 activated by a small flag/tab attached to trolley 910, as will be further described below. Positions are set based on mold cavity locations along the width of the mold. Other suitable sensors may be employed. Any number of sensors may be employed.

In a preferred embodiment, motor 907 is selectively powered to move belt 909 and trolley 910 along member 903 to selectively move and position trolley 910 along member 903.

Figure 11:
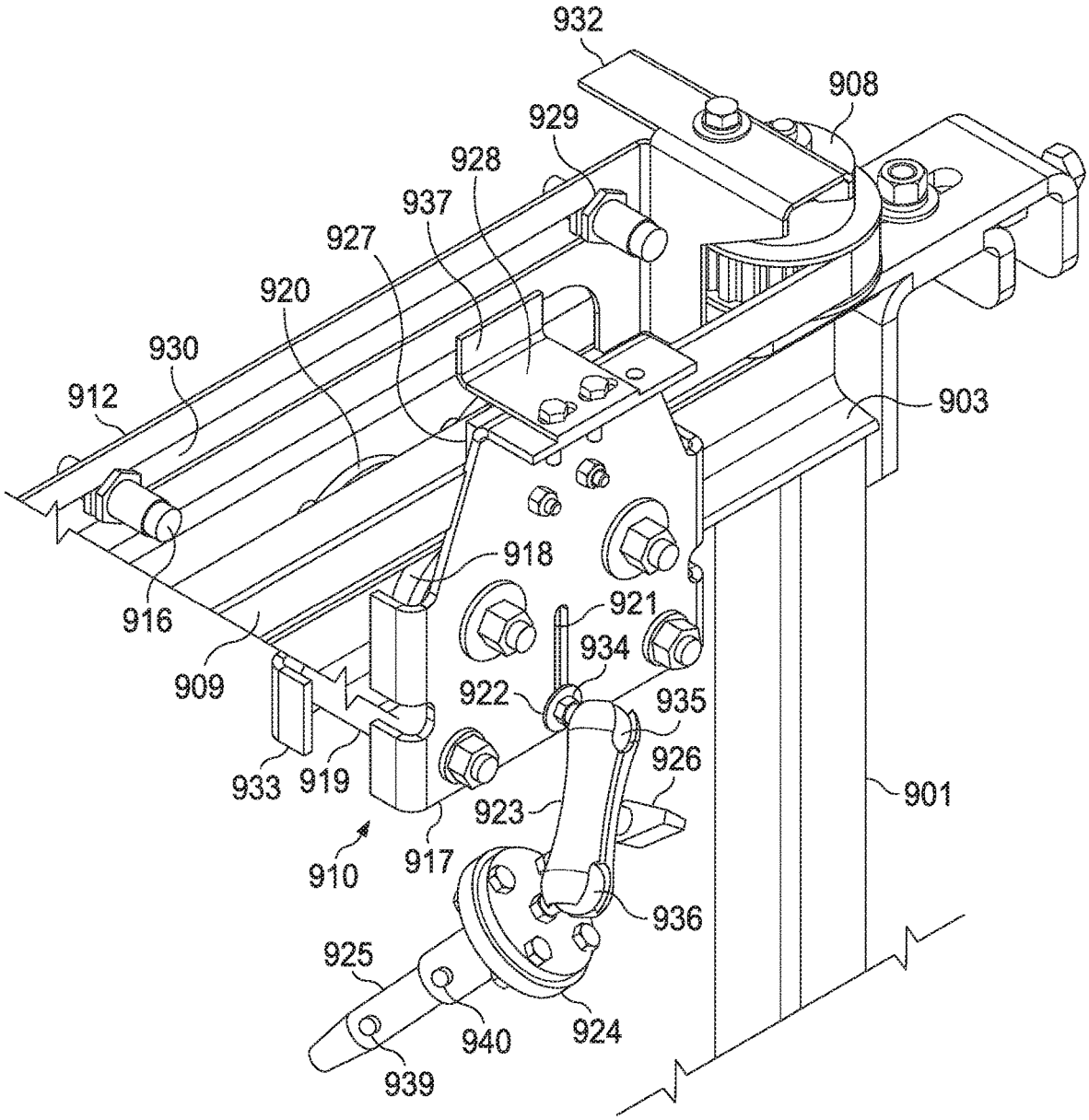
FIG. 11 is a detail isometric view of a spray assembly of a preferred embodiment.

Referring to FIG. 11, trolley 910 includes plate 917. Set of wheels 918 is rotatably connected to plate 917 and engaged with member 903. Connector 919 is connected to plate 917. Plate 933 is connected to connector 919 opposite plate 917. Set of wheels 920 is connected to plate 933 and engaged with member 903 opposite set of wheels 918. Plate 917 includes slot 921 integrally formed therein. Fastener 922 is frictionally engaged with slot 921. Spray post 934 is attached to fastener 922. Spray arm 923 is adjustably connected to spray post 934 with ball joint 935. Nozzle base 924 is adjustably connected to spray arm 923 with ball joint 936. Spray nozzle 925 is connected to nozzle base 924. Thumb fastener 926 is connected to spray arm 923. Spray nozzle 925 includes product inlet 939 and air inlet 940 for connected of a sprayable product supply and air supply, respectively.

Plate 917 further includes clamp 927 connected to belt 909. Guide plate 928 is fastened to plate 917. Guide plate includes tab 937. By way of example, sensor 929 is adjacent to tab 937 and slidably and adjustably engages with slot 930 integrally formed in sensor bracket 912. In use, tab 937 is positioned adjacent to sensors 916 and 929 to activate sensors 916 and 929, respectively.

In a preferred embodiment, each of sets of wheels 918 and 920 is a set of flange wheels with ball bearings from a ¼-Ton overhead crane trolley. Other suitable wheels known in the art may be employed.

In a preferred embodiment, spray nozzle 925 is a pneumatically siphoning nozzle. In this embodiment, pressurized air is forced through an outer chamber which passes over an orifice tied to a line containing the liquid product. As the air moves past the orifice, a low pressure region is created that draws the liquid out and creates a droplet spray. Rates are controlled by orifice size and air pressure setting. Other suitable sprayers and spray nozzles known in the art may be employed.

In one embodiment, a release product is employed to enable material to be released from a mold. Any type of release product known in the art may be employed. In another embodiment, a color dye is employed. Any type of suitable color dye known in the art may be employed. Any type of suitable spray medium may be employed.

Figure 12A:
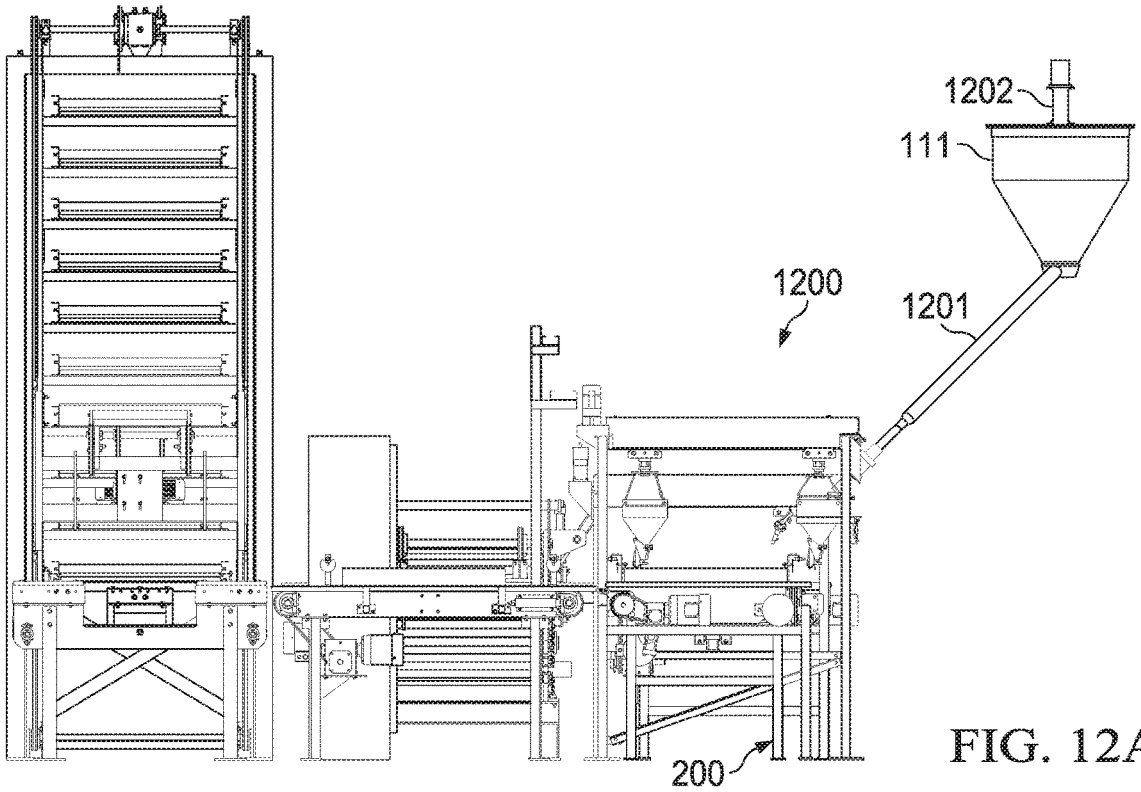
FIG. 12A is an end view of a hopper and fill station of a conveyor rack and elevator system of a preferred embodiment.
Figure 12B:
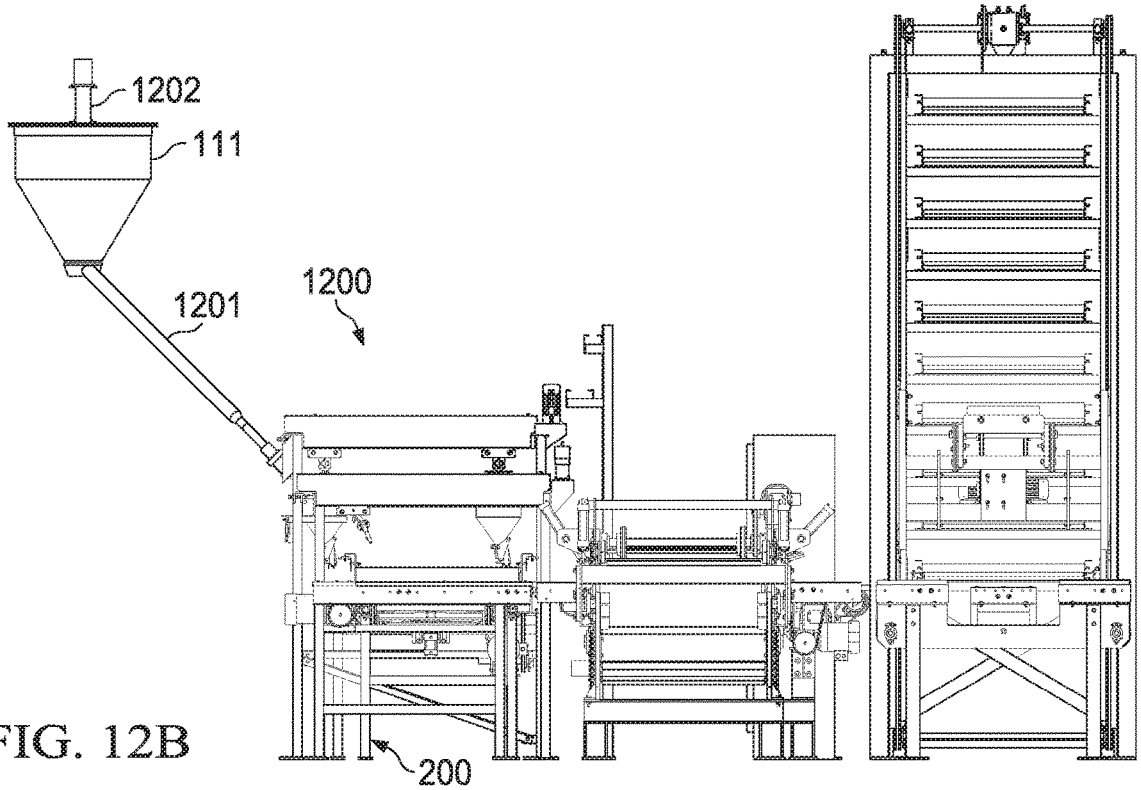
FIG. 12B is an end view of a hopper and fill station of a conveyor rack and elevator system of a preferred embodiment.

Referring to FIGS. 12A and 12B, fill station 1200 is connected to conveyor table 200. Hopper 111 is connected to fill station 1200 with set of supply lines 1201. Hopper 111 has inlet 1202. In a preferred embodiment, hopper 111 contains a cementitious material. In one embodiment, hopper 111 is connected to a storage hopper or mixer with inlet 1202, which can supply the cementitious material.

Figure 13:
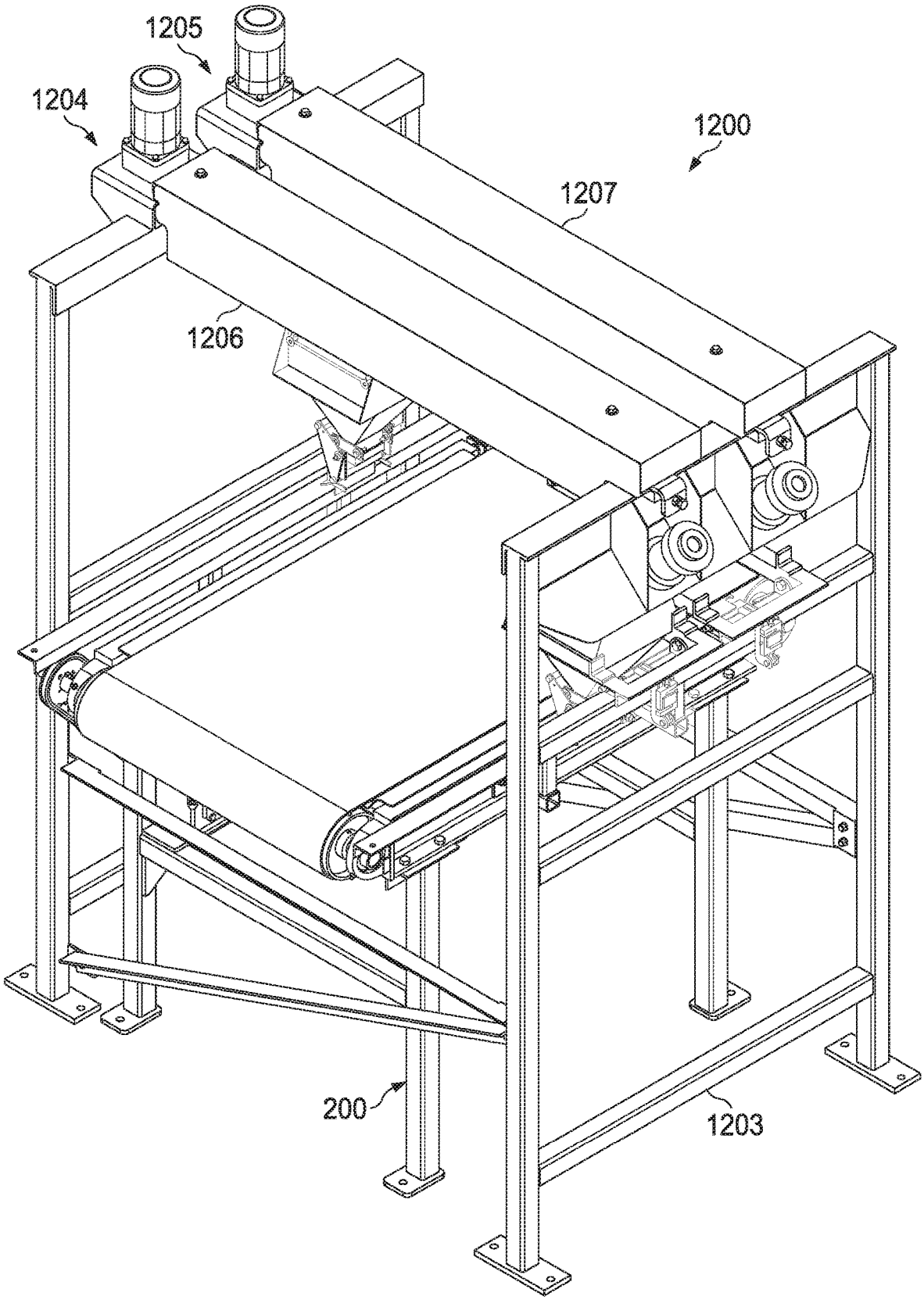
FIG. 13 is an isometric view of a fill station of a preferred embodiment.
Figure 14:
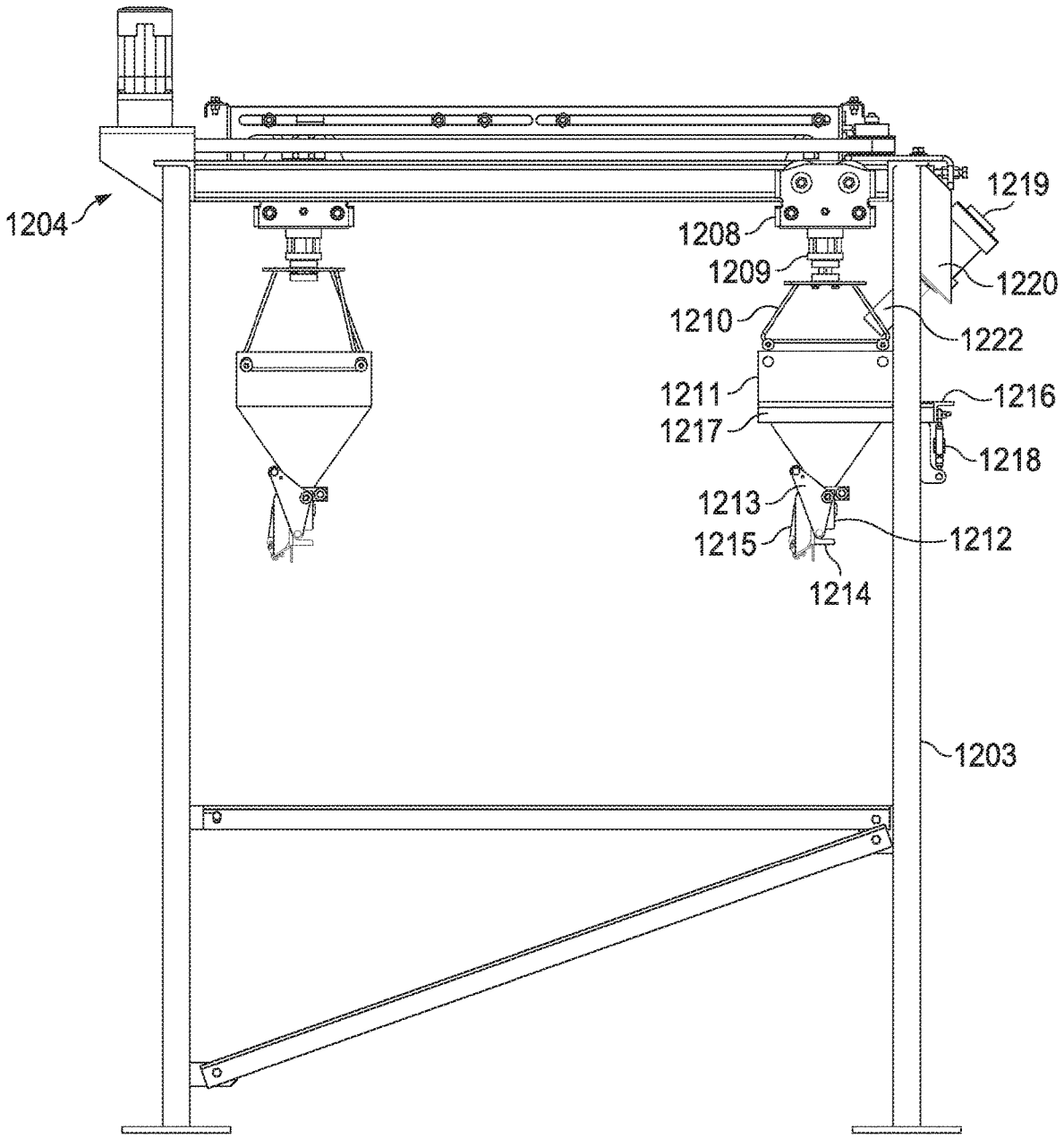
FIG. 14 is a side view of a fill station and a set of hopper trolleys of a preferred embodiment.
Figure 15:
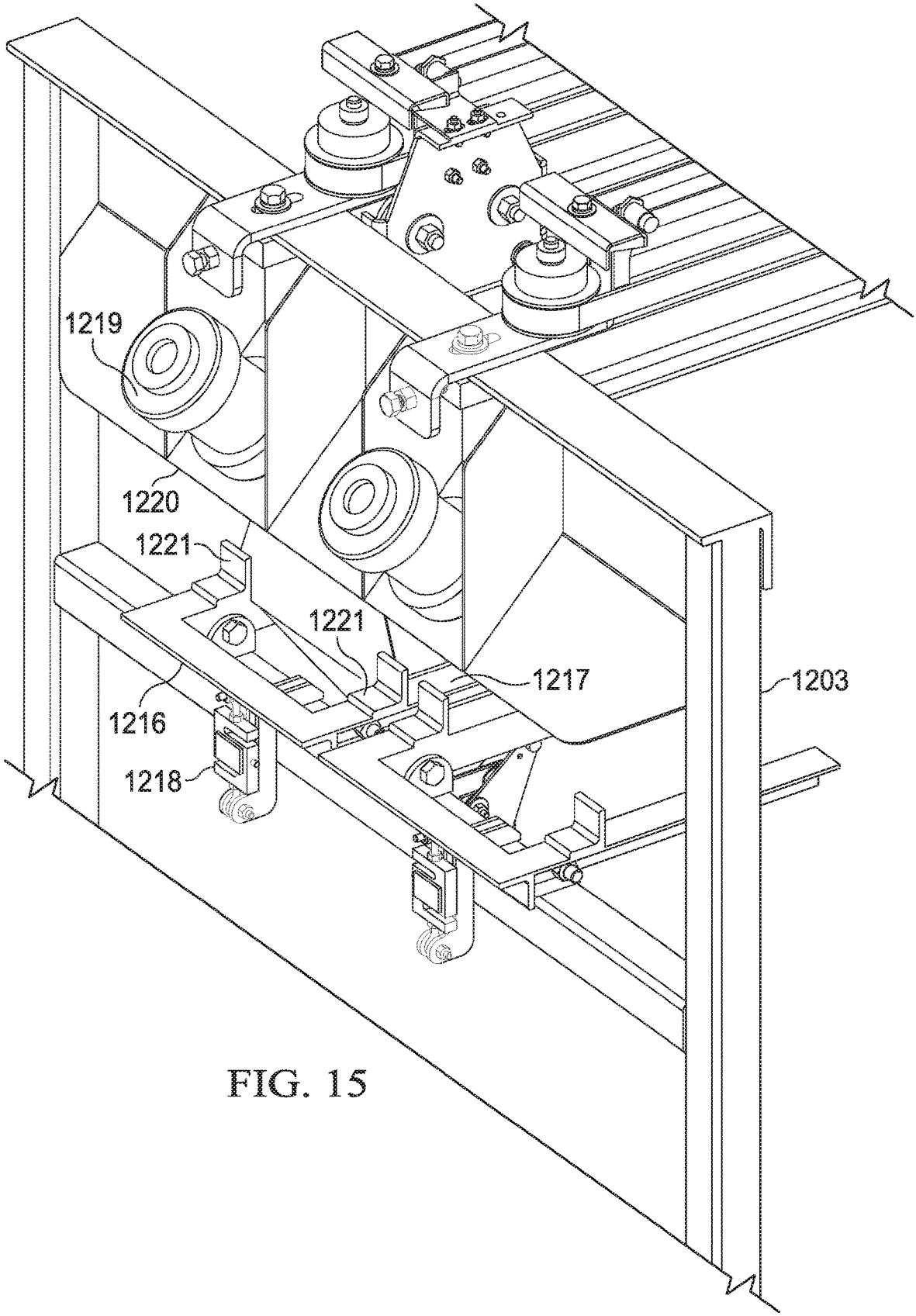
FIG. 15 is a detail isometric view of a hopper trolley assembly of a preferred embodiment.

Referring to FIGS. 13, 14, and 15, fill station 1200 is positioned adjacent to conveyor table 200. Fill station 1200 includes frame 1203 and trolley assemblies 1204 and 1205 attached to frame 1203. Trolley assemblies 1204 and 1205 have shrouds 1206 and 1207, respectively. Each of trolley assemblies 1204 and 1205 is the same as that described in FIGS. 9, 10, and 11, except that trolley assemblies 1204 and 1205 do not include a sprayer. For example, all features with respect to the motor, belt drive system, trolley, and positioning sensors are the same. With respect to each other, trolley assemblies 1204 and 1205 are the same and will be described only with respect to trolley assembly 1204. Trolley 1208 is the same as trolley 910. In one embodiment, where more than one fill station is employed, trolley assemblies 1204 and 1205 are spaced apart at differing widths to fill different portions of the mold.

Pneumatic cylinder 1209 is attached to trolley 1208. Bracket 1210 is connected to pneumatic cylinder 1209. Hopper 1211 is connected to bracket 1210. Hopper 1211 includes outlet 1212. Linkage 1213 is connected to outlet 1212. Air cylinder 1215 is connected to linkage 1213 and to hopper 1211. Valve arm 1214 is connected to linkage 1213. Weigh frame 1216 is attached to frame 1203. Weigh frame 1216 has a general "U-shape" and includes set of weigh arms 1217 connected to load cell 1218. Load cell 1218 is connected to frame 1203 and to controller via a wired or a wireless connection. Set of weigh arms includes set of stops 1221. Set of weigh arms 1217 support hopper 1211 when hopper 1211 is filled or not in use at a filling or "home" position. Supply line support 1220 is attached to frame 1203. Fill valve 1219 is attached to supply line support 1220 and to supply line 1222.

In a preferred embodiment, pneumatic cylinder 1209 is a pneumatic non-rotating cylinder with a one inch stroke. Other suitable lifting and lowering mechanisms known in the art may be employed.

In a preferred embodiment, air cylinder 1215 is a restricted flow dual-direction air cylinder. Any suitable air cylinder or actuator known in the art may be employed.

In a preferred embodiment, fill valve 1219 is a 1.5 inch pneumatic pinch valve. Any suitable valve known in the art may be employed.

In use, molds are filled at fill station 1200. Molds remain stationary on conveyor table 200 while trolley 1208 travels between the filling or "home" position and a set of predetermined positions above the empty cavities of the molds. Pneumatic cylinder 1209 retracts and extends to raise and lower, respectively, hopper 1211 onto weigh frame 1216. Lowering hopper 1211 onto weigh frame 1216 enables load cell 1218 to weigh hopper 1211 and not trolley 1208, bracket 1210, or pneumatic cylinder 1209. Load cell 1218 is "zeroed" when hopper 1211 is empty. Hopper 1211 is controllably filled with the cementitious material with fill valve 1219. The amount of cementitious material controlled by the weight of hopper 1211 and the cementitious material sensed by load cell 1218. Each cavity of the mold is associated with a predetermined weight of cementitious material. When the weight of the hopper 1211 and the cementitious material is approximately equal to the predetermined weight, then fill valve 1219 closes supply line 1222. Hopper 1211 is now filled with the correct amount of cementitious material.

Pneumatic cylinder 1209 retracts and raises hopper 1211 from weigh frame 1216. Trolley 1208 is indexed to the predetermined position by the motor and belt assembly to position hopper 1211 above the empty mold cavity. Pneumatic cylinder 1209 extends and lowers hopper 1211. Air cylinder 1215 opens valve arm 1214 to release the cementitious material. In one embodiment, the flow rate of the cementitious material can be restricted by an inline orifice or a flow control valve as known in the art. Other flow control mechanisms known in the art may be employed. After a predetermined period of time, air cylinder 1215 closes valve arm 1214. Pneumatic cylinder 1209 retracts and raises hopper 1211. The motor and belt assembly moves hopper 1211 back to a position above weigh frame 1216. Pneumatic cylinder 1209 extends to lower hopper 1211 onto weigh frame 1216 to support hopper 1211 in the filling or "home" position. After each fill, valve arm 1214 is opened, and hopper 1211 rinsed out with water. Valve arm 1214 is closed, load cell 1218 is again "zeroed", and the cementitious material for the next mold cavity is controllably metered into hopper 1211.

Figure 16:
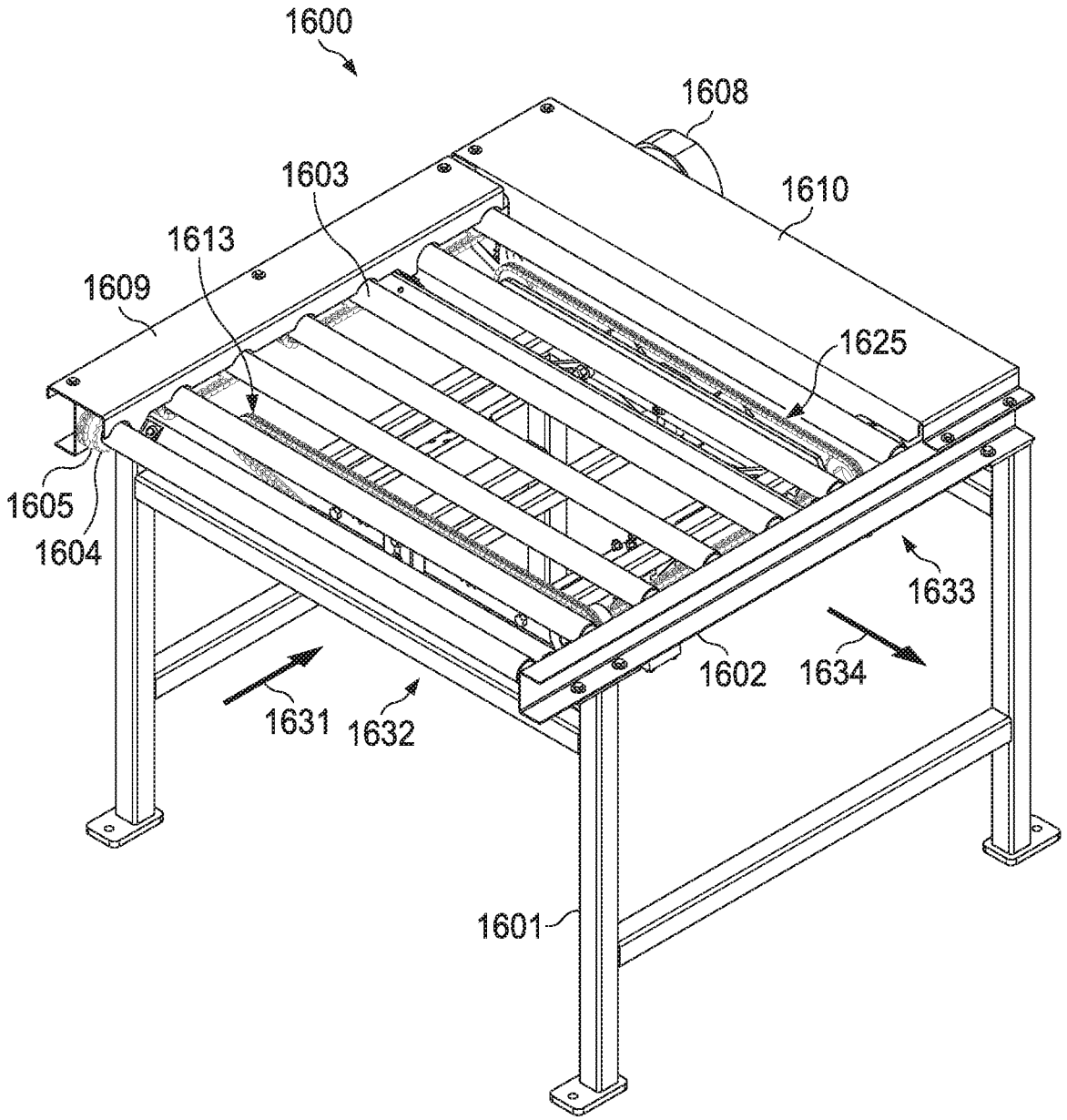
FIG. 16 is an isometric view of a right angle transition table of a preferred embodiment.
Figure 17:
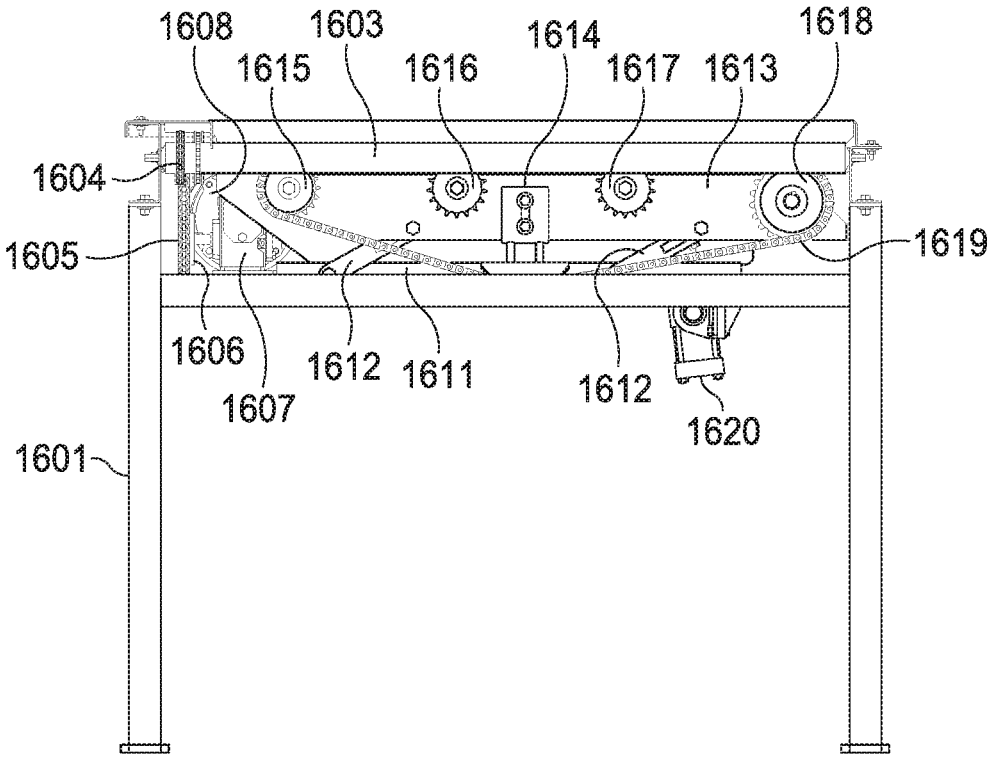
FIG. 17 is a side view of a right angle transition table of a preferred embodiment.
Figure 18:
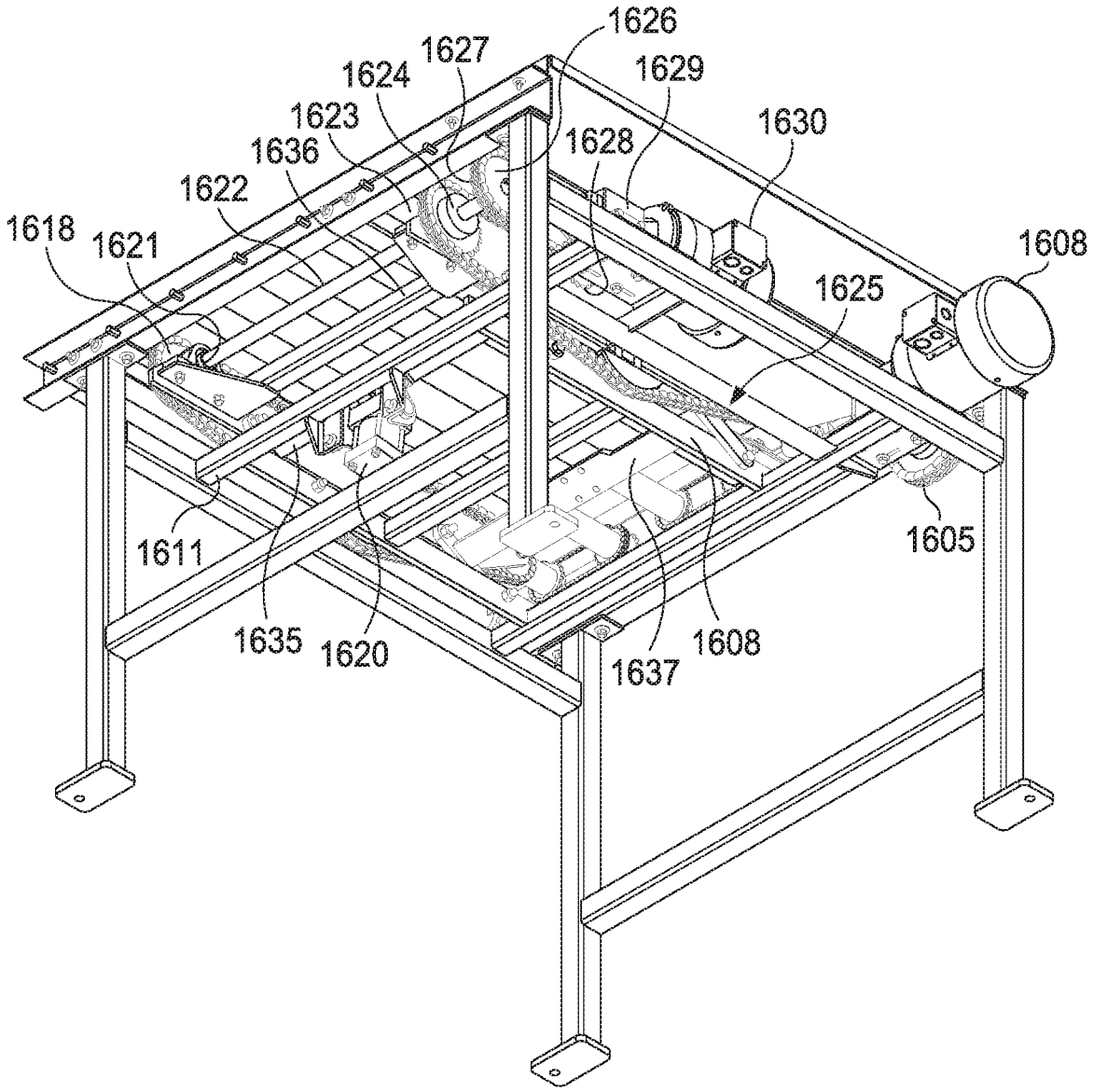
FIG. 18 is an isometric view of a right angle transition table of a preferred embodiment.

Referring to FIGS. 16, 17, and 18, RAT table 1600 includes frame 1601 and table support 1602 attached to frame 1601. Set of rollers 1603 is rotatably attached to table support 1602. Sprocket 1604 is connected to set of rollers 1603. Chain 1605 is engaged with sprockets 1604 and 1606. Sprocket 1606 is connected to gearbox 1607. Motor 1608 is connected to gearbox 1607. Cover stop 1609 is adjacent to chain 1605 and is positioned generally perpendicular to set of rollers 1603. Cover stop 1610 is positioned generally perpendicular with respect to cover stop 1609 and generally parallel to set of rollers 1603. Sub-frame 1611 is attached to frame 1601. Set of hinge supports 1612 is rotatably connected to sub-frame 1611 and to chain assembly 1613. Chain guide 1614 is connected to chain assembly 1613. Chain assembly 1613 includes sprockets 1615, 1616, 1617, and 1618, and chain 1619 engaged with sprockets 1615, 1616, 1617, and 1618. Pneumatic cylinder 1620 is connected to sub-frame 1611 and brace 1635. Brace 1635 is attached to chain assembly 1613 and to chain assembly 1625. Chain assembly 1625 is the same as chain assembly 1613 and positioned generally parallel to chain assembly 1613. Sprocket 1618 of chain assembly is attached to axle 1622. Axle 1622 is rotatably connected to bearings 1621 and 1623. Bearing 1621 is attached to chain assembly 1613. Bearing 1623 is attached to chain assembly 1625. Each of chain assemblies 1613 and 1625 is attached to cross-tubes 1636 and 1637 to form a raiseable weldment. Sprocket 1624 of chain assembly 1625 is attached to axle 1622. Axle 1622 is further attached to reduction gear 1626. Reduction gear 1626 is engaged with chain 1627. Chain 1627 is engaged with sprocket 1628 of gearbox 1629. Gearbox 1629 is connected to motor 1630. Gearbox 1629 and motor 1630 are mounted on sub-frame 1611.

In a preferred embodiment, each of frame 1601, sub-frame 1611, and cover stops 1609 and 1610 is made of steel. Other suitable materials known in the art may be employed.

In a preferred embodiment, each roller in set of rollers 1603 is a 1.9 inch live roller.

In a preferred embodiment, gearbox 1607 and motor 1608 together are a right angle gearmotor. Other suitable motors, gears, and drivetrains known in the art may be employed.

In a preferred embodiment, gearbox 1629 and motor 1630 together are a right angle gearmotor. Other suitable motors, gears, and drivetrains known in the art may be employed.

In use, a mold and a slaveboard enters RAT table 1600 on side 1632 generally along direction 1631. When the mold and slaveboard is completely on the table and rests against cover stop 1610, set of rollers 1603 stop and pneumatic cylinder 1620 raises sub-frame 1611 to slightly elevate the mold off set of rollers 1603. Chain assemblies 1613 and 1625 engage the slaveboard of the mold. When chain assemblies 1613 and 1625 are powered, the mold exits side 1633 and is transferred onto the next conveyor belt component generally along direction 1634.

Figure 19:
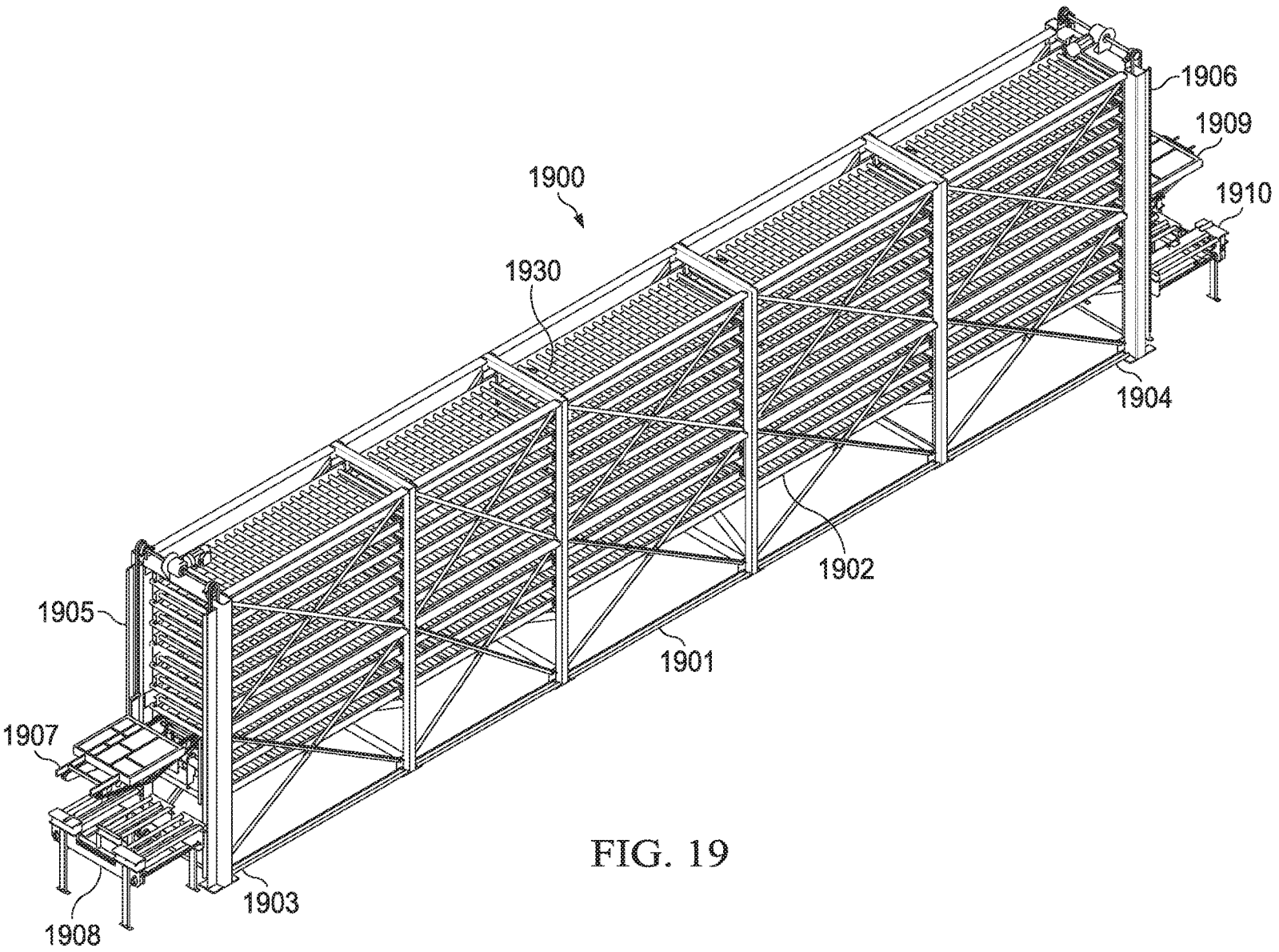
FIG. 19 is an isometric view of a drying rack of a preferred embodiment.

Referring to FIG. 19, drying rack 1900 includes frame 1901 and set of racks 1902 attached to frame 1901. Each rack of set of racks 1902 is spaced a predetermined distance with respect to each other. Each rack of set of racks 1902 includes set of rollers 1930. Drying rack 1900 further includes entry elevator 1905 at end 1903 and exit elevator 1906 at end 1904, opposite end 1903. Entry elevator table 1908 is connected to drying rack 1900 adjacent to entry elevator 1905. Set of entry elevator tines 1907 is movably connected to entry elevator 1905. Elevator exit table 1910 is connected to drying rack 1900 adjacent to exit elevator 1906. Set of exit elevator tines 1909 is movably connected to exit elevator 1906.

In a preferred embodiment, drying rack 1900 has length of approximately fifty-five (55) feet. Other lengths may be employed.

In a preferred embodiment, frame 1901 is made of steel. Other suitable materials known in the art may be employed.

In a preferred embodiment, the predetermined distance between each rack of set of racks 1902 is approximately 18 inches. Other distances may be employed.

In a preferred embodiment, each roller of set of rollers 1930 is a 1.9 inch gravity roller. Other suitable rollers known in the art may be employed.

In use, entry elevator table 1908 receives the mold from a belt conveyor after being turned from the vibration table through a RAT table. Set of entry elevator tines 1907 is located beneath the table deck of entry elevator table 1908. Entry elevator 1905 is powered and set of entry elevator tines 1907 lift the mold to the desired row in set of racks 1902 based on how full each row is and the dwell period of the molds on each row, as will be further described below. When the set of entry elevator tines 1907 reaches the desired row in set of racks 1902, the mold is pushed onto set of rollers 1930 by set of entry elevator tines 1907, as will be further described below. A row of drying rack 1900 is from time to time full of molds, at which time the new mold being placed onto the row will push the oldest mold out the opposite end. Exit elevator tines 1909 of exit elevator 1906 receives the dried mold. Exit elevator 1906 lowers exit elevator tines 1909 onto exit elevator table 1910, which transports to the dry mold onto a demolder. Entry elevator table 1908 is the same as exit elevator table 1910.

Figure 20:
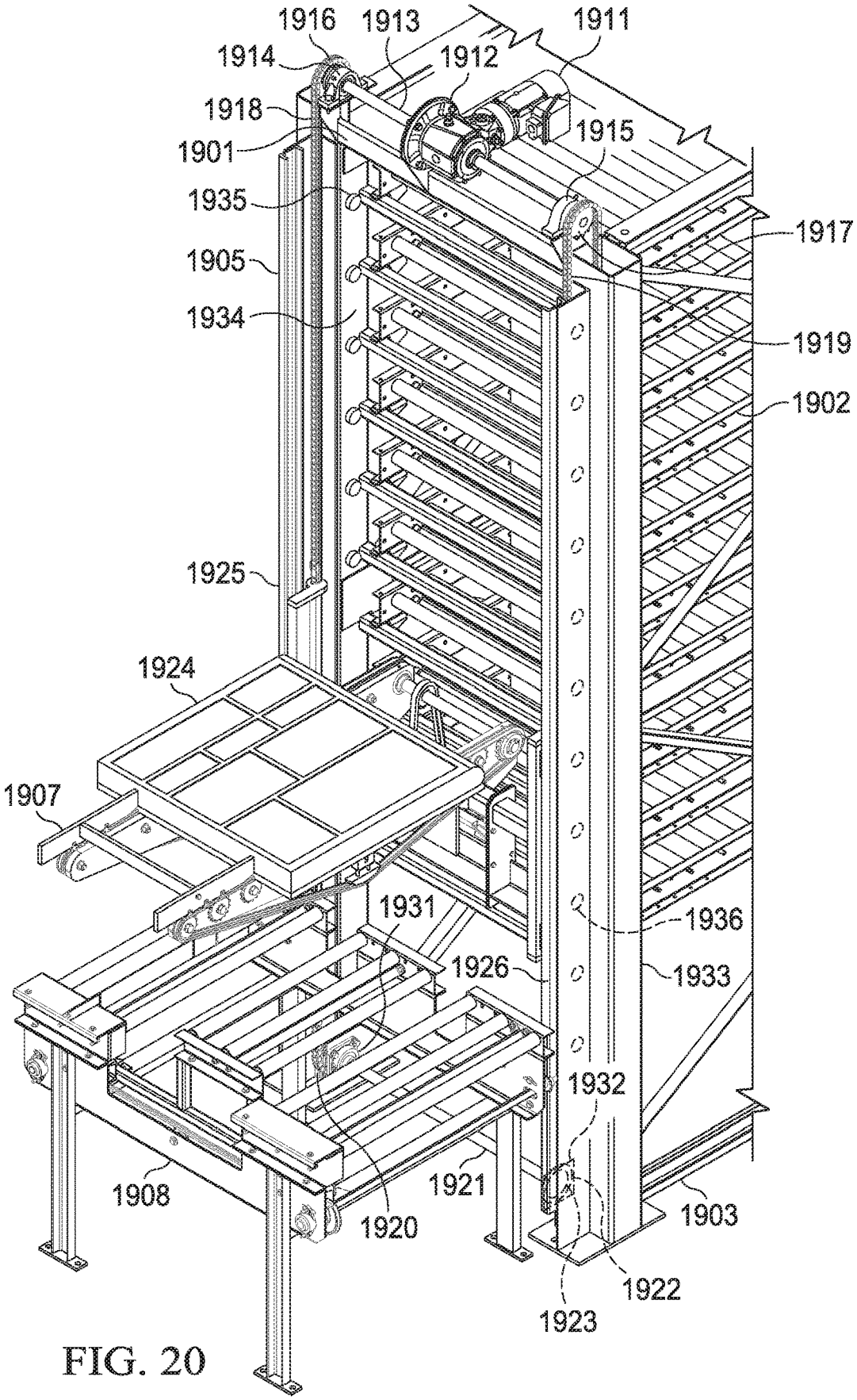
FIG. 20 is an isometric view of an entry elevator of a preferred embodiment.

Referring to FIG. 20, entry elevator 1905 includes motor 1911 and gearbox 1912 mounted to frame 1901. Axle 1913 is rotatably connected to gearbox 1912. Each of bearings 1914 and 1915 is rotatably connected to axle 1913 and mounted to frame 1901. Sprocket 1916 is attached to axle 1913. Sprocket 1917 is attached to axle 1913. Chain 1918 is engaged with sprocket 1916 and sprocket 1920. Sprocket 1920 is attached to axle 1921. Bearing 1931 is rotatably connected to axle 1921 and mounted to frame 1901. Chain 1919 is engaged with sprocket 1917 and sprocket 1922. Sprocket 1922 is attached to axle 1921. Bearing 1932 is rotatably connected to axle 1921 and mounted to frame 1901. Guide 1925 is attached to column 1934 of frame 1901 and adjacent to a portion of chain 1918. Guide 1926 is attached to column 1933 of frame 1901 and adjacent to a portion of chain 1919. A portion of chain 1919 is positioned in column 1933 of frame 1901. A counterweight assembly is attached to the portion of chain 1919 in column 1933. A portion of chain 1918 is positioned in column 1934 of frame 1901. A counterweight assembly is attached to the portion of chain 1918 in column 1934. Set of sensors 1935 is connected to column 1934 and connected to a controller via a wired or a wireless connection, each sensor is positioned adjacent to each row of set of racks 1902. Set of sensors 1936 is connected to column 1933 and connected to a controller via a wired or a wireless connection, each sensor is positioned adjacent to each row of set of racks 1902. Set of entry elevator tines 1907 is connected to each of chains 1918 and 1919 and has a set of rollers engaged with each of guides 1925 and 1926, as will be further described below. Set of entry elevator tines 1907 supports and lifts mold 1924 from entry elevator table 1908.

In a preferred embodiment, motor 1911 is an electric gearmotor. In this embodiment, gearbox 1912 is a hollow-shaft reducer. Other suitable drive systems known in the art may be employed.

In a preferred embodiment, each sensor of sets of sensors 1935 and 1936 is an AK Series M18 DC Inductive Proximity Sensor available from AutomationDirect.com.

Figure 21A:
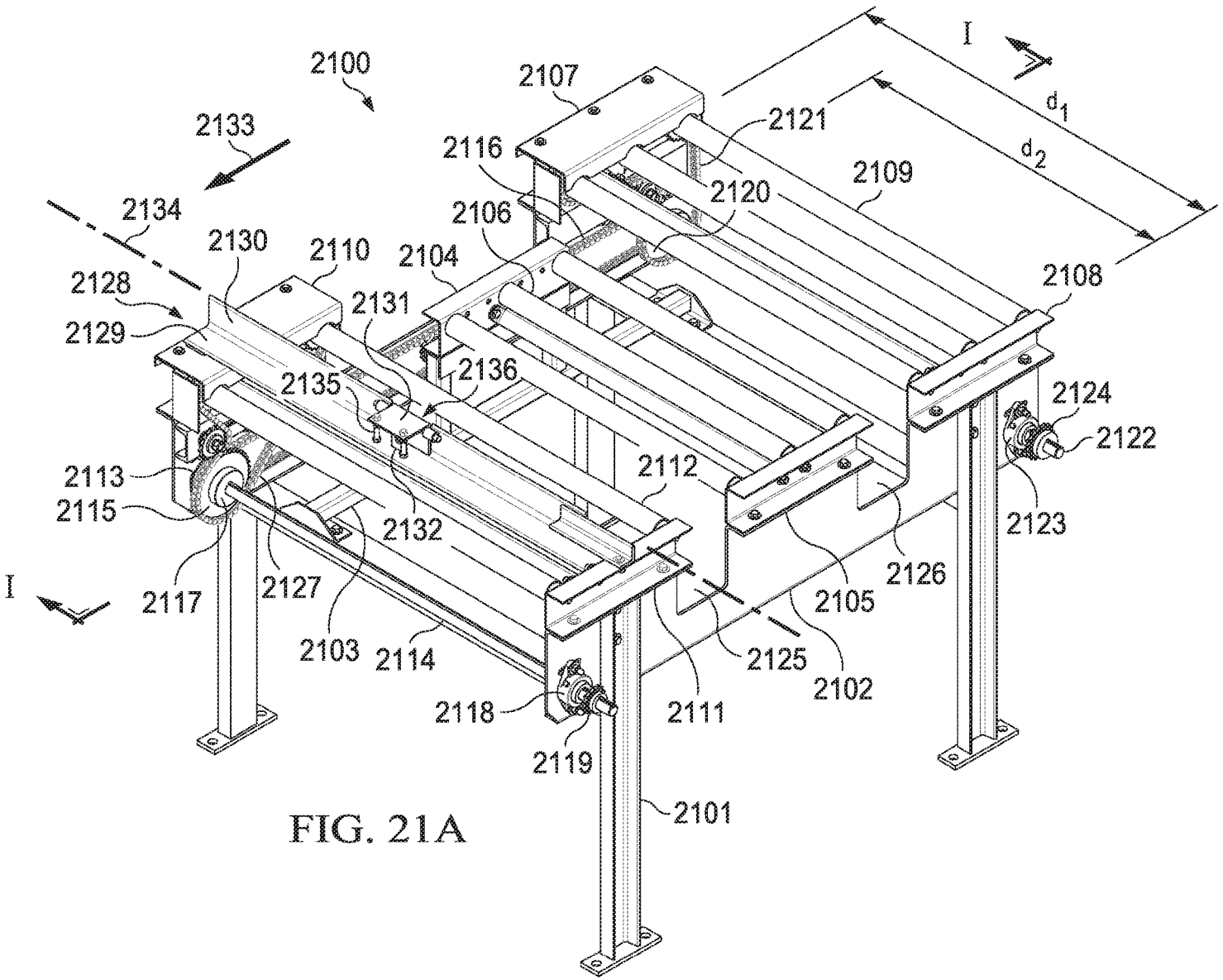
FIG. 21A is an isometric view of an elevator table of a preferred embodiment.

Referring to FIG. 21A, each of entry elevator table 1908 and exit elevator table 1910 will be further described as elevator table 2100. Elevator table 2100 includes frame 2101 and table support 2102 connected to frame 2101. Sub-frame 2103 is attached to frame 2101. Center roller support 2104 is attached to sub-frame 2103. Center roller support 2105 is attached to table support 2102. Set of center rollers 2106 is rotatably connected to center roller supports 2104 and 2105. Side roller supports 2107, 2108, 2110, and 2111 are attached to table support 2102. Set of side rollers 2109 is rotatably connected to side roller supports 2107 and 2108. Set of side rollers 2112 is rotatably connected to side roller supports 2110 and 2111. Bearings 2113 is mounted to table support 2102. Axle 2114 is rotatably connected to bearings 2113. Sprocket 2115 is connected to axle 2114.

Chain 2116 is engaged with sprocket 2115. Sprocket 2117 is connected to axle 2114 adjacent to sprocket 2115. Bearings 2118 is mounted to table support 2102 and rotatably connected to axle 2114. Sprocket 2119 is connected to axle 2114 adjacent to bearings 2118. Chain 2127 is engaged with sprocket 2117 and set of side rollers 2112. Chain 2116 is engaged with sprocket 2120. Sprocket 2120 is further engaged with chain 2121 which is engaged with set of side rollers 2109. Axle 2122 is connected to sprocket 2120. Bearings 2123 is rotatably connected to axle 2122 and mounted to table support 2102. Sprocket 2124 is connected to axle 2122 adjacent to bearings 2123.

Position sensor assembly 2128 is connected to side roller support 2110. It will be appreciated by those skilled in the art that position sensor assembly 2128 may be positioned at any location on elevator table 2100. Position sensor assembly 2118 includes base 2129 connected to side roller support 2110 and sensor stop 2130 attached and base 2129. Sensor window 2136 is integrally formed in sensor stop 2130. Sensor 2132 is connected to base 2129 and to a controller via a wired or wireless connection and positioned adjacent to sensor window 2136. Sensor flap 2131 is rotatably attached to sensor stop 2130 to rotate about axis 2134, which extends through an edge of sensor stop 2130 opposite base 2129. Counter weight 2135 is optionally attached to sensor flap 2131.

Set of side rollers 2112 and set of center rollers 2106 are separated by gap 2125. Set of side rollers 2109 and set of center rollers 2106 are separated by gap 2126. Each of gaps 2125 and 2126 has sufficient dimensions to accommodate a set of entry elevator tines and a set of exit elevator tines. Each of set of side rollers 2109 and 2112 has length $d_1$. Set of center rollers 2106 has length $d_2$.

In a preferred embodiment, base 2129 and sensor stop 2120 are made of angle iron. Other suitable materials may be employed.

In a preferred embodiment, $d_2$ is less than $d_1$. In other embodiments, $d_1$ is approximately equal to $d_2$. In other embodiments, $d_1$ is greater than $d_2$.

In a preferred embodiment, elevator table 2100 is a roller chain-driven live roller table.

In a preferred embodiment, each roller in sets of side rollers 2109 and 2112 is a 1.9 inch dual-sprocketed roller. Other suitable rollers known in the art may be employed.

In a preferred embodiment, each roller of set of center rollers 2106 is a 1.9 inch gravity roller. Other suitable rollers known in the art may be employed.

In use, a mold and a slaveboard move across elevator table generally in direction 2133 and engage sensor flap 2131, causing sensor flap 2131 to rotate about axis 2134 to activate sensor 2132.

Figure 21B:
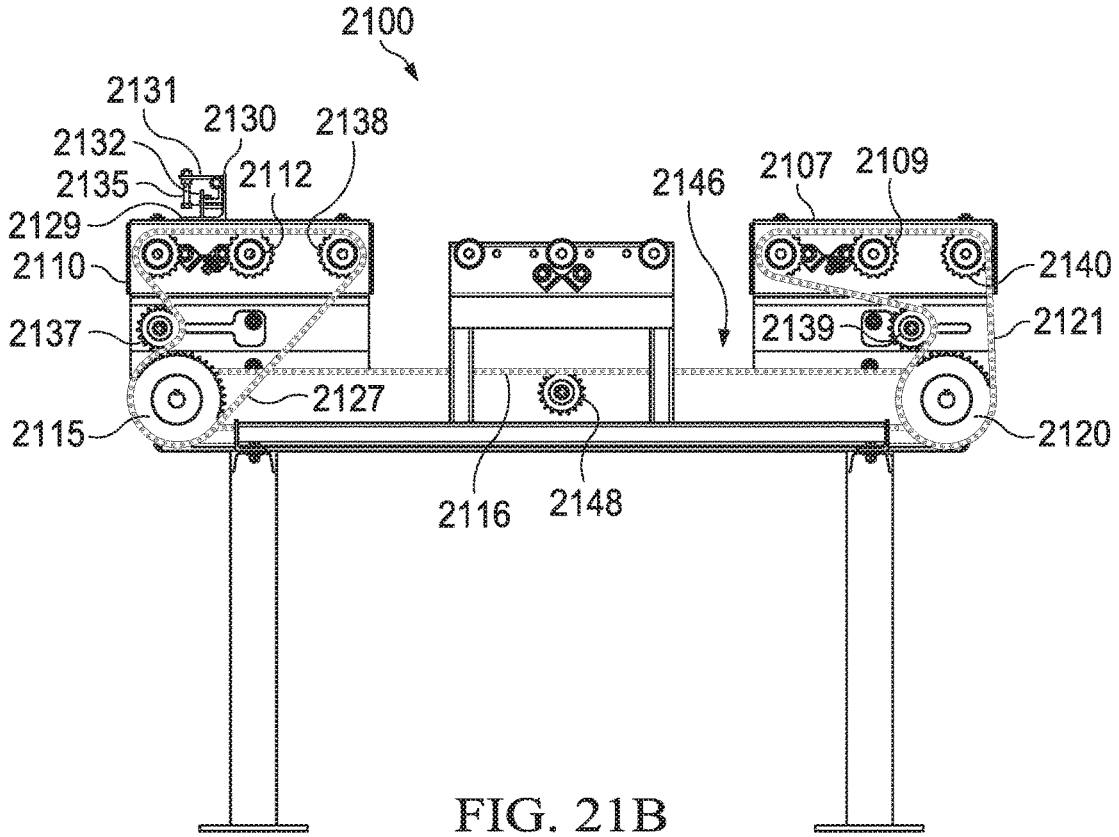
FIG. 21B is a partial section view of a drive chain arrangement of an entry elevator table.

Referring to FIG. 21B, in one embodiment, elevator table 2100 has entry chain arrangement 2146. In this embodiment, set of side roller sprockets 2138 and tension sprocket 2137 are rotatably attached to side roller support 2110. Set of side roller sprockets 2140 and tension sprocket 2139 are rotatably attached to side roller support 2107.

Chain 2127 is engaged with set of side roller sprockets 2138, tension sprocket 2137, and sprocket 2115. Chain 2116 is engaged with sprockets 2115 and 2120 and support sprocket 2148. Support sprocket 2148 is rotatably attached to table support 2102. Chain 2121 is engaged with sprocket 2120, tension sprocket 2139, and set of side roller sprockets 2140.

In a preferred embodiment, each of sprockets 2115 and 2120 has a diameter of 6.055 inches. Other suitable dimensions may be employed.

Figure 21C:
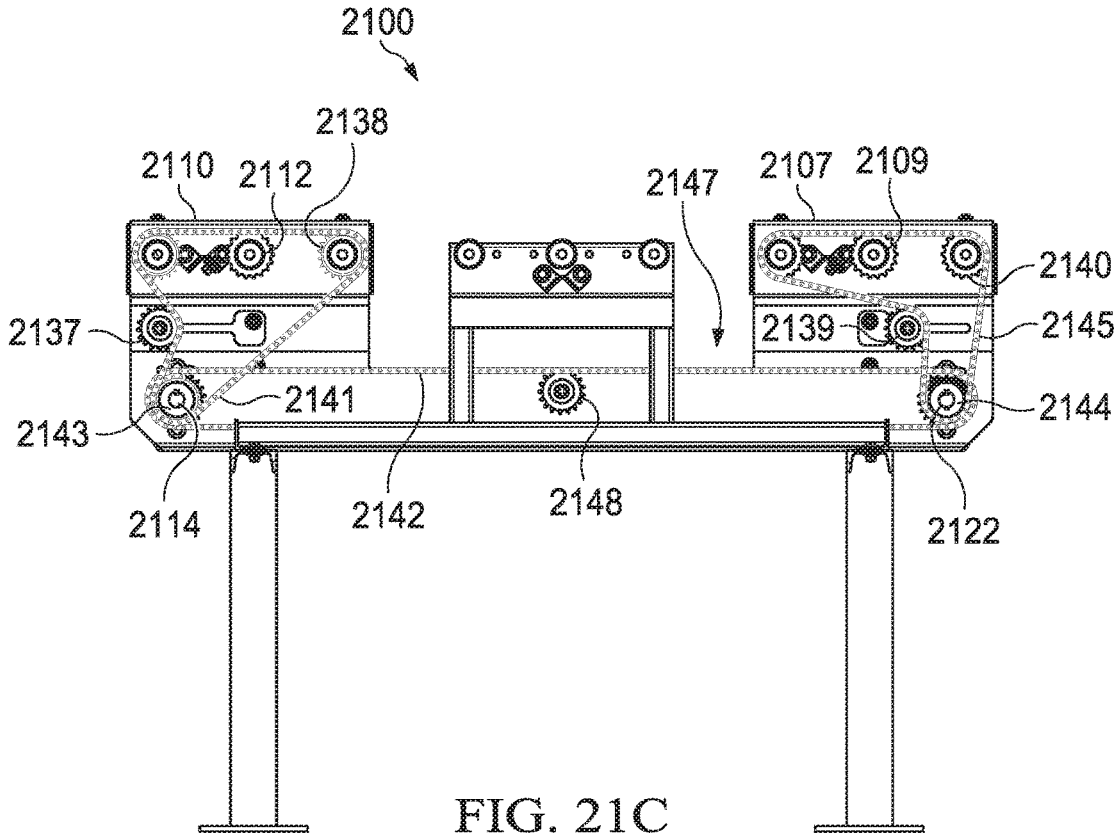
FIG. 21C is a partial section view of a drive chain arrangement of an exit elevator table.

Referring to FIG. 21C, in another embodiment, elevator table 2100 has exit chain arrangement 2147. In this embodiment, set of side roller sprockets 2138, tension sprocket 2137, and sprocket 2143 are rotatably attached to side roller support 2110. Set of side roller sprockets 2140, tension sprocket 2139, and sprocket 2144 are rotatably attached to side roller support 2107.

Chain 2141 is engaged with set of side roller sprockets 2138, tension sprocket 2137, and sprocket 2143. Chain 2142 is engaged with sprockets 2143 and 2144 and support sprocket 2148. Chain 2145 is engaged with sprocket 2144, tension sprocket 2139, and set of side roller sprockets 2140.

In a preferred embodiment, each of sprockets 2143 and 2144 has a diameter of 2.879 inches. Other suitable dimensions may be employed.

Figure 22A:
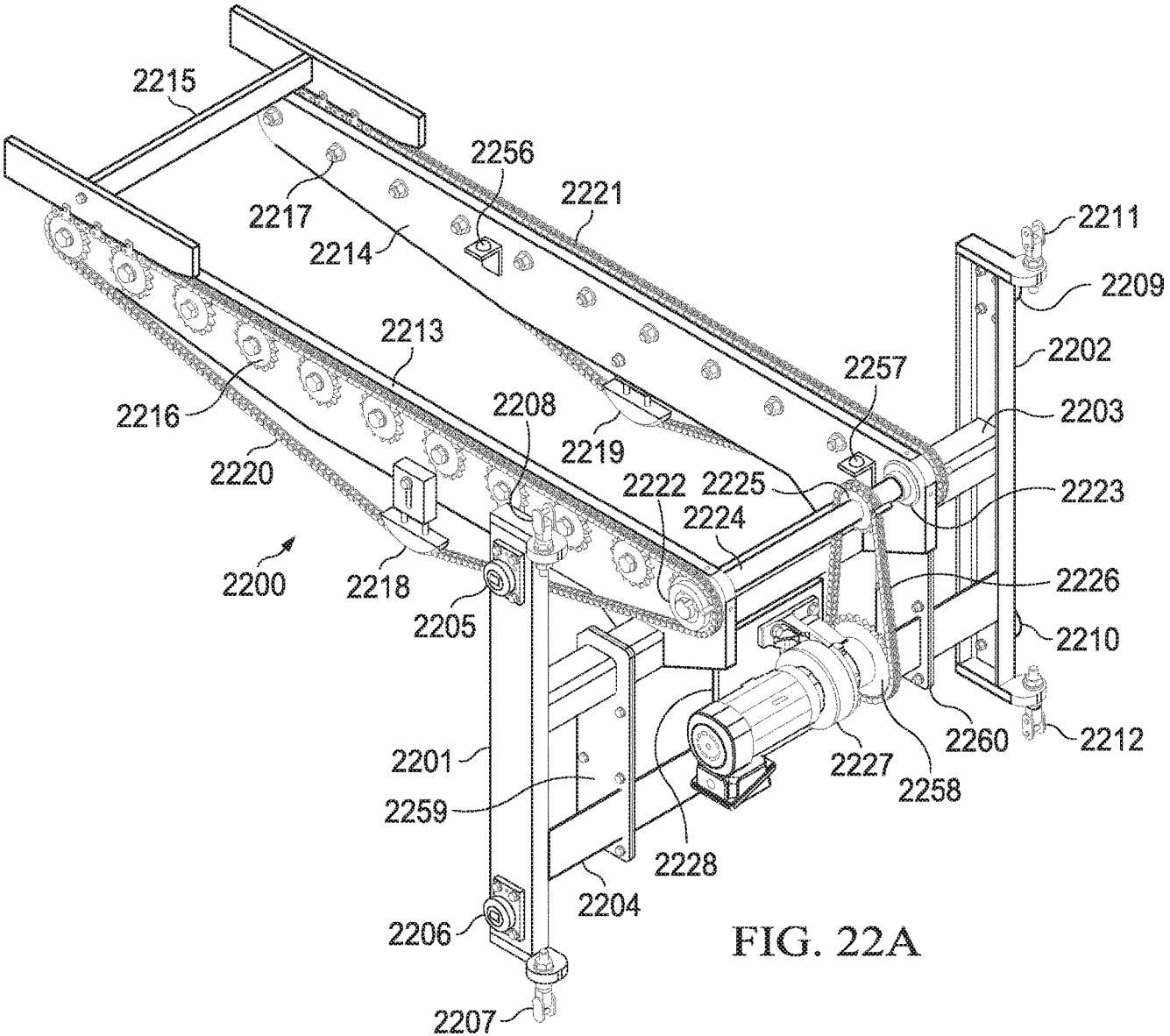
FIG. 22A is an isometric view of a set of entry elevator tines of a preferred embodiment.
Figure 22B:
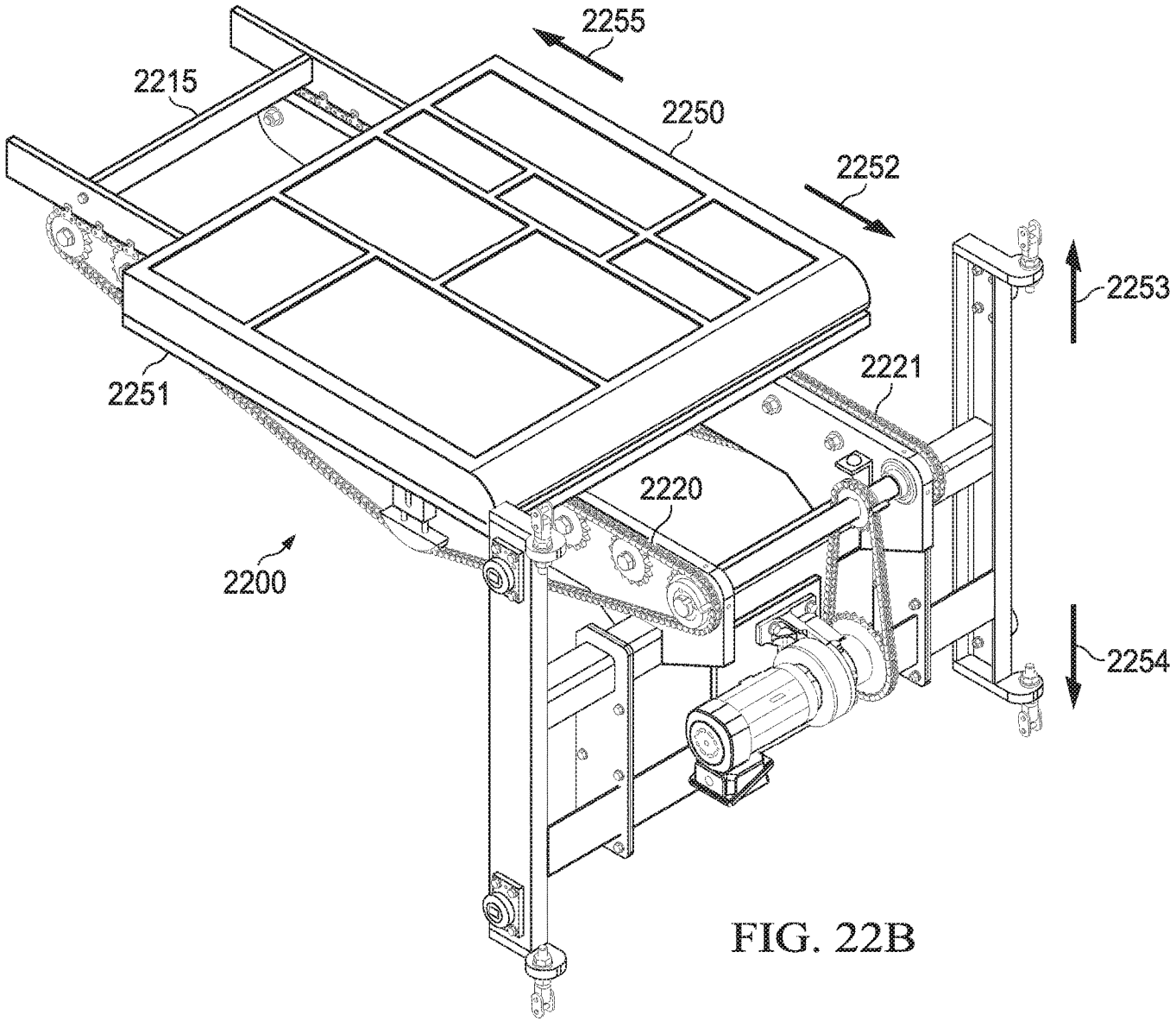
FIG. 22B is an isometric view of a set of entry elevator tines and a mold of a preferred embodiment.

Referring to FIGS. 22A and 22B, set of entry elevator tines 1907 will be further described as set of entry elevator tines 2200. Set of entry elevator tines 2200 includes supports 2201 and 2202 attached to members 2203 and 2204. Bolt plates 2259 and 2260 are attached to members 2203 and 2204. Rollers 2205 and 2206 are attached to support 2201. Rollers 2209 and 2210 are attached to support 2202. Each of rollers 2205, 2206, 2209, and 2210 engage with a set of guides for an entry elevator, as previously described. Chain couplers 2207 and 2208 are attached to opposing ends of support 2201. Chain couplers 2211 and 2212 are attached to opposing ends of support 2202. Each of chain couplers 2207, 2208, 2211, and 2212 is coupled to chains 1918 and 1919. Tines 2213 and 2214 are attached to member 2203. Set of sprockets 2216 is rotatably attached to tine 2213. Set of sprockets 2217 is rotatably attached to tine 2214. Sensors 2256 and 2257 are mounted to tine 2214 and connected to a controller via a wired or wireless connection. Chain guide 2218 is movably attached to tine 2213. Chain guide 2219 is movably attached to tine 2214. Chain 2220 is engaged with set of rollers 2216 and drive sprocket 2222 rotatably attached to tine 2213. Chain 2221 is engaged with set of rollers 2217 and drive sprocket 2223. Weldment 2215 is attached to chains 2220 and 2221. Drive sprockets 2222 and 2223 are attached to axle 2224. Sprocket 2225 is attached to axle 2224. Chain 2226 is engaged with sprocket 2225 and with sprocket 2258 of motor 2227. Motor 2227 is mounted to plate 2228. Plate 2228 is attached to members 2203 and 2204.

In a preferred embodiment, each of supports 2201 and 2202, members 2203 and 2204, tines 2213 and 2214, weldment 2215, and plate 2228 is made of steel. Other suitable materials known in the art may be employed.

In a preferred embodiment, each roller of sets of rollers 2216 and 2217 is an idler roller. Other suitable rollers known in the art may be employed.

In a preferred embodiment, motor 2227 is a parallel axis gearmotor. Other suitable motors and drive system may be employed.

In a preferred embodiment, each of sensors 2256 and 2257 is an AK Series M18 DC Inductive Proximity Sensor. Other suitable sensors known in the art may be employed.

In use, set of entry elevator tines 2200 is moved along directions 2253 and 2254 via chain couplers 2207, 2208, 2211, and 2212 coupled to chains 1918 and 1919. Mold 2250 rests on slaveboard 2251. Slaveboard 2251 is positioned on chains 1918 and 1919. Mold 2250 and slaveboard 2251 are positioned adjacent to weldment 2215. Motor 2227 is selectively powered to move chains 2220 and 2221 and weldment 2215 in direction 2252. Weldment 2215 urges mold 2250 and slaveboard 2251 in direction 2252 into drying rack 1900. Motor 2227 is selectively powered to move chains 2220 and 2221 and weldment in direction 2255 to return weldment 2215 to a "home" position to receive another mold and slaveboard.

Figure 23:
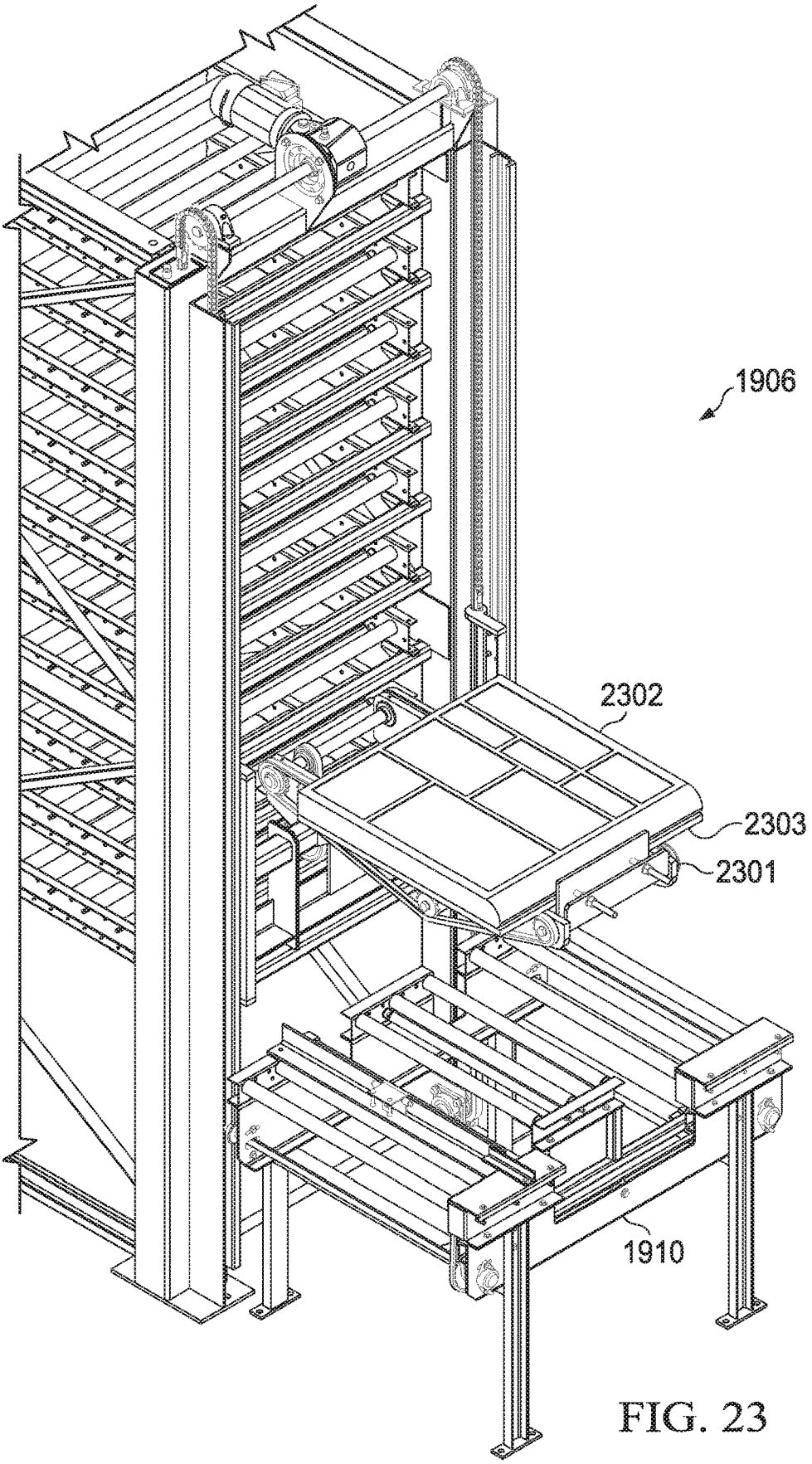
FIG. 23 is an isometric view of an exit elevator of a preferred embodiment.

Referring to FIG. 23, exit elevator 1906 has the same structure and features as entry elevator 1905, as previously described. Exit elevator table 1910 has the same structure and features as elevator table 2100, as previously described. Set of exit elevator tines 2301 is attached to exit elevator 1906 and supports dried mold 2302 and slaveboard 2303.

Figure 24:
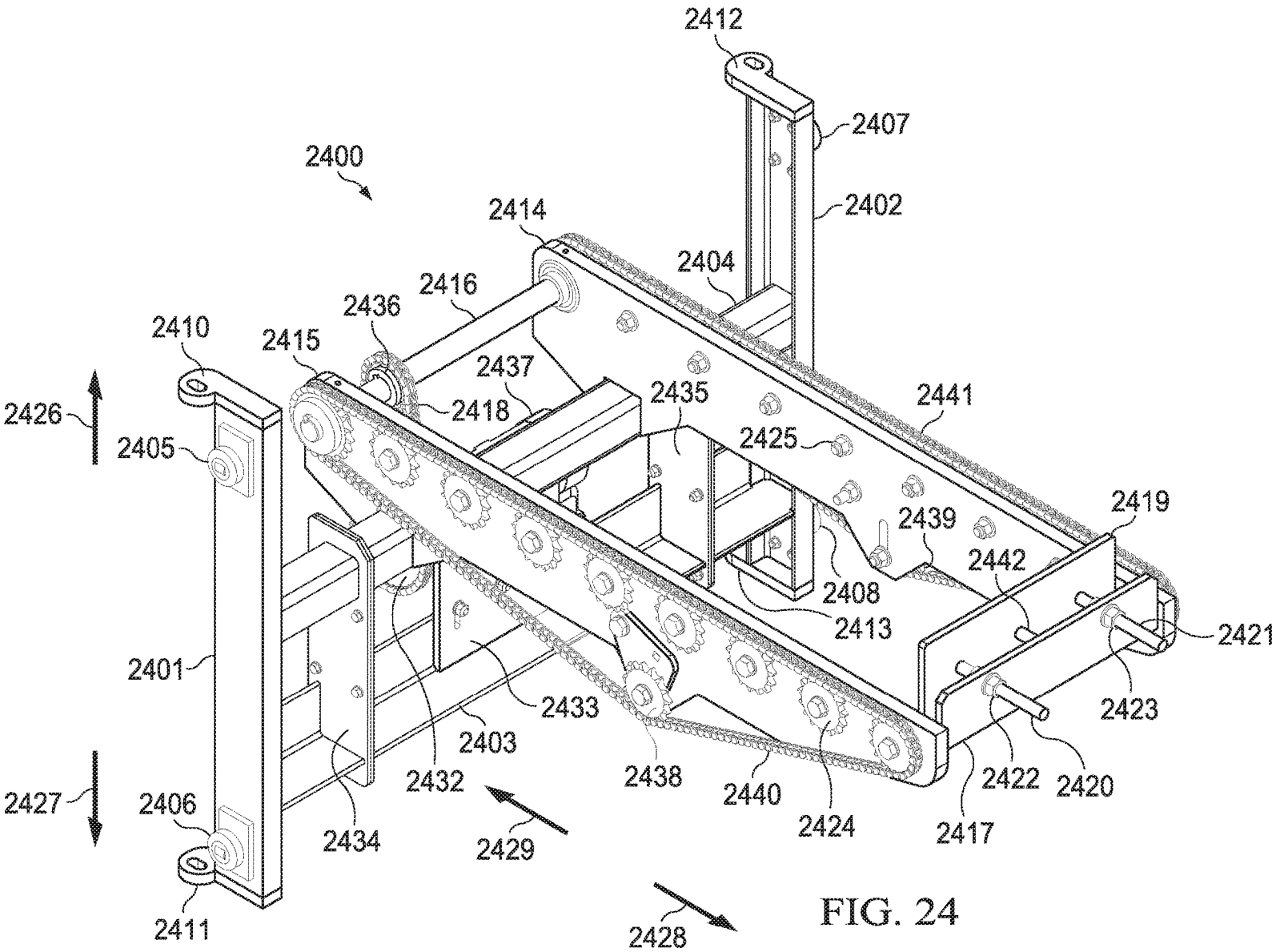
FIG. 24 is an isometric view of a set of exit elevator tines of a preferred embodiment.
Figure 25:
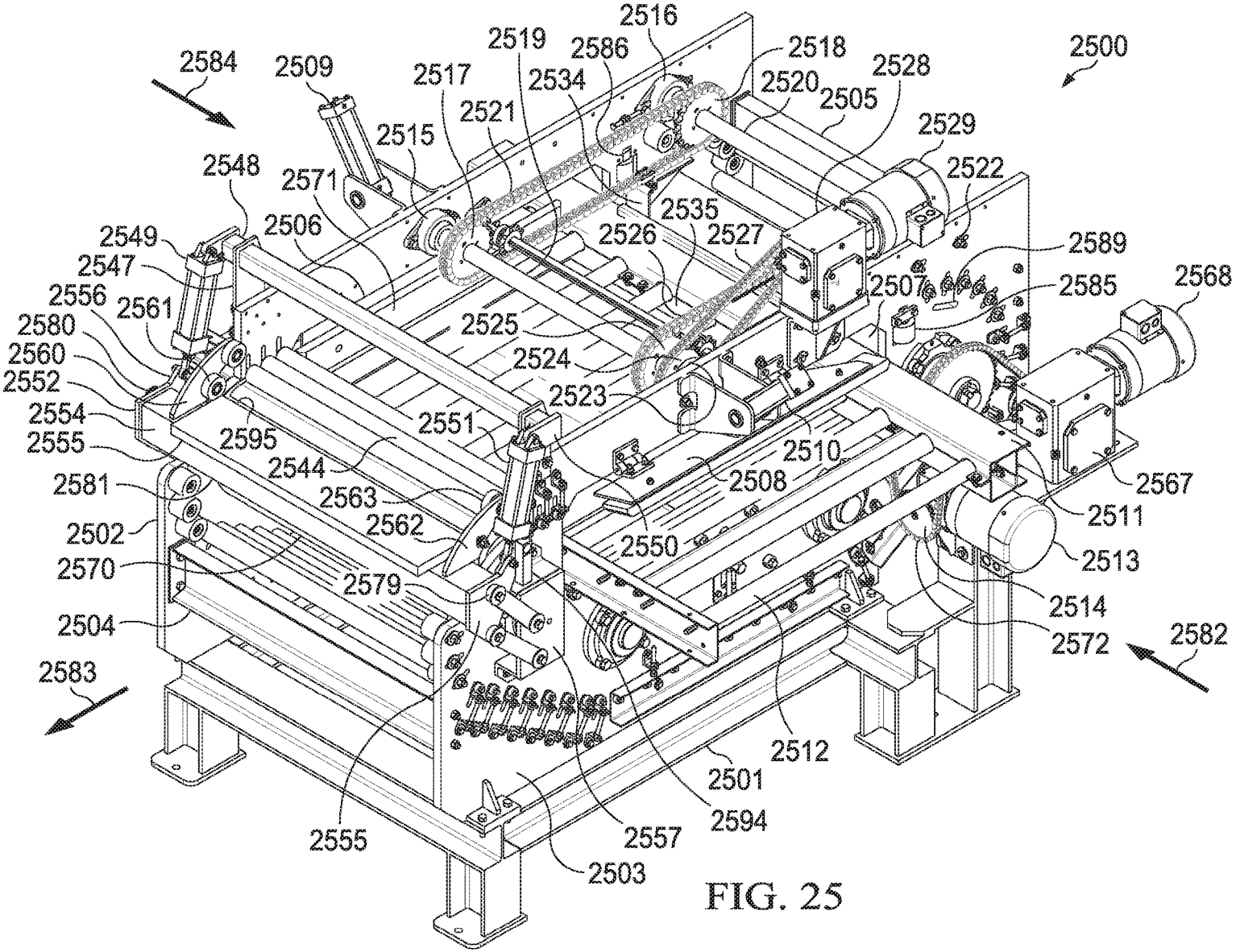
FIG. 25 is an isometric view of a demolder of a preferred embodiment.
Figure 26:
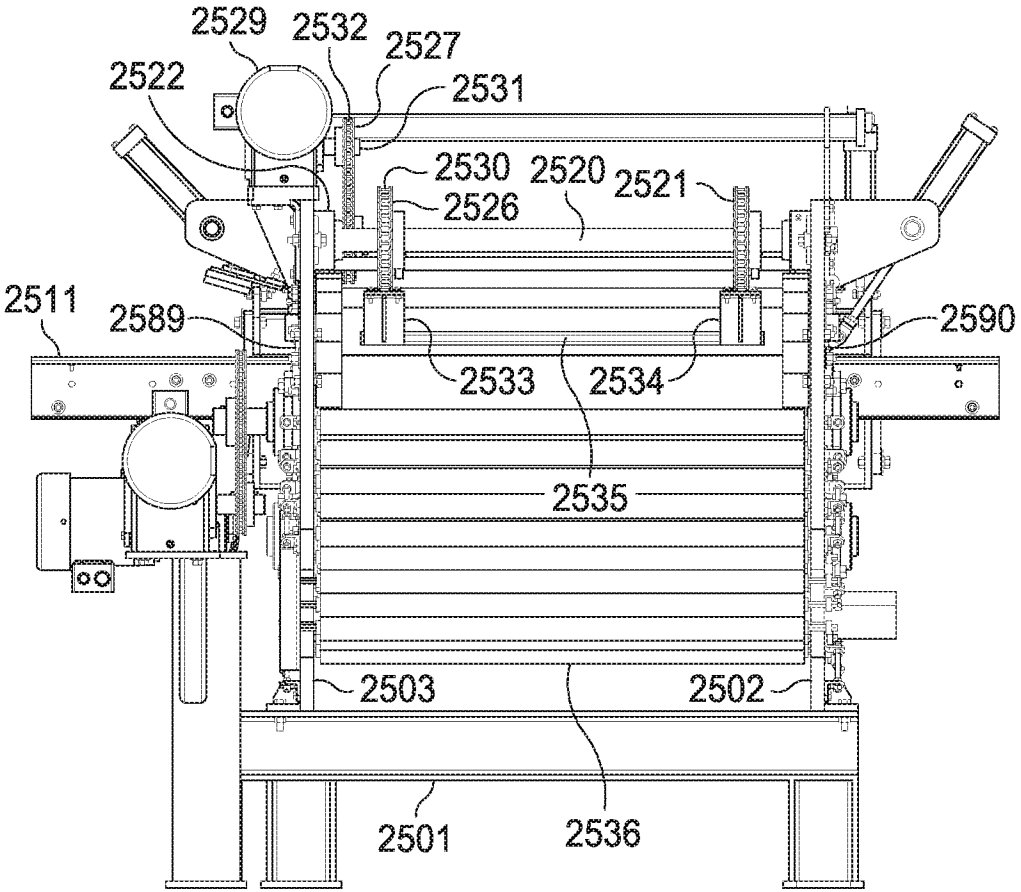
FIG. 26 is an end view of a demolder of a preferred embodiment.
Figure 27:
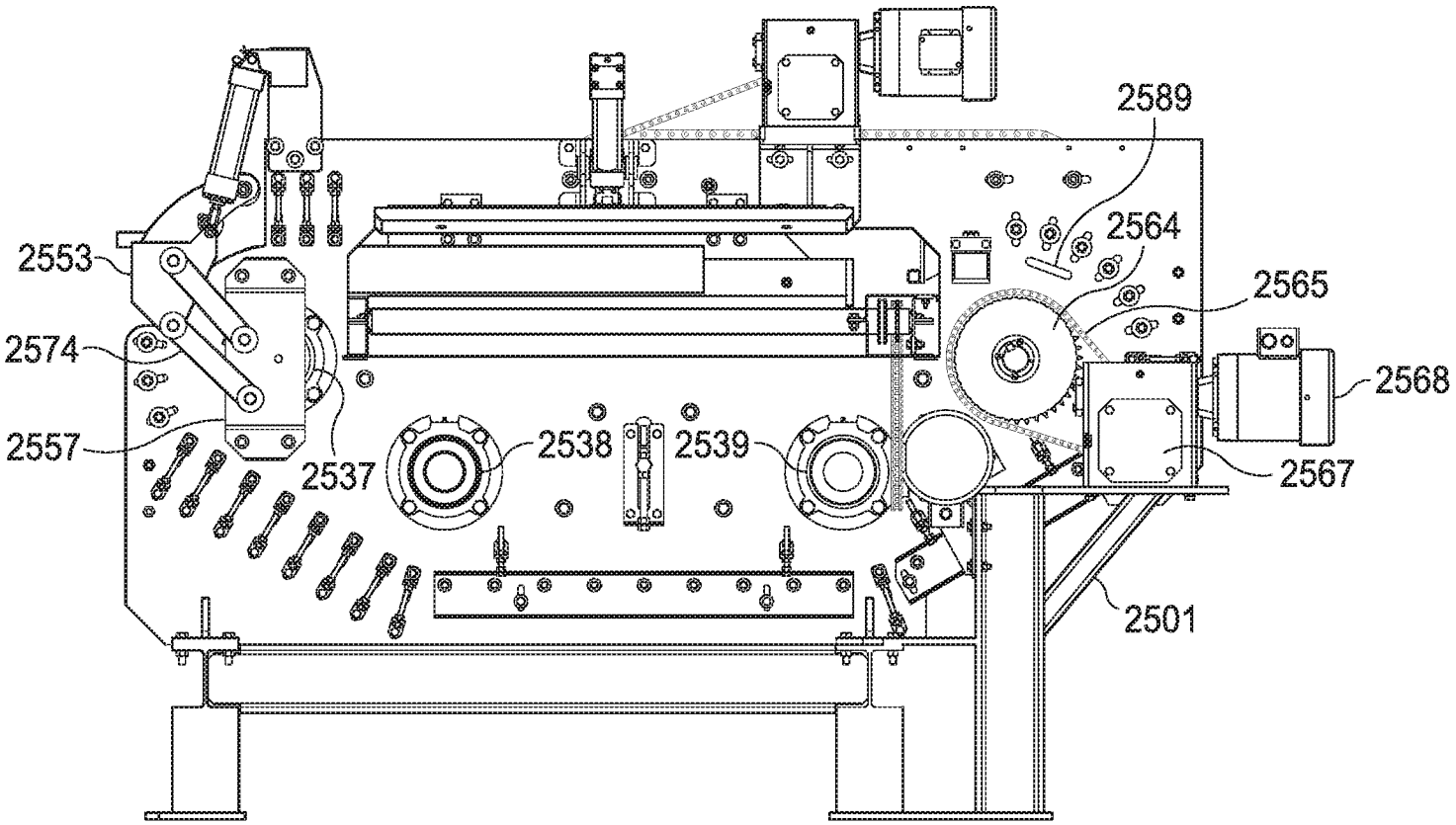
FIG. 27 is a side view of a demolder of a preferred embodiment.

Referring to FIG. 24, set of exit elevator tines 2301 will be further described as set of exit elevator tines 2400. Set of exit elevator tines 2400 includes members 2401 and 2402. Supports 2403 and 2404 are attached to members 2401 and 2402. Support plate 2433 is attached to supports 2403 and 2404. Bolt plates 2434 and 2435 are attached to supports 2403 and 2404. Rollers 2405 and 2406 are connected to member 2401. Rollers 2407 and 2408 are connected to member 2402. Chain couplers 2410 and 2411 are attached to member 2401 and are coupled to a chain of an exit elevator. Chain couplers 2412 and 2413 are attached to member 2402 and are coupled to a chain of an exit elevator. Tines 2414 and 2415 are attached to member 2404. Axle 2416 is rotatably attached to tines 2414 and 2415. Cross-member 2417 is attached between tines 2414 and 2415. Stop 2419 is adjustably connected to cross-member 2417 with bolts 2420 and 2421 attached to stop 2419 and nuts 2422 and 2423 rotatably connected to cross-member 2417. Sensor 2442 is mounted through stop 2419. Set of sprockets 2424 is rotatably connected to tine 2415 and to axle 2416. Set of sprockets 2425 is connected to tine 2414 and to axle 2416. Tension sprocket 2438 is adjustably attached to tine 2415. Tension sprocket 2439 is adjustably attached to tine 2414. Chain 2440 is engaged with set of sprockets 2424 and tension sprocket 2438. Chain 2441 is engaged with set of sprockets 2425 and tension sprocket 2439. Motor 2437 is mounted to support plate 2433. Motor 2437 includes drive sprocket 2432. Drive sprocket 2432 is engaged with drive chain 2418. Drive chain 2418 is engaged with sprocket 2436 of axle 2416.

In a preferred embodiment, each of members 2401 and 2402, supports 2403 and 2404, tines 2414 and 2415, axle 2416, cross-member 2417, stop 2419, bolts 2420 and 2421, and nuts 2422 and 2423 is made of steel. Other suitable materials known in the art may be employed.

In a preferred embodiment, sensor 2442 is an AK Series M18 DC Inductive Proximity Sensor. Other suitable sensors known in the art may be employed.

In use, set of exit elevator tines 2400 is moved along directions 2426 and 2427 via chain couplers 2410, 2411, 2412, and 2413 coupled to a set of chains of an exit elevator. A dried mold and a slaveboard is retrieved from a drying rack by powering motor 2427 to drive chains 2440 and 2441 generally along direction 2428 and reversed to drive chains along direction 2429 to position the mold and slaveboard adjacent to stop 2419.

Referring to FIGS. 25, 26, 27, and 28, demolder 2500 includes frame 2501 and sides 2502 and 2503 attached, each of which is attached to frame 2501. Cross-members 2504 and 2505 are attached to sides 2502 and 2503. Side 2502 includes opening 2506 integrally formed therein. Side 2503 includes opening 2507 integrally formed therein. Stop gate plate 2508 is hingedly attached to side 2503. Similarly, stop gate plate 2571 is hingedly attached to side 2502. Actuator 2509 is attached to side 2502 and to stop gate plate 2571. Actuator 2510 is attached to side 2503 and to stop gate plate 2508. Roller table 2511 is attached to sides 2502 and 2503 and is positioned in openings 2506 and 2507. Roller table 2511 includes set of rollers 2512. Motor 2513 is mounted to frame 2501. Sprocket 2514 is connected to motor 2513 and is engaged with chain 2572. Chain 2572 is engaged with set of rollers 2512. Bearings 2515 and 2516 are mounted to side 2502. Bearings 2522 and 2523 are mounted to side 2503. Axle 2519 is rotatably mounted to bearings 2515 and 2523. Axle 2520 is rotatably mounted to bearings 2516 and 2522. Sprocket 2517 is attached to axle 2519 adjacent to bearings 2515. Sprocket 2518 is attached to axle 2519 adjacent to bearings 2516. Chain 2521 is engaged with sprockets 2517 and 2518. Sprocket 2524 is attached to axle 2519 adjacent to bearings 2523. Sprocket 2525 is attached to axle 2519 adjacent to sprocket 2524. Chain 2526 is engaged with sprocket 2530. Sprocket 2530 is attached to axle 2520. Chain 2527 is engaged with sprocket 2524 and sprocket 2532 of gearbox 2528. Gearbox 2528 is mounted to side 2503 and operatively connected to motor 2529. Gearbox 2528 includes axle 2531 attached to sprocket 2532.

Bracket 2533 is attached to chain 2526. Bracket 2534 is attached to chain 2521. Pusher bar 2535 is attached to brackets 2533 and 2534. Idler roller 2585 is attached to side 2503. Idler roller 2586 is attached to side 2502. Proximity sensor 2589 is attached to side 2503 adjacent to belt 2536 and senses the presence of a mold. Proximity sensor 2590 is attached to side 2502 adjacent to belt 2536 and senses the presence of a mold. Proximity sensor 2591 is attached to side 2503 at start position 2594. Proximity sensor 2592 is attached to side 2503 at engage position 2595. Proximity sensor 2593 is attached to side 2503 at clearance position 2596.

Belt 2536 is engaged with belt rollers 2537, 2538, 2539, and 2540, belt guide rollers 2573, 2574, 2575, 2576, 2577, and 2578, and tension roller 2558. Belt 2536 travels along a direction that is generally perpendicular to roller table 2511. Belt rollers 2537, 2538, 2539, and 2540 are rotatably attached to sides 2502 and 2503. Belt guide rollers 2573, 2574, 2575, and 2576 are rotatably attached to sides 2502 and 2503. Tension roller 2558 is rotatably attached to sides 2502 and 2503. By way of example, slot 2559 is integrally formed in side 2503. Tension roller 2558 is adjustably slidingly engaged with slot 2559 to adjust the tension on belt 2536. Sprocket 2564 is attached to roller 2540. Chain 2565 is engaged with sprocket 2564 and gearbox 2567. Gearbox 2537 is mounted to frame 2501 and connected to motor 2568.

Sets of guide rollers 2541, 2542, 2543, 2544, 2545, and 2546 are rotatably attached to sides 2502 and 2503 and are positioned generally parallel to the travel path of belt 2536. Bracket 2557 is attached to side 2503 adjacent to roller 2537. Similarly, bracket 2556 is attached to side 2502 adjacent to roller 2537. Proximity sensor 2594 is attached to bracket 2557 adjacent to set of guide rollers 2541 and senses the presence of a mold. Similarly, proximity sensor 2595 is attached to bracket 2556 adjacent to set of guide rollers 2541 and senses the presence of a mold.

Set of swing arms 2579 is pivotally attached to bracket 2557. Similarly, set of swing arms 2580 is pivotally attached to bracket 2556. Plate 2553 is pivotally attached to set of swing arms 2579. Similarly, plate 2552 is pivotally attached to set of swing arms 2580. Lip breaker 2554 is attached to plates 2552 and 2553. Lip breaker 2554 includes release surface 2555. Support 2547 is attached to side 2502. Support 2550 is attached to side 2503. Beam 2548 is attached to and extends through supports 2547 and 2550. Actuator 2549 is attached to beam 2548. Actuator 2551 is attached to beam 2548. Roller support 2560 is attached to lip breaker 2554 adjacent to release surface 2555 and adjacent to side 2502. Set of bend rollers 2561 is rotatably attached to roller support 2560. Roller support 2562 is attached to lip breaker 2554 adjacent to release surface 2555, opposite roller support 2560, and adjacent to side 2503. Set of bend rollers 2563 is rotatably attached to roller support 2562. Breaker plate 2570 is attached to lip breaker 2554 opposite roller support 2562. Similarly, breaker plate 2581 is attached to lip breaker 2554 opposite roller support 2560.

In a preferred embodiment, frame 2501 is made of steel. Other suitable materials known in the art may be employed.

In a preferred embodiment, each of sides 2502 and 2503 is made of steel. Other suitable materials known in the art may be employed.

In a preferred embodiment, each of set of rollers 2512 is a 1.9 inch sprocketed live roller, making roller table 2511 a live bed. Other suitable rollers known in the art may be employed.

In a preferred embodiment, motor 2513 is a right angle gearmotor. Other suitable motors may be employed.

In a preferred embodiment, motor 2529 and gearbox 2528 are a right angle gearmotor. Other suitable motors may be employed.

In a preferred embodiment, motor 2568 and gearbox 2567 are a right angle gearmotor. Other suitable motors may be employed.

In a preferred embodiment, each of belt rollers 2537 and 2540 is a 9 inch roller with a rubber coating. Other suitable rollers known in the art.

In a preferred embodiment, each of belt rollers 2538 and 2539 is a 9 inch roller. Other suitable rollers known in the art.

In a preferred embodiment, each of guide rollers 2573, 2574, 2575, 2576, 2577, and 2578 is a 2.5 inch idler roller. Other suitable rollers known in the art may be employed.

In a preferred embodiment, tension roller 2558 is a 3 inch tension roller having a threaded rod. A fastener is engaged with the threaded rod to adjust the tension of belt 2536.

In a preferred embodiment, belt 2536 is a friction-surface belt. Any suitable material known in the art may be employed.

In a preferred embodiment, each guide roller of set of guide rollers 2541 is a gravity idler roller having a diameter of approximately 1.9 inches. Other rollers known in the art may be employed.

In a preferred embodiment, each guide roller of set of guide rollers 2542 is a gravity idler roller having a diameter of approximately 1.9 inches. Other rollers known in the art may be employed.

In a preferred embodiment, each guide roller of set of guide rollers 2543 is a gravity idler roller having a diameter of approximately 1.9 inches. Other rollers known in the art may be employed.

In a preferred embodiment, each guide roller of set of guide rollers 2544 is a gravity idler roller having a diameter of approximately 1.9 inches. Other rollers known in the art may be employed.

In a preferred embodiment, each guide roller of set of guide rollers 2545 is a gravity idler roller having a diameter of approximately 1.9 inches. Other rollers known in the art may be employed.

In a preferred embodiment, each guide roller of set of guide rollers 2546 is a 2-inch idler roller. Other rollers known in the art may be employed.

Figure 28:
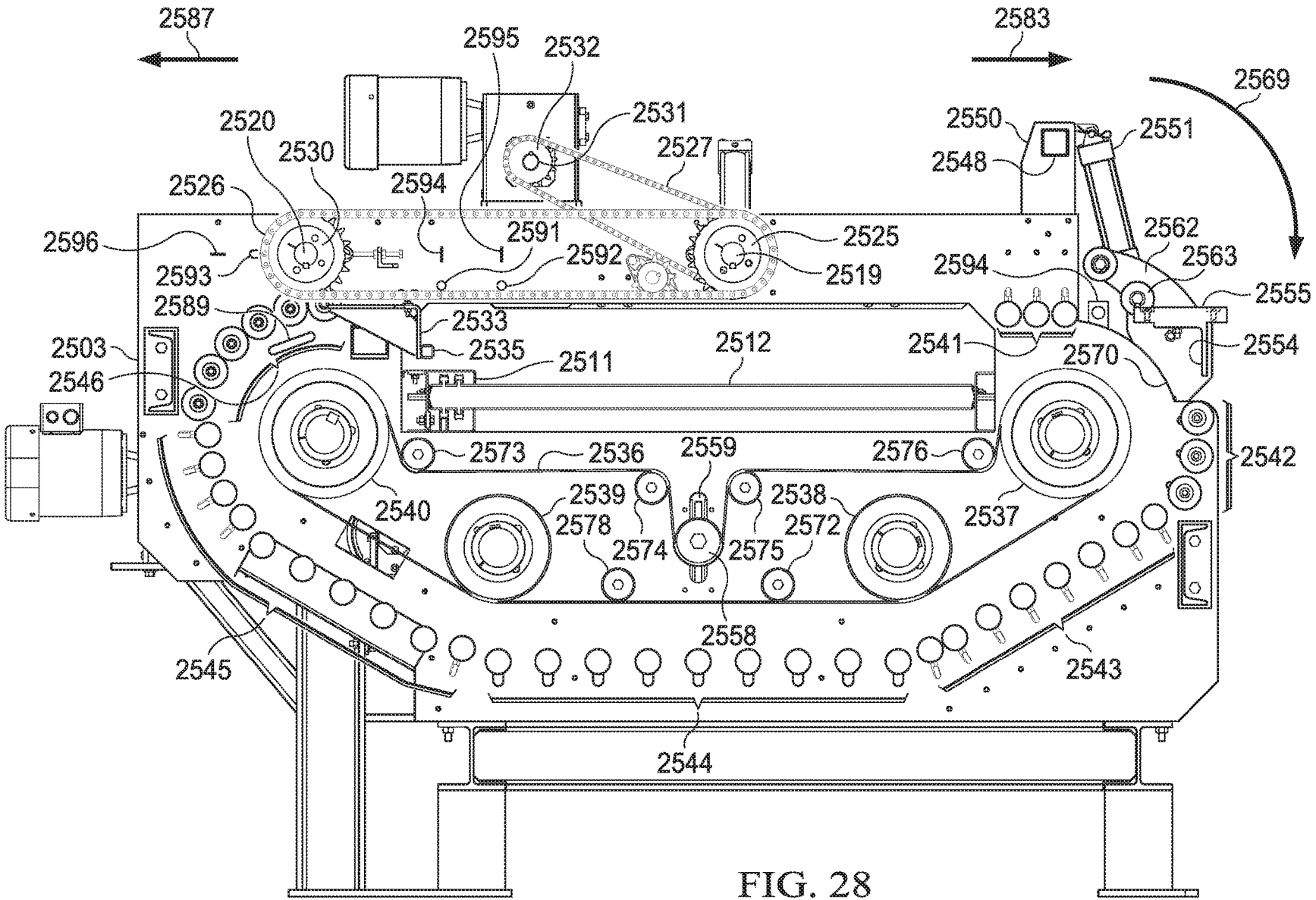
FIG. 28 is a sectional view of a demolder of a preferred embodiment.

Referring to FIG. 28 in use, a mold and a slaveboard enters demolder 2500 generally along either of directions 2582 or 2584 via roller table 2511 powered by motor 2513. For example, the mold and the slaveboard enters demolder along direction 2582 and engages stop gate plate 2571. Stop gate plate 2508 is closed by actuator 2510. Motor 2529 is powered to move pusher bar 2535 from start position 2591 generally in direction 2583. Motor 2568 is powered to rotate belt 2536 generally in direction 2583. Pusher bar 2535 engages the mold at approximately engage position 2595 and urges the mold off of the slaveboard onto belt 2536 and belt roller 2537. Sets of rollers 2541 and 2542 redirect and bend the mold around belt 2536 and belt roller 2537 partially ejecting the dried stones from the mold. To aid in the redirection of the mold and the ejection of the dried stones from the mold, actuators 2549 and 2551 are powered upon position sensor 2594 and/or position sensor 2595 sensing the presence of the mold to rotate lip breaker 2554 generally in direction 2569 and apply a force on the mold to further bend the mold around belt roller 2537 thereby further ejecting the dried stones from the mold. The redirection of the mold around belt roller 2537 creates a bend in the mold of approximately 150 degrees. In other embodiments, other angles are employed.

As the dried stones are ejected and as the mold is bent around belt roller 2537, lip breaker 2554 is rotated along direction 2569 so that release surface 2555 is lowered thereby allowing the dried stones to slide across release surface 2555 to exit demolder 2500. As pusher bar 2535 urges the mold around belt roller 2537 the mold engages set of rollers 2542 and belt 2536. Pusher bar 2535 continues to travel generally in direction 2583 and rotates about axle 2519 to reverse course to travel generally in direction 2587 and to partially rotate about axle 2520 to stop at clearance position 2596. Belt 2536 moves the mold to engage sets of rollers 2543, 2544, 2545, and 2546 to return the empty mold to roller table 2511. Once the mold is sensed and clears proximity sensor 2589 and/or proximity sensor 2590, a signal is sent to the controller to power motor 2529. Pusher bar 2535 then continues to rotate about axle 2520 and returns to and stops at start position 2594.

After all the stones are removed, the mold travels around rollers back to partially on top the slave board, where pusher bar 2535 engages the mold again to fully place the mold on the slave board. Stop gate plates 2508 and 2571 are opened and roller table 2511 is powered to move the empty mold out of demolder 2500 and down the process line.

Figure 29:
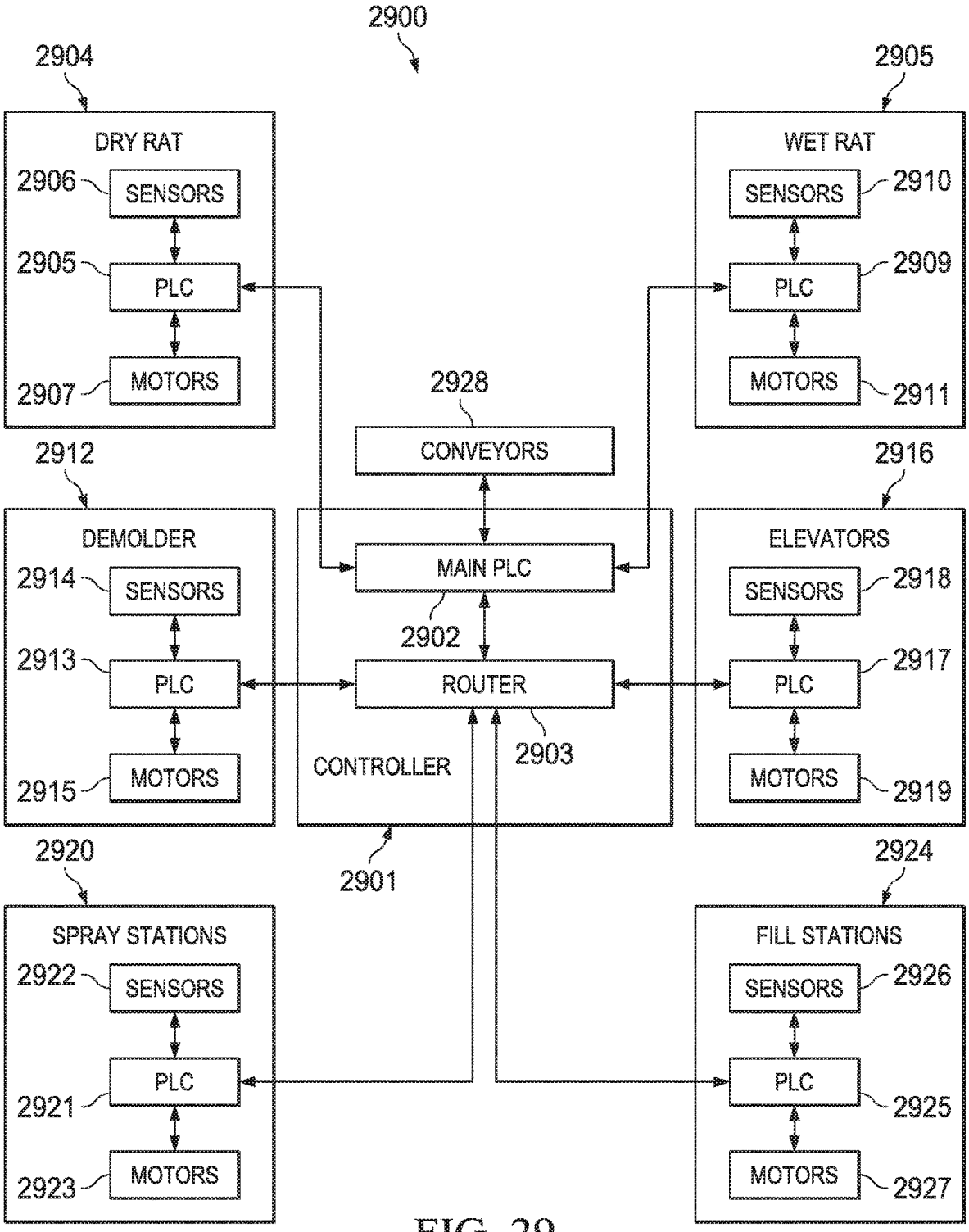
FIG. 29 is a block diagram of a control system of the conveyor rack and elevator system of a preferred embodiment.

Referring to FIG. 29, control system 2900 includes controller 2901 connected to dry RAT 2904, wet RAT 2908, demolder 2912, elevators 2916, spray stations 2920, fill stations 2924, and conveyors 2928. In some embodiments, controller 2901 is further connected to a local area network and/or a wide area network such as the internet, including cellular networks to enable remote interaction with controller 2901.

Controller 2901 includes main PLC 2902 and router 2903 connected to main PLC 2902. In a preferred embodiment, main PLC 2902 is an Automation Direct Model 250-1 programmable logic controller. Other suitable programmable logic controllers known in the art may be employed. In a preferred embodiment, router 2903 is a Stride Model SE2-SW8U router. Other suitable routers known in the art may be employed.

Dry RAT 2904 includes PLC 2905, set of sensors 2906 connected to PLC 2905, and set of motors 2907 connected to PLC 2905. In a preferred embodiment, PLC 2905 is an Automation Direct Model D0-05DR programmable logic controller. Other suitable programmable logic controllers known in the art may be employed.

Wet RAT 2908 includes PLC 2909, set of sensors 2910 connected to PLC 2909, and set of motors 2911 connected to PLC 2909. In a preferred embodiment, PLC 2909 is an Automation Direct Model D0-05DR programmable logic controller. Other suitable programmable logic controllers known in the art may be employed.

Demolder 2912 includes PLC 2913, set of sensors 2914 connected to PLC 2913, and set of motors 2915 connected to PLC 2913. In a preferred embodiment, PLC 2913 is an Automation Direct Model 250-1 programmable logic controller. Other suitable programmable logic controllers known in the art may be employed.

Elevators 2916 include PLC 2917, set of sensors 2918 connected to PLC 2917, and set of motors 2919 connected to PLC 2917. In a preferred embodiment, PLC 2917 is an Automation Direct Model 250-1 programmable logic controller. Other suitable programmable logic controllers known in the art may be employed. Elevators 2919 is an example of and corresponds to each of entry elevator 1905 and exit elevator 1906.

Spray stations 2920 includes PLC 2921, set of sensors 2922 connected to PLC 2921, and set of motors 2923 connected to PLC 2921. In a preferred embodiment, PLC 2921 is an Automation Direct Model 250-1 programmable logic controller. Other suitable programmable logic controllers known in the art may be employed. Spray stations 2920 is an example of and corresponds to each of spray stations 103, 104, 105, 106, 107, and 900.

Fill stations 2924 includes PLC 2925, set of sensors 2926 connected to PLC 2925, and set of motors 2927 connected to PLC 2925. In a preferred embodiment, PLC 2925 is an Automation Direct Model H2-DM1E programmable logic controller. Other suitable programmable logic controllers known in the art may be employed. Fill stations 2924 is an example of and corresponds to each of fill stations 108, 109, 110, and 1200.

Conveyors 2928 is an example of and corresponds to conveyor table 200 and vibration table 500.

Figure 30:
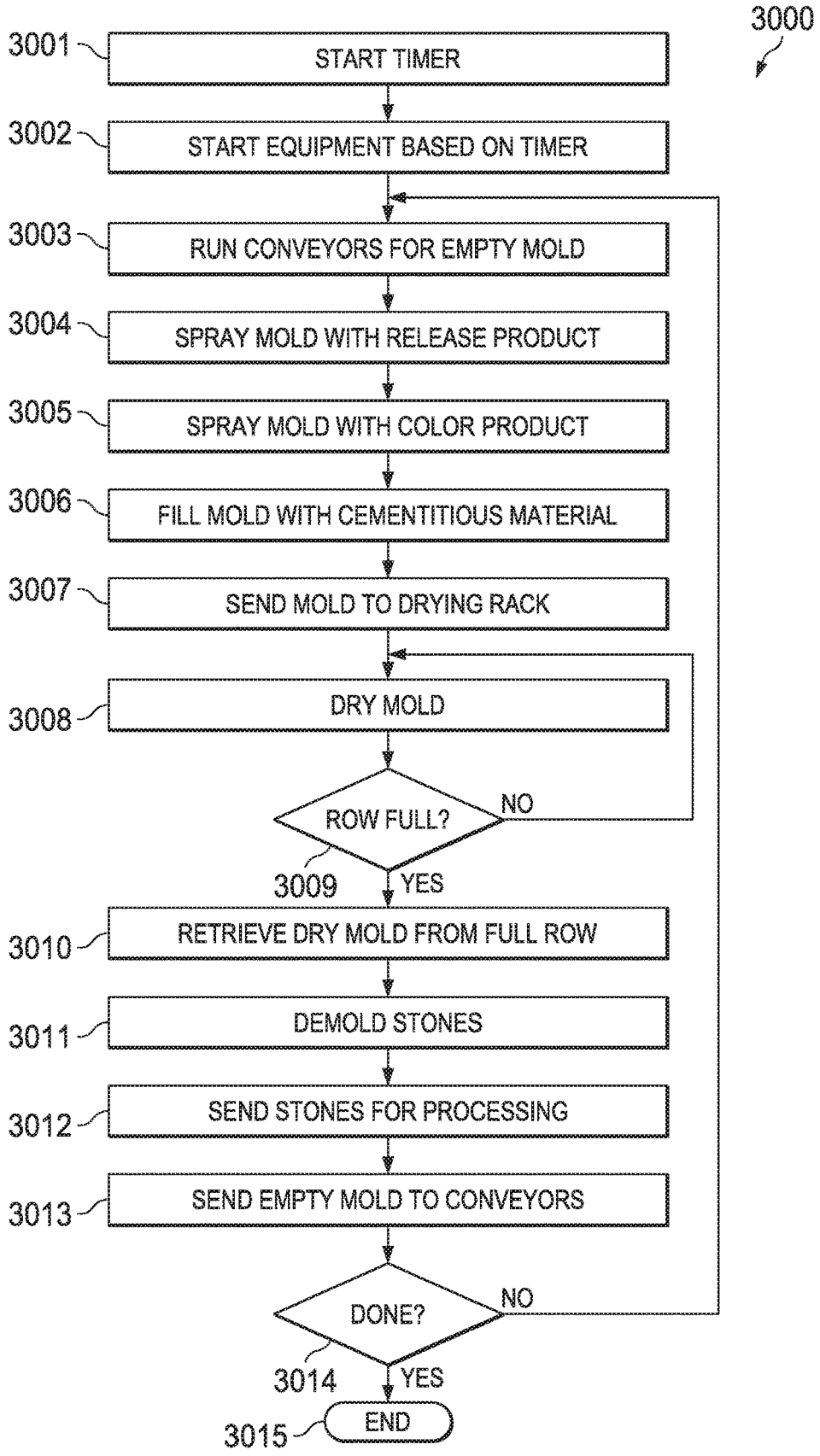
FIG. 30 is a flowchart of a method for manufacturing stones of a preferred embodiment.

Referring to FIG. 30, method 3000 begins at step 3001. At step 3001, a timer is started. At step 3002, a set of conveyors, a set of vibration tables, elevators, RAT tables, and a demolder, are started sequentially. In a preferred embodiment, each category of equipment is started every ten (10) seconds. Other intervals may be used. At step 3003, a set of conveyors for an empty mold is run. At step 3004, a release product is sprayed onto the empty mold. At step 3005, a set of color products is sprayed into the empty mold. At step 3006, the empty mold is filled with a cementitious material. At step 3007, the filled mold is sent to the drying rack. At step 3008, the filled mold is dried in the drying rack. In a preferred embodiment, a dry time period for the filled mold is determined by the composition and mix design of the cementitious material and the ambient conditions of the drying rack. Other known factors may be employed. At step 3009, a determination is made as to whether a row of the drying rack is full. In this step, if a row is full, a signal is received from a proximity sensor located at the end of a row in the drying rack which indicates the presence of a mold at the end of the row. If the signal is received, then method 3000 proceeds to step 3010. If the signal is not received, then the row is not full and method 3000 returns to step 3008.

At step 3010, the dried mold is retrieved from the drying rack. At step 3011, the stones are demolded. At step 3012, the stones are sent out of demolder. At step 3013, the empty mold is sent back to the set of conveyors. At step 3014, whether a stop command has been received is determined. If not, method 3000 returns to step 3003. If so, then method 3000 ends at step 3015.

Figure 31:
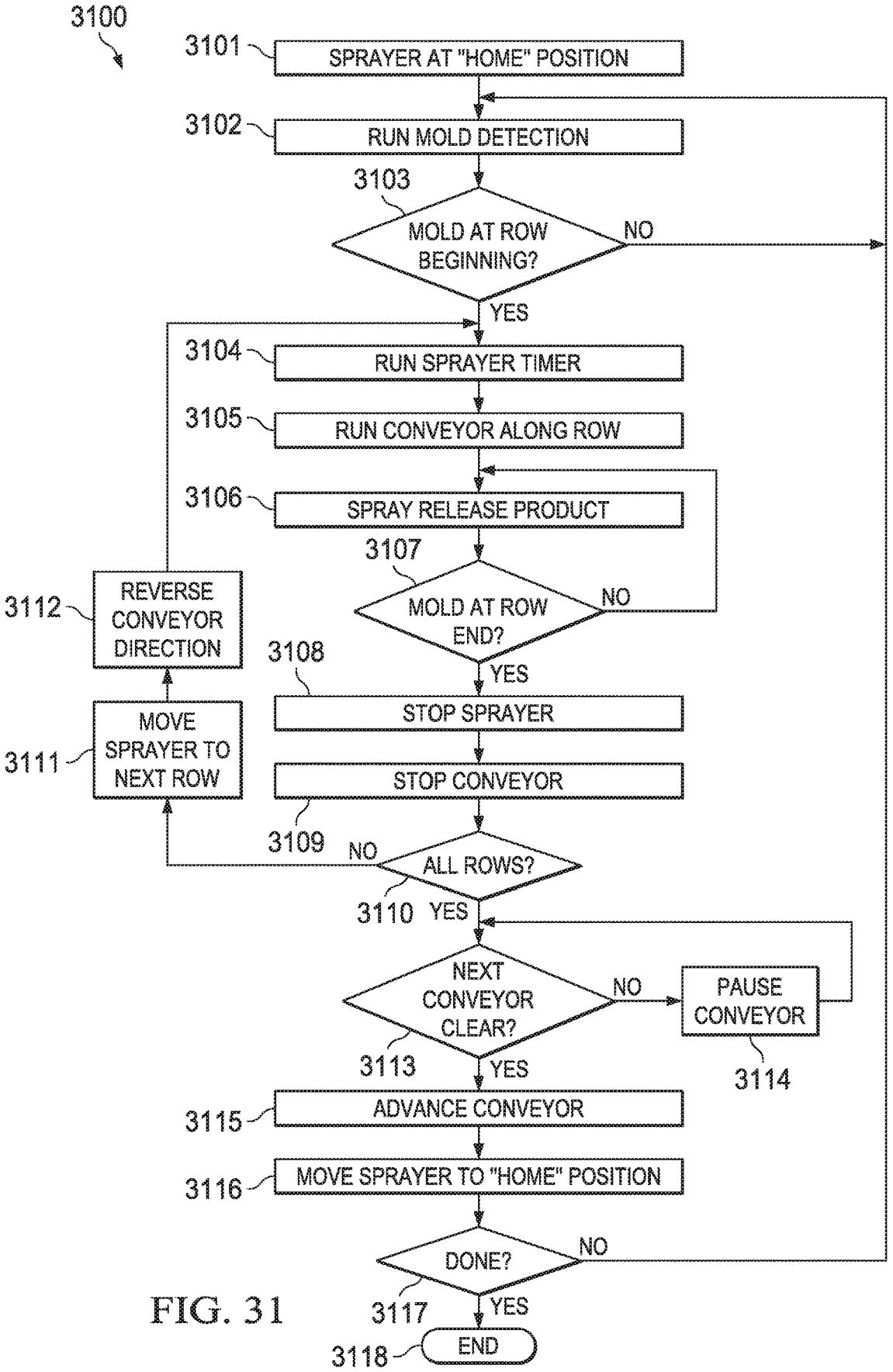
FIG. 31 is a flowchart of a method for applying a release product of a preferred embodiment.

Referring to FIG. 31, step 3004 will be further described as method 3100. Each spray station performs method 3100 covering different sets of rows. In one embodiment, the empty mold has six (6) rows. The first spray station covers rows one (1) through three (3) and the second spray station covers rows four (4) through six (6). Any coverage method may be employed including one spray station covering all rows and alternating and/or random row coverage. At step 3101, the sprayer is positioned at a "home" position. At step 3102, a mold detection routine is run. In this step, a set of proximity sensors is enabled. At step 3103, whether a mold is present at a beginning end of a row is determined. In this step, if a mold is present, a signal is received from the set of proximity sensors. If so, method 3100 proceeds to step 3104. If no mold is present, i.e., no signal is received, then method 3100 returns to step 3102. At step 3104, a sprayer timer is run. At step 3105, the sprayer conveyor is run along the direction of the row to be sprayed. At step 3106, a release product is sprayed into the empty mold along the row. At step 3107, whether the mold has reached the end of the row is determined. When the mold reaches the end of the row, a proximity sensor senses the presence of the mold at the end of the row and sends signal to the controller. If the signal has not been received, then method 3100 returns to step 3106. If a signal has been received, then method 3100 proceeds to step 3108. At step 3108, the sprayer stops. At step 3109, the conveyor stops. At step 3110, whether all rows for the spray station has been sprayed is determined. If not, then method 3100 proceeds to step 3111.

At step 3111, the sprayer is indexed to the next row. At step 3112, the conveyer is reversed to run in the opposite direction of the last row. In this way, the spray station applies the release product in a "zig-zag"-type pattern. Method 3100 then returns to step 3104. If all rows have been sprayed at step 3110, then method 3100 proceeds to step 3113.

At step 3113, a determination is made as to whether the next conveyor and/or station is clear. In this step, whether no signal is received from a proximity sensor on the next conveyor and/or station. If a signal is received, then a mold is present in the next conveyor and/or station and is "not clear". Method 3100 pauses for a predetermined period of time at step 3114. In a preferred embodiment, the predetermined period of time is approximately twenty (20) seconds. Any time period may be employed. Method 3100 then returns to step 3113. If the next conveyor is "clear", i.e., no signal is received, then the conveyor motor is powered to advance the conveyor belt and the mold to the next conveyor and/or station at step 3115. At step 3116, the sprayer is returned to the "home" position. At step 3117, whether a stop command has been received is determined. If not, then method 3100 returns to step 3102. If so, then method 3100 ends at step 3118.

Figure 32:
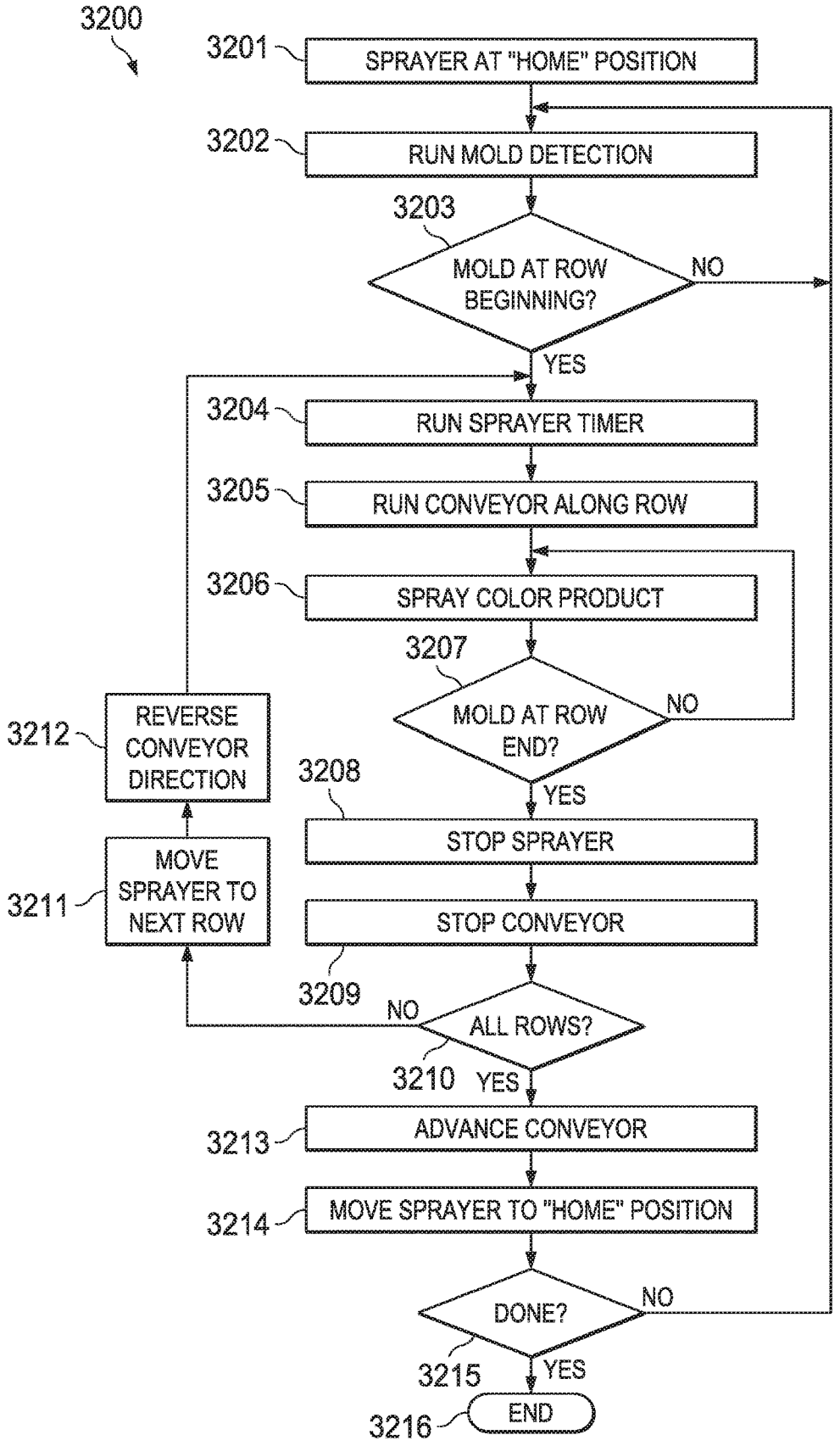
FIG. 32 is a flowchart of a method for applying a color product of a preferred embodiment.

Referring to FIG. 32, step 3005 will be further described as method 3200. Each color spray station performs method 3200 covering different sets of rows. In one embodiment, the empty mold has six (6) rows. The first color spray station covers rows one (1) through three (3) and the second color spray station covers rows four (4) through six (6). Any coverage method may be employed including one color spray station covering all rows and alternating and/or random row coverage. In a preferred embodiment, the spray nozzle of each color spray station is oriented in a different position. Other orientations may be employed. In this way, the color applied will have a random appearance. At step 3201, the sprayer is positioned at a "home" position. At step 3202, a mold detection routine is run. In this step, a set of proximity sensors is enabled. At step 3203, whether a mold is present at a beginning end of a row is determined. In this step, if a mold is present, a signal is received from the set of proximity sensors. If so, method 3200 proceeds to step 3204. If no mold is present, i.e., no signal is received, then method 3200 returns to step 3202. At step 3204, a sprayer timer is run. At step 3205, the sprayer conveyor is run along the direction of the row to be sprayed. At step 3206, a color product is sprayed into the empty mold along the row. At step 3207, whether the mold has reached the end of the row is determined. When the mold reaches the end of the row, a proximity sensor senses the presence of the mold at the end of the row and sends a signal to the controller. If the signal has not been received, then method 3200 returns to step 3206. If a signal has been received, then method 3200 proceeds to step 3208. At step 3208, the sprayer stops. At step 3209, the conveyor stops. At step 3210, whether all rows for the spray station has been sprayed is determined. If not, then method 3200 proceeds to step 3211. At step 3211, the sprayer is indexed to the next row. At step 3212, the conveyer is reversed to run in the opposite direction of the last row. In this way, the spray station applies the color product in a "zig-zag"-type pattern. Method 3200 then returns to step 3204. If all rows have been sprayed at step 3210, then method 3200 proceeds to step 3213.

At step 3213, the conveyor motor is powered to advance the conveyor belt and the mold to the next conveyor and/or station. At step 3214, the sprayer is returned to the "home" position. At step 3215, whether a stop command has been received is determined. If not, then method 3200 returns to step 3202. If so, then method 3200 ends at step 3216.

Figure 33:
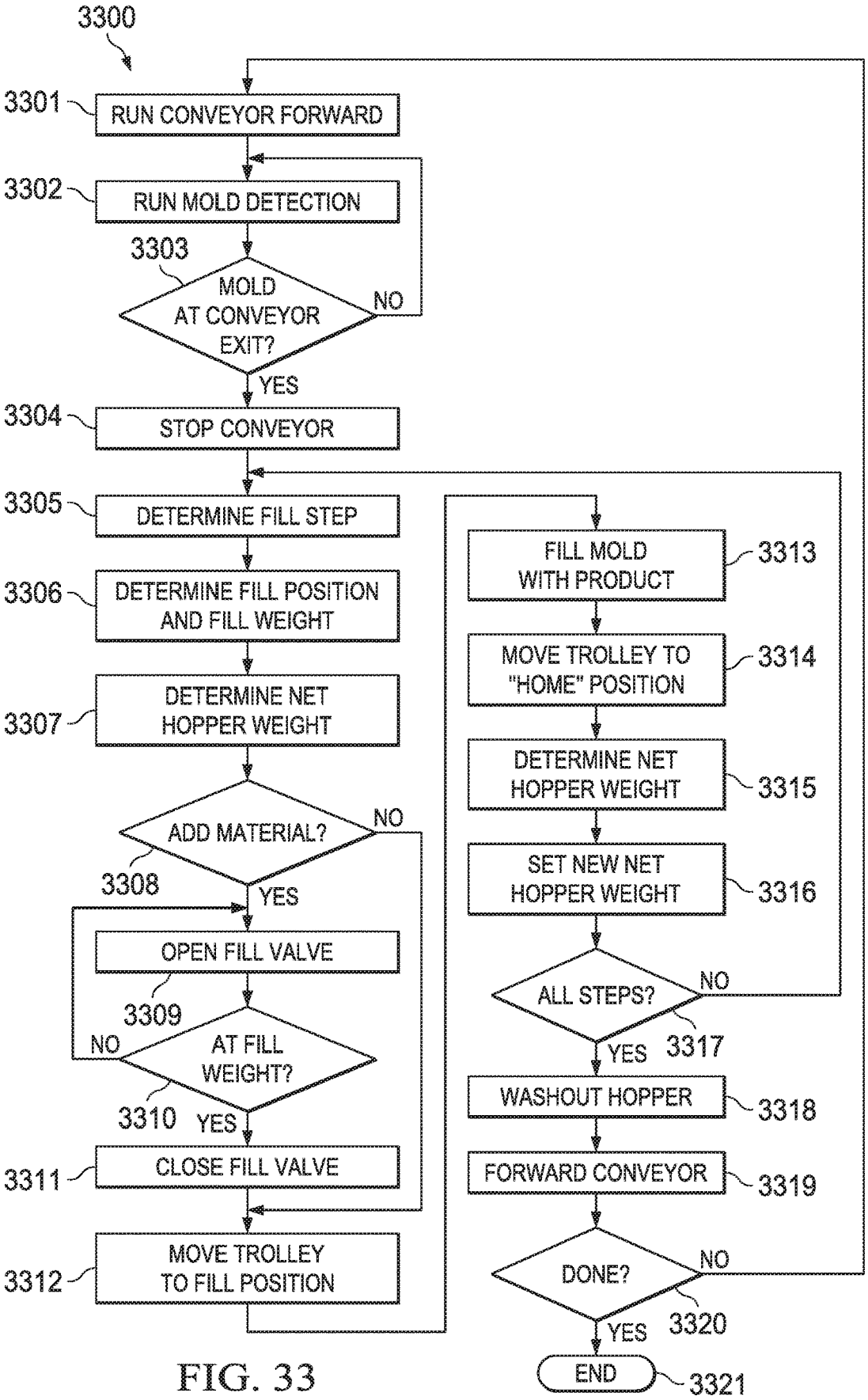
FIG. 33 is a flowchart of a method for filling a mold with a material of a preferred embodiment.

Referring to FIG. 33, step 3006 will be further described as method 3300. Each hopper trolley fill station performs method 3300 covering different fill steps. In one embodiment, the empty mold has nine (9) fill steps with each step including a fill position and a fill weight of fill material. The first fill station then fills steps one through three, the second fill station fills steps three through six, and the third fill station will fill steps seven through nine. Any fill method may be employed including one fill station covering all steps and alternating and/or random step coverage. In a preferred embodiment, each fill station has a set of trolleys spaced apart from each other at different widths to fill the different subsets of fill steps.

At step 3301, a conveyor motor of a fill station is powered to run the conveyor in a forward direction. At step 3302, a mold detection routine is run. In this step, a set of proximity sensors is enabled. At step 3303, whether a mold is present at the exit end of the fill station is determined. In this step, if the mold is present, a signal is received from the set of proximity sensors located at one end of the conveyor. If no mold is present, i.e., no signal is received, then method 3300 returns to step 3302. If so, method 3300 proceeds to step 3304 where the conveyor is stopped. At step 3305, a fill step is determined. In a preferred embodiment, the mold is divided into a set of fill positions. A fill step includes a fill position for each trolley of the fill station and a fill weight for the fill position for each trolley. The fill weight is the measured weight of a trolley and an amount of cementitious material minus the known weight of an empty trolley. In some embodiments, one or more fill steps may be skipped, due to damaged mold partitions that separate cavities of the mold. At step 3306, the fill position and the fill weight is determined from the fill step. At step 3307, a net hopper weight is determined by weighing the hopper. In this step, the hopper may contain residual cementitious material remaining in the hopper. In this way, the net hopper weight accounts for this residual cementitious material so as to not overfill the hopper and tares off the residual cementitious material.

At step 3308, whether to add cementitious material is determined. In this step, the net hopper weight is compared to the fill weight. If the net hopper weight is greater than or equal to the fill weight, then method proceeds to step 3312. If the net hopper weight is less than the fill weight, then method 3300 proceeds to step 3309. At step 3309, a fill valve is opened to fill the hopper with cementitious material. At step 3310, whether the net hopper weight is at the fill weight is determined. In this step, the net hopper weight is compared to the fill weight. If the net hopper weight is less than the fill weight, then method 3300 returns to step 3309 where the hopper continues to be filled with cementitious material. If the net hopper weight is equal to the fill weight, then method 3300 proceed to step 3311 where the fill valve is closed. At step 3312, a trolley motor is powered to move the trolley with the hopper filled with the cementitious material at the fill weight is moved to the fill position. At step 3313, an outlet valve on the hopper is opened to fill the mold with the cementitious material at the fill position. At step 3314, the trolley motor is powered to return the trolley to a "home" position at rest on a weigh frame. At step 3315, the net hopper weight is determined by weighing the hopper which may include some residual cementitious material and the known weight of the hopper. At step 3316, the measured net hopper weight is set as the new net hopper weight. At step 3317, whether all fill steps have been completed is determined. If all fill steps have not been completed, then method 3300 returns to step 3305. If not, then method 3300 proceeds to step 3318 where the hopper is washed out with water. At step 3319, the conveyor motor is powered to move the conveyor and thereby move the mold forward. At step 3320, whether a stop signal has been received is determined. If not, then method 3300 returns to step 3301. If so, then method 3300 ends at step 3321.

Figure 34:
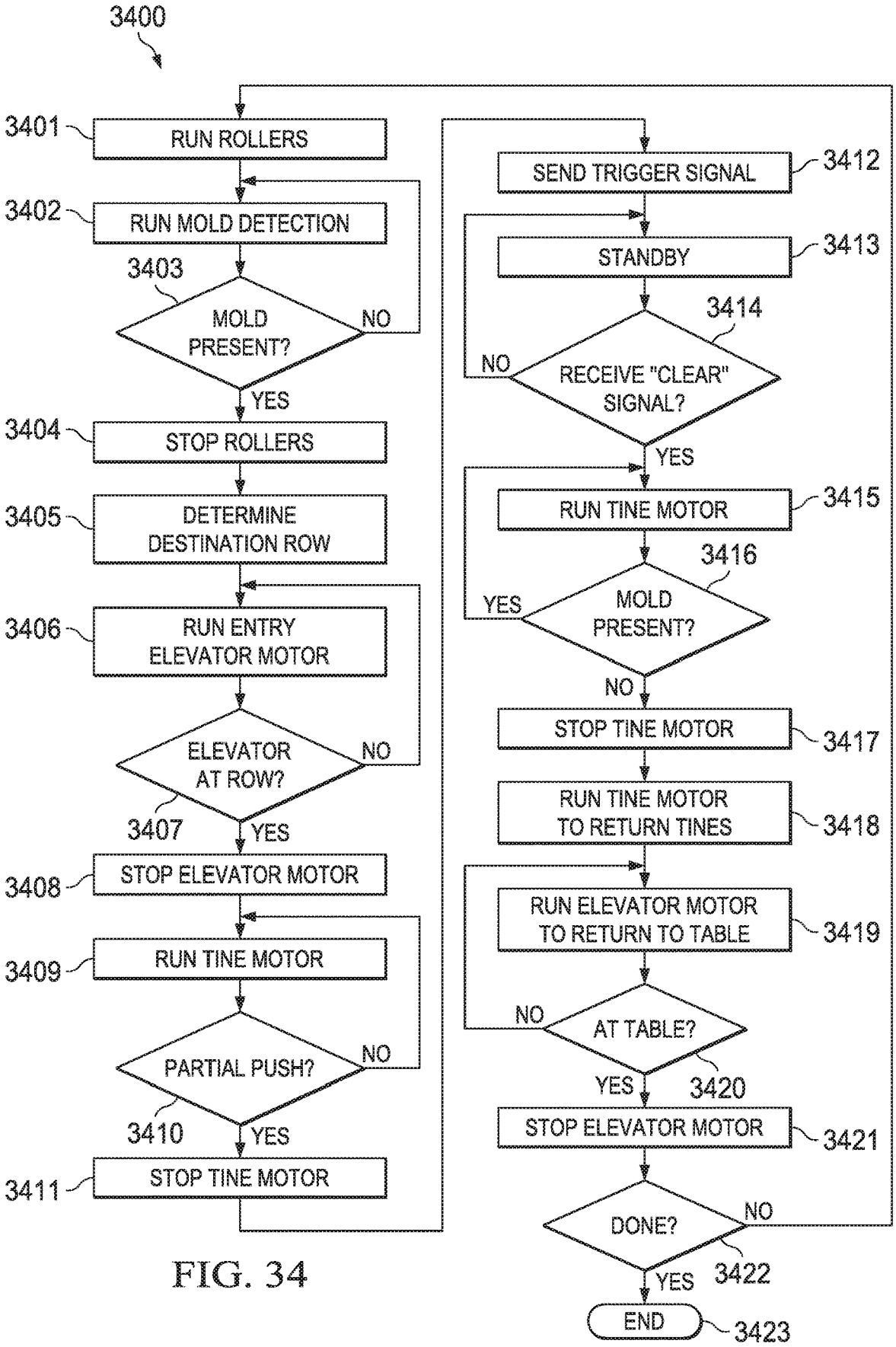
FIG. 34 is a flowchart of a method for filling a drying rack with a mold of a preferred embodiment.

Referring to FIG. 34, step 3007 will be further described as method 3400. At step 3401, a roller motor is powered to run a set of rollers to receive a mold filled with wet cementitious material. At step 3402, a mold detection routine is run. In this step, a set of proximity sensors is enabled. At step 3403, whether a mold is present at the entry elevator table is determined. In this step, if a mold is present, a signal is received from the set of proximity sensors. If no mold is present, i.e., no signal is received, then method 3400 returns to step 3402. If so, method 3400 proceeds to step 3404 where the set of rollers is stopped. At step 3405, a destination row for the wet mold is determined. In this step, a set of proximity sensors are enabled adjacent to the destination row. To determine which set of proximity sensors to enable, the controller determines the dwell or dry time of a full row of molds. If the dry time is equal to or greater than a predetermined dry time, then that full row is the destination row. At step 3406, an entry elevator motor is powered to raise a set of entry elevator tines to the destination row. At step 3407, whether the set of entry elevator tines is the destination row is determined. In this step, if a signal from the set of proximity sensors adjacent to the destination row is received, then the set of entry elevator tines is at the destination row and the elevator motor is stopped at step 3408. If no signal is received at step 3407, then method 3400 returns to step 3406.

At step 3409, a tine motor is powered to run a set of entry elevator tine chains with a weldment attached thereto to partially push the wet mold into the drying rack. As a result of the row full of molds, a mold at the exit will be partially pushed out of the drying rack. At step 3410, whether the mold has been pushed a partial push distance is determined. The partial push distance is less than the length of the mold. If the mold has been pushed into the drying rack by the partial push distance, then method 3400 proceeds to step 3411 where the tine motor is stopped. If the mold has not been pushed into the drying rack by the partial push distance, then method 3400 returns to step 3409. At step 3412, a trigger signal is sent to the controller, which is then relayed to the exit elevator. At step 3413, the set of entry elevator tines stands by in the partial push position. At step 3414, whether a clear signal, indicating that the partially pushed out mold on the exit end of the drying rack has been retrieved, has been received from the exit elevator is determined. If not, then method 3400 returns to step 3413. If so, then method 3400 proceeds to step 3415 where the tine motor is run to continue to push the mold into the drying rack.

At step 3416, a determination is made as to whether the mold is present on the set of entry elevator tines. If a signal is received from a set of sensors on the set of entry elevator tines, then method 3400 returns to step 3415. If the signal is not received, then method 3400 proceeds to step 3417 where the tine motor is stopped. At step 3418, the tine motor is run in reverse to return the set of tine chains and the weldment to a "home" position. At step 3419, the elevator motor is run in reverse to return the set of tines to the entry elevator table. At step 3420, whether the set of tines is at the entry elevator table is determined by a set of sensors. If a signal is received from the set of sensors, then the elevator motor stops at step 3421. If not, then method 3400 returns to step 3419. At step 3422, whether a stop command has been received is determined. If not, then method 3400 returns to step 3401. If so, then method 3400 ends at step 3423.

Figure 35:
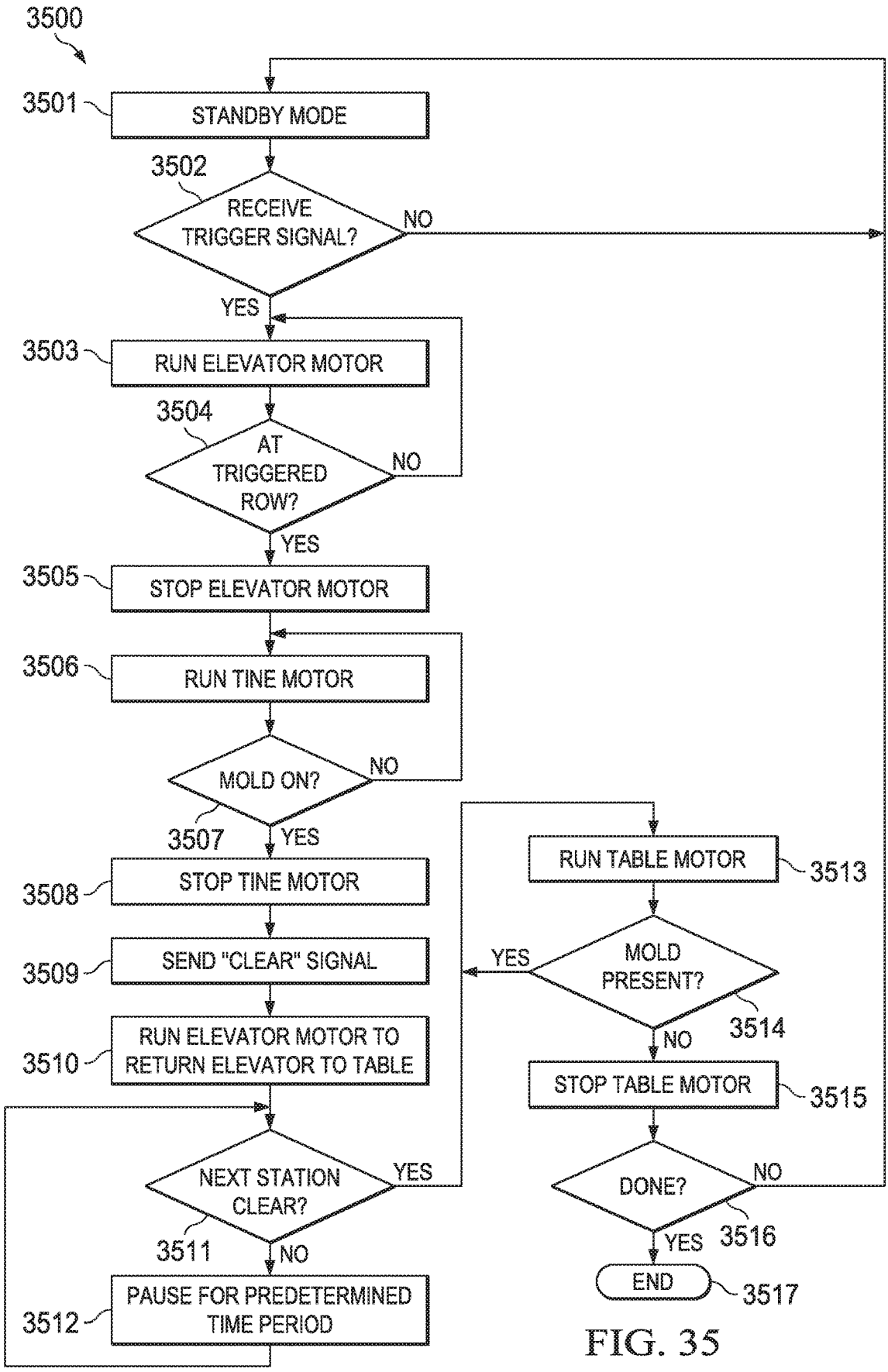
FIG. 35 is a flowchart of a method for retrieving a mold from a drying rack of a preferred embodiment.

Referring to FIG. 35, step 3010 will be further described as method 3500. At step 3501, a set of exit elevator tines is in a standby mode. At step 3502, whether a trigger signal from the entry elevator has been received is determined. The trigger signal indicates the destination row where a dry mold is partially protruding from the drying rack. If not, then method 3500 returns to step 3501. If so, then method 3500 proceeds to step 3502 where the exit elevator motor is run to raise the set of exit elevator tines to the triggered row. At step 3504, whether the set of exit elevator tines is at the destination row is determined. In this step, if a signal from a set of proximity sensors adjacent to the destination row is received, then the set of exit elevator tines is at the destination row and the exit elevator motor is stopped at step 3505. If no signal is received at step 3504, then method 3500 returns to step 3503.

At step 3506, a tine motor is powered to frictionally engage and retrieve the partially protruding dry mold. At step 3507, whether the mold is completely on the set of exit elevator tines is determined. If a signal has been received from a set of sensors mounted on the stop of the set of exit elevator tines, then the tine motor is stopped at step 3508. If not, then method 3500 returns to step 3506.

At step 3509, a "clear" signal is sent to the entry elevator. At step 3510, the exit elevator motor is powered to return the set of exit elevator tines to the exit elevator table. At step 3511, whether the next station adjacent to the exit elevator table is clear is determined. If not, then method 3500 proceeds to step 3512 where method 3500 is paused for a predetermined period of time and returns to step 3511. In a preferred embodiment, the predetermined period of time is approximately thirty (30) seconds. Other time periods may be employed. If the next station is clear in step 3511, then method 3500 proceeds to step 3513. At step 3513, a table motor is powered to run a set of table rollers to move the dry mold to the next station. At step 3514, whether the mold is present on the exit table is determined. If a signal is received from a set of exit sensors on the exit table, then the mold is present and method 3500 returns to step 3513. If no signal is received, then the mold is not present and the table motor is stopped at step 3515. At step 3516, whether a stop command has been received is determined. If not, then method 3500 returns to step 3501. If so, then method 3500 ends at step 3517.

Figure 36:
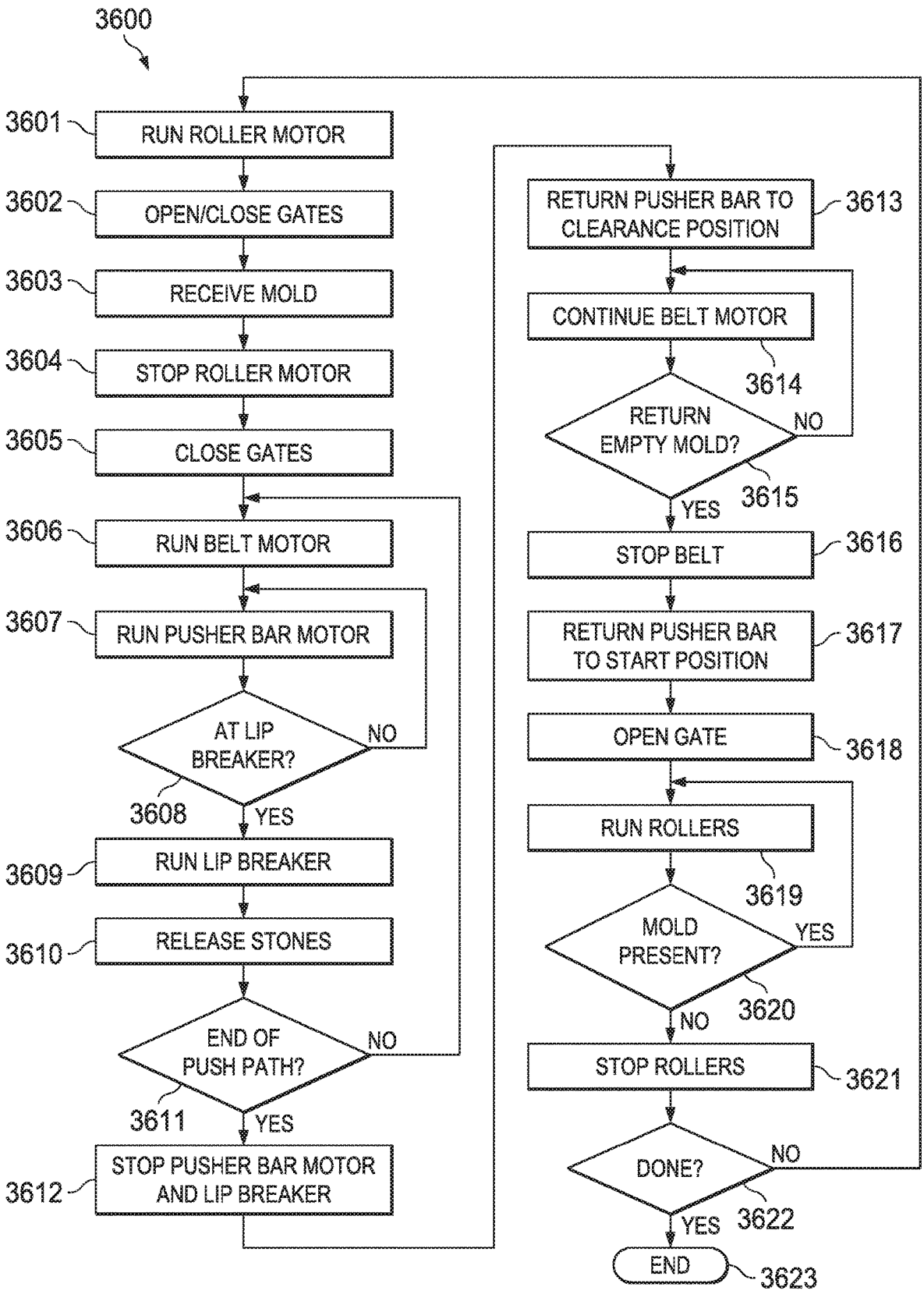
FIG. 36 is a flowchart of demolding stones from a mold of a preferred embodiment.

Referring to FIG. 36, step 3011 will be further described as method 3600. At step 3601, a motor for a set of rollers is run. At step 3602, a first gate of the demolder is open and a second gate of the demolder is closed based on which side of the demolder is the entrance. At step 3603, a mold and a slave board are received. At step 3604, the roller motor is stopped to stop the set of rollers. At step 3605, any open gate of the demolder is closed. At step 3606, a belt motor is run to move the belt. At step 3607, a pusher bar motor is run to urge the mold off the slave board. At step 3608, whether the mold has reached the lip breaker is determined. If a signal is received from a set of sensors adjacent to the lip breaker, then the mold is at the lip breaker and method proceeds to step 3609. If no signal is received, then method 3600 returns to step 3607.

At step 3609, a set of actuators are powered to run the lip breaker. At step 3610, a set of stones are released from the mold. At step 3611, whether the pusher bar has reached the end of a push path is determined. If a signal is received from a set of sensors adjacent to an end of a chain drive to which the pusher bar is attached, then the pusher bar has reached the end of the push path and method 3600 proceeds to step 3612 where the pusher bar motor and the lip breaker are stopped. If at step 3611 a signal is not received, then method 3600 returns to step 3606.

At step 3613, the pusher bar motor is powered to return the pusher bar to a clearance position. At step 3614, the belt motor continues to run. At step 3615, whether the empty mold has returned to the slave board on the roller table is determined. If a signal is received from a set of sensors adjacent to the roller table, then the mold has returned to the roller table, and method 3600 proceeds to step 3616 where the belt motor is stopped. If, at step 3615 no signal is received, then method 3600 returns to step 3614.

At step 3617, the pusher bar motor is powered to return the pusher bar to a start position. At step 3618, a gate is opened. At step 3619, the roller motor is powered to move the empty mold and slave board out of the demolder. At step 3620, whether the mold is present on the roller table is determined. If a signal is received from a set of exit sensors on the roller table, then the mold is present and method 3600 returns to step 3619. If no signal is received, then the mold is not present and the roller motor is stopped at step 3621. At step 3622, whether a stop command has been received is determined. If not, then method 3600 returns to step 3601. If so, then method 3600 ends at step 3623.

Figure 37:
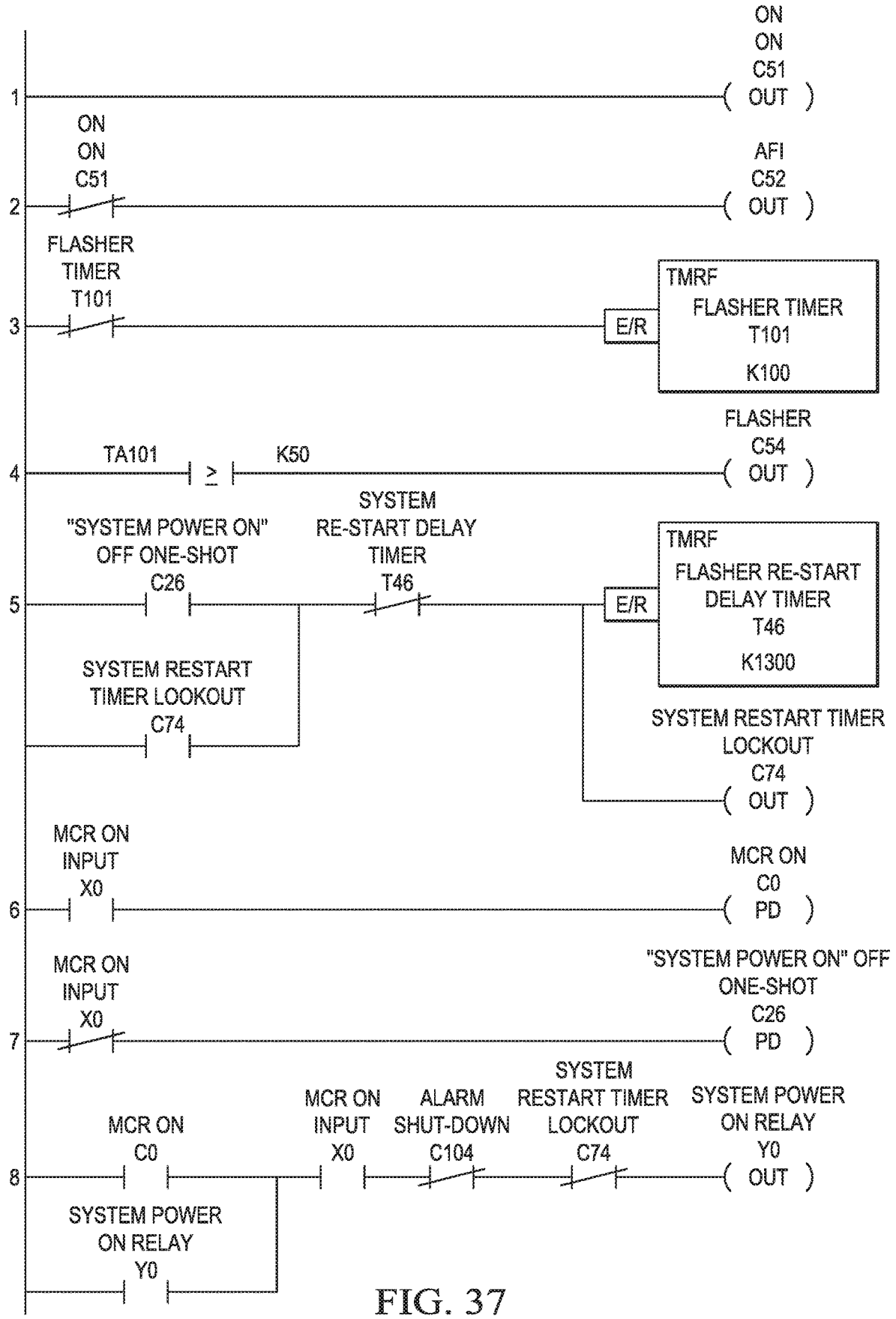
FIGS. 37-248 is a program code implementing the methods of the conveyor and elevator system of a preferred embodiment.
Figure 38:
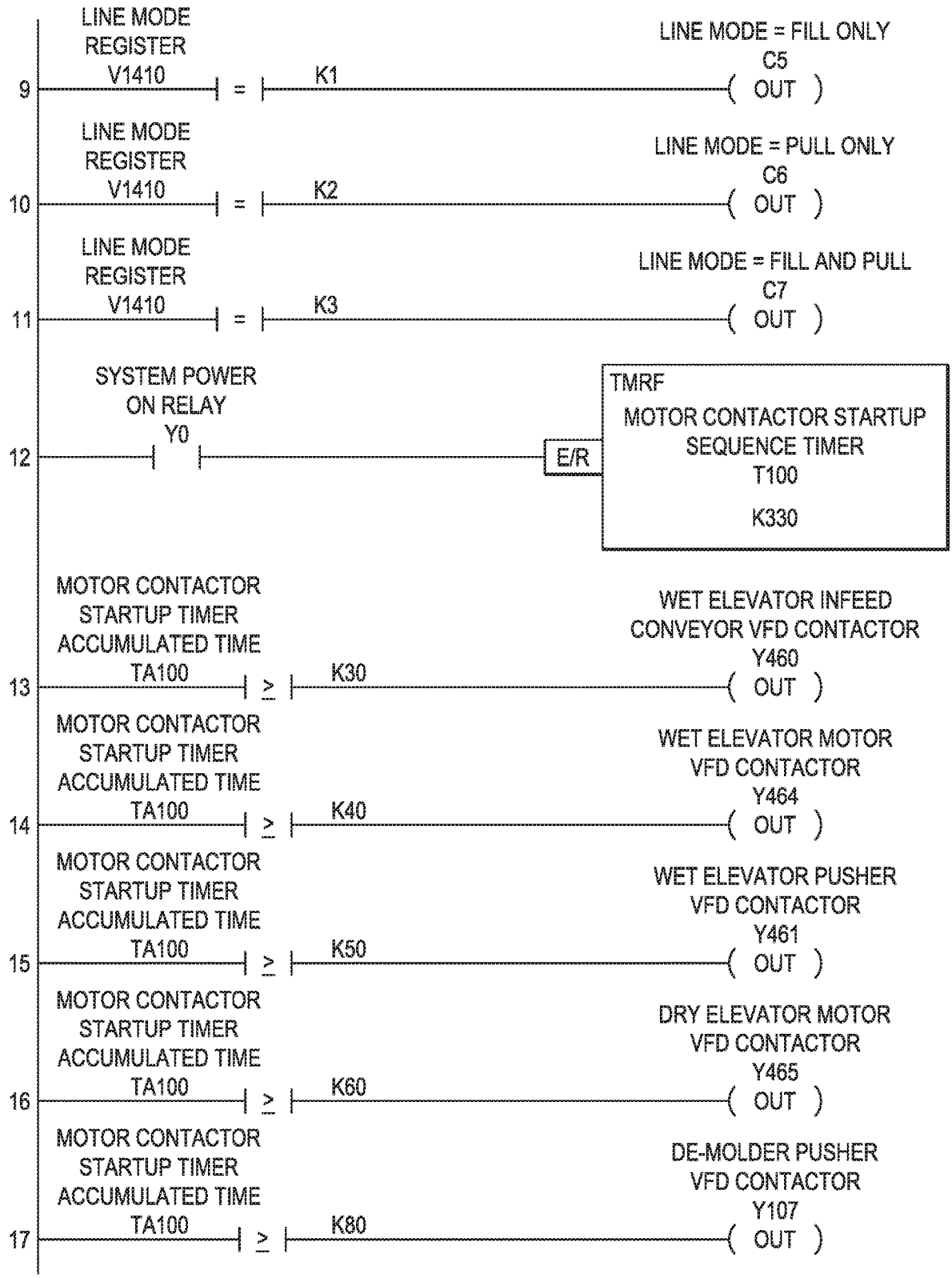
Figure 39:
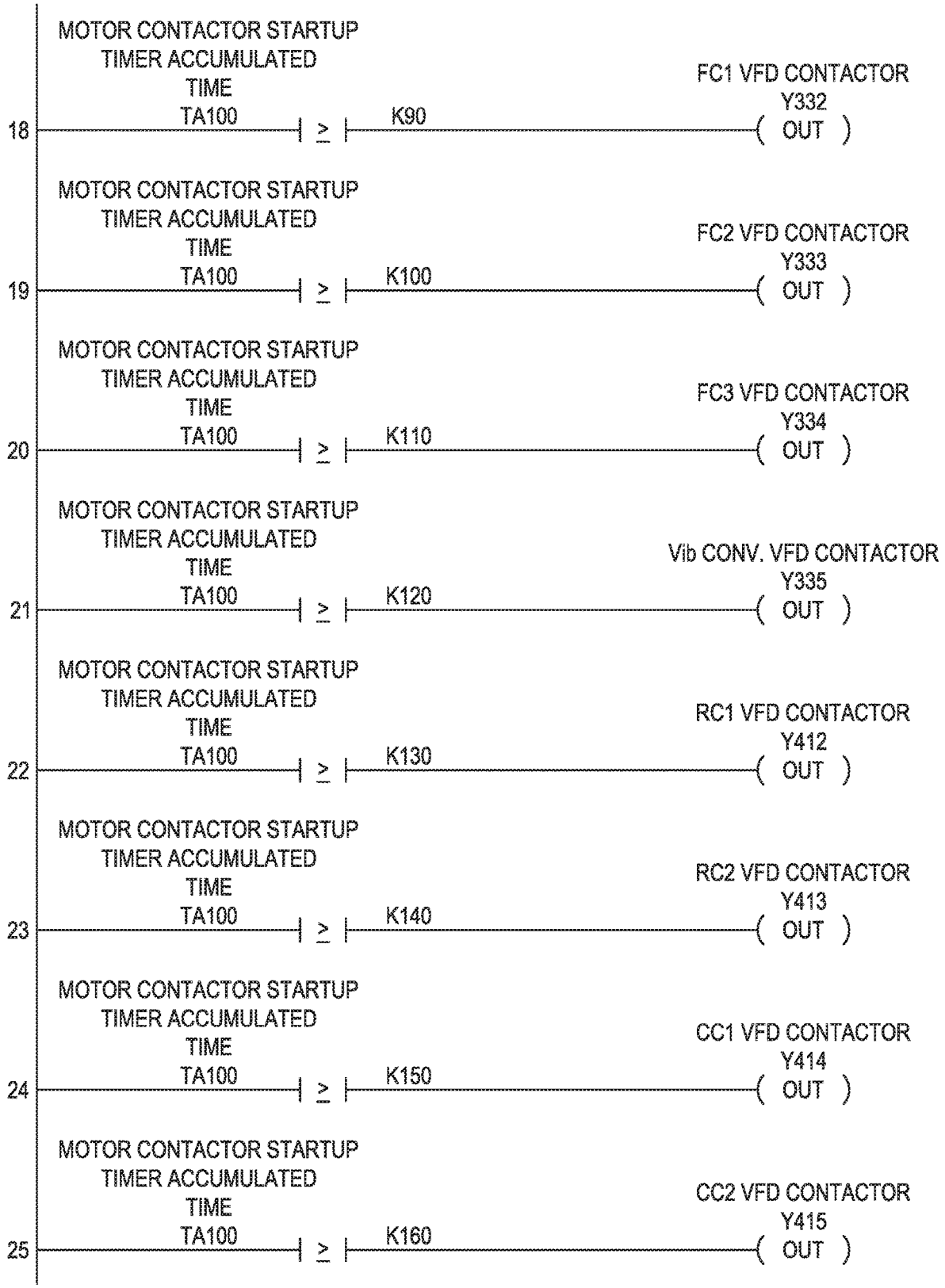
Figure 40:
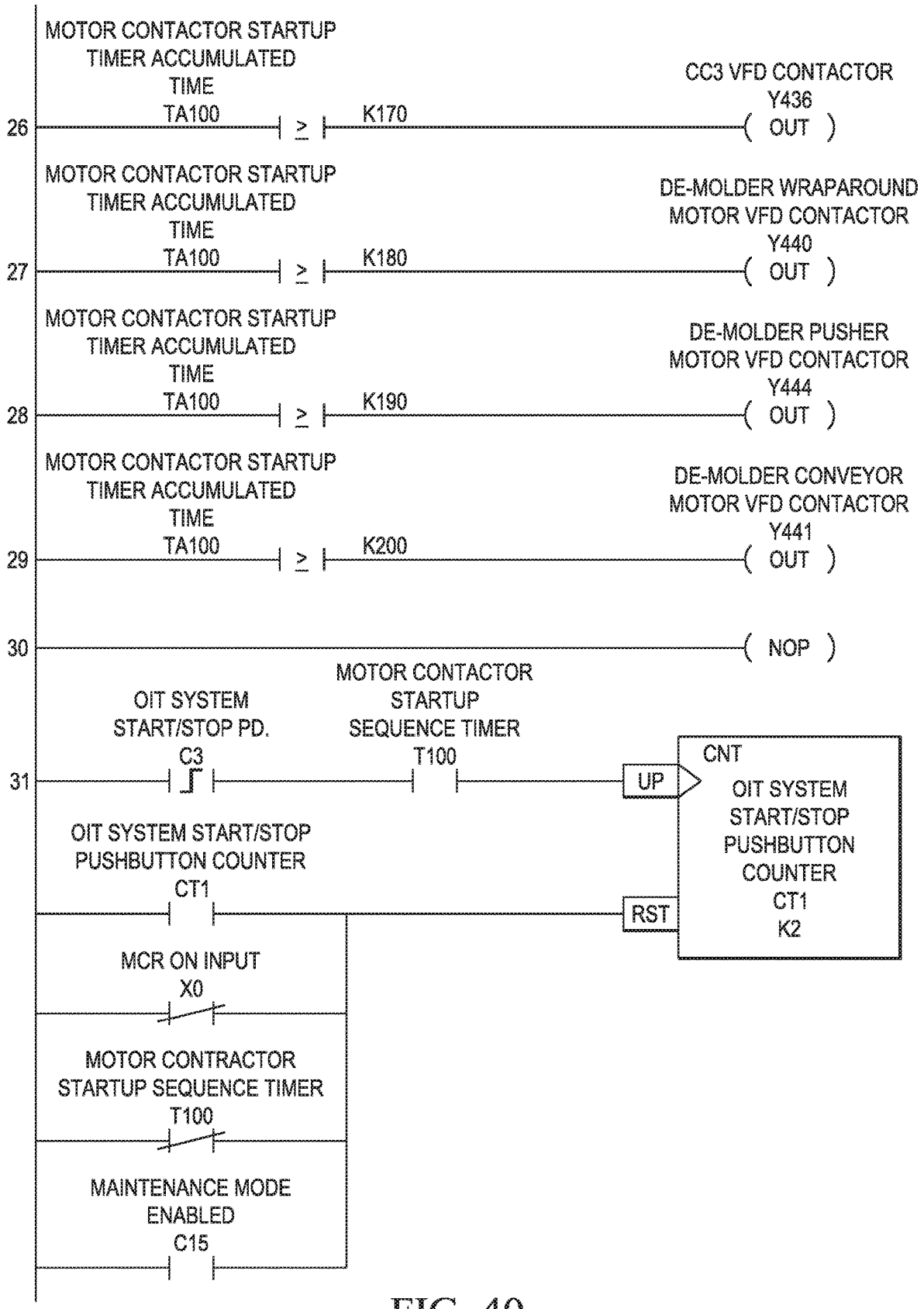
Figure 41:
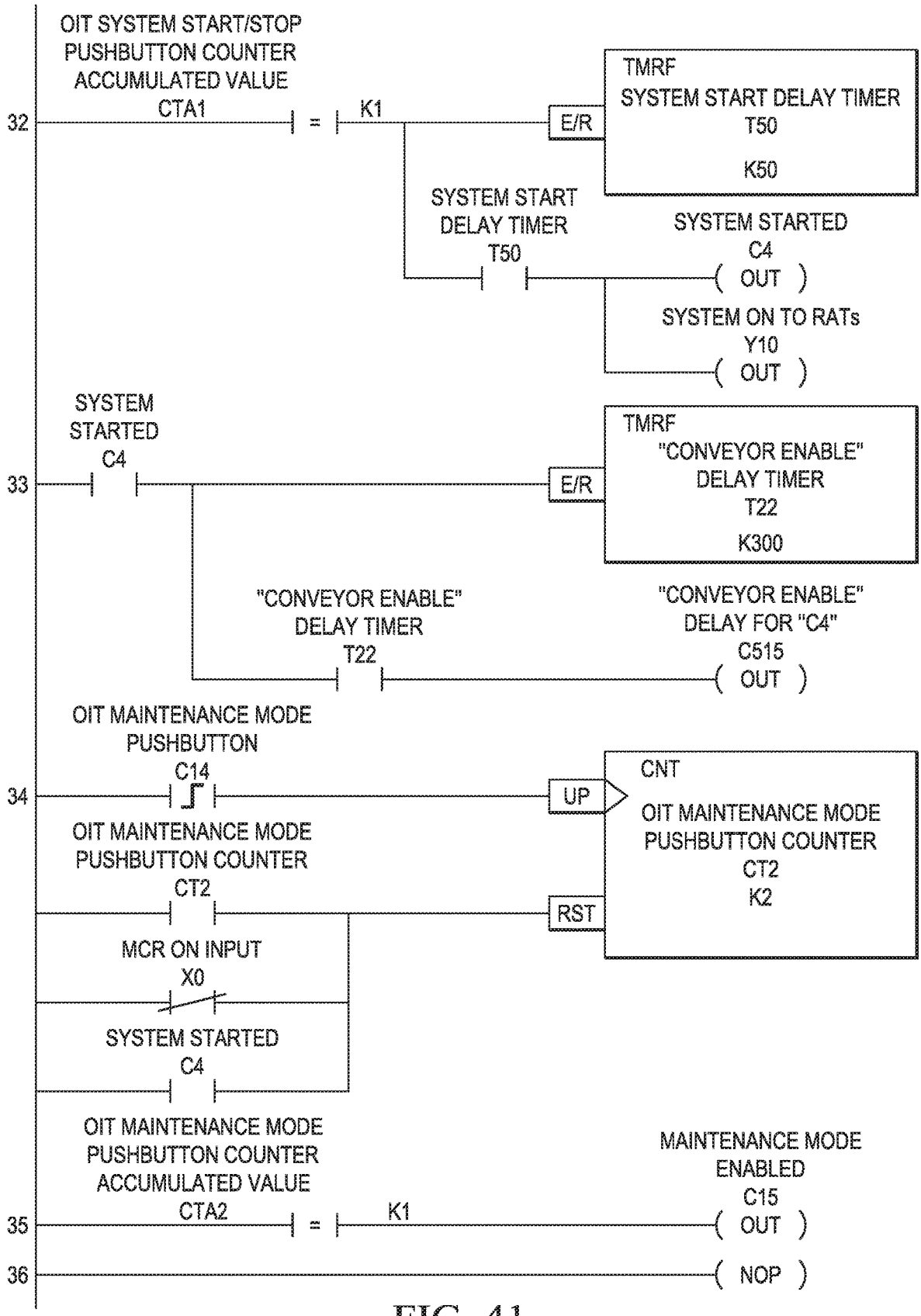
Figure 42:
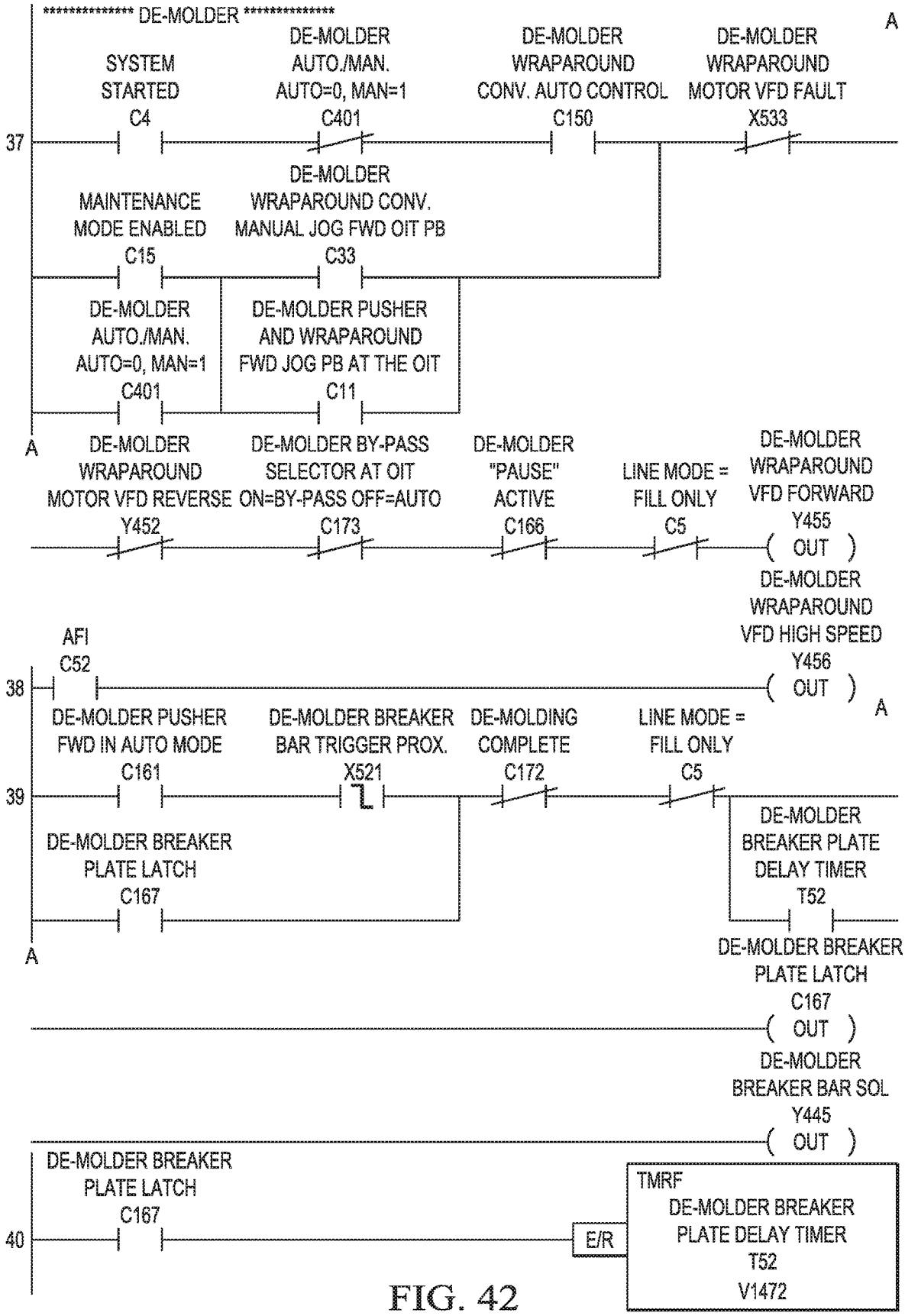
Figure 43:
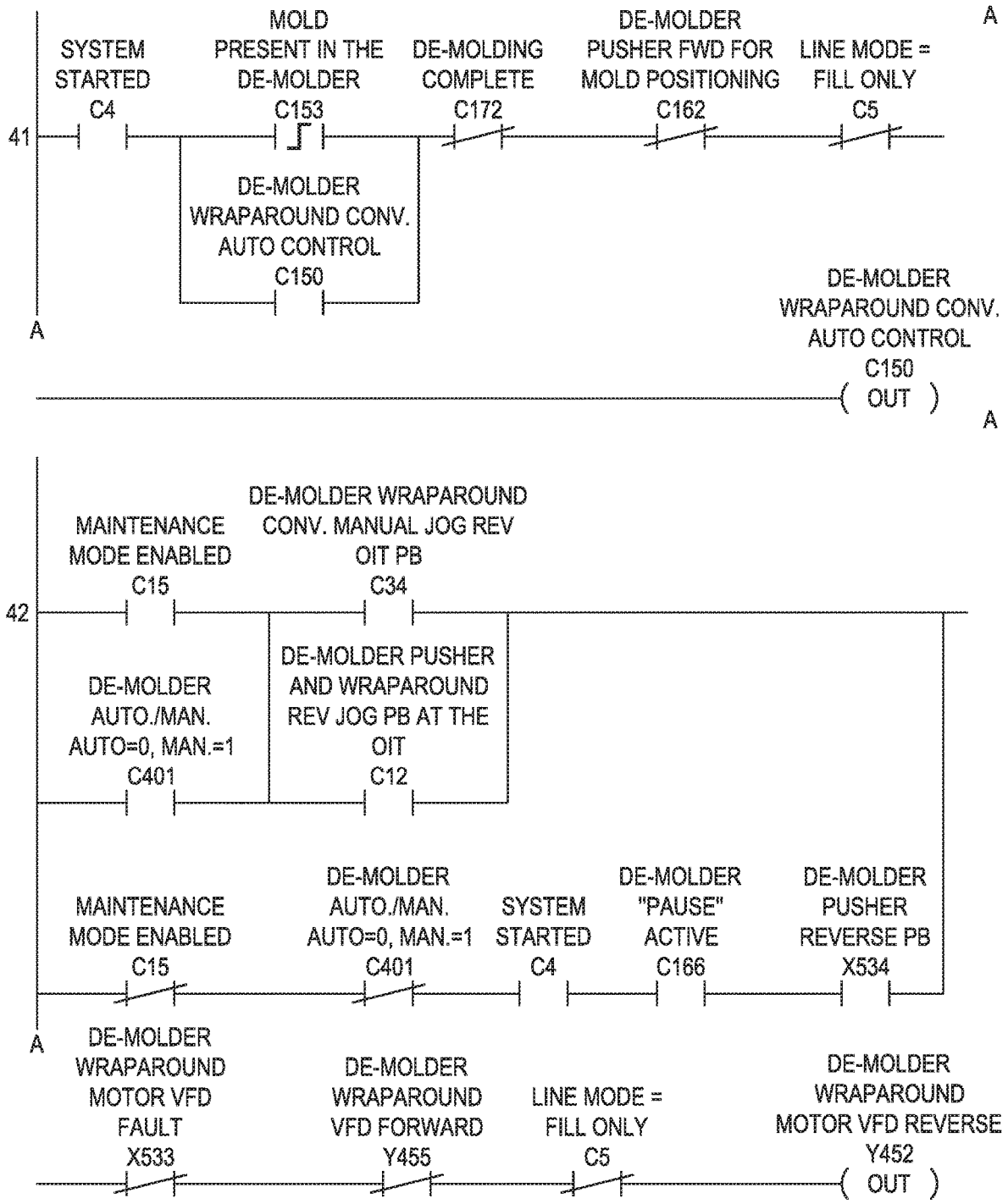
Figure 44:
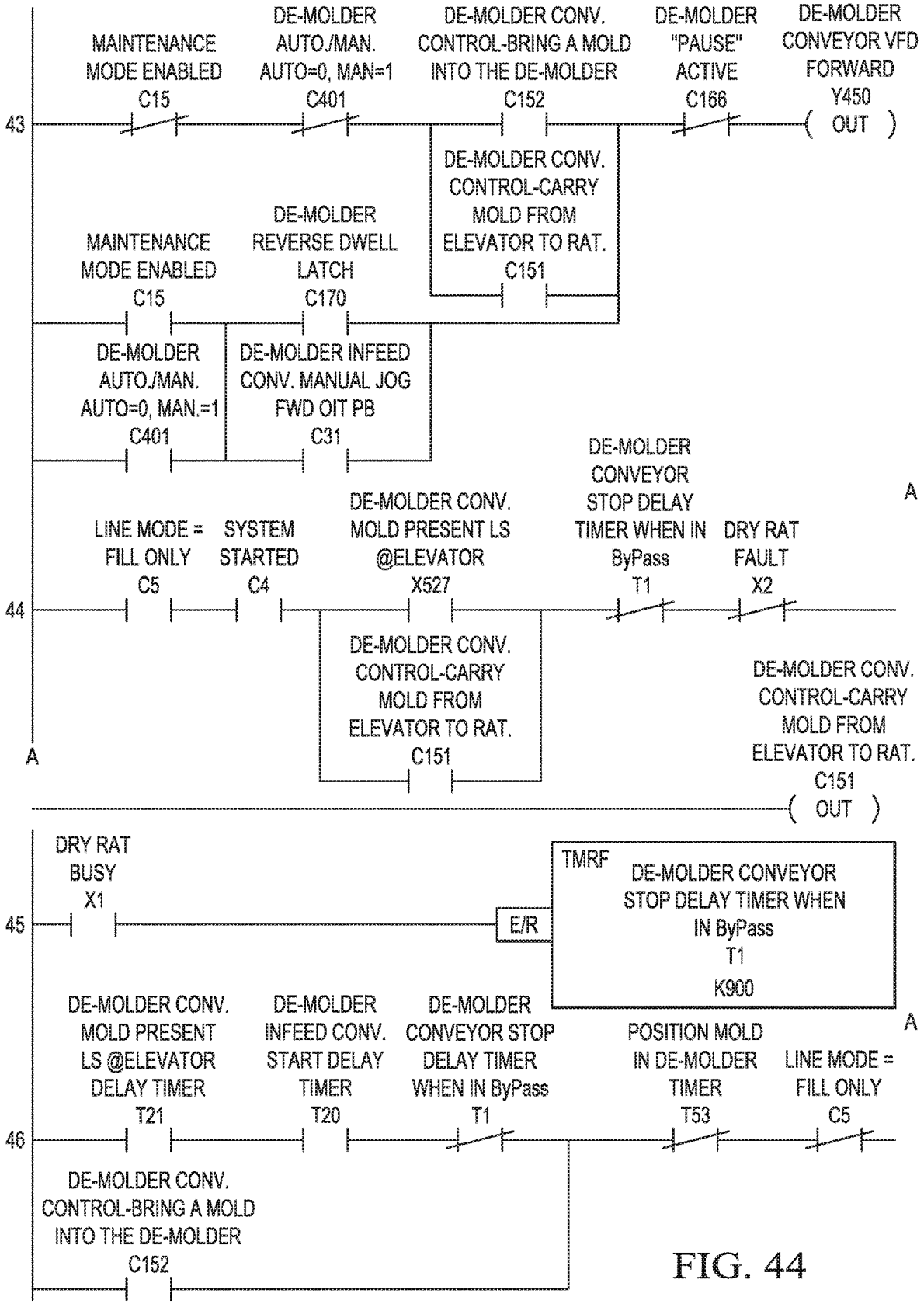
Figure 45:
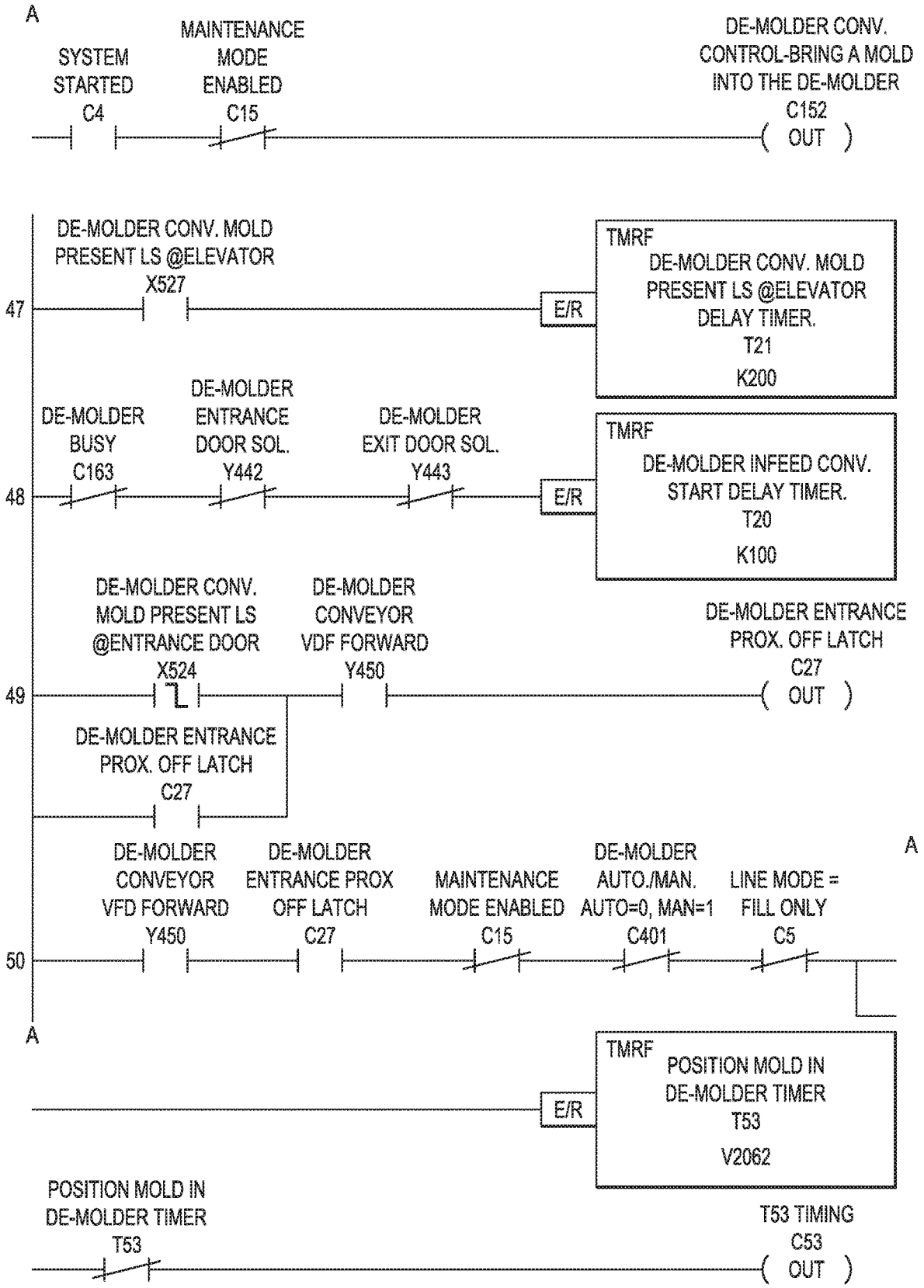
Figure 46:
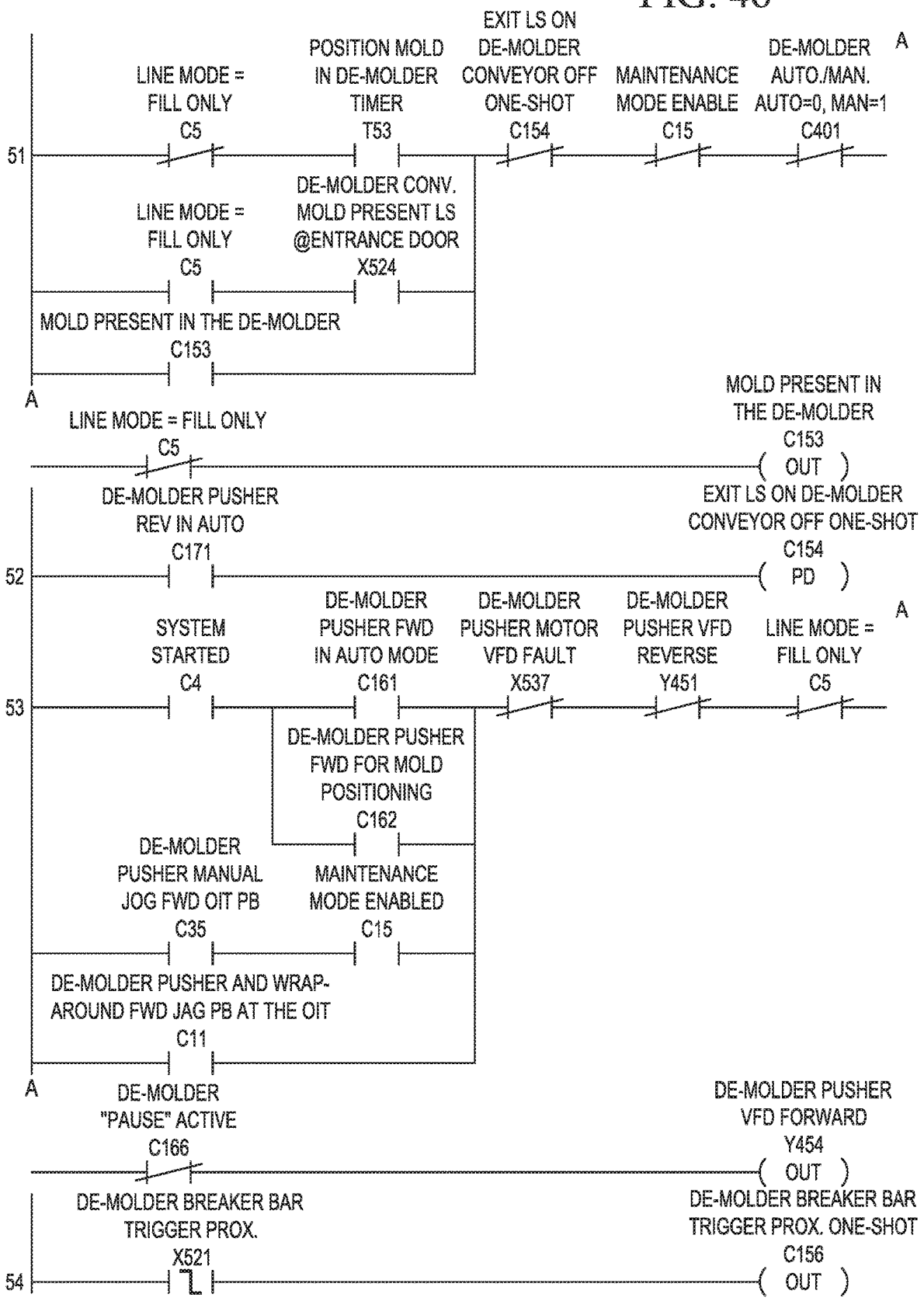
Figure 47:
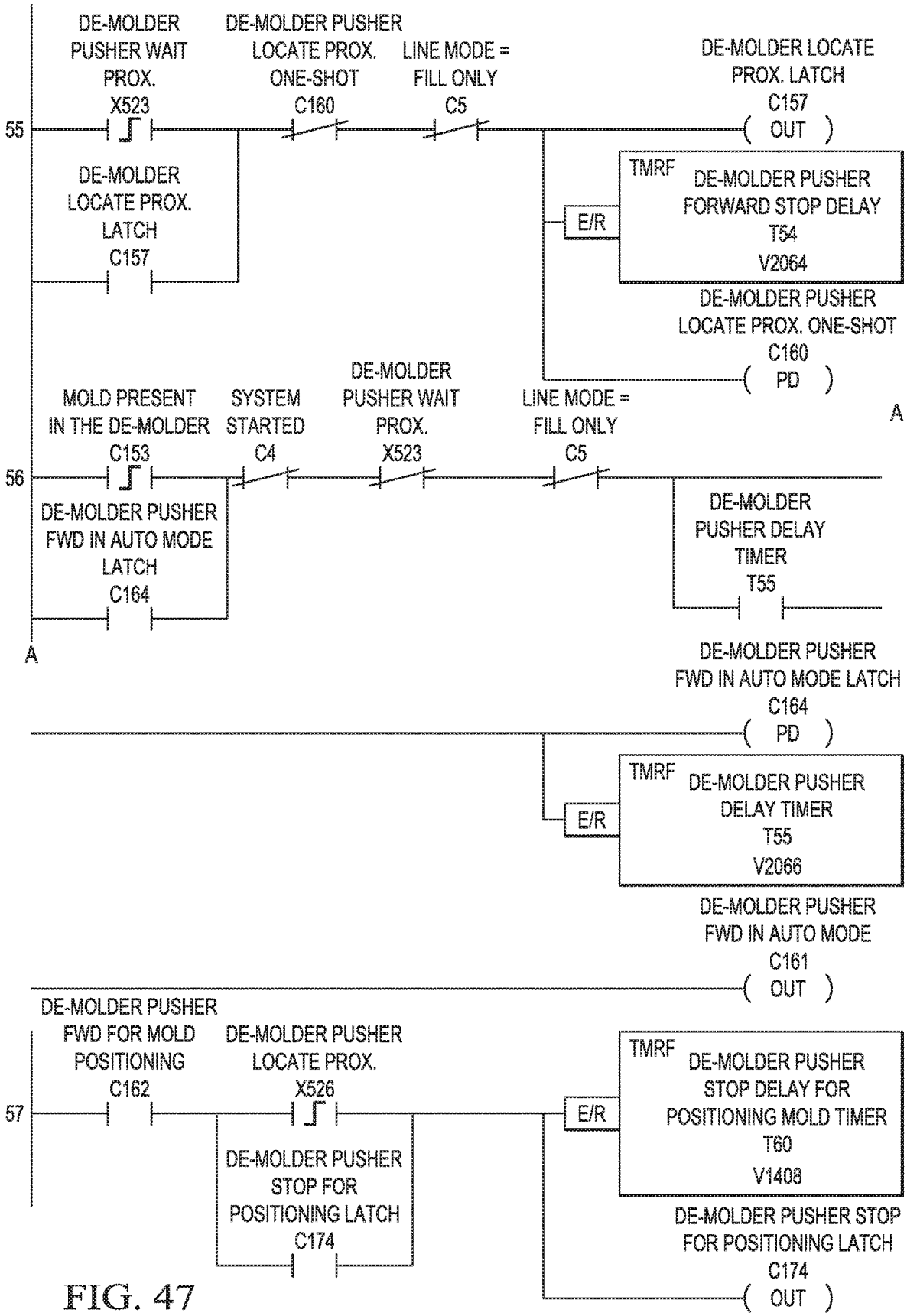
Figure 48:
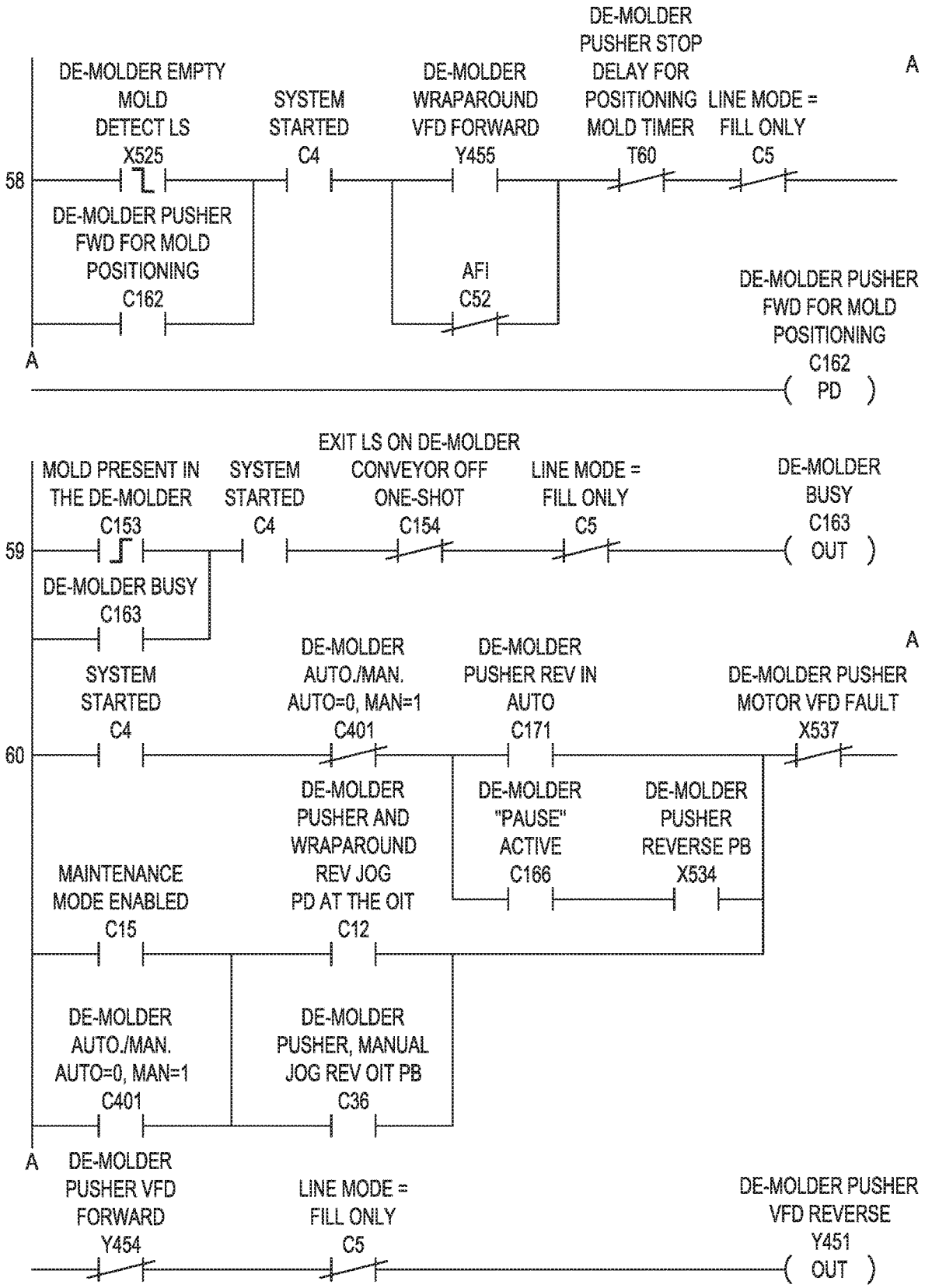
Figure 49:
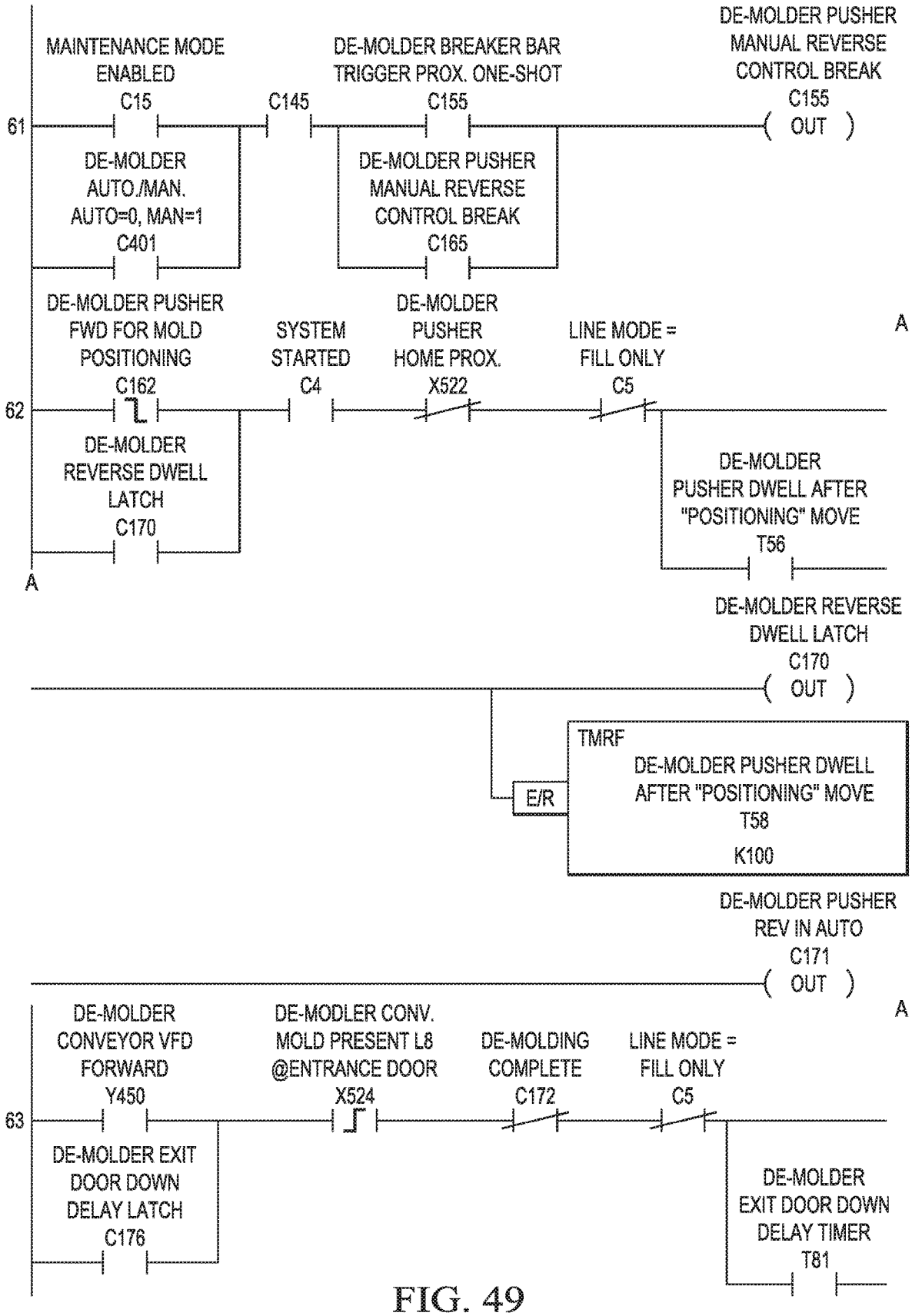
Figure 50:
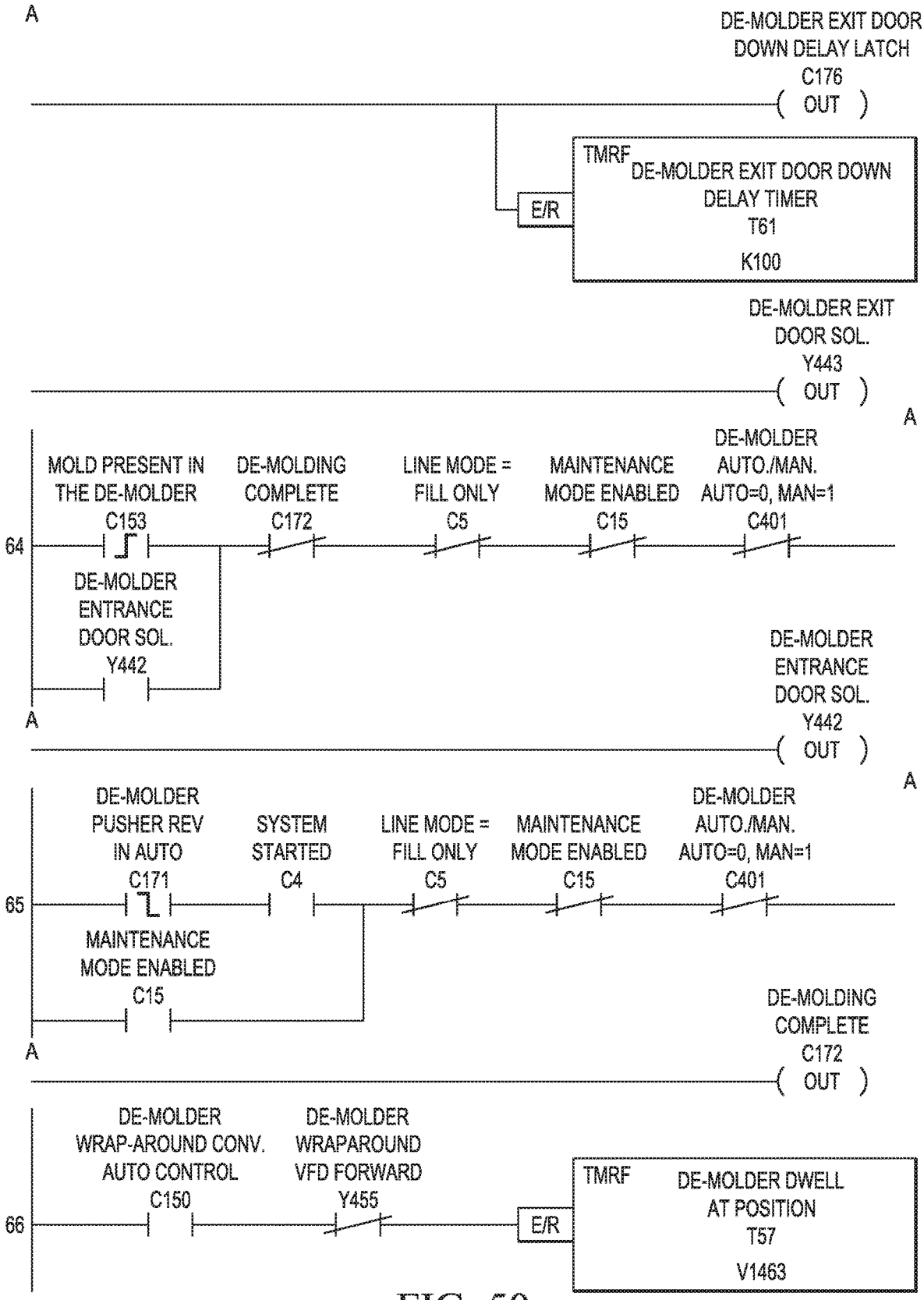
Figure 51:
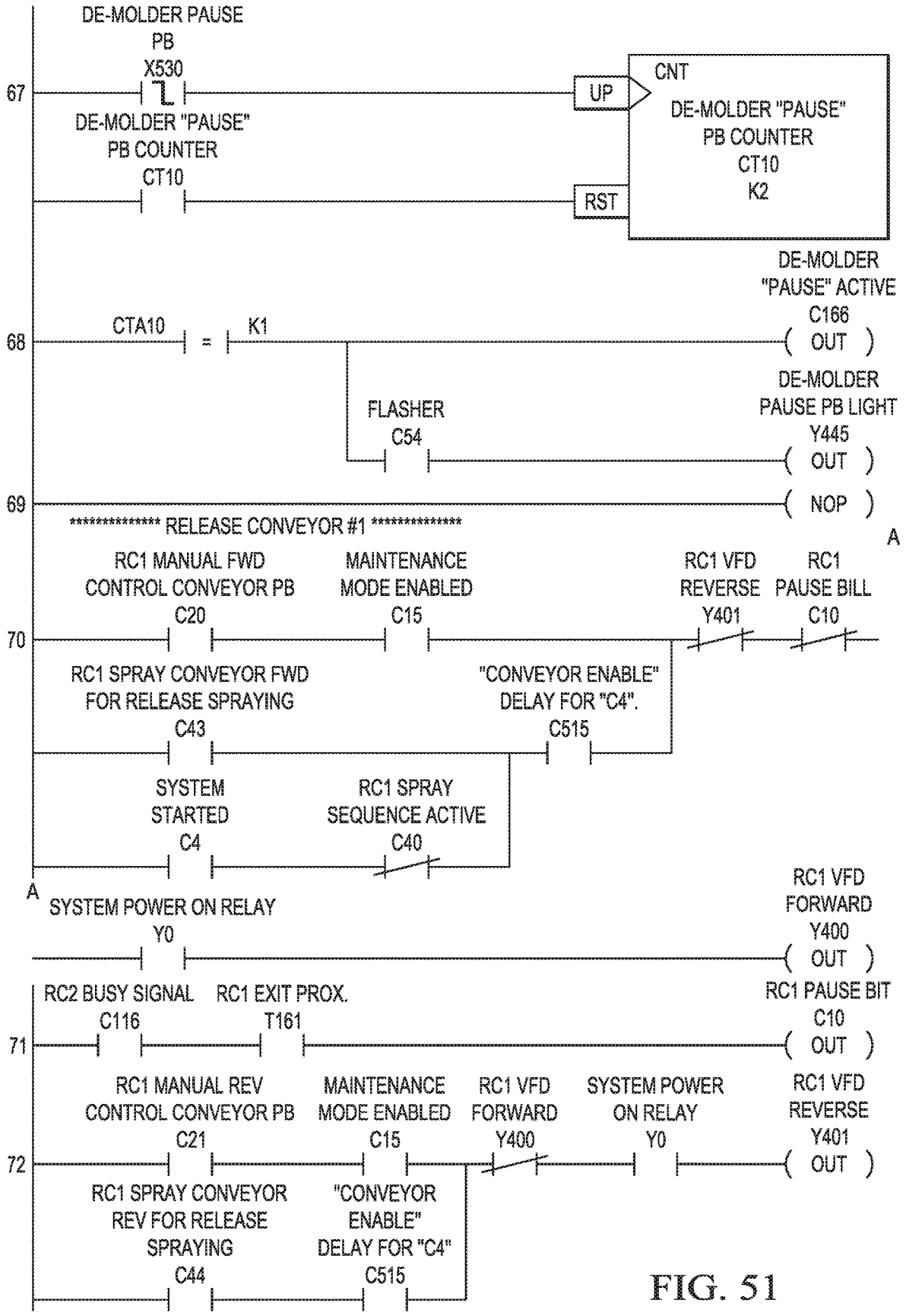
Figure 52:
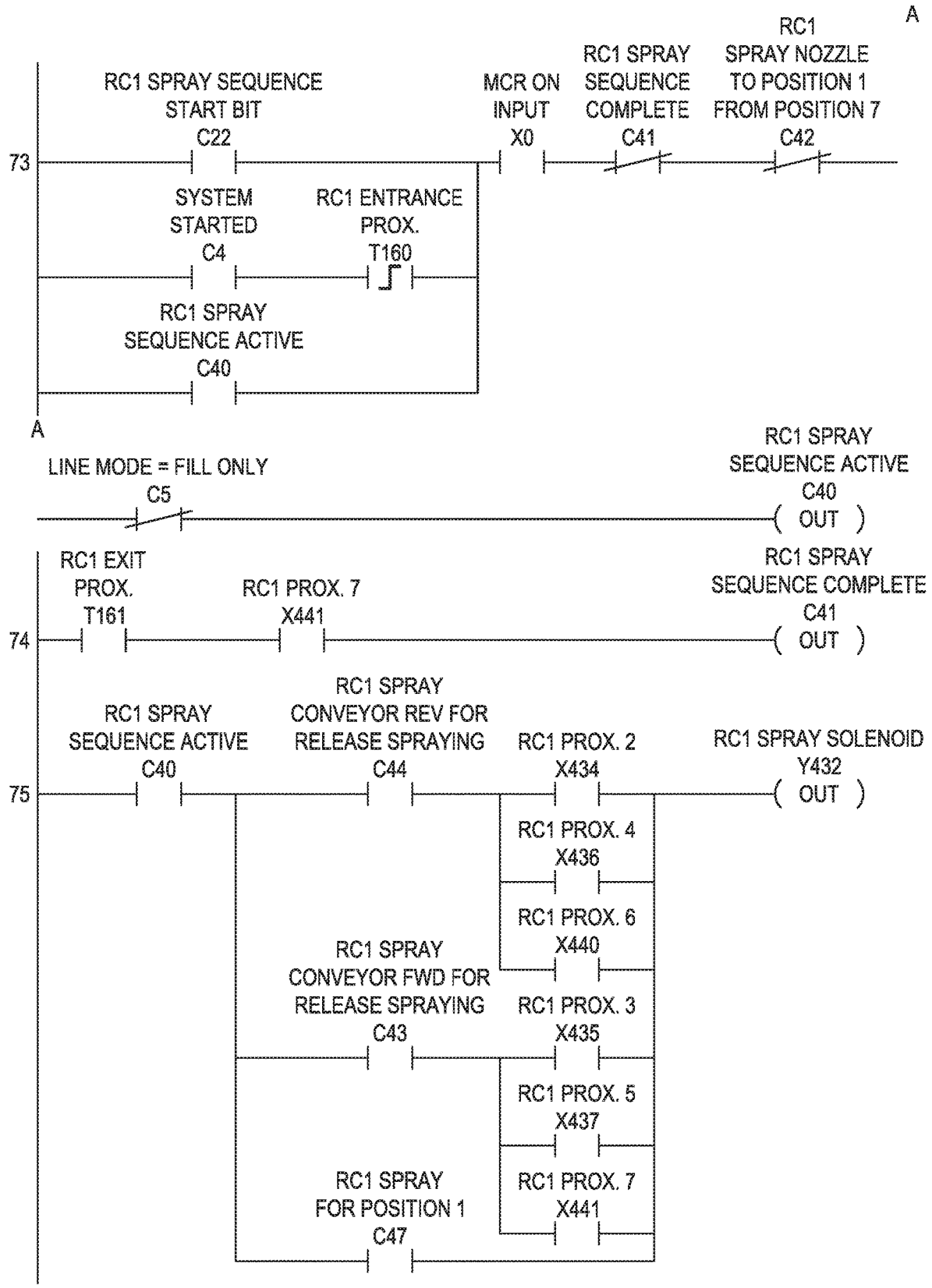
Figure 53:
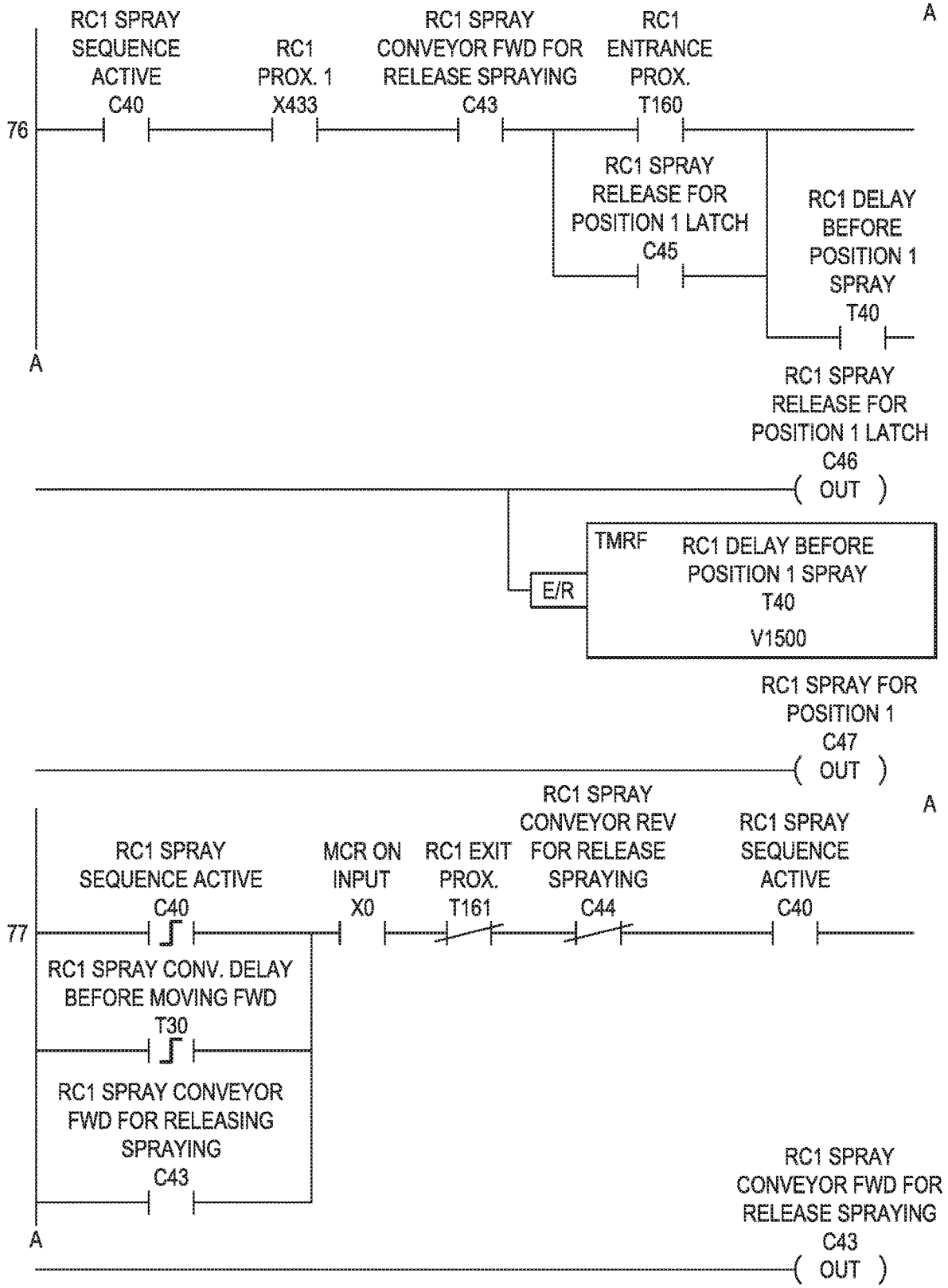
Figure 54:
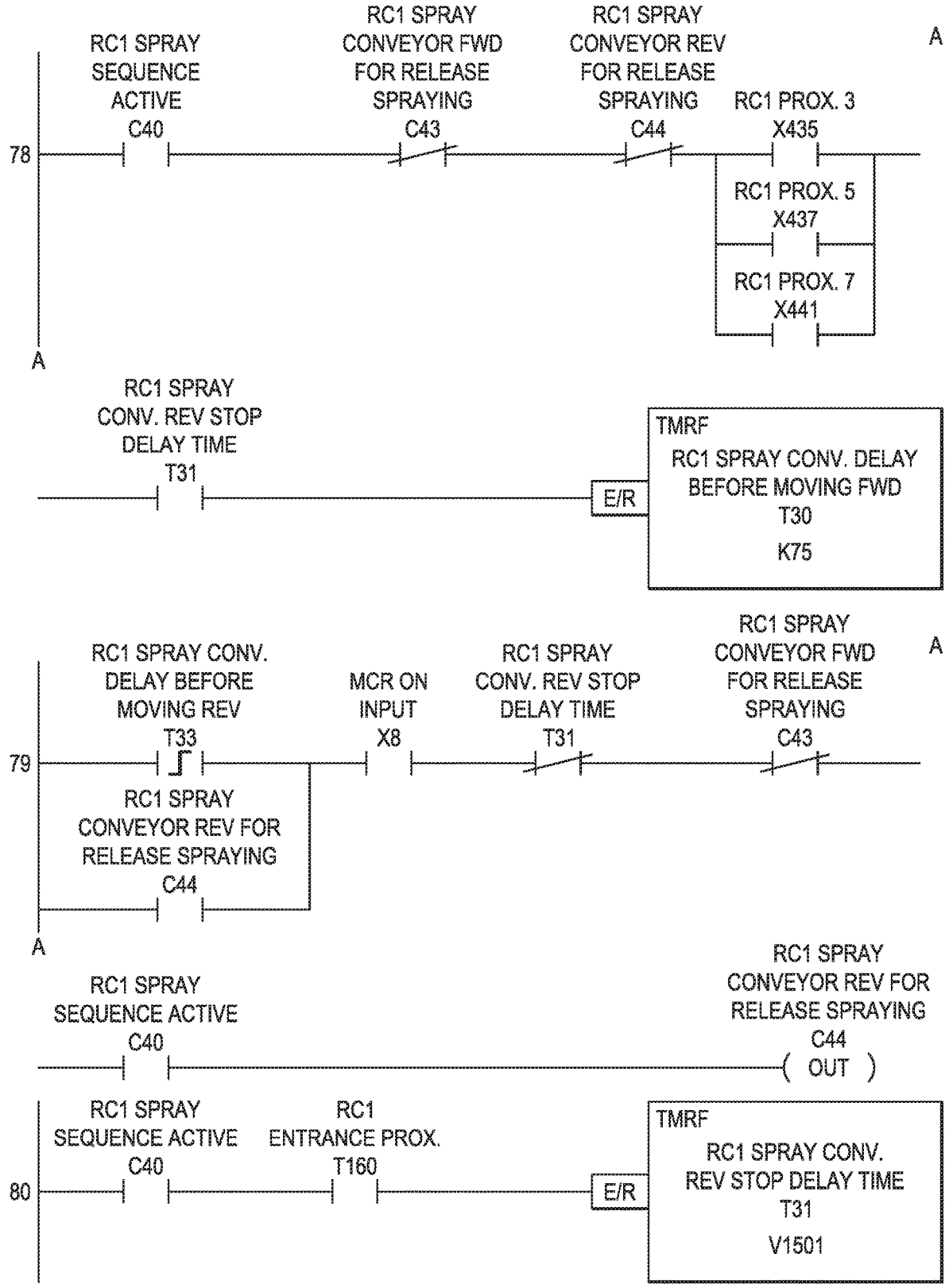
Figure 55:
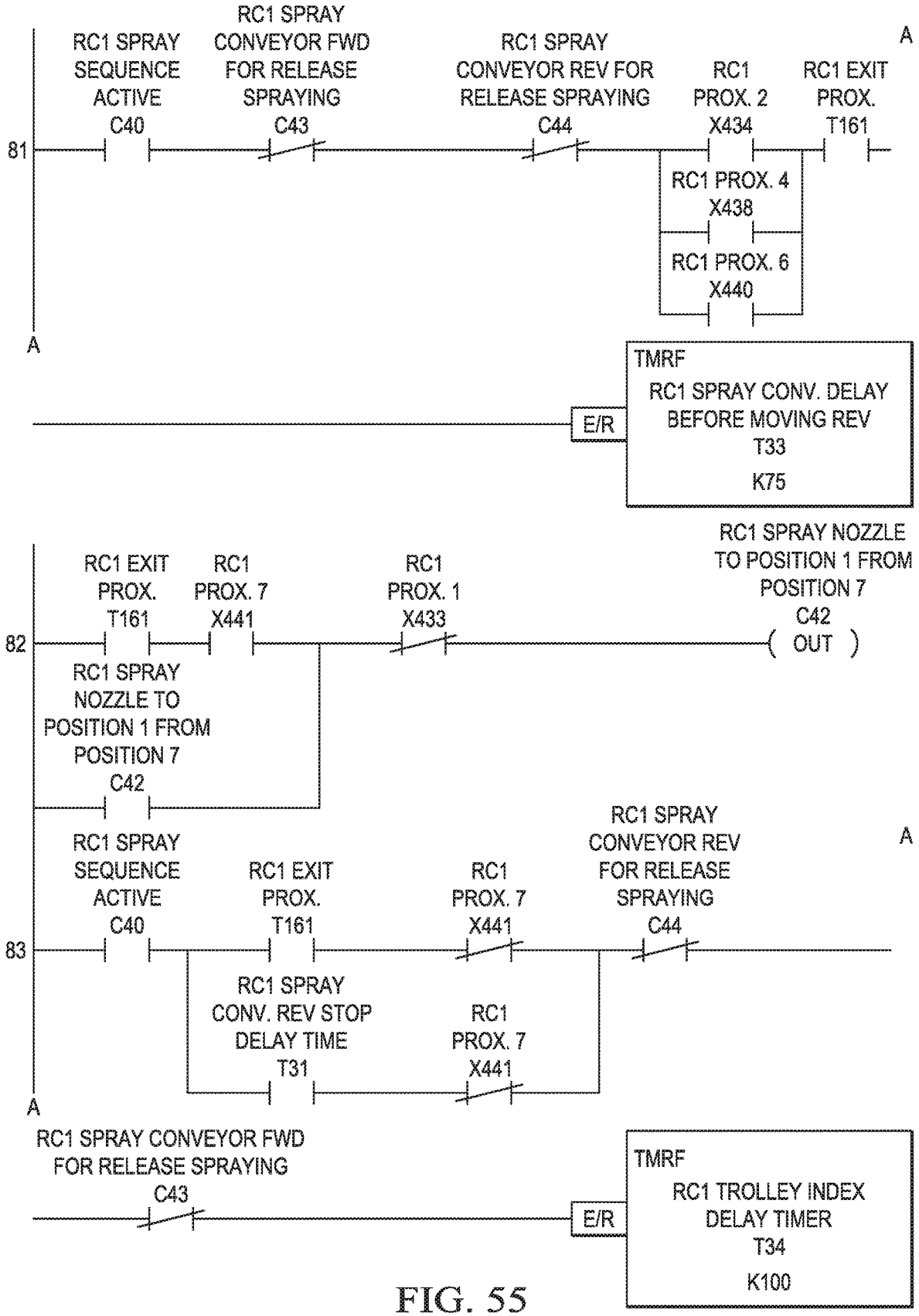
Figure 56:
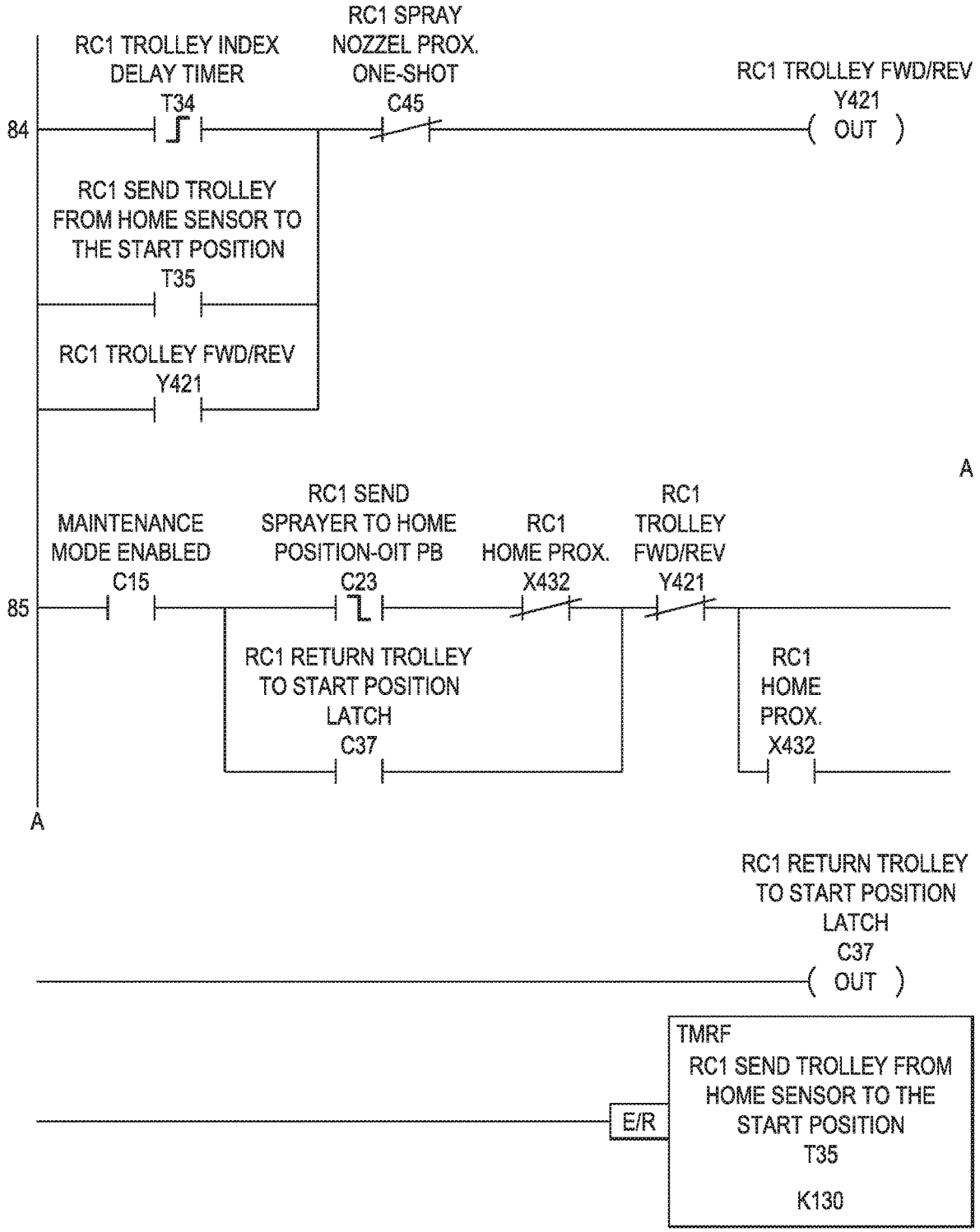
Figure 57:
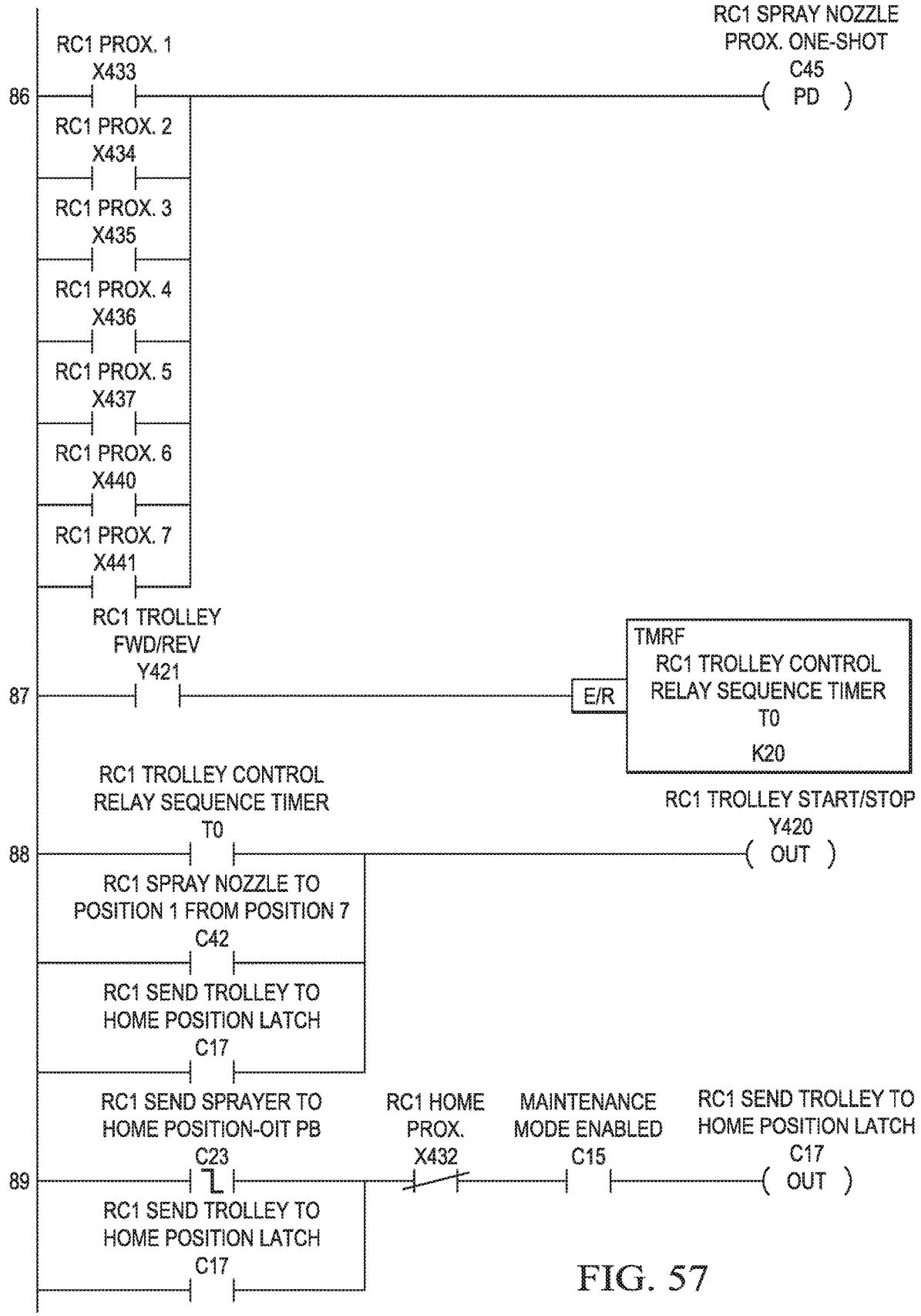
Figure 58:
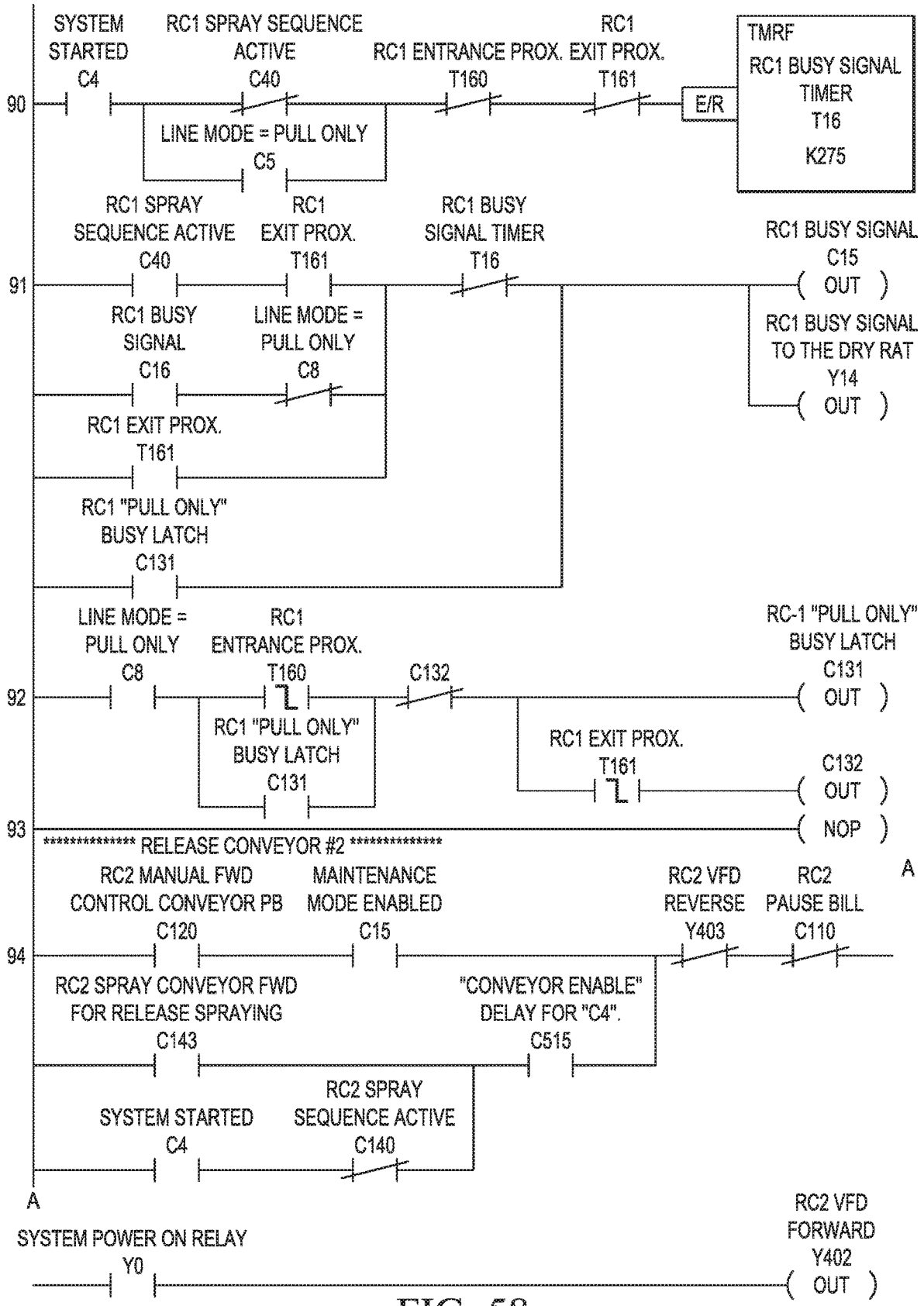
Figure 59:
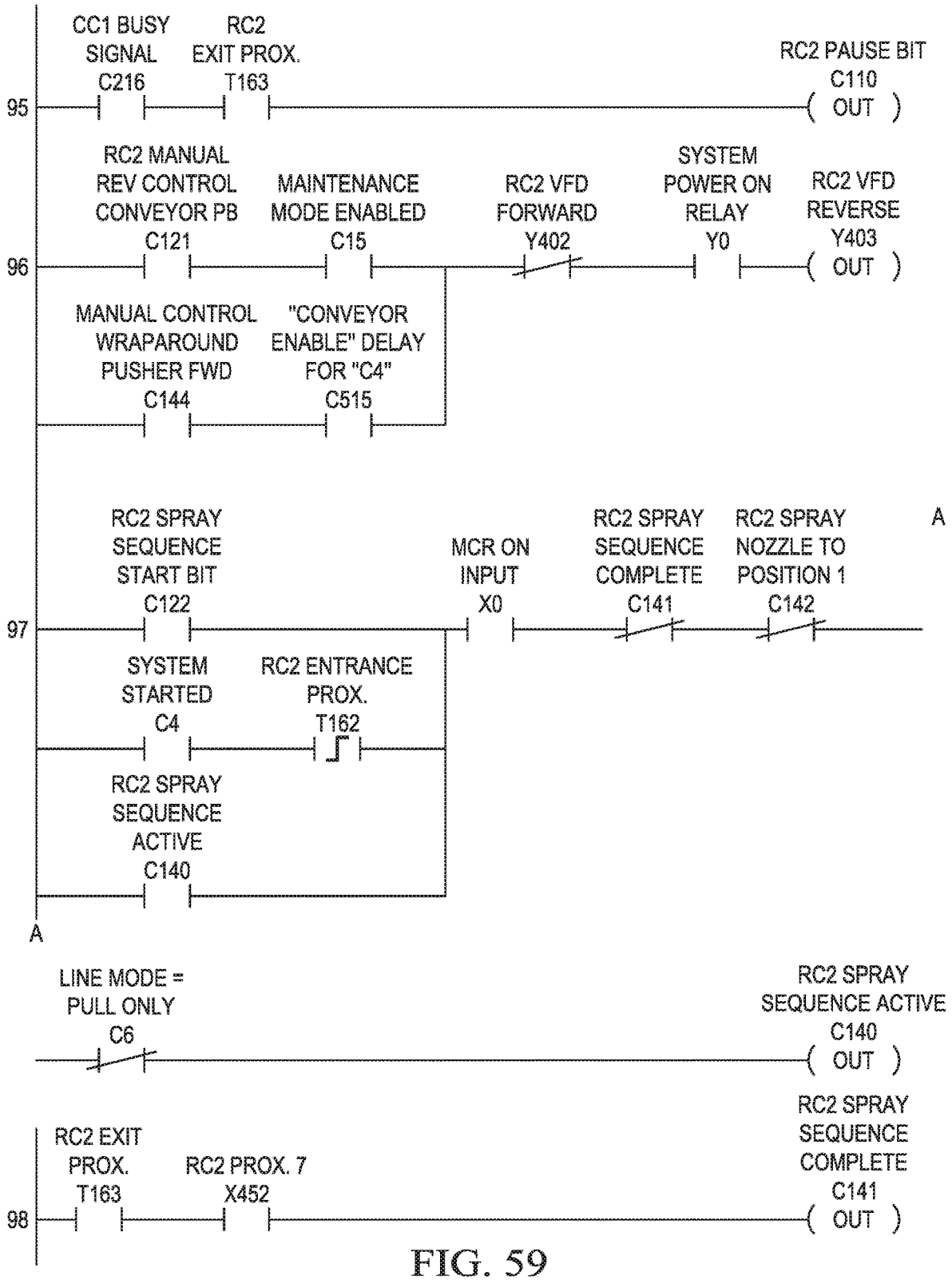
Figure 60:
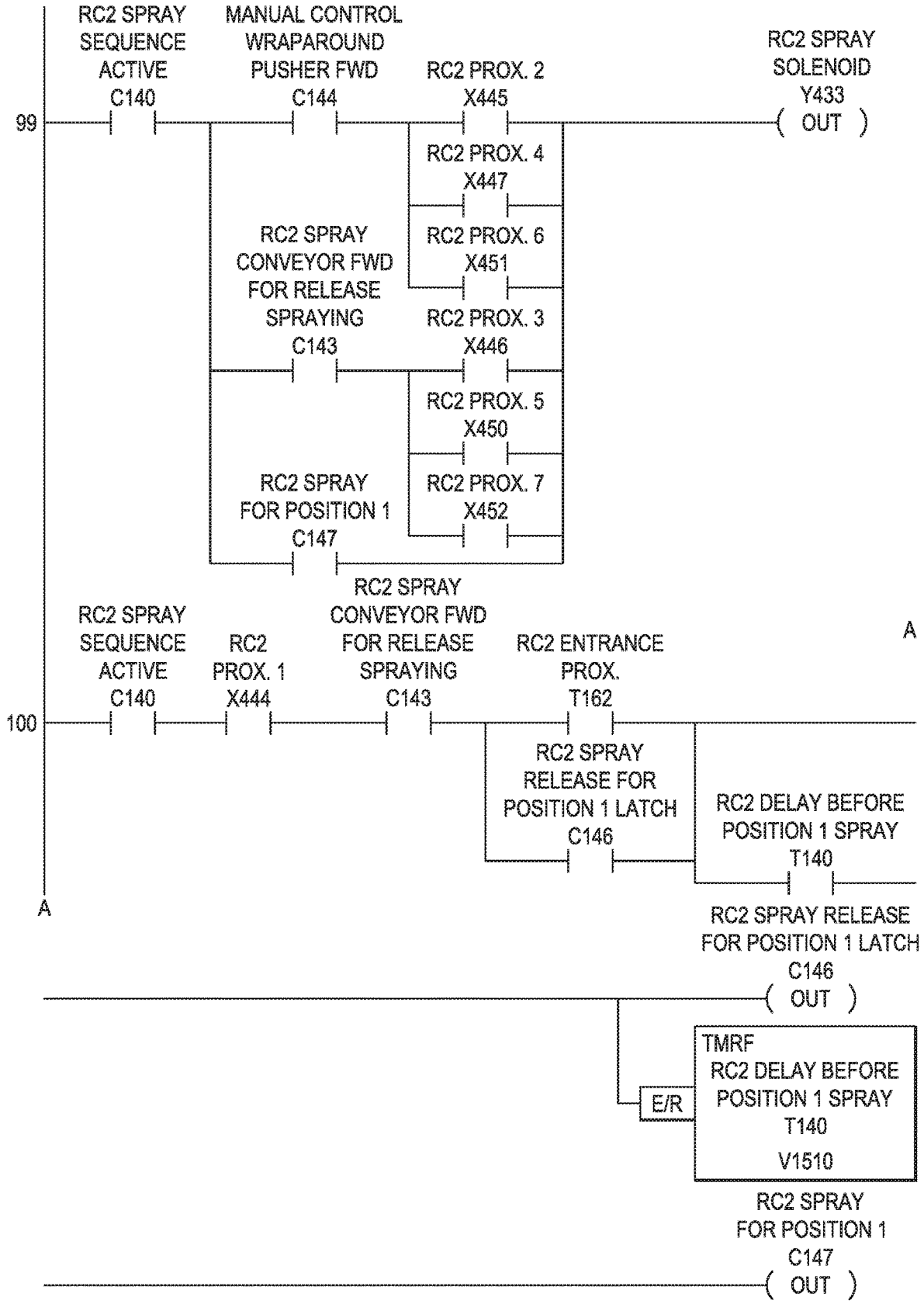
Figure 61:
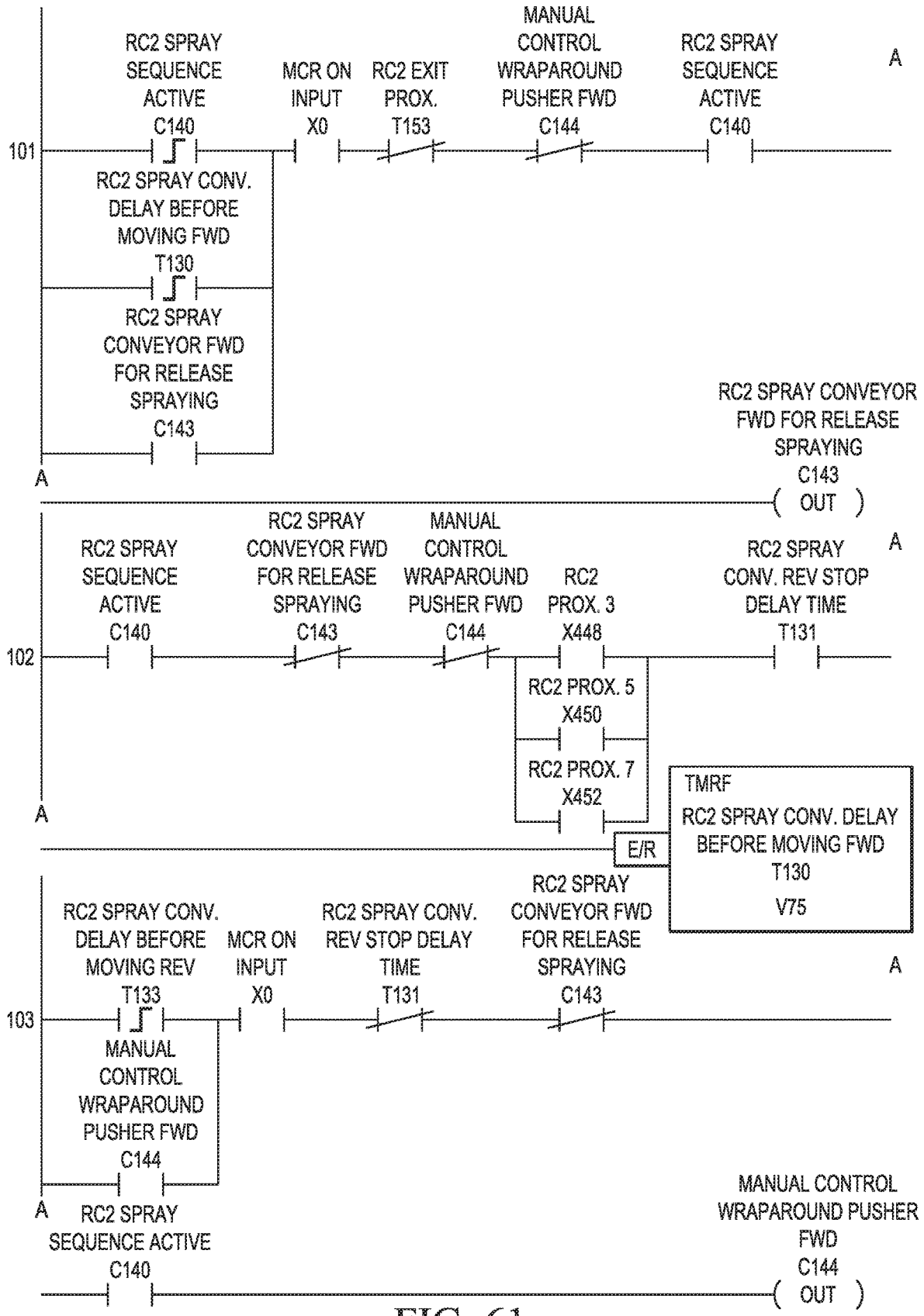
Figure 62:
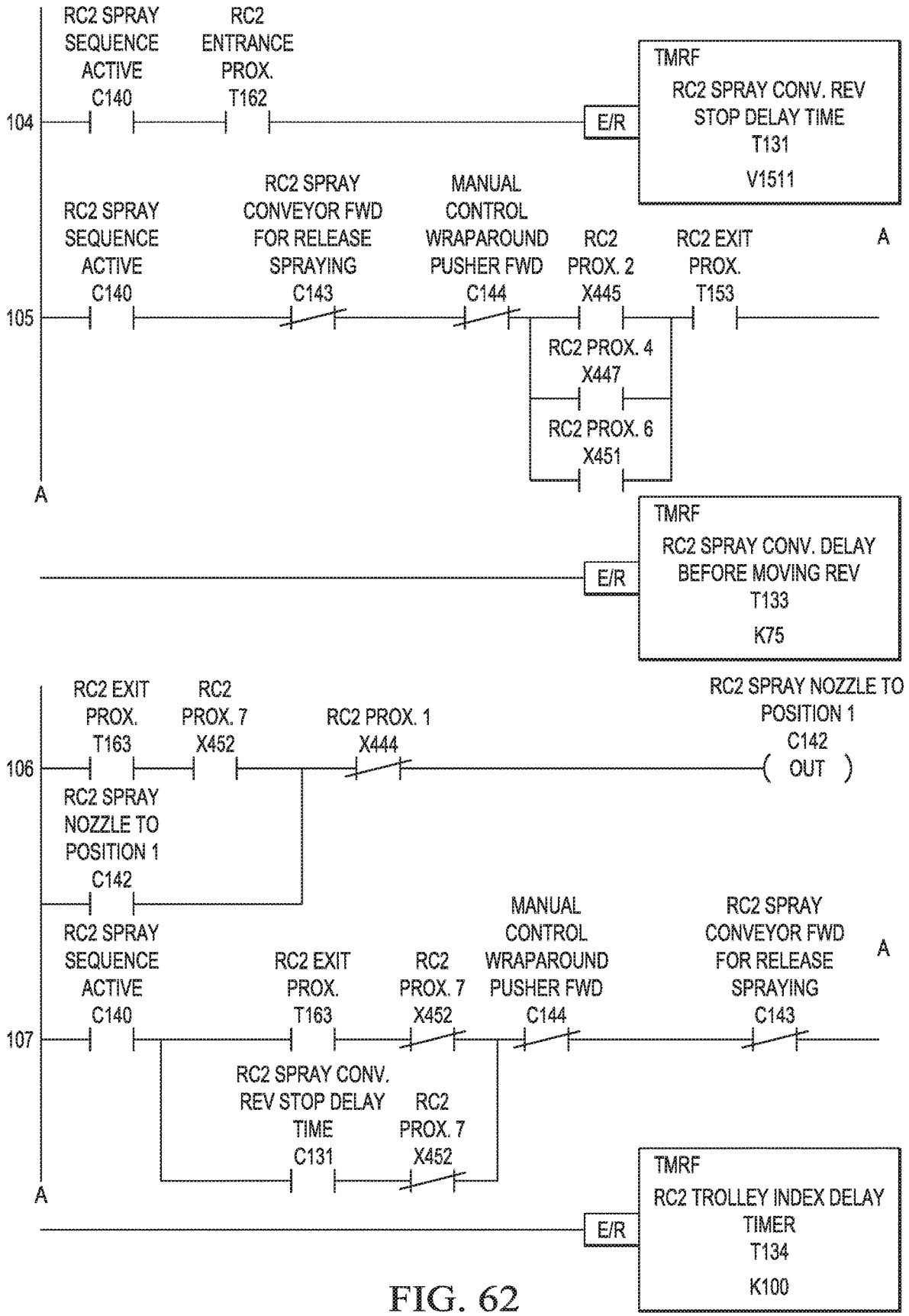
Figure 63:
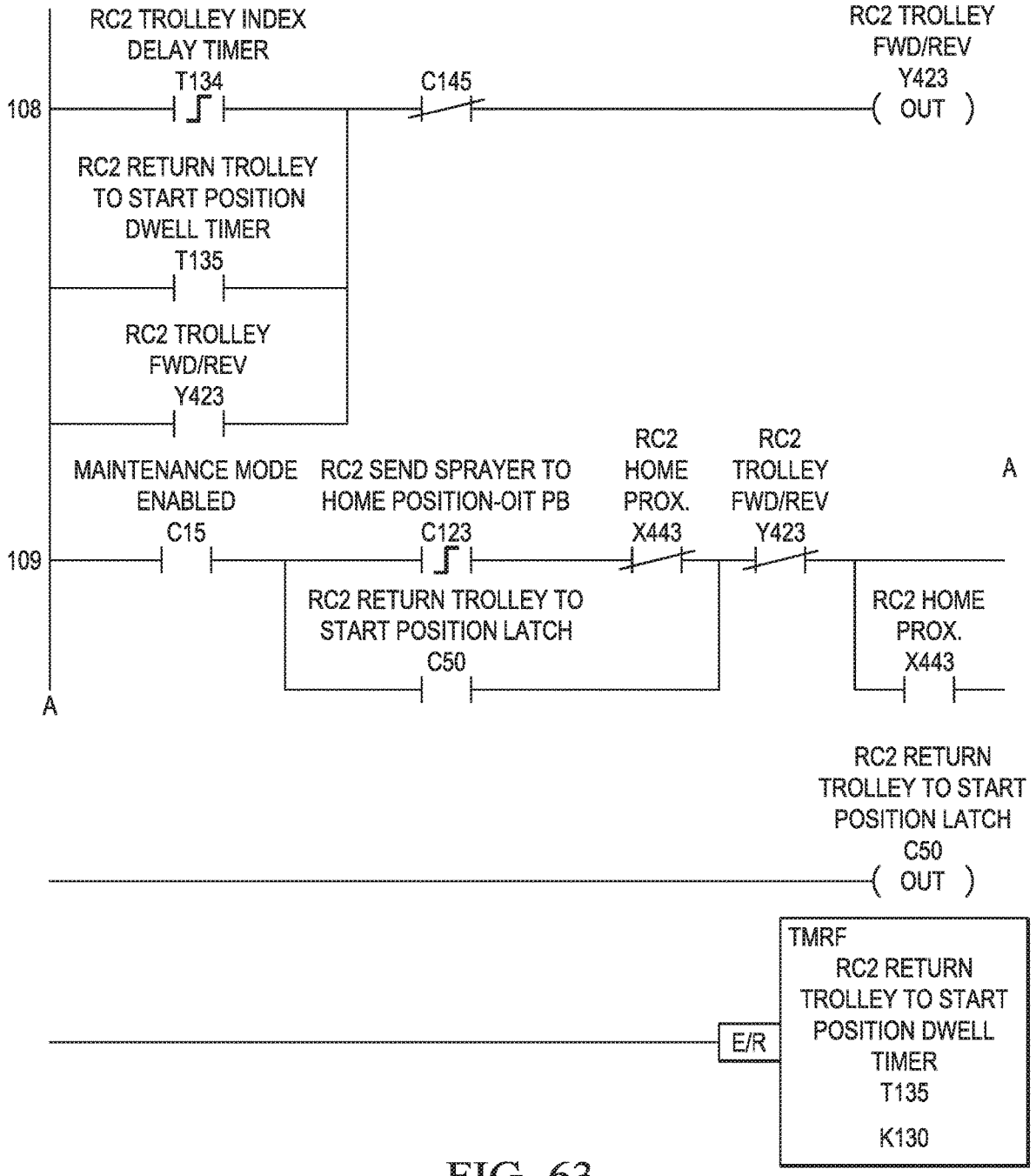
Figure 64:
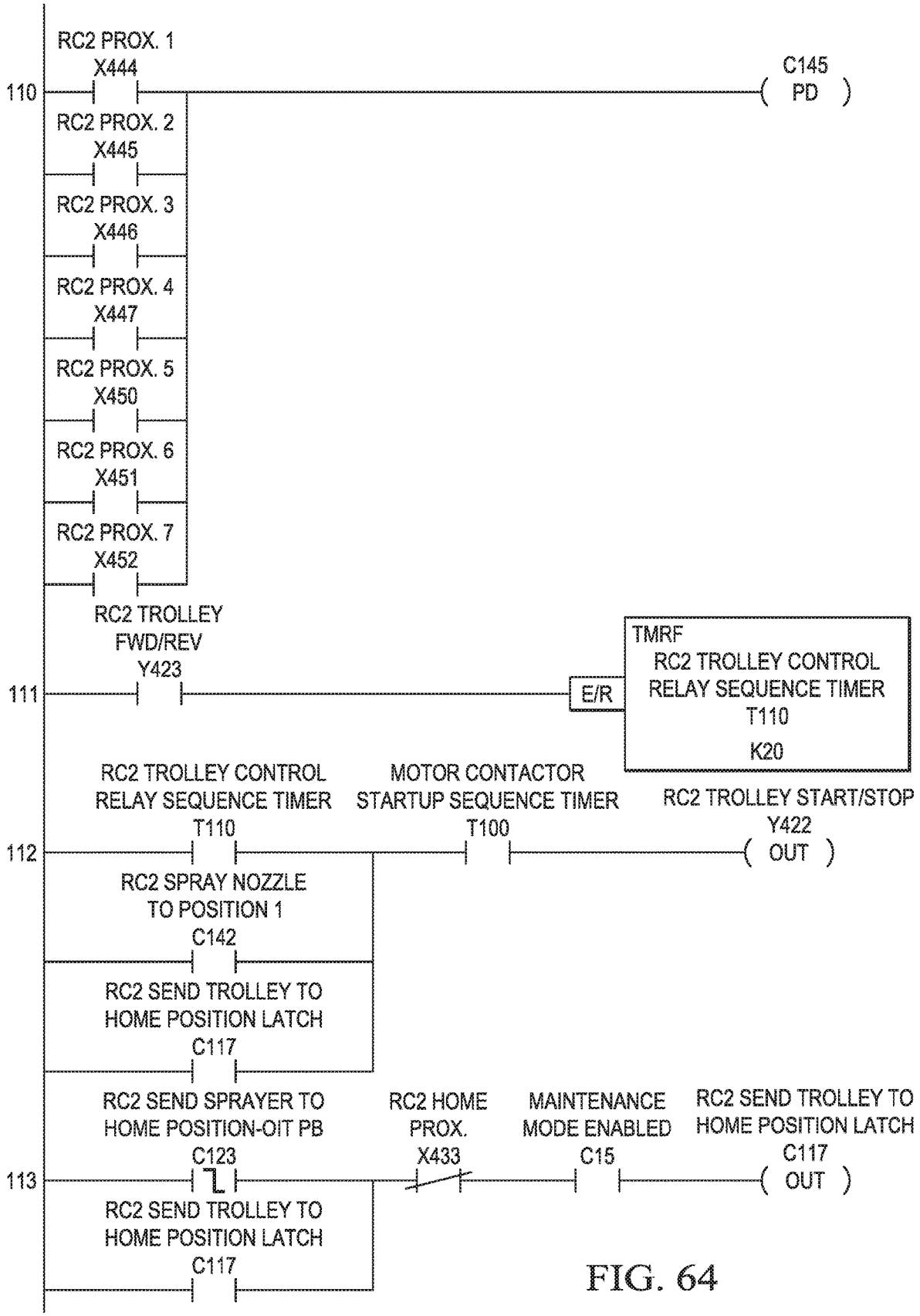
Figure 65:
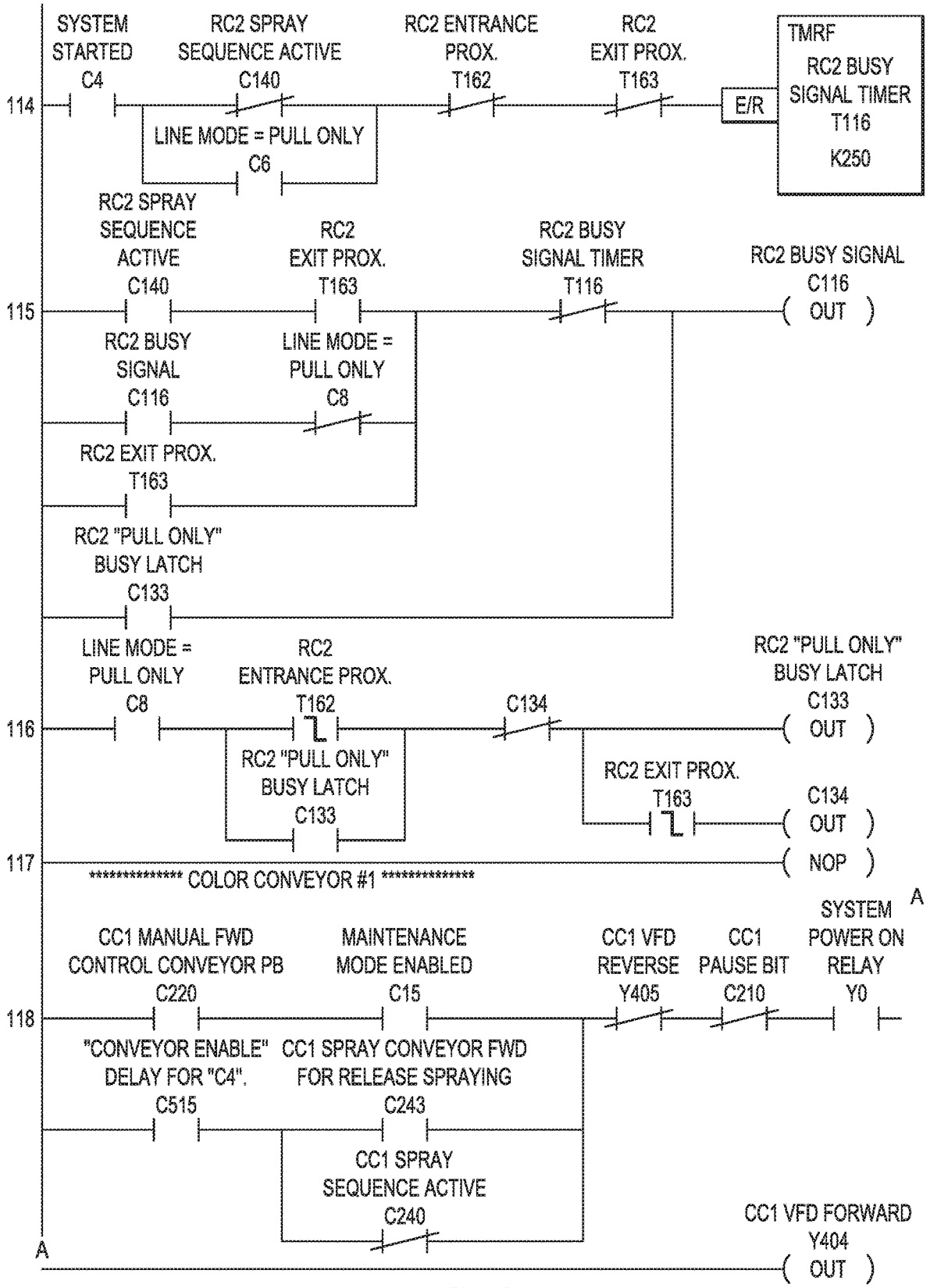
Figure 66:
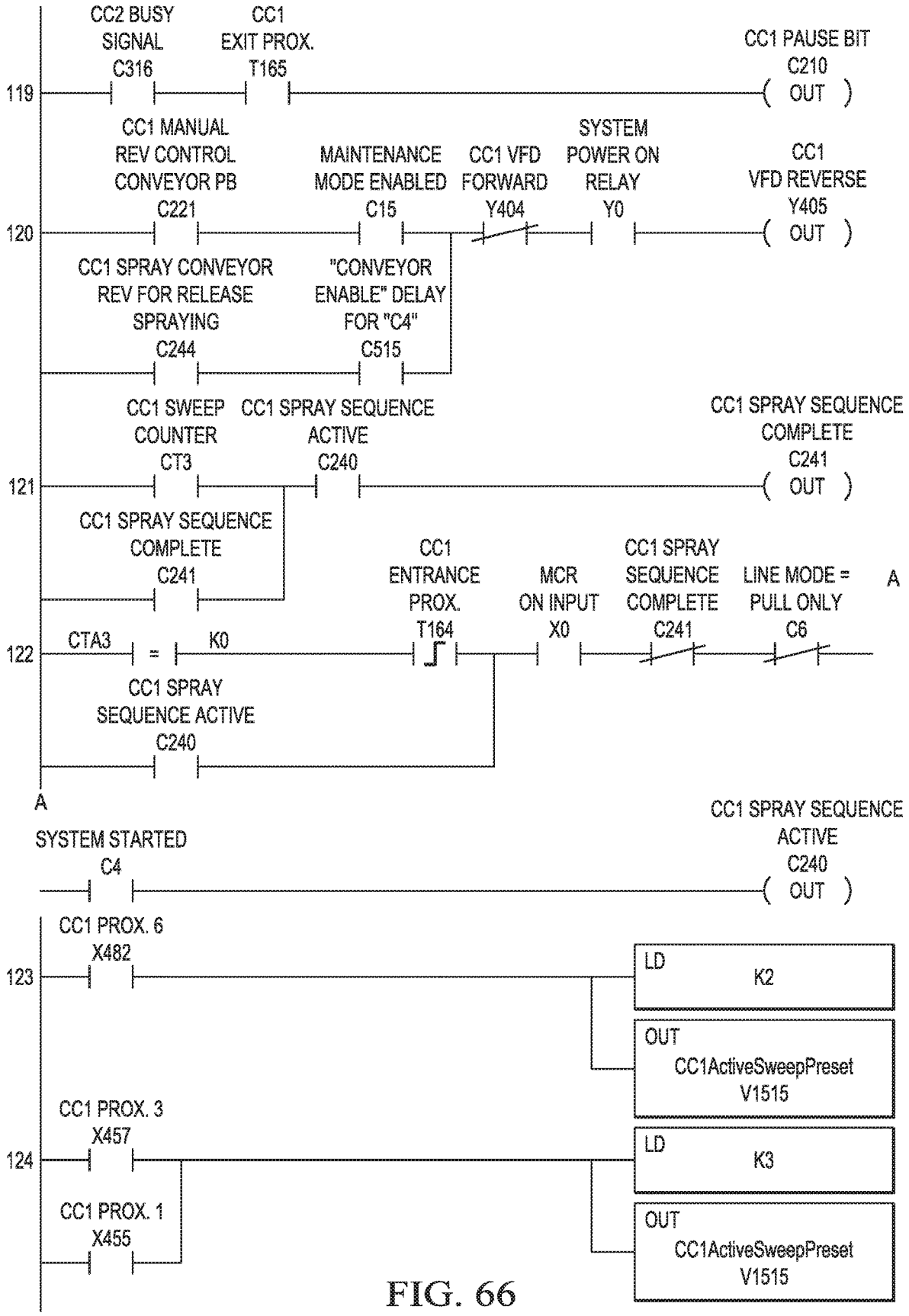
Figure 67:
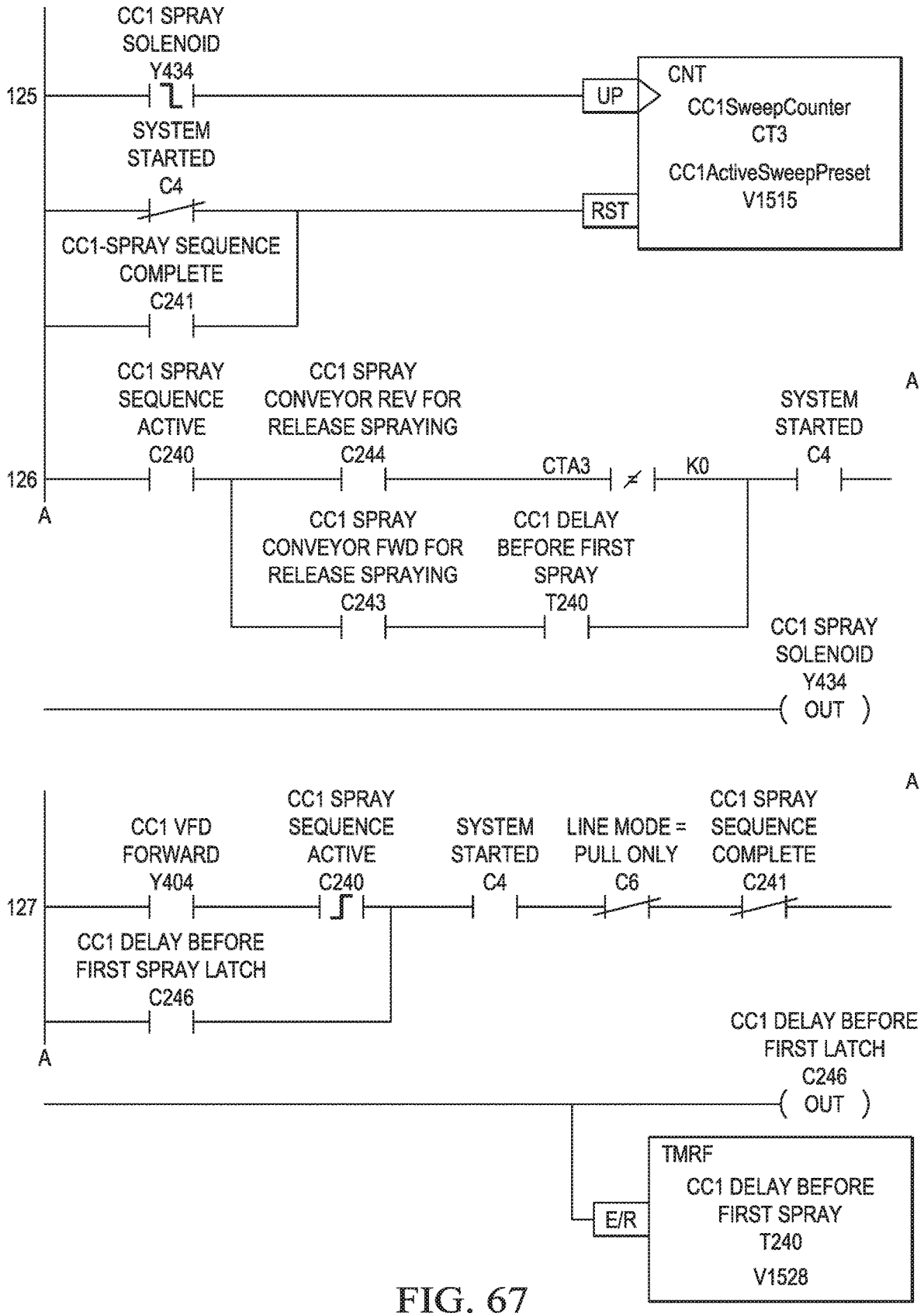
Figure 68:
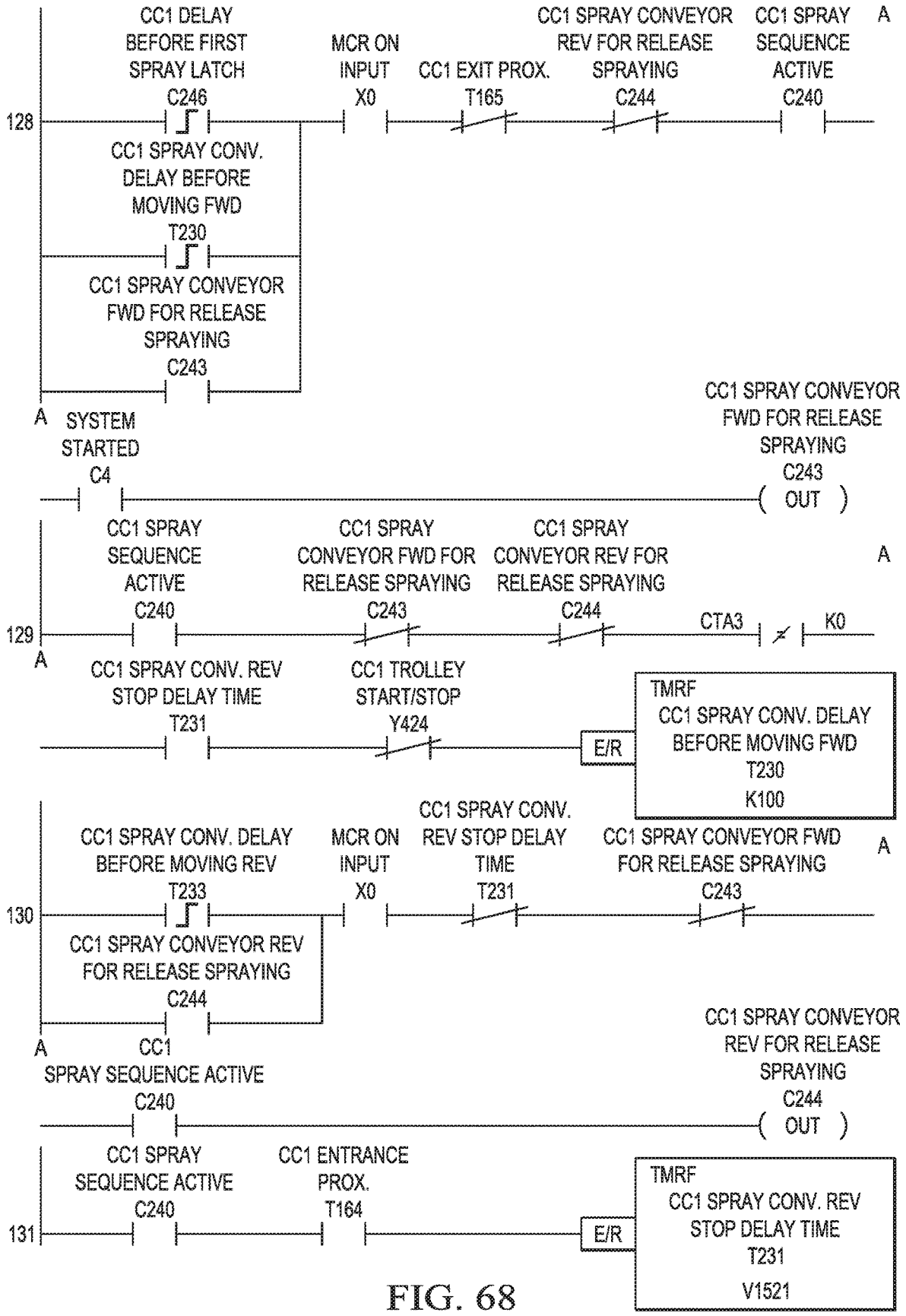
Figure 69:
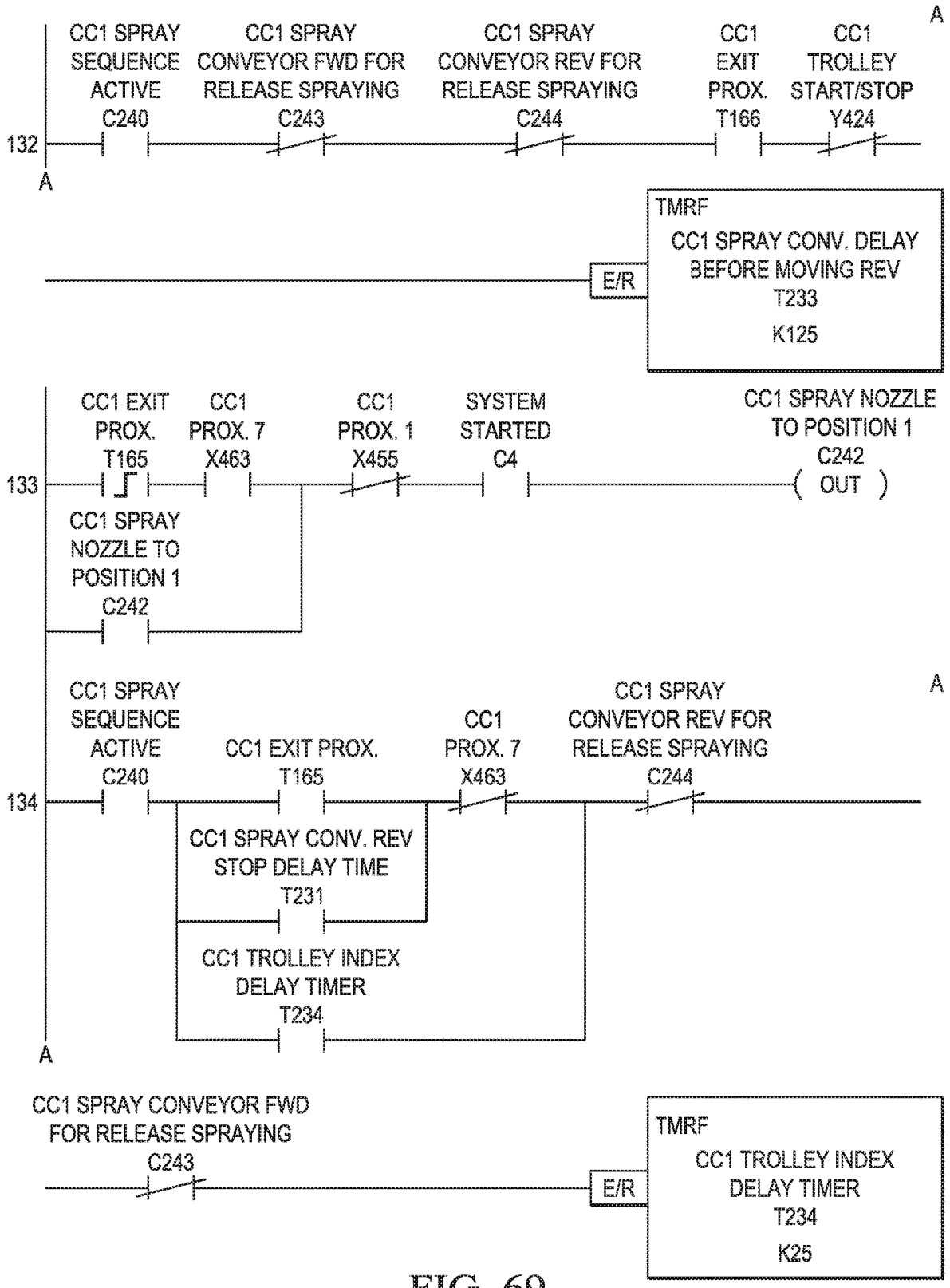
Figure 70:
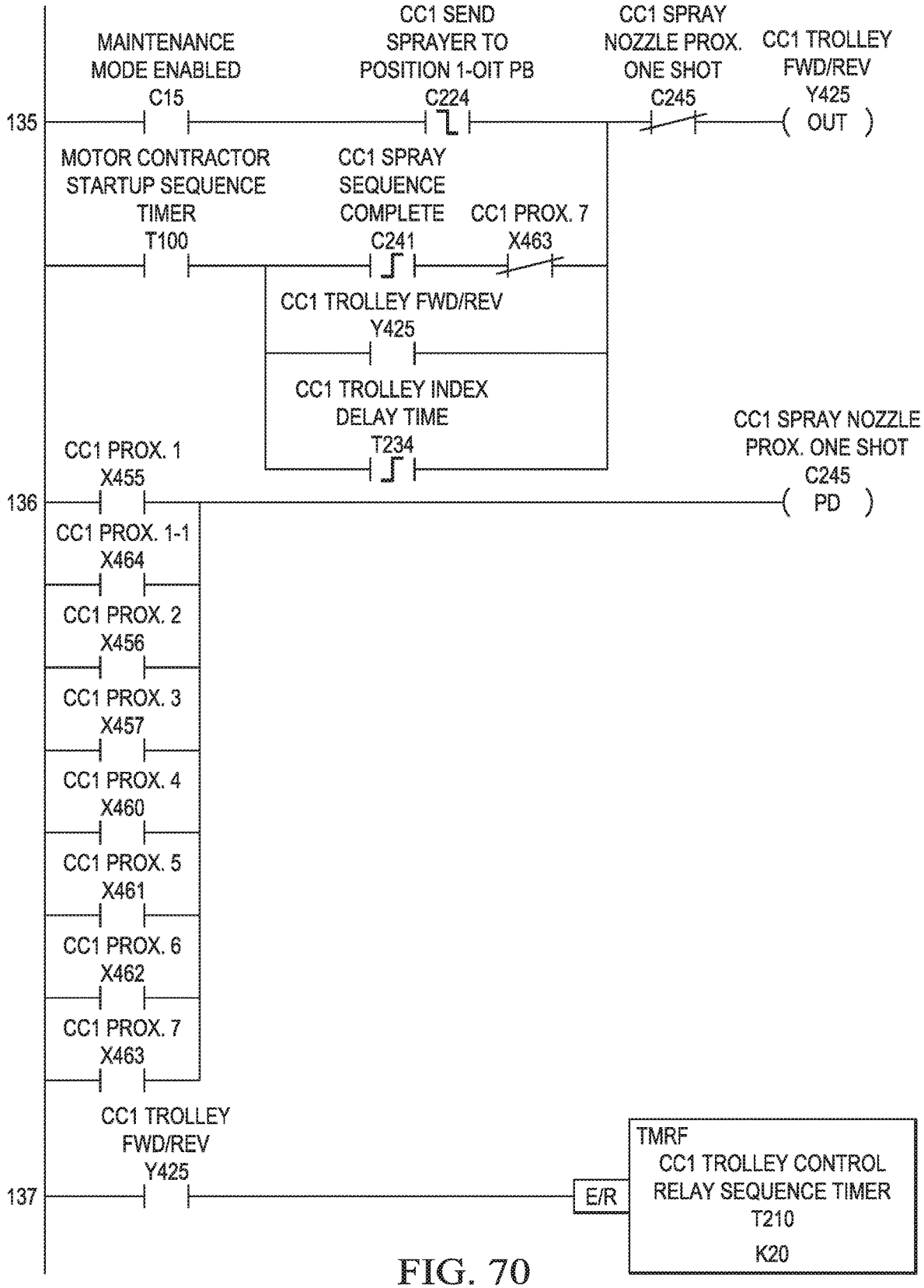
Figure 71:
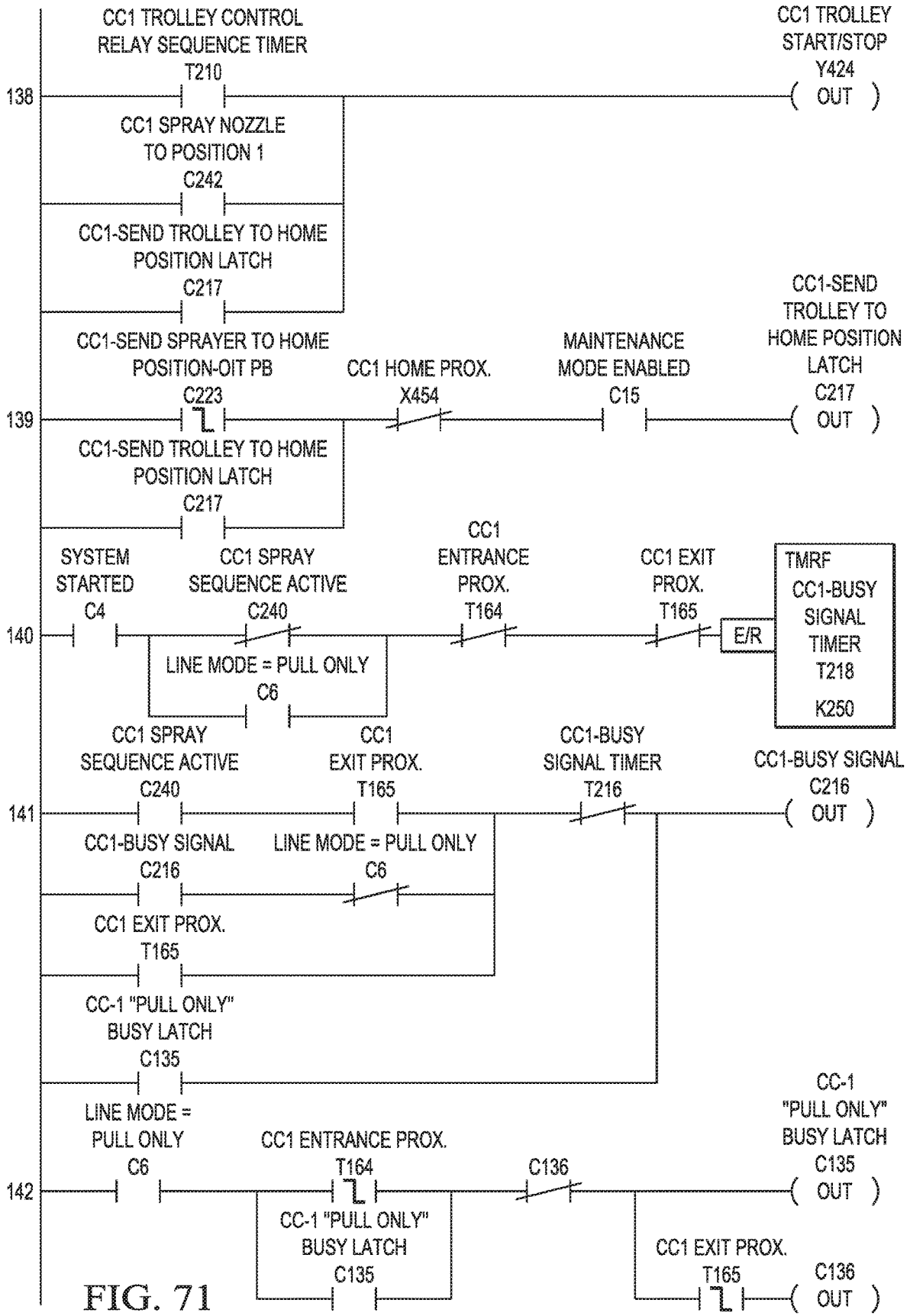
Figure 72:
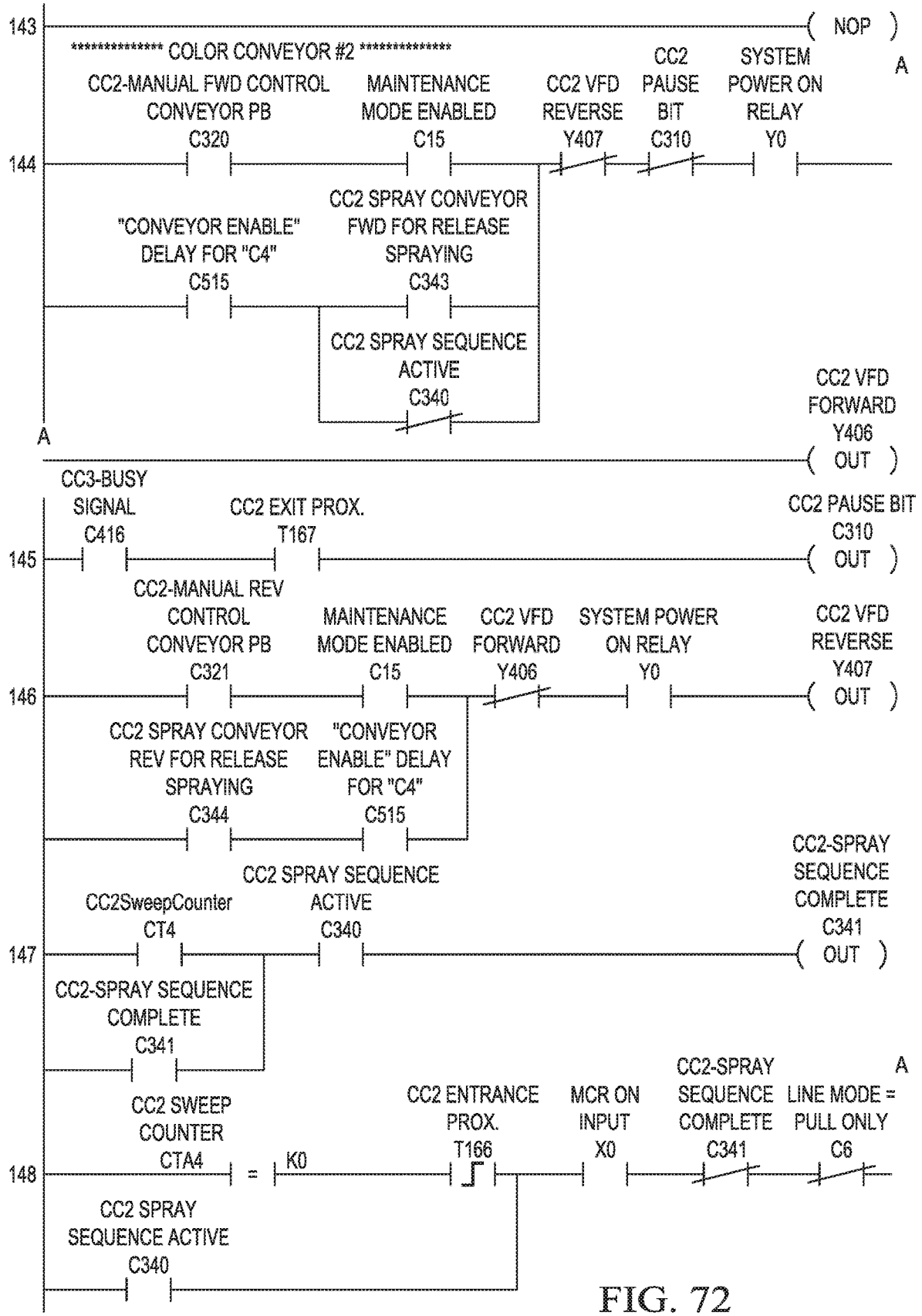
Figure 73:
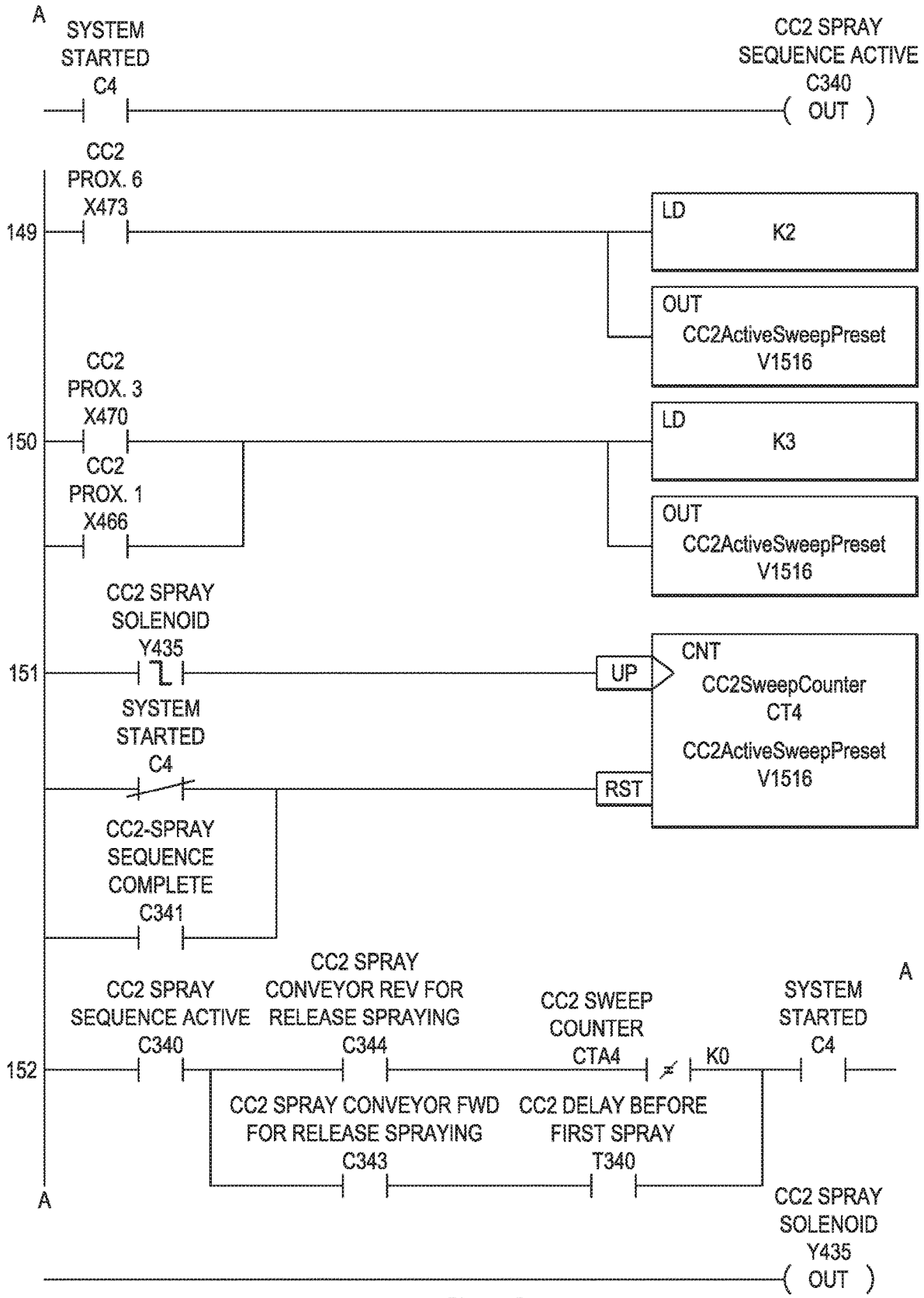
Figure 74:
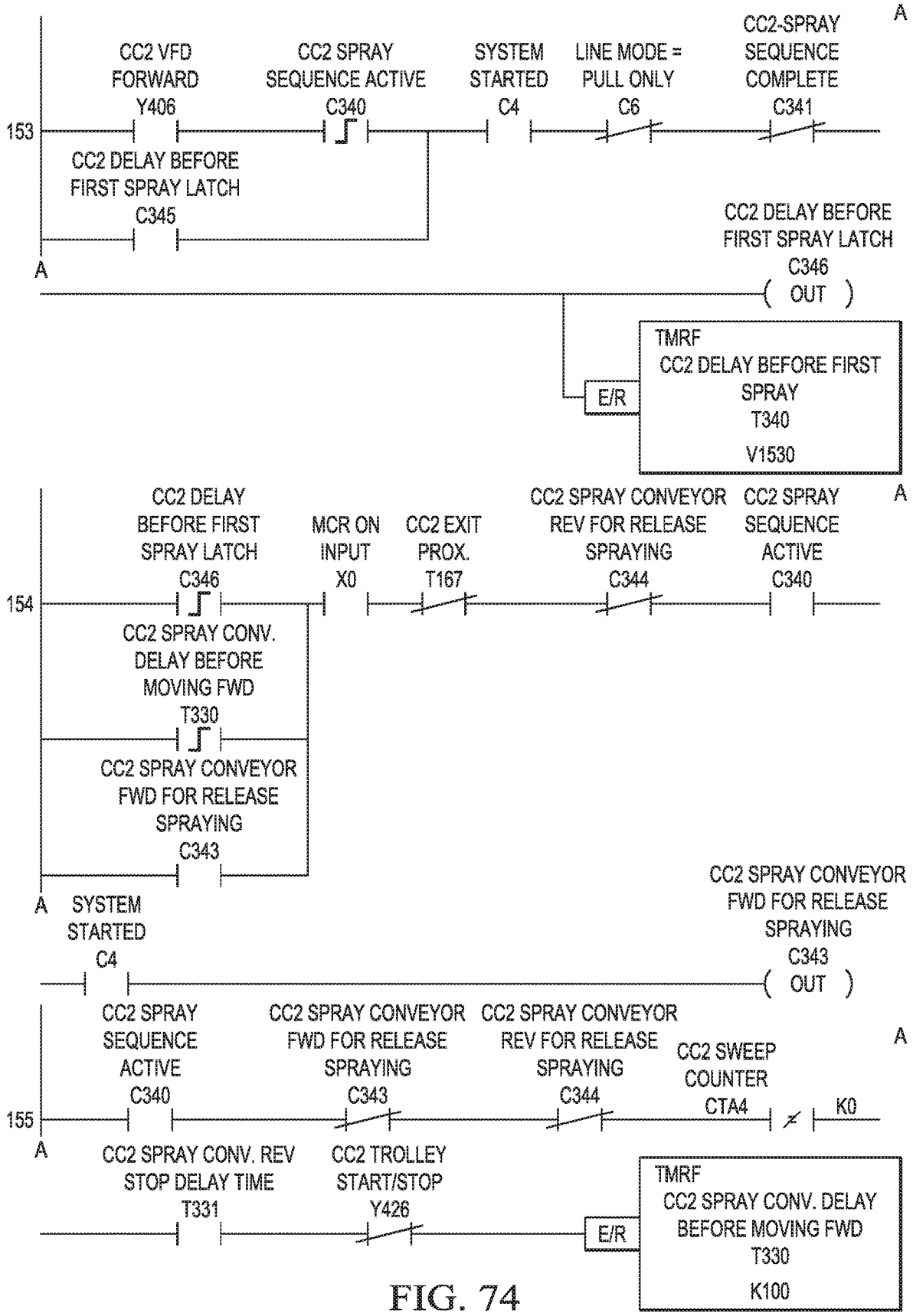
Figure 75:
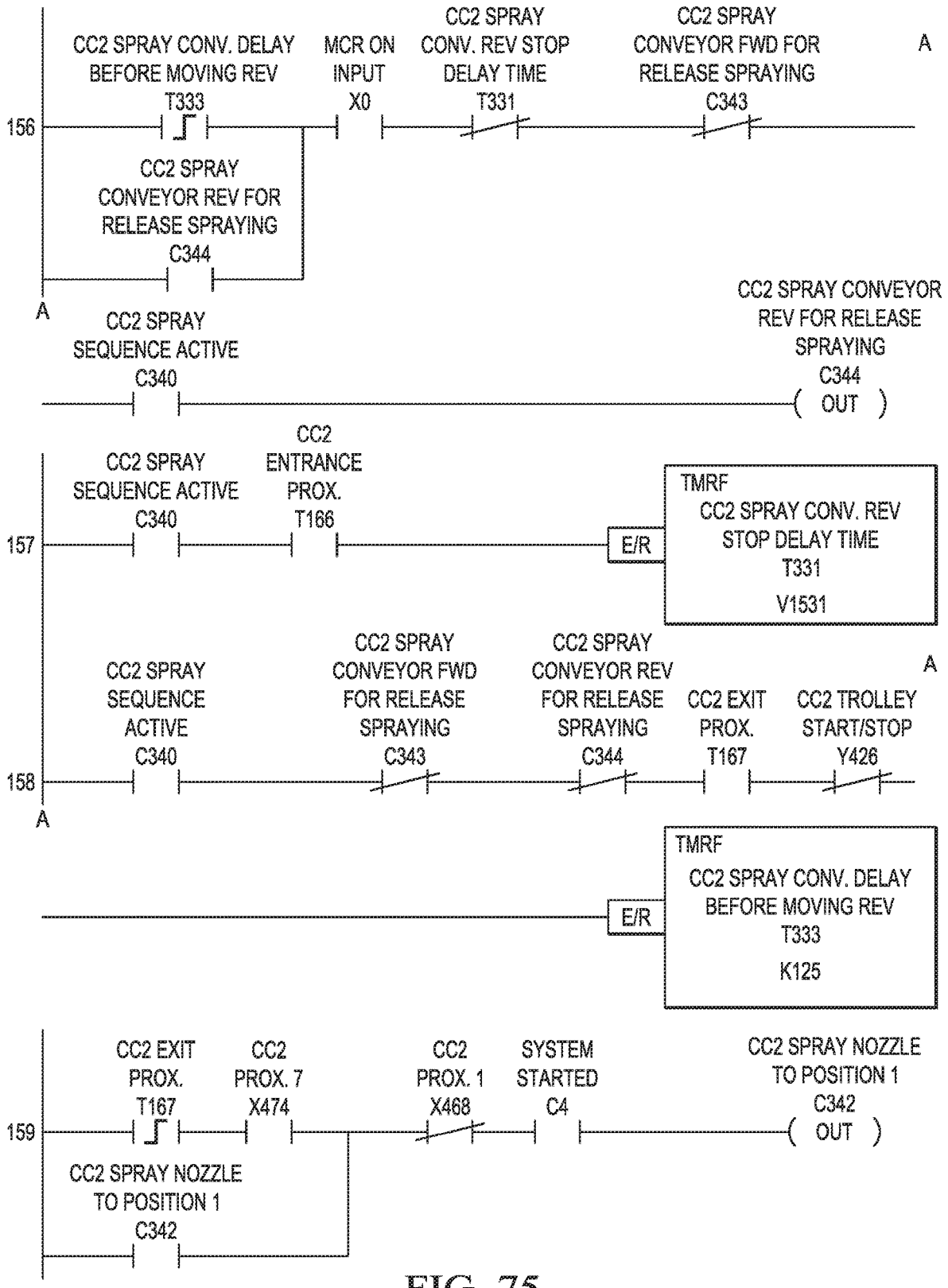
Figure 76:
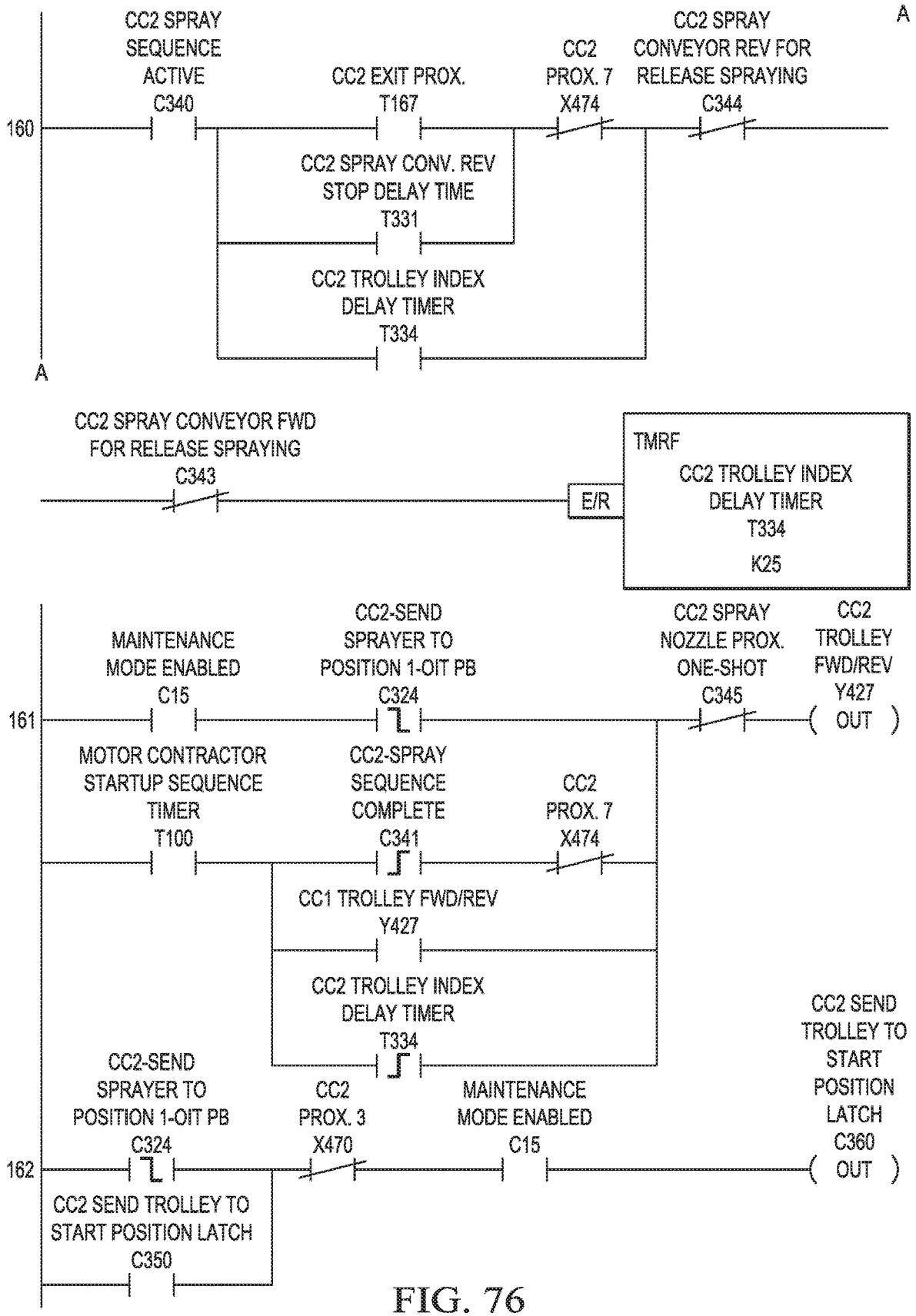
Figure 77:
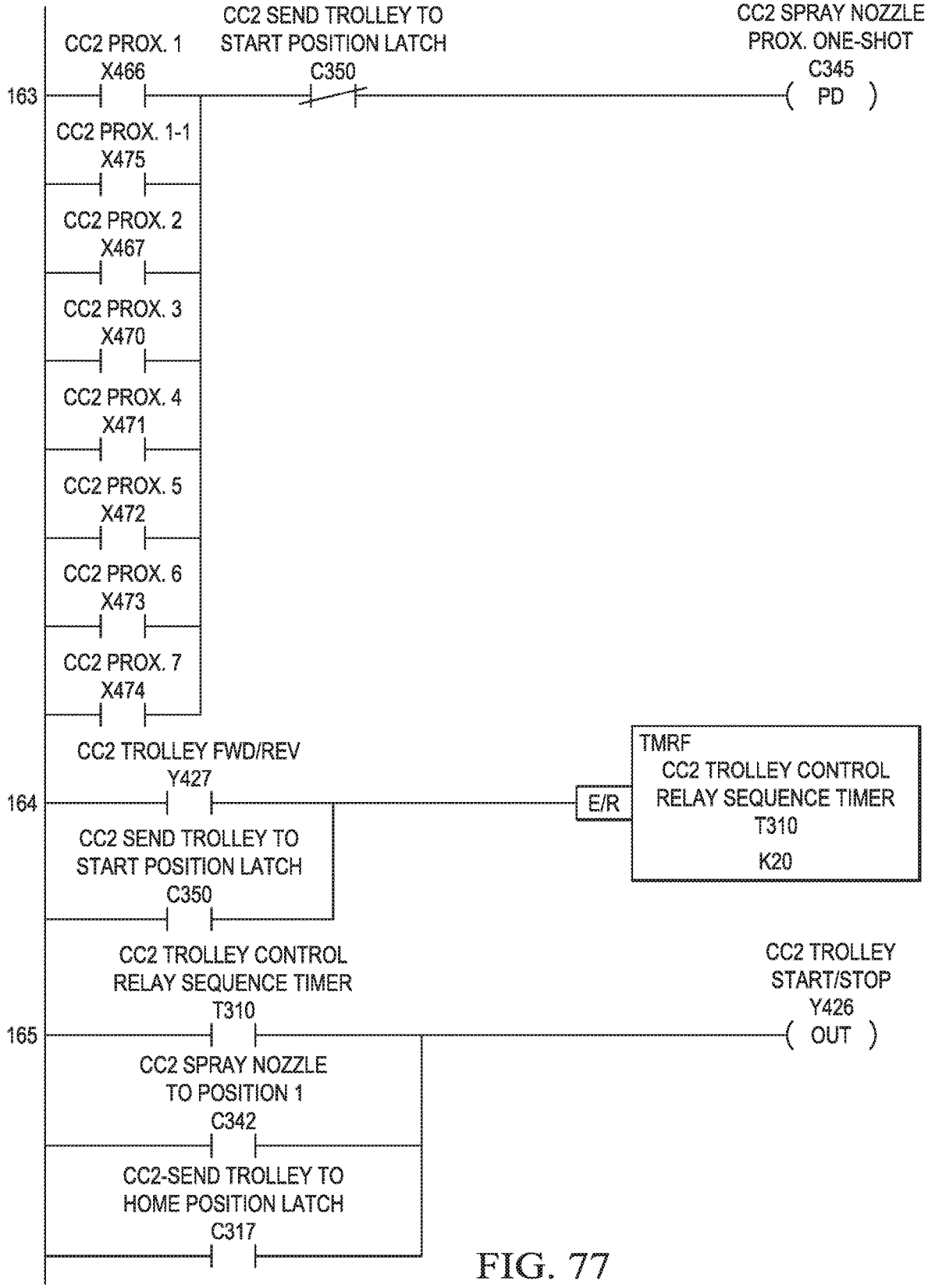
Figure 78:
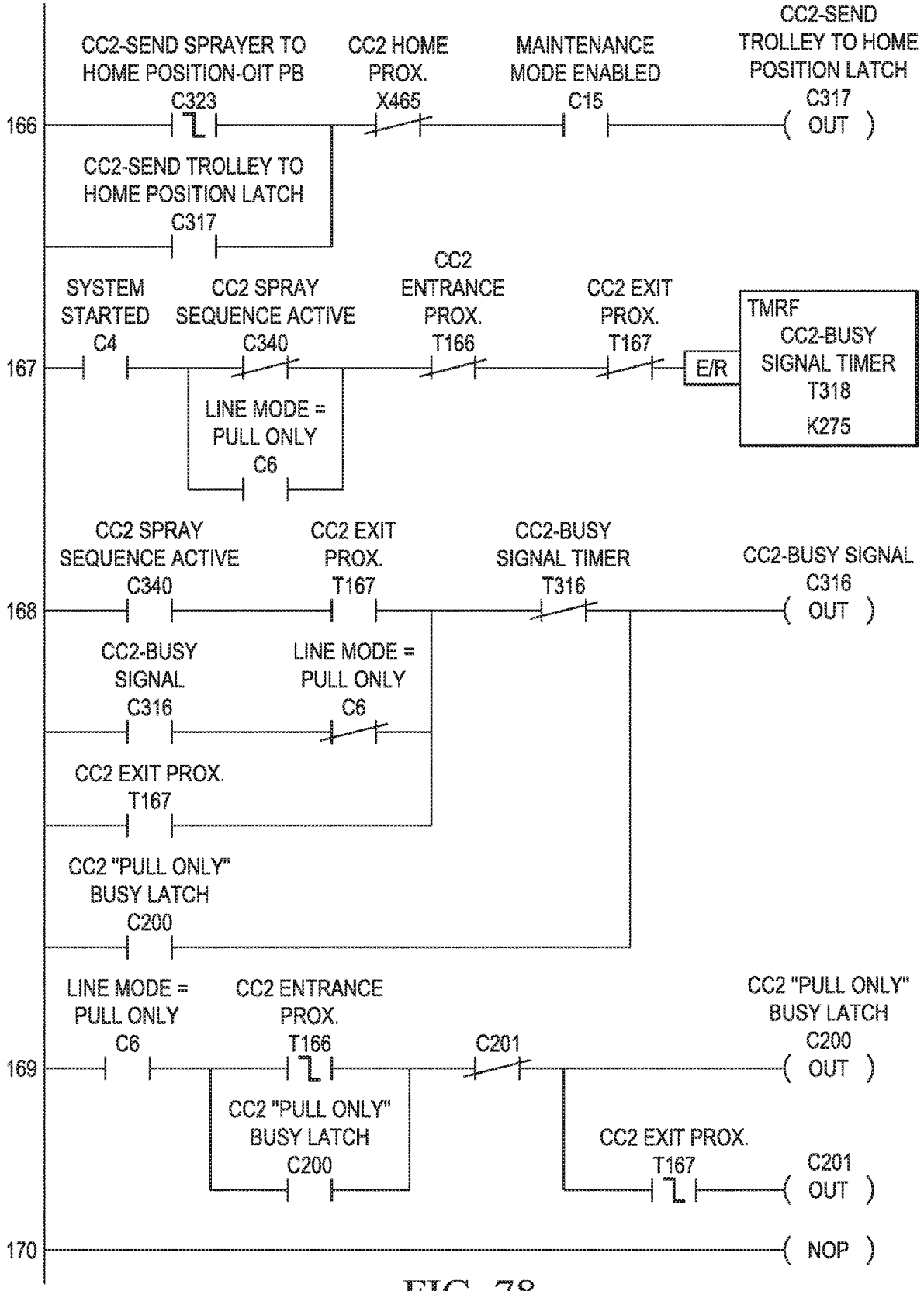
Figure 79:
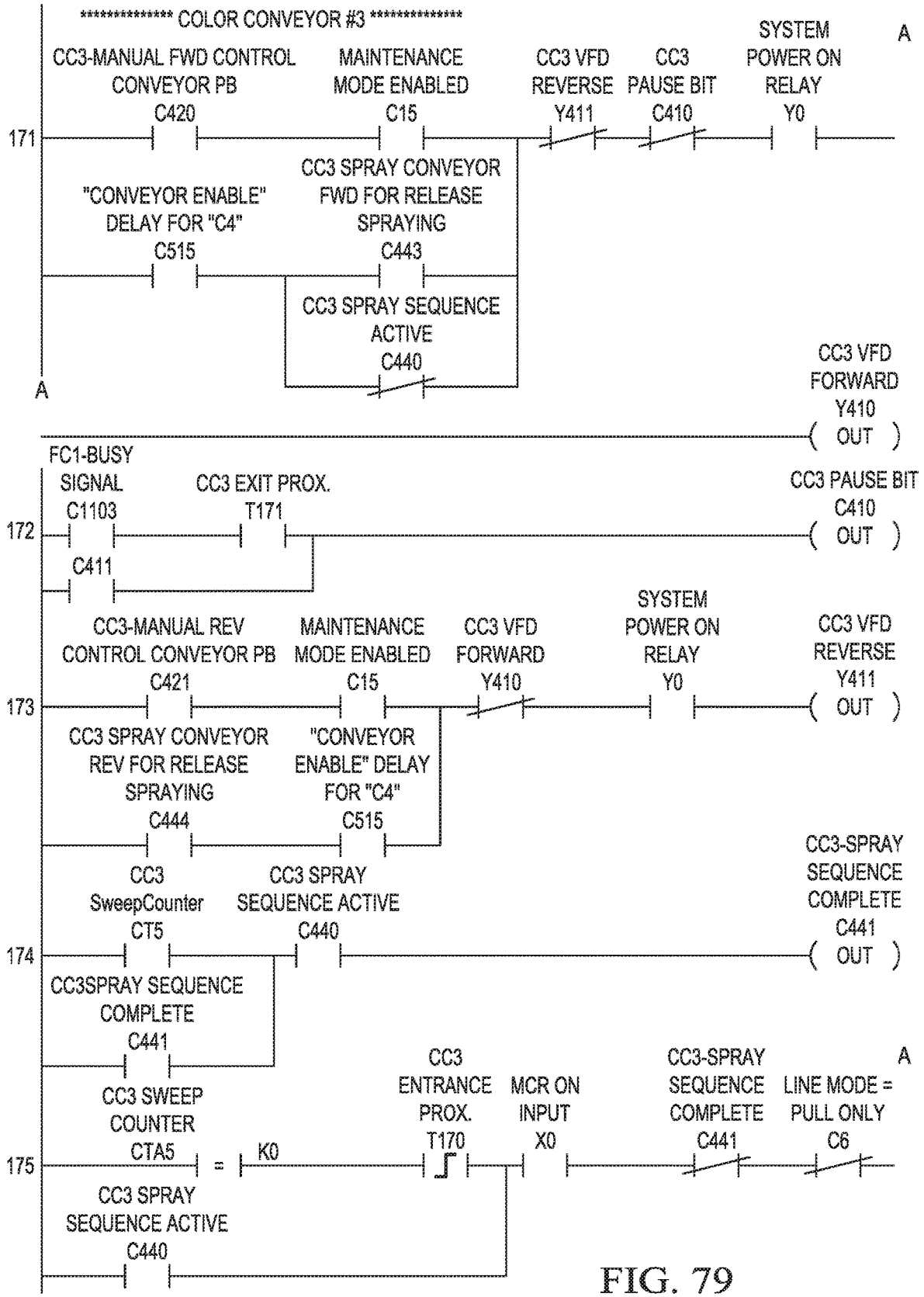
Figure 80:
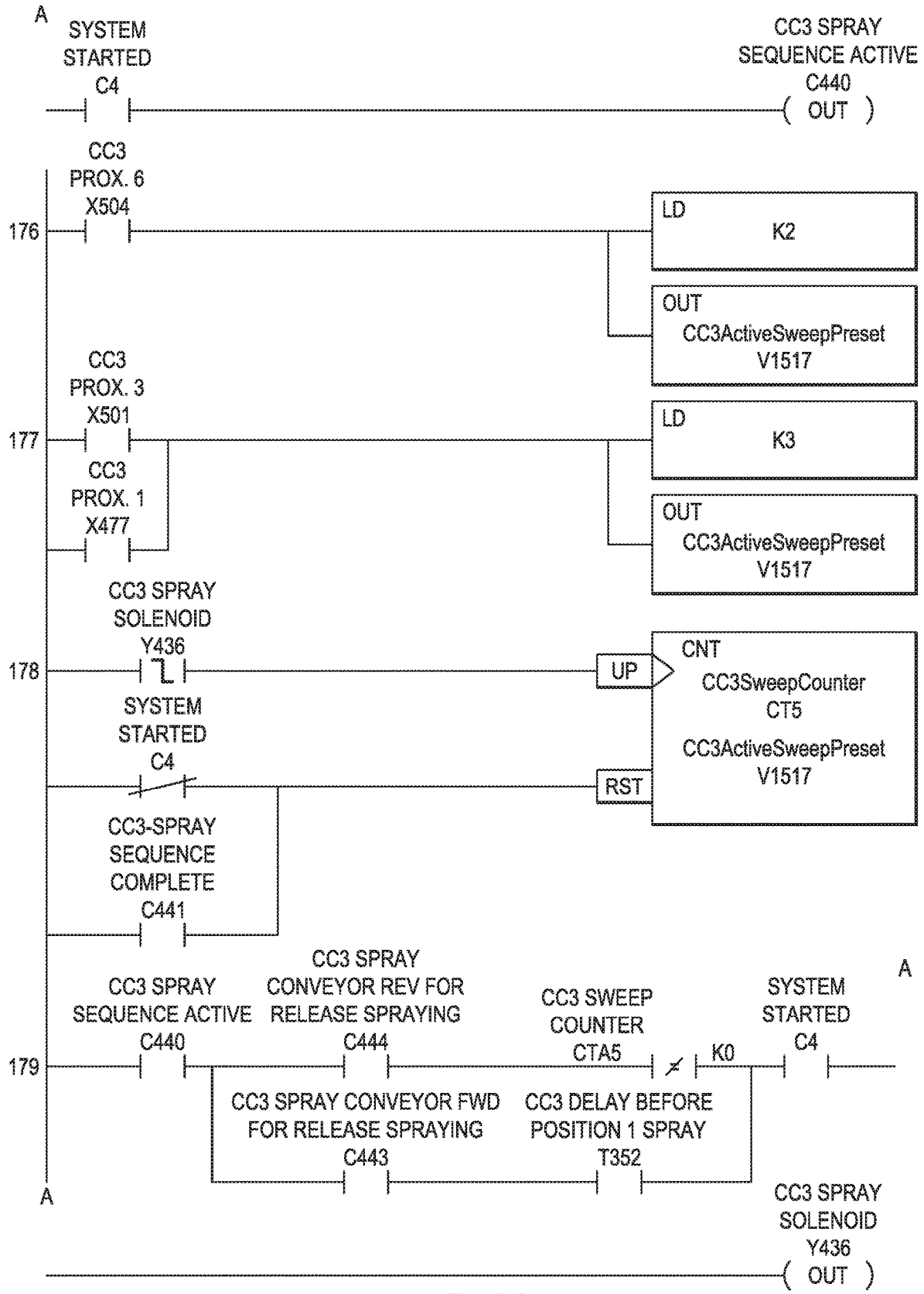
Figure 81:
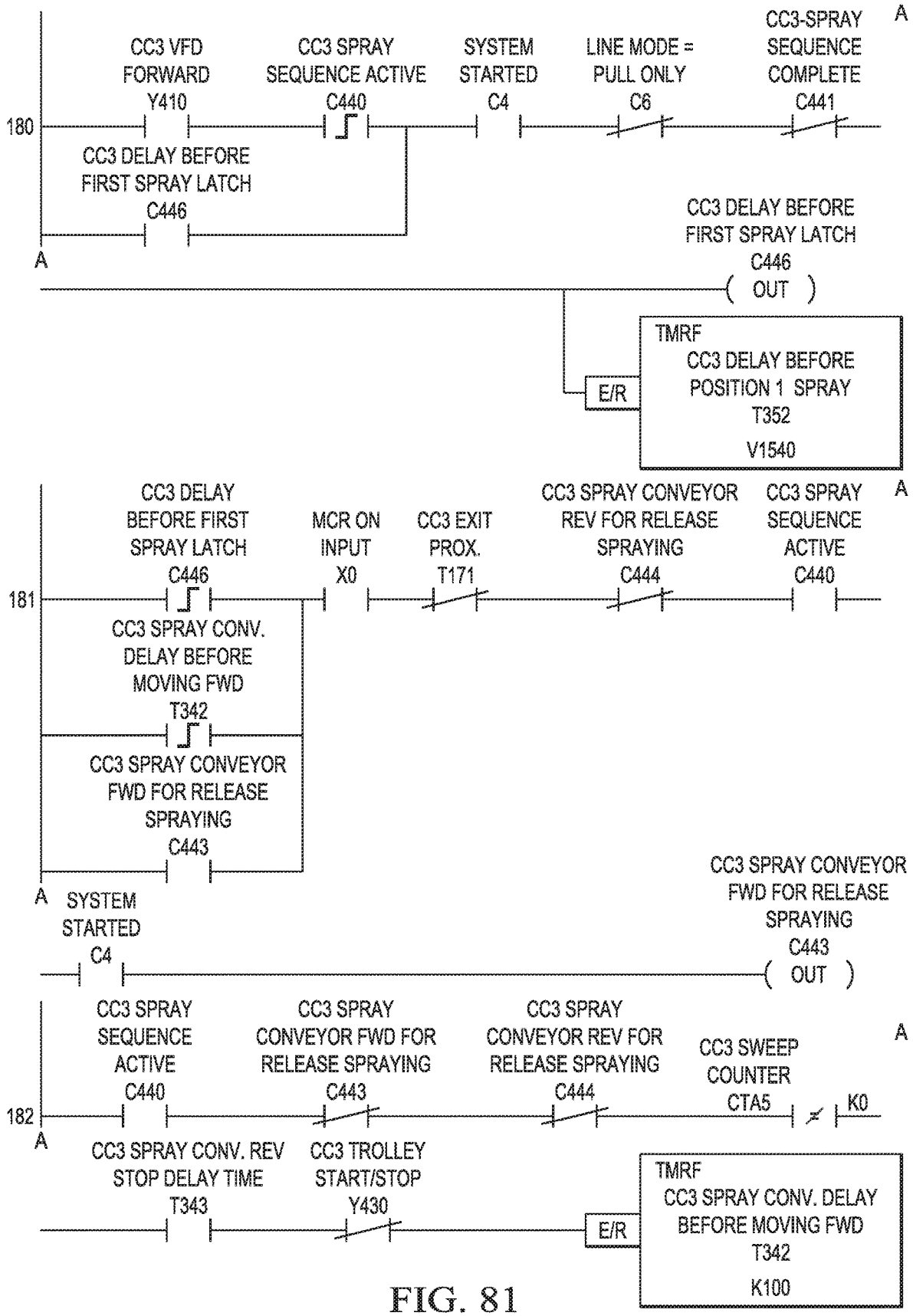
Figure 82:
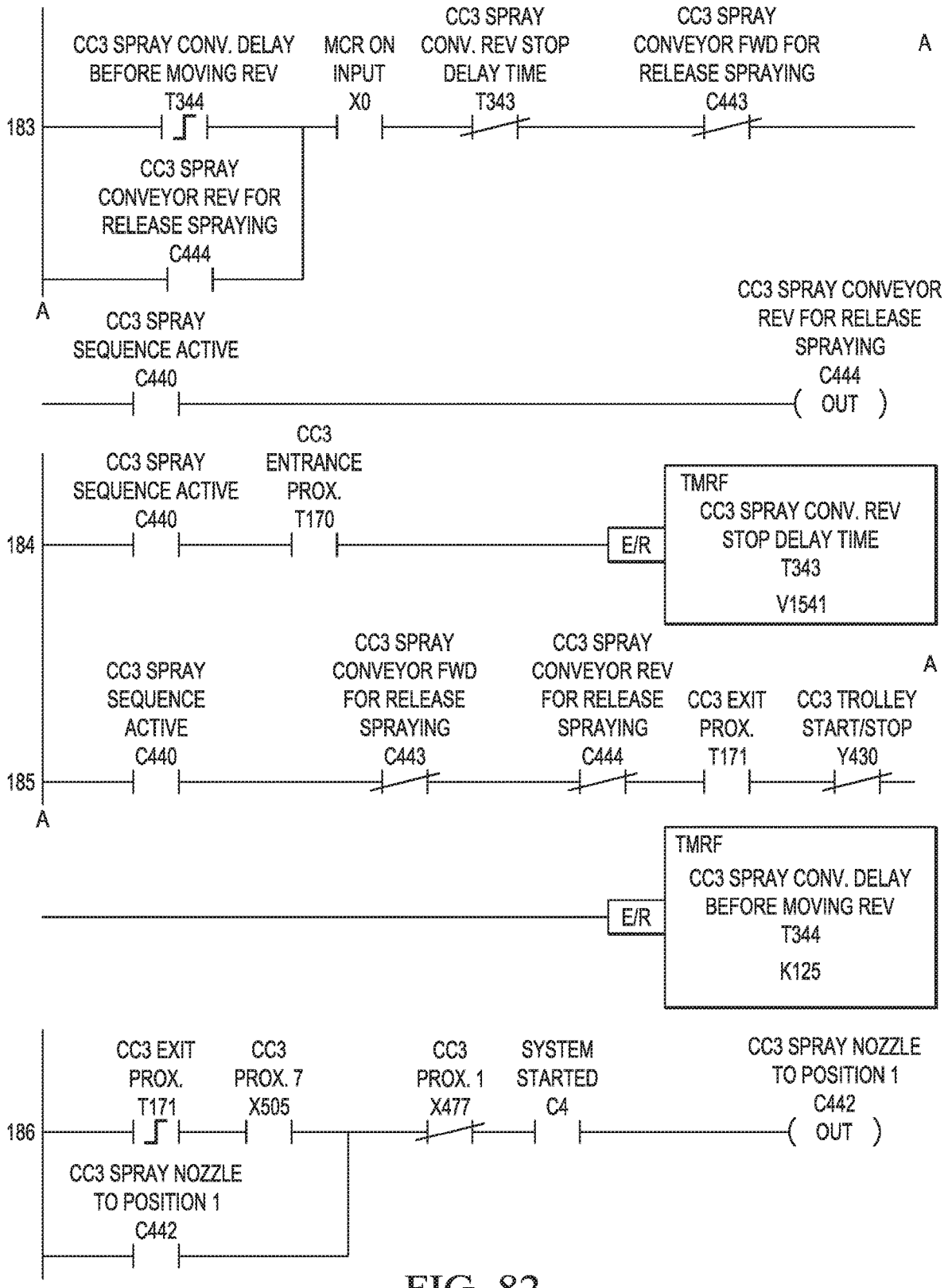
Figure 83:
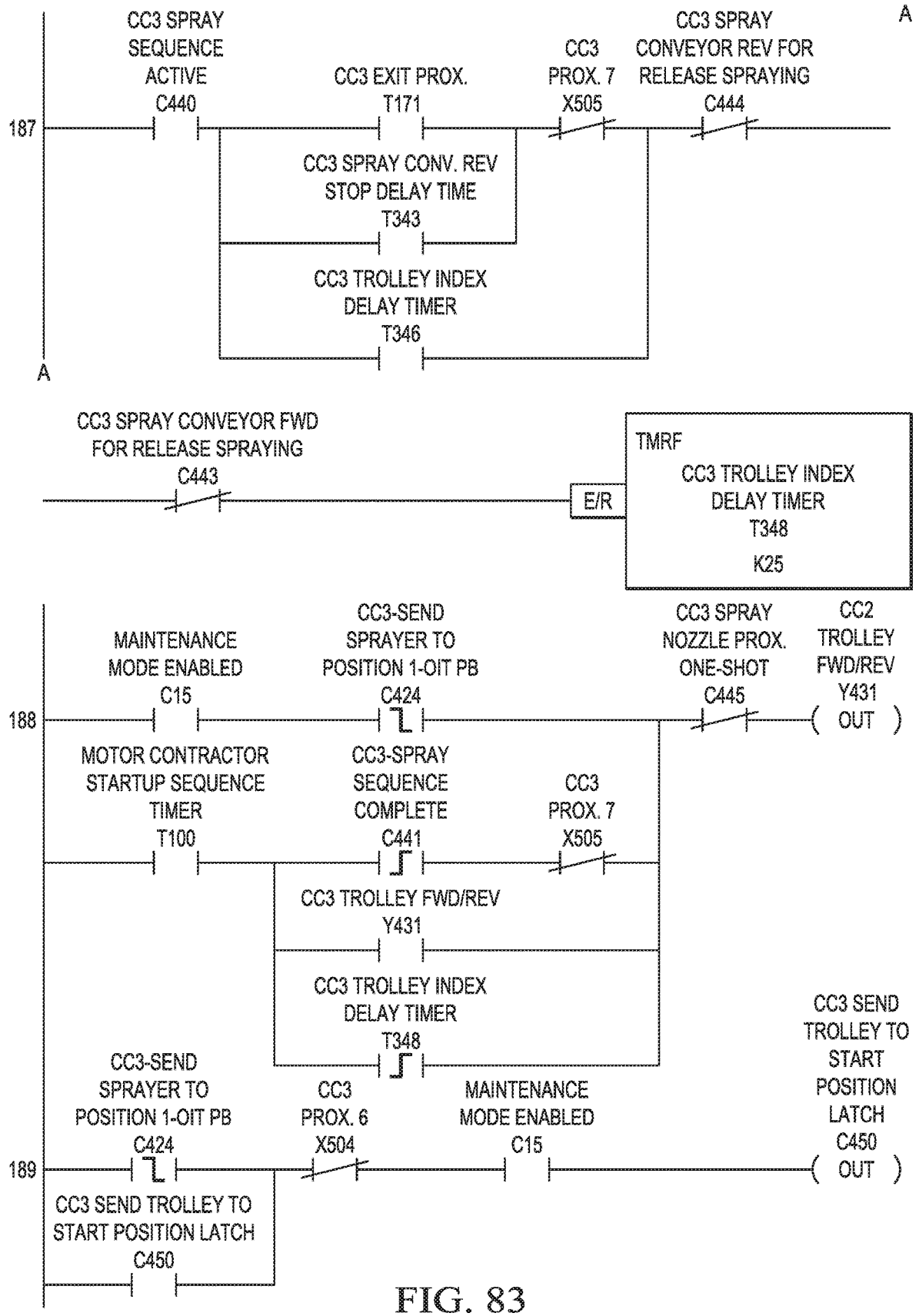
Figure 84:
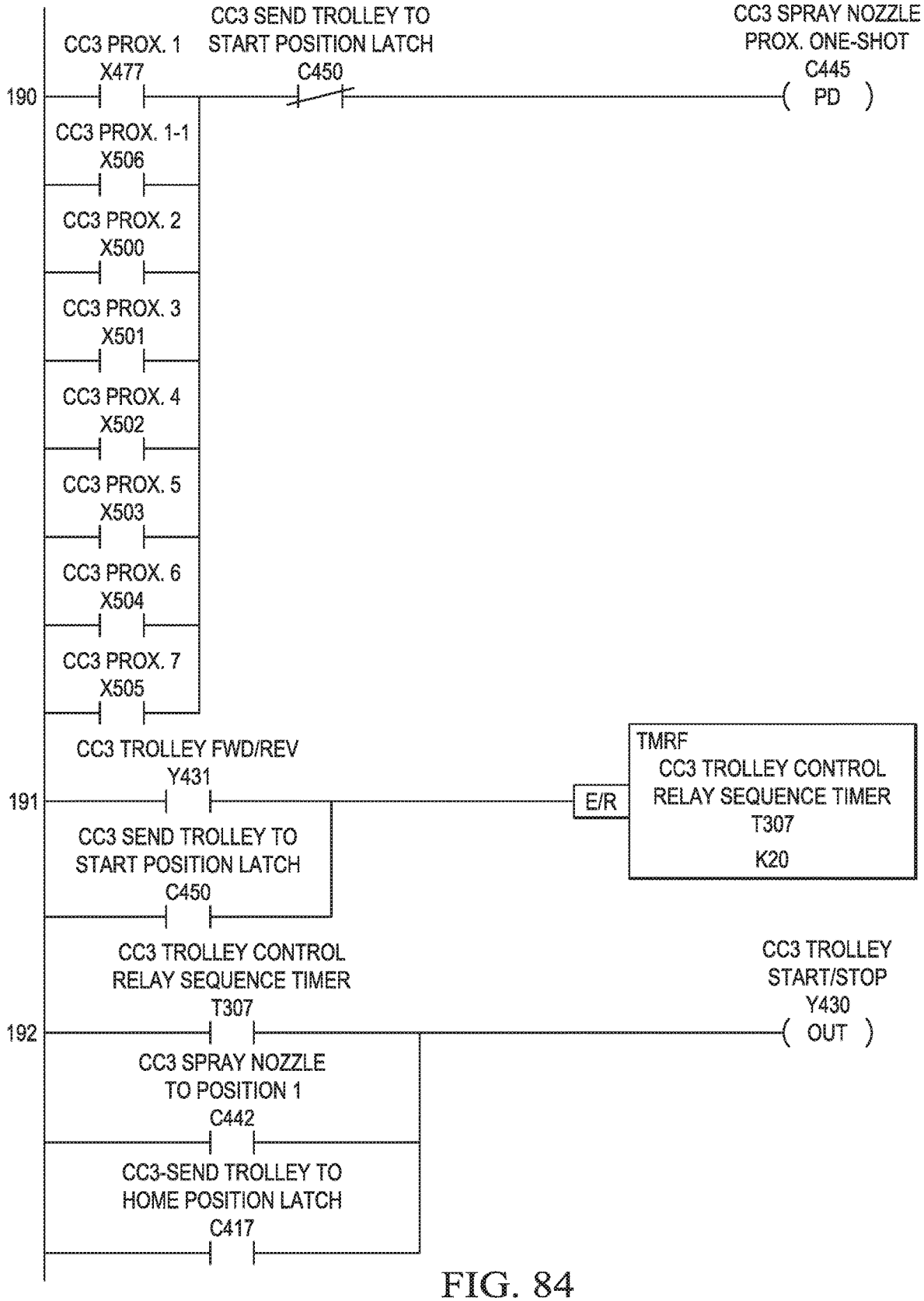
Figure 85:
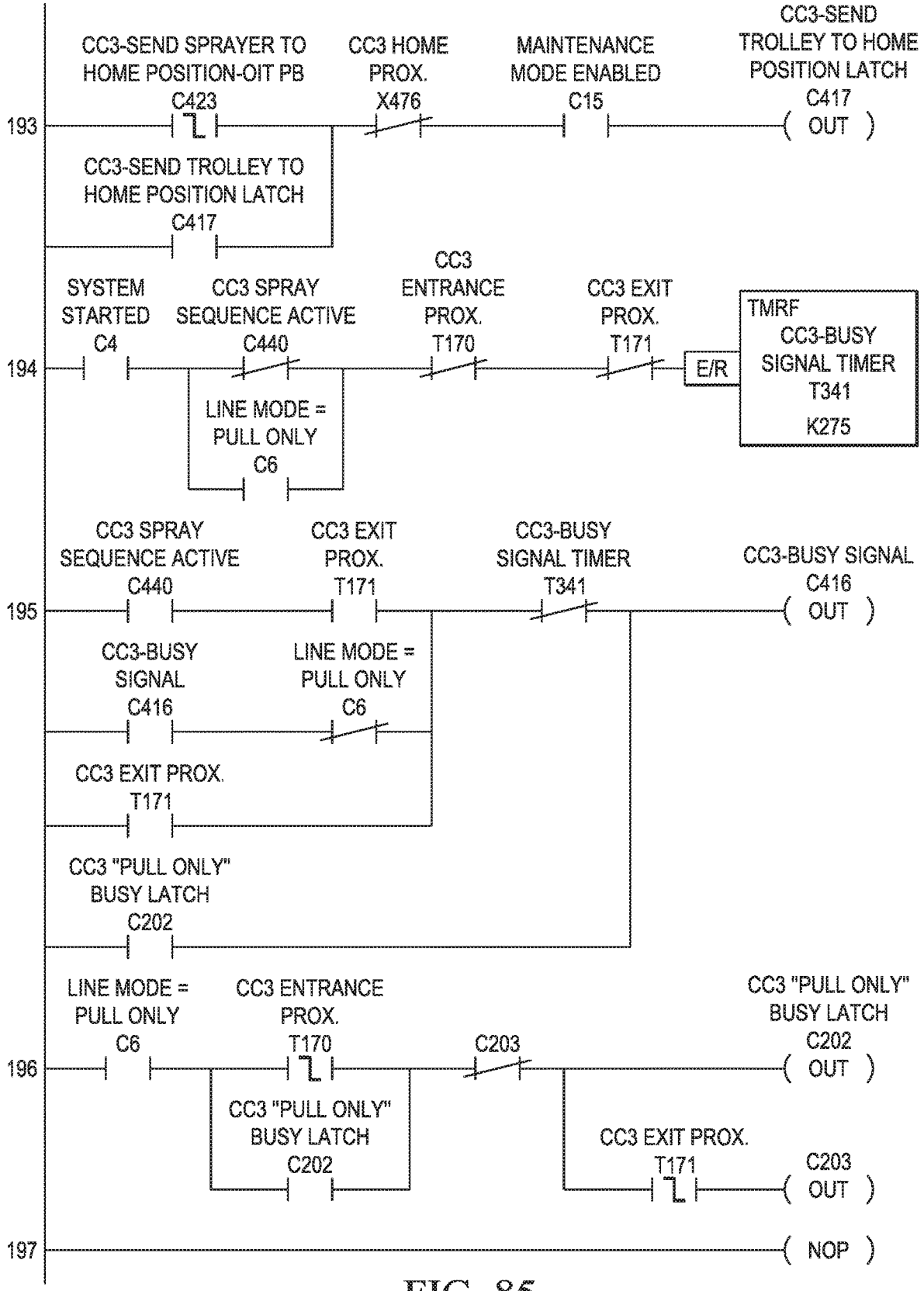
Figure 86:
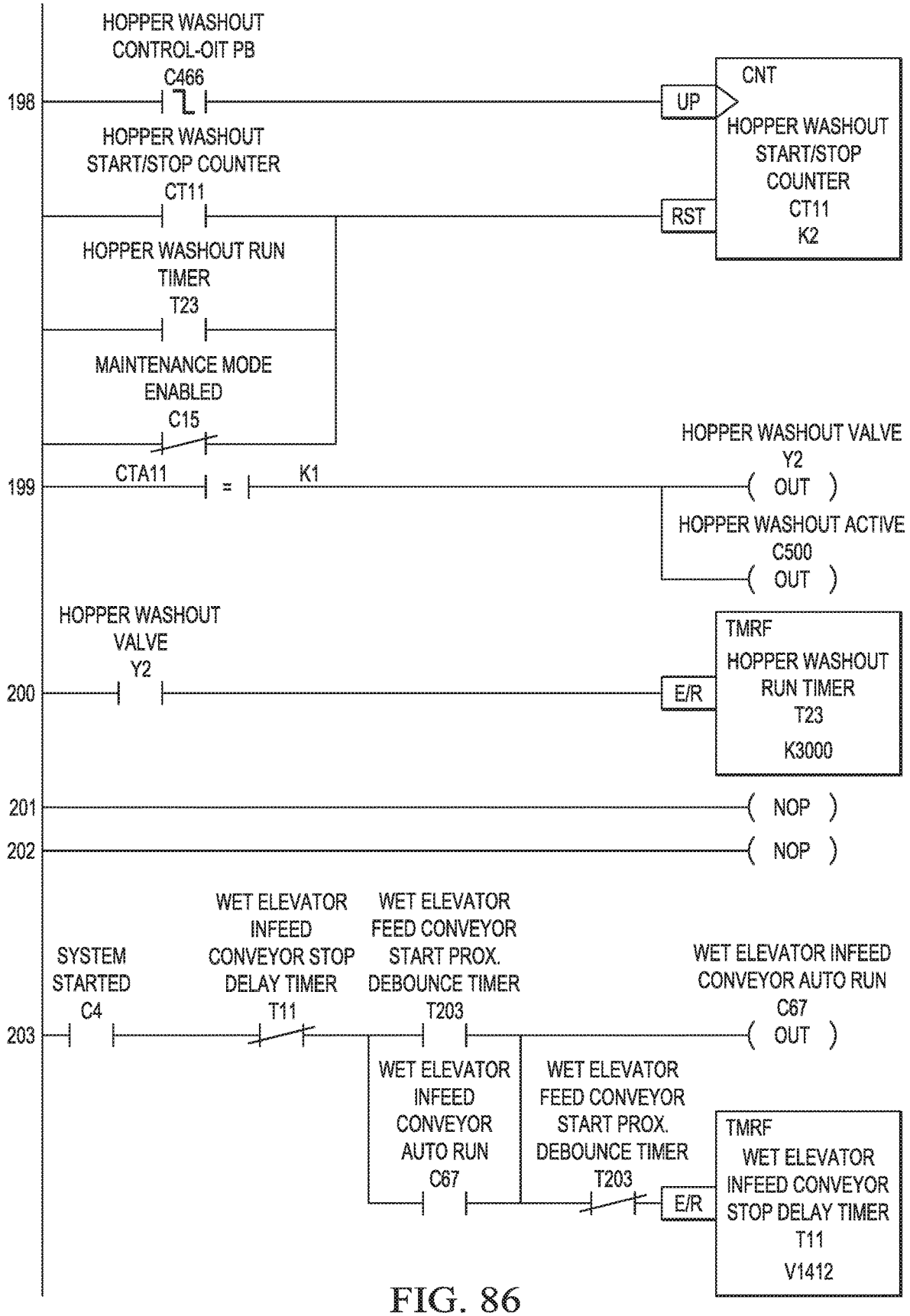
Figure 87:
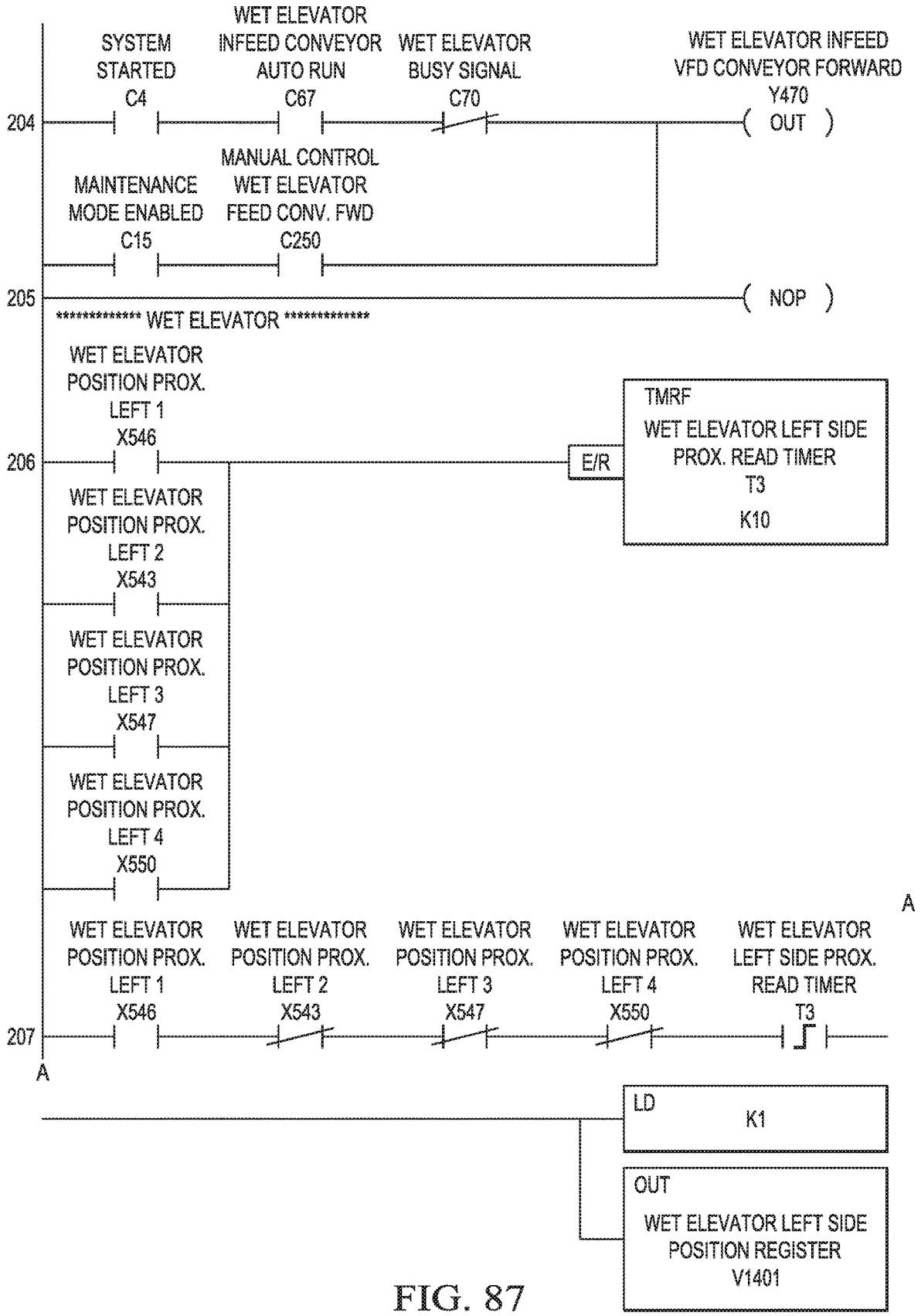
Figure 88:
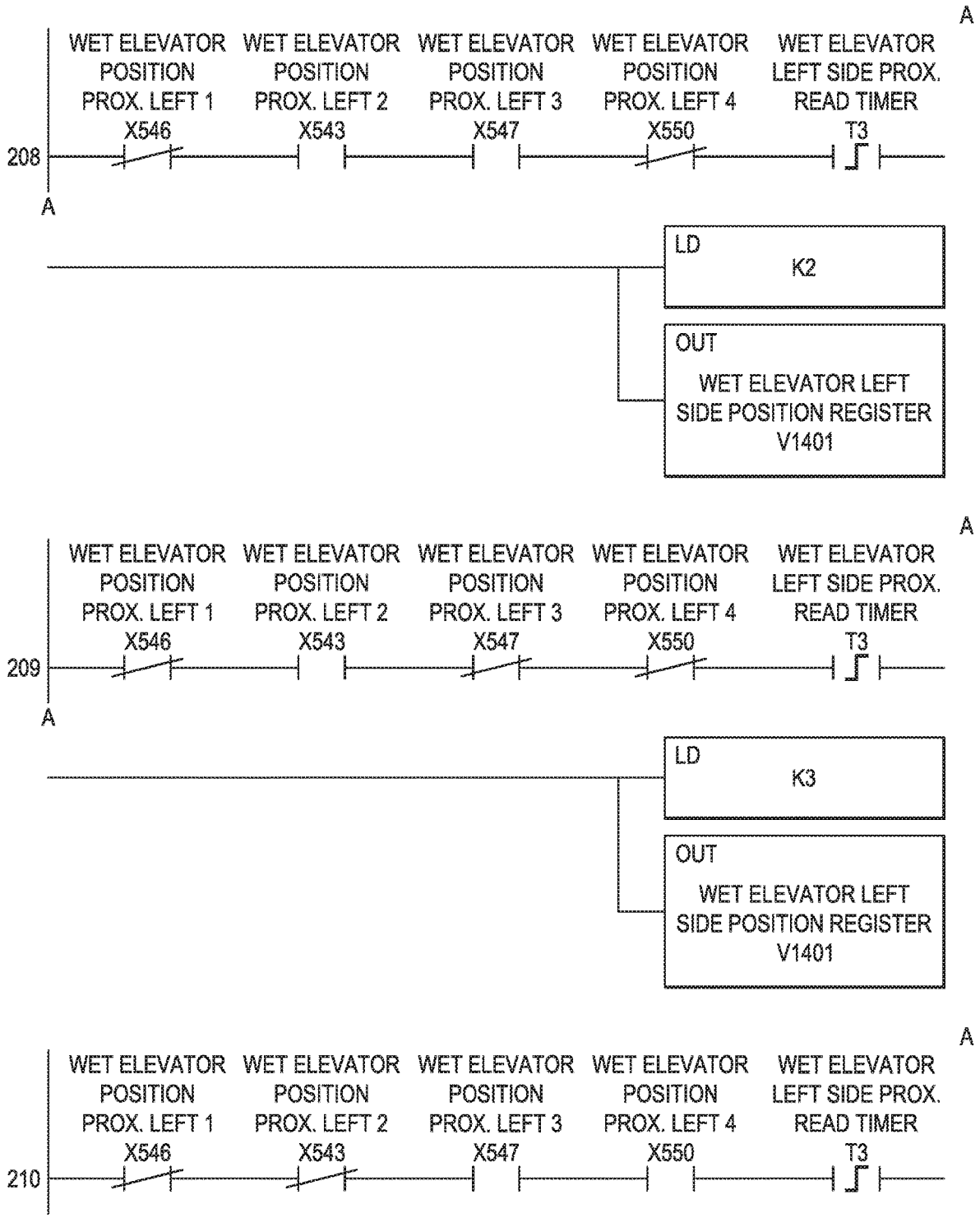
Figure 89:
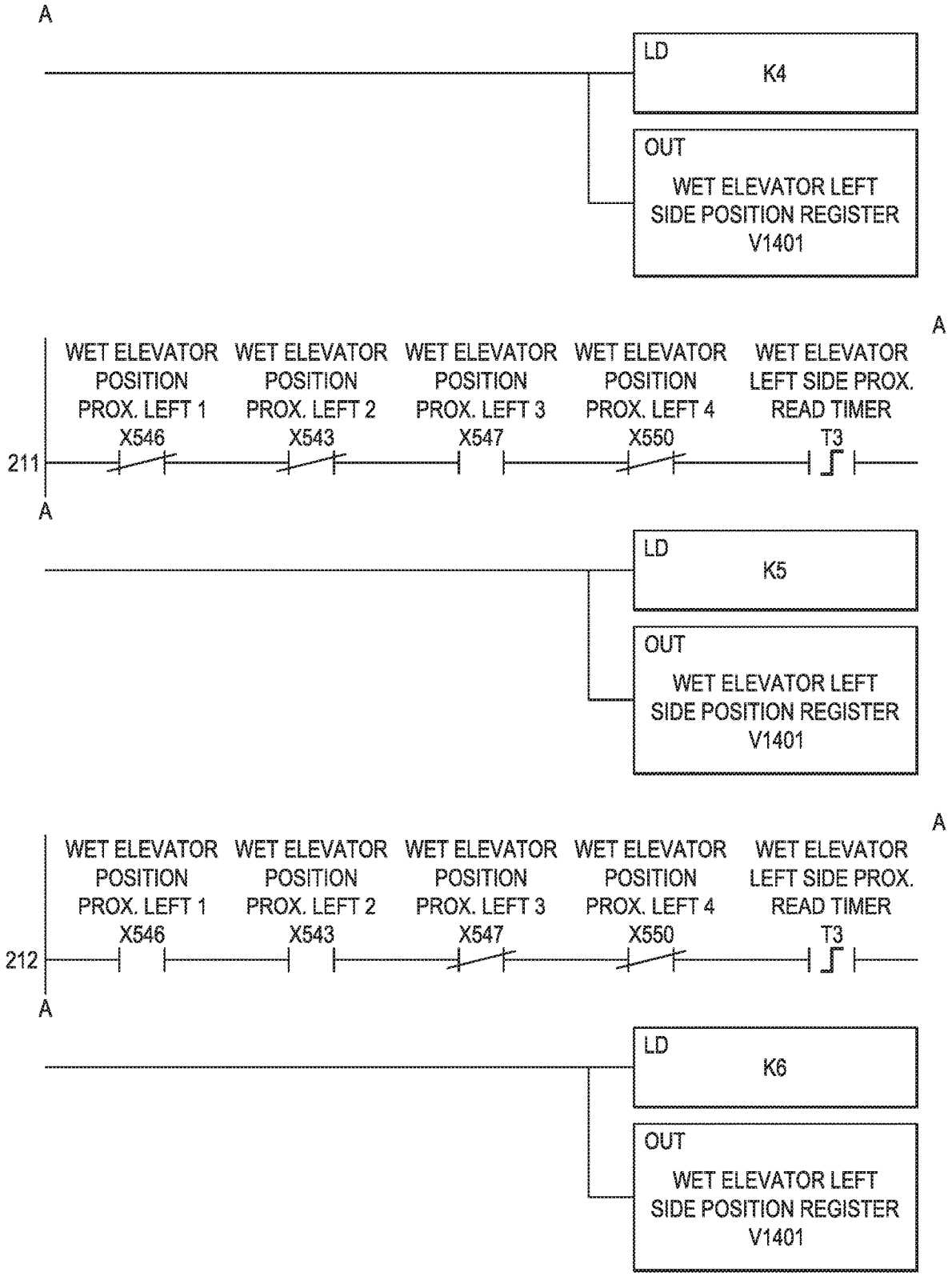
Figure 90:
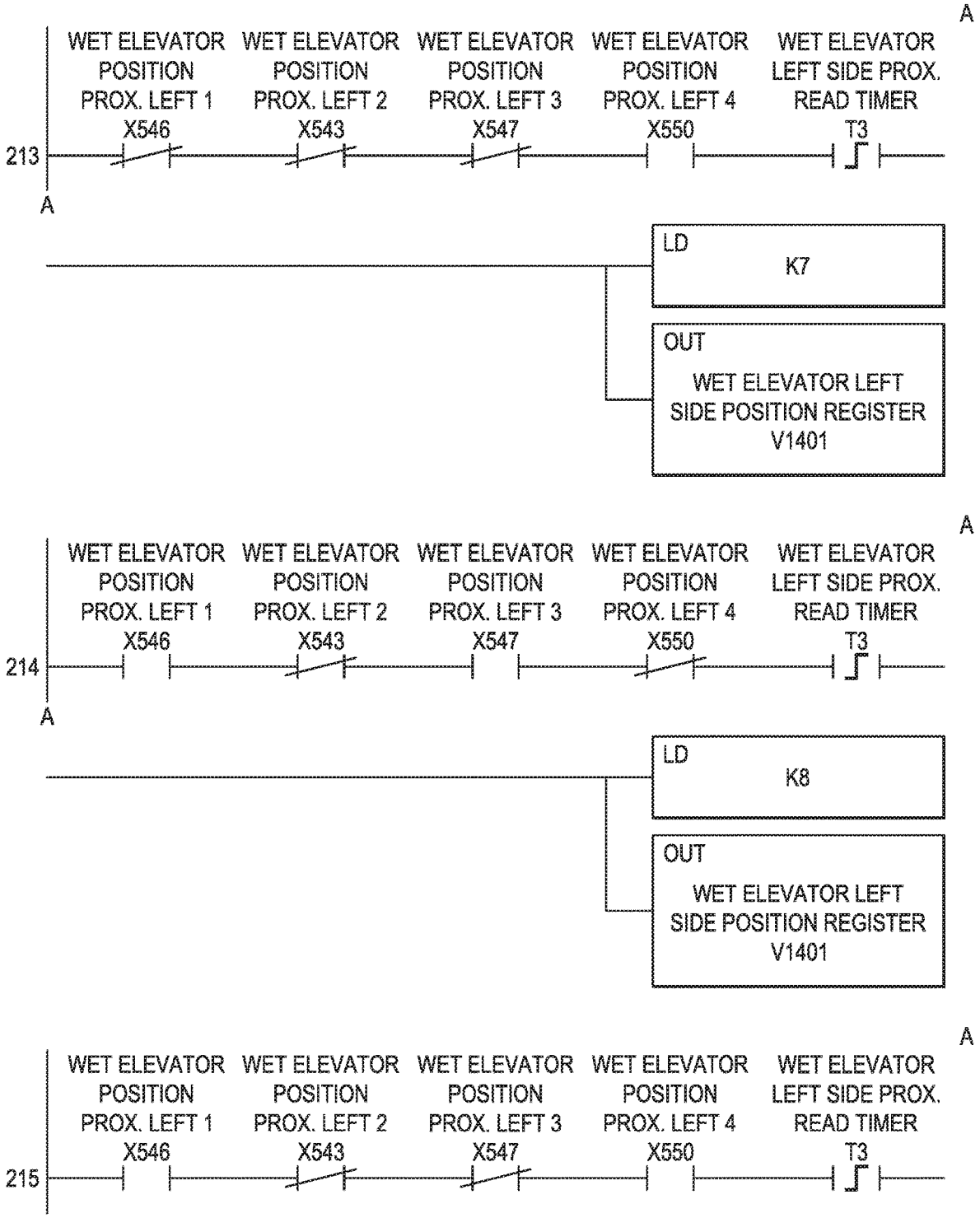
Figure 91:
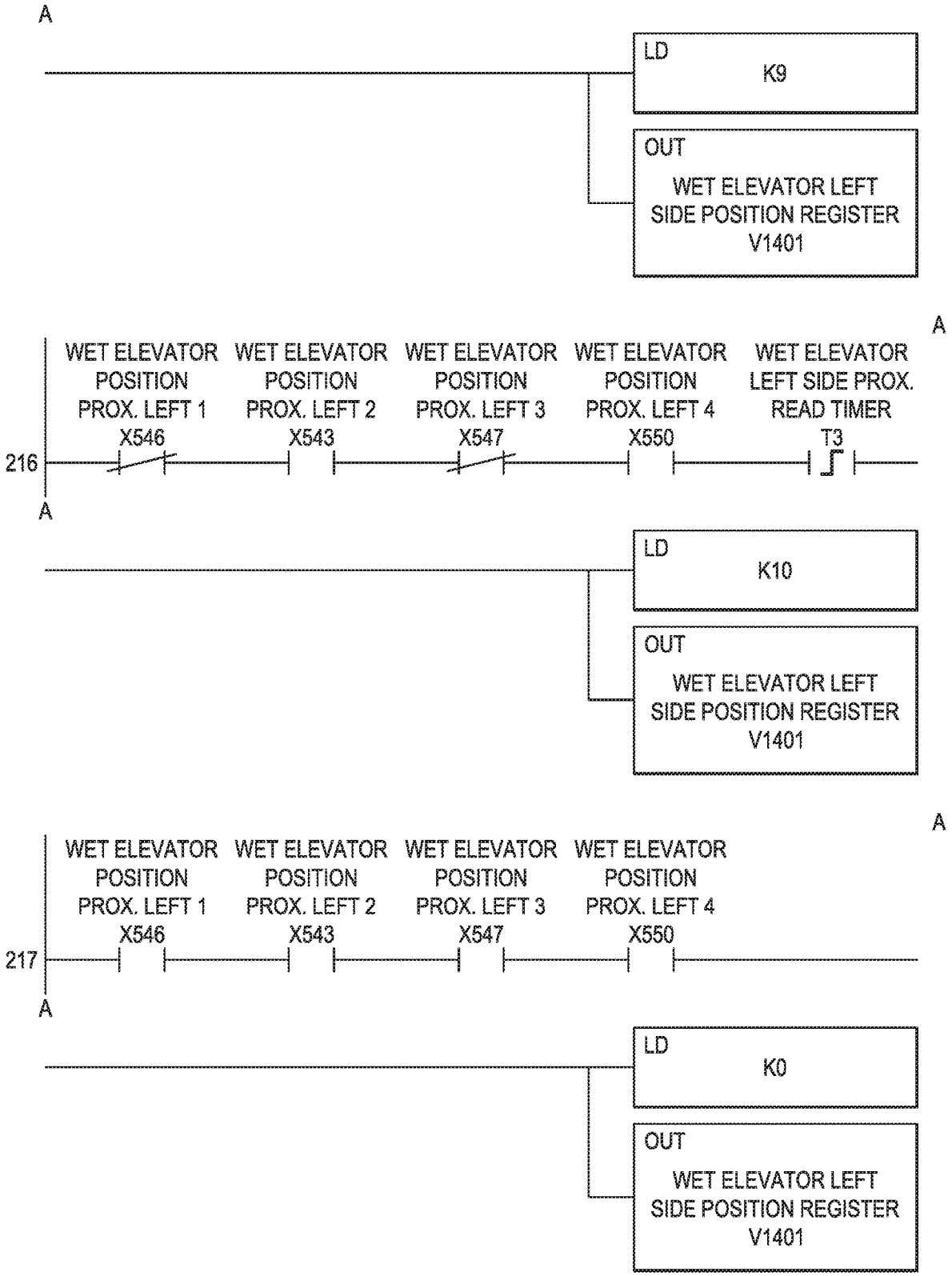
Figure 92:
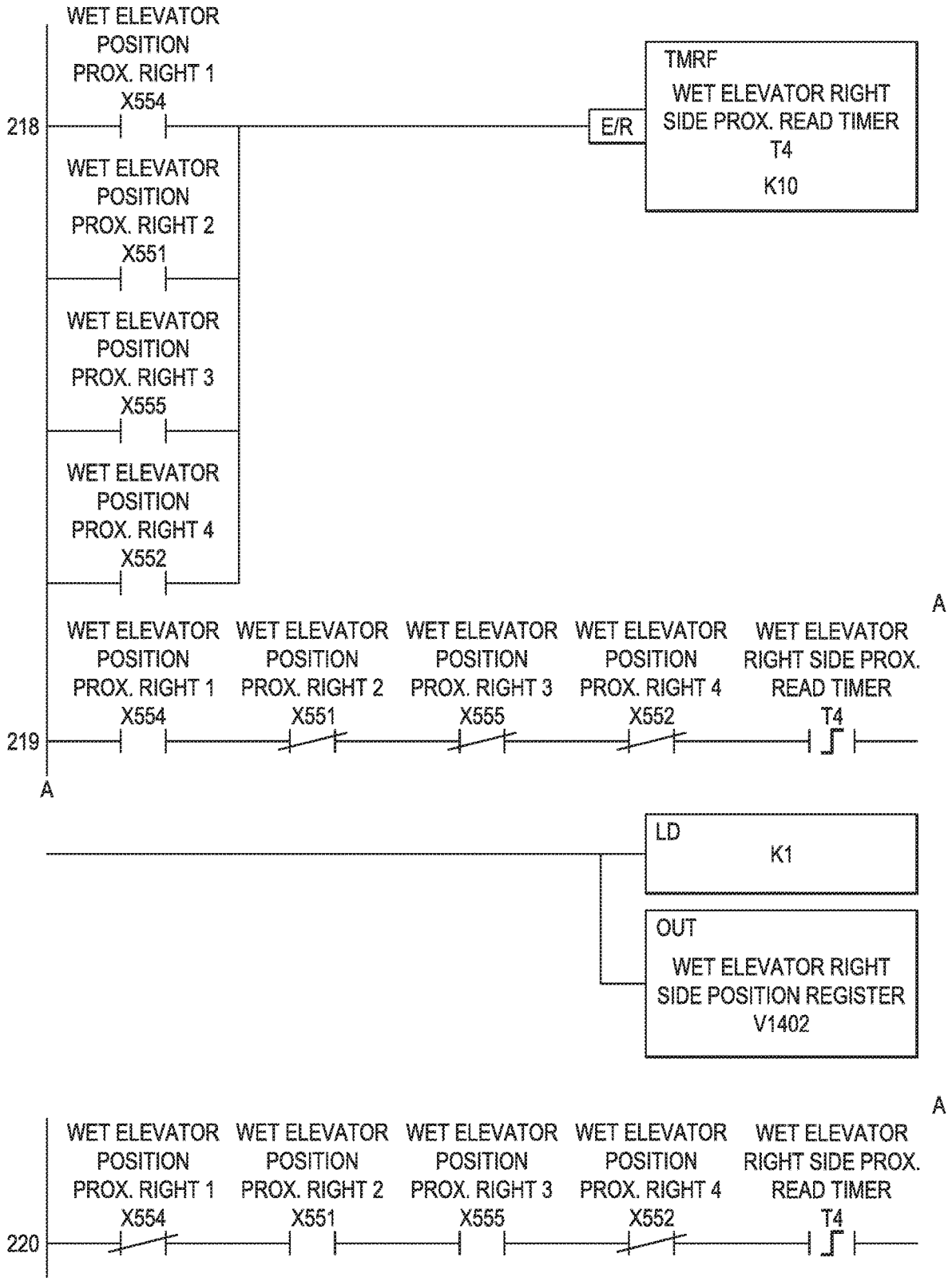
Figure 93:
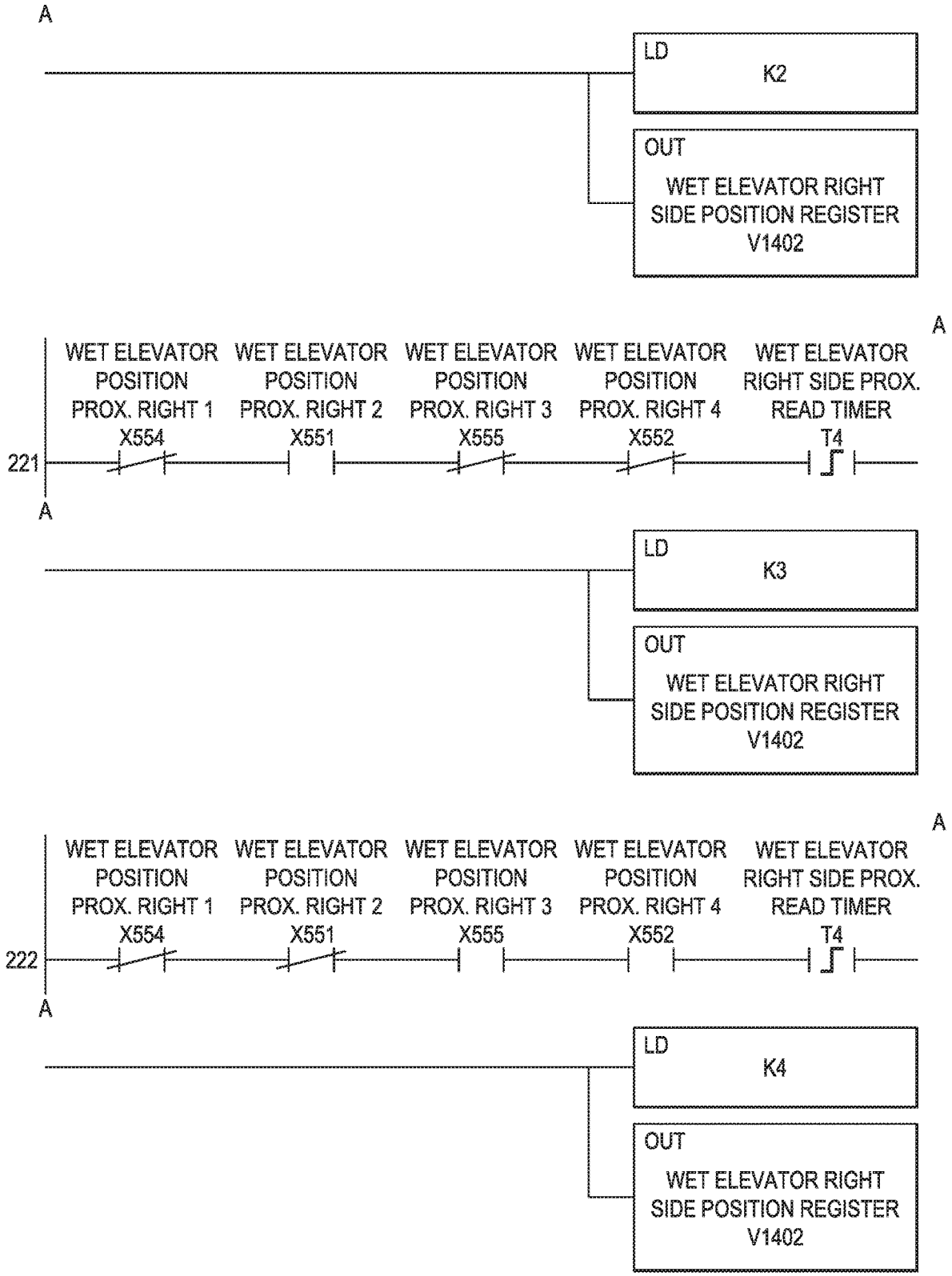
Figure 94:
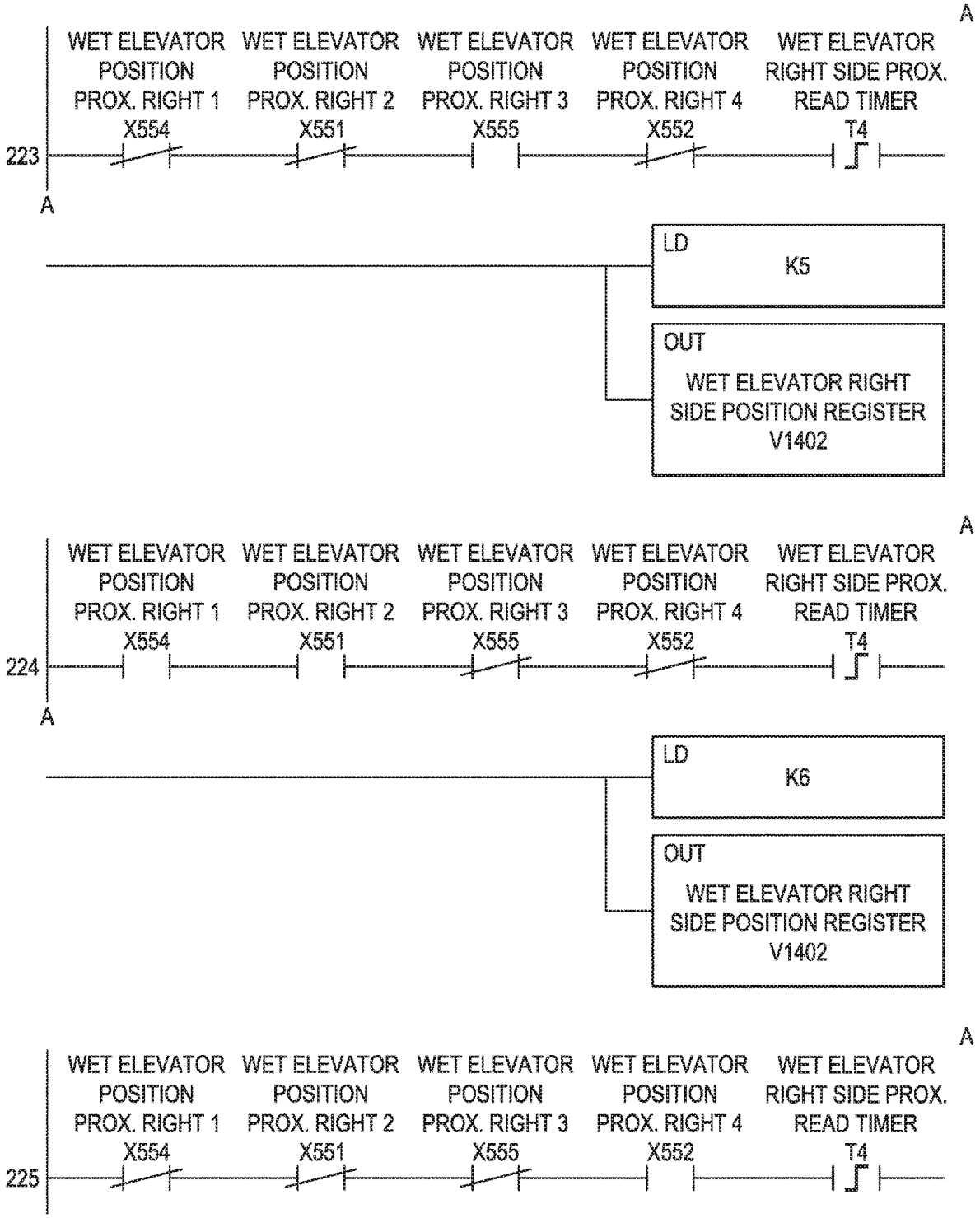
Figure 95:
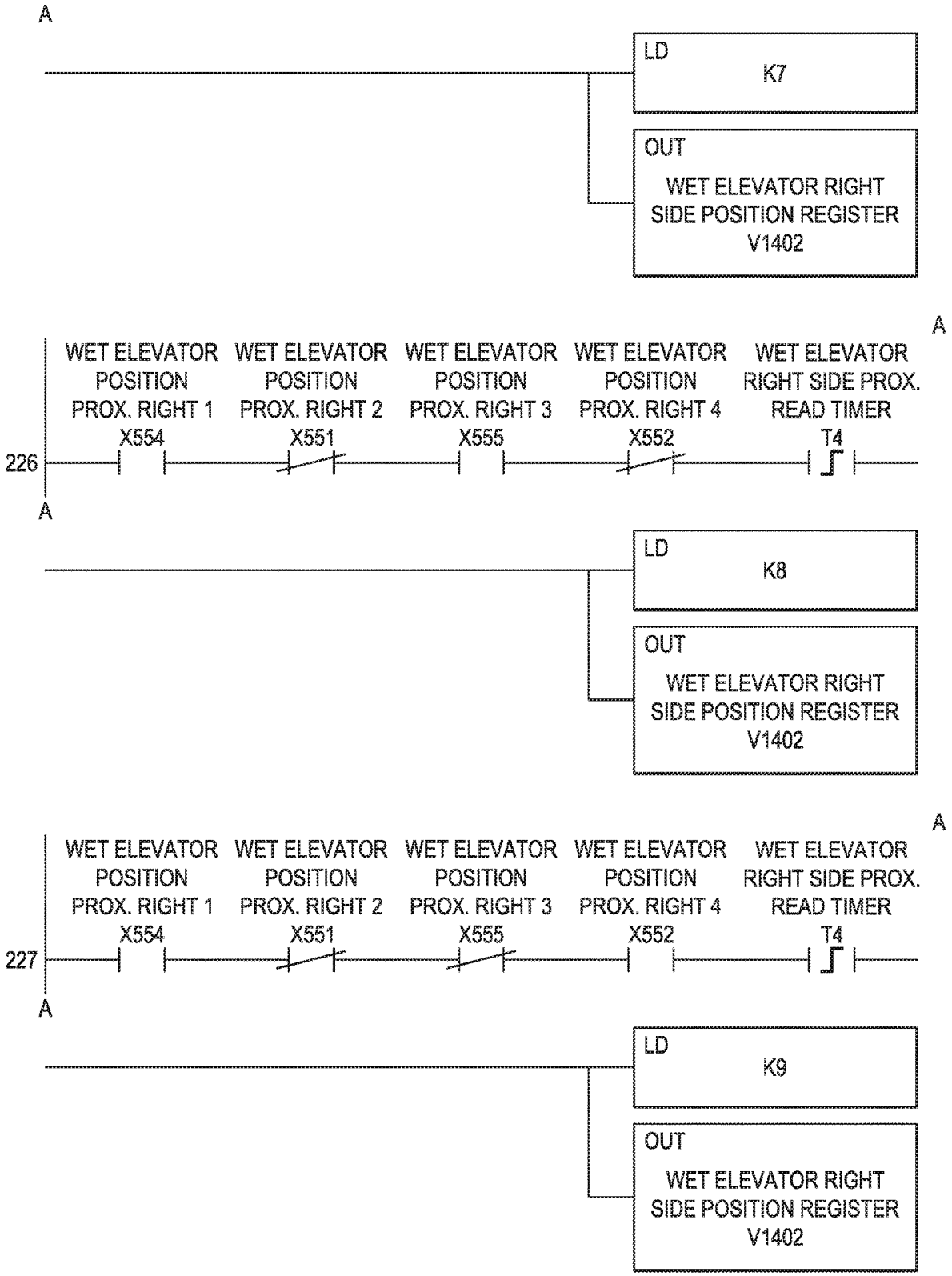
Figure 96:
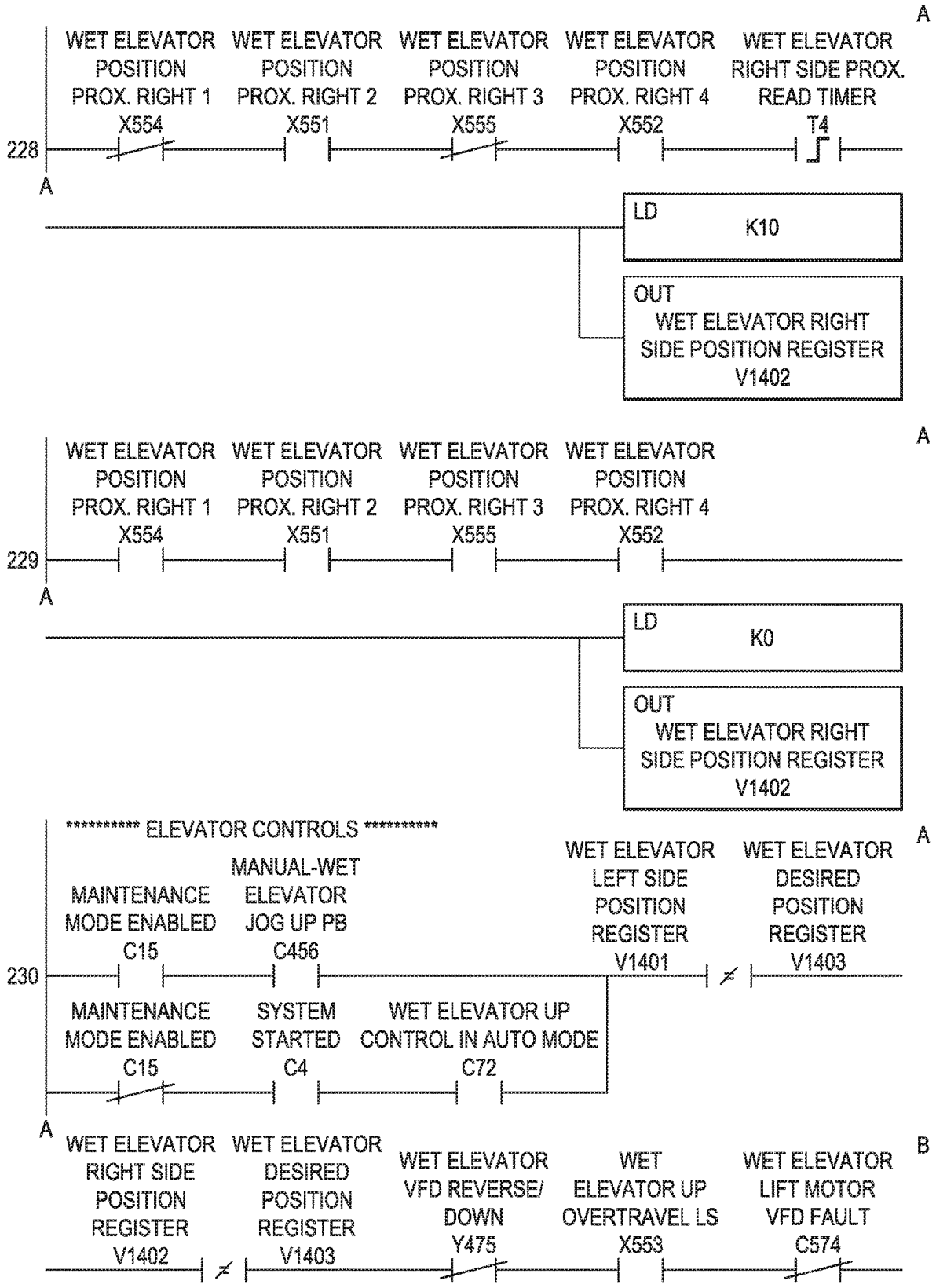
Figure 97:
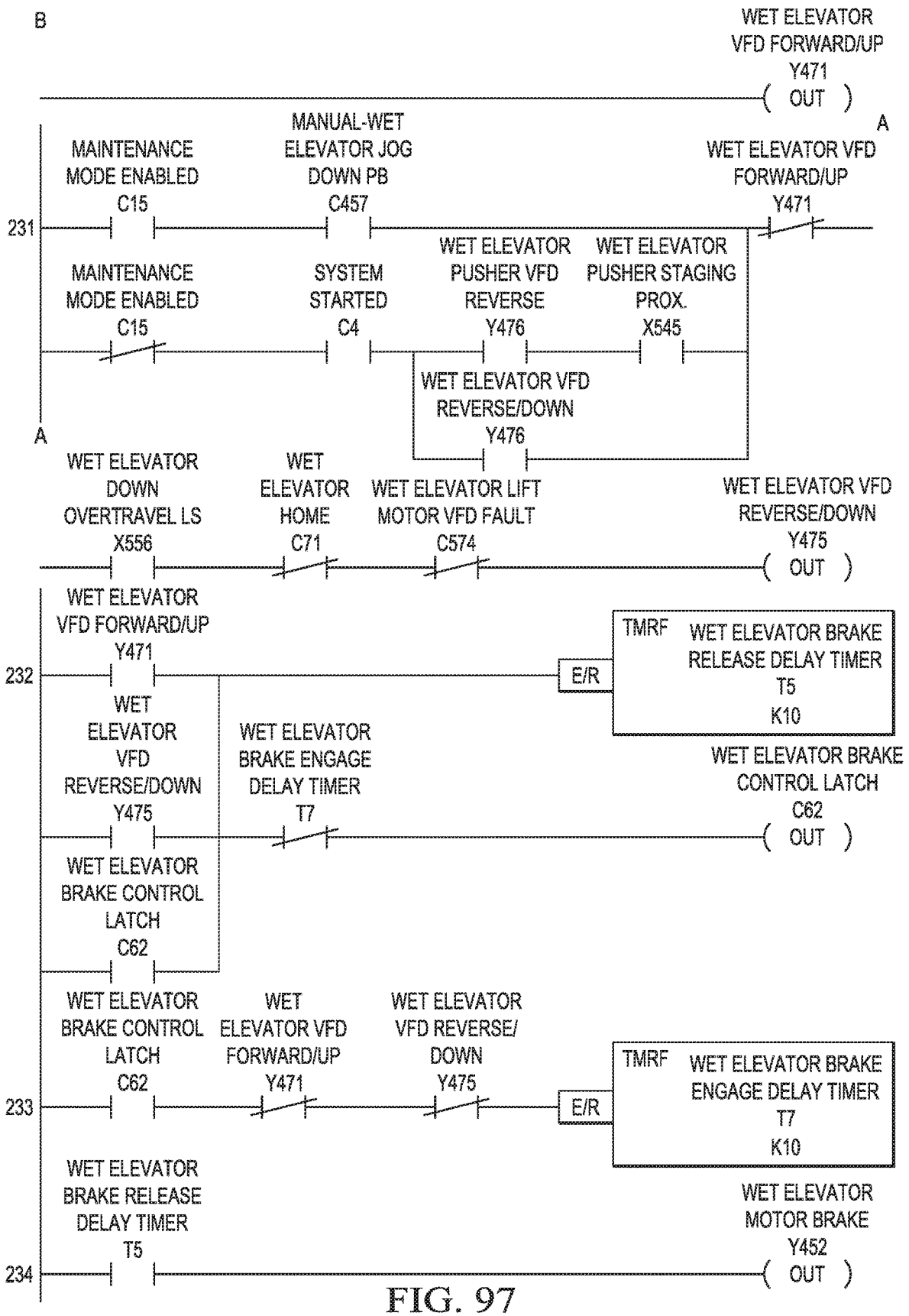
Figure 98:
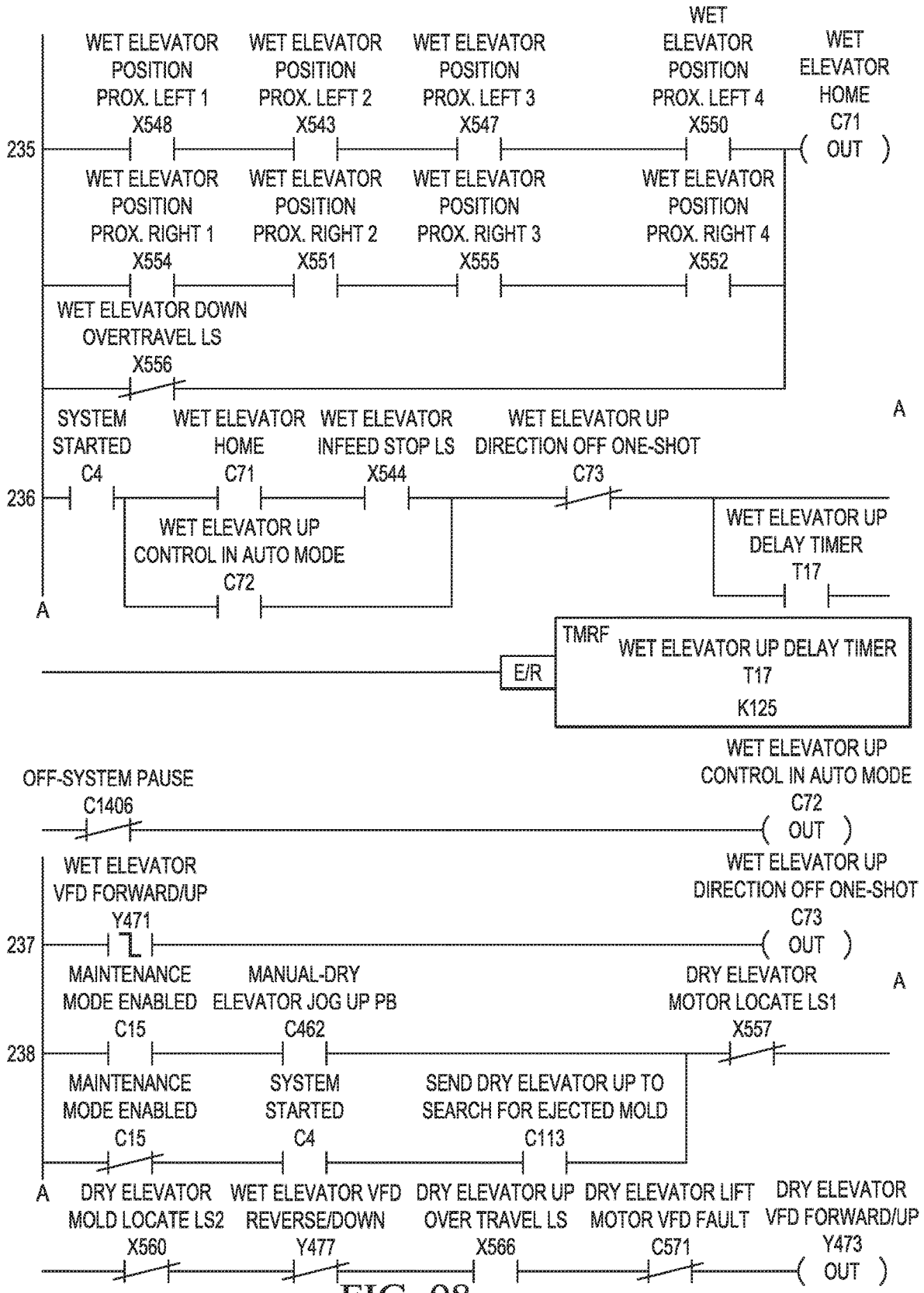
Figure 99:
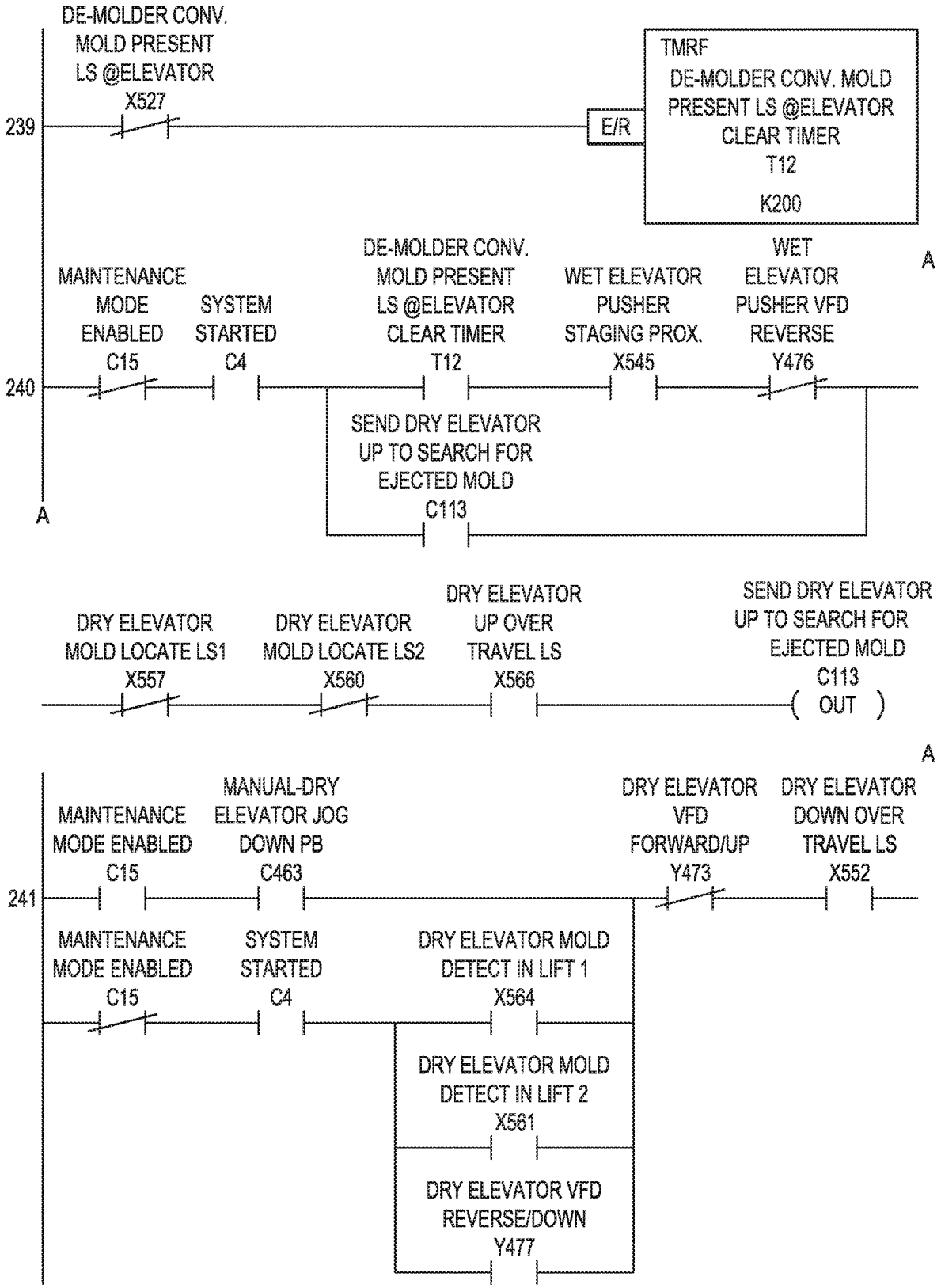
Figure 100:
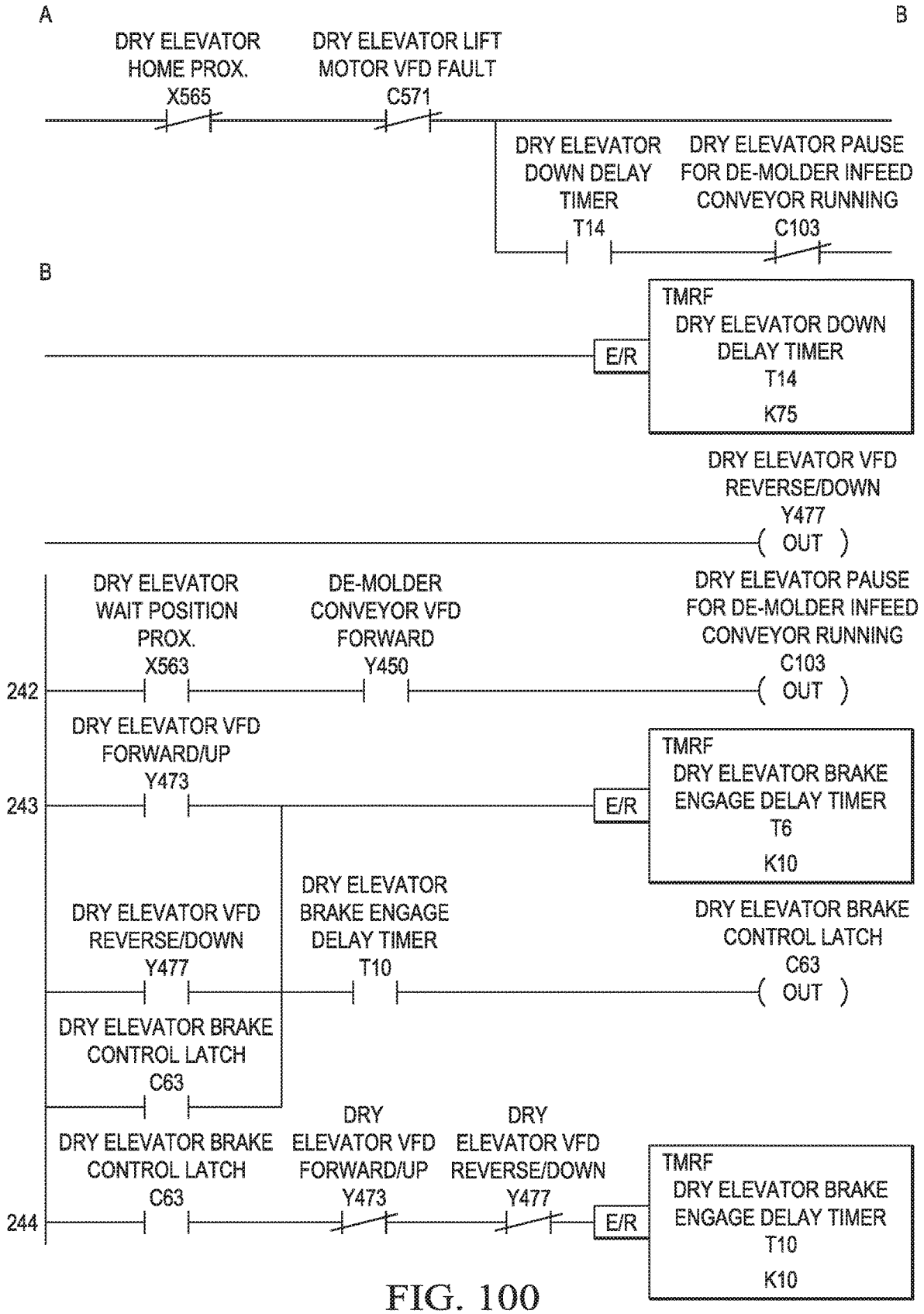
Figure 101:
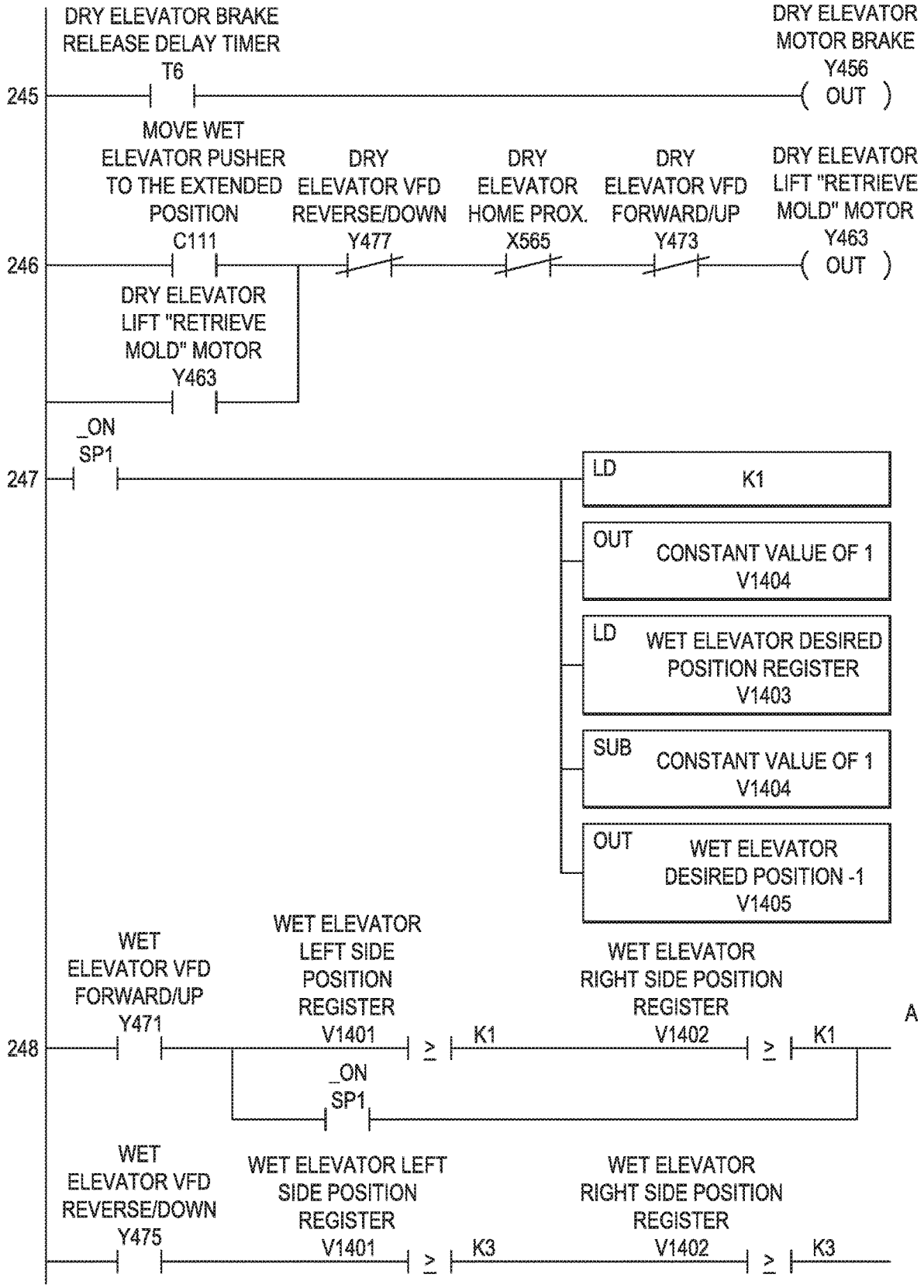
Figure 102:
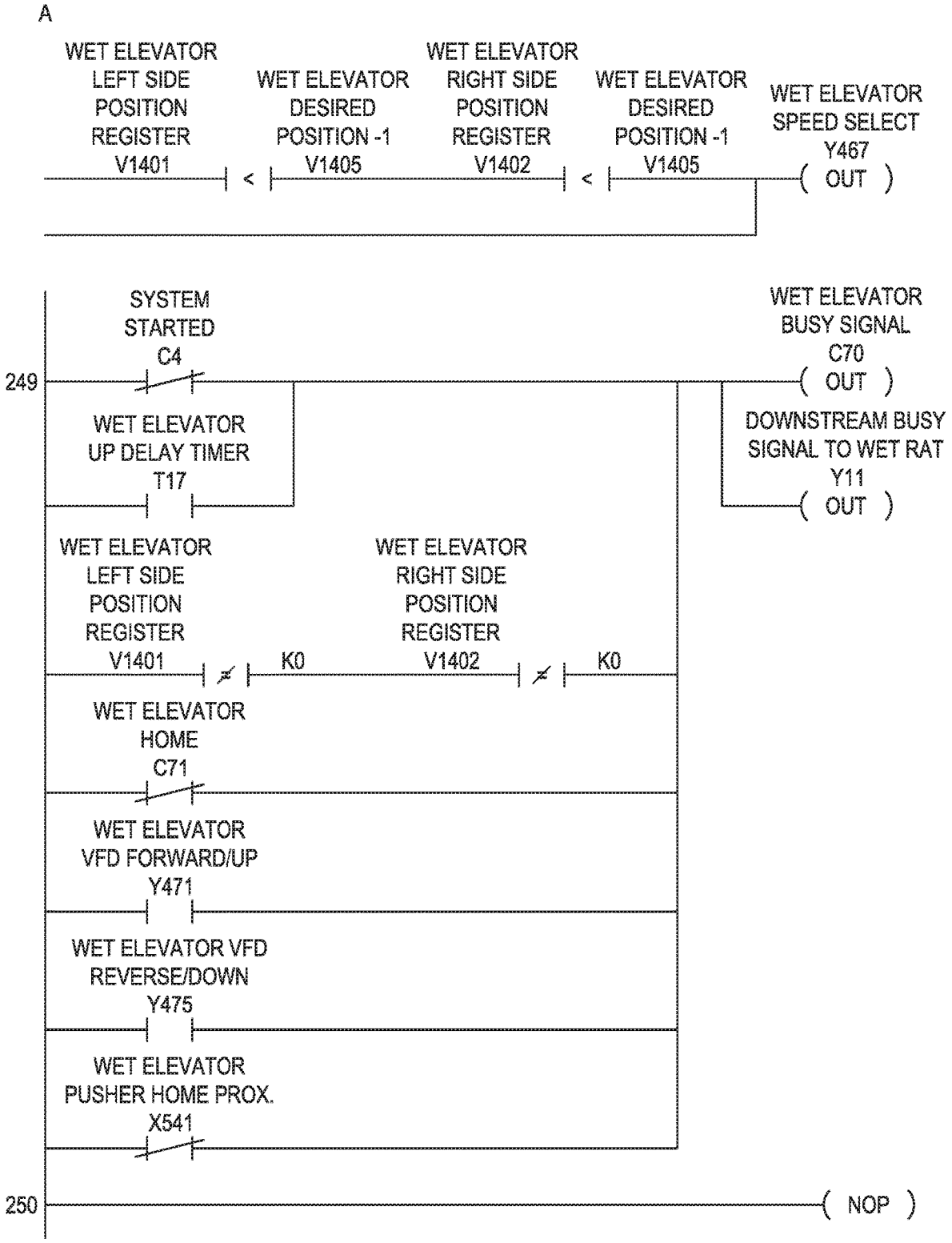
Figure 103:
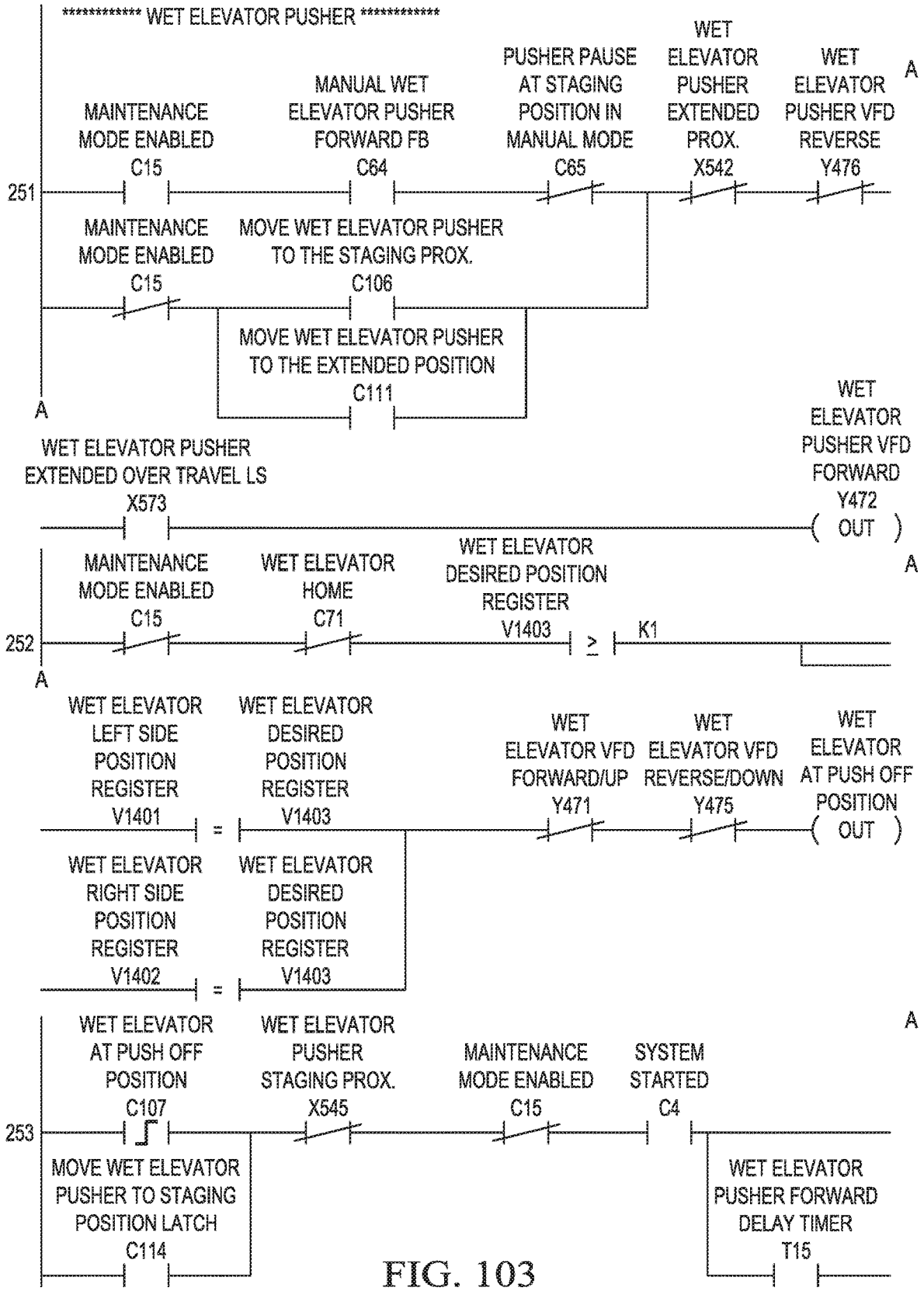
Figure 104:
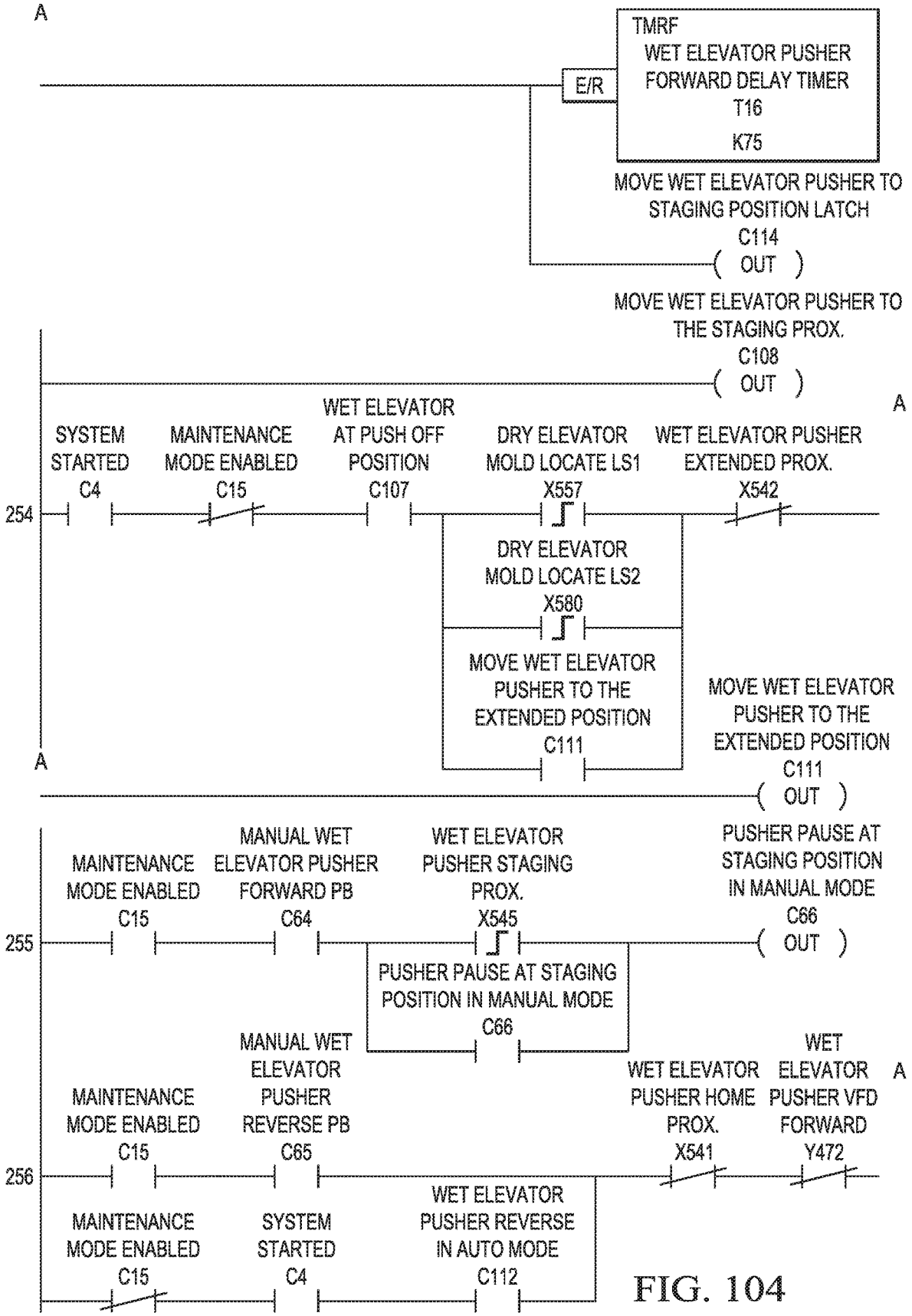
Figure 105:
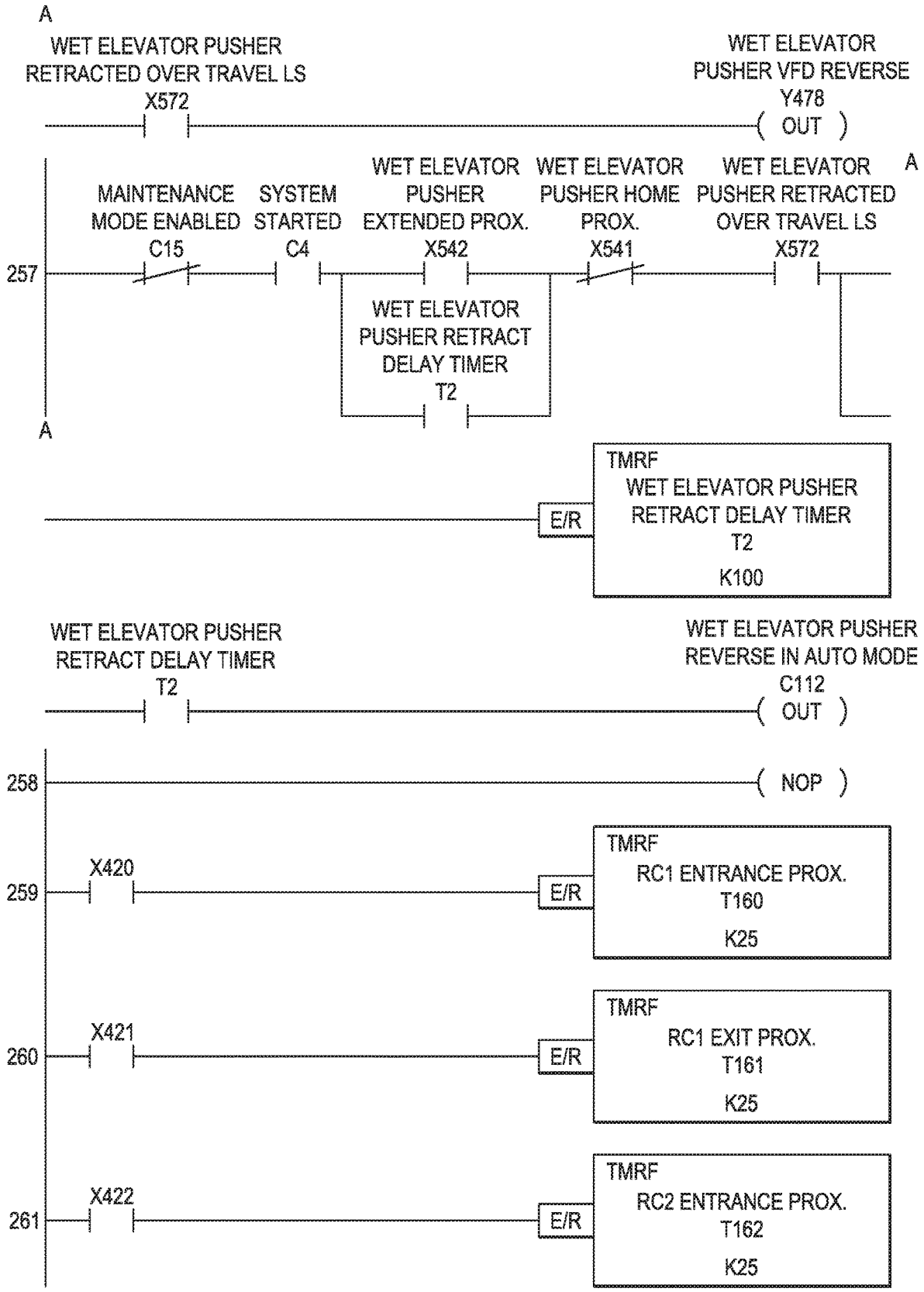
Figure 106:
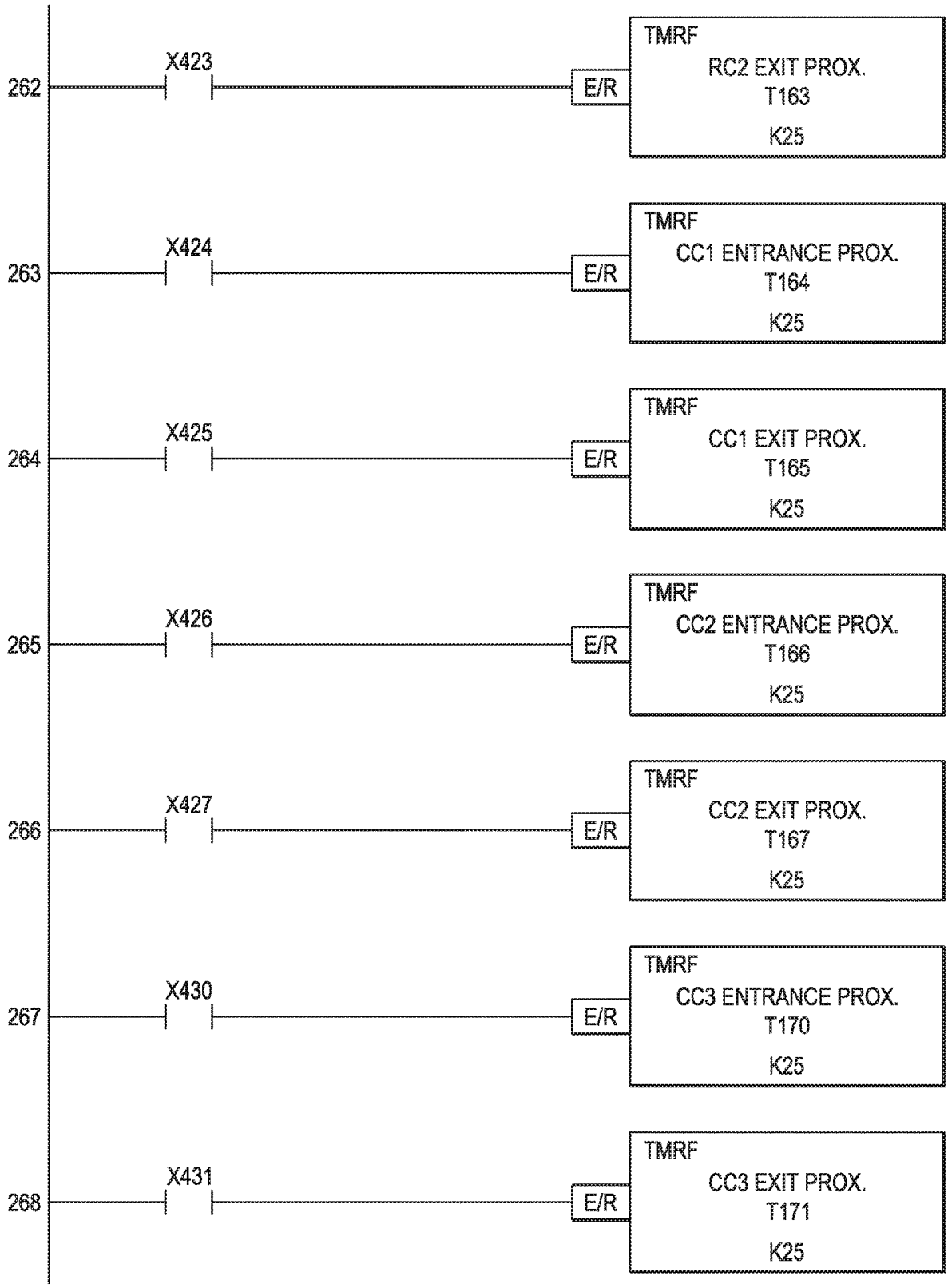
Figure 107:
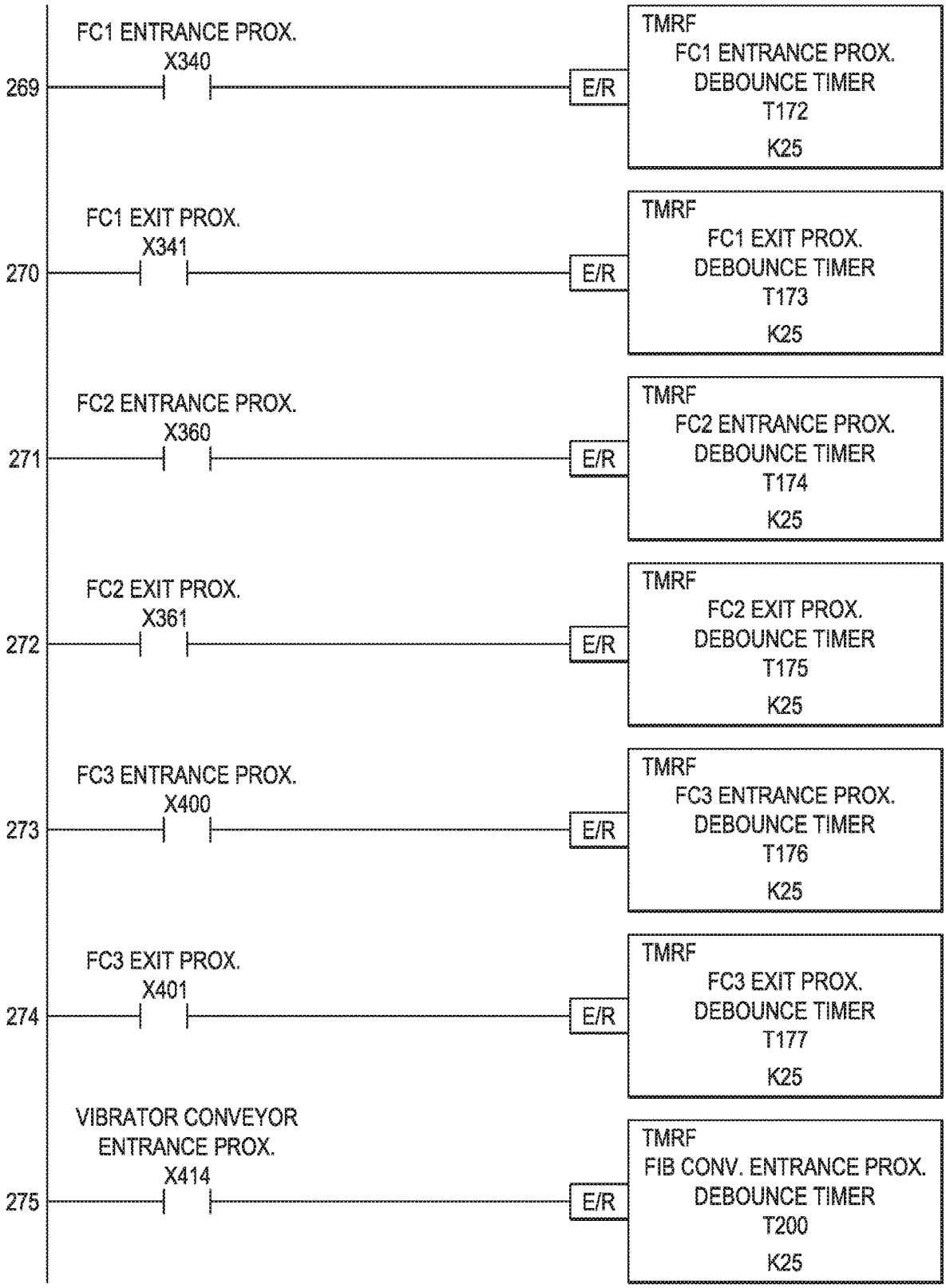
Figure 108:
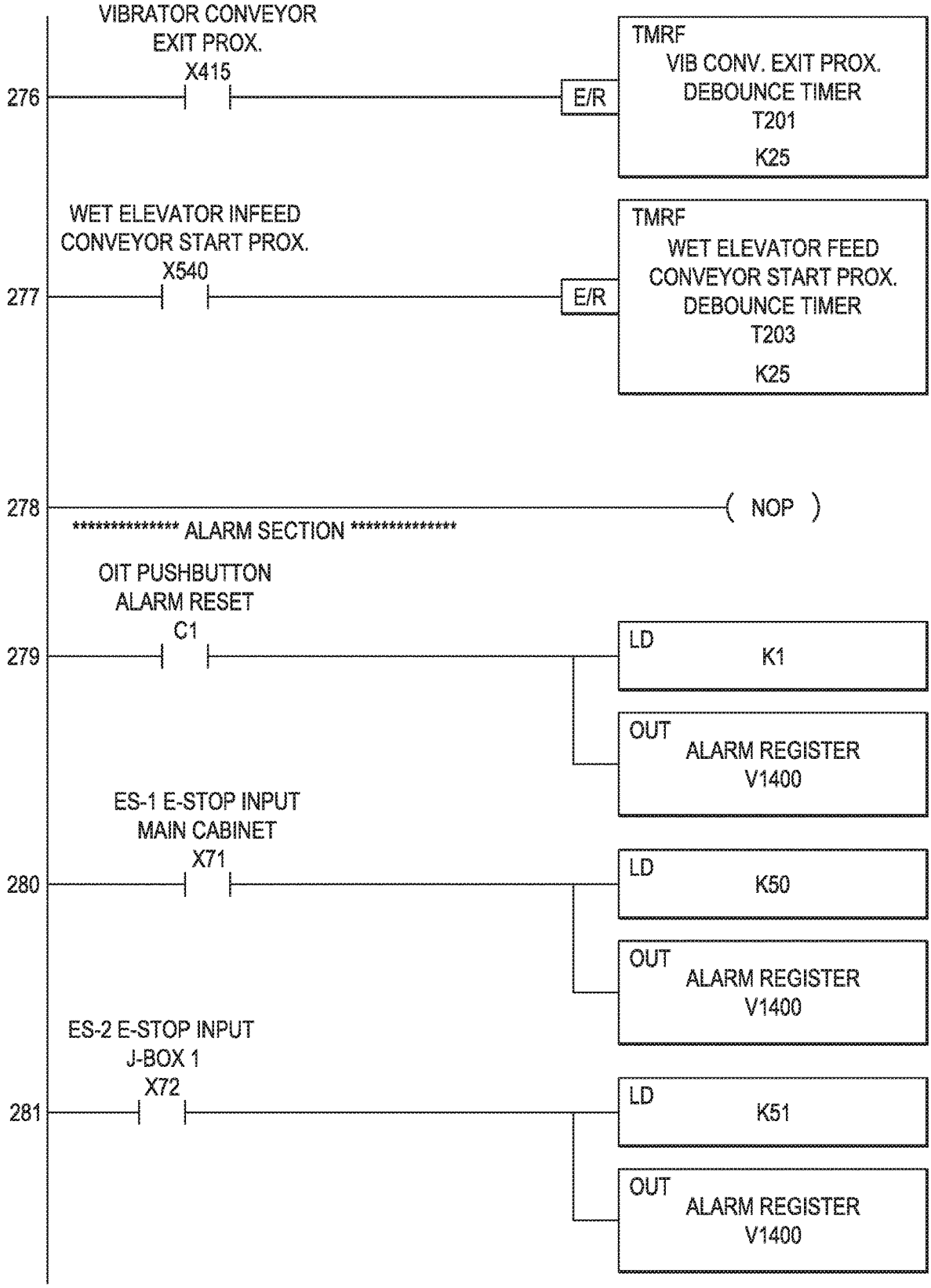
Figure 109:
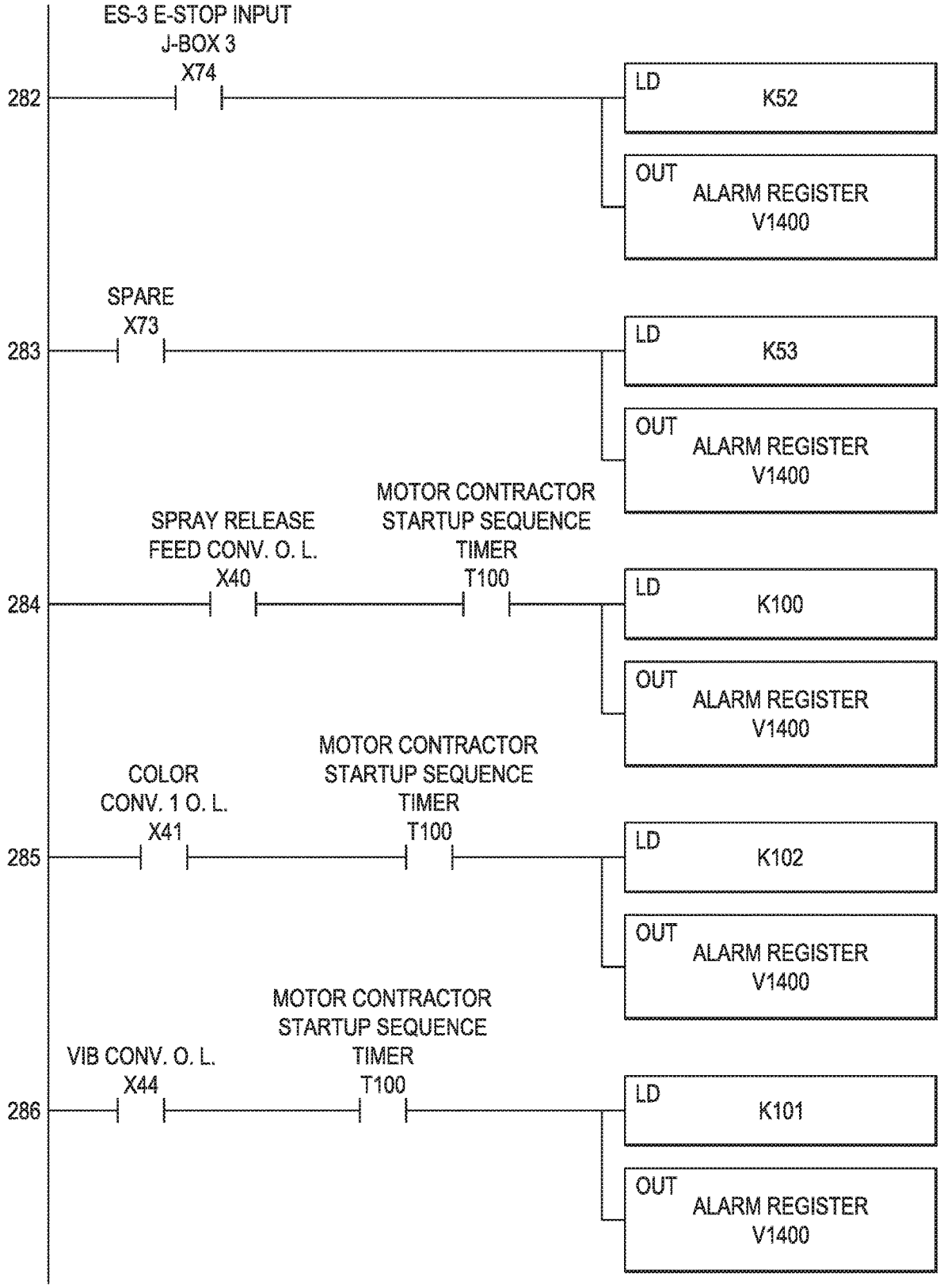
Figure 110:
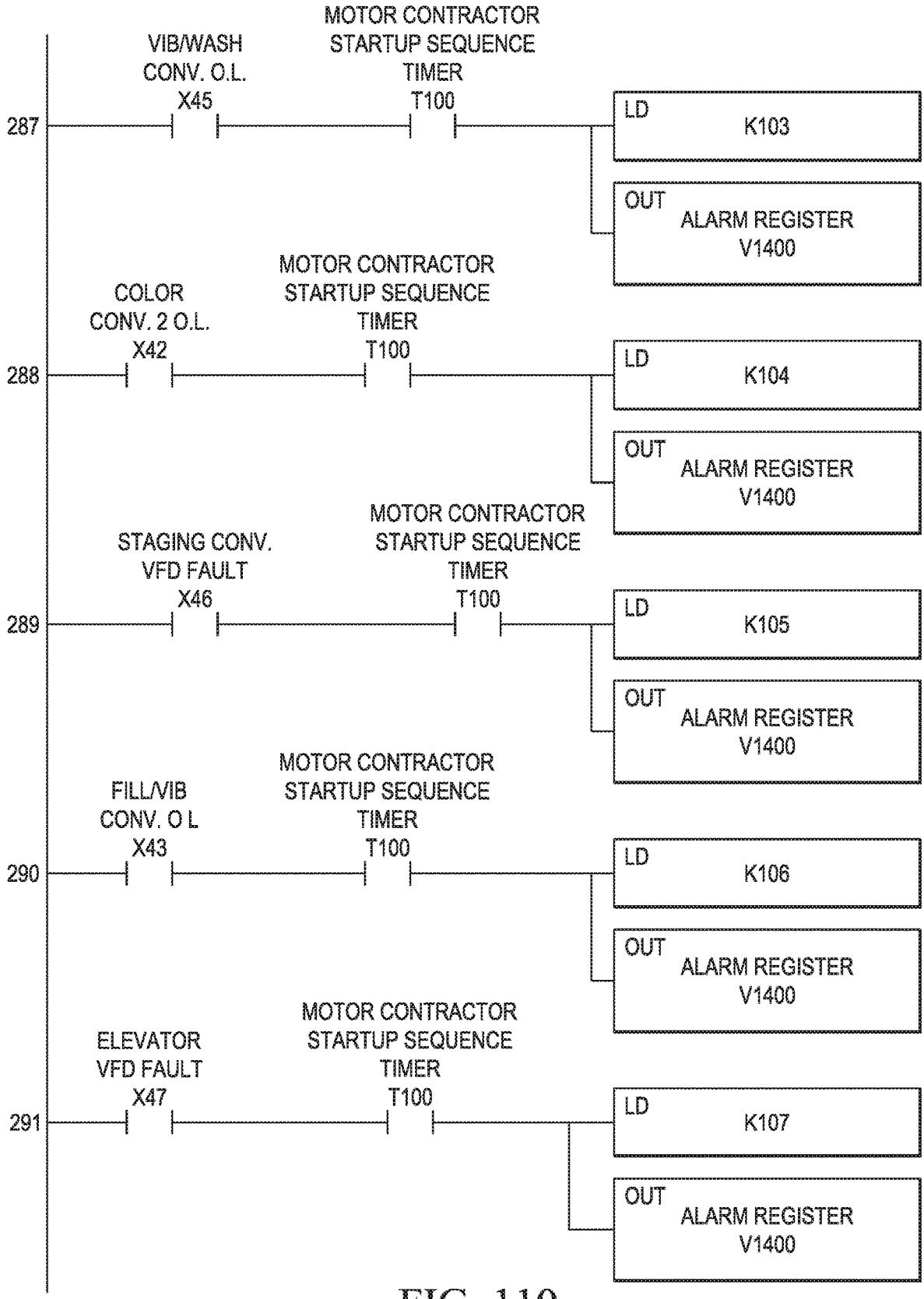
Figure 111:
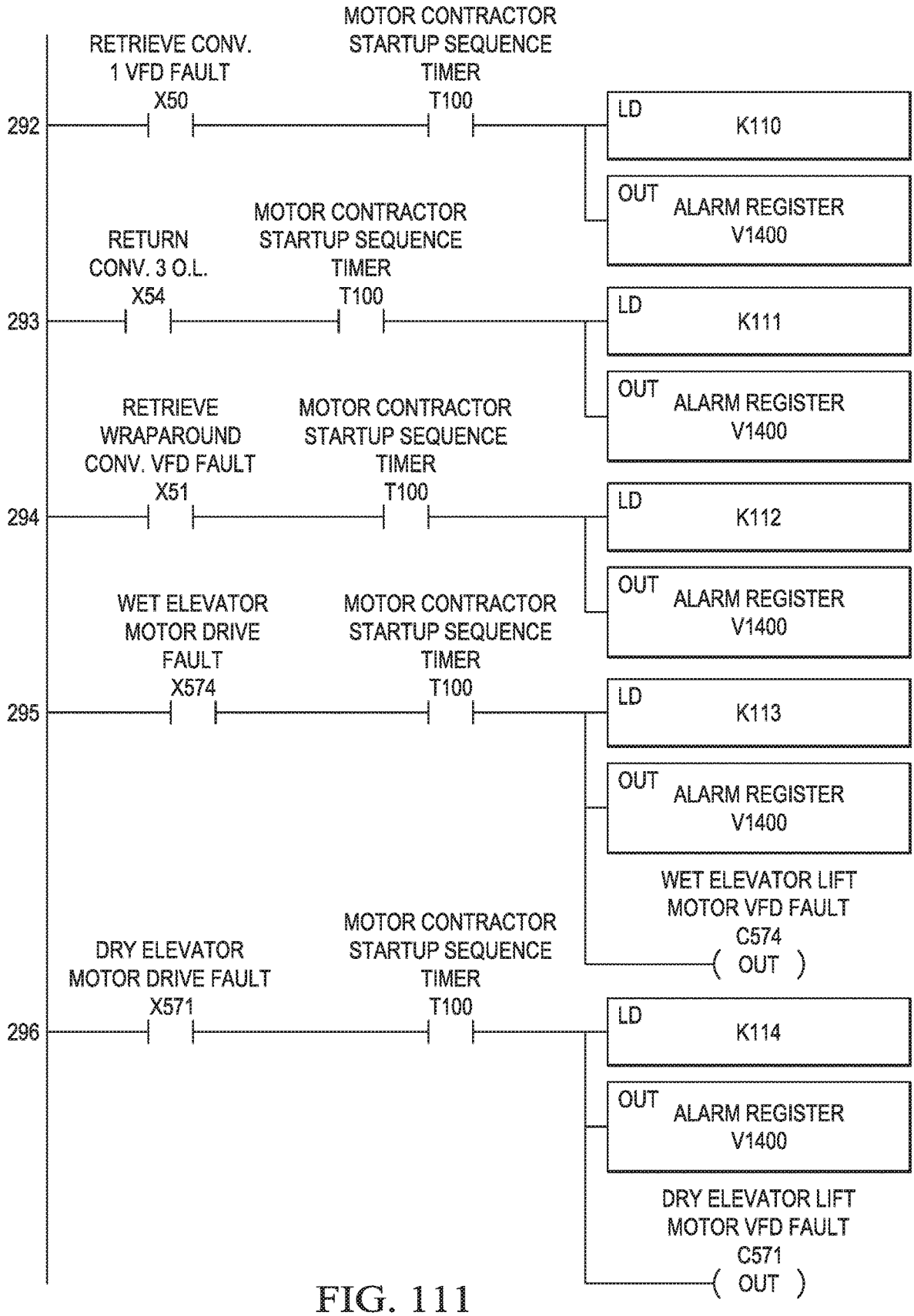
Figure 112:
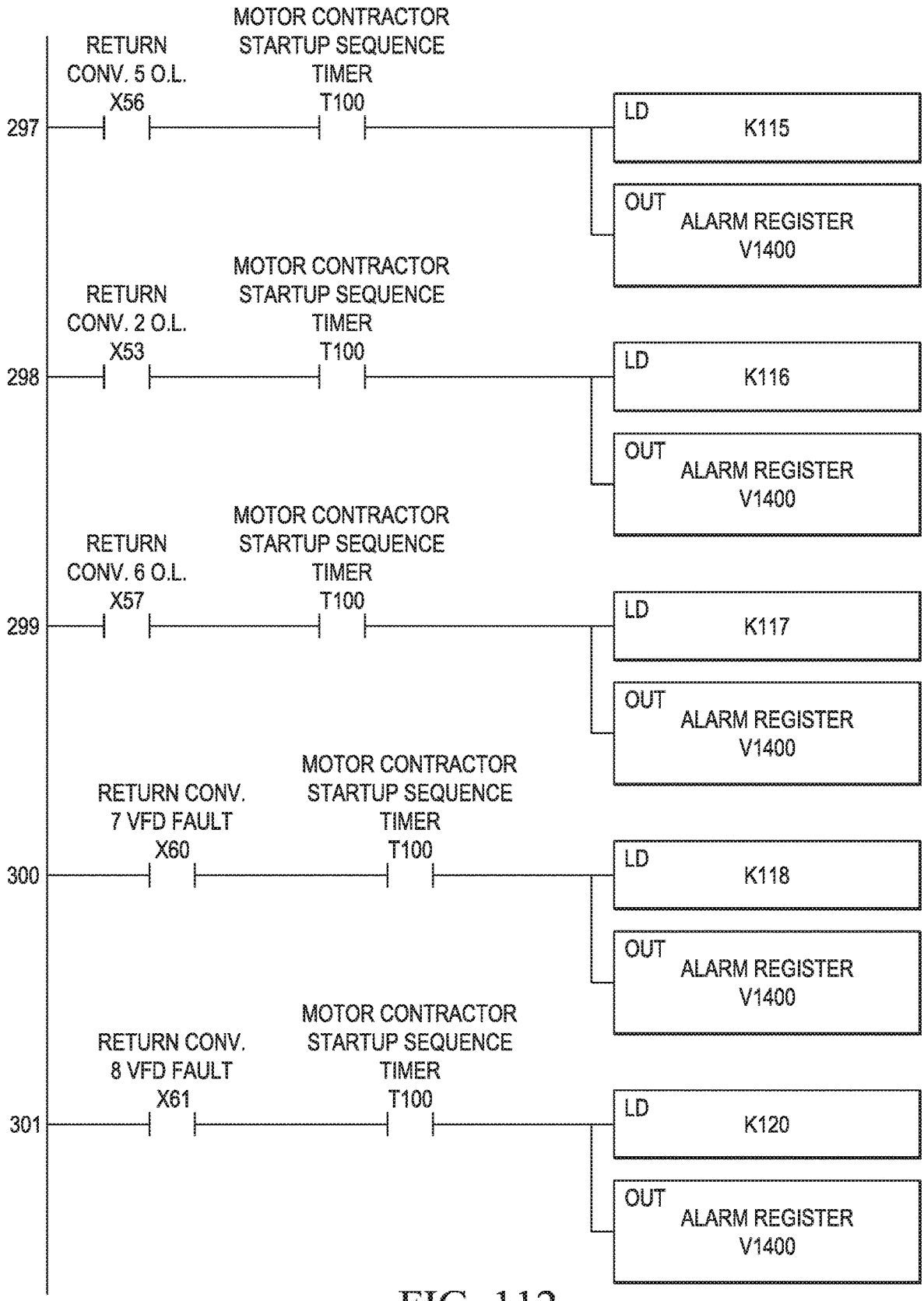
Figure 113:
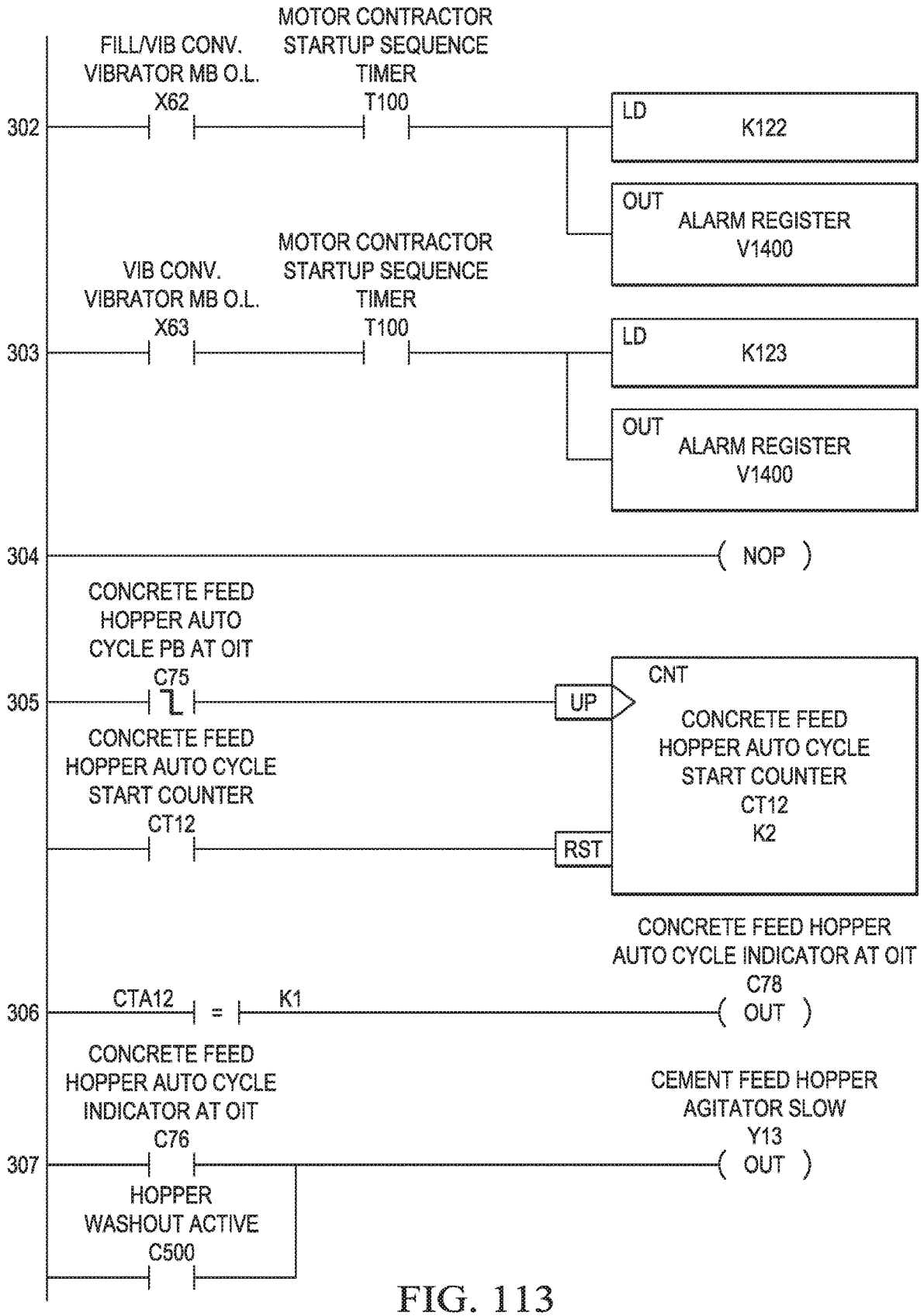
Figure 114:
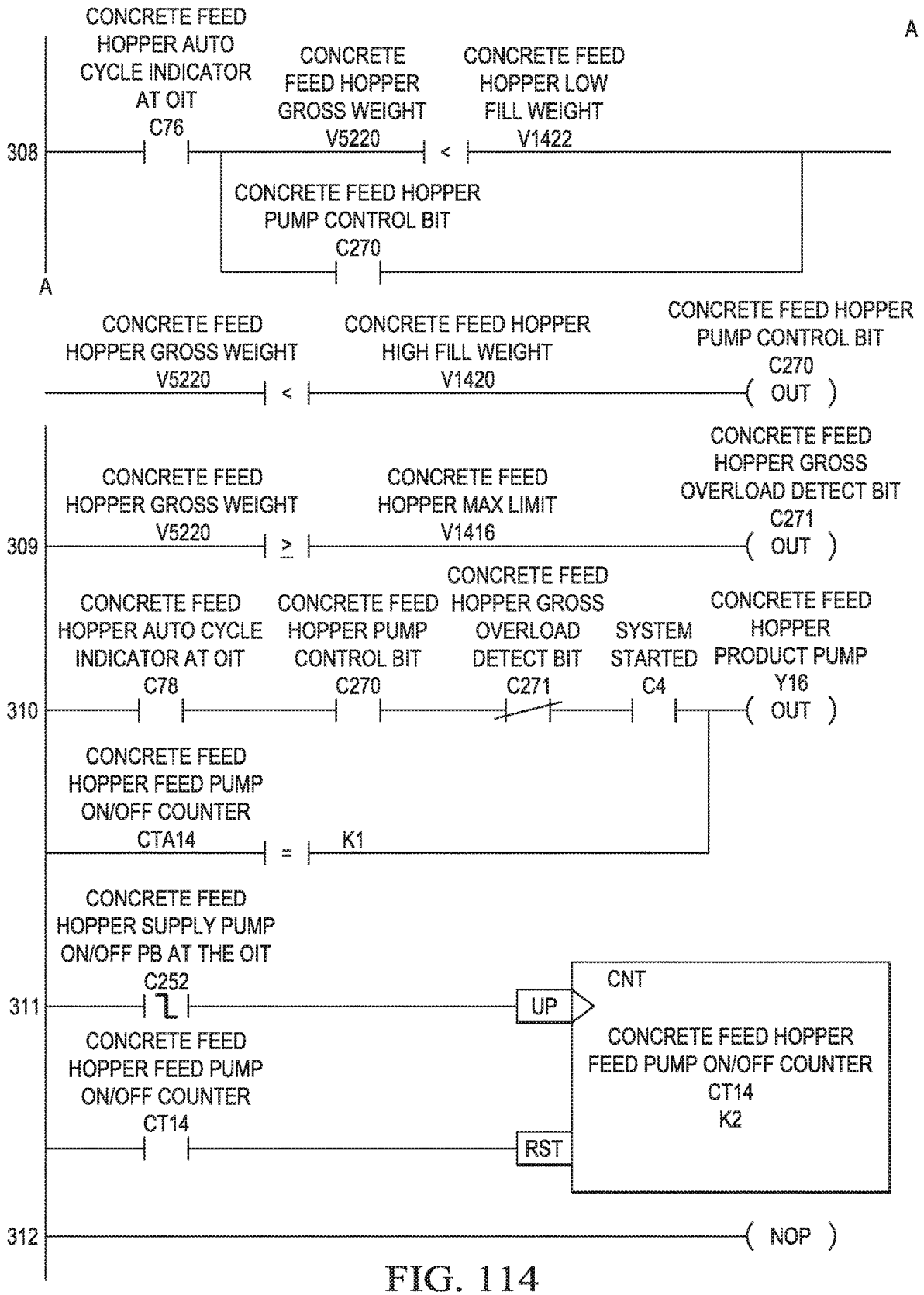
Figure 115:
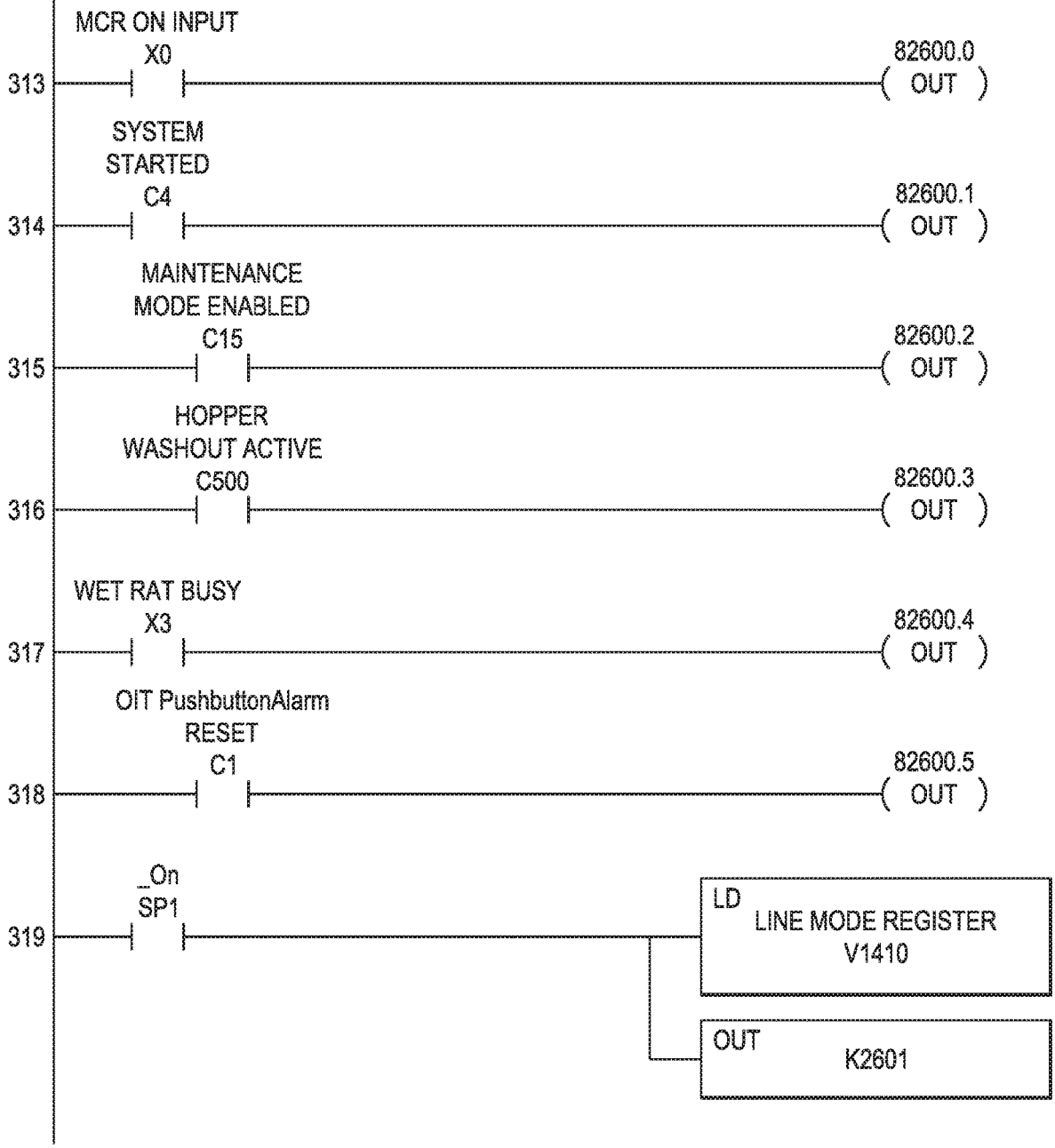
Figure 116:
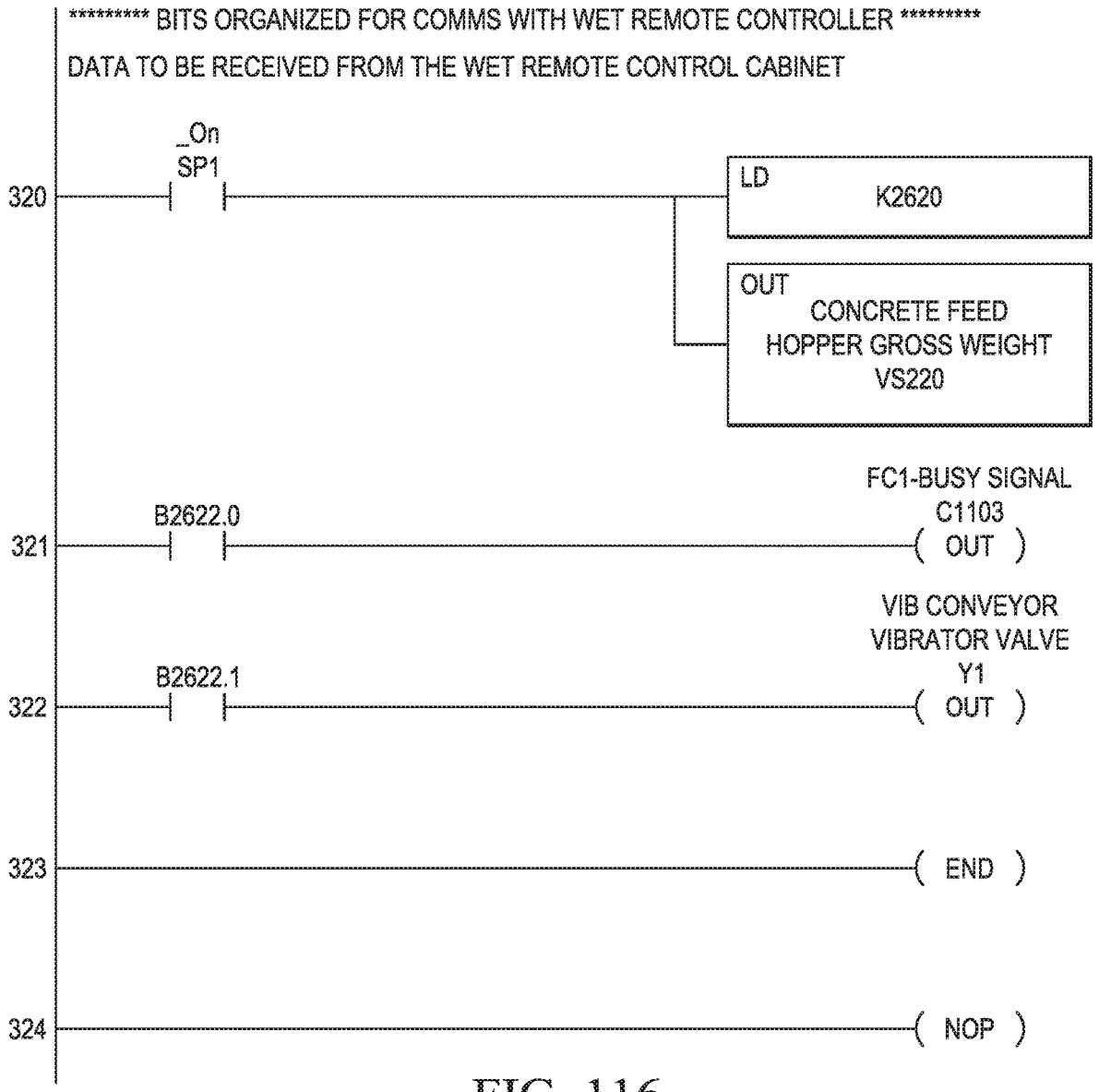
Figure 117:
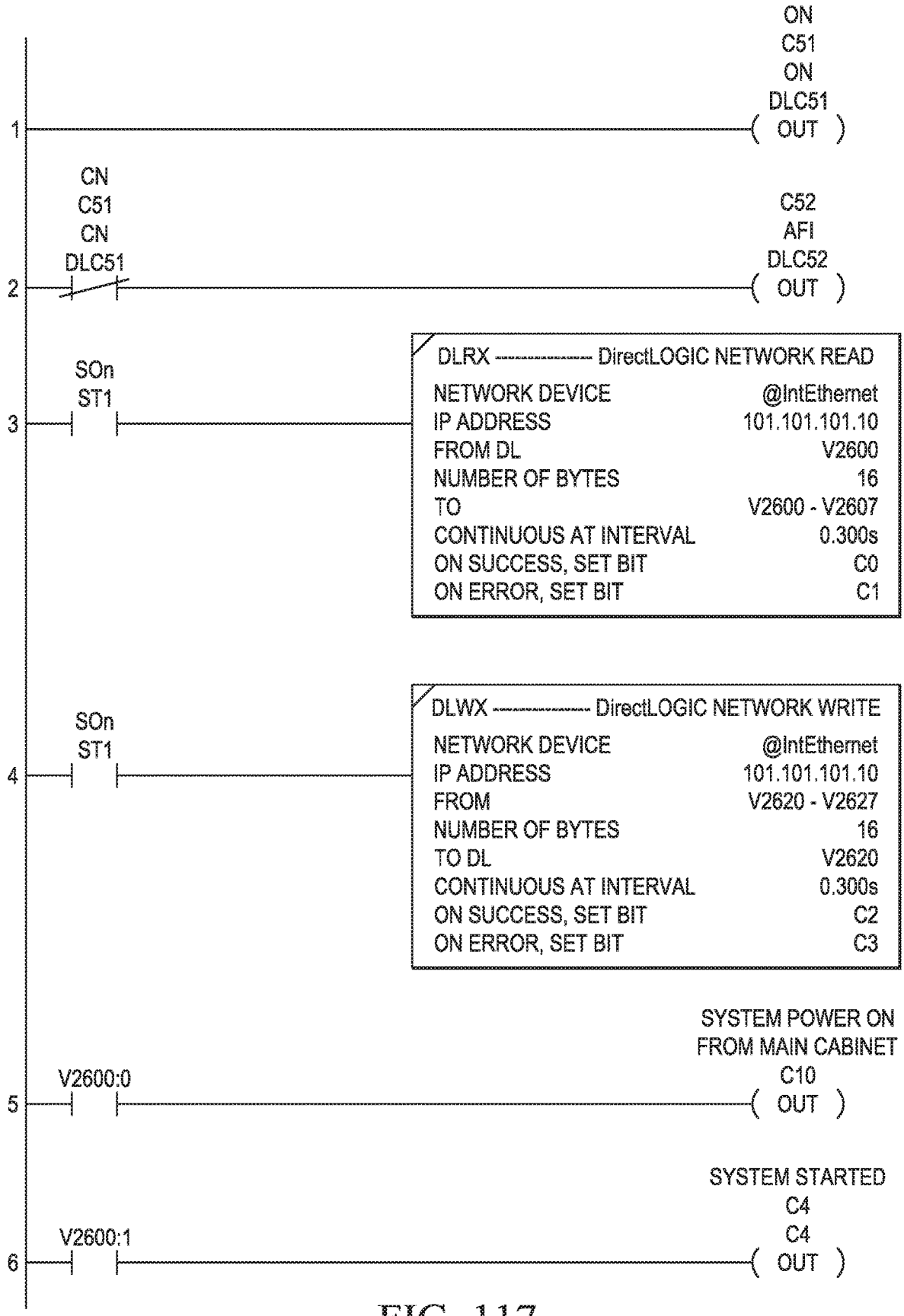
Figure 118:
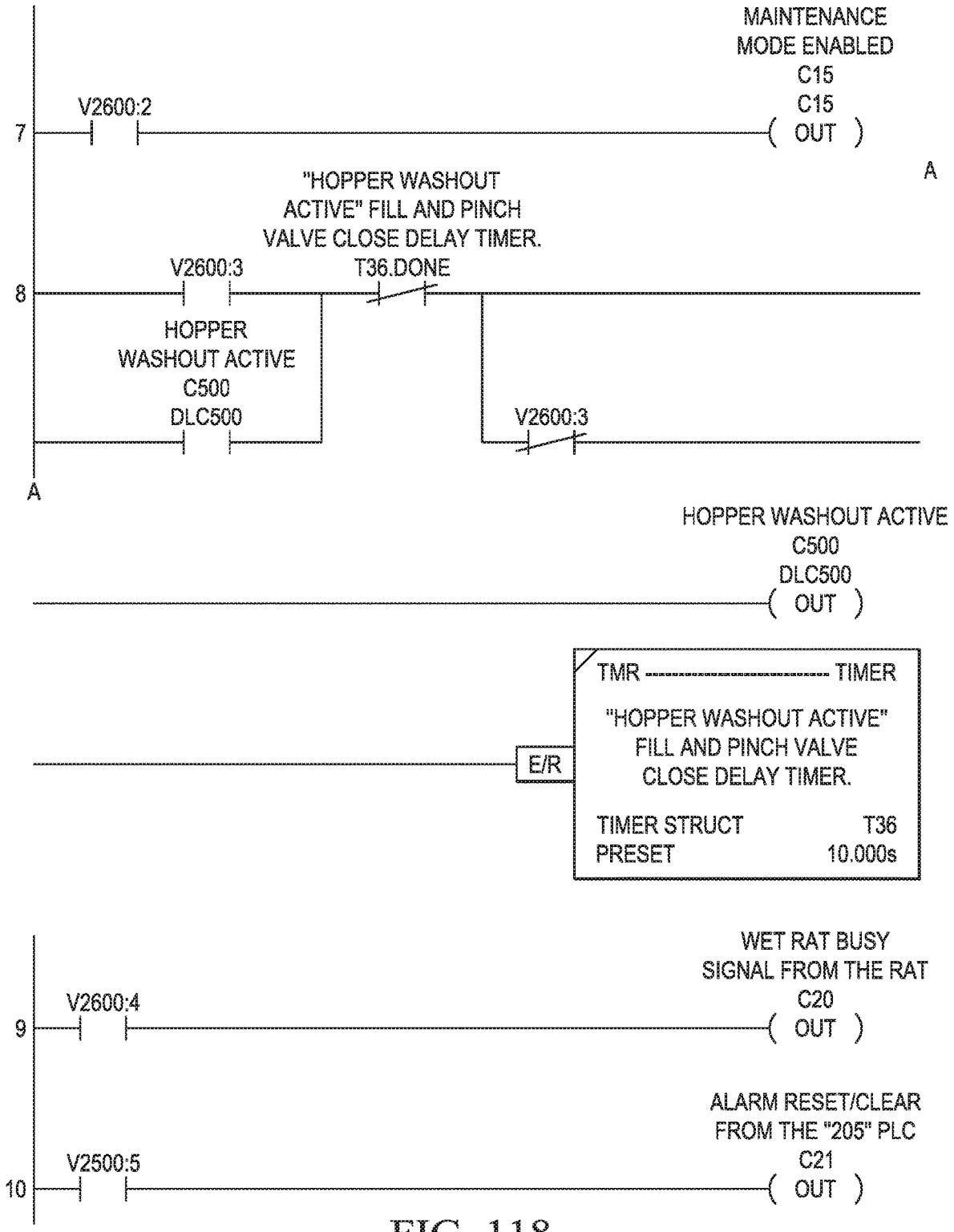
Figure 119:
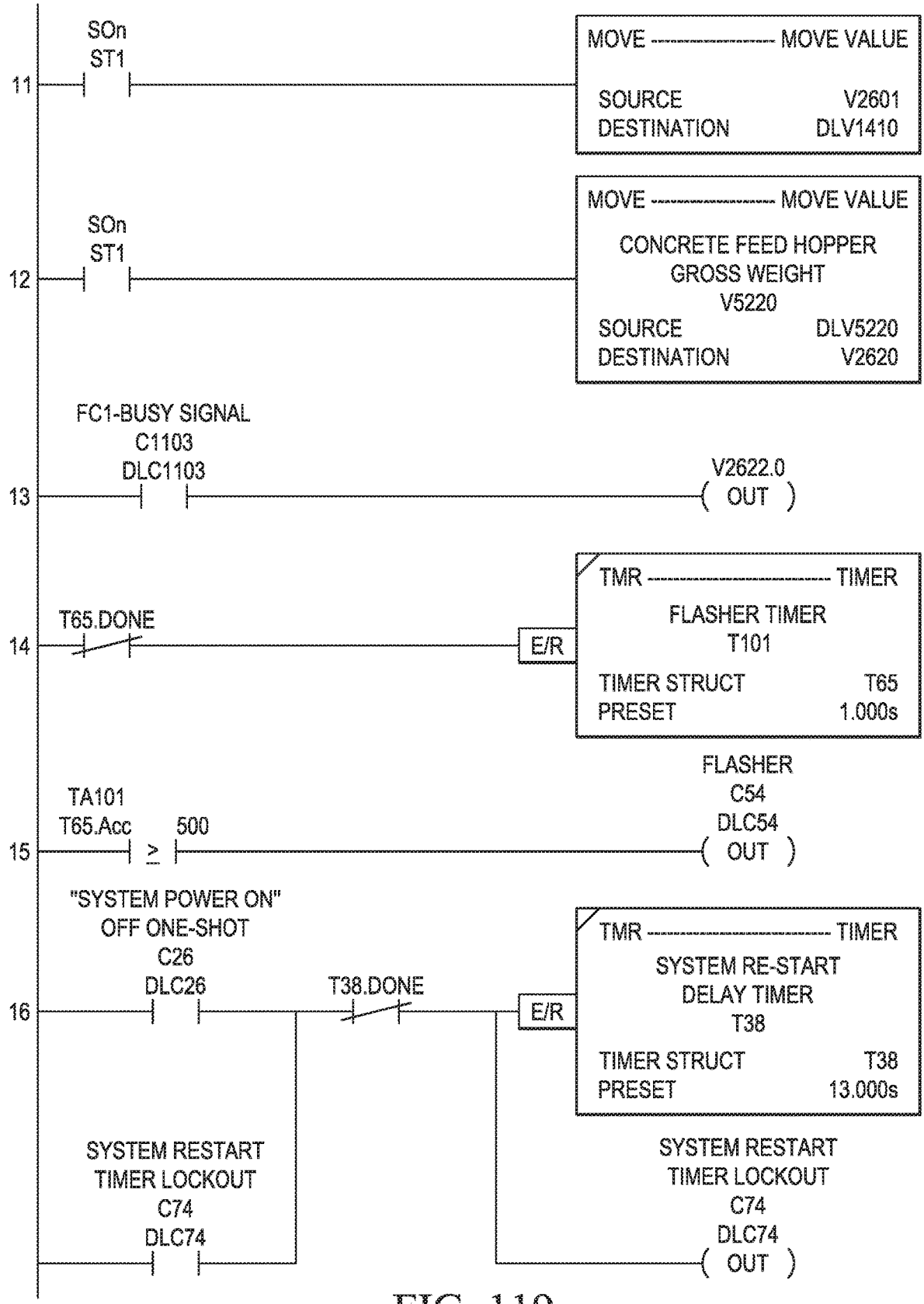
Figure 120:
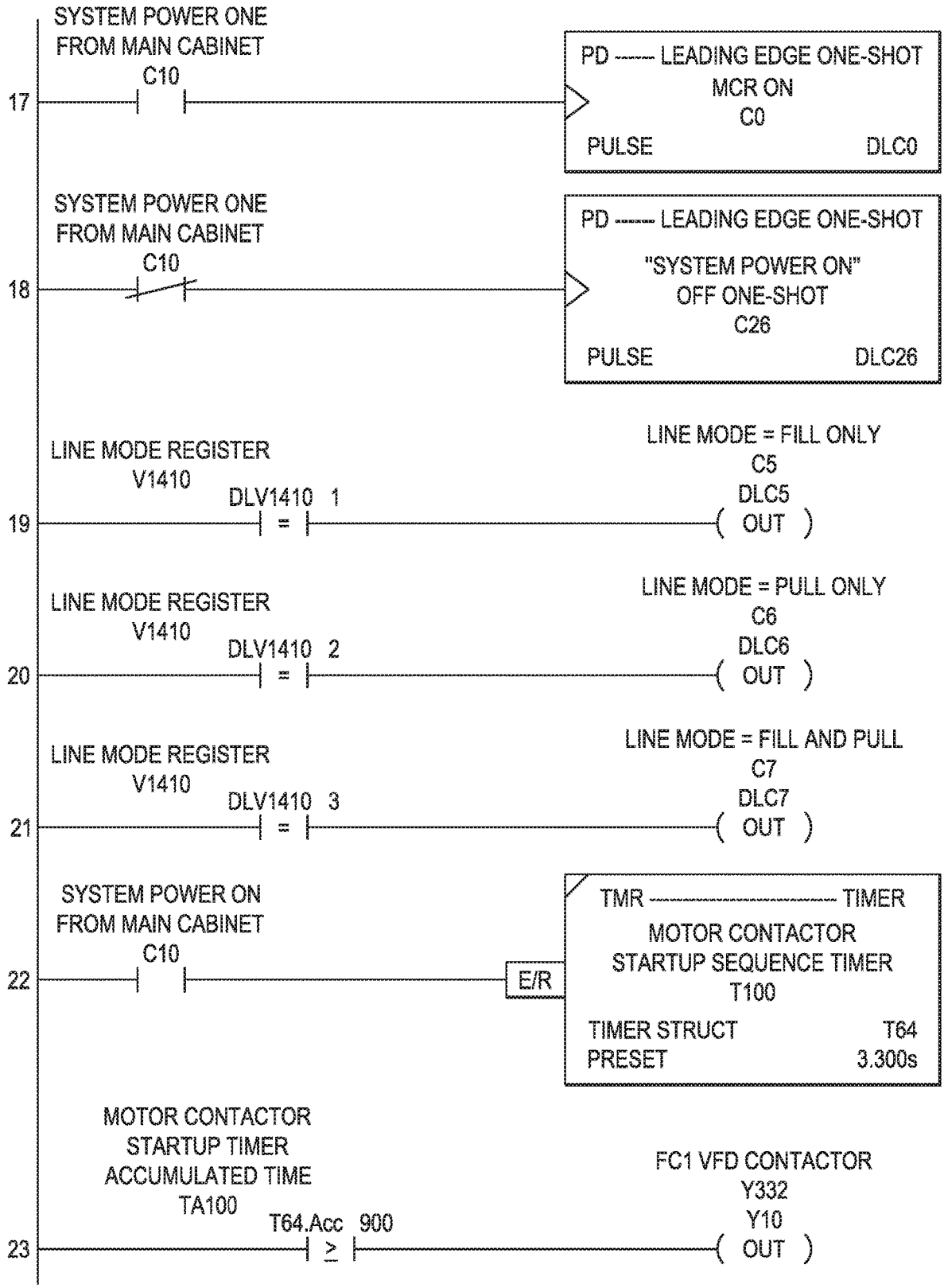
Figure 121:
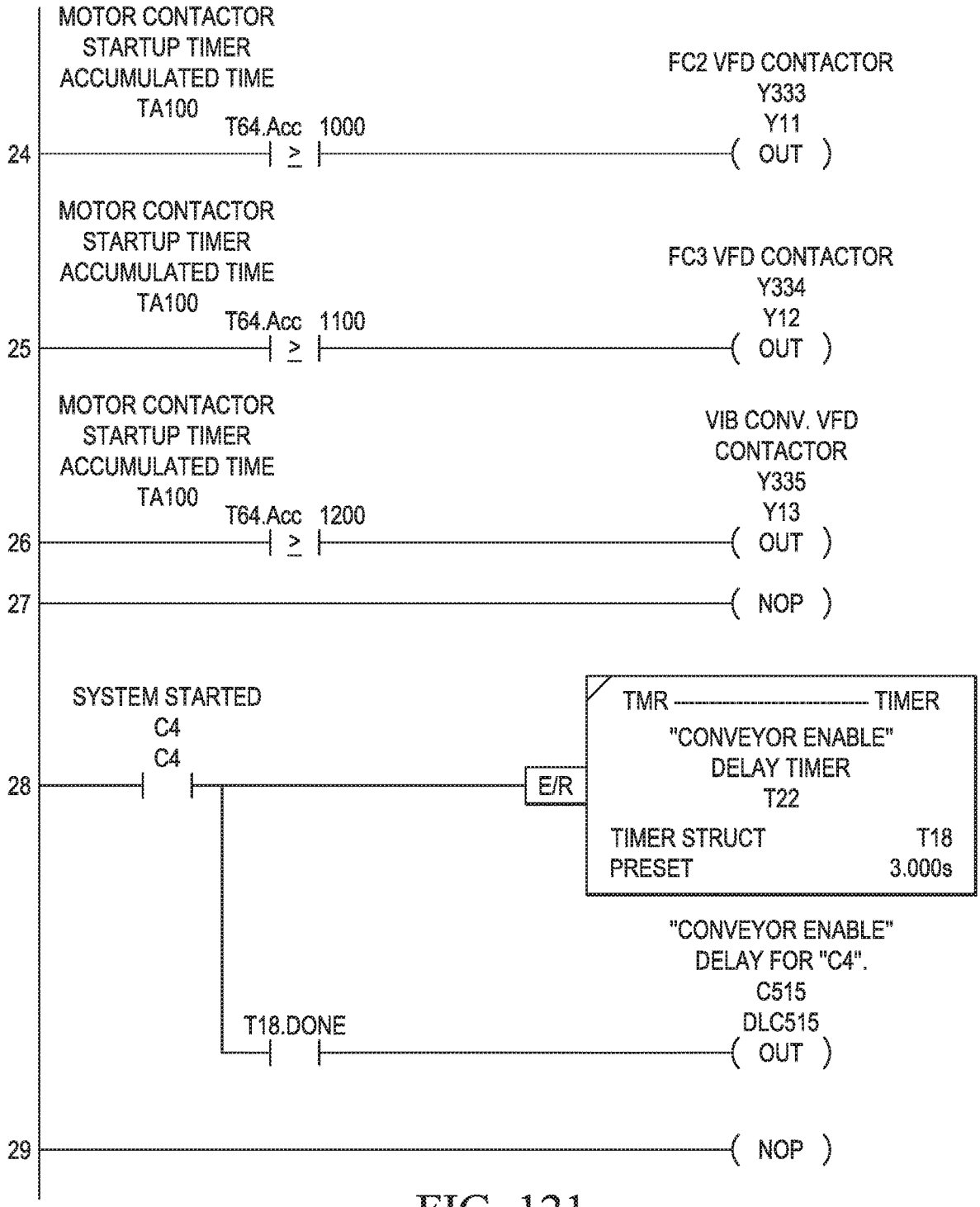
Figure 122:
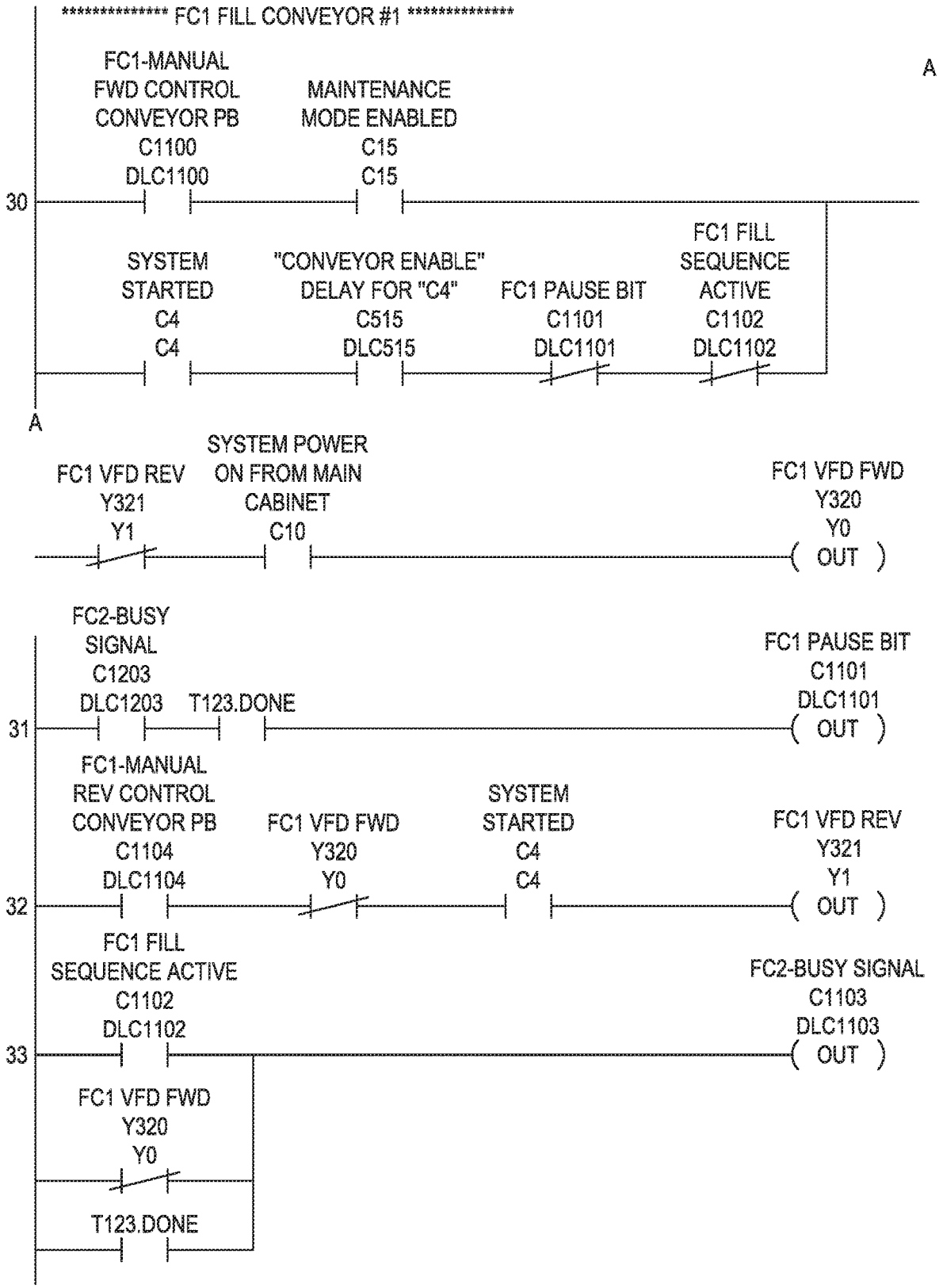
Figure 123:
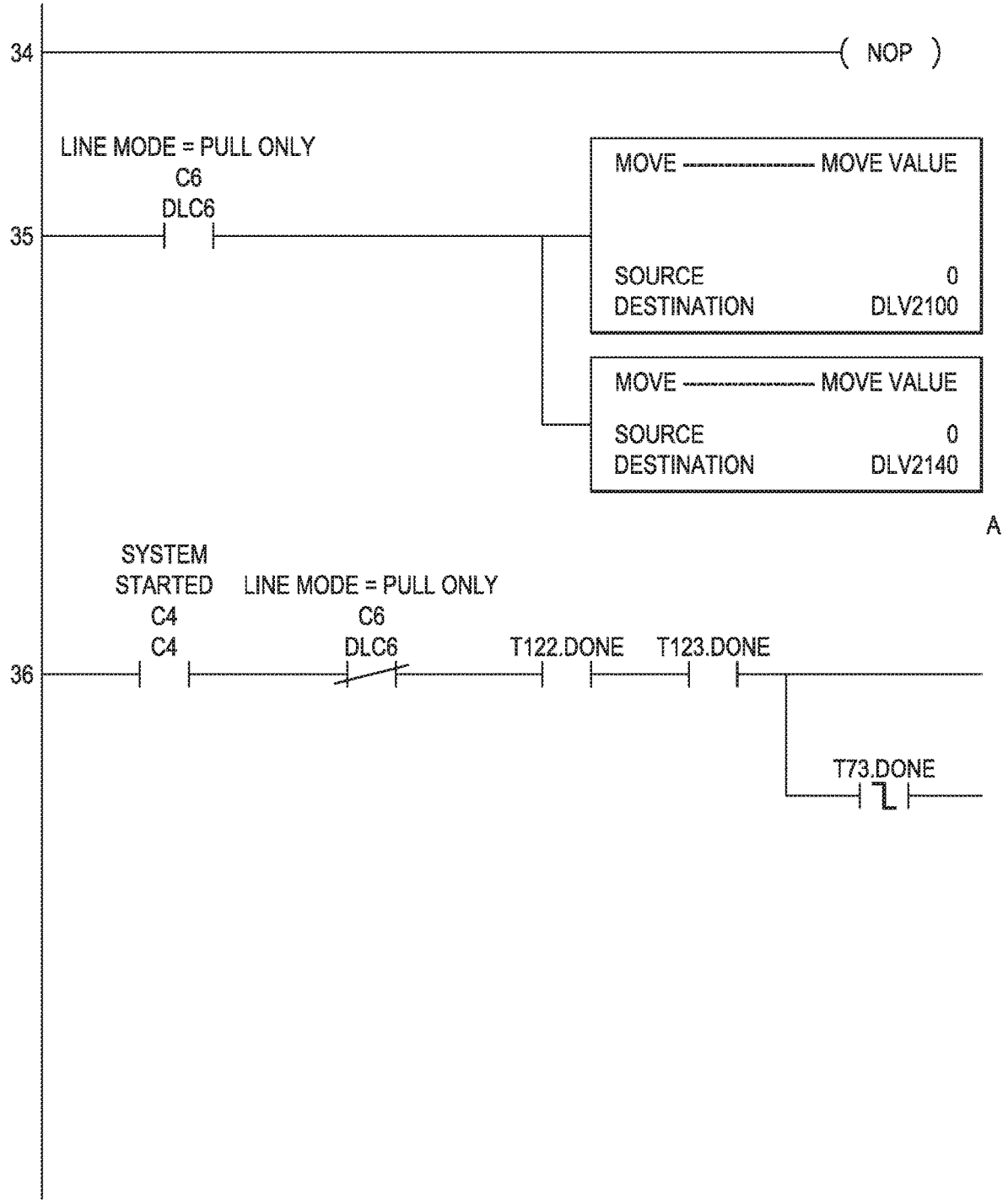
Figure 124:
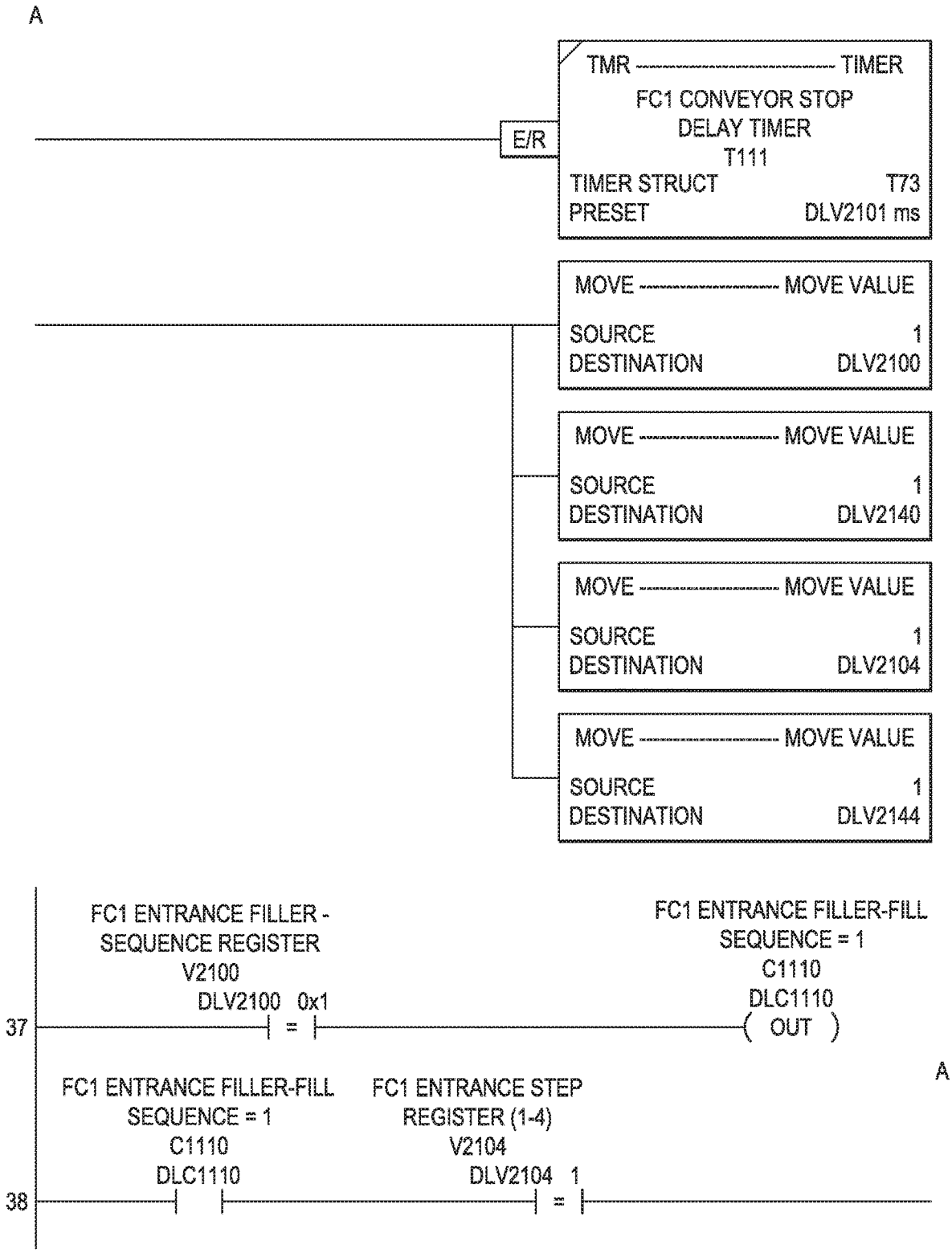
Figure 125:
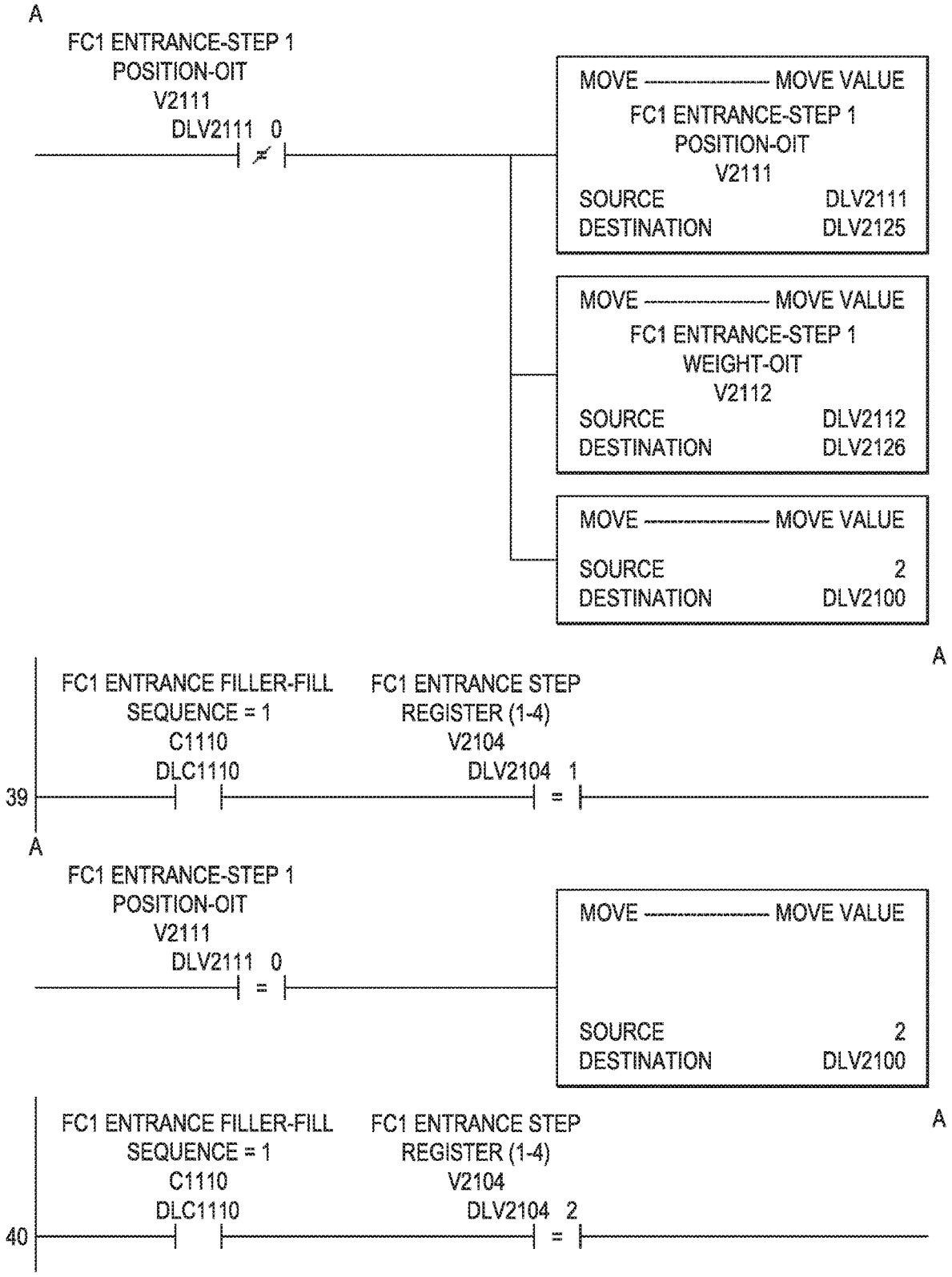
Figure 126:
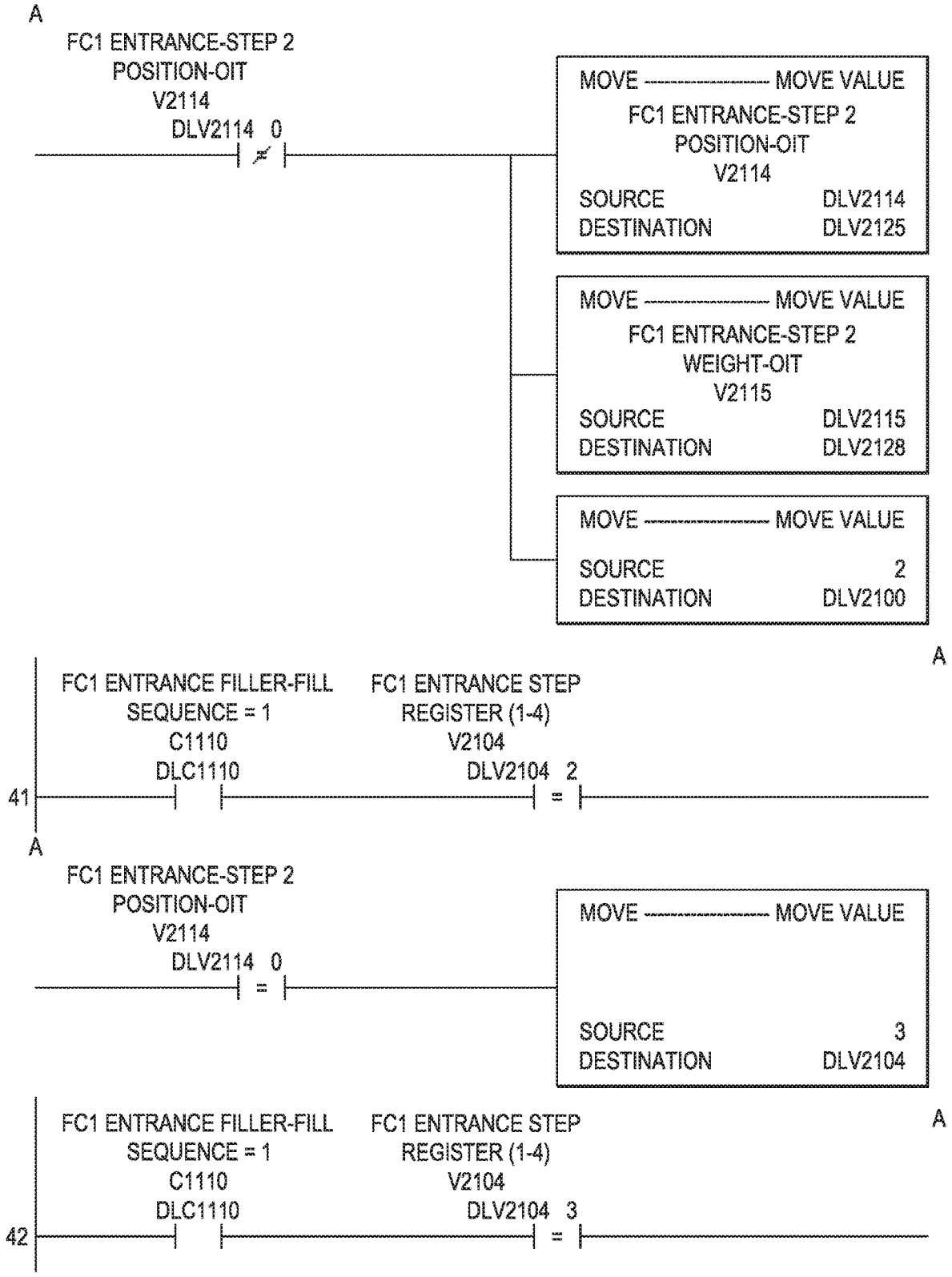
Figure 127:
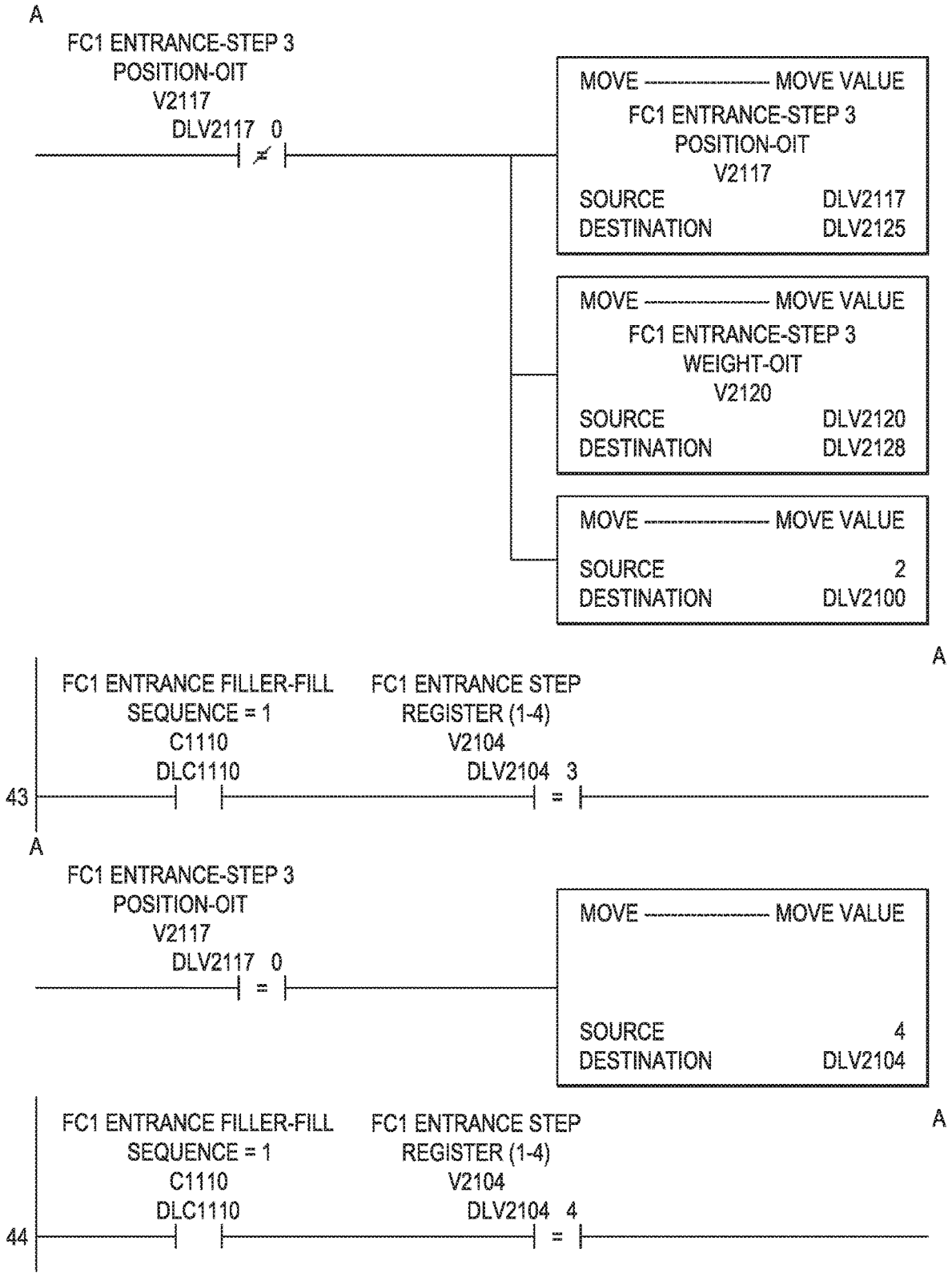
Figure 128:
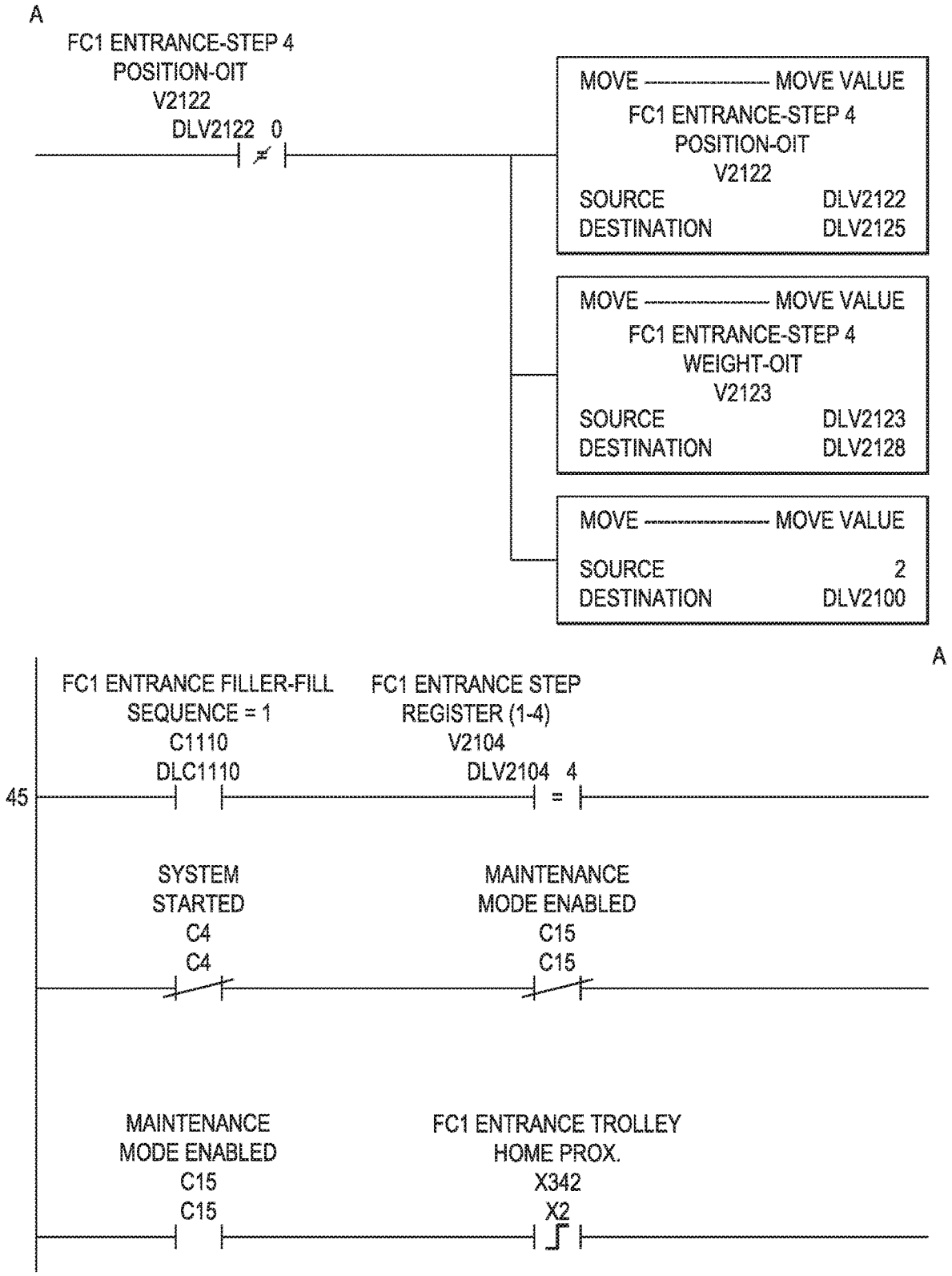
Figure 129:
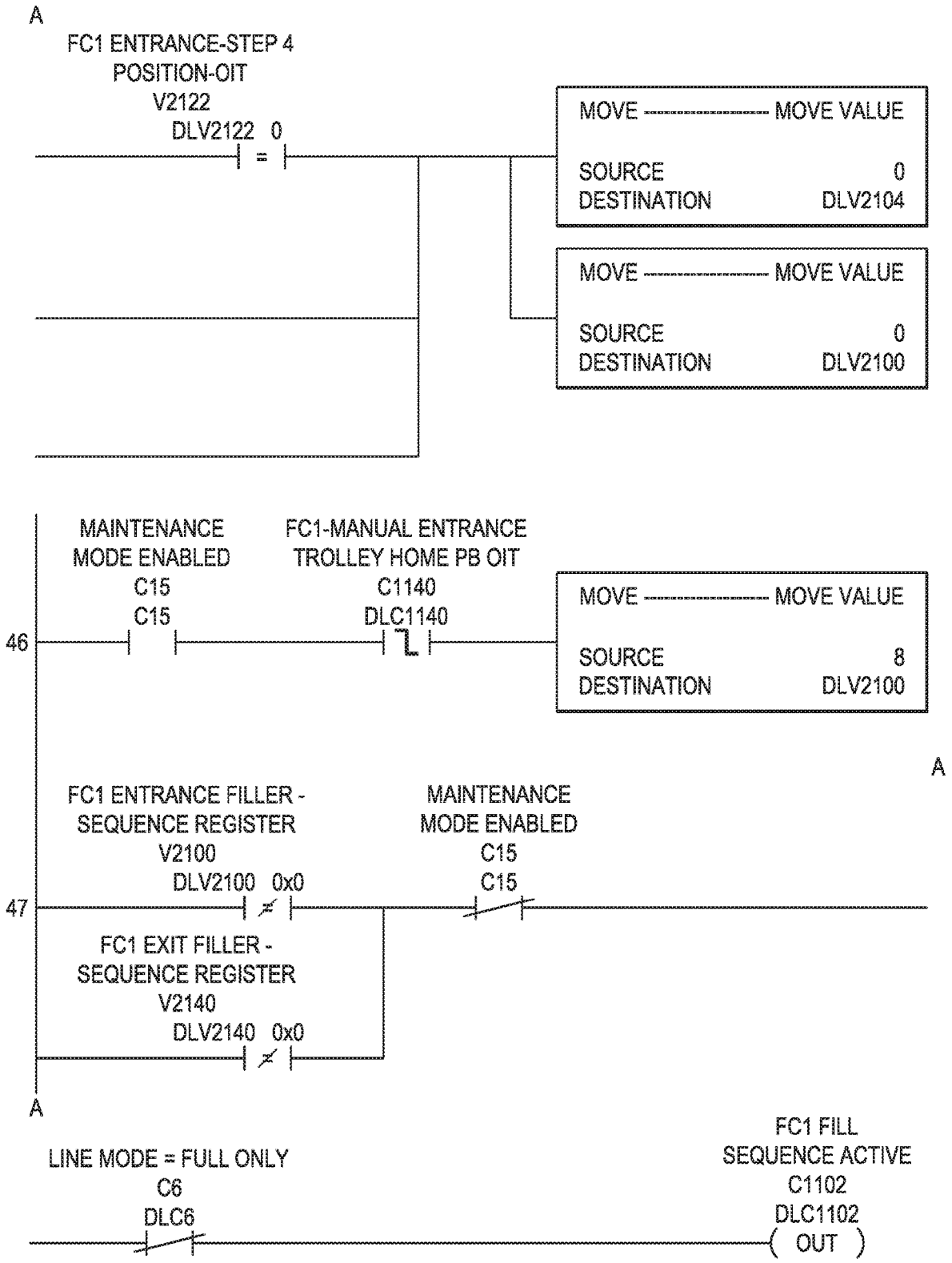
Figure 130:
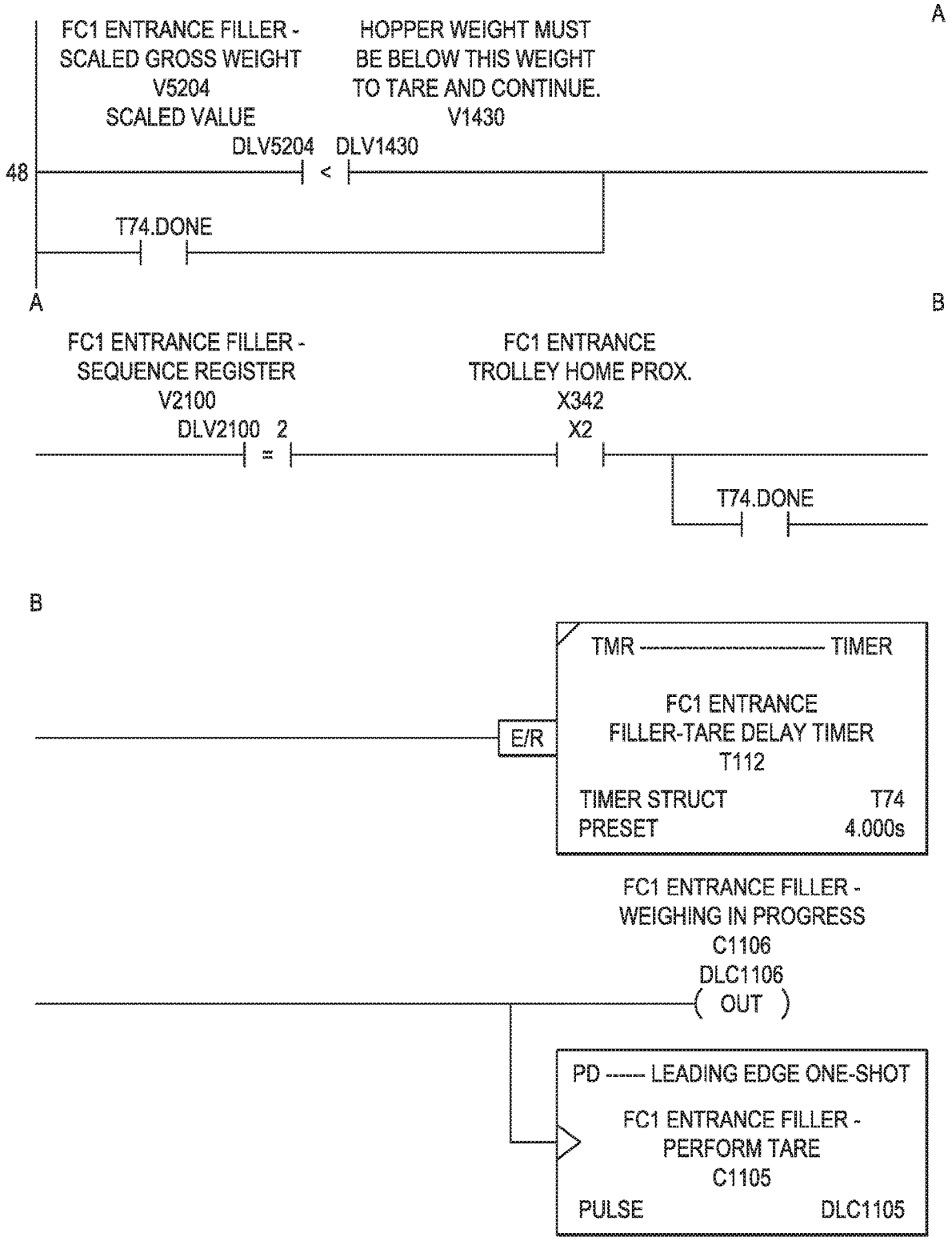
Figure 131:
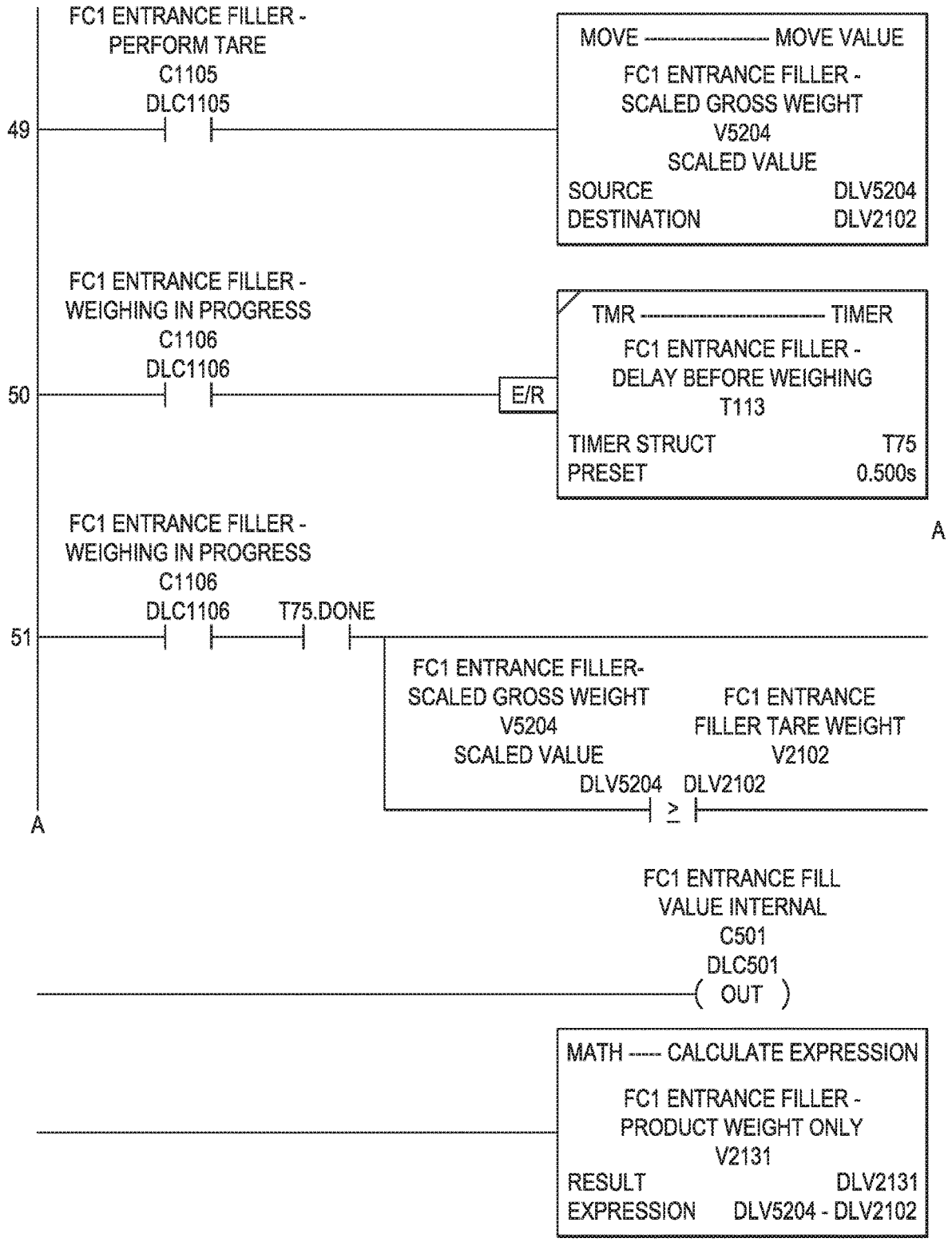
Figure 132:
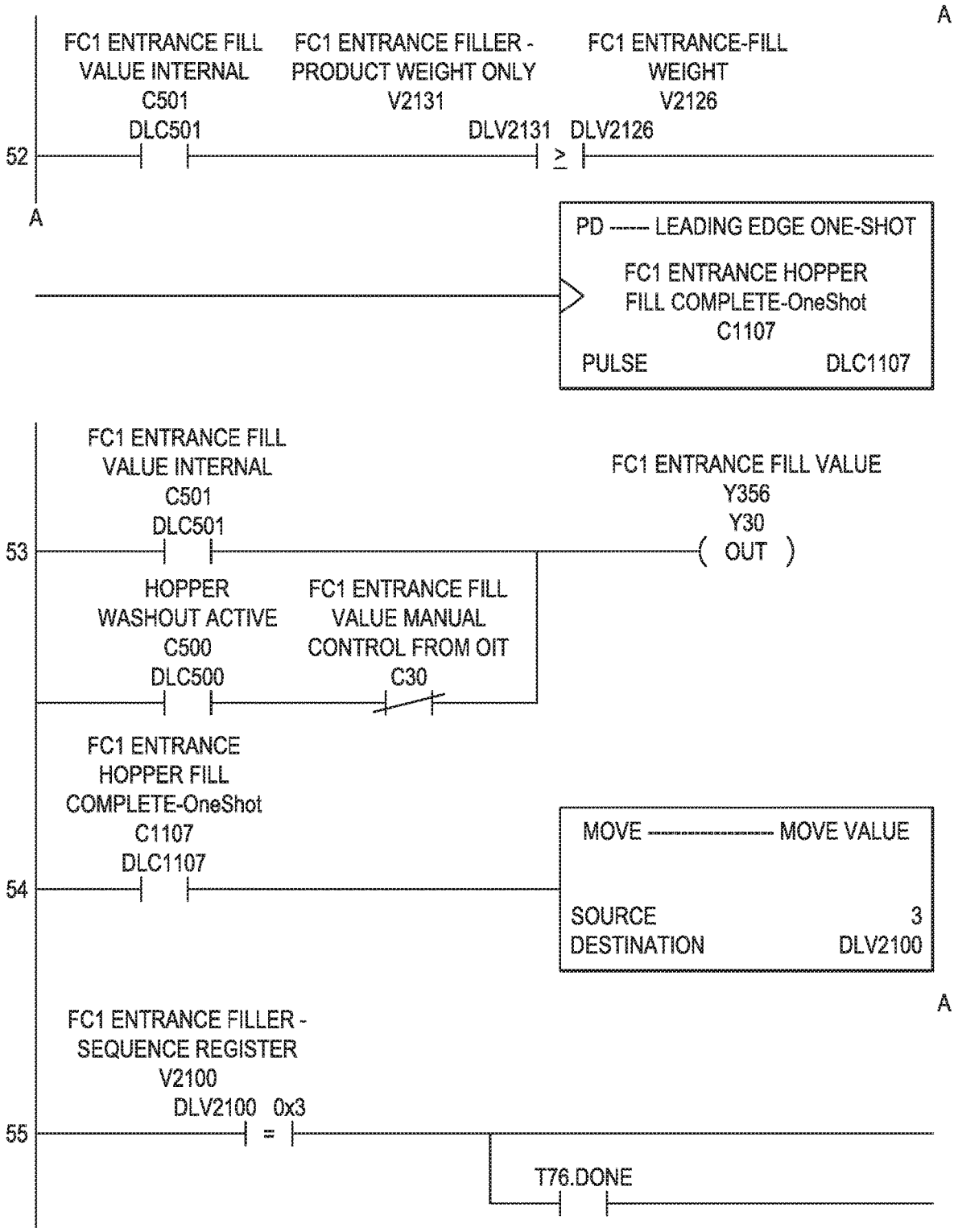
Figure 133:
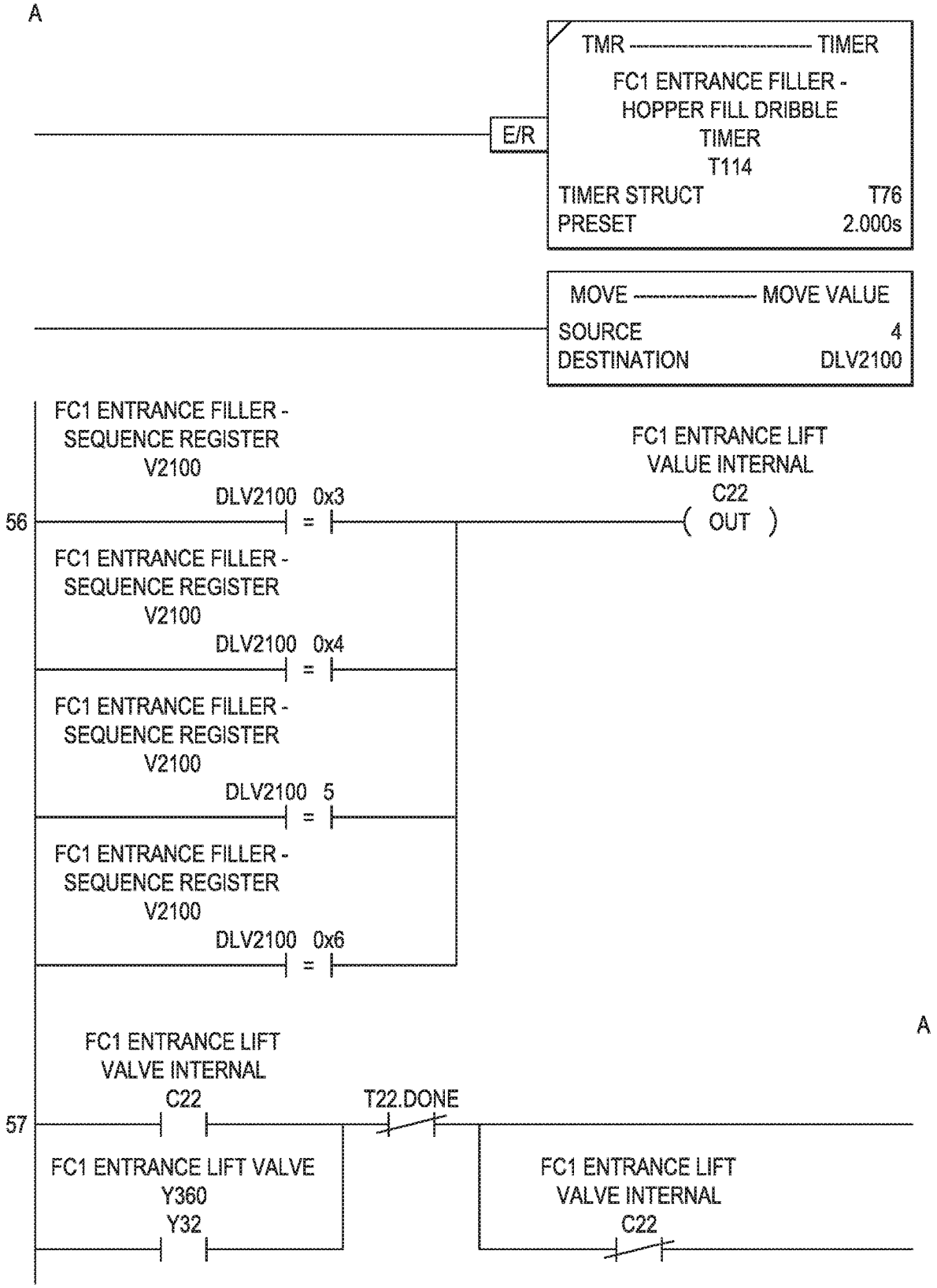
Figure 134:
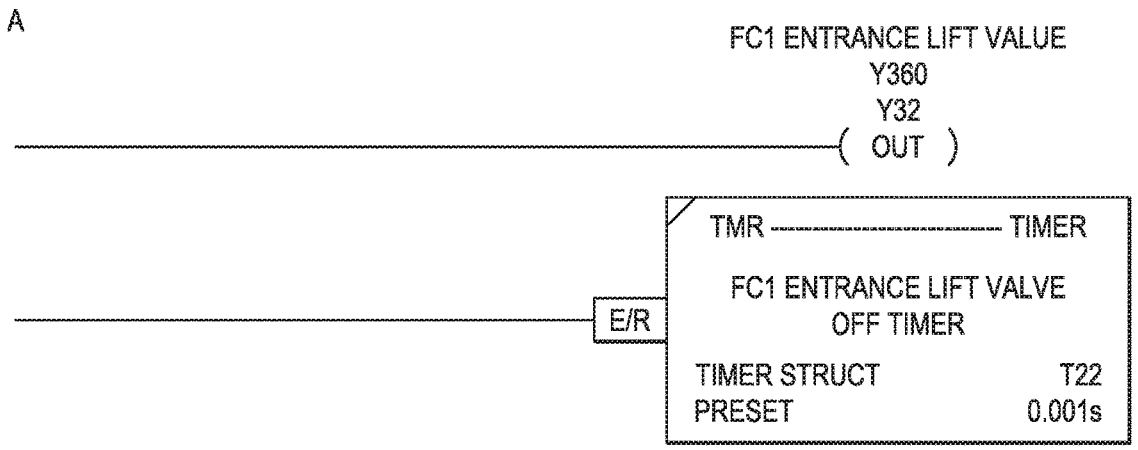
Figure 135:
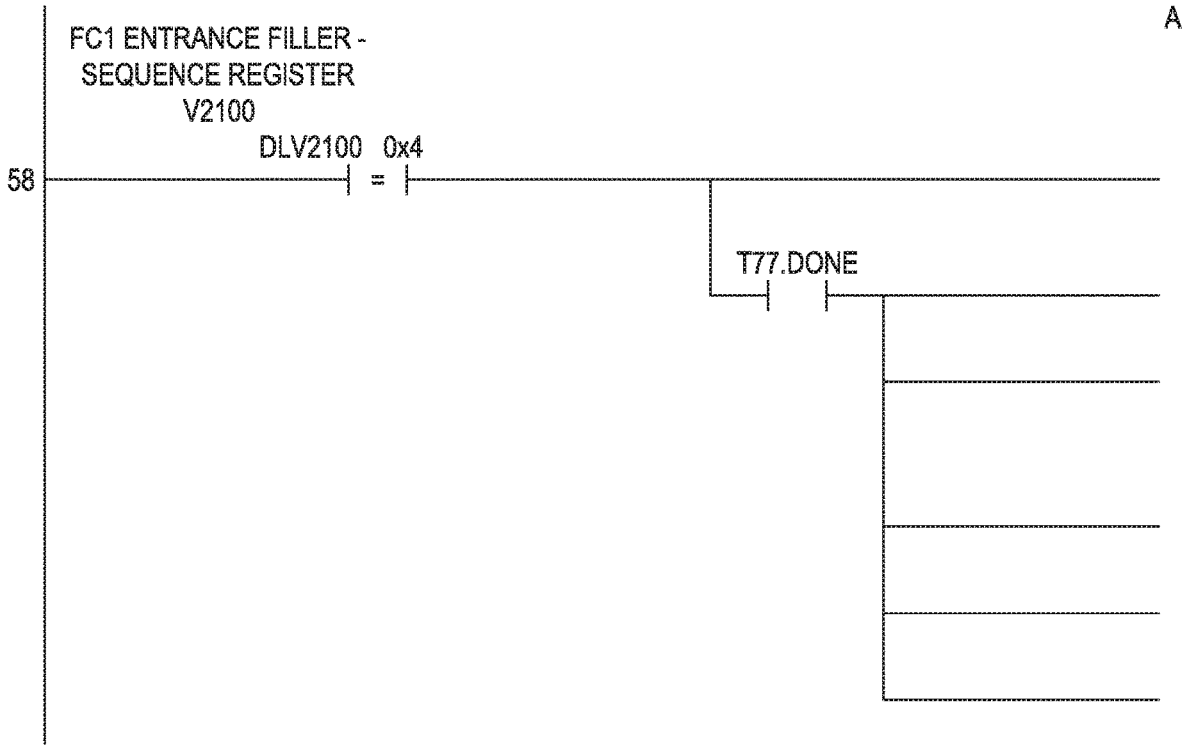
Figure 136:
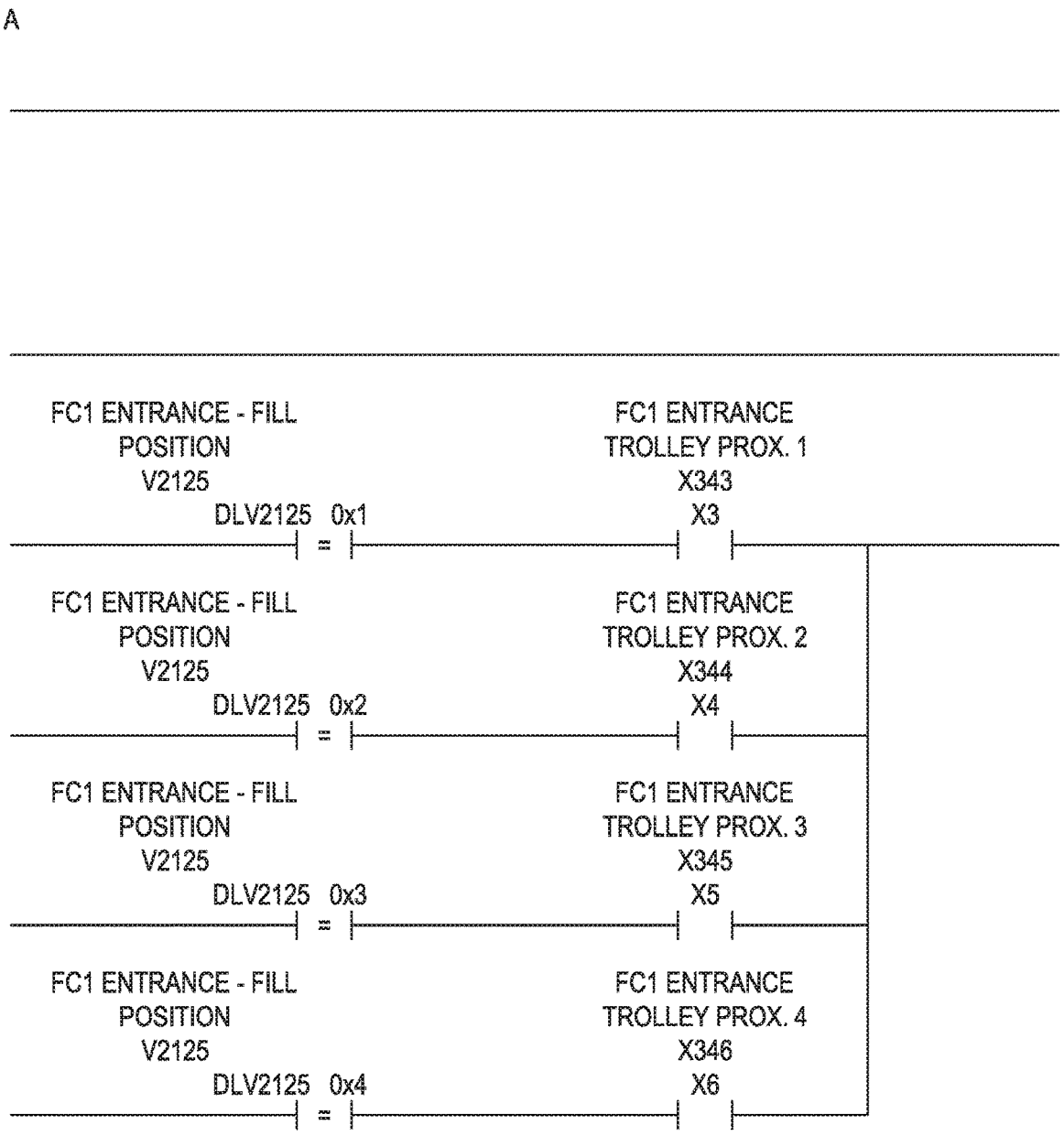
Figure 137:
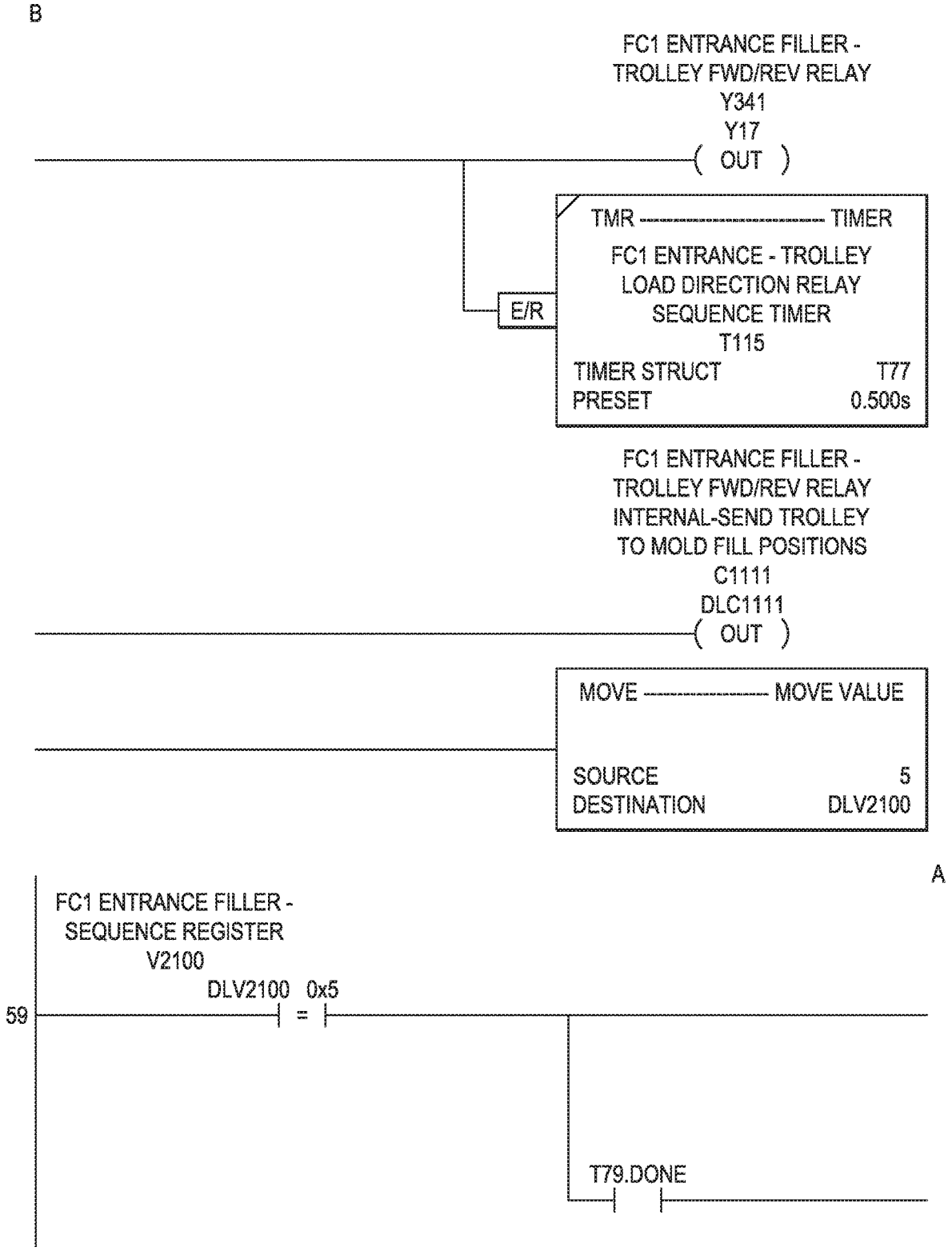
Figure 138:
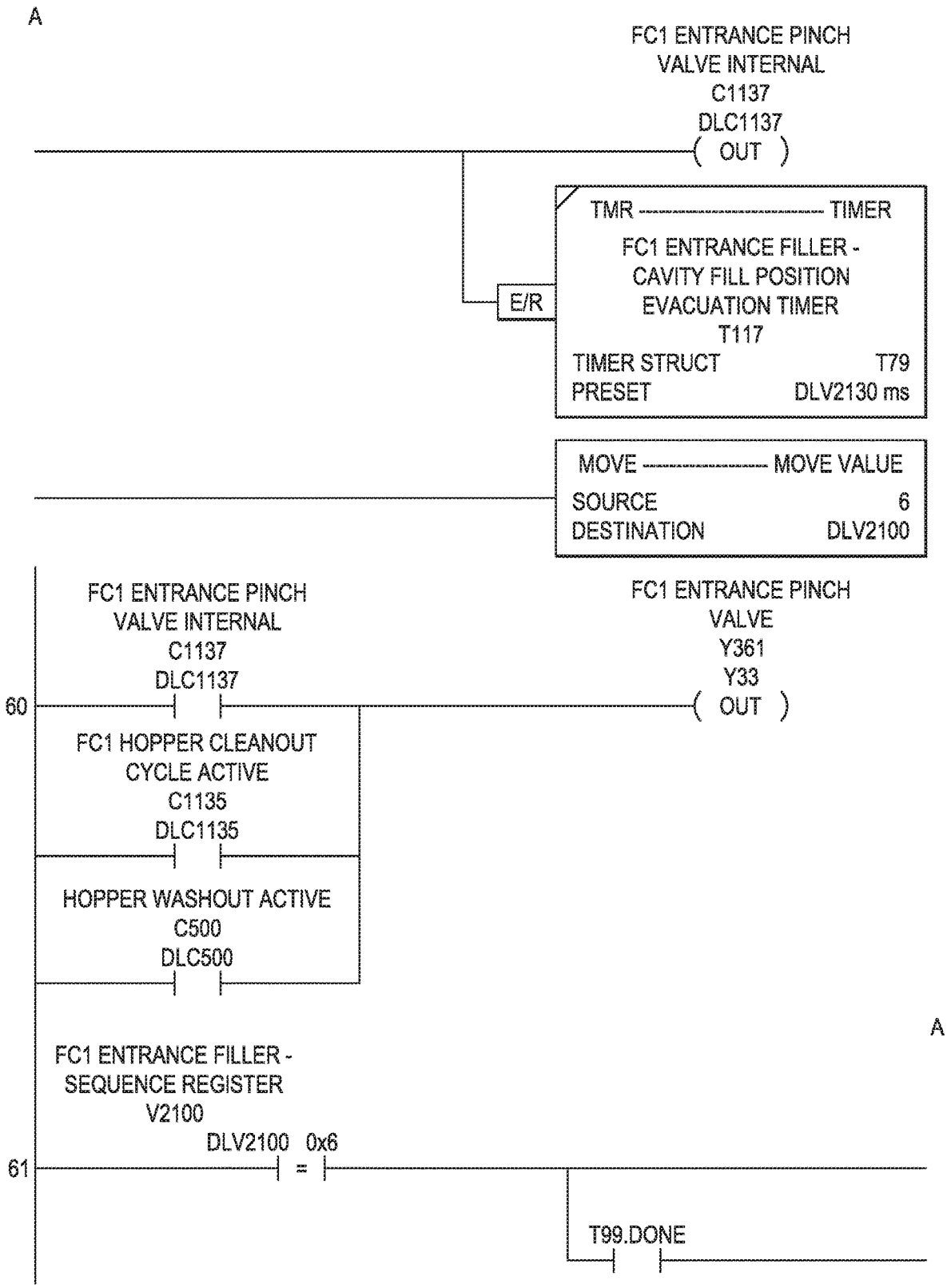
Figure 139:
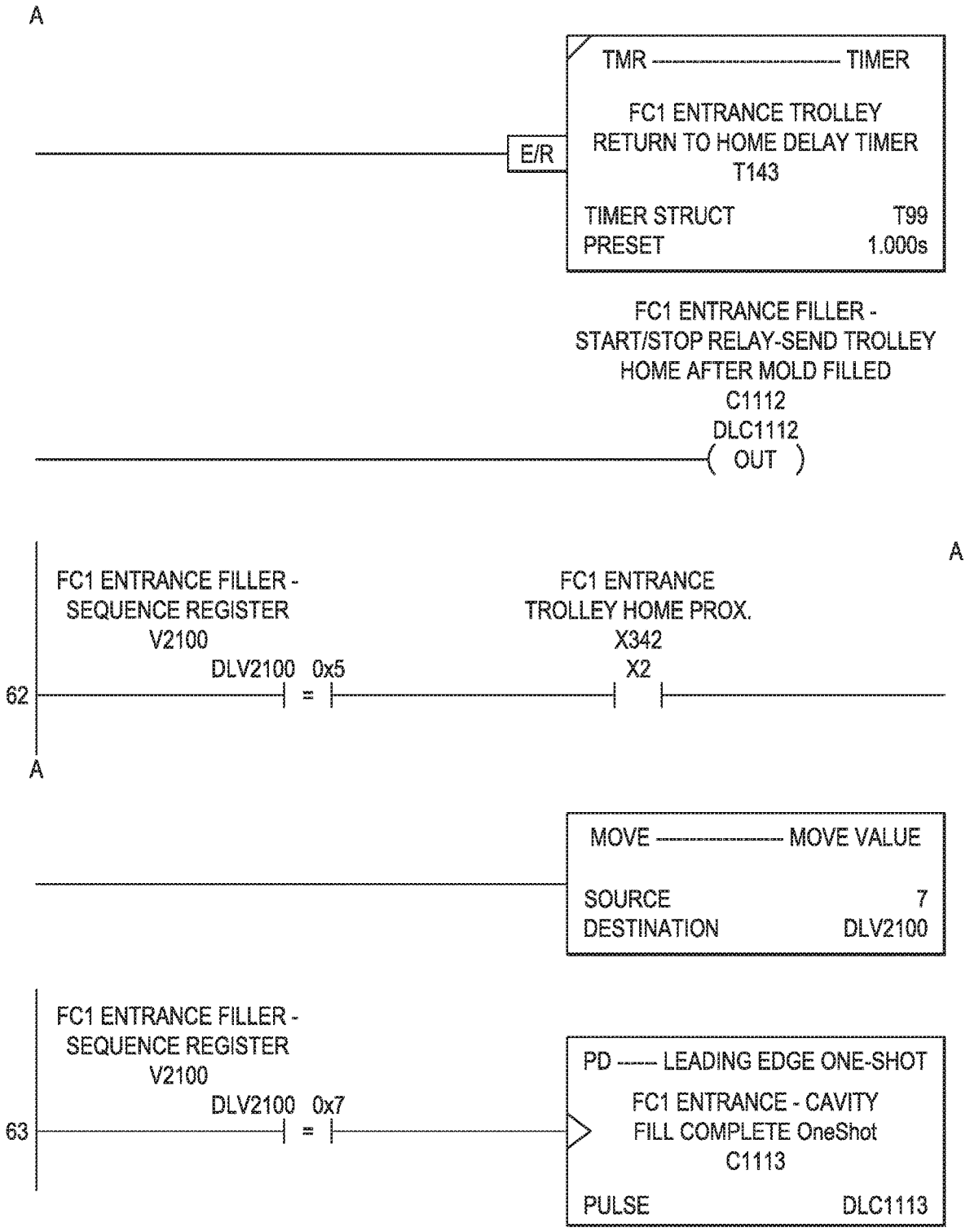
Figure 140:
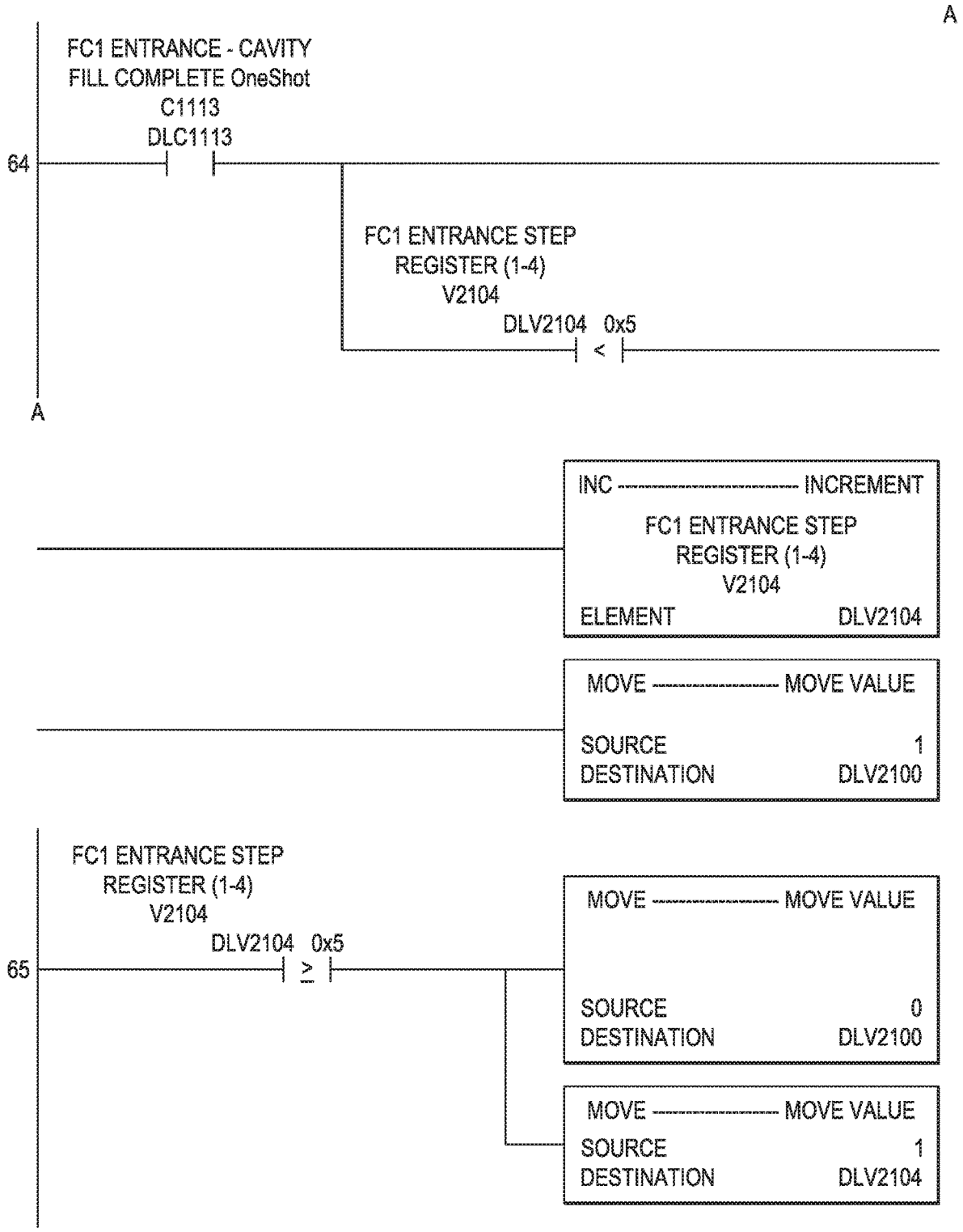
Figure 141:
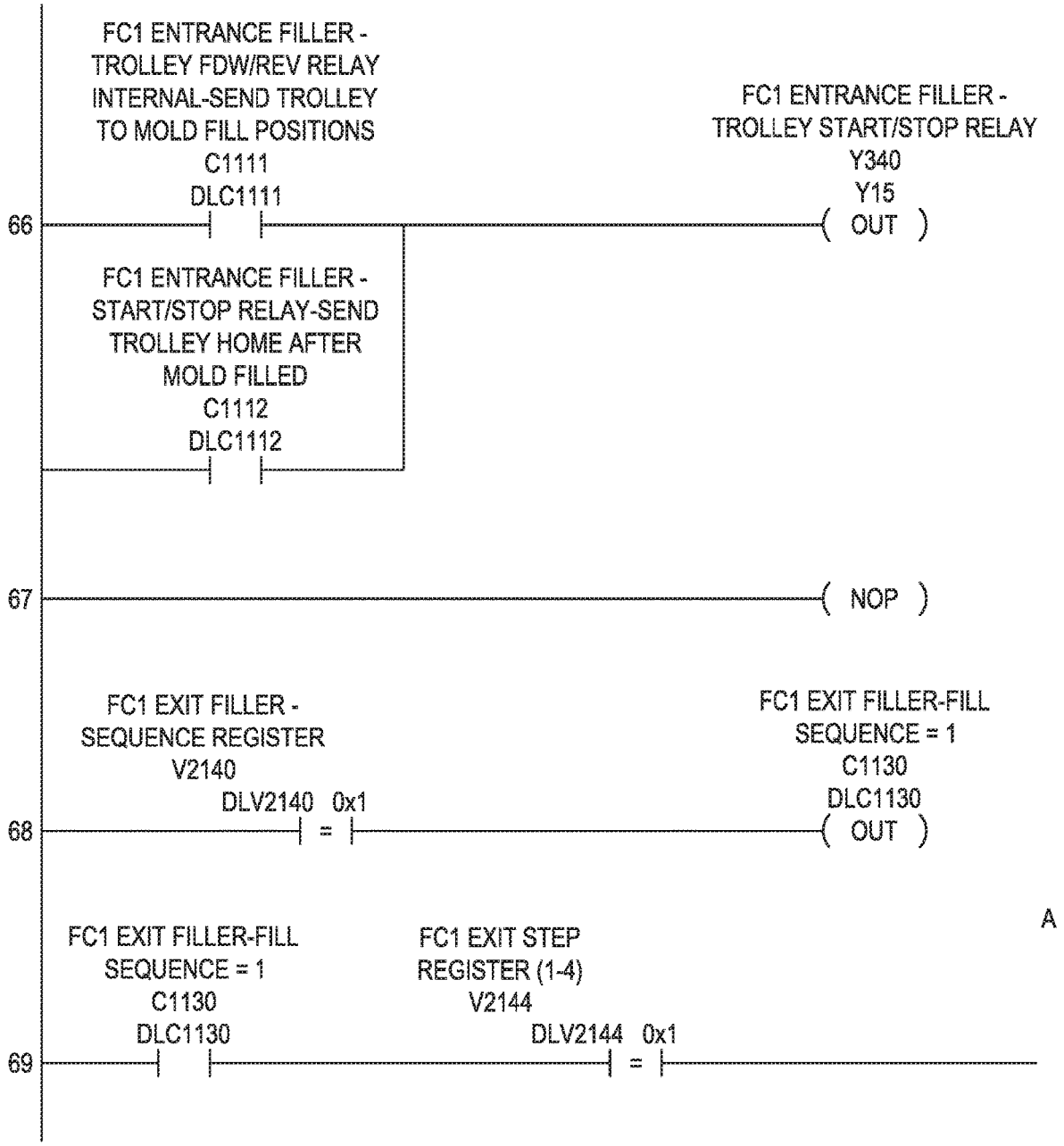
Figure 142:
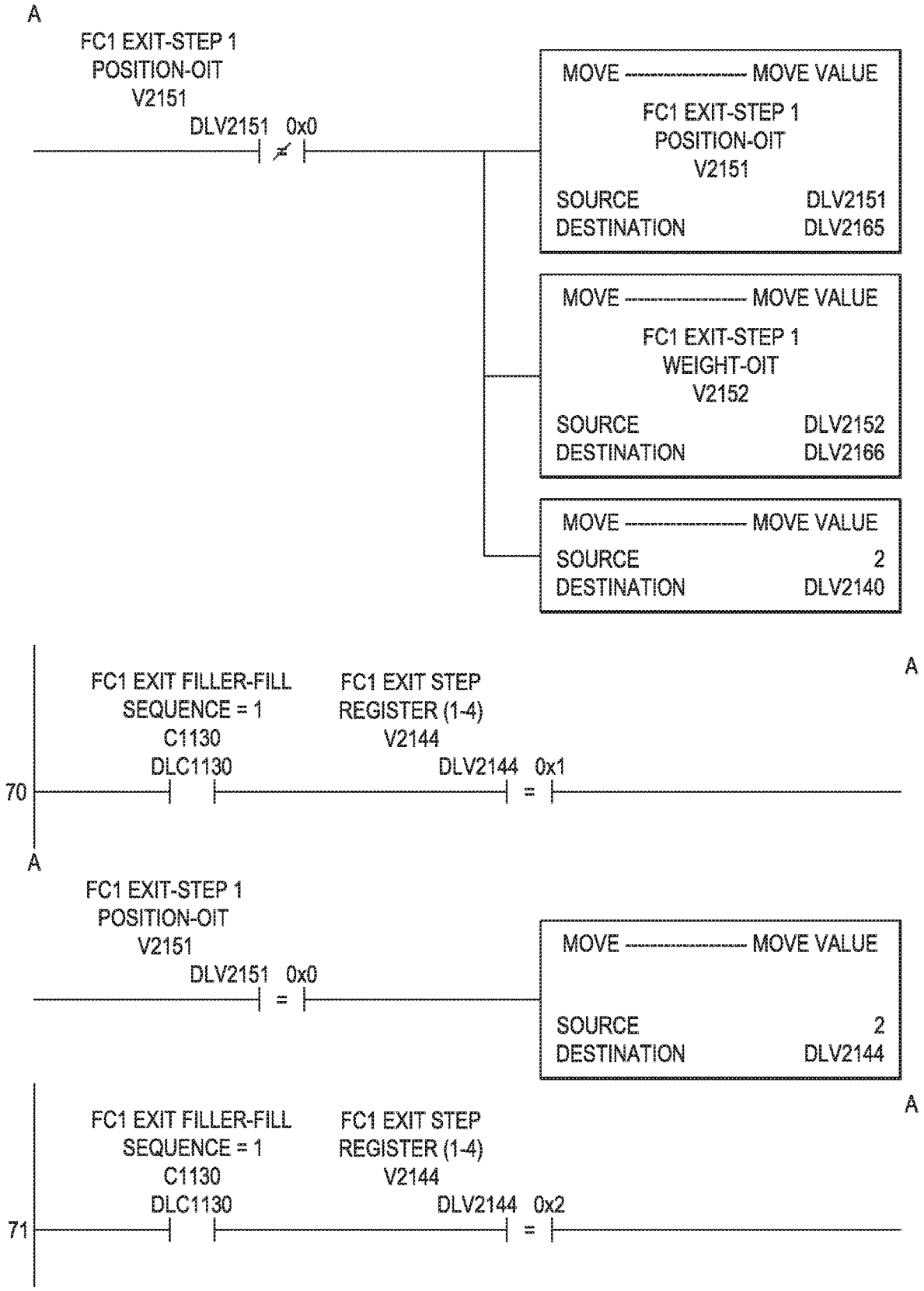
Figure 143:
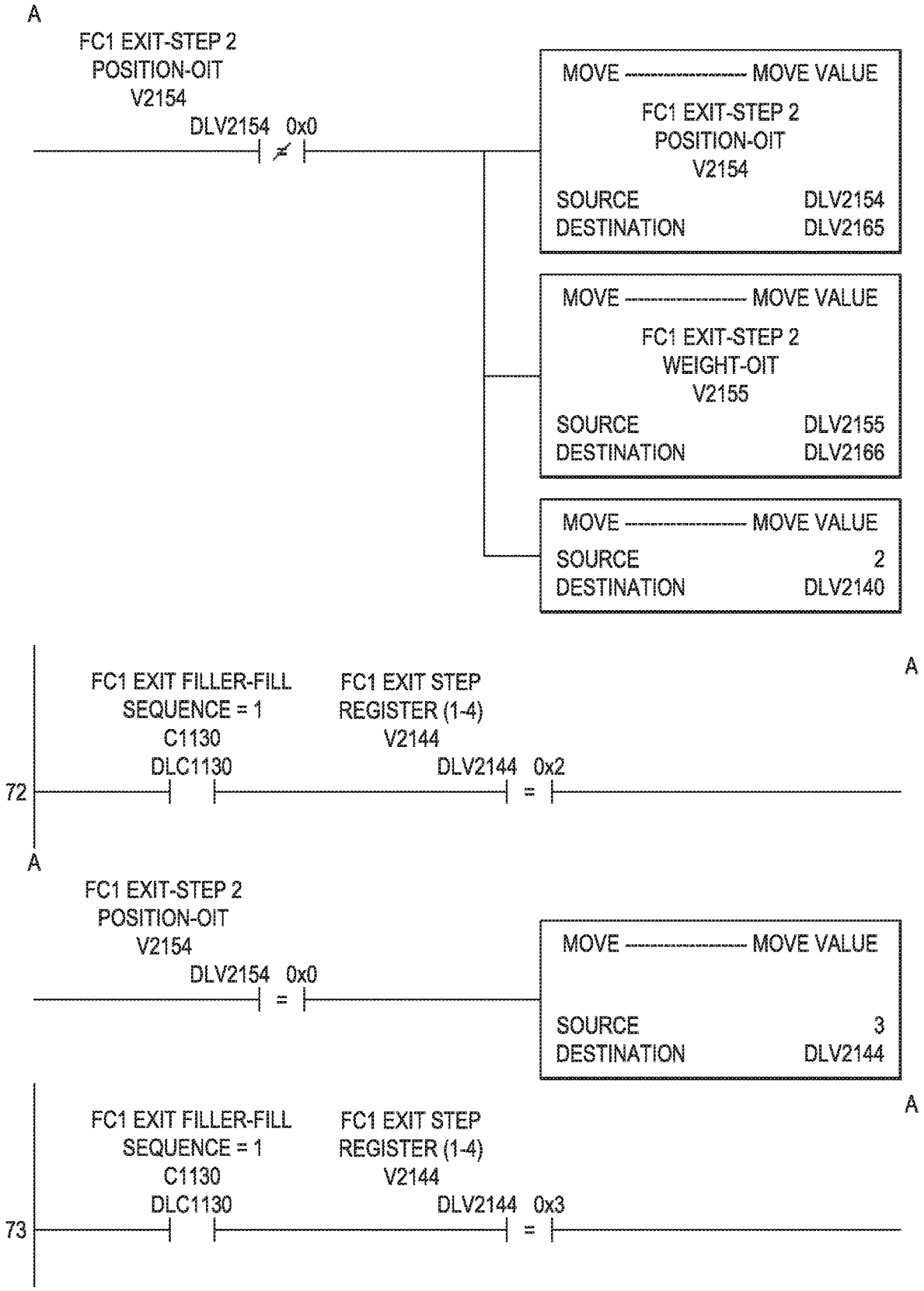
Figure 144:
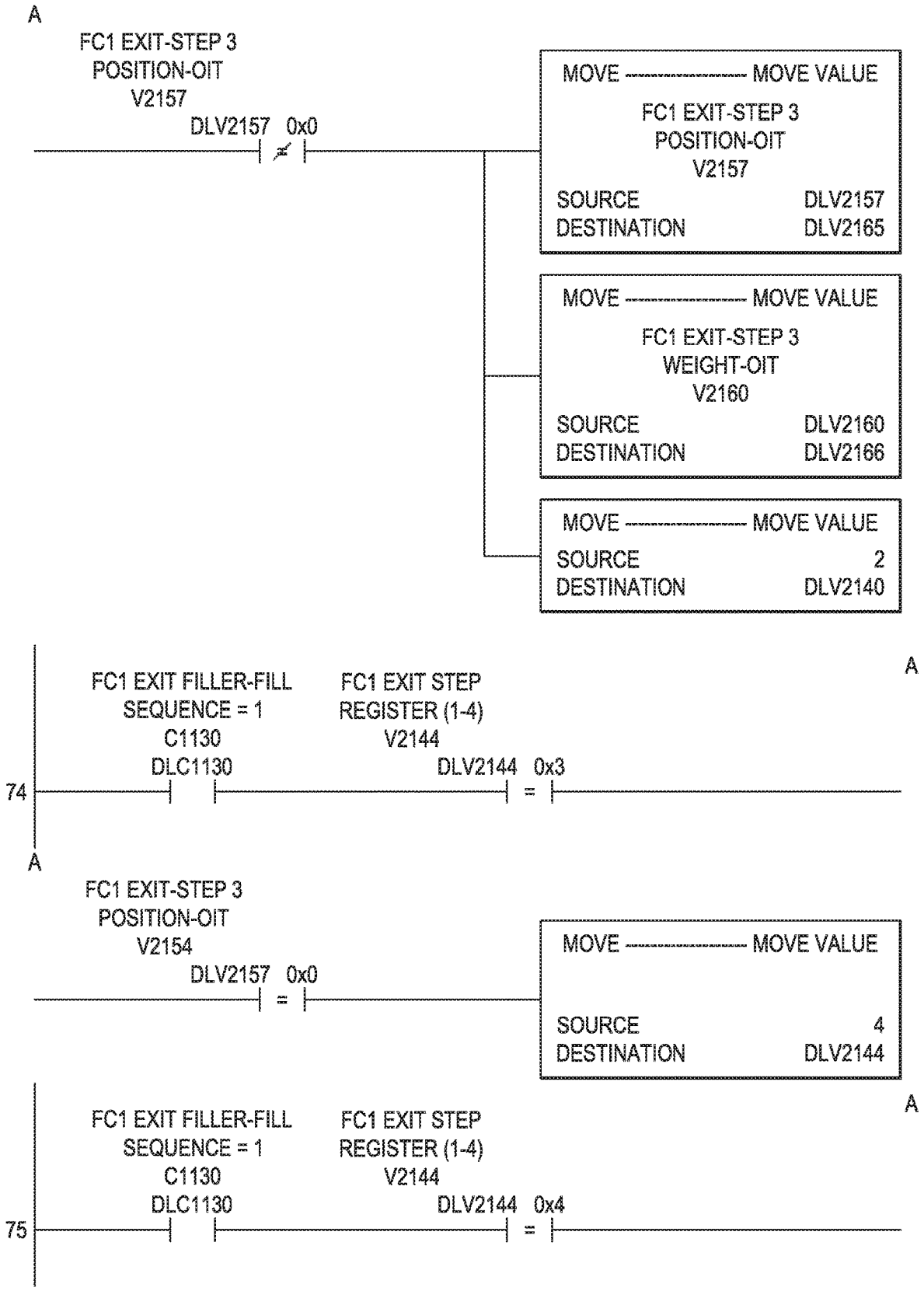
Figure 145:
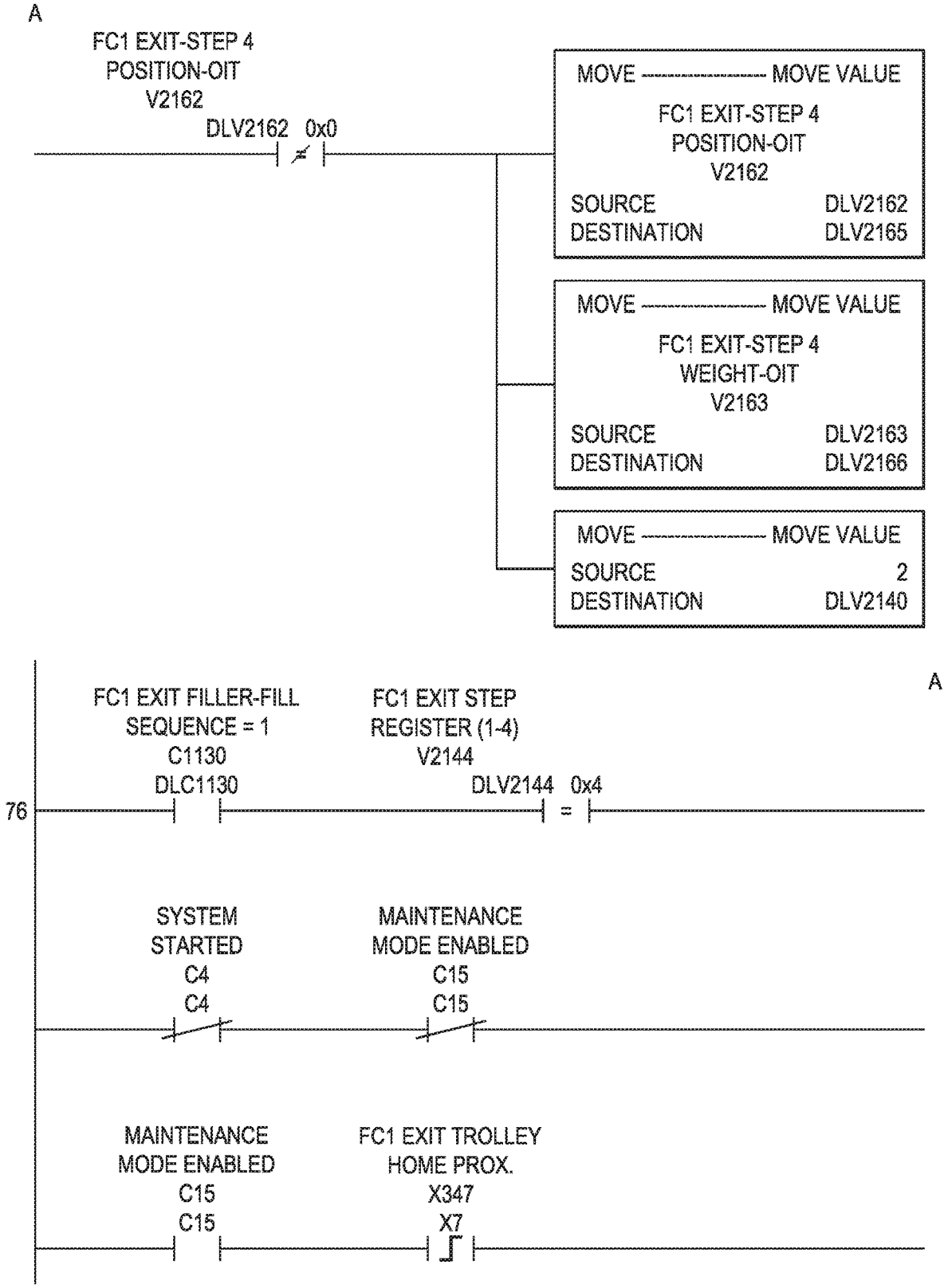
Figure 146:
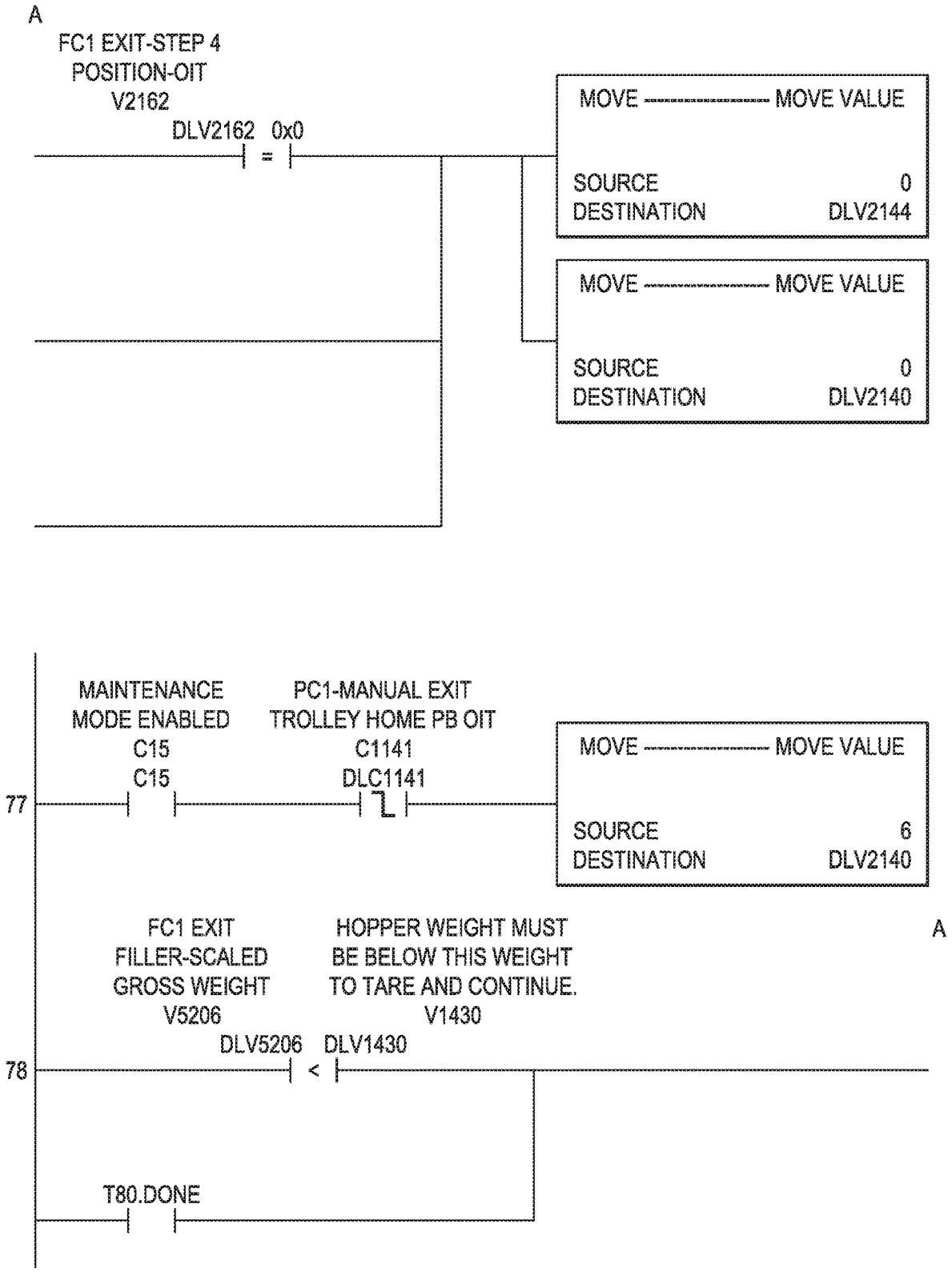
Figure 147:
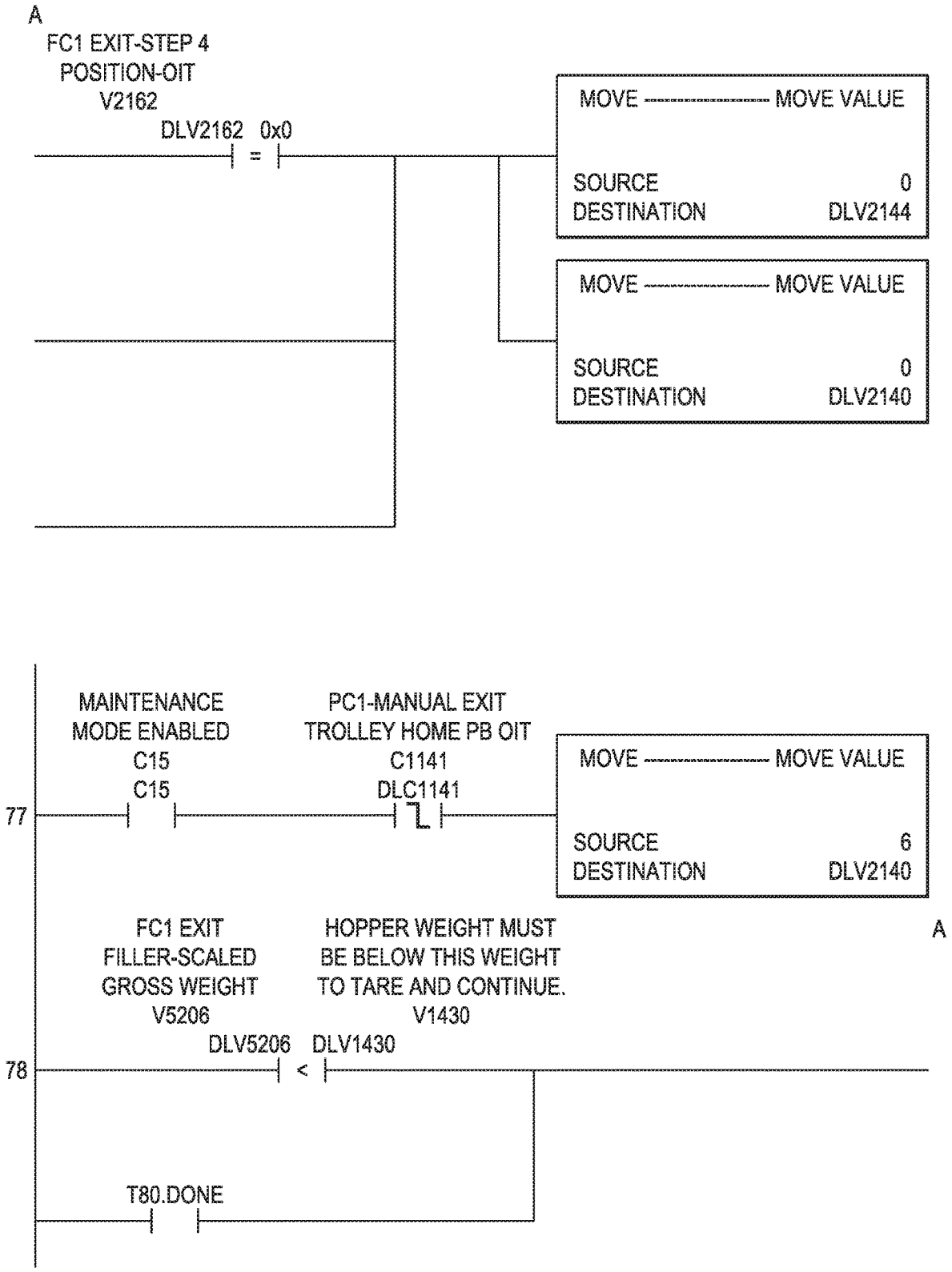
Figure 148:
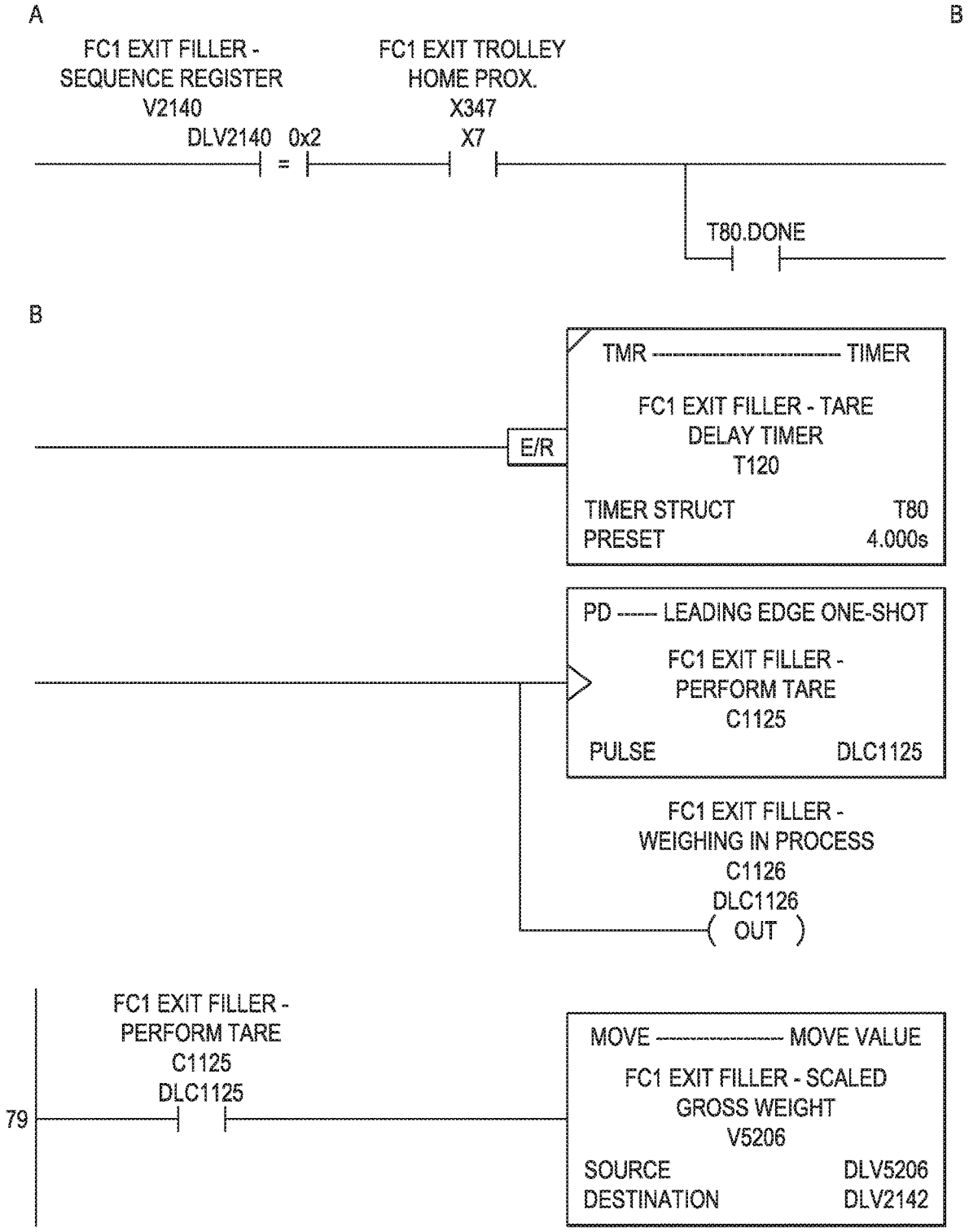
Figure 149:
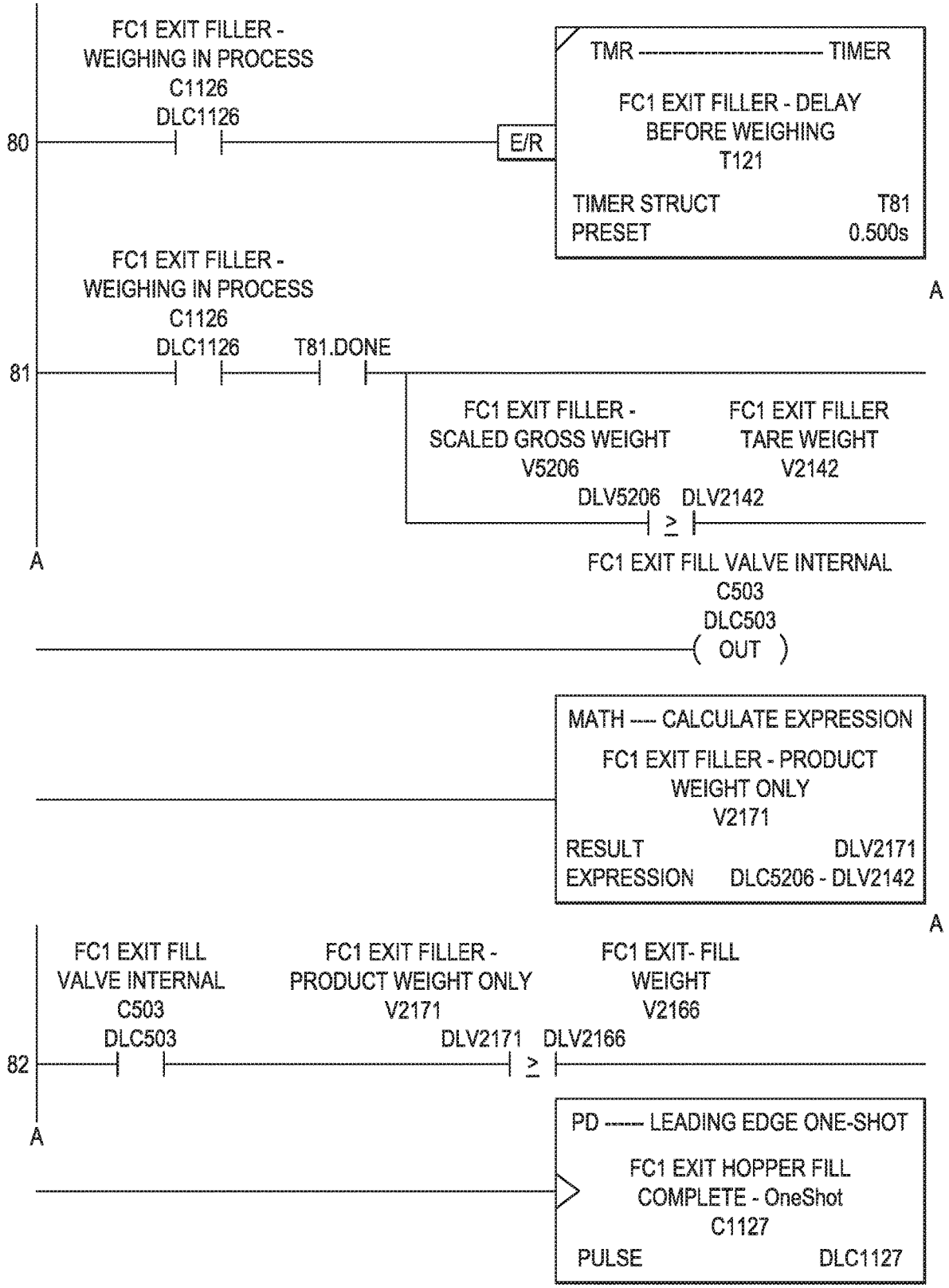
Figure 150:
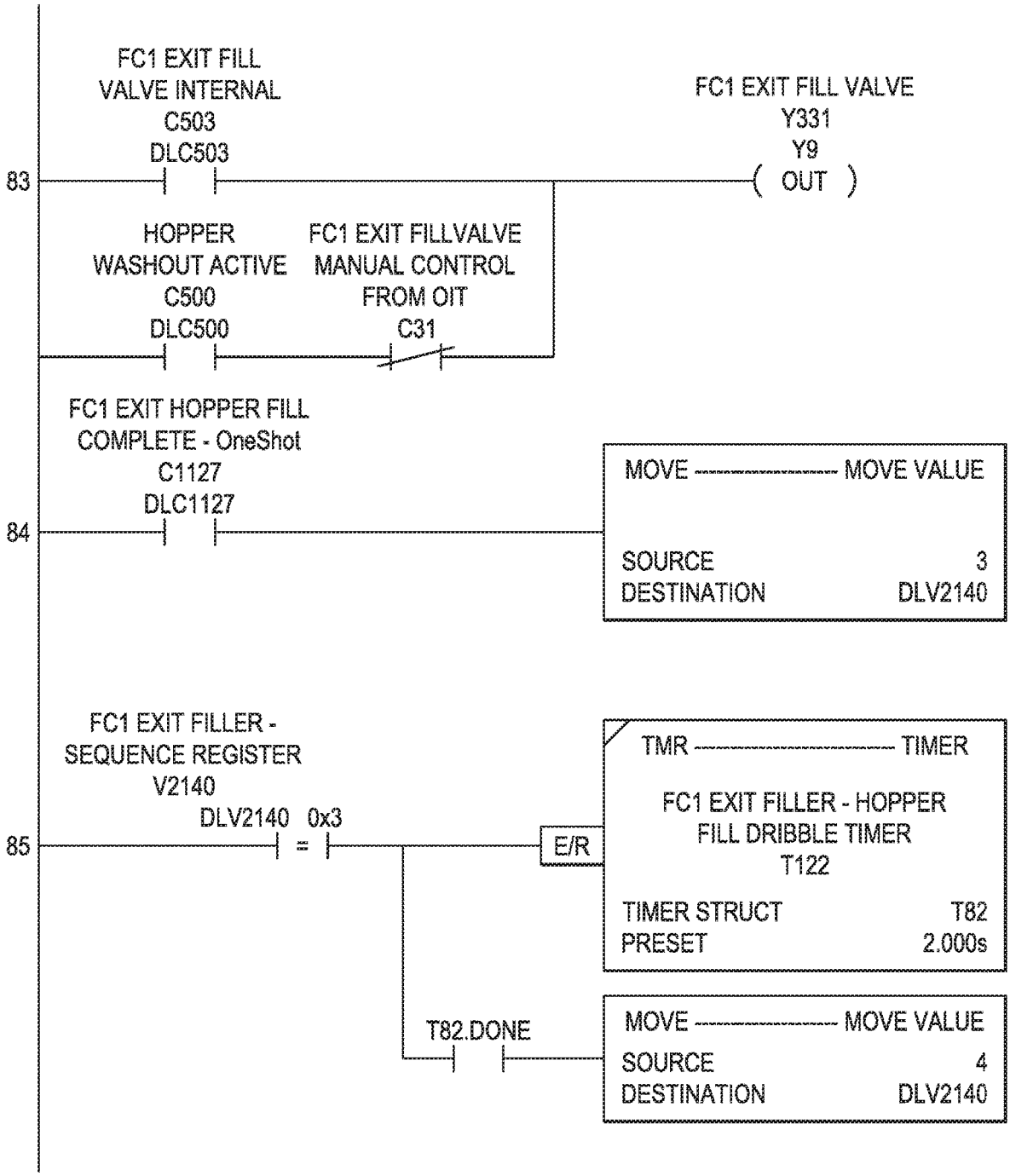
Figure 151:
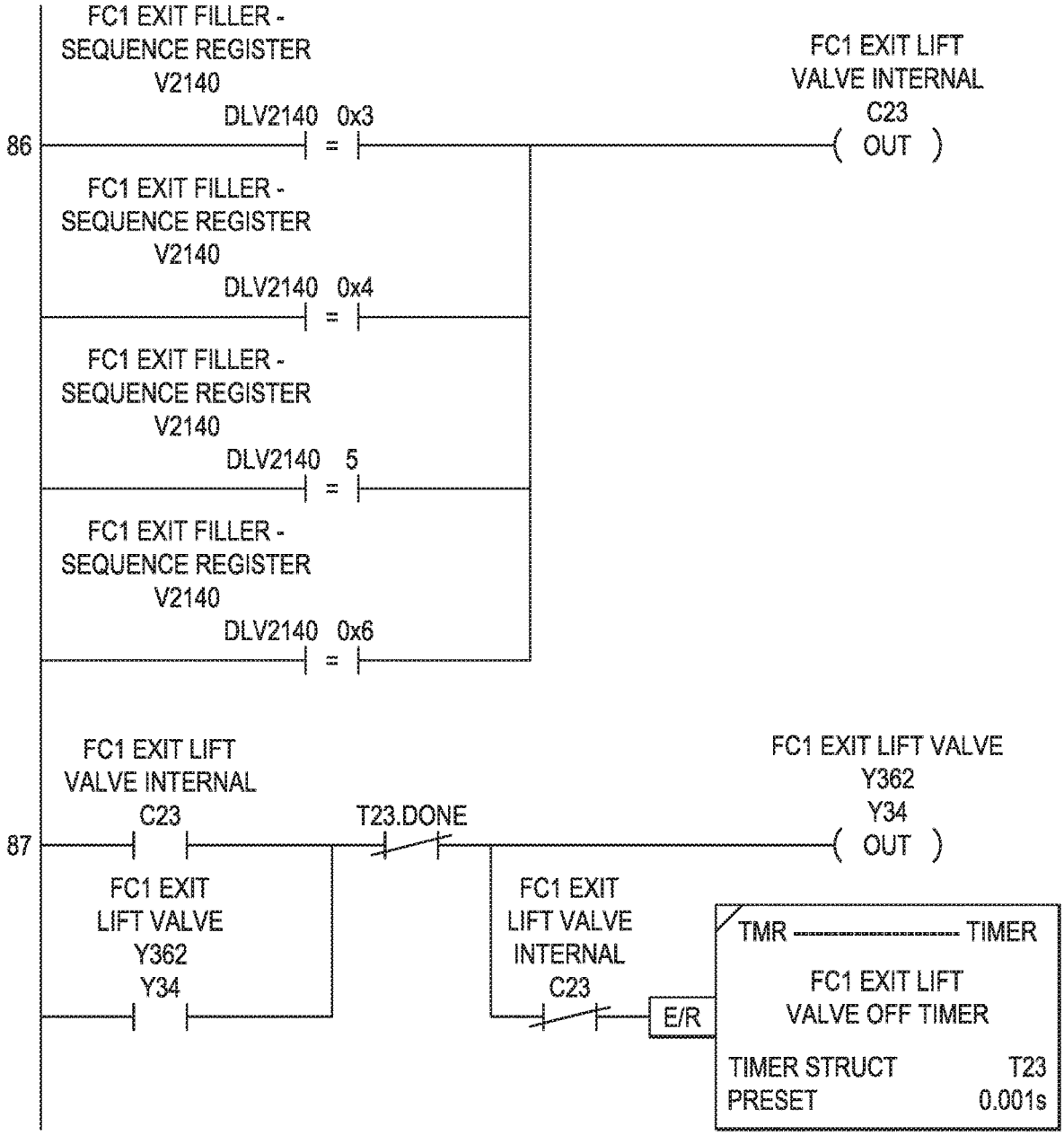
Figure 152:
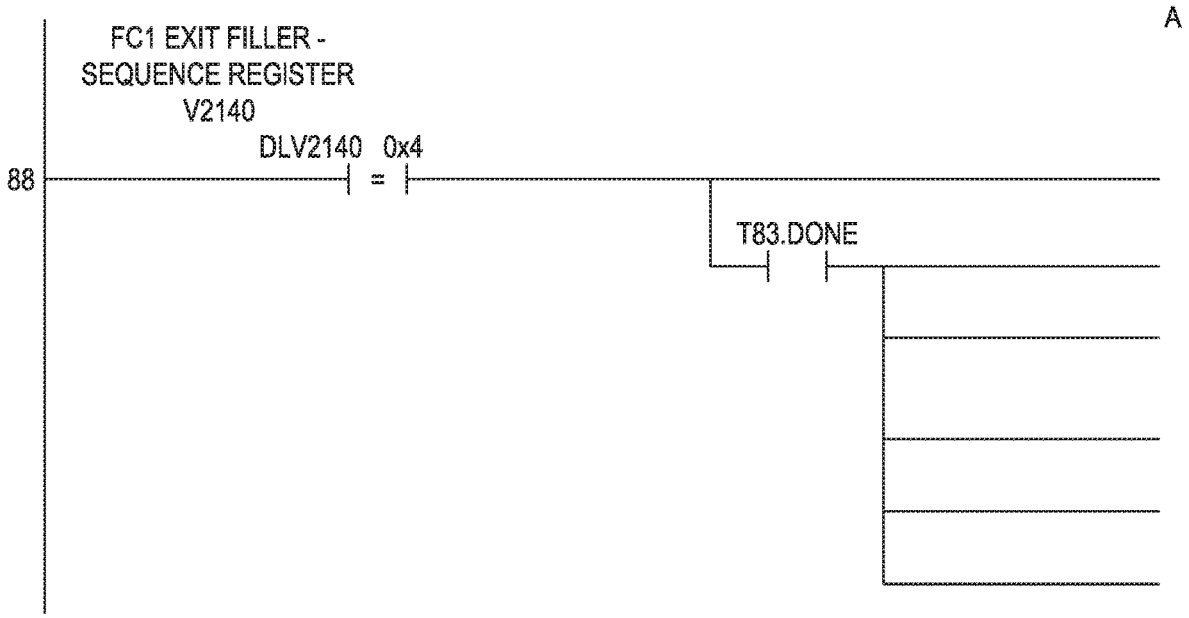
Figure 153:
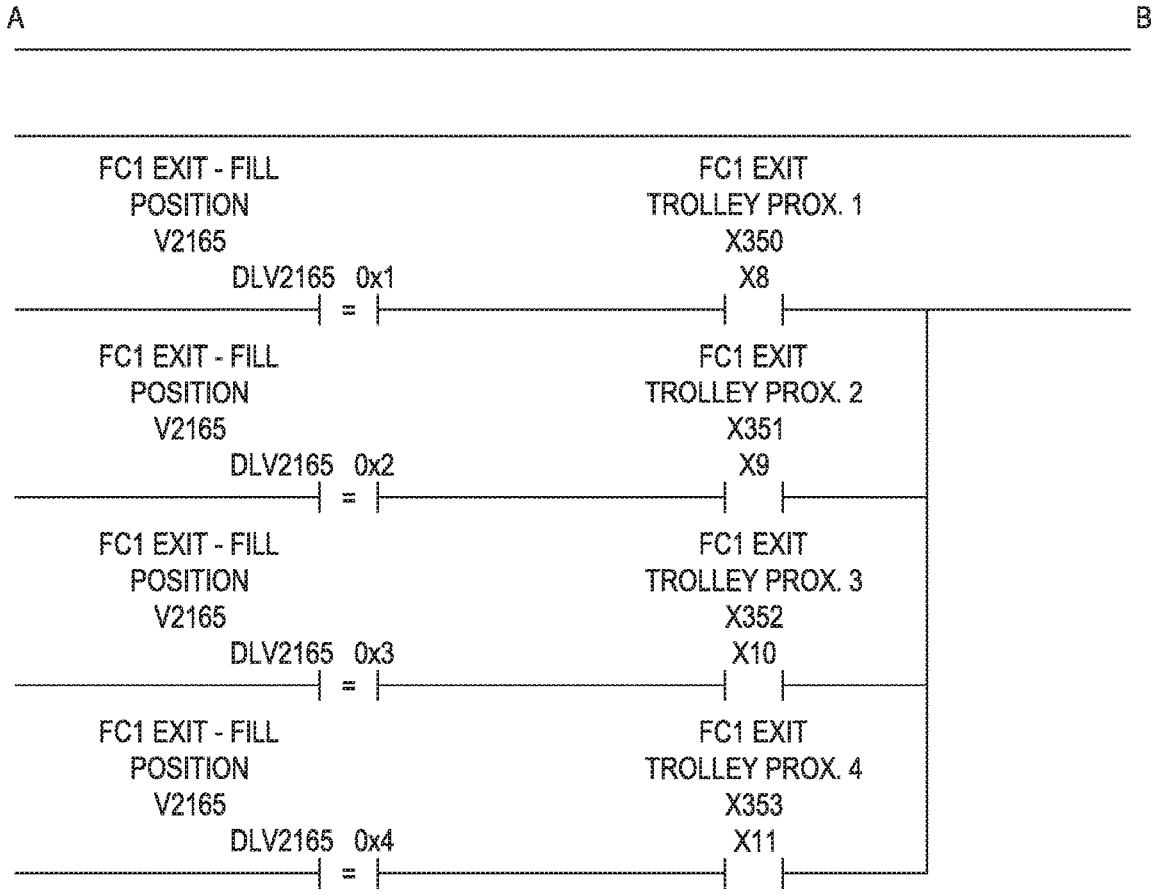
Figure 154:
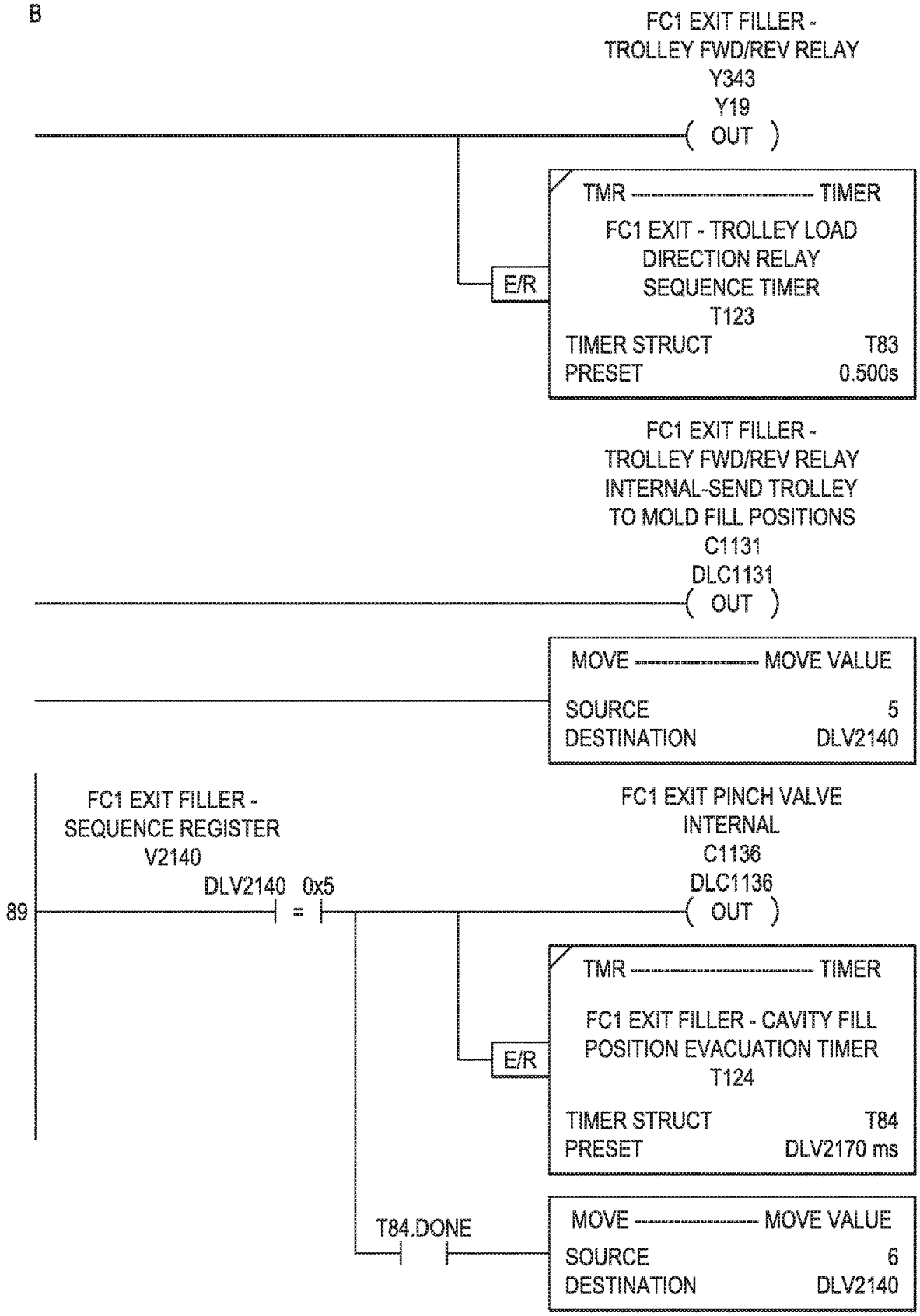
Figure 155:
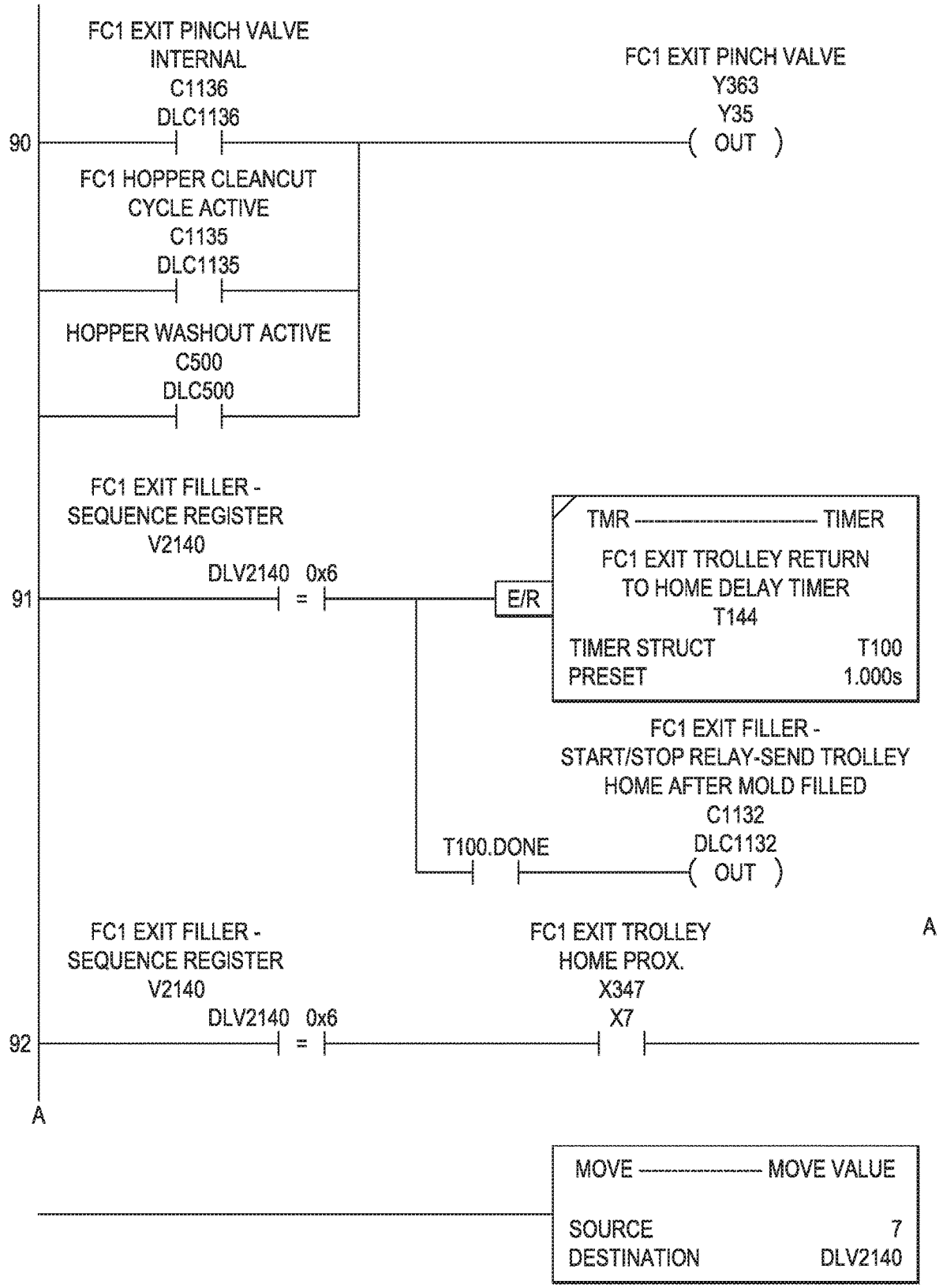
Figure 156:
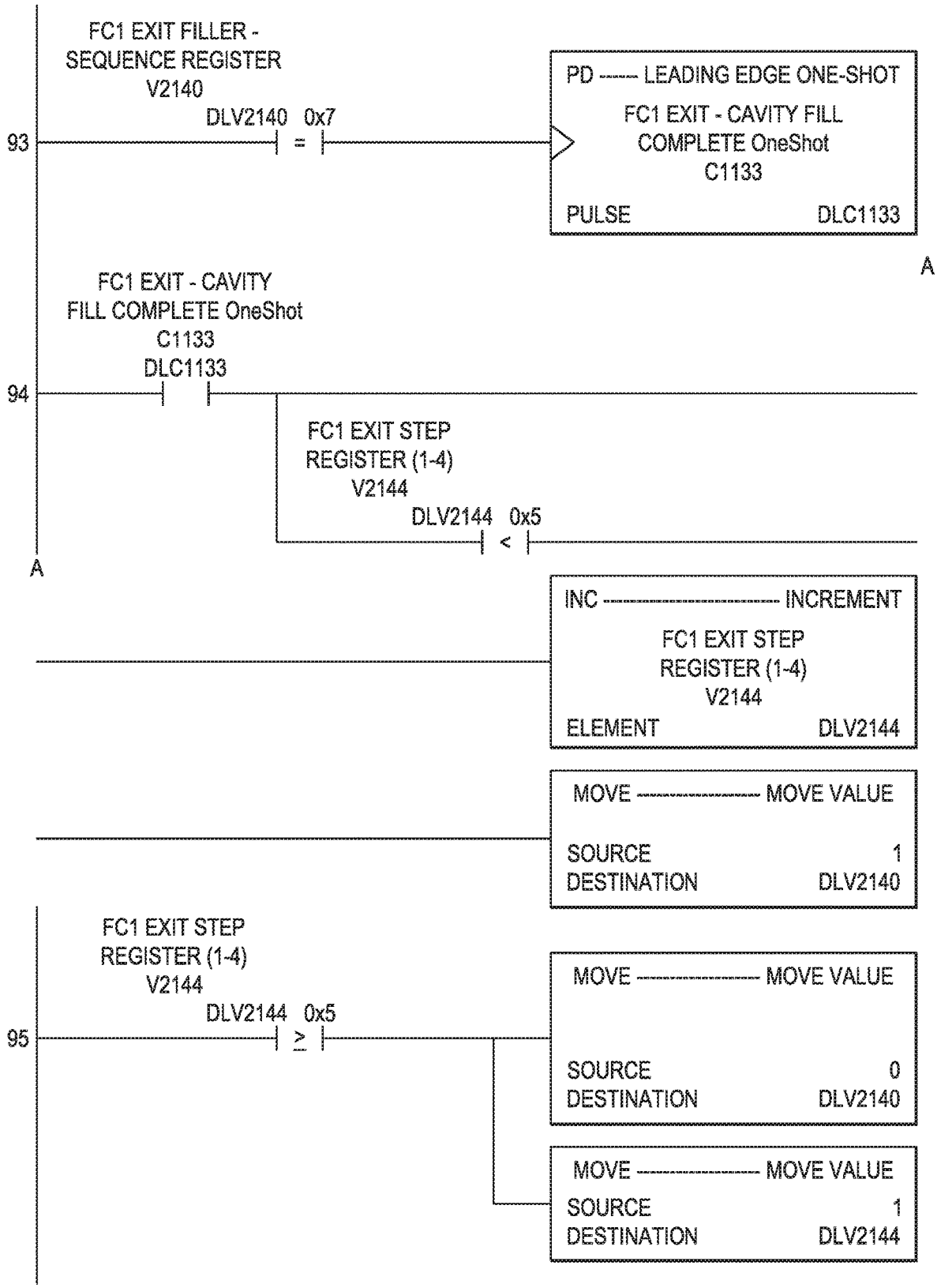
Figure 157:
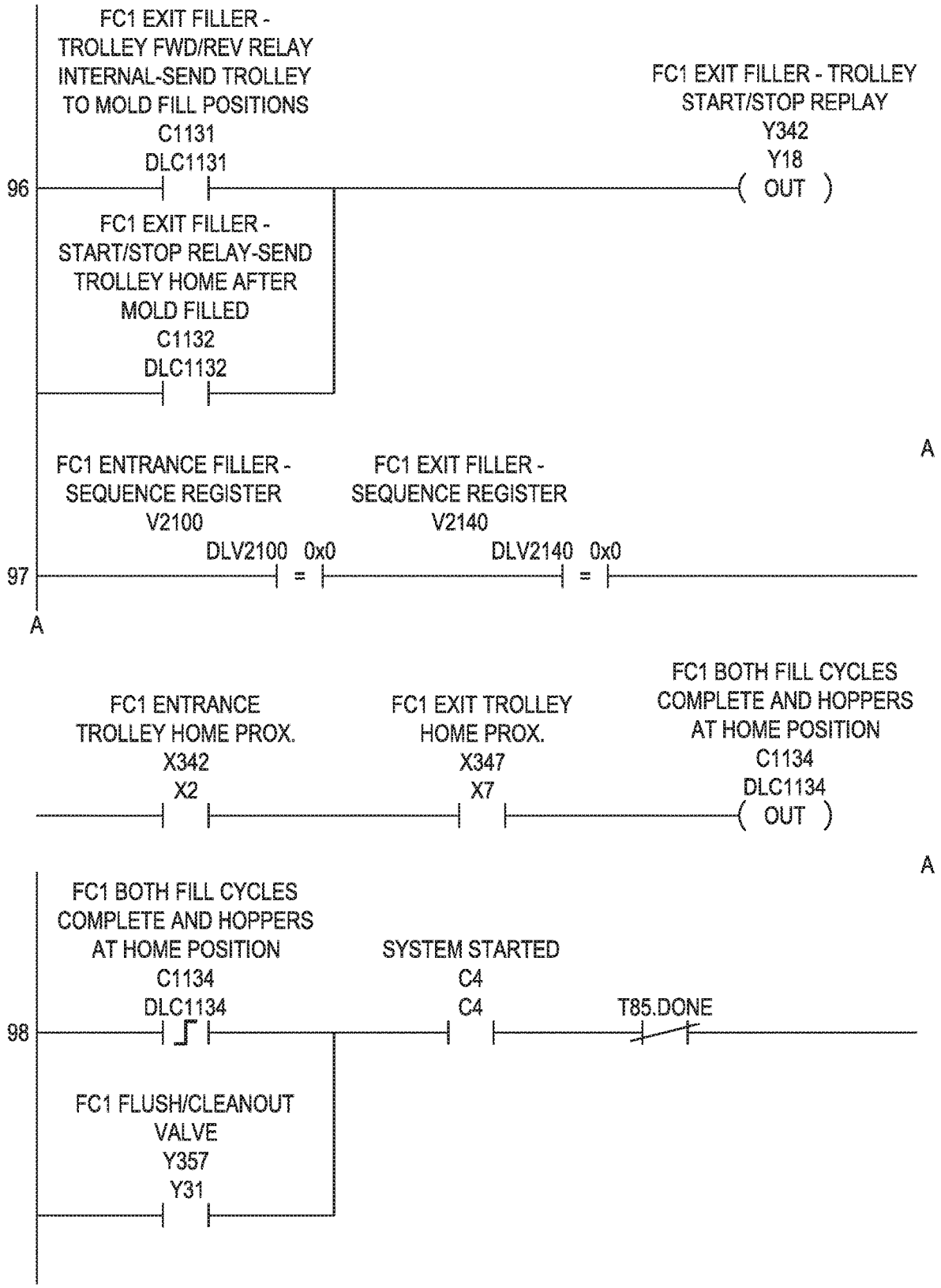
Figure 158:
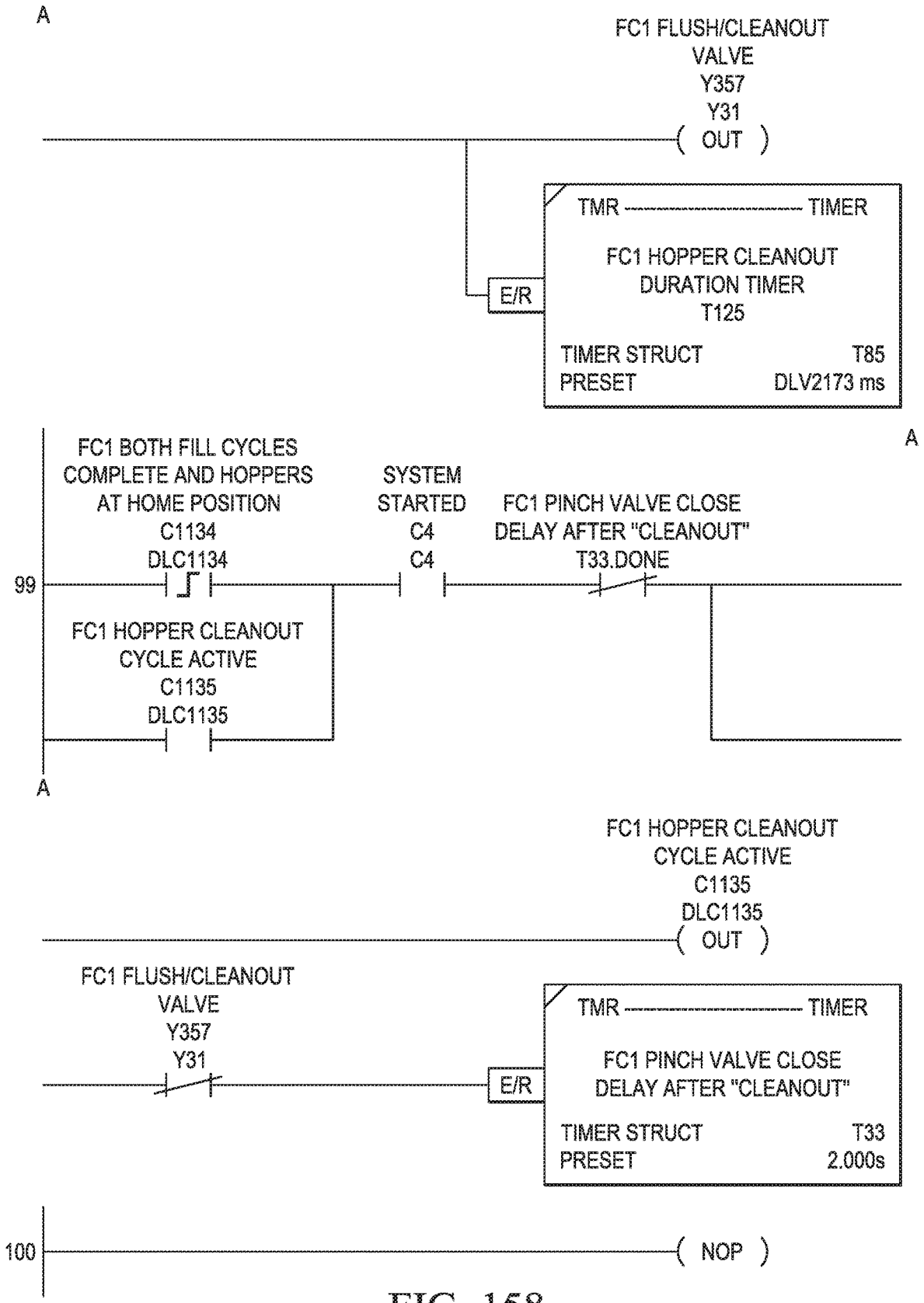
Figure 159:
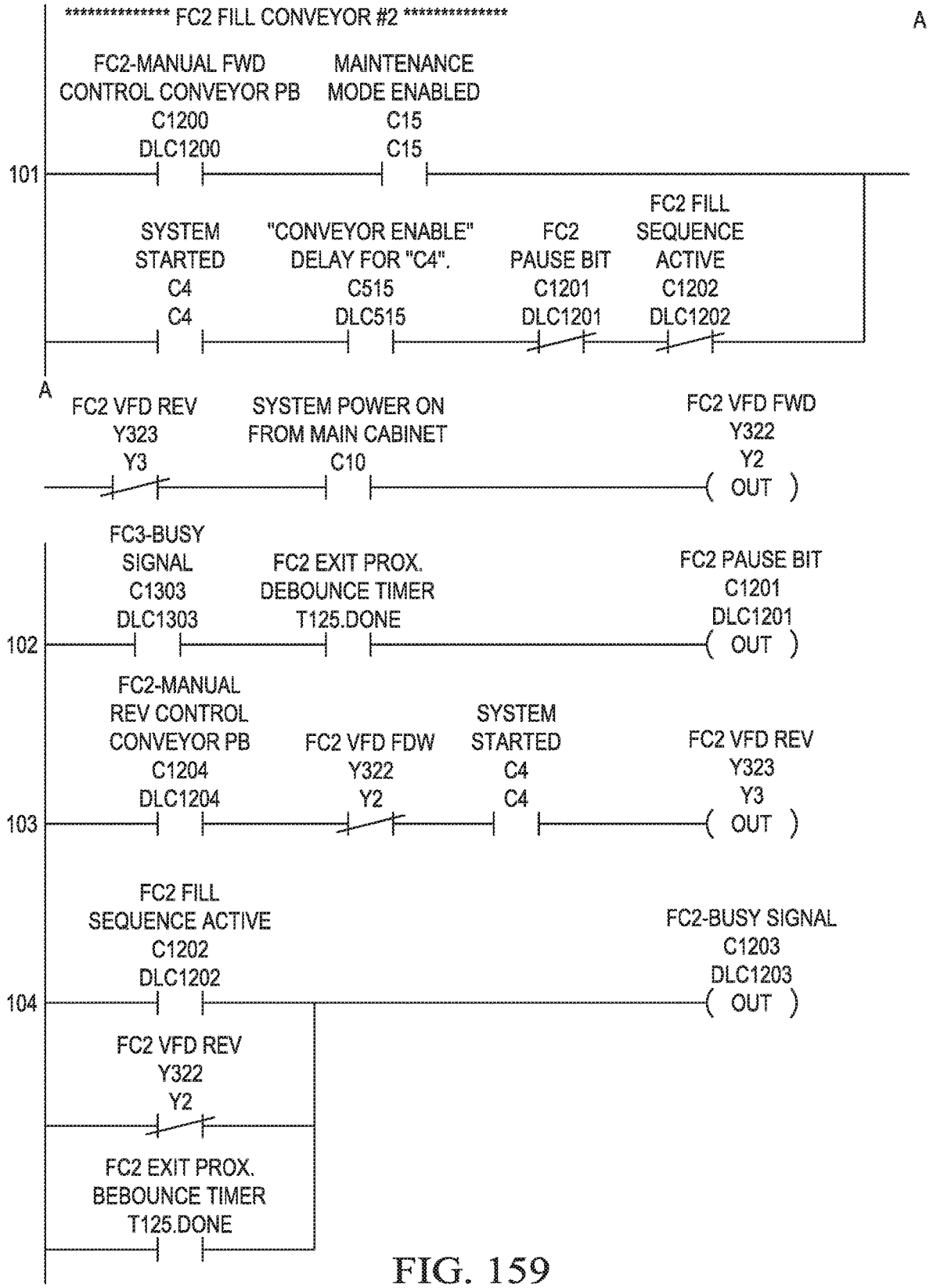
Figure 160:
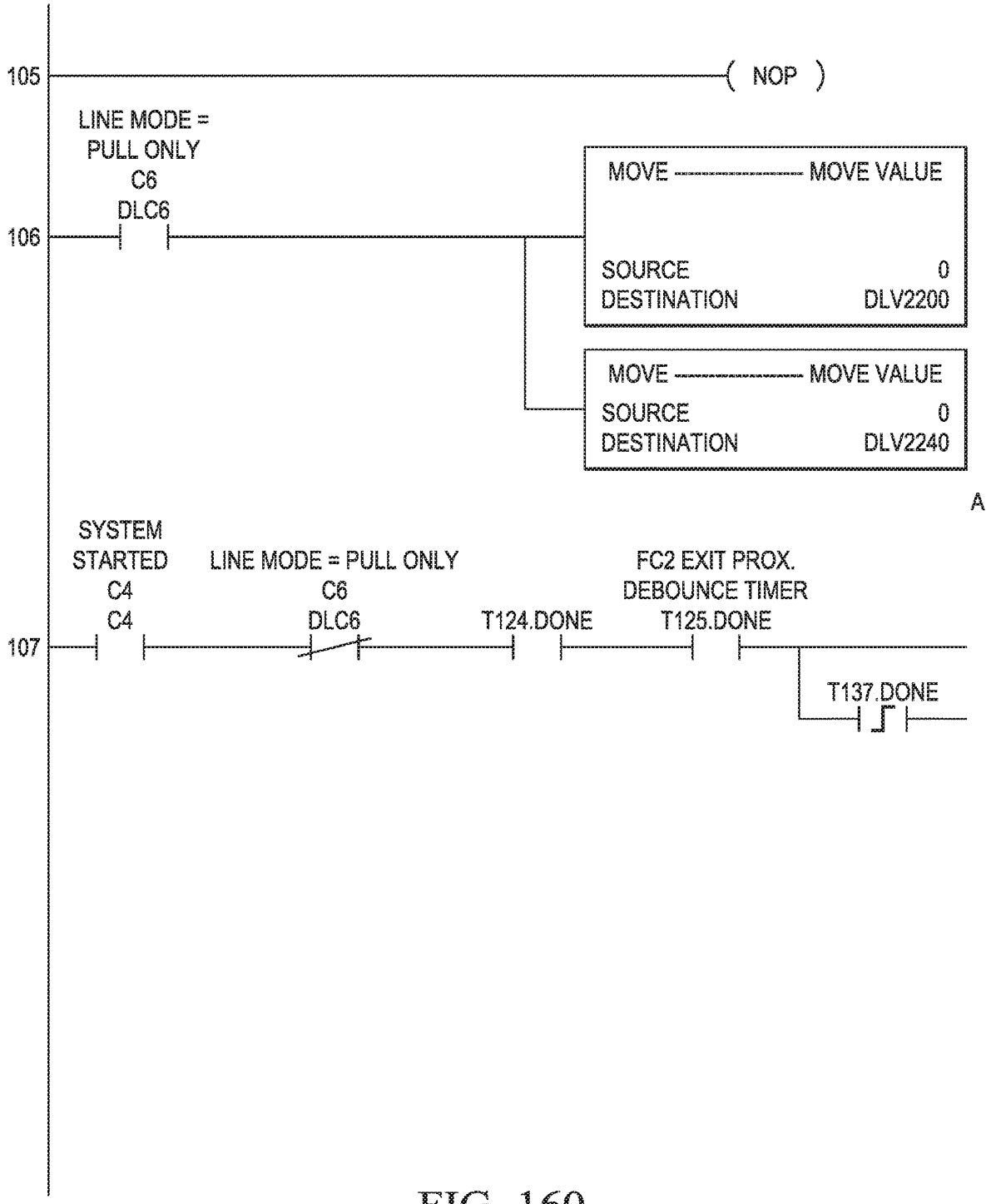
Figure 161:
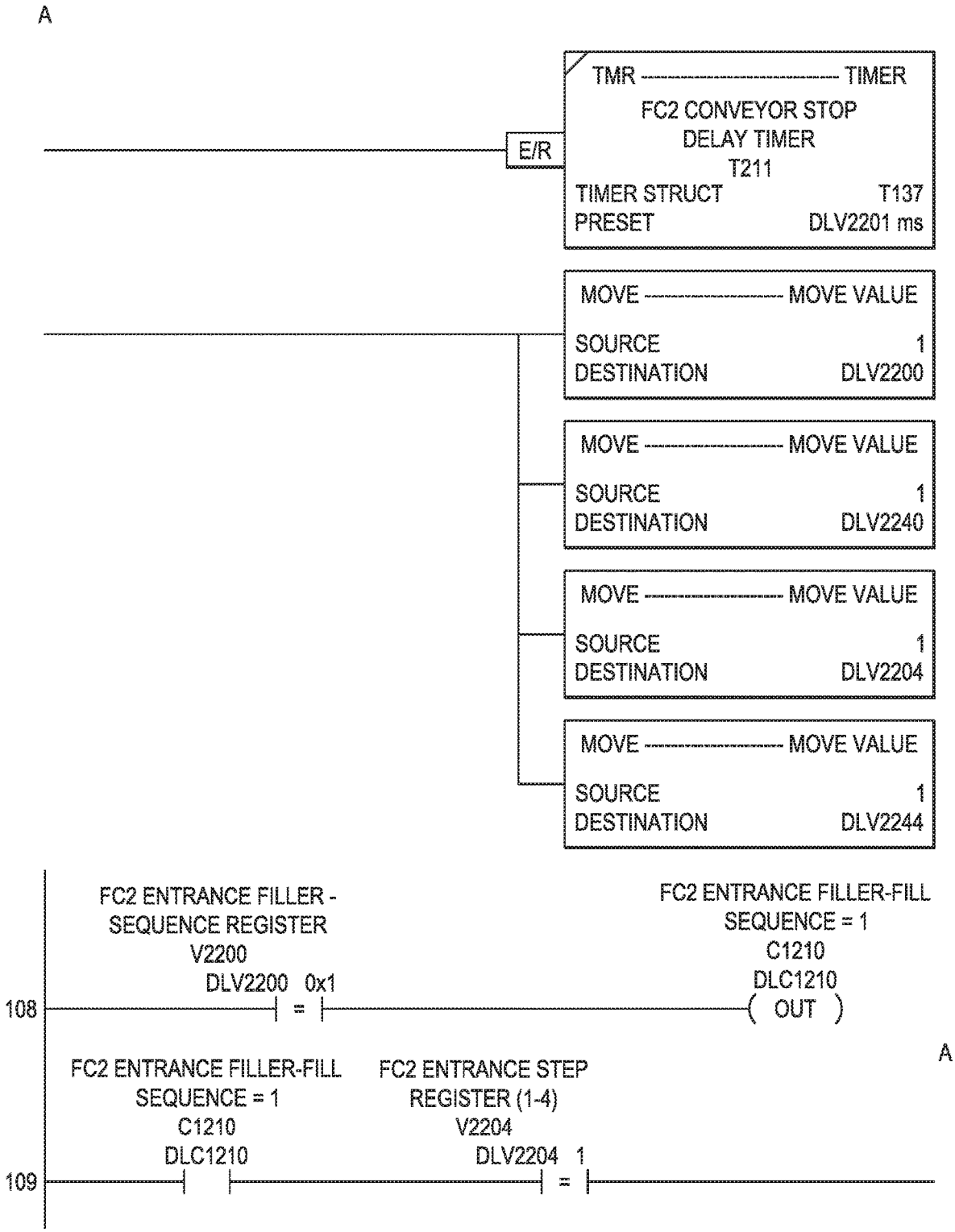
Figure 162:
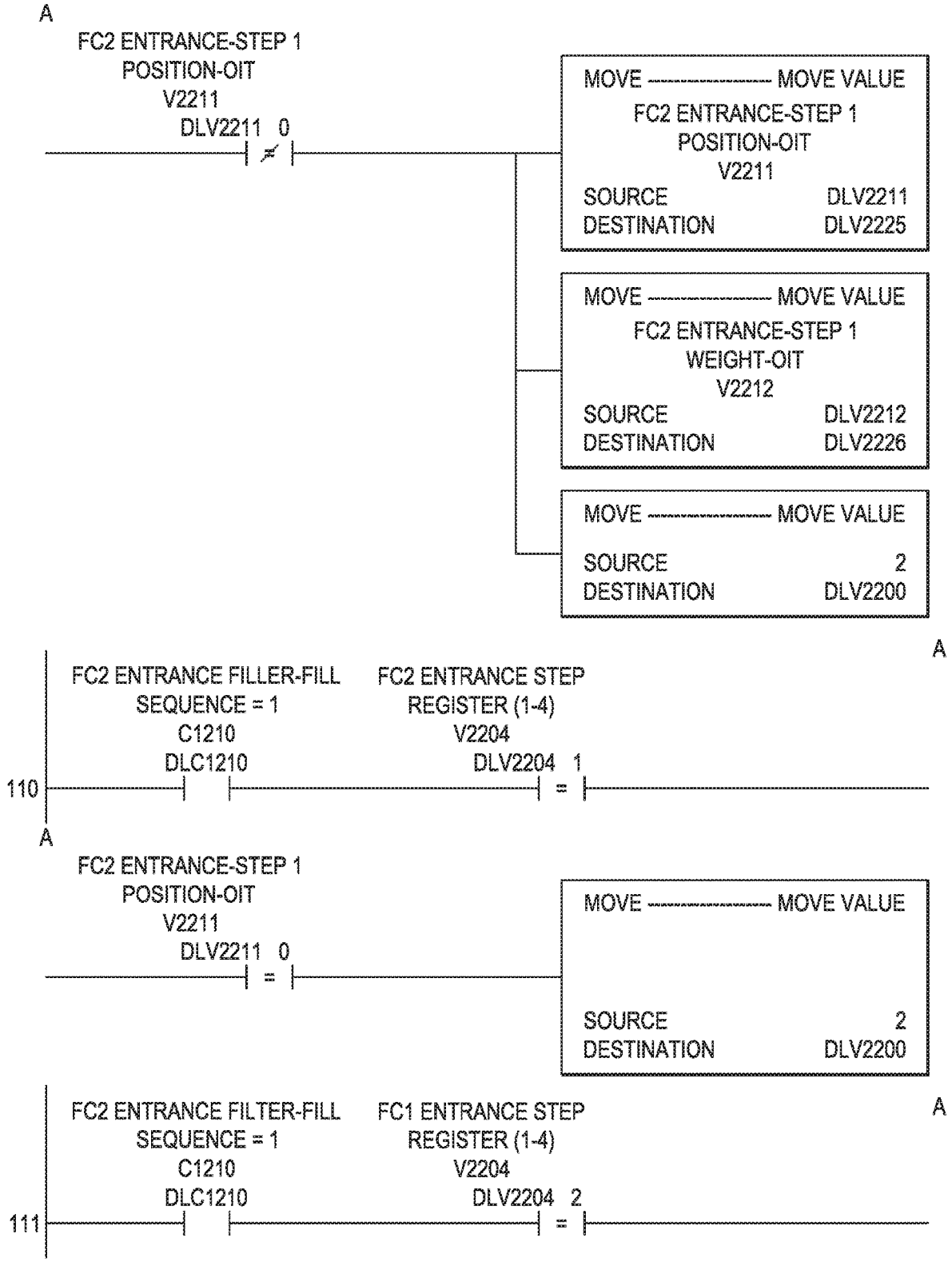
Figure 163:
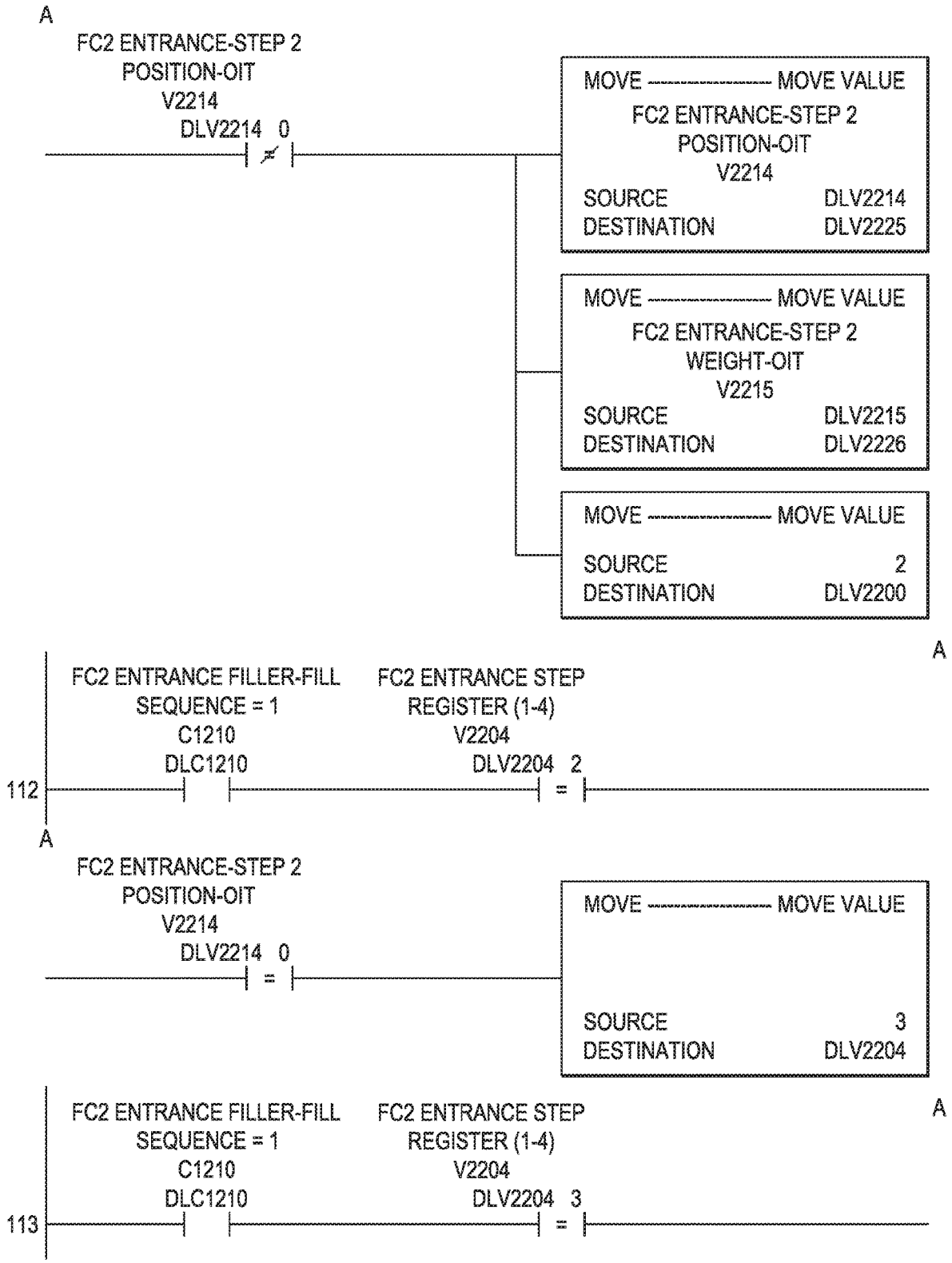
Figure 164:
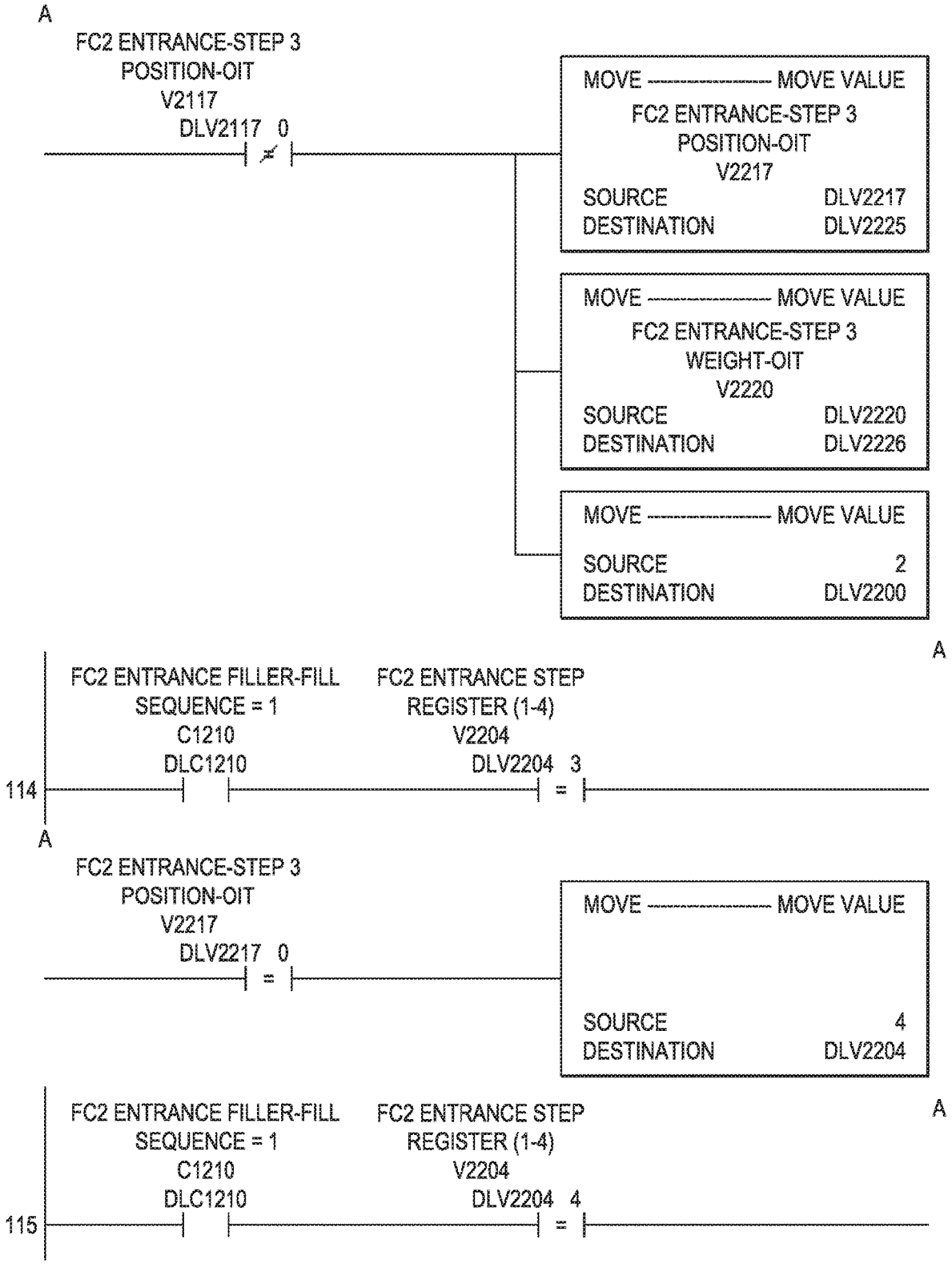
Figure 165:
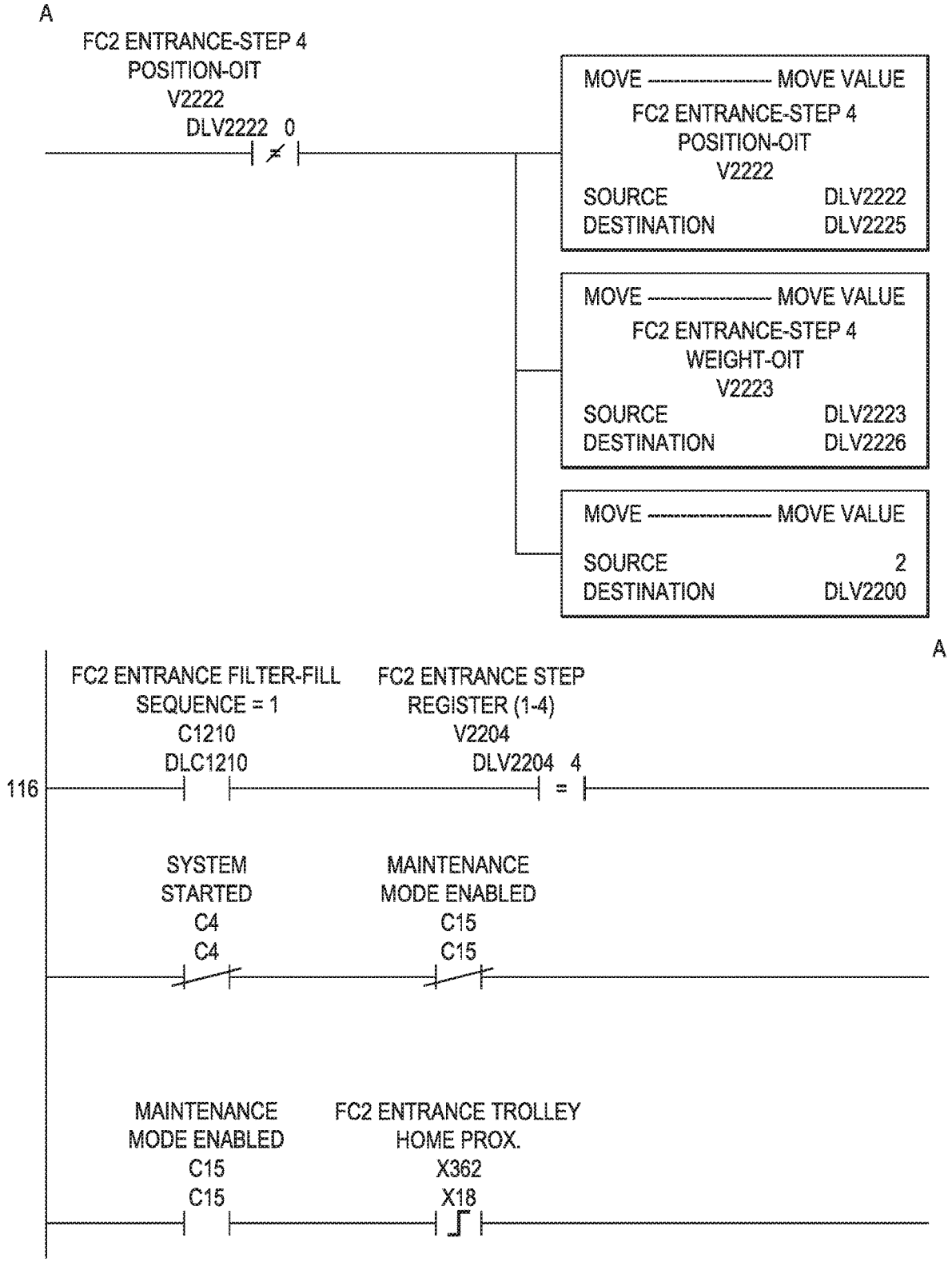
Figure 166:
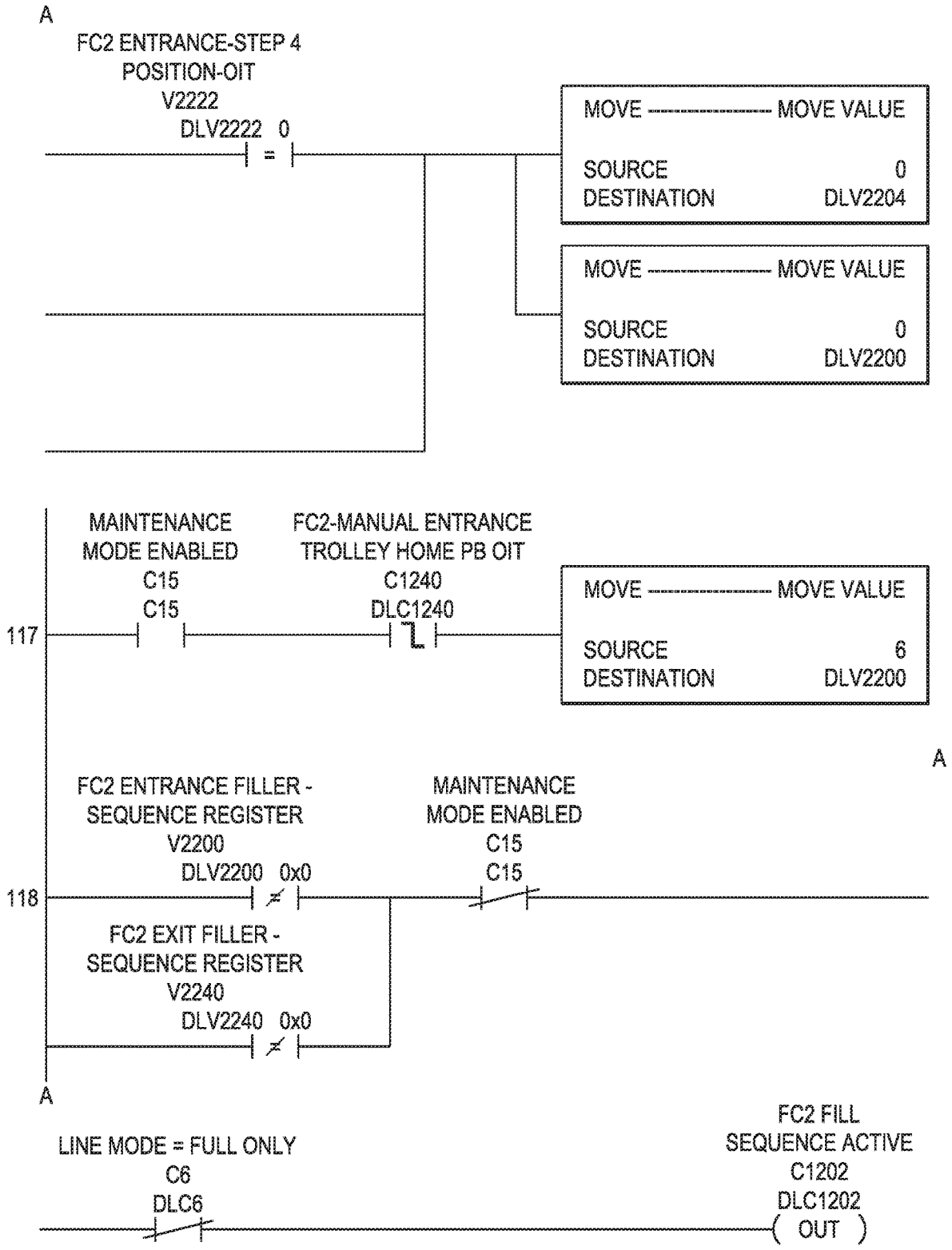
Figure 167:
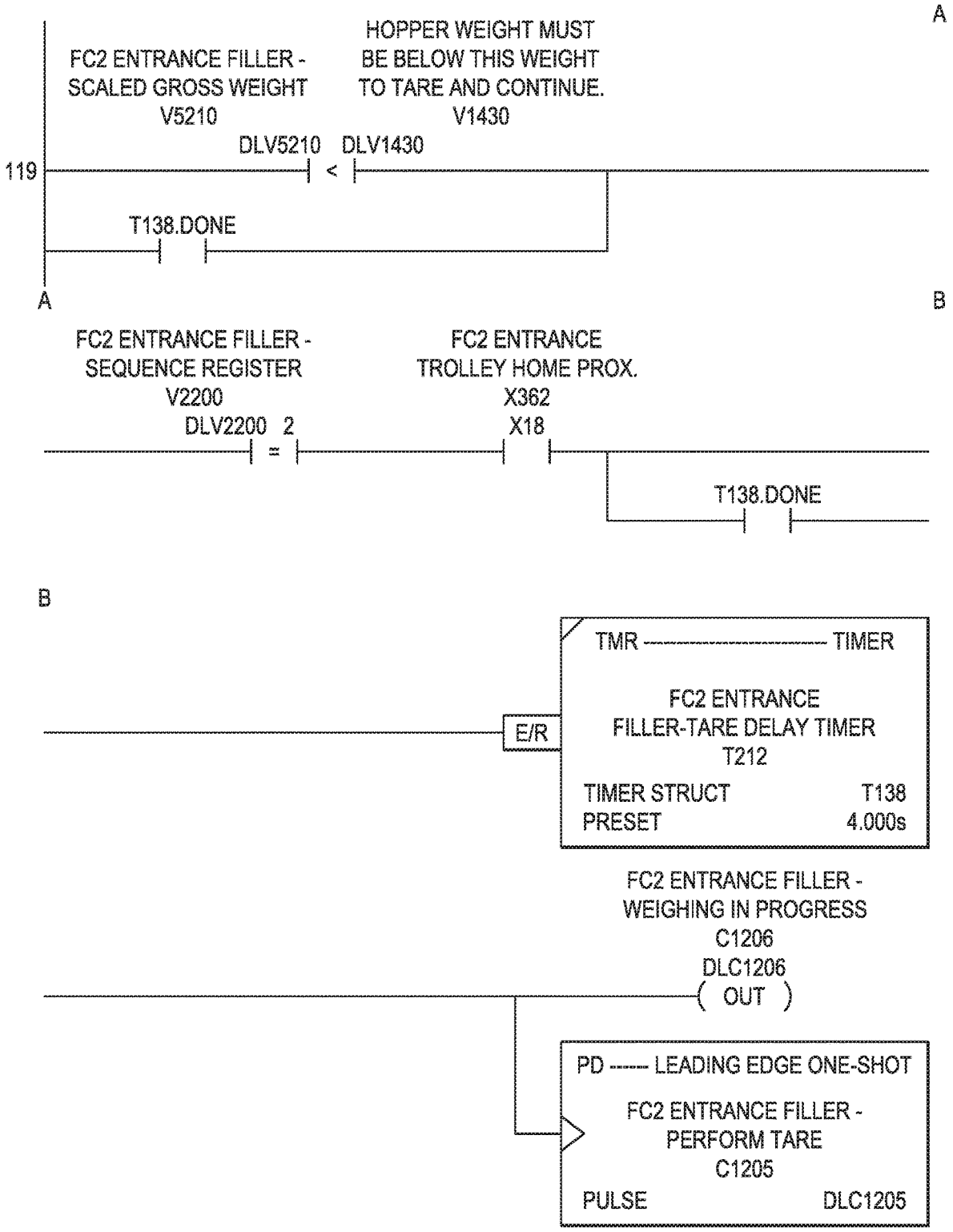
Figure 168:
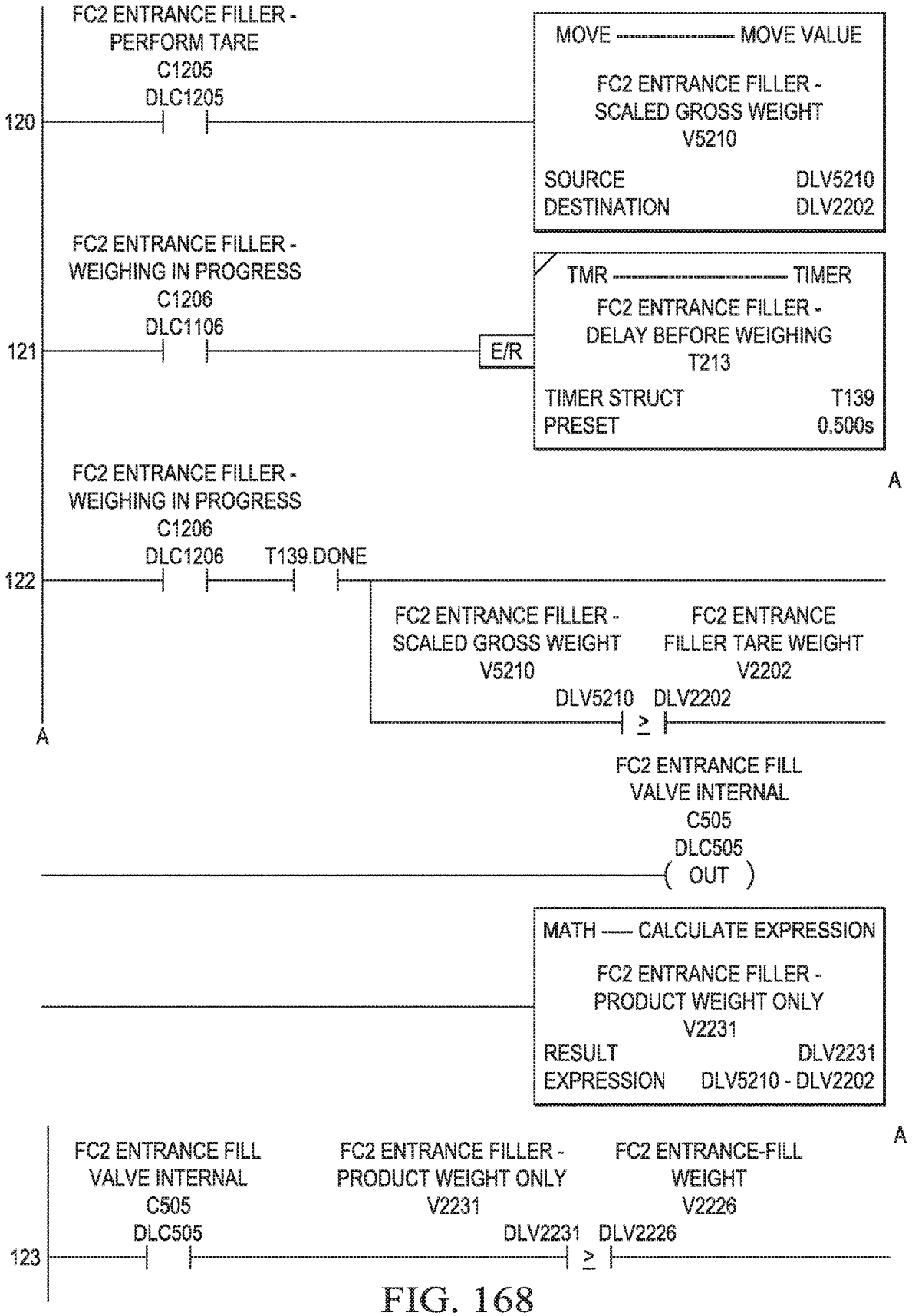
Figure 169:
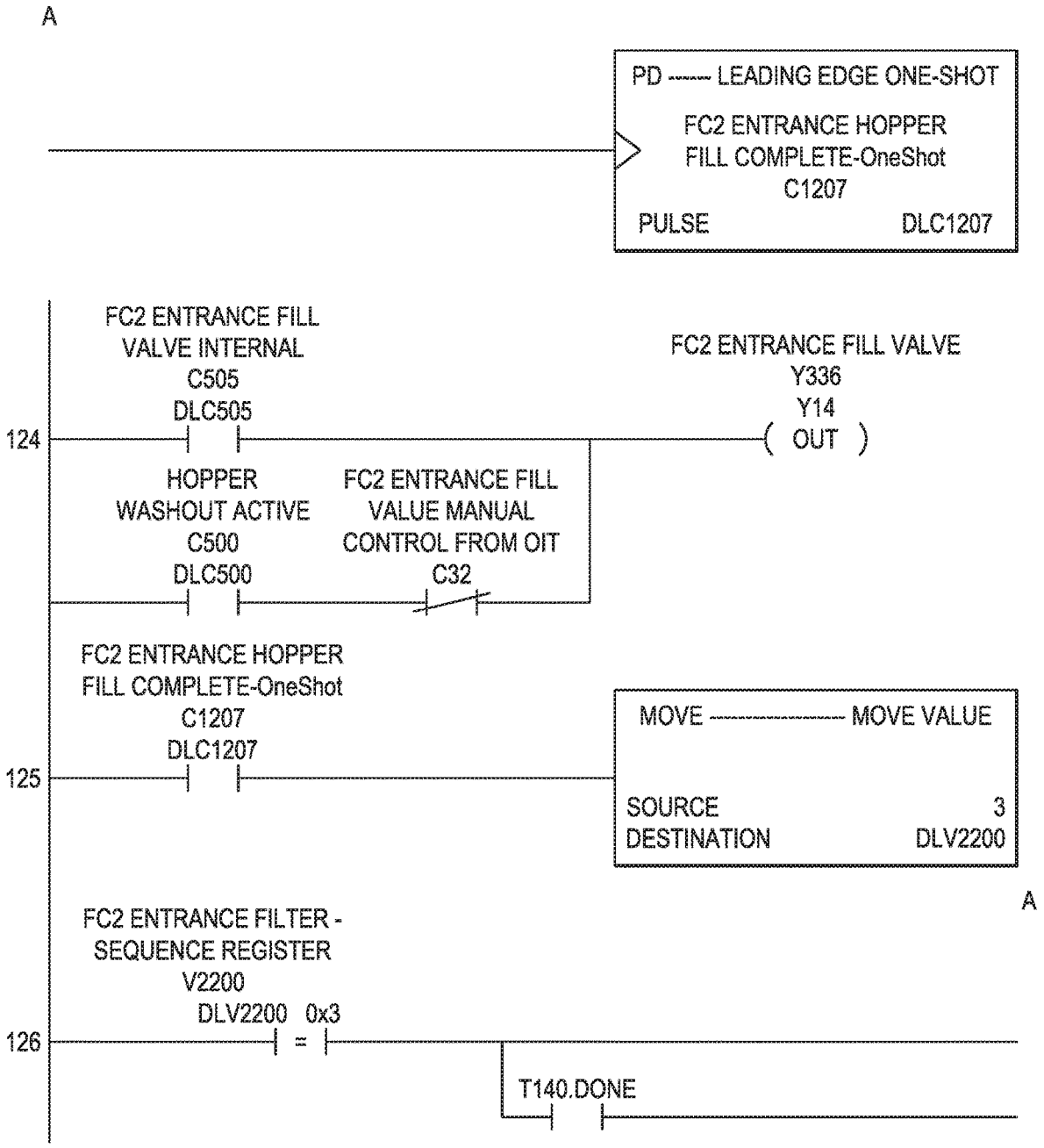
Figure 170:
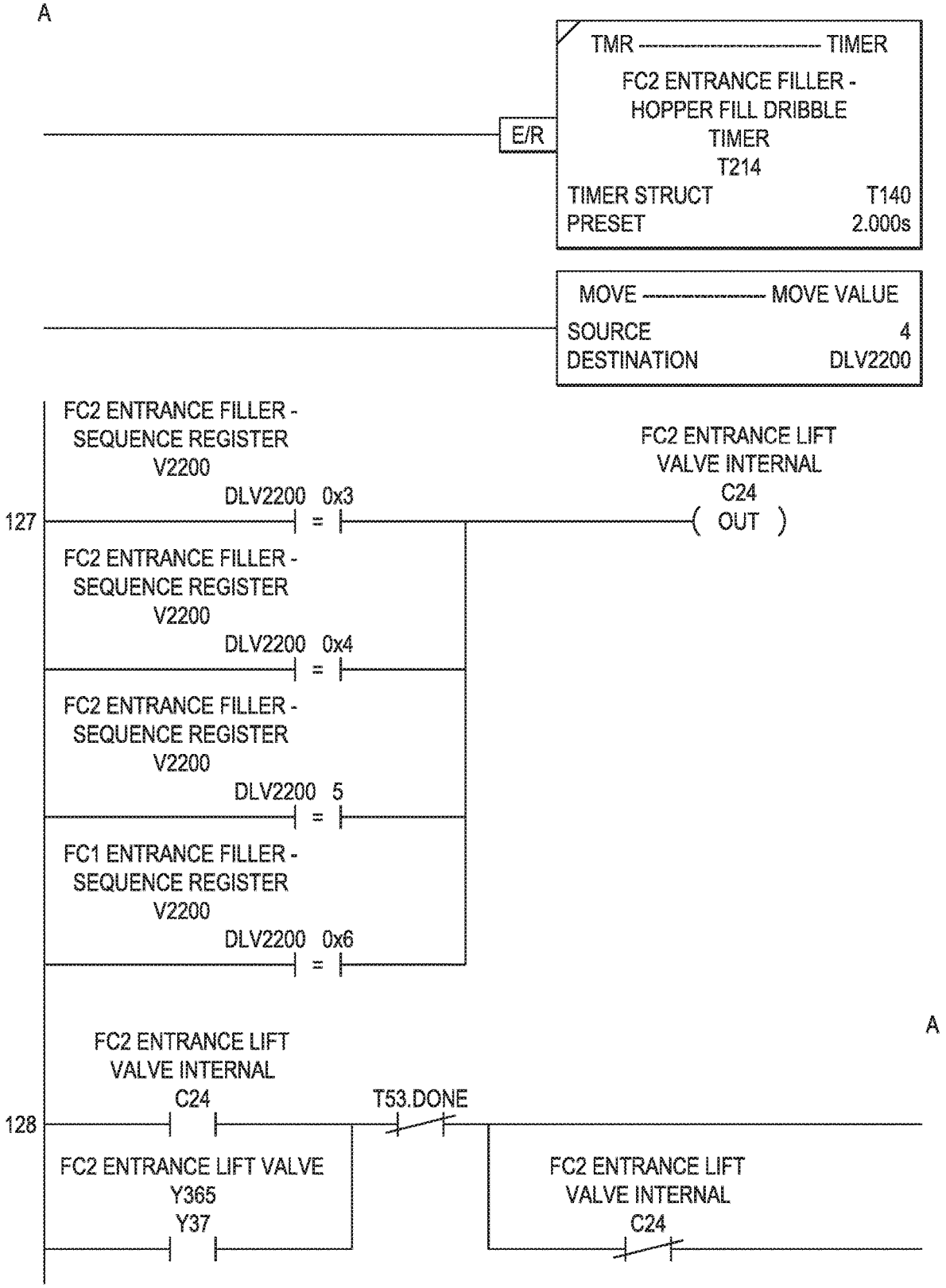
Figure 171:
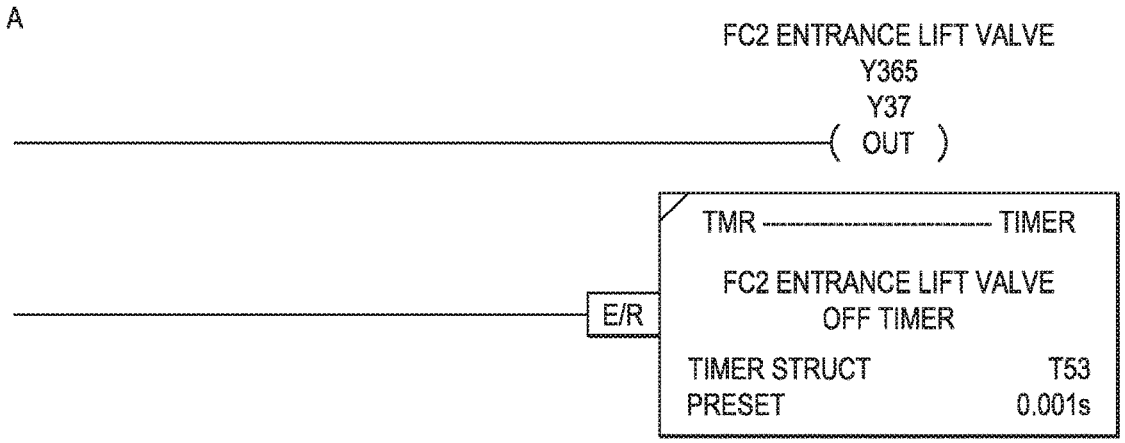
Figure 172:
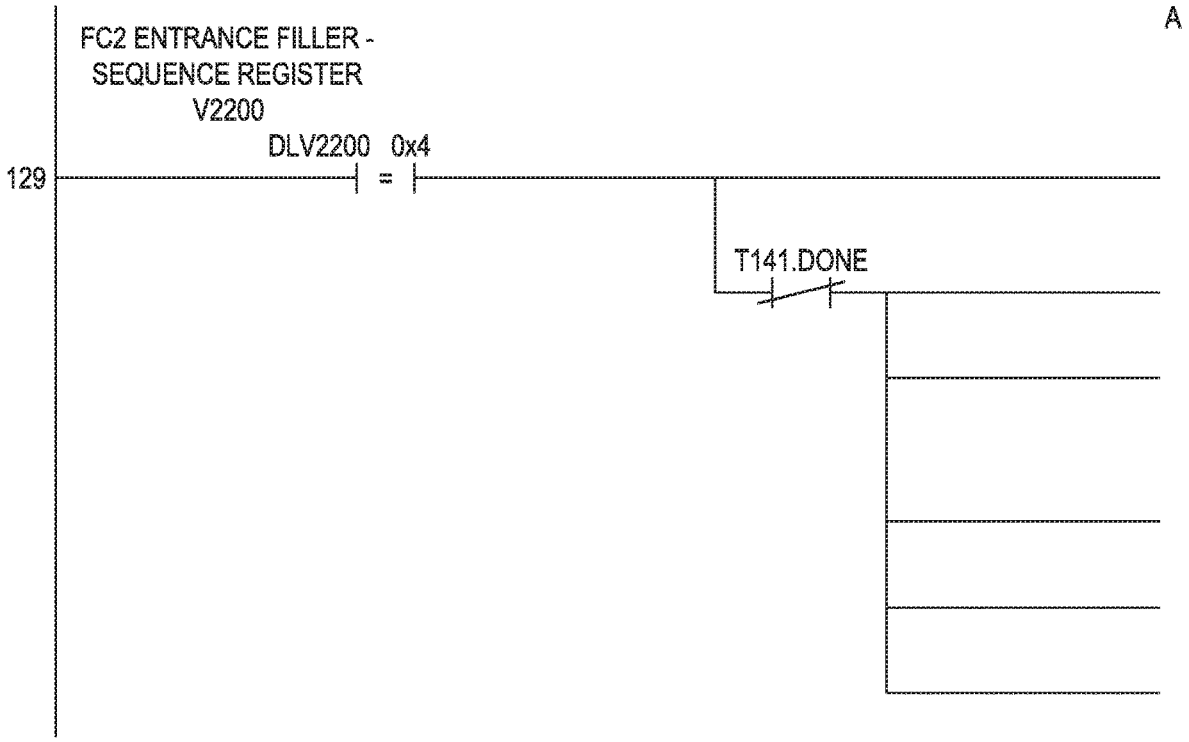
Figure 173:
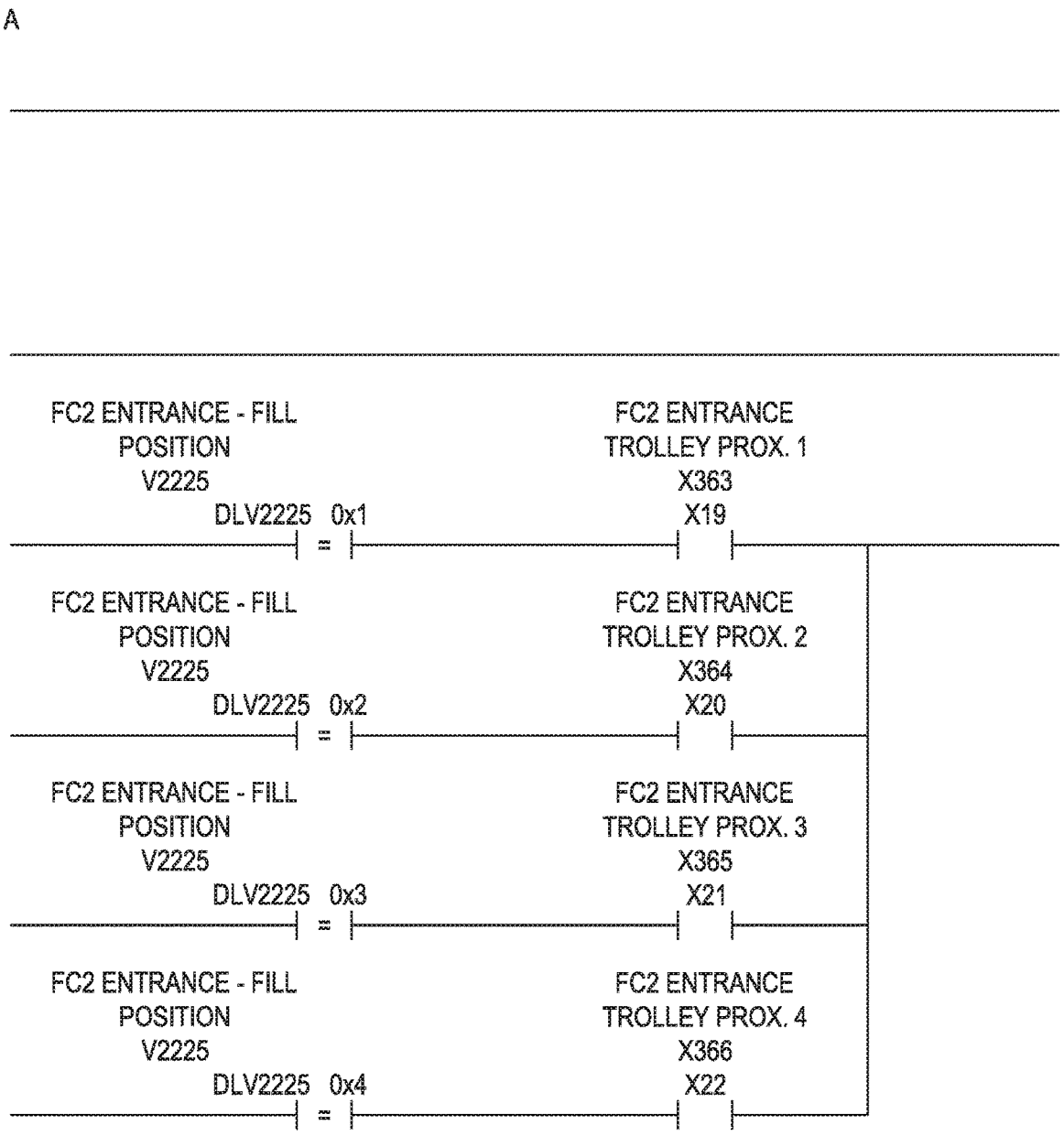
Figure 174:
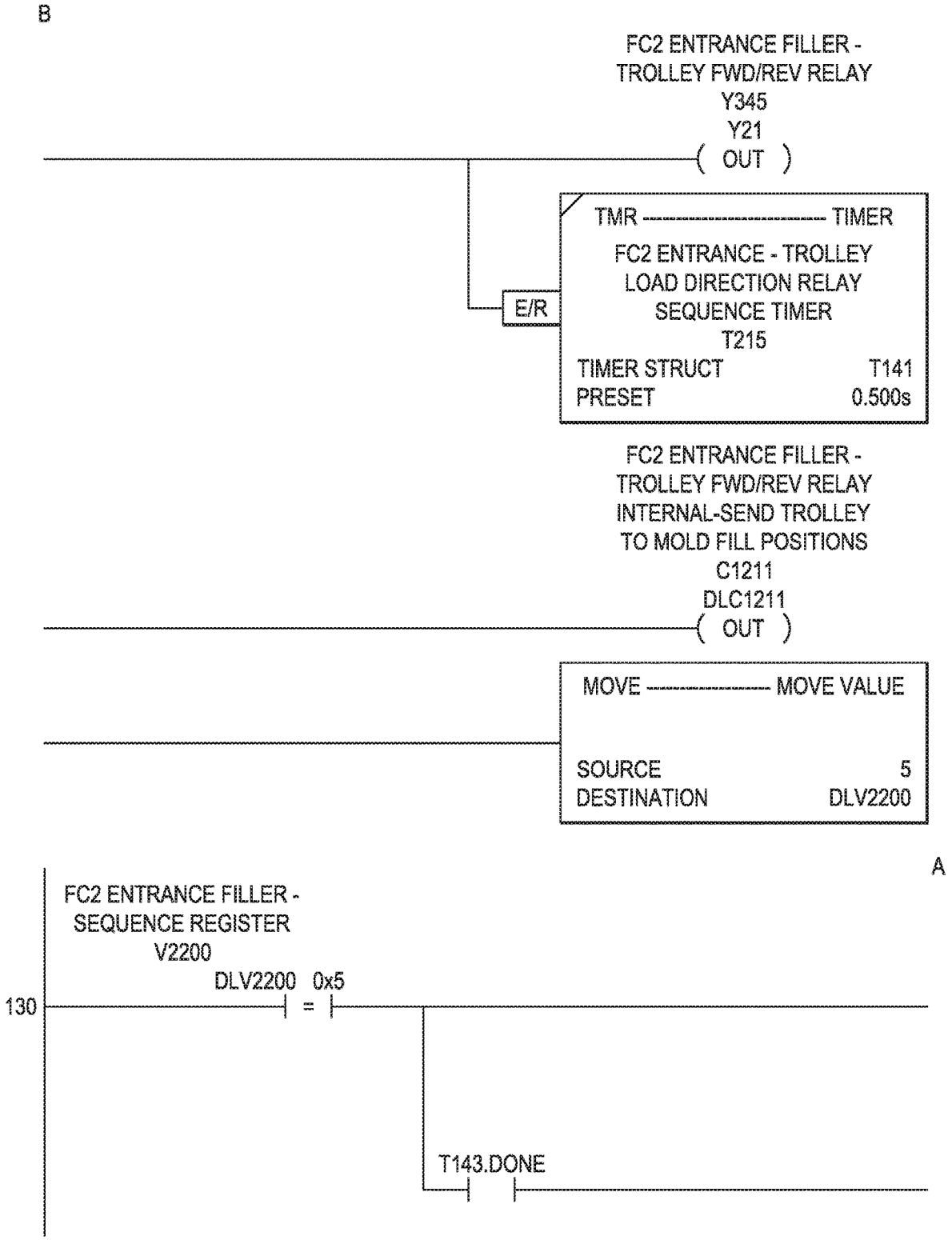
Figure 175:
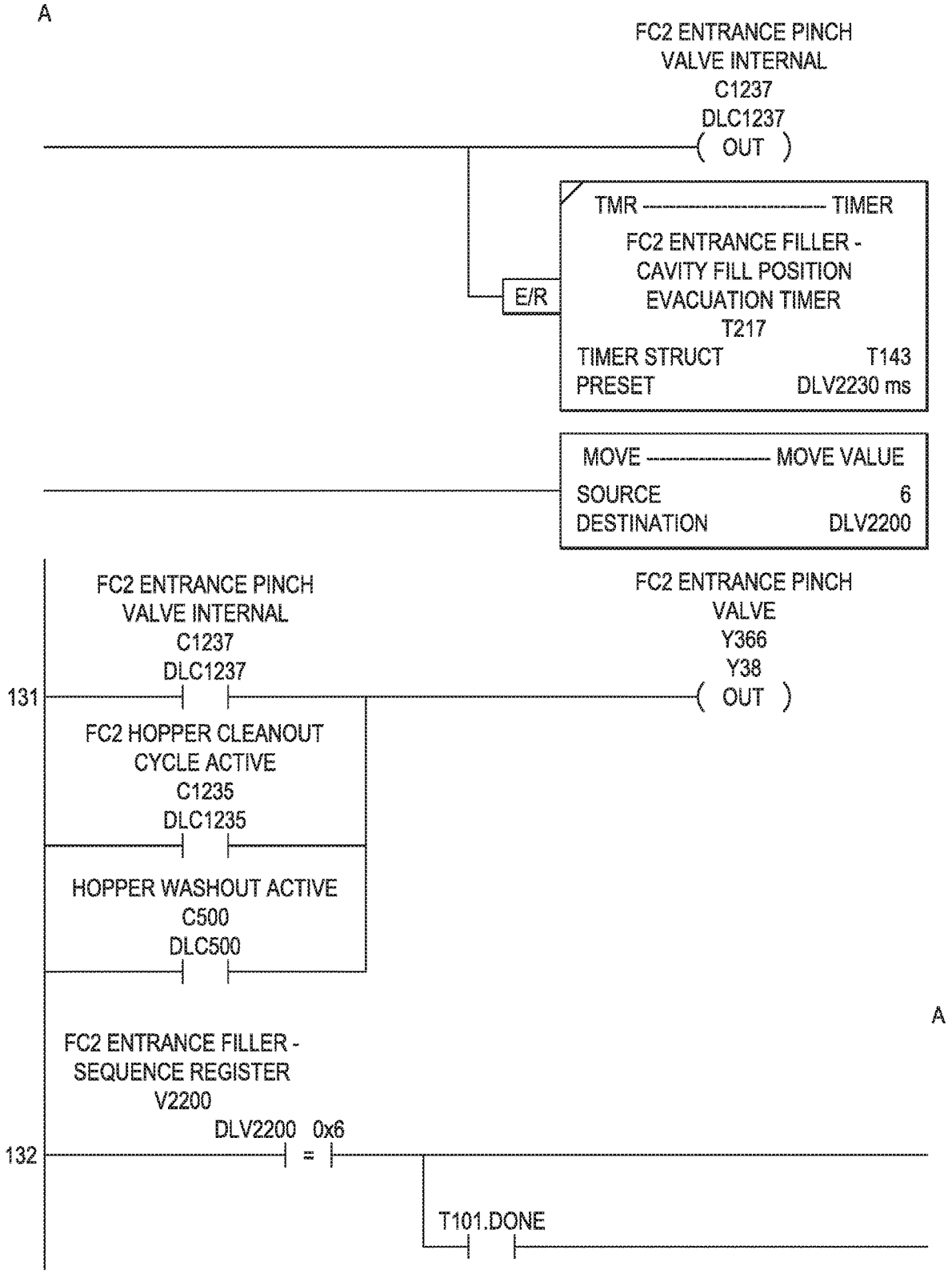
Figure 176:
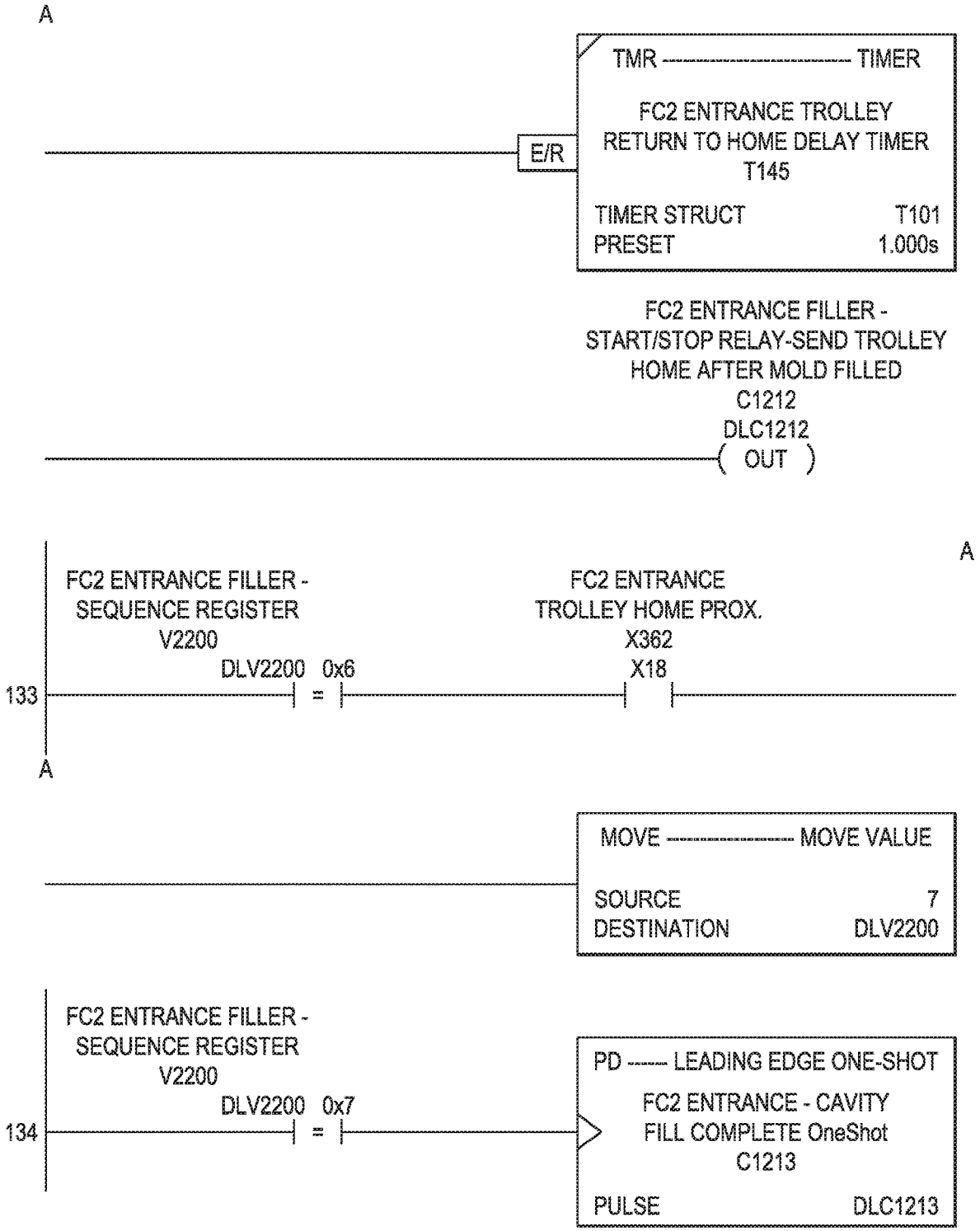
Figure 177:
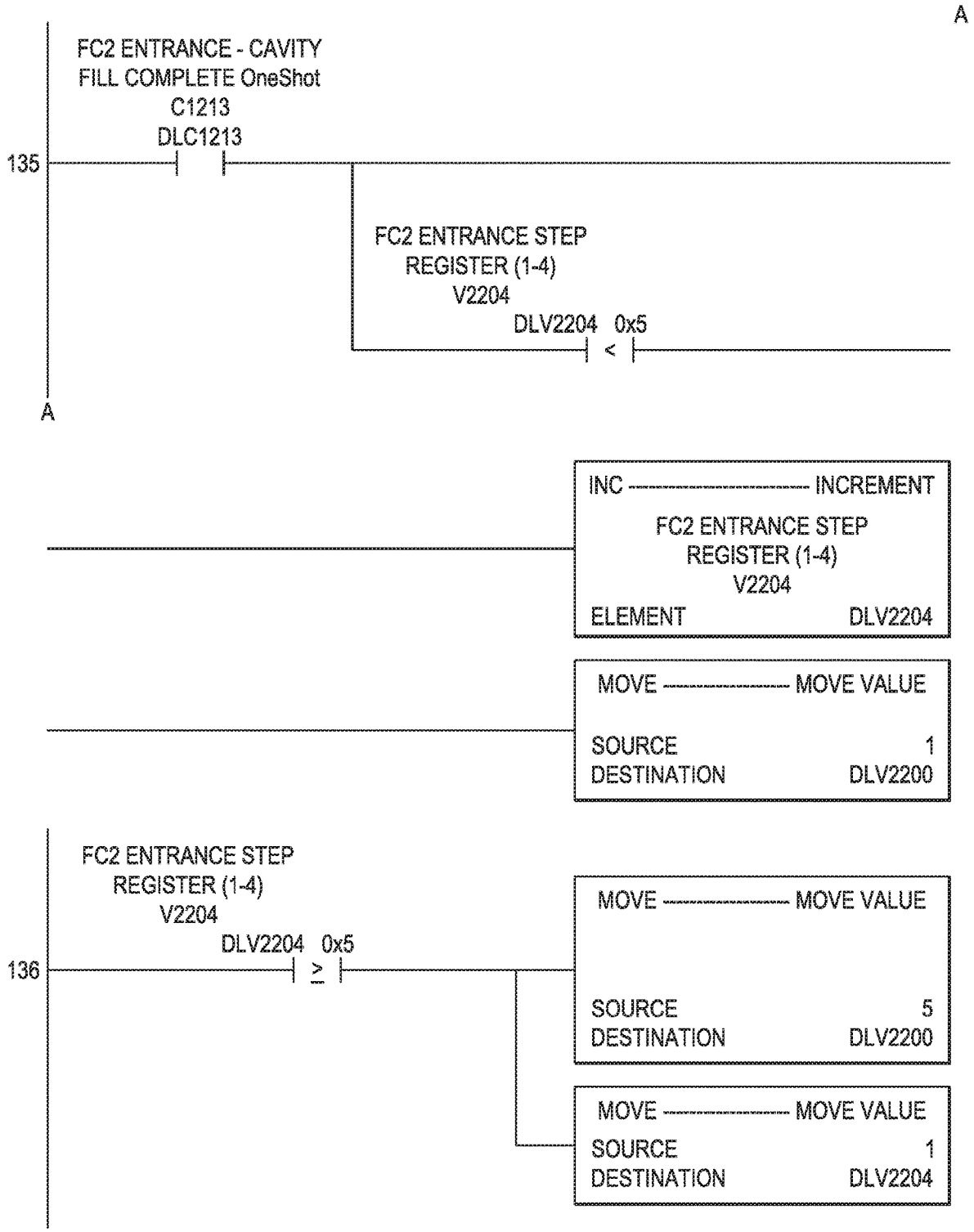
Figure 178:
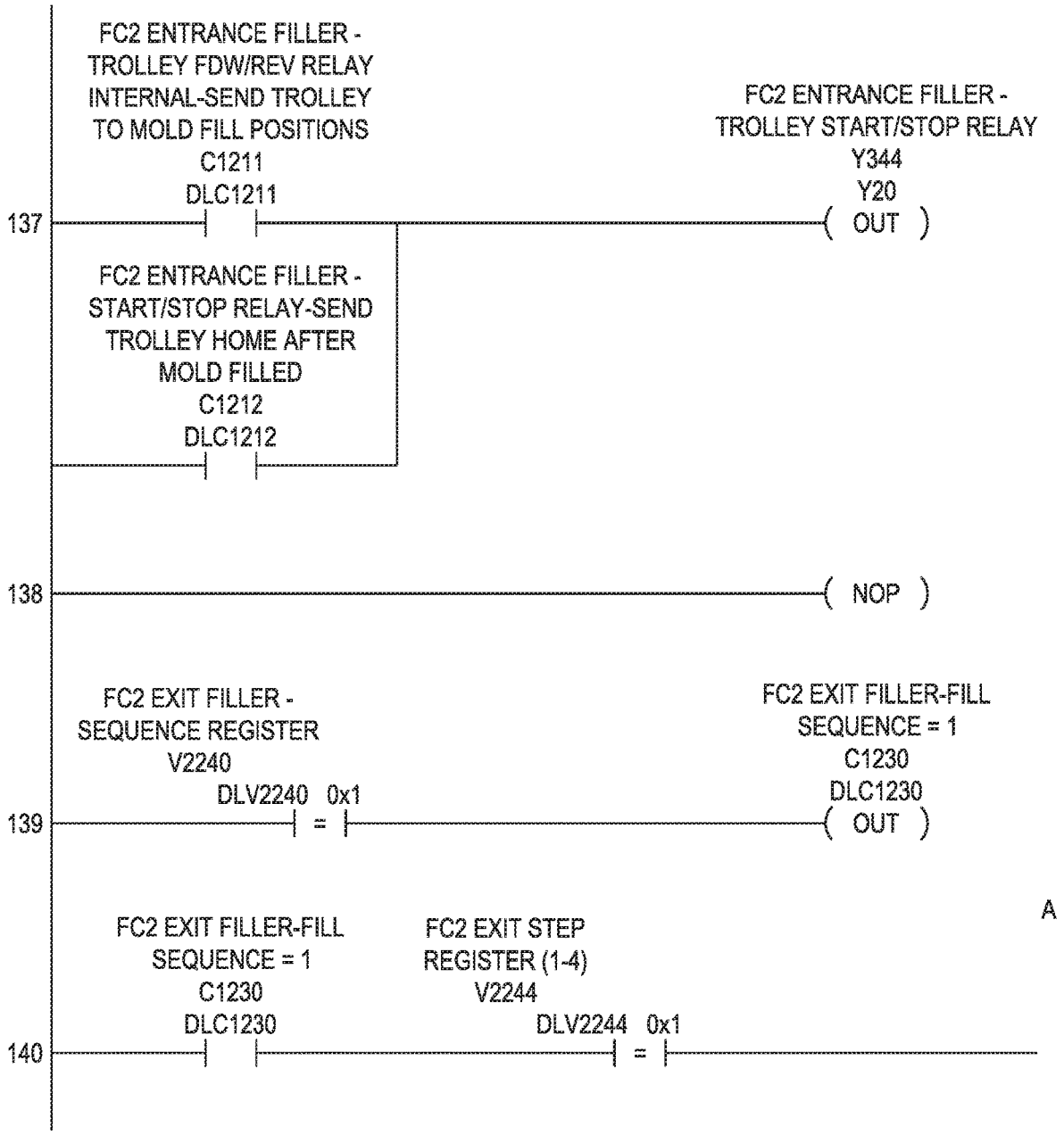
Figure 179:
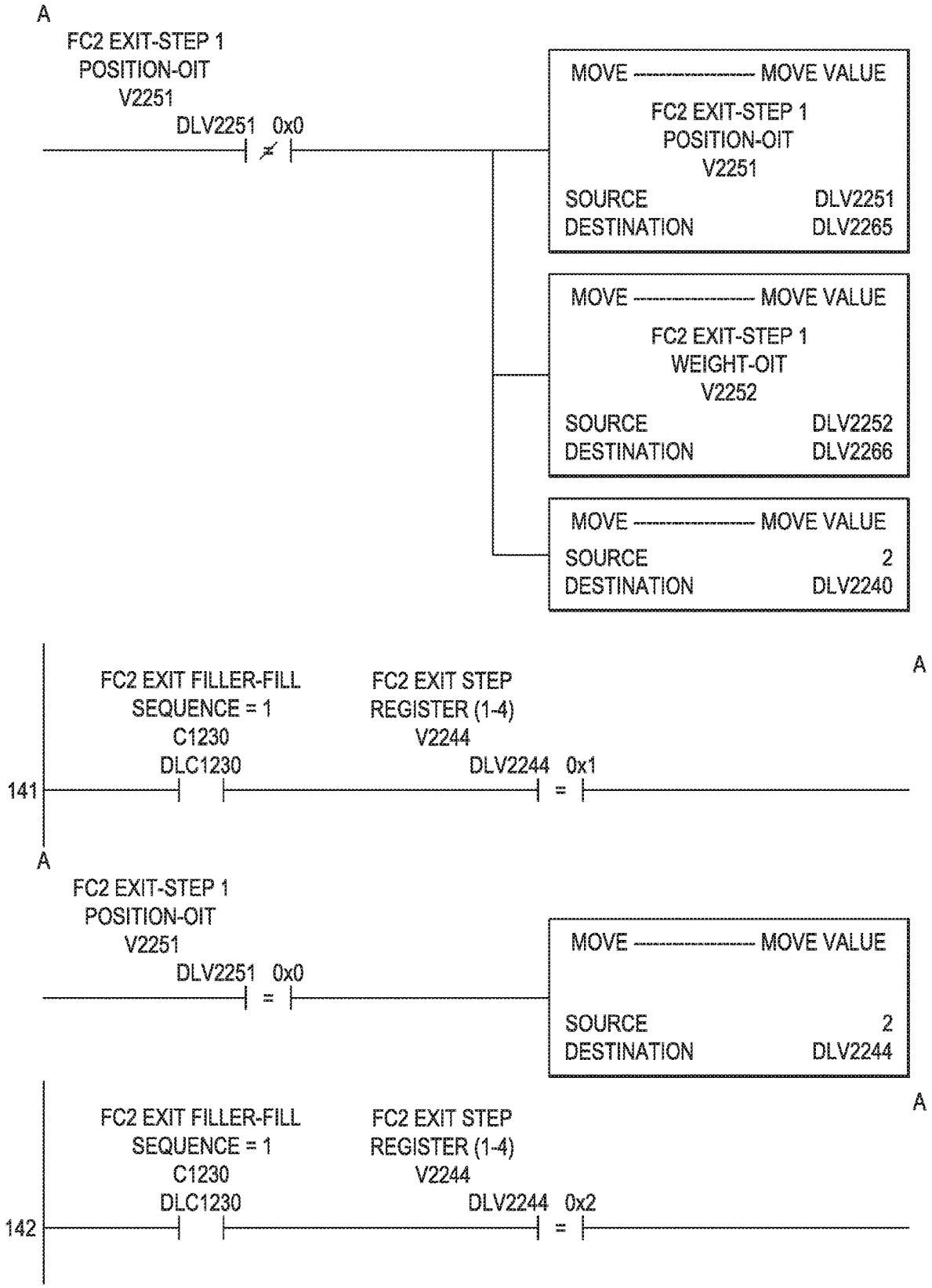
Figure 180:
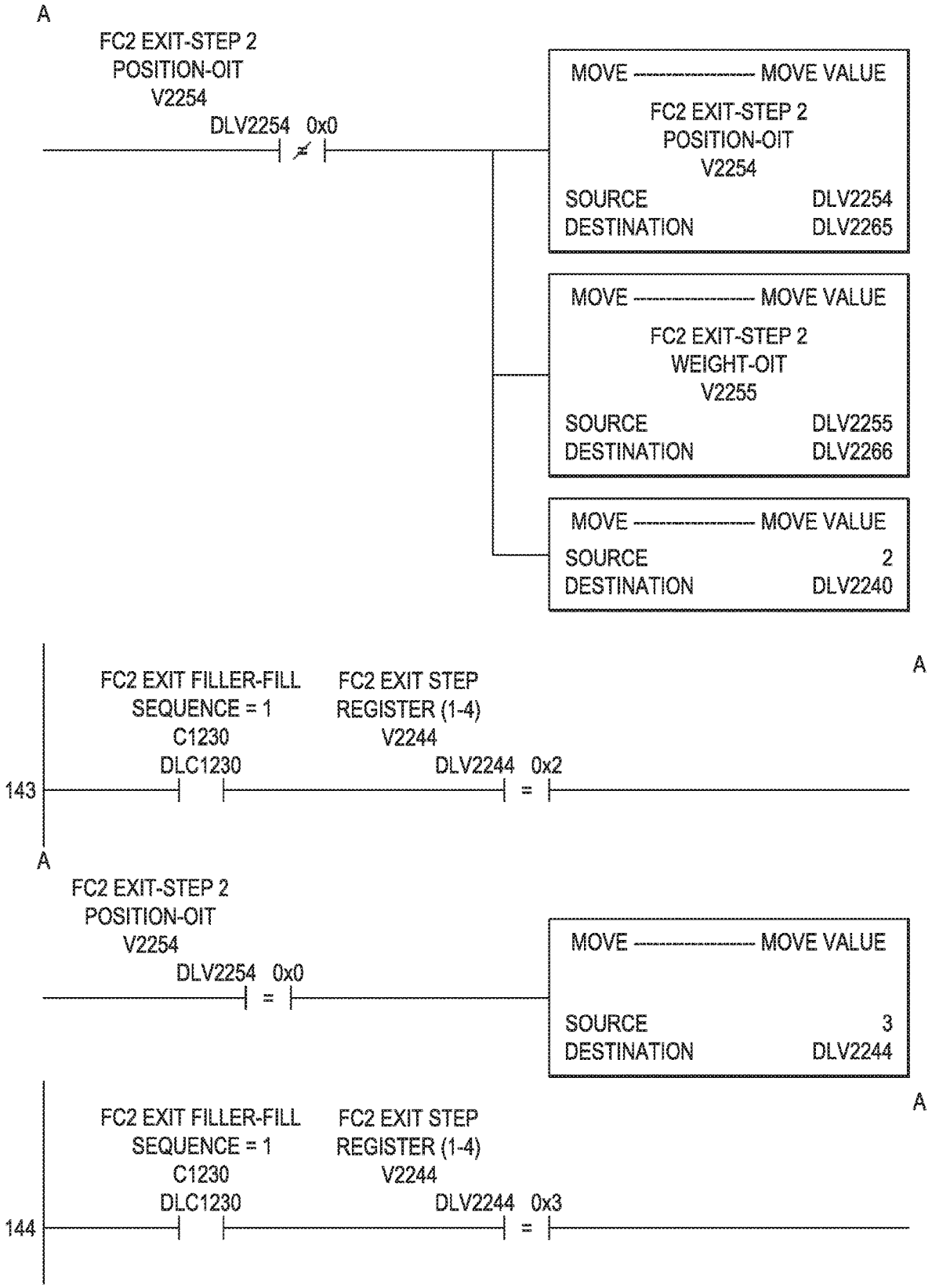
Figure 181:
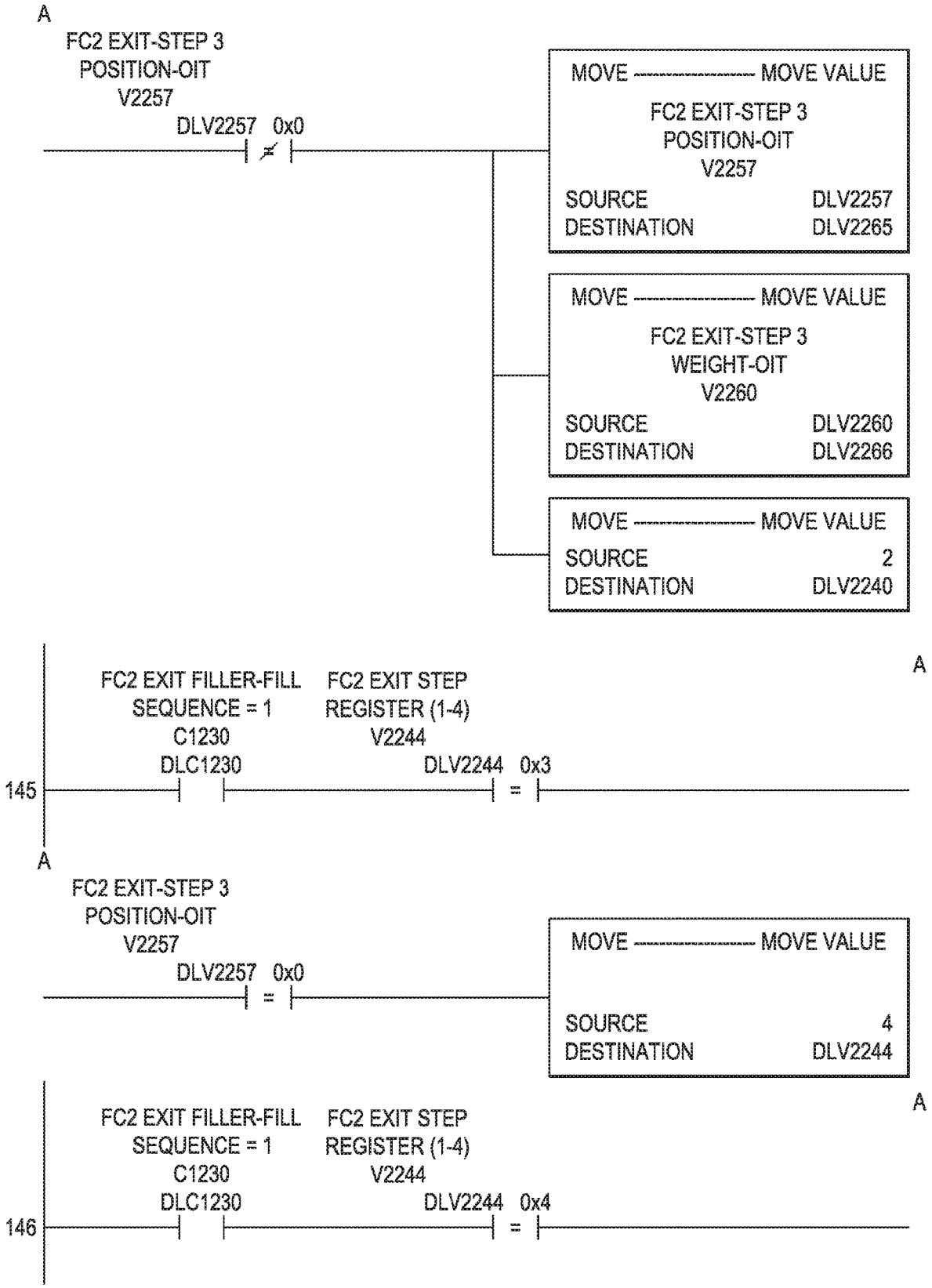
Figure 182:
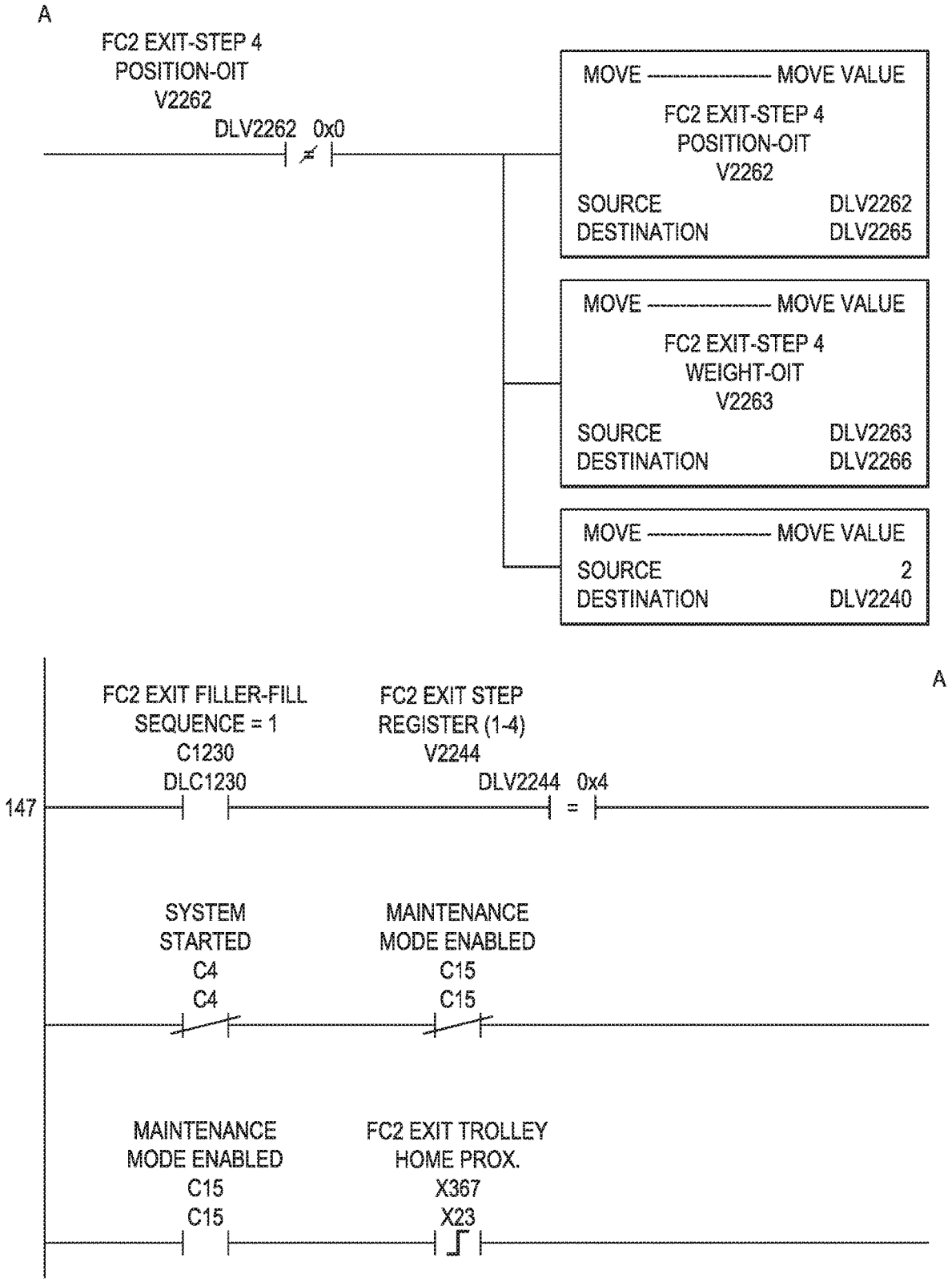
Figure 183:
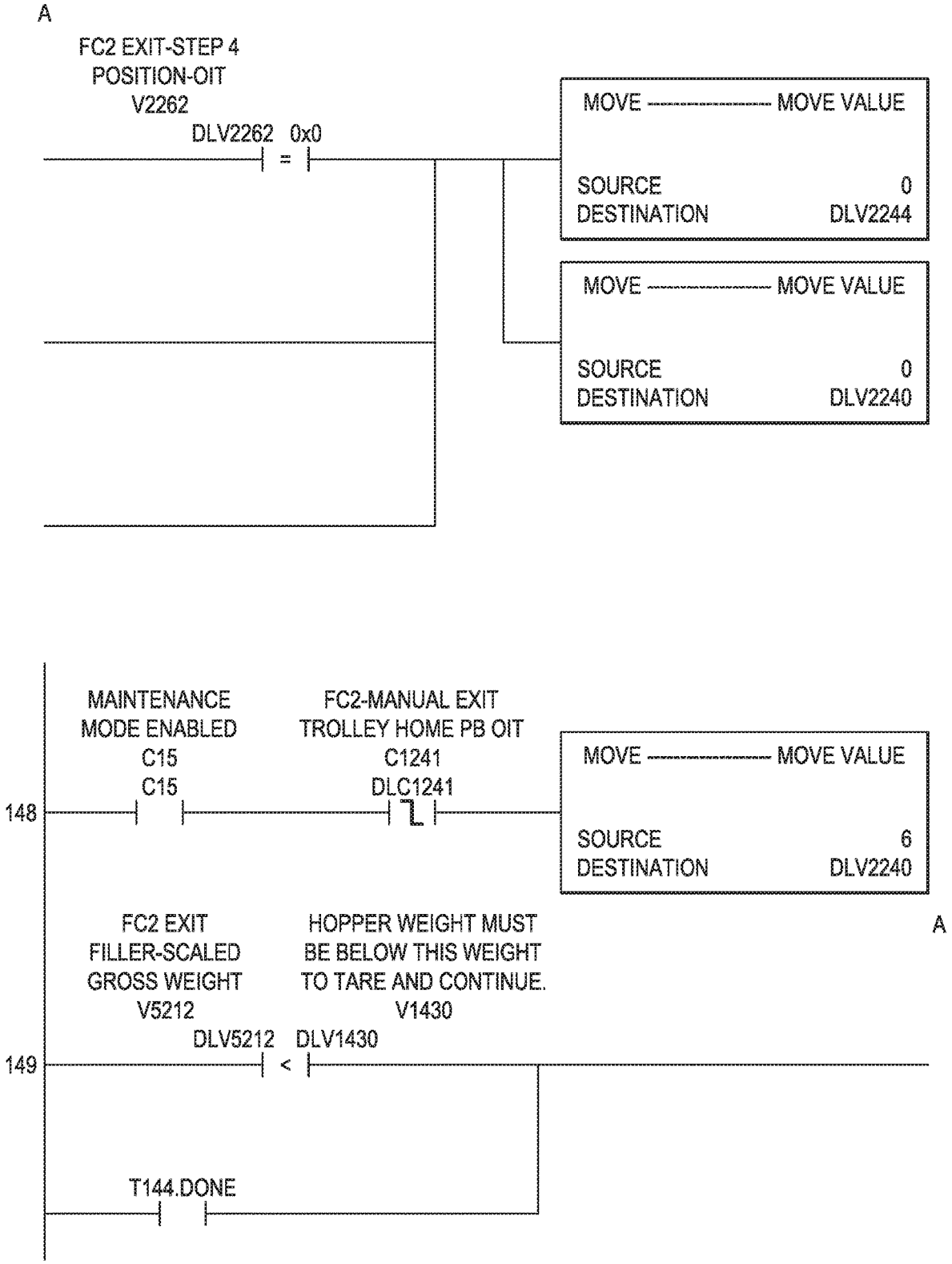
Figure 184:
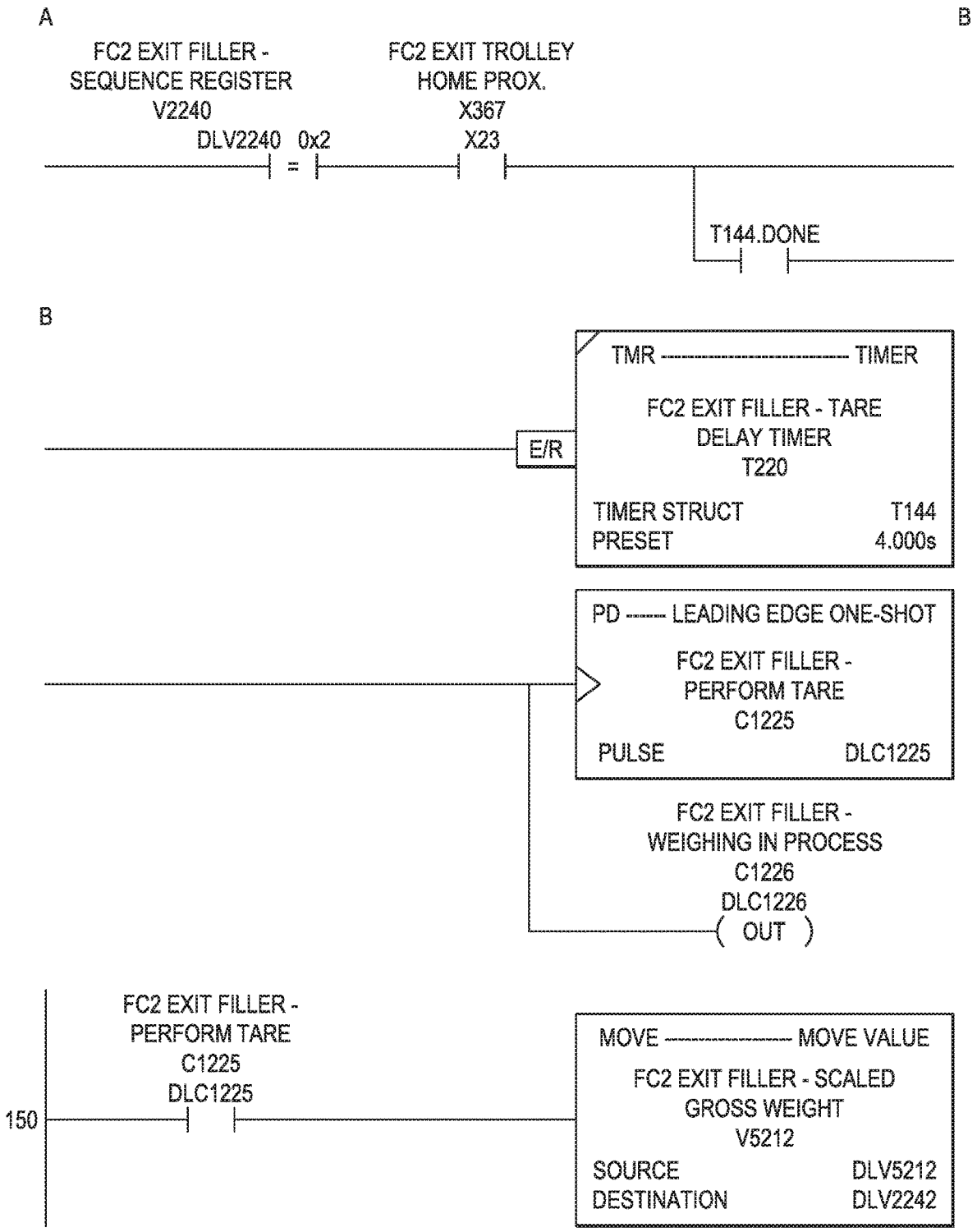
Figure 185:
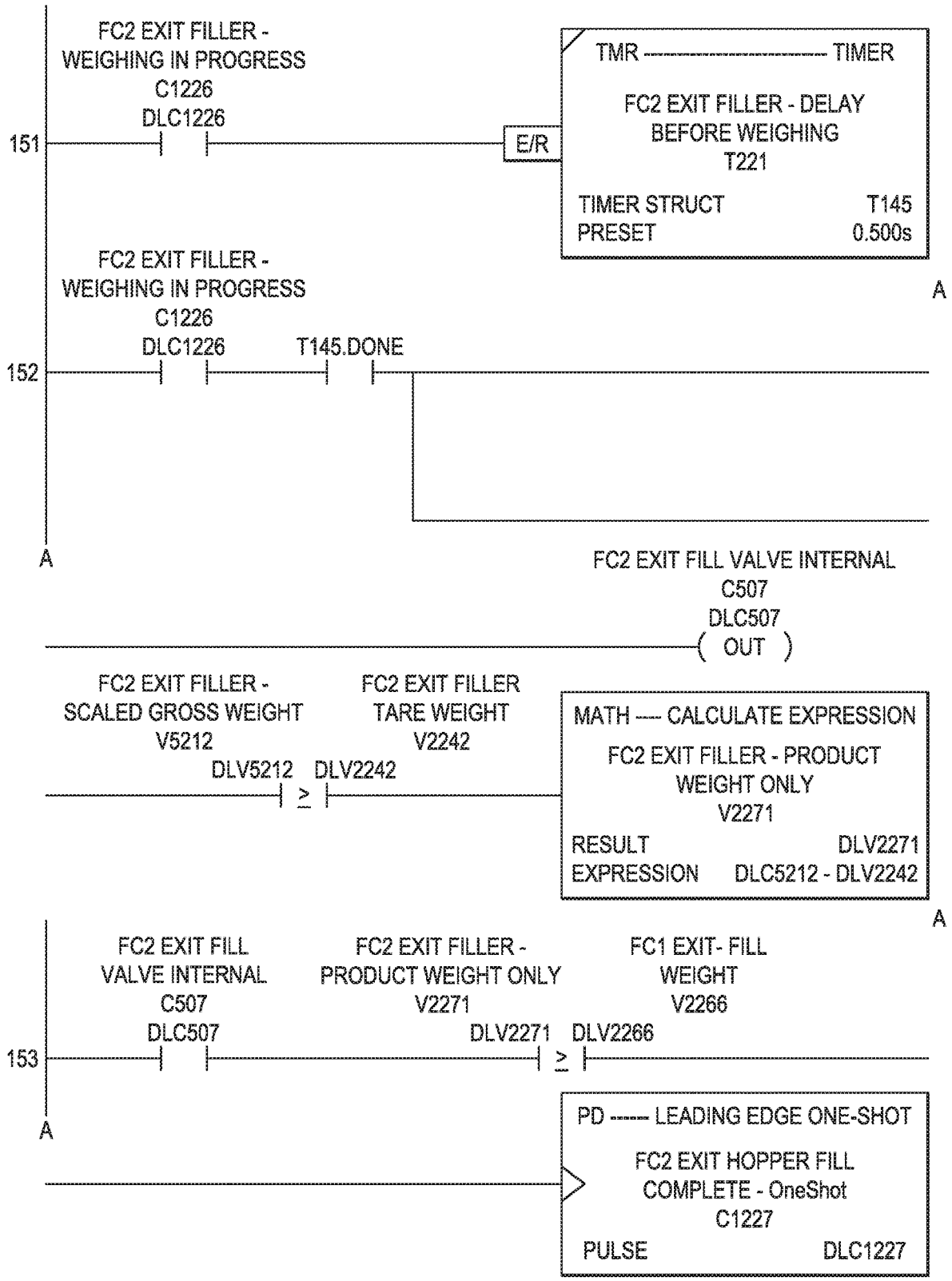
Figure 186:
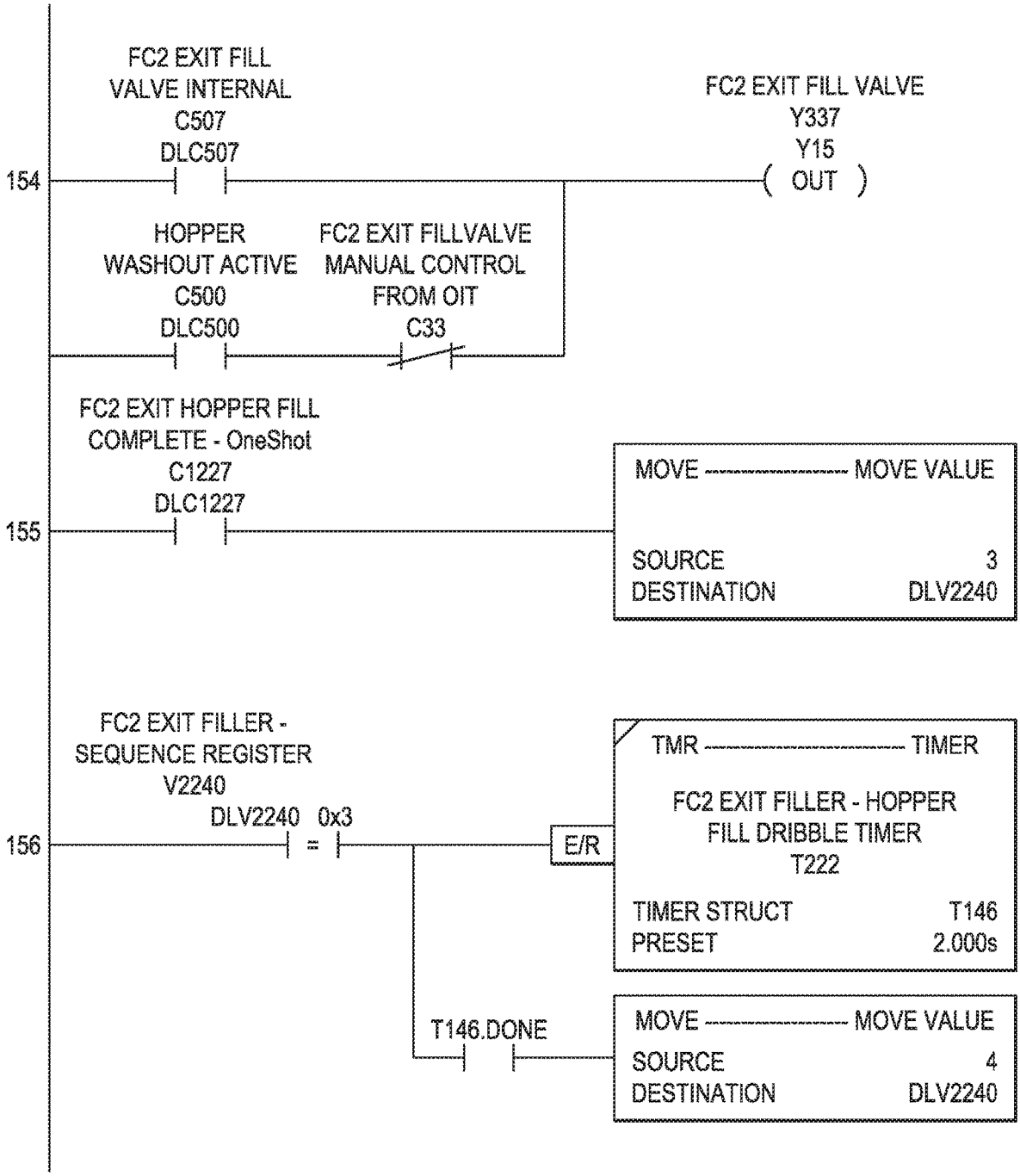
Figure 187:
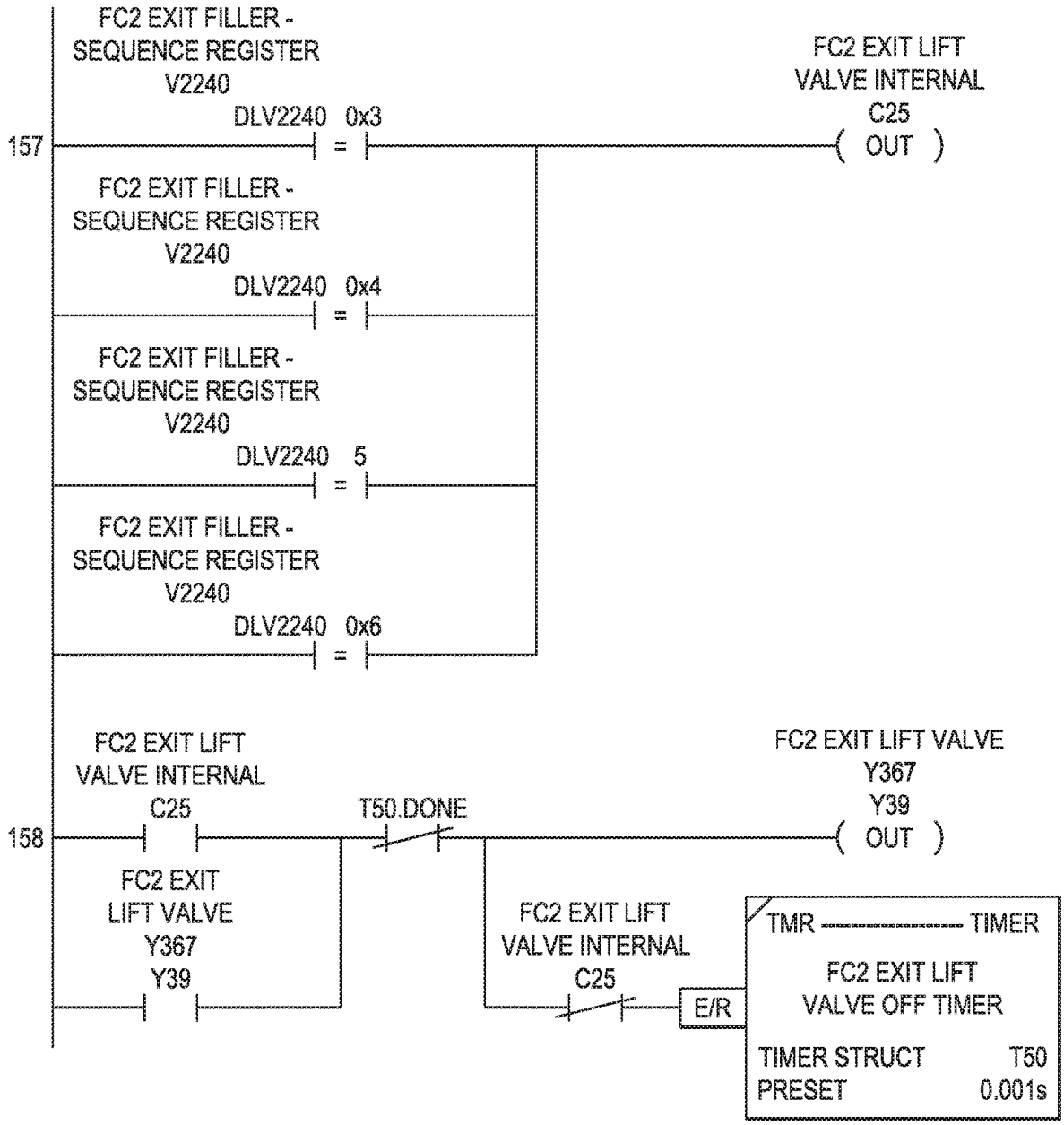
Figure 188:
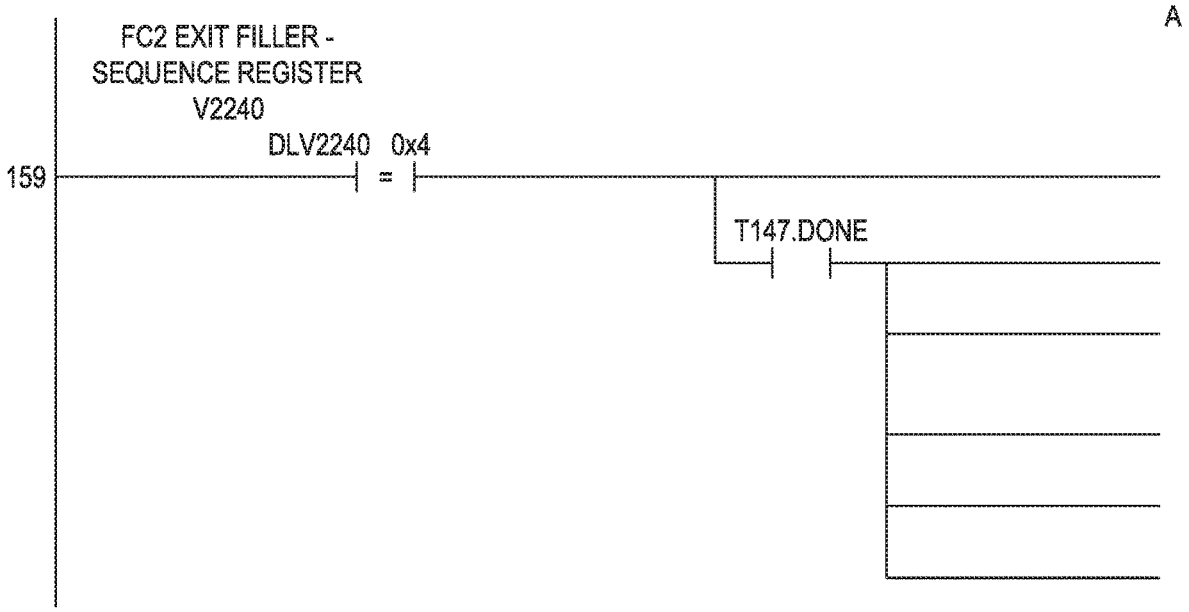
Figure 189:
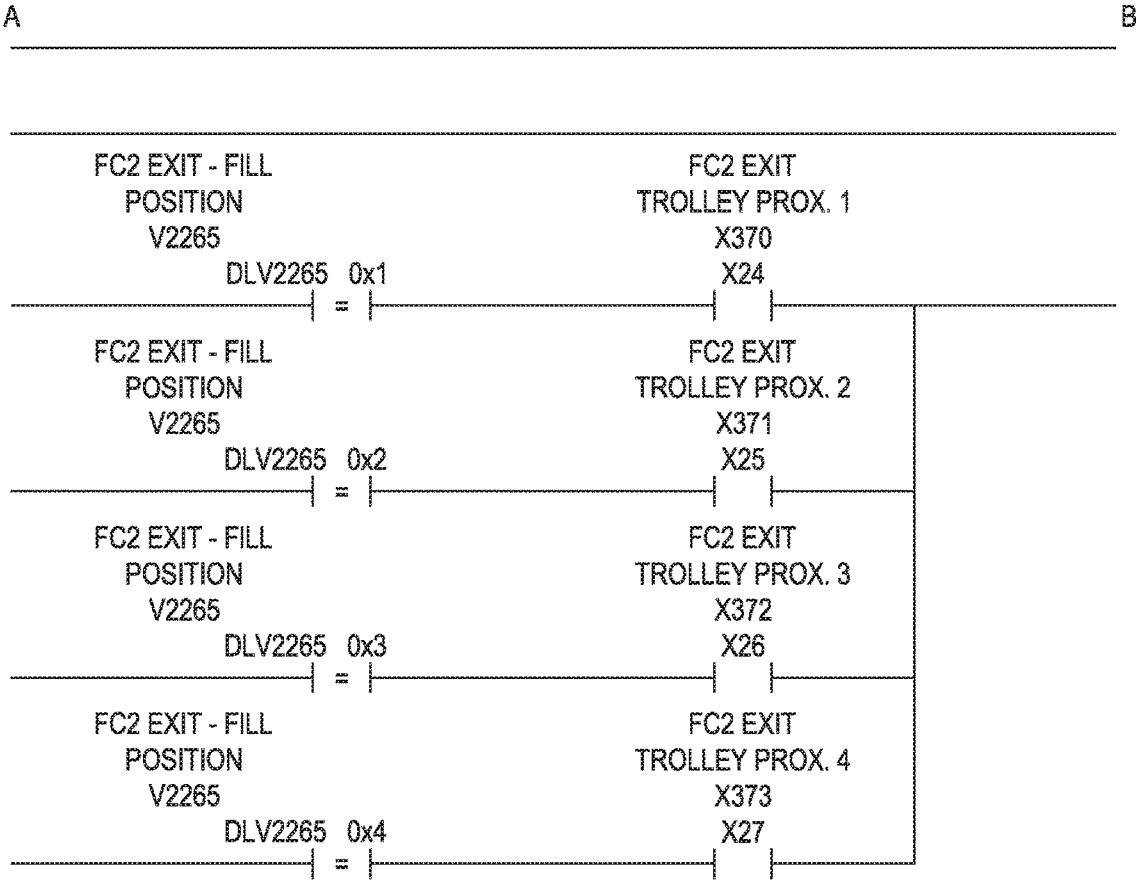
Figure 190:
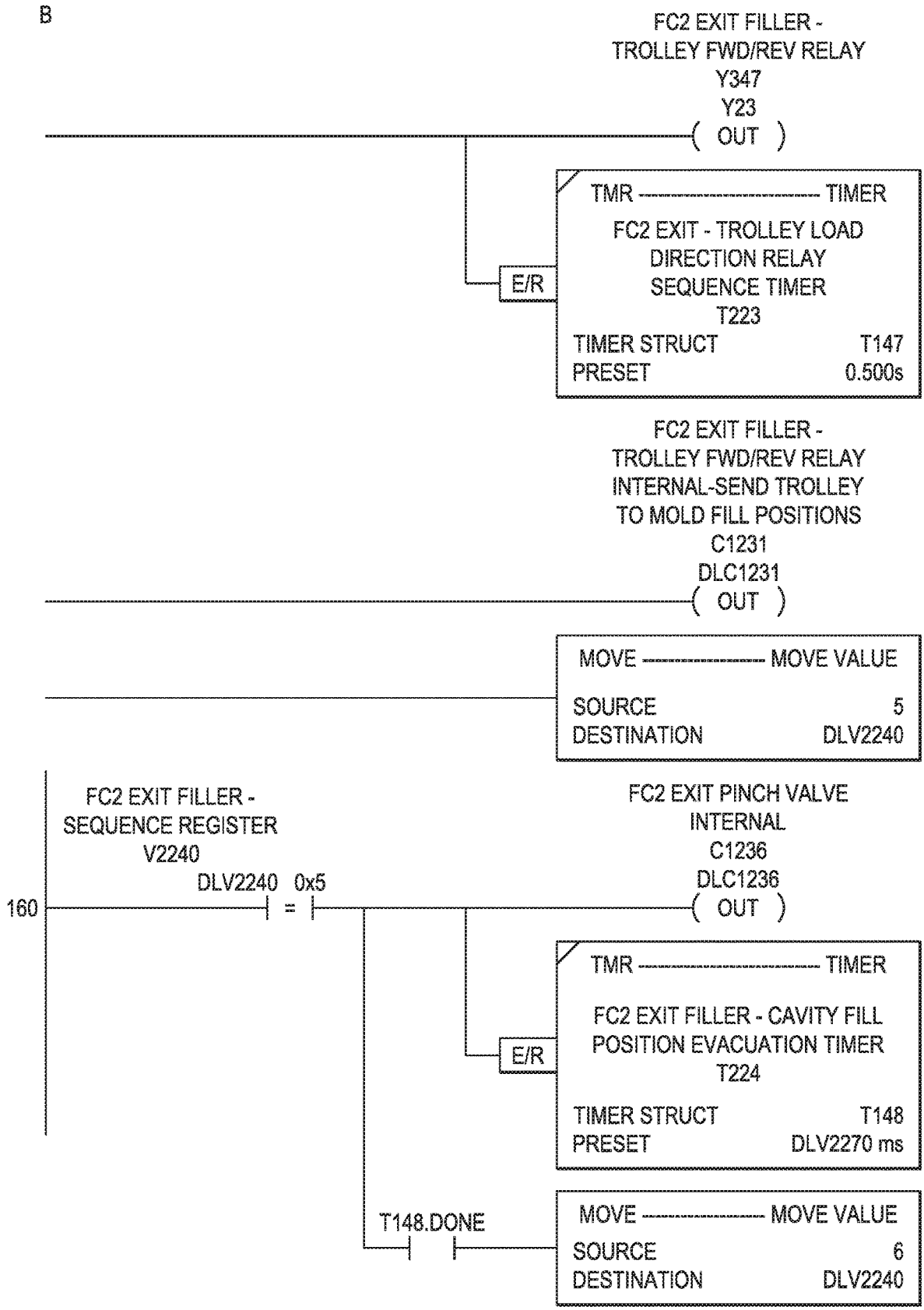
Figure 191:
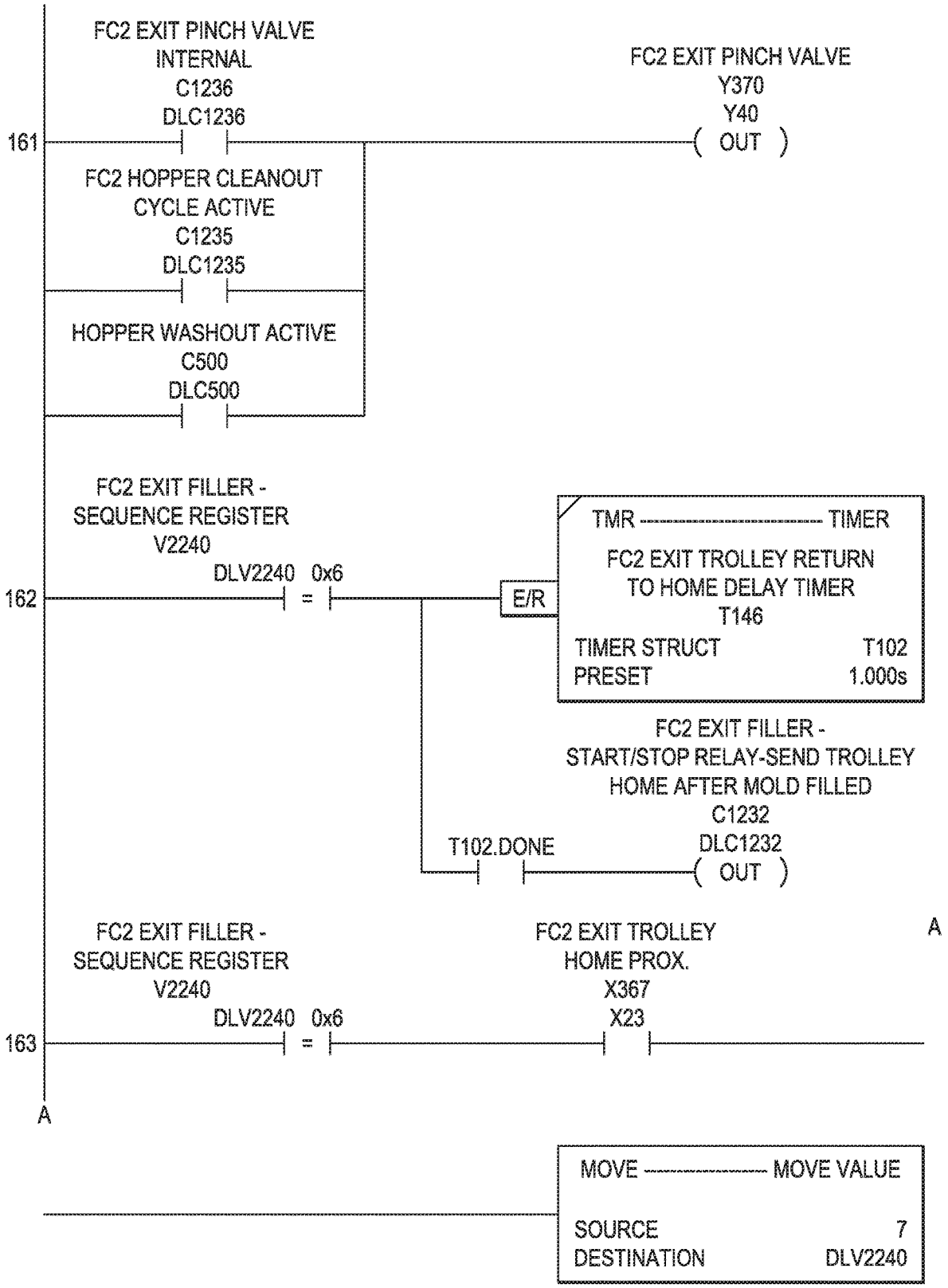
Figure 192:
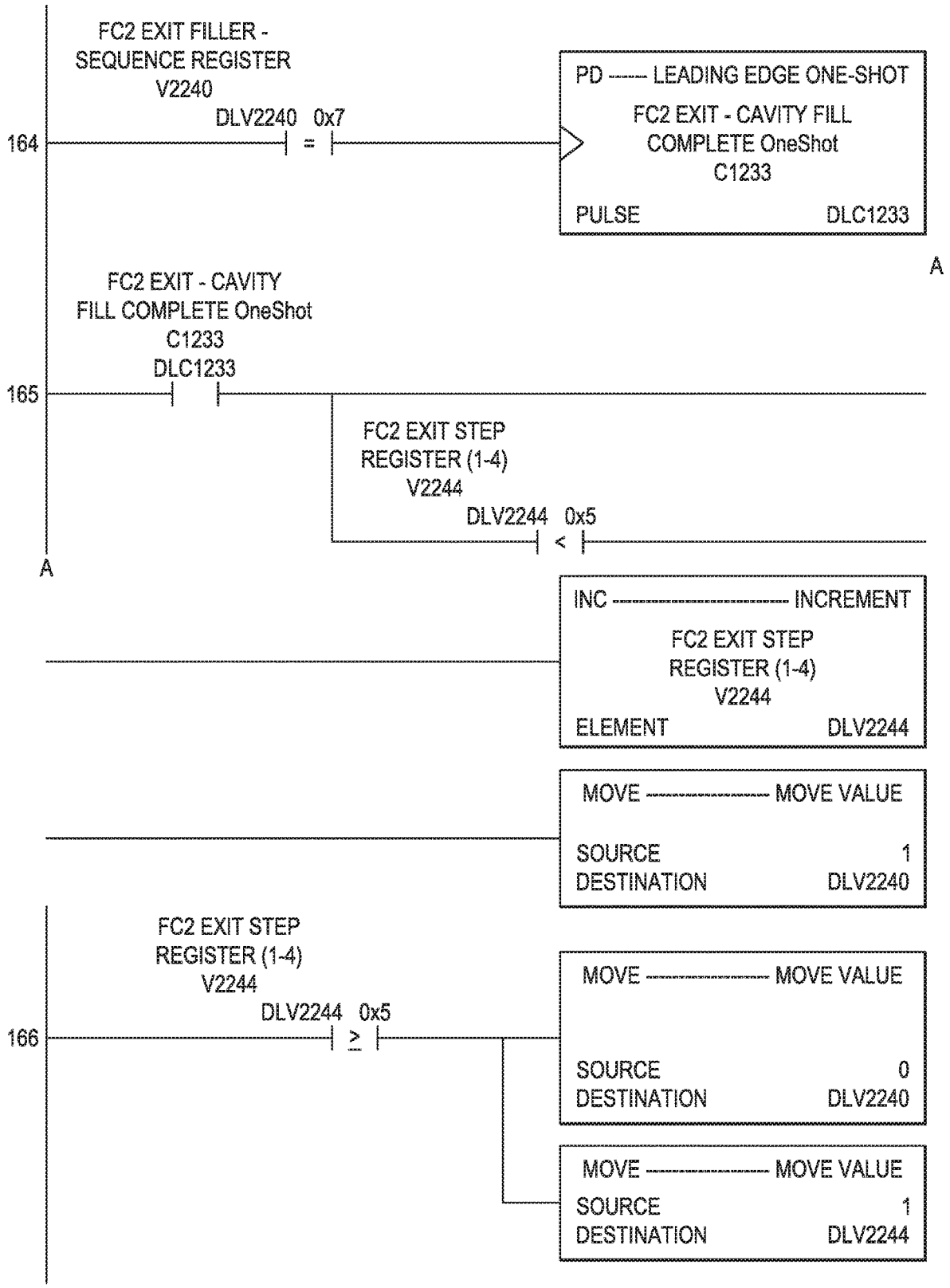
Figure 193:
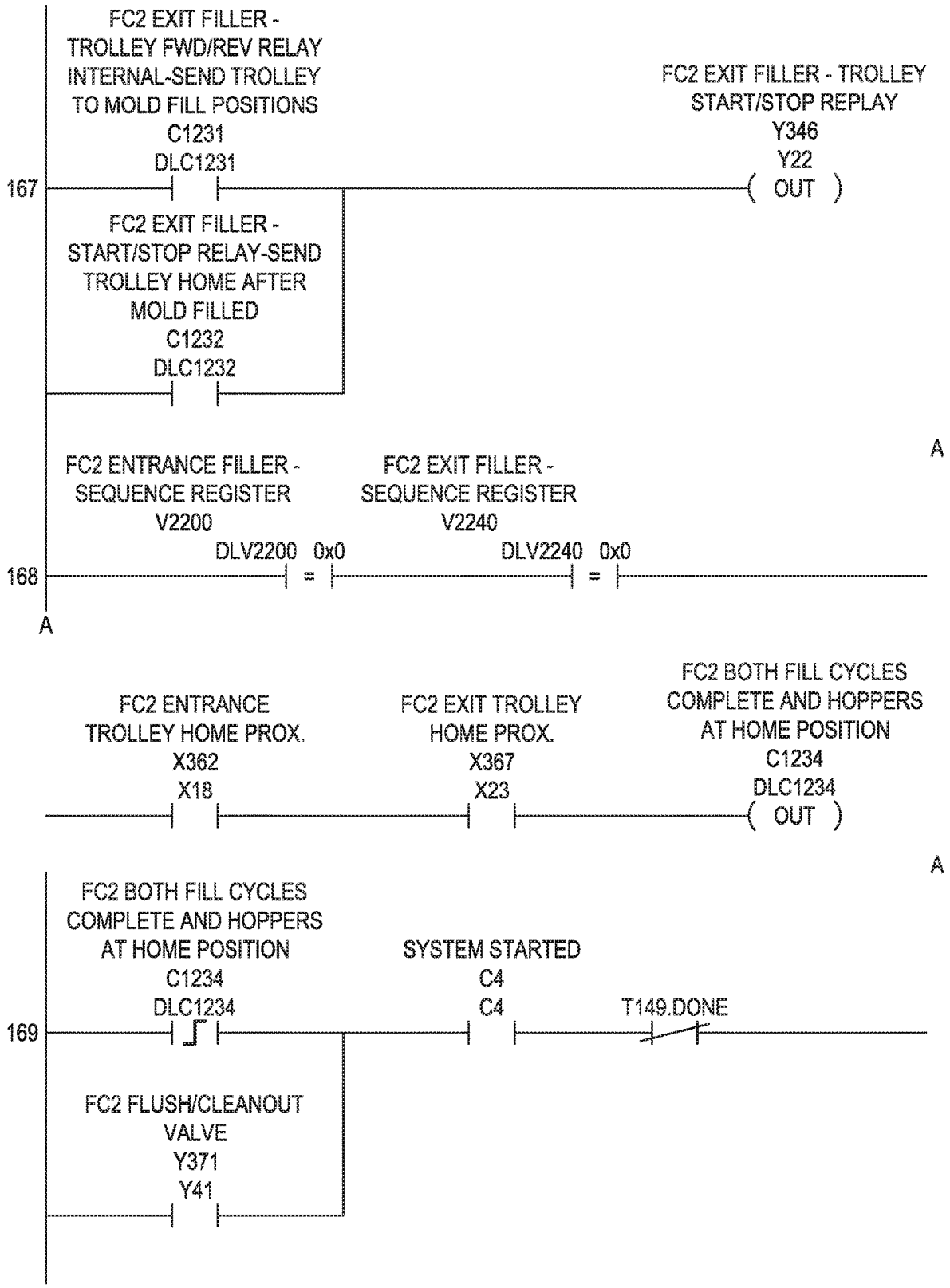
Figure 194:
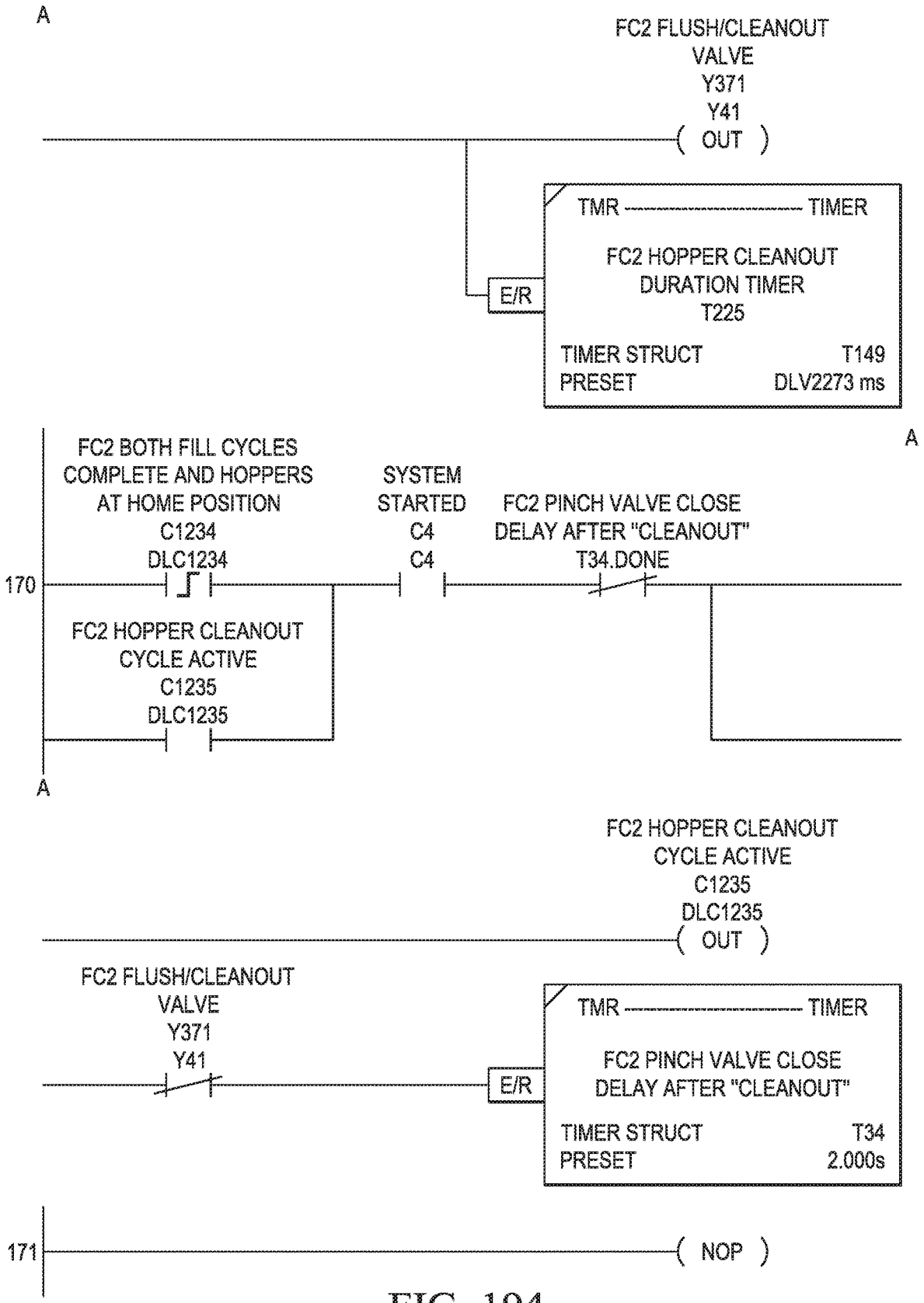
Figure 195:
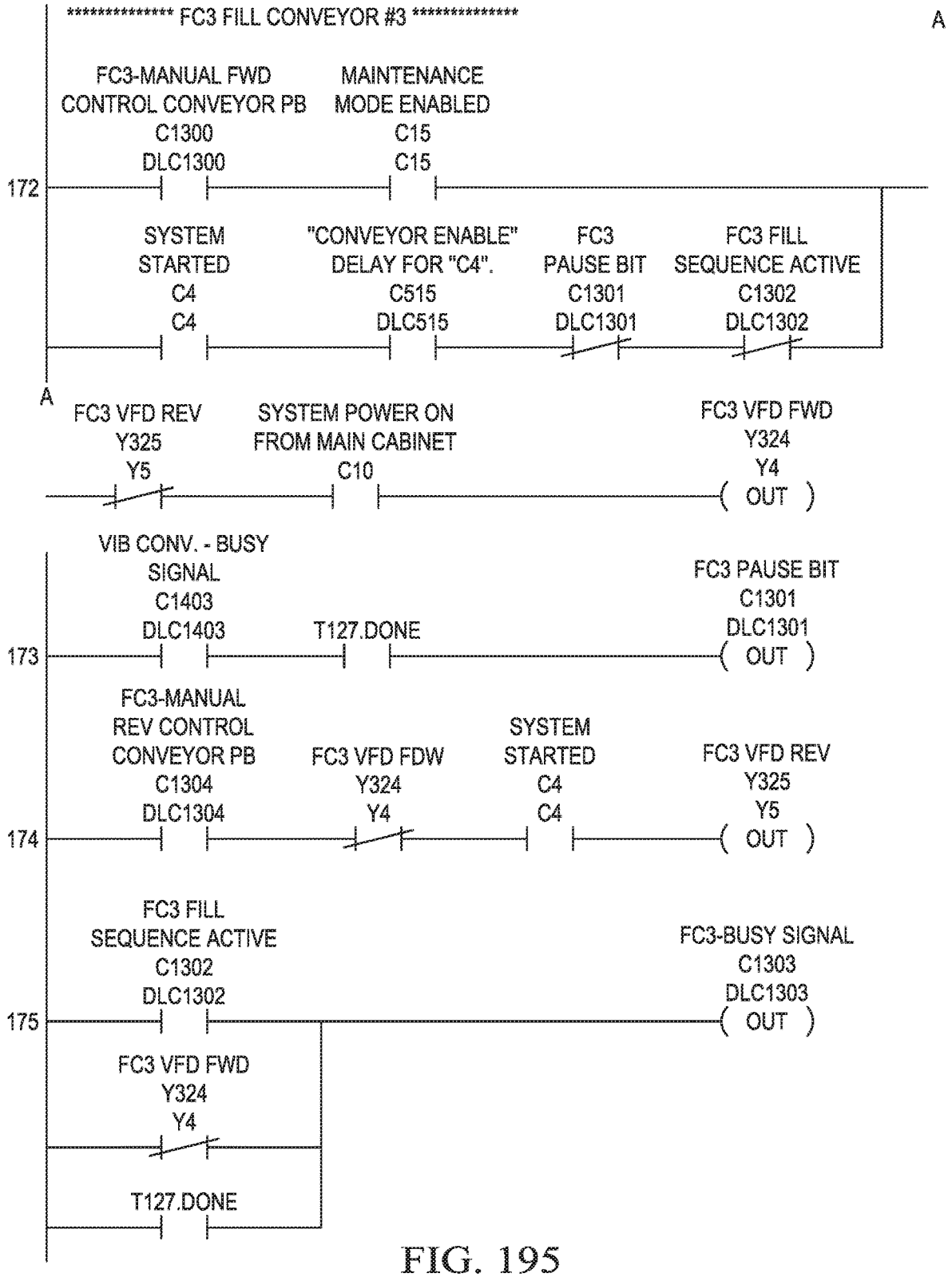
Figure 196:
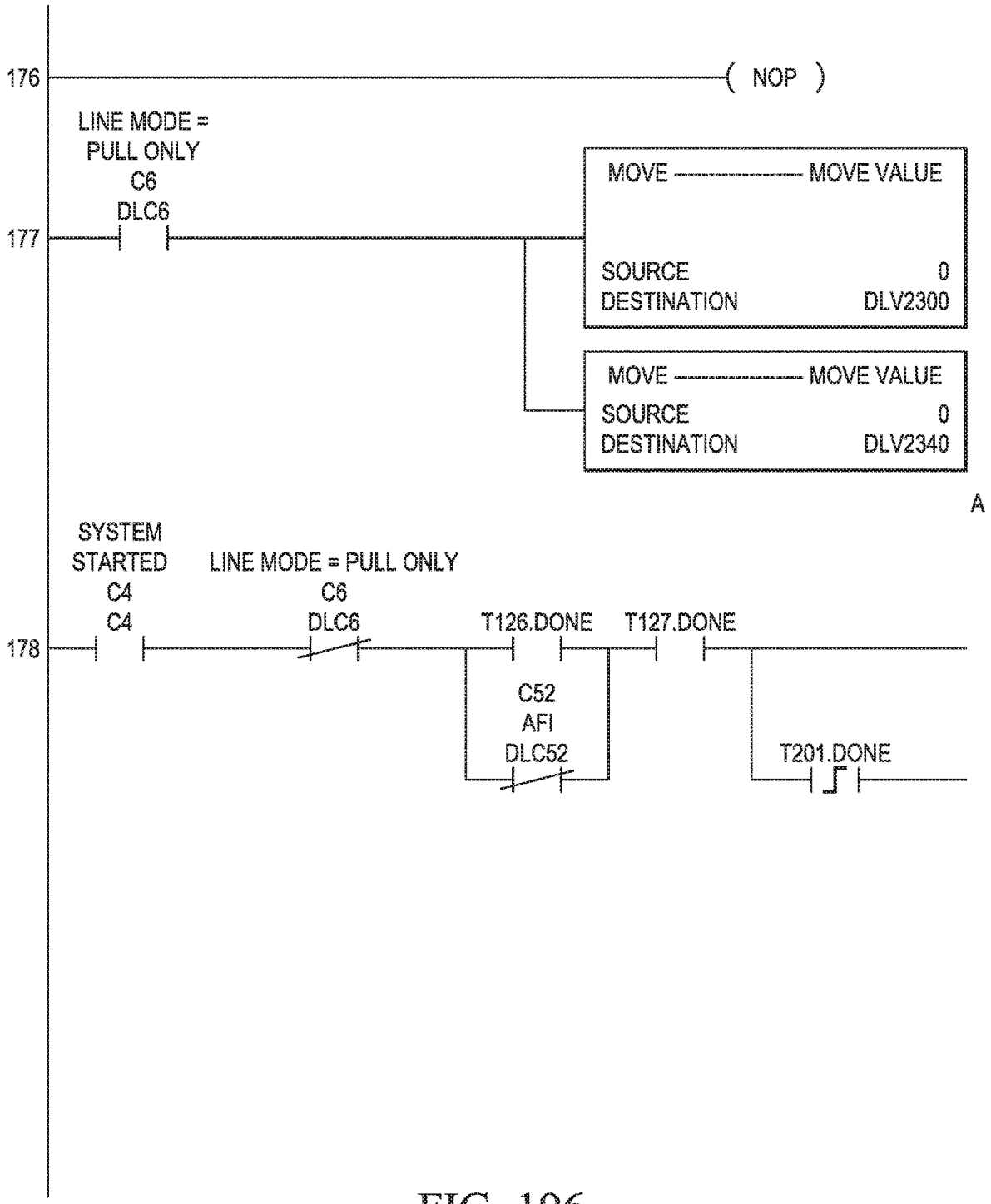
Figure 197:
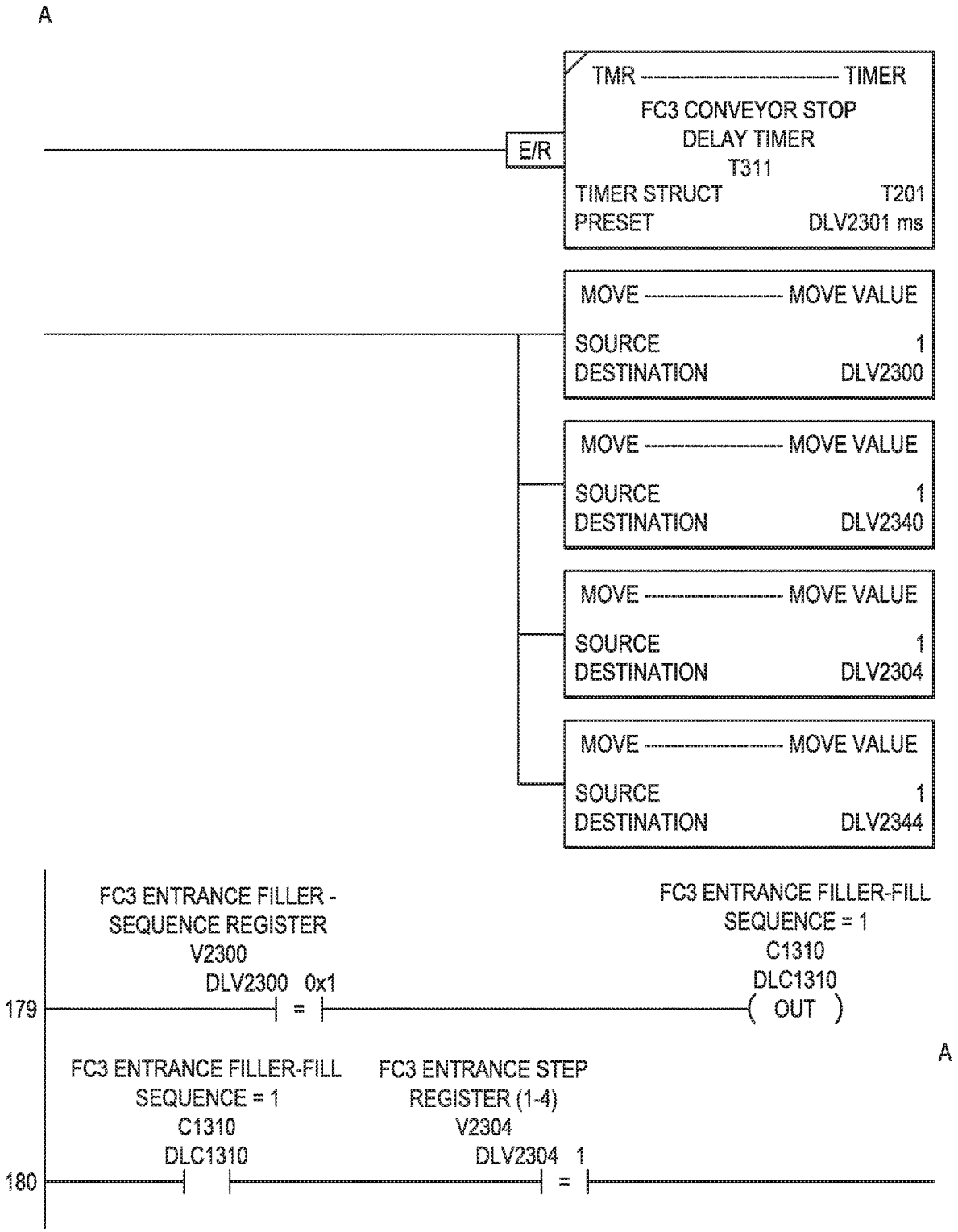
Figure 198:
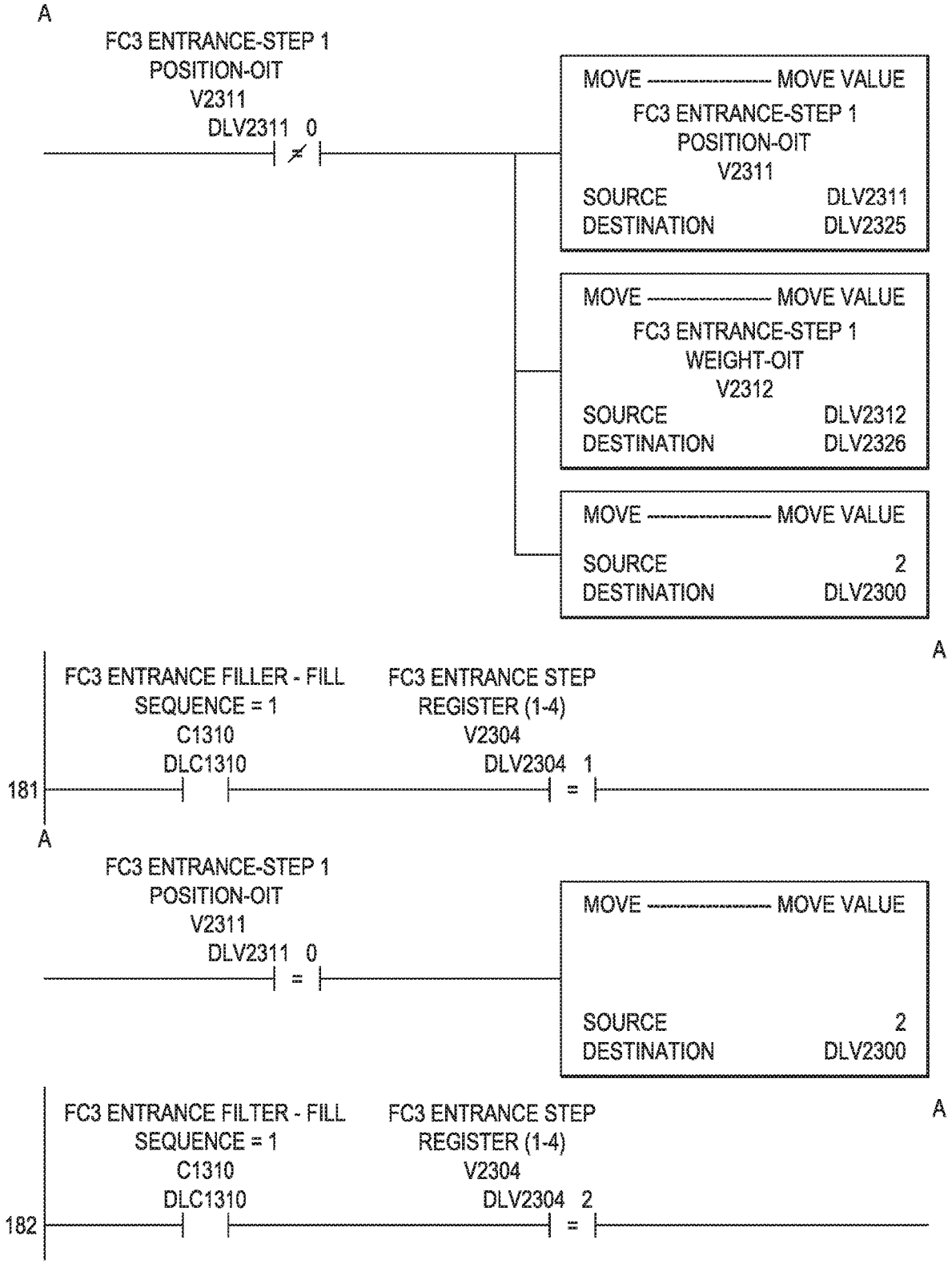
Figure 199:
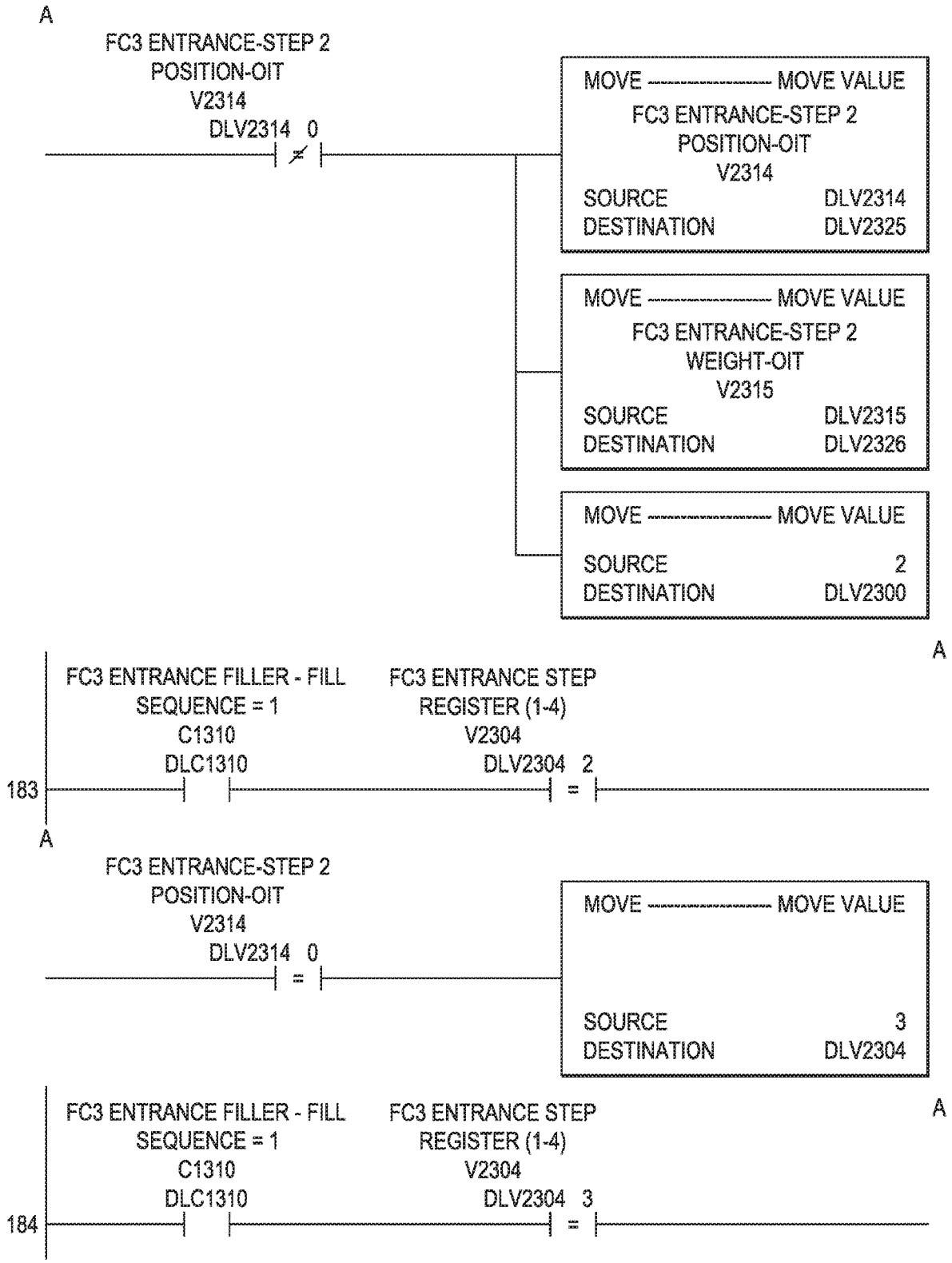
Figure 200:
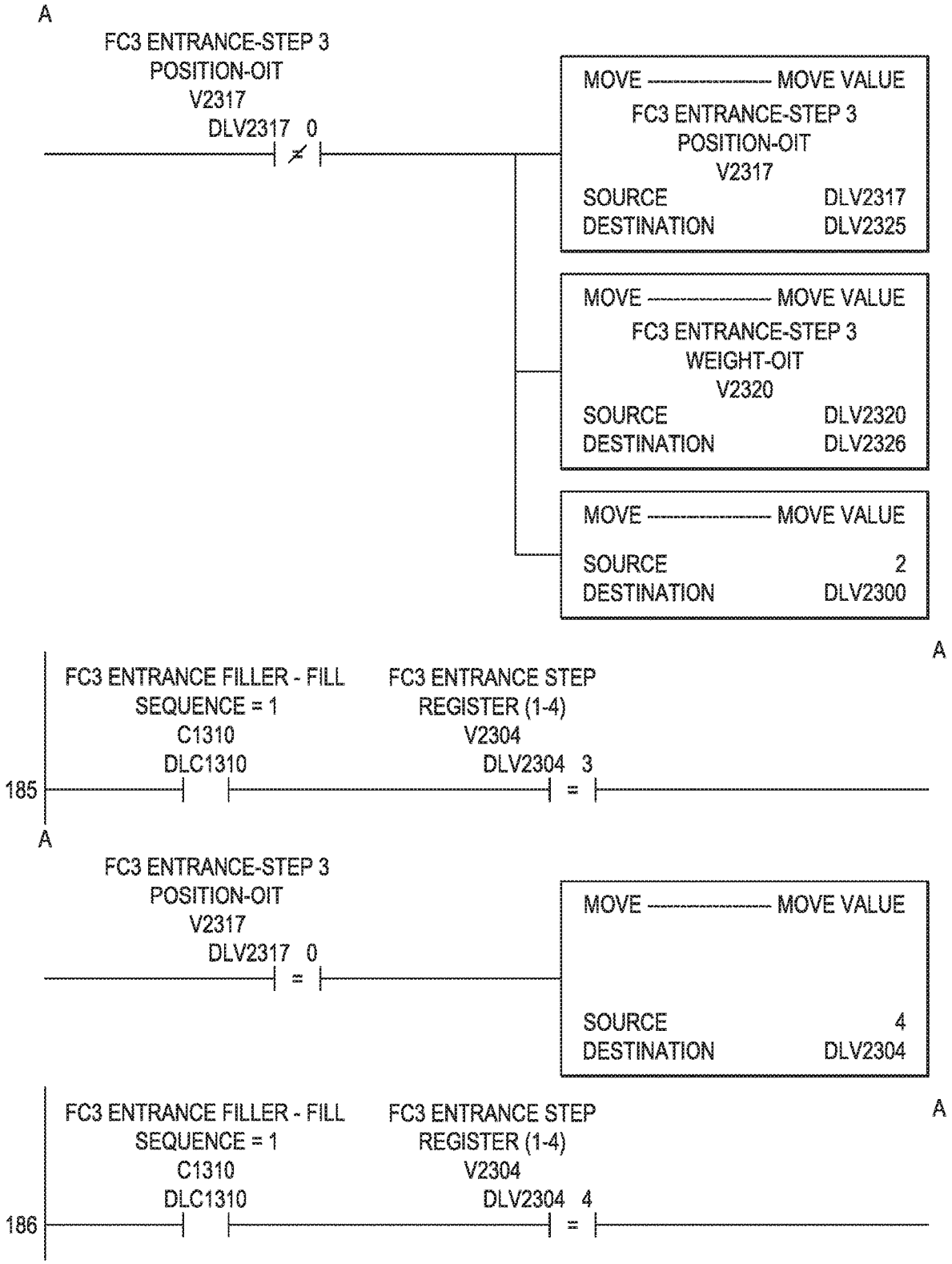
Figure 201:
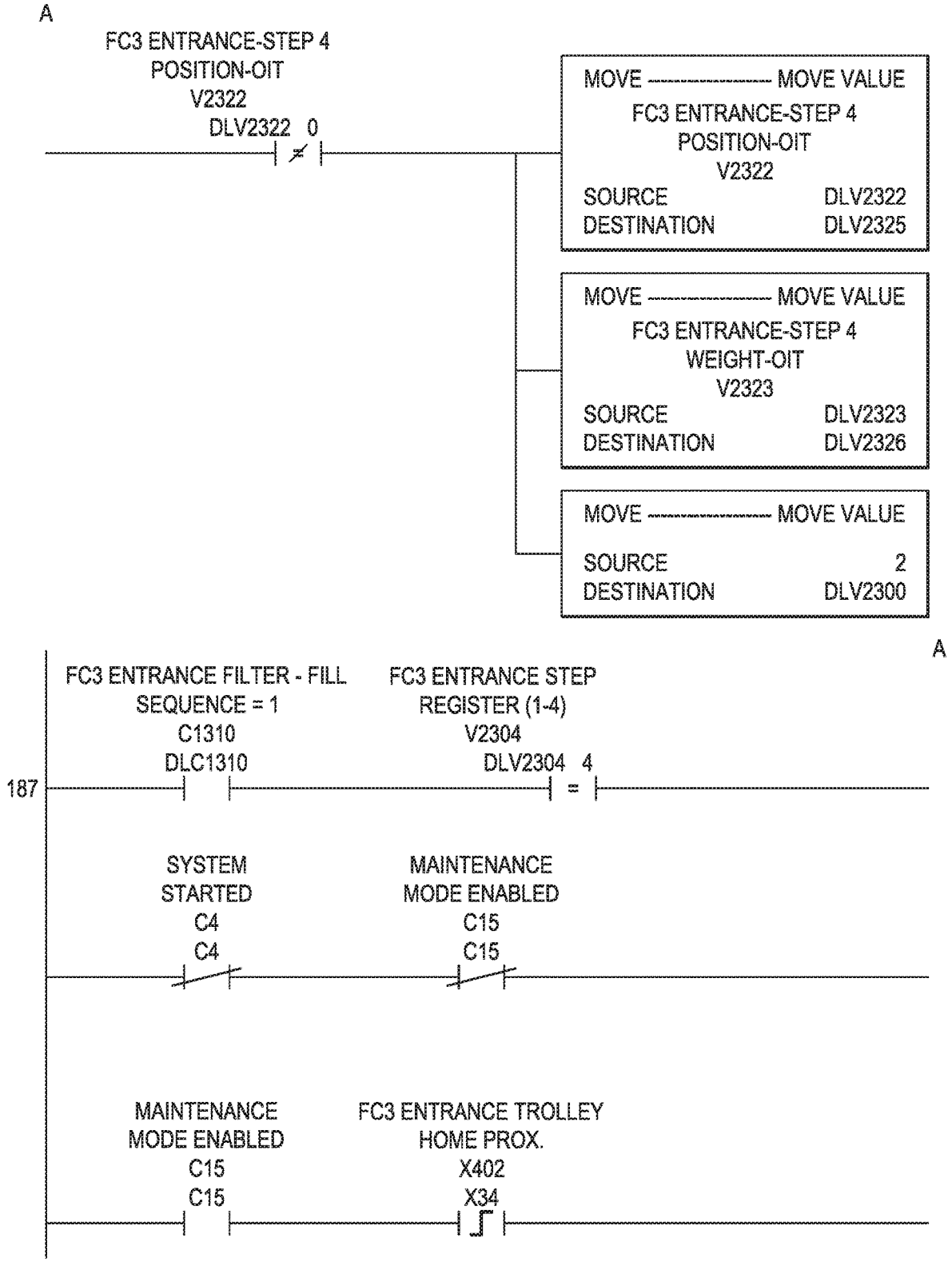
Figure 202:
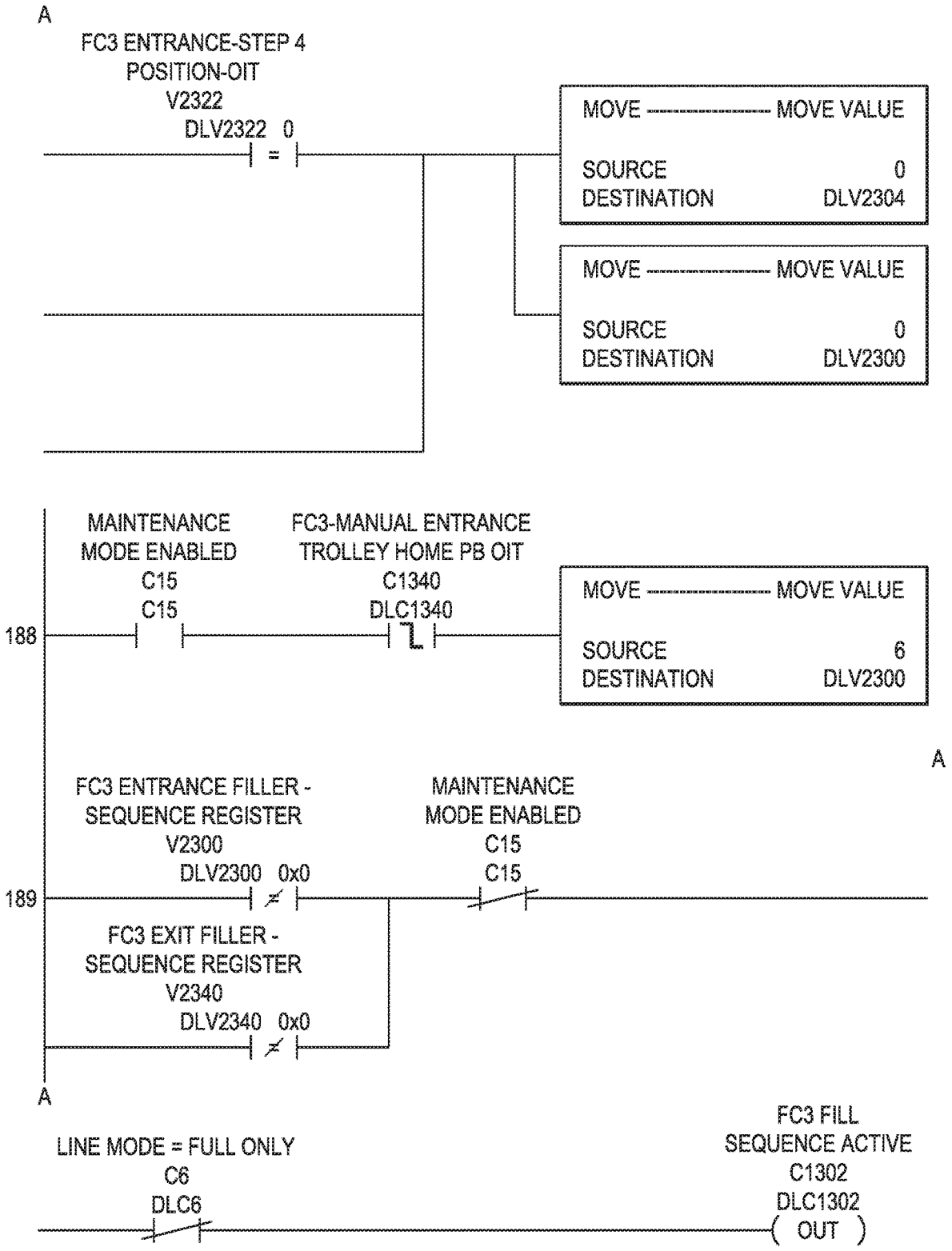
Figure 203:
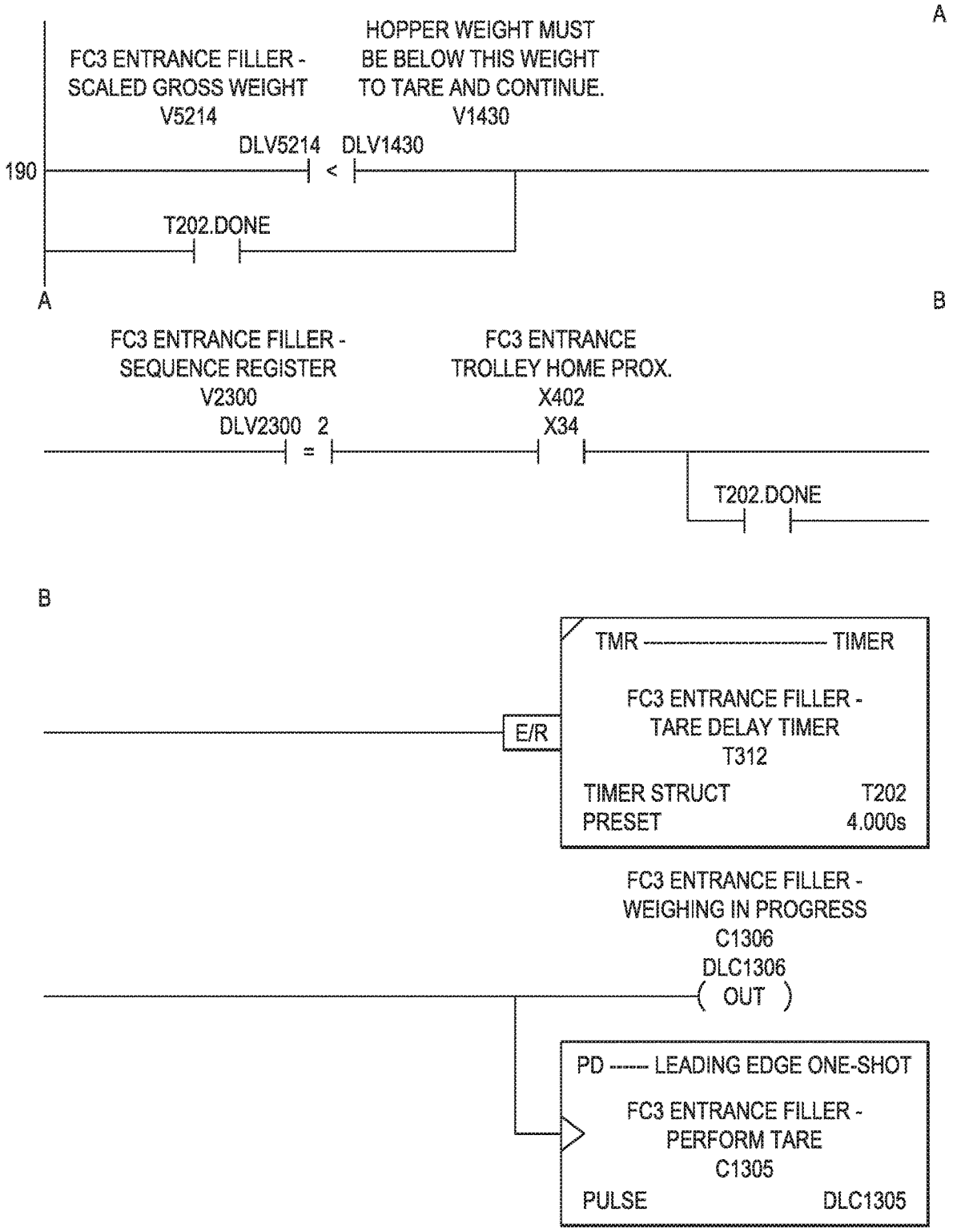
Figure 204:
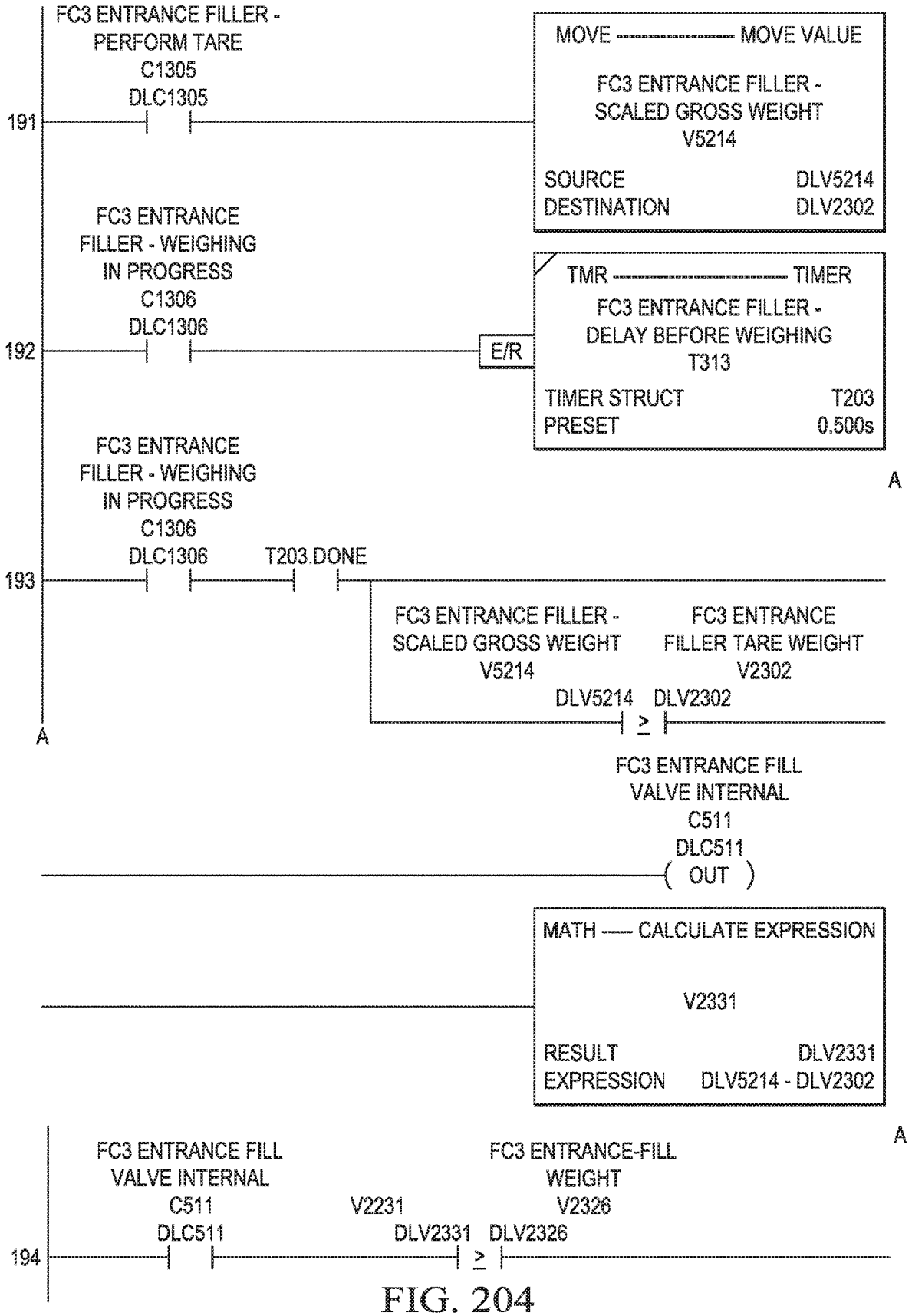
Figure 205:
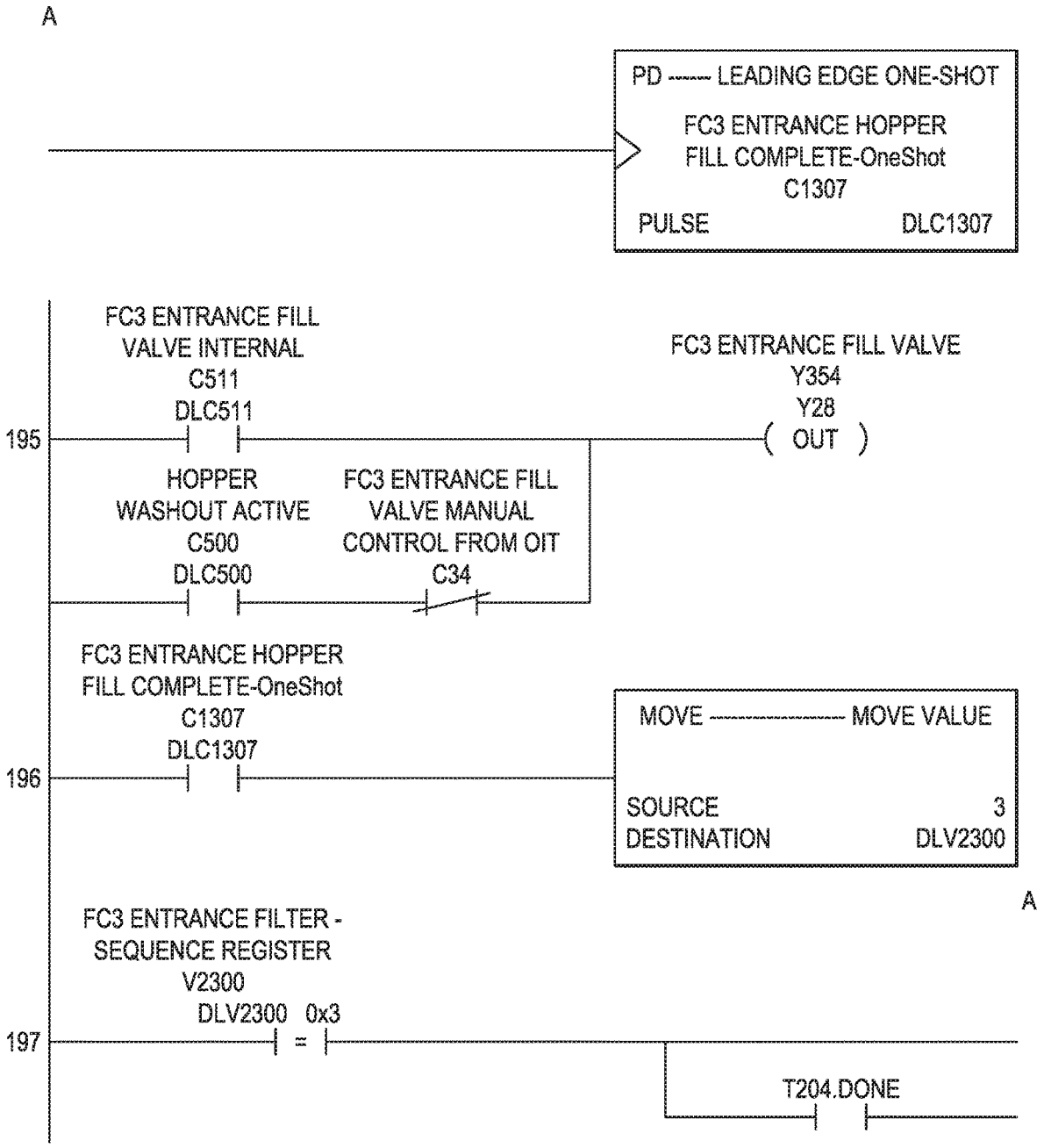
Figure 206:
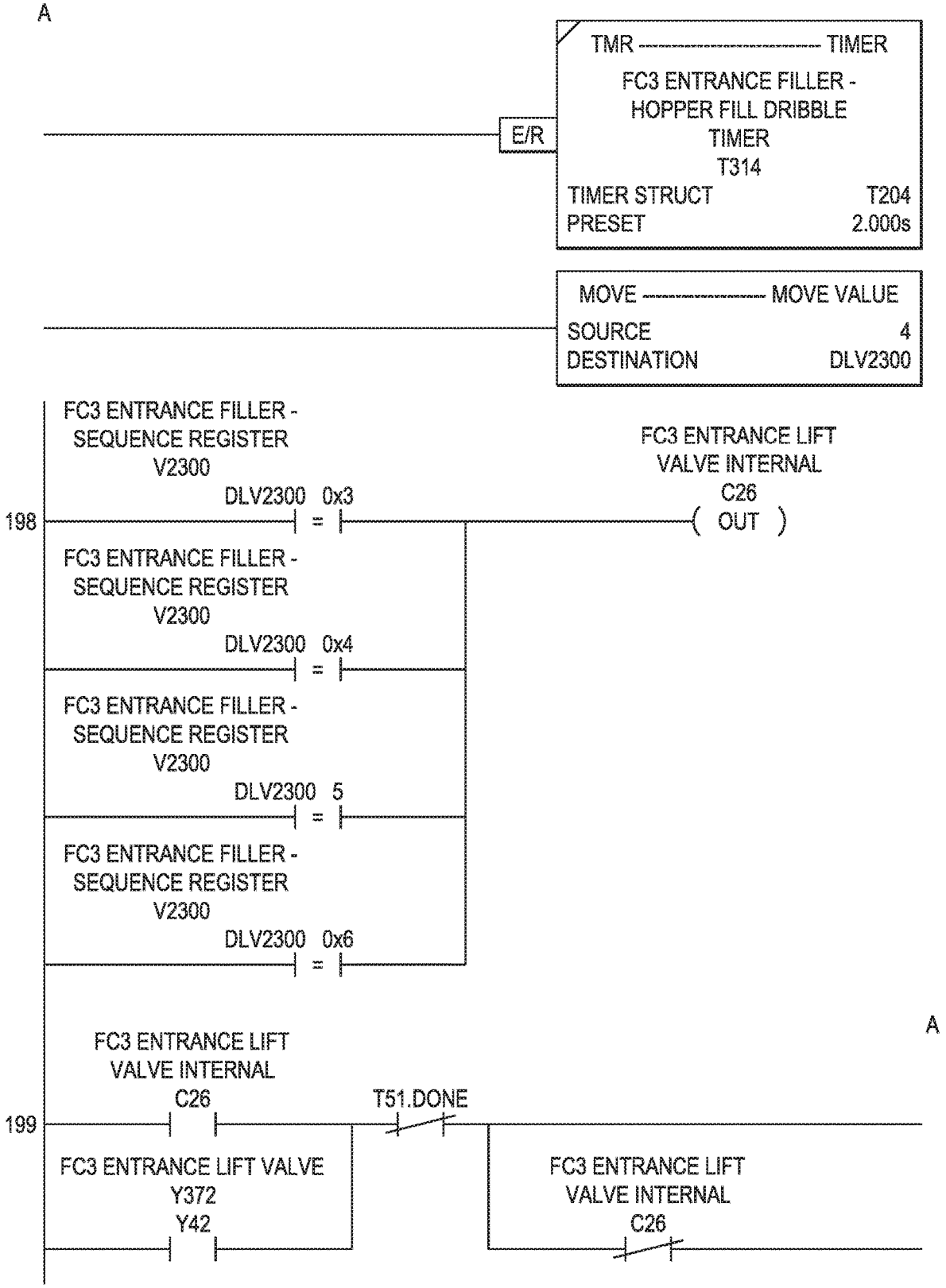
Figure 207:
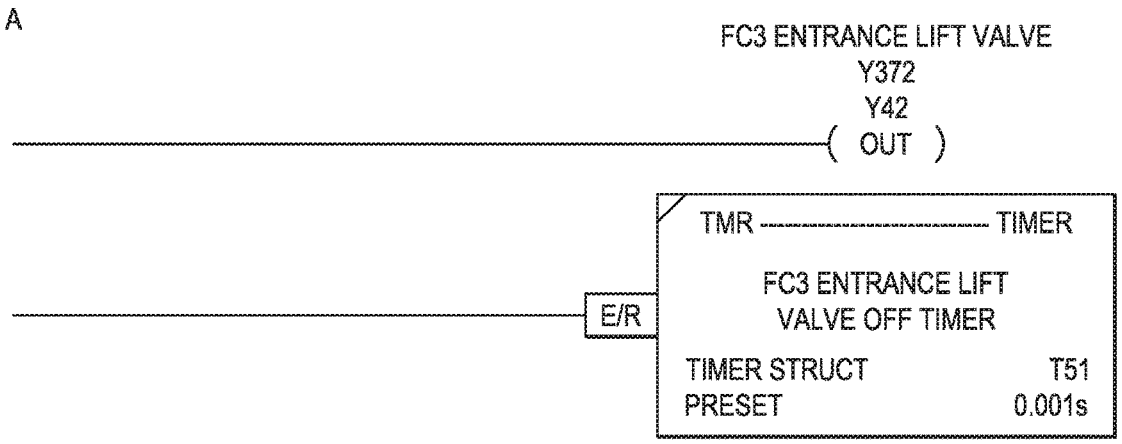
Figure 208:
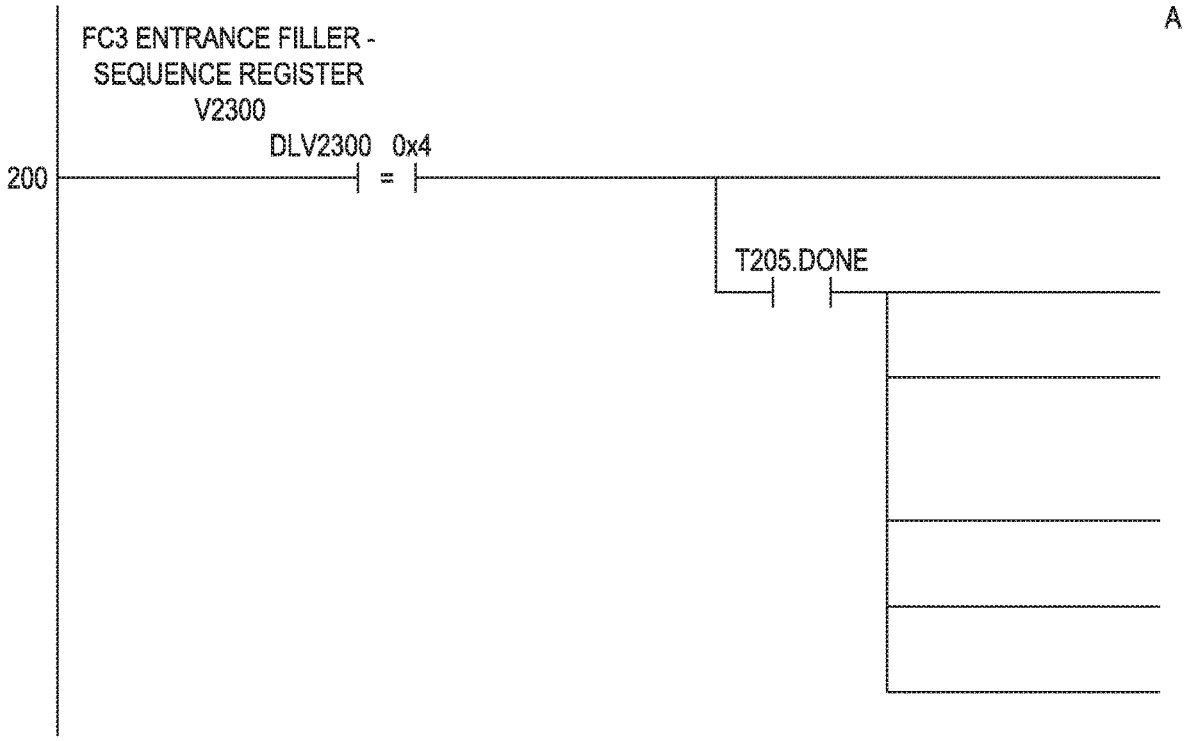
Figure 209:
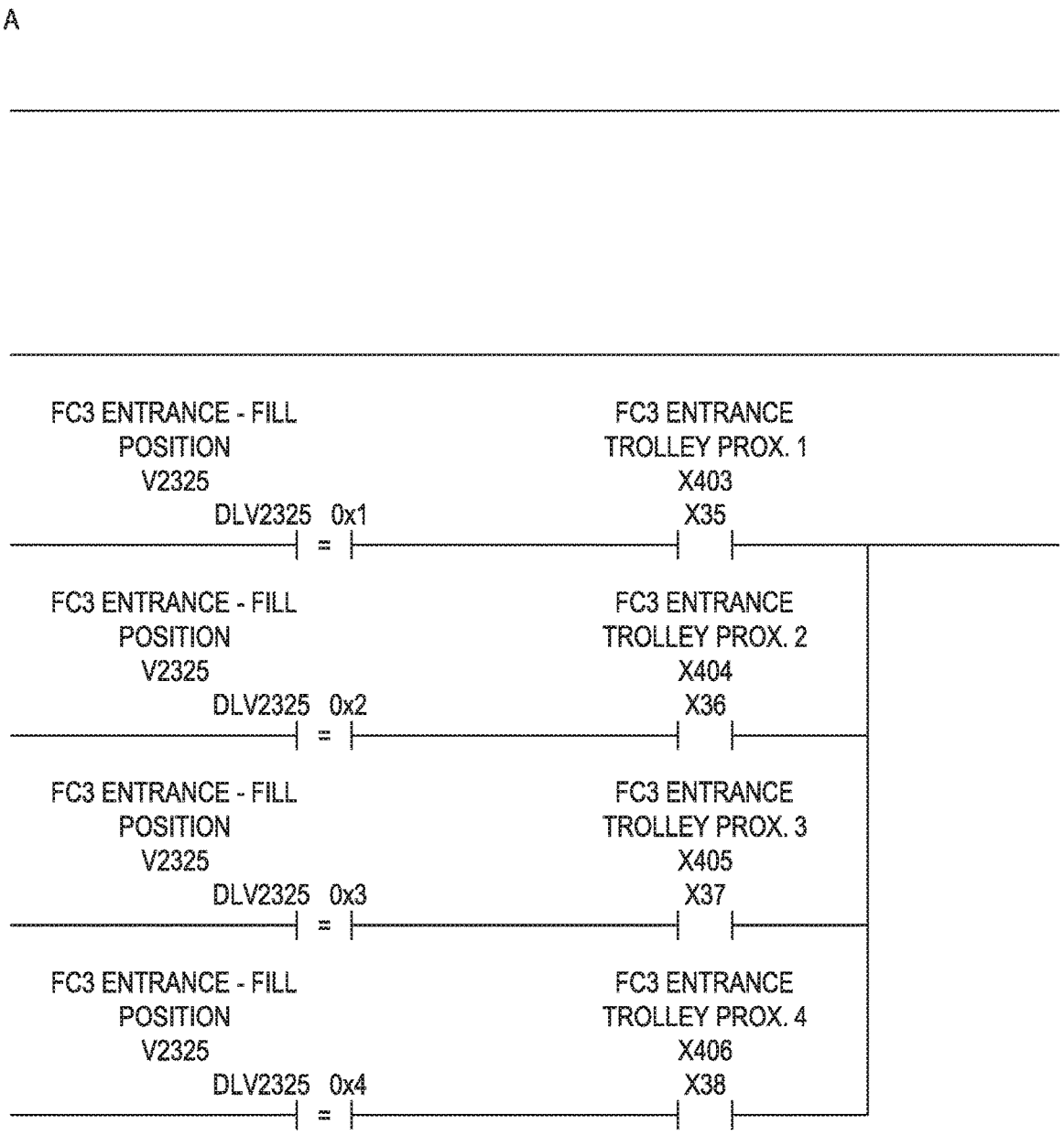
Figure 210:
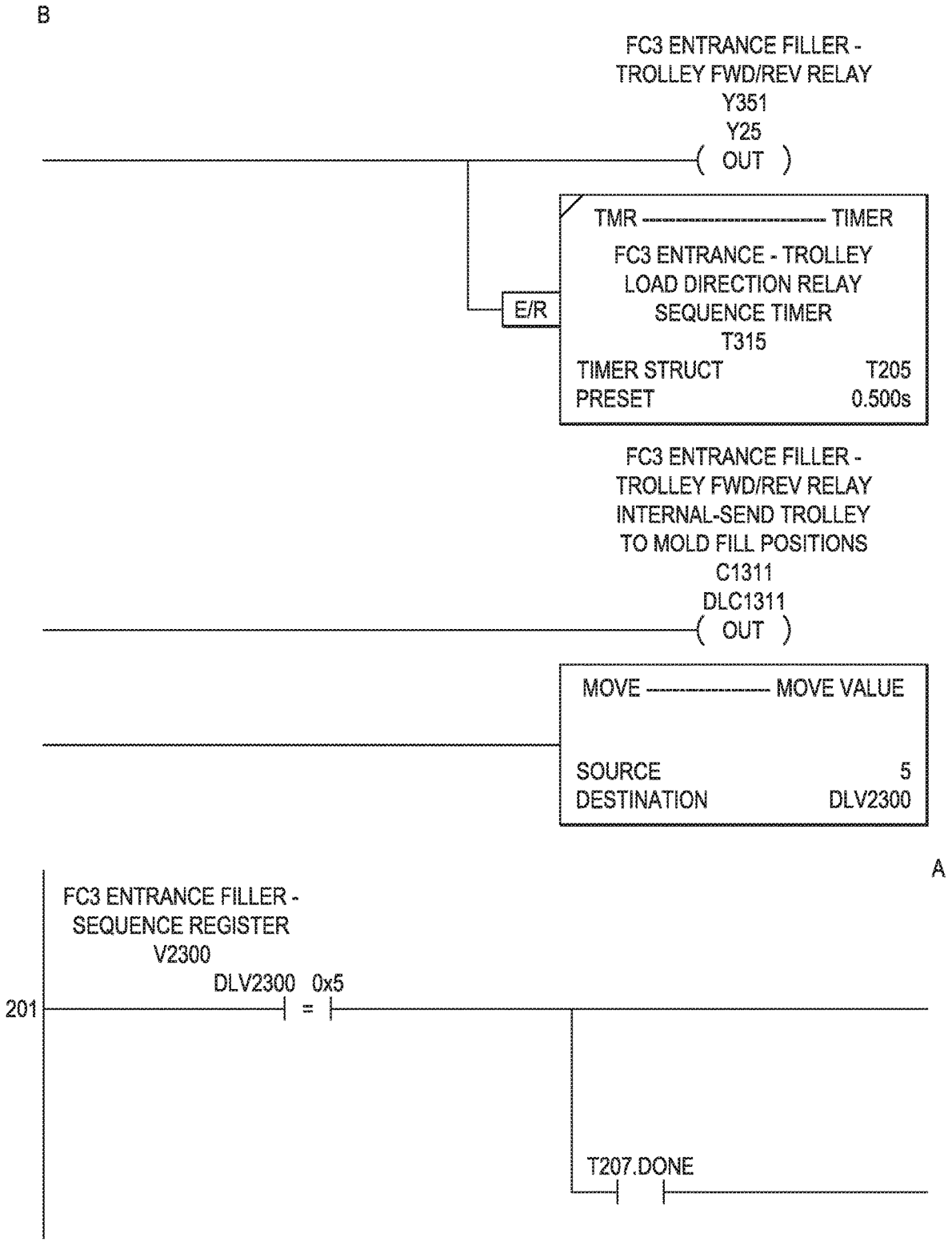
Figure 211:
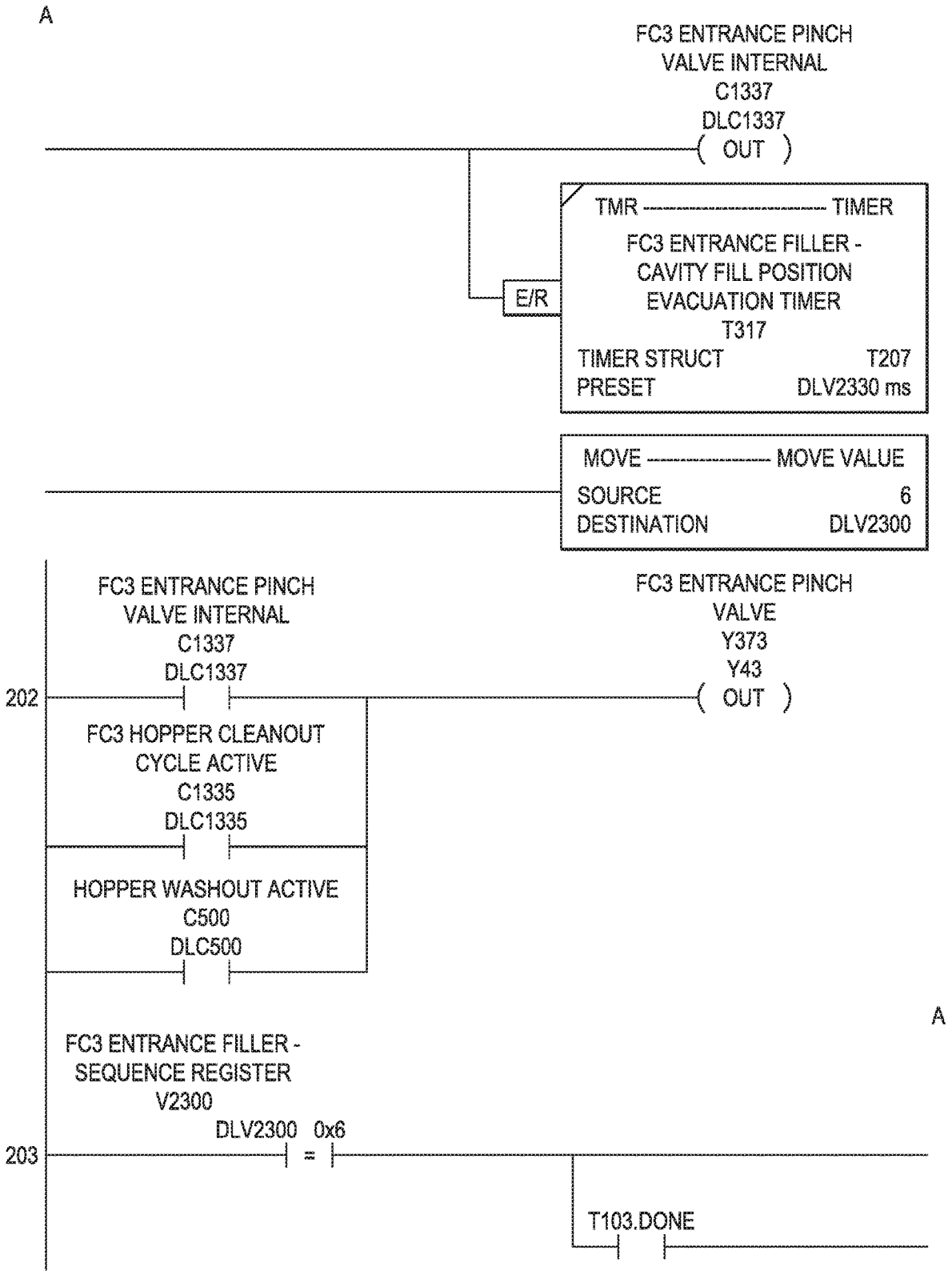
Figure 212:
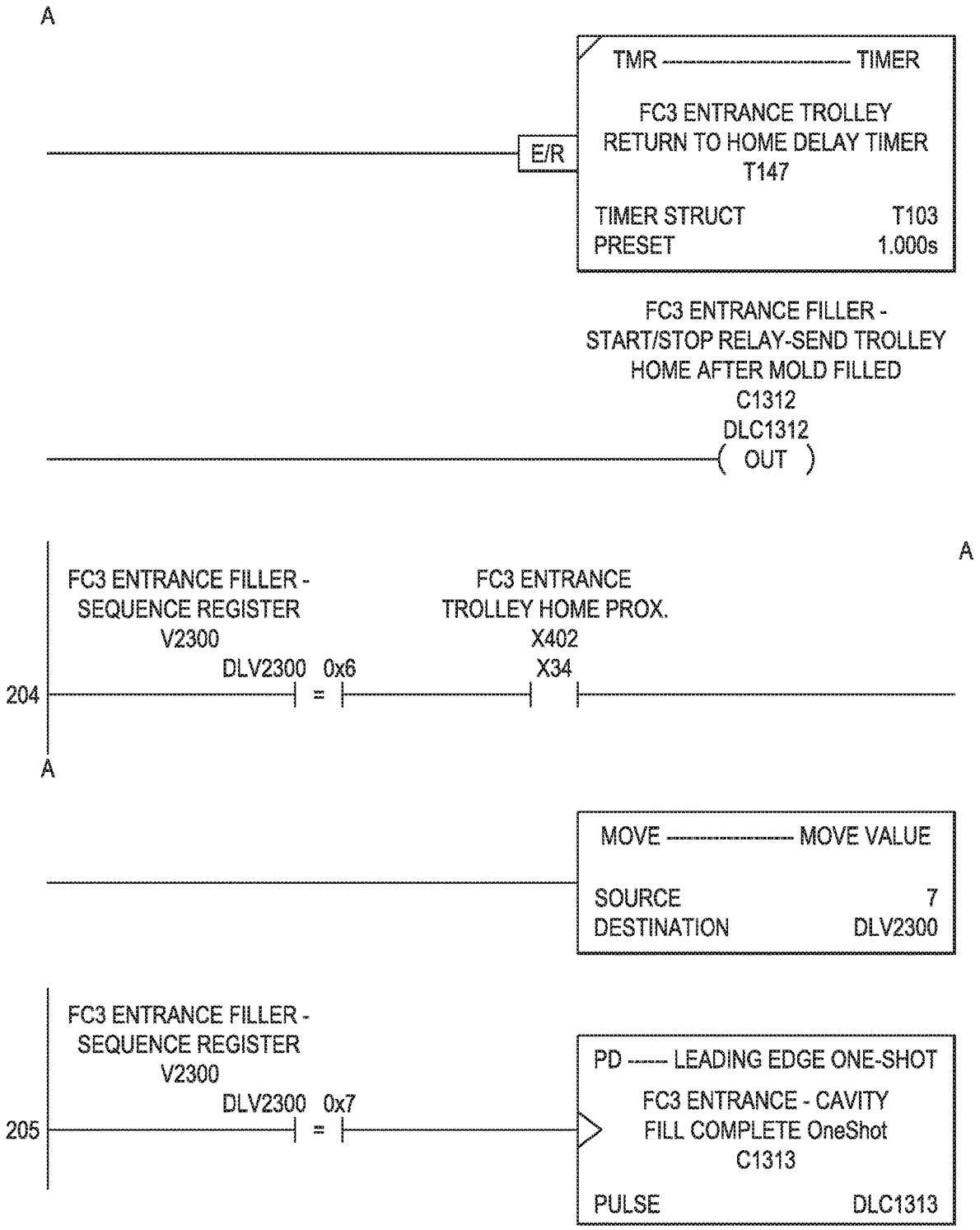
Figure 213:
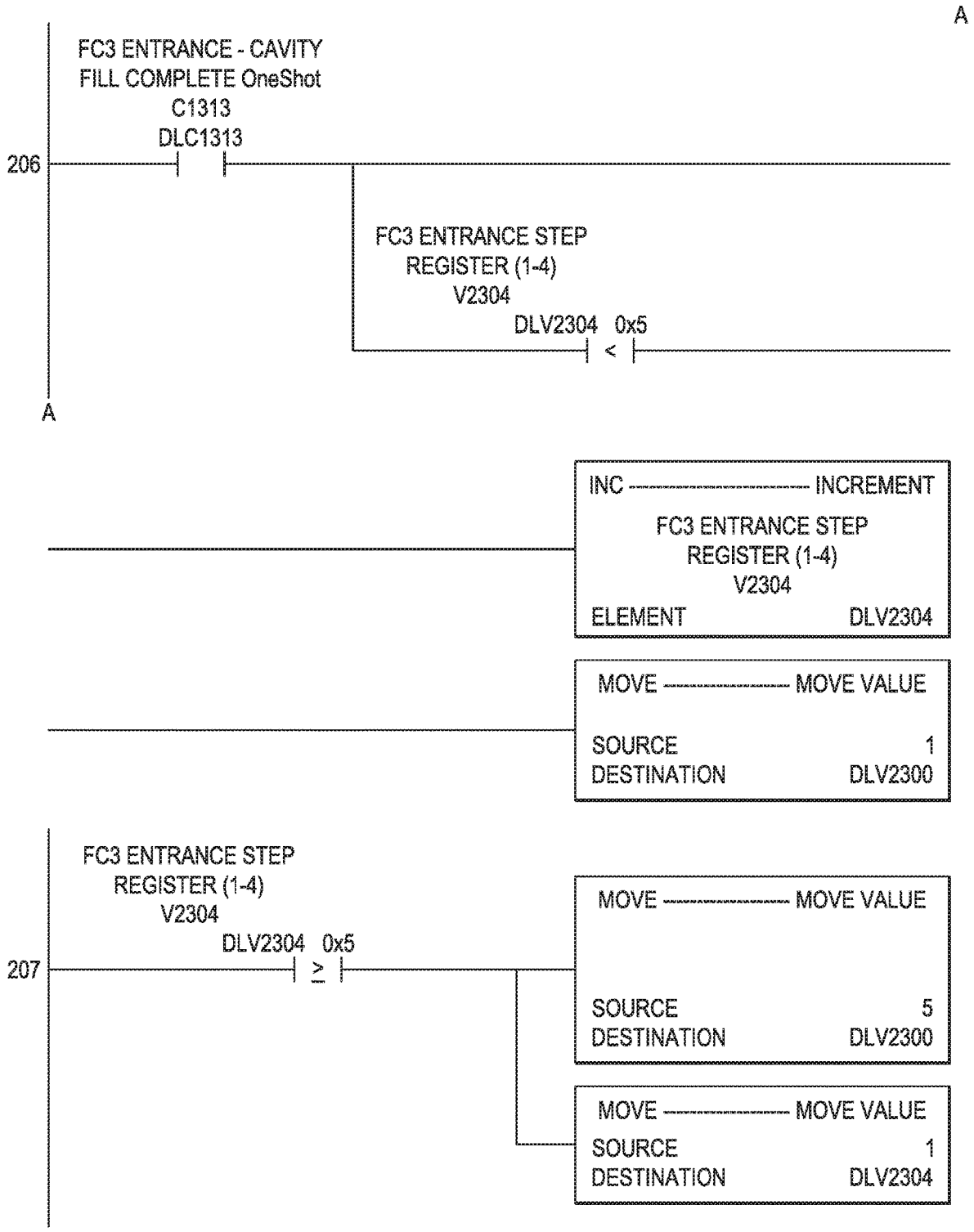
Figure 214:
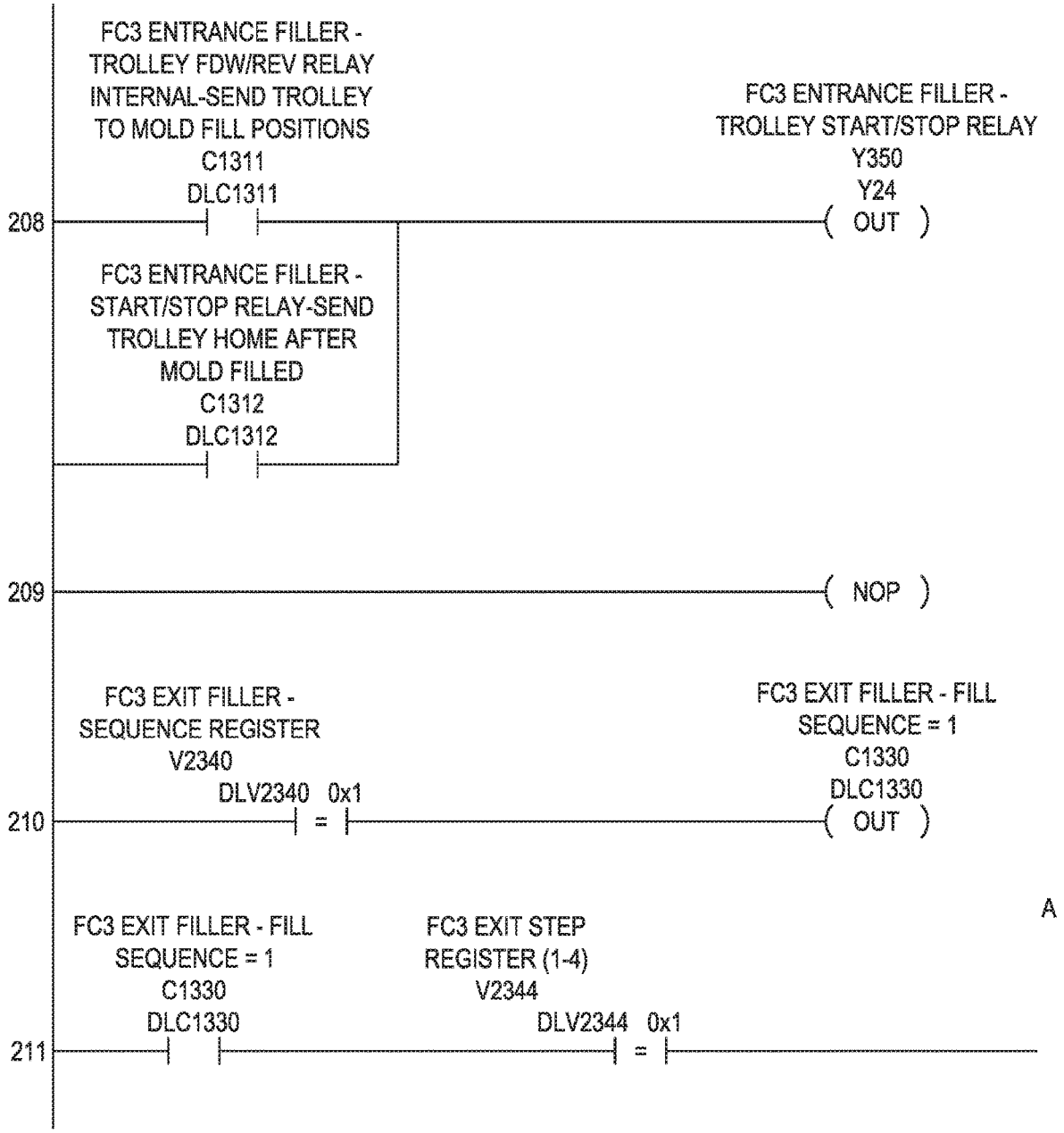
Figure 215:
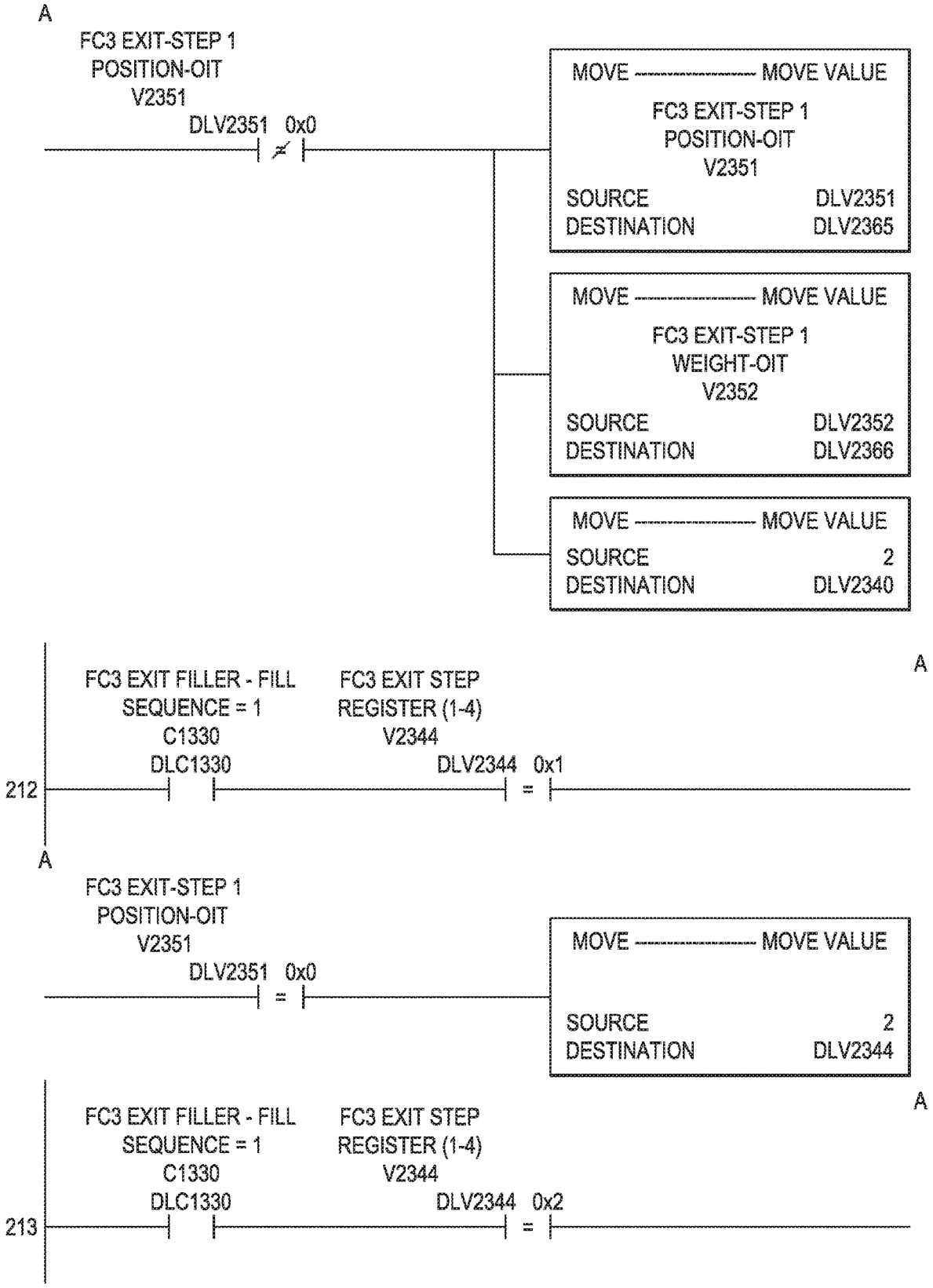
Figure 216:
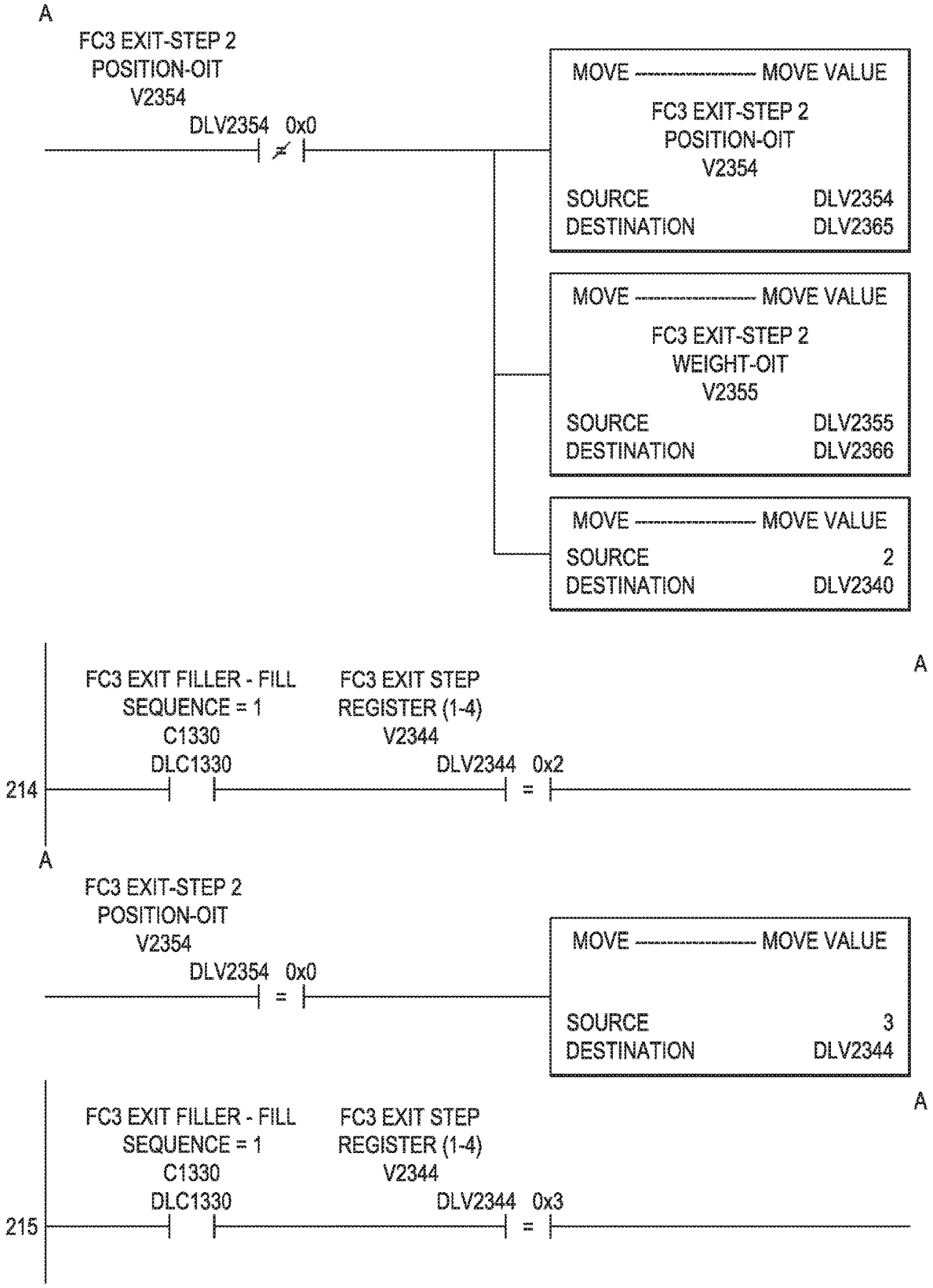
Figure 217:
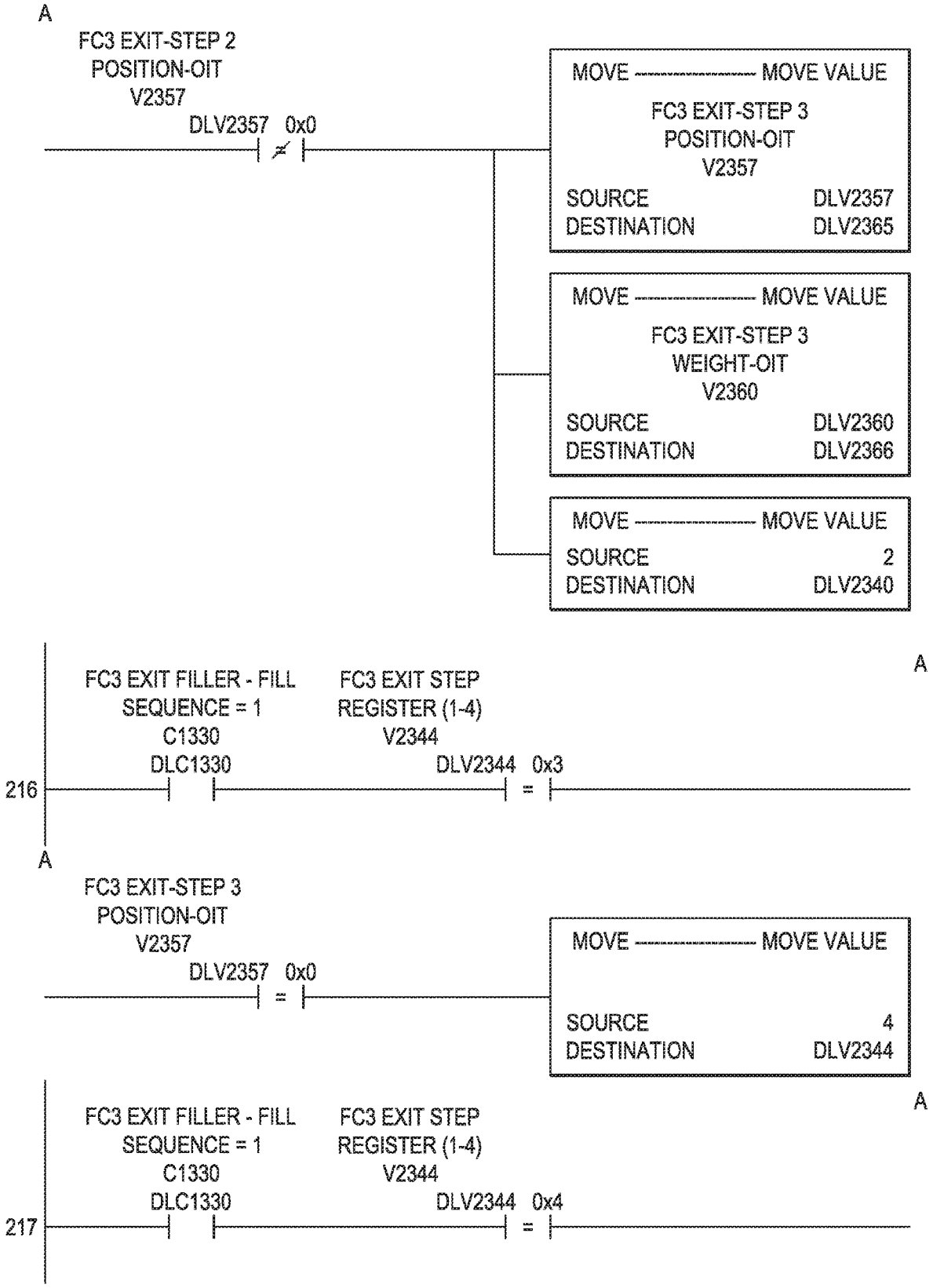
Figure 218:
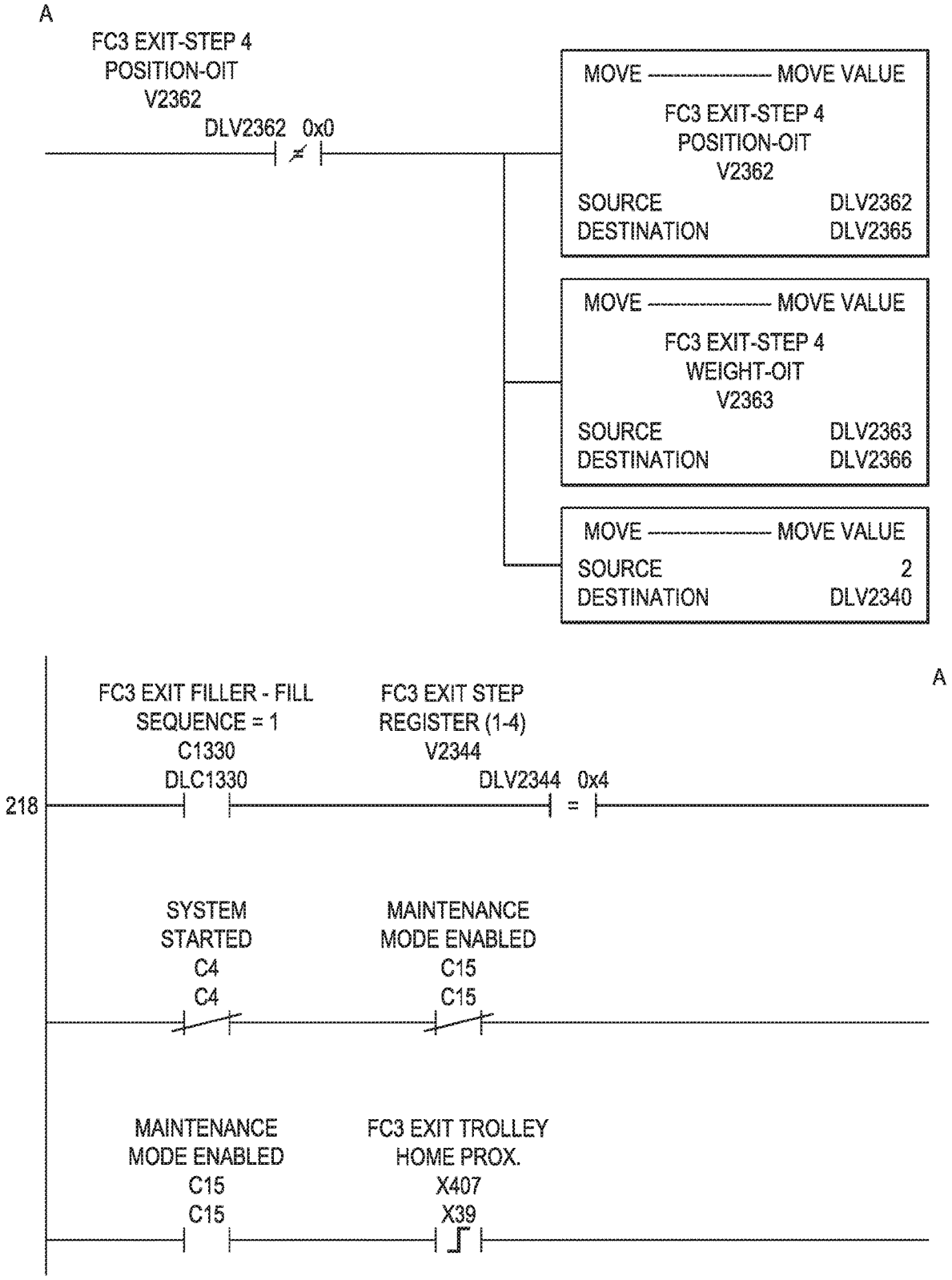
Figure 219:
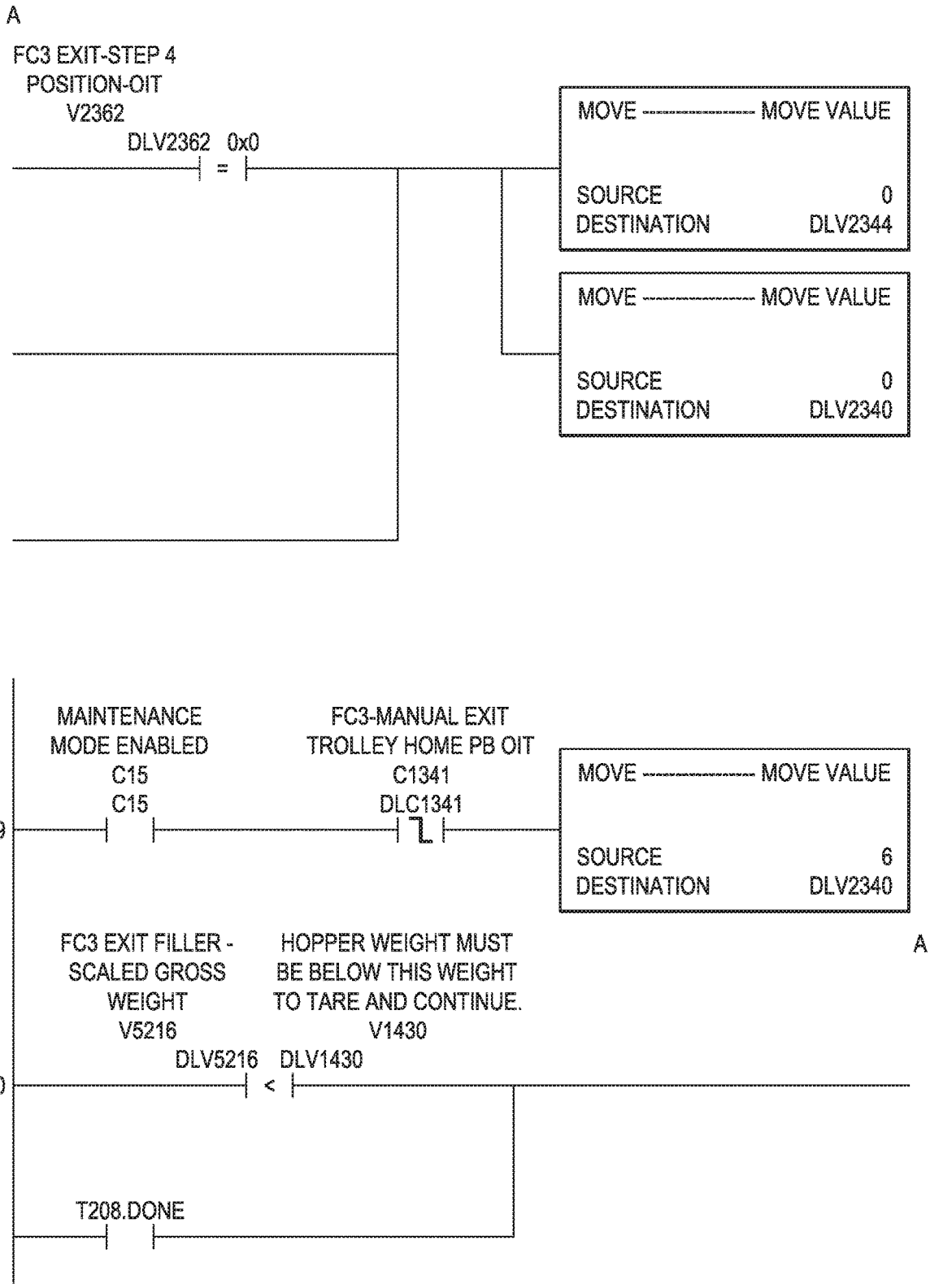
Figure 220:
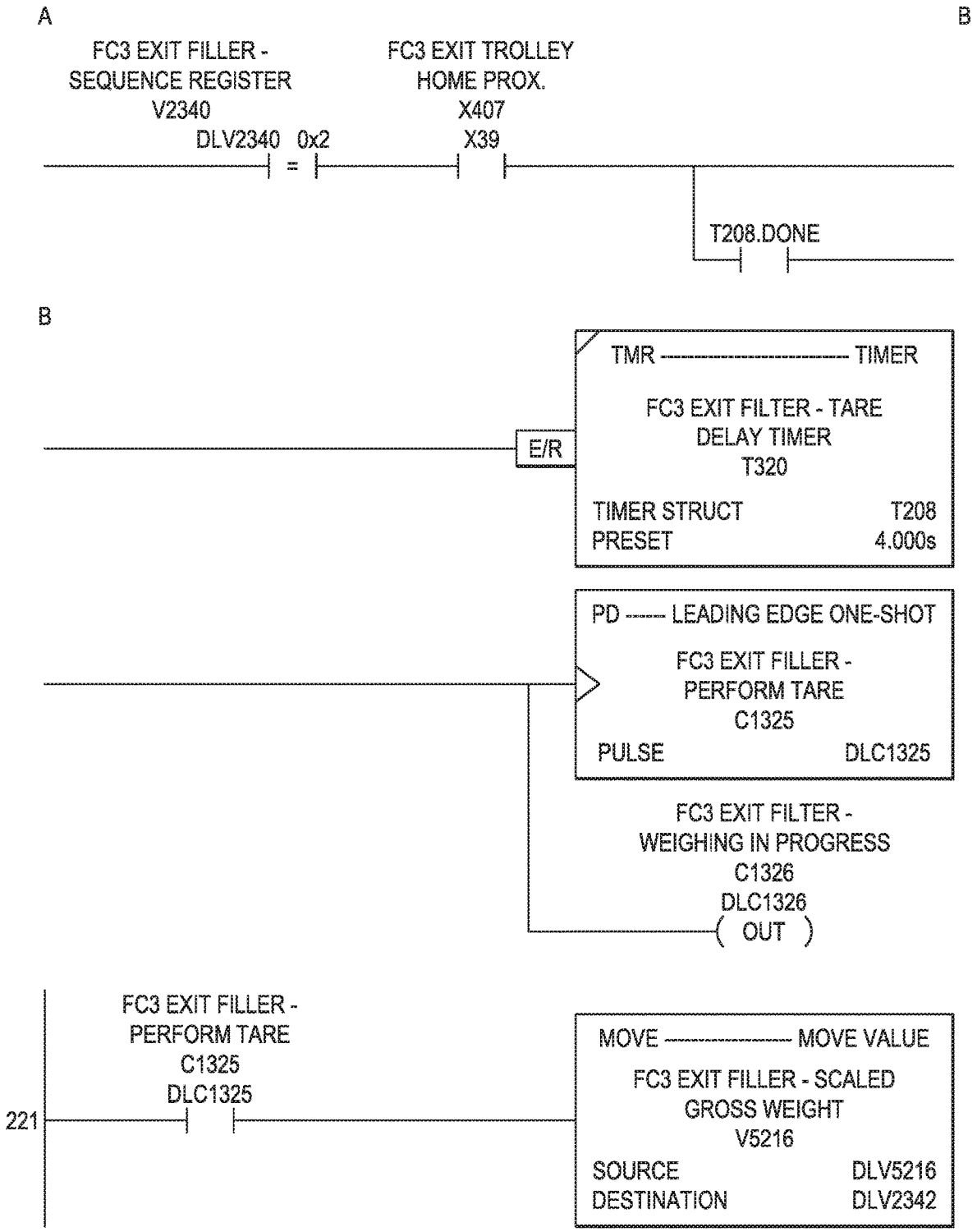
Figure 221:
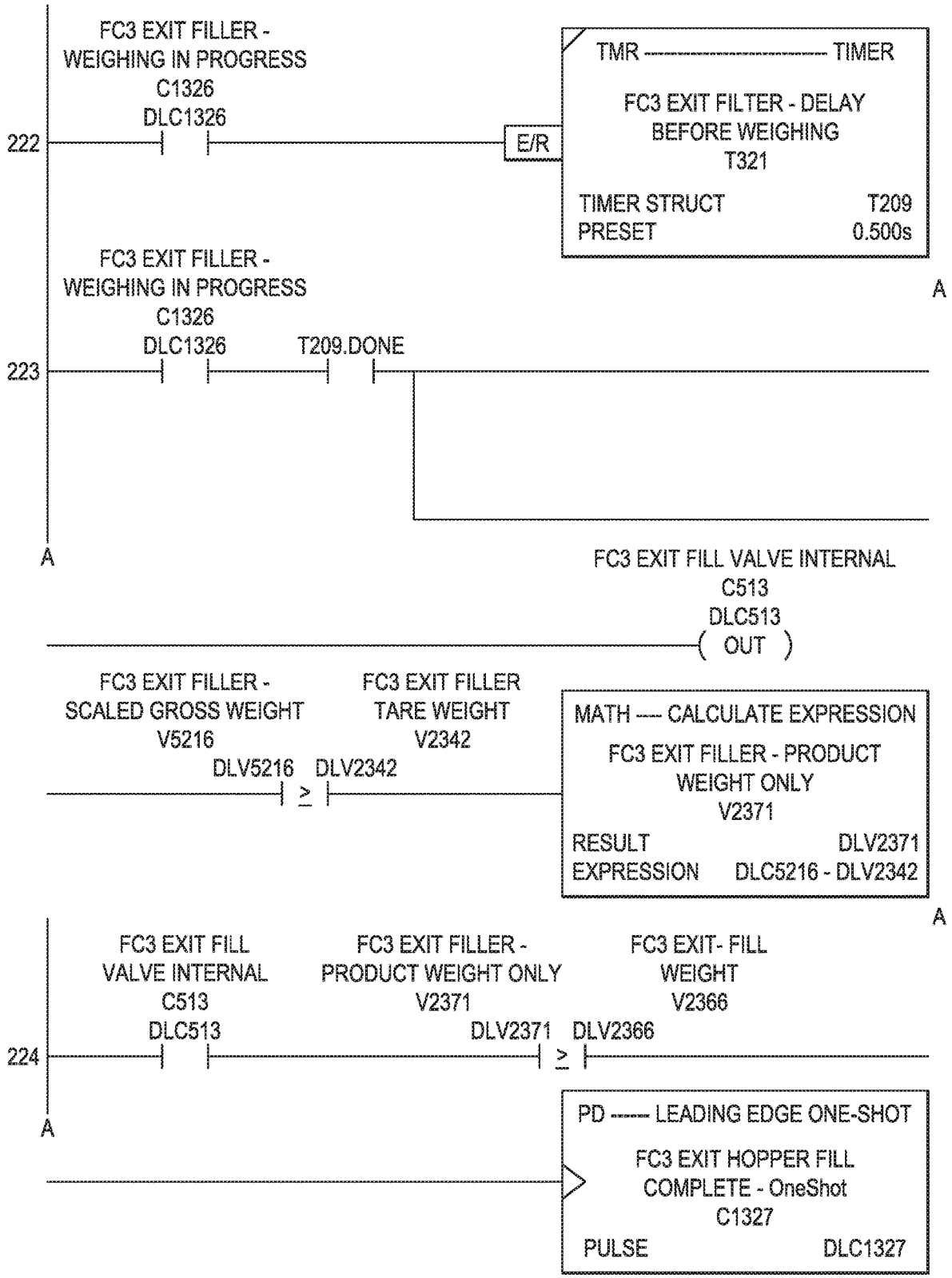
Figure 222:
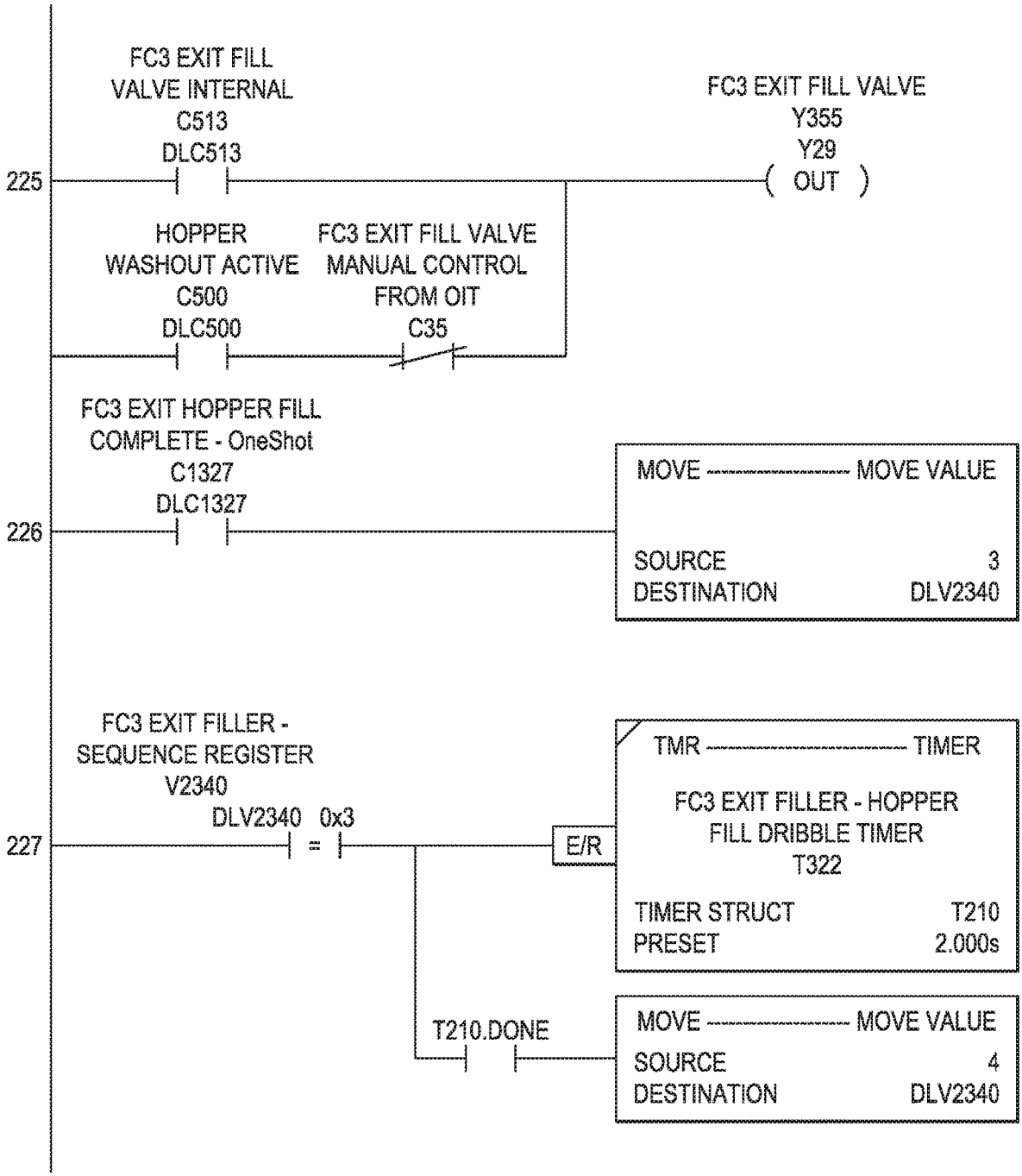
Figure 223:
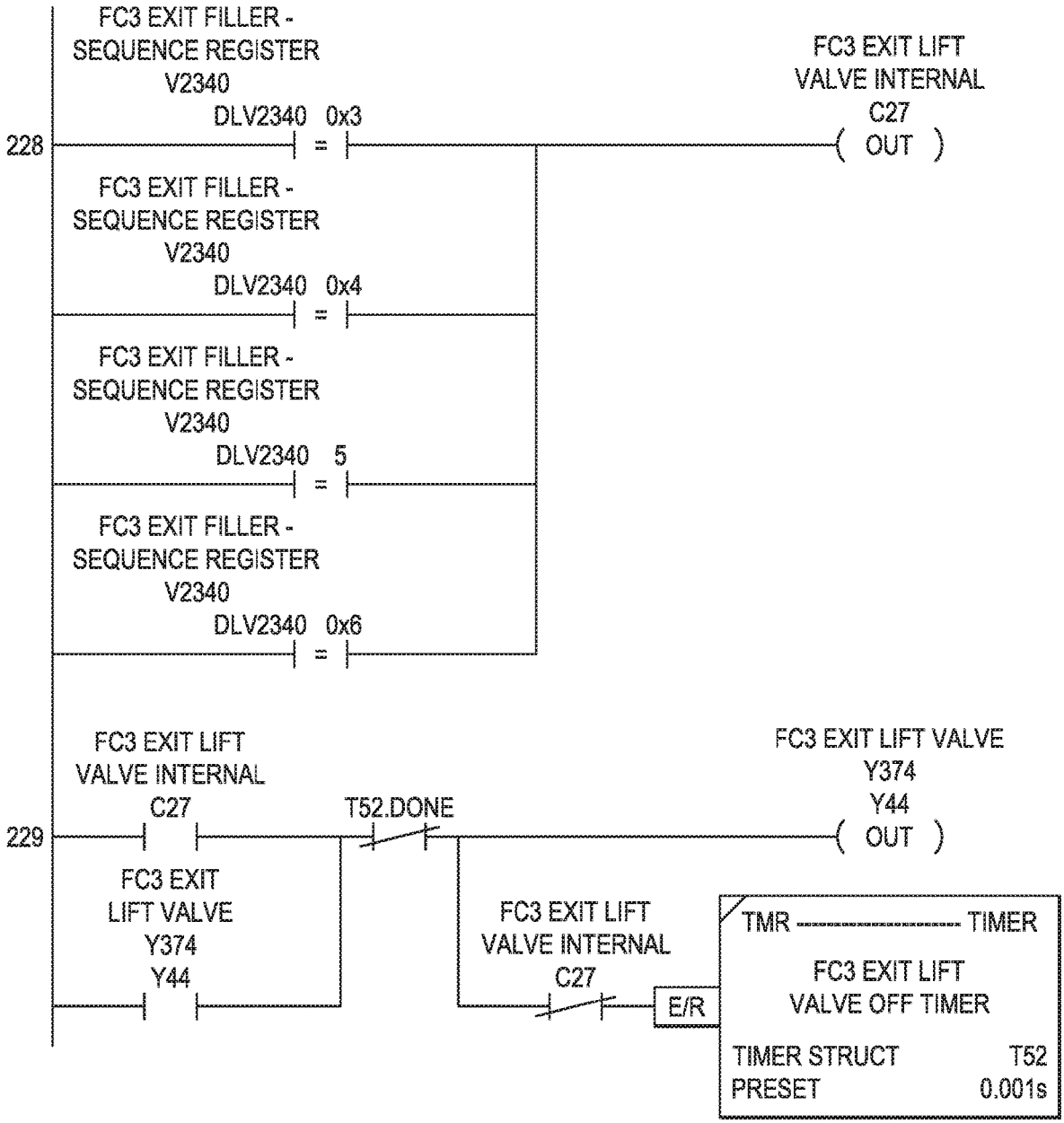
Figure 224:
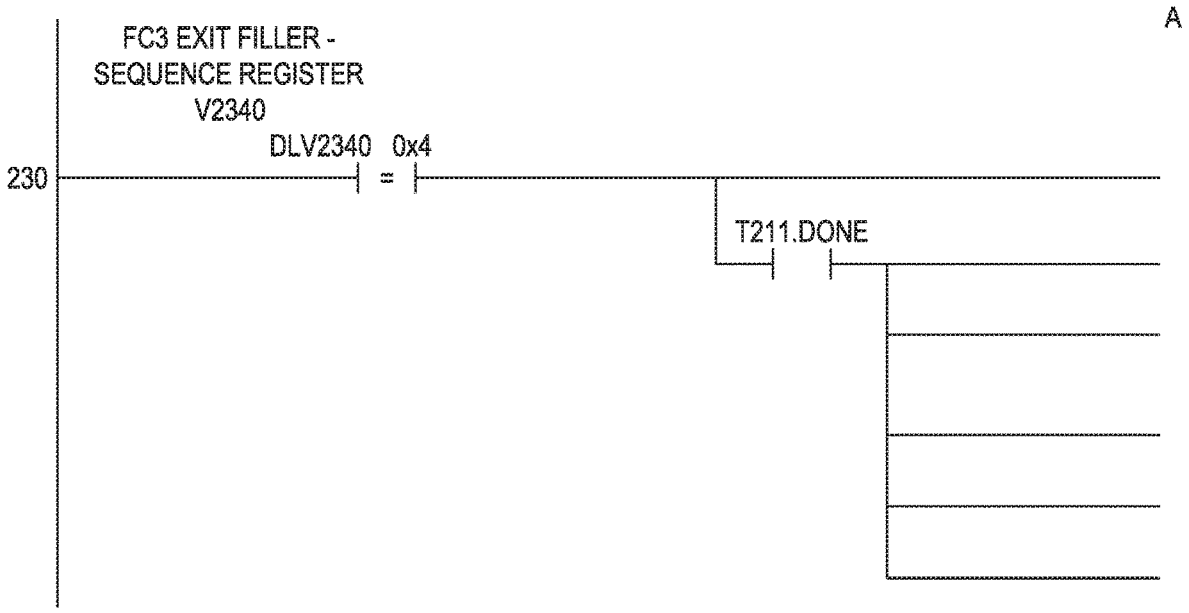
Figure 225:
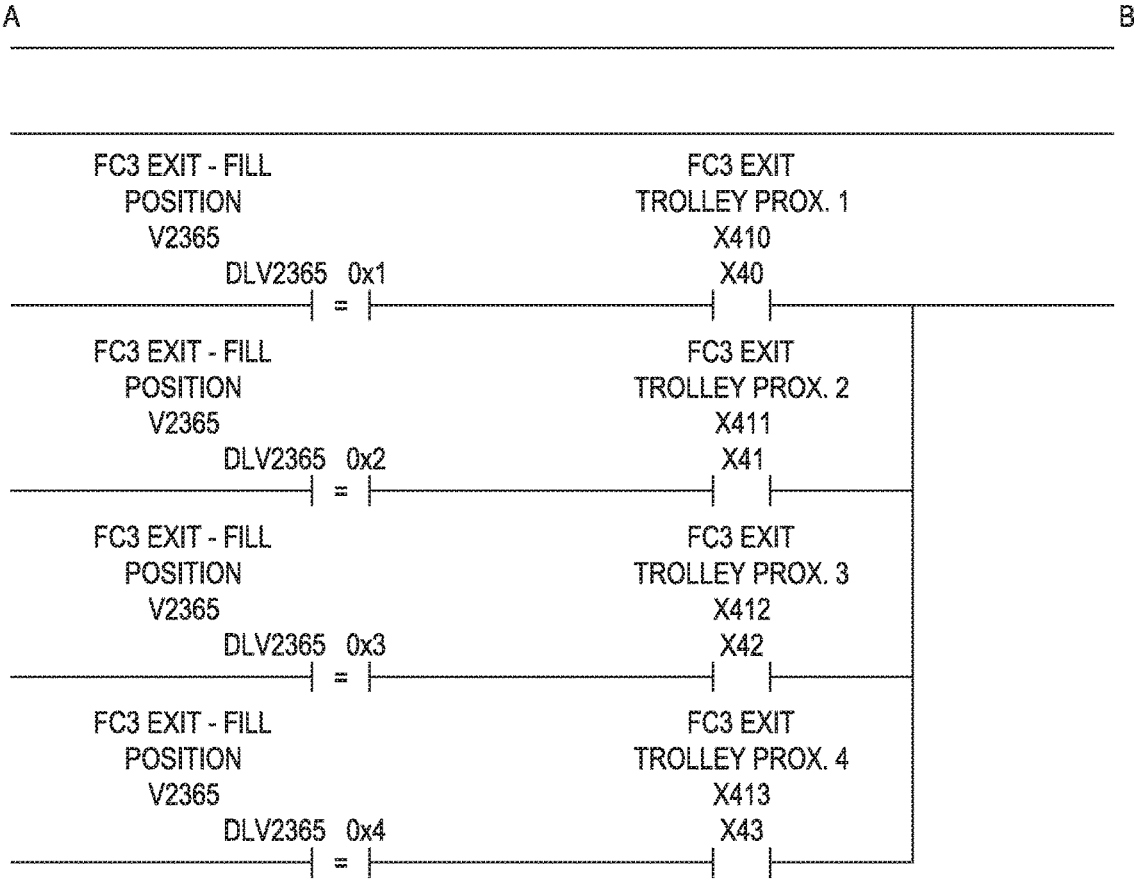
Figure 226:
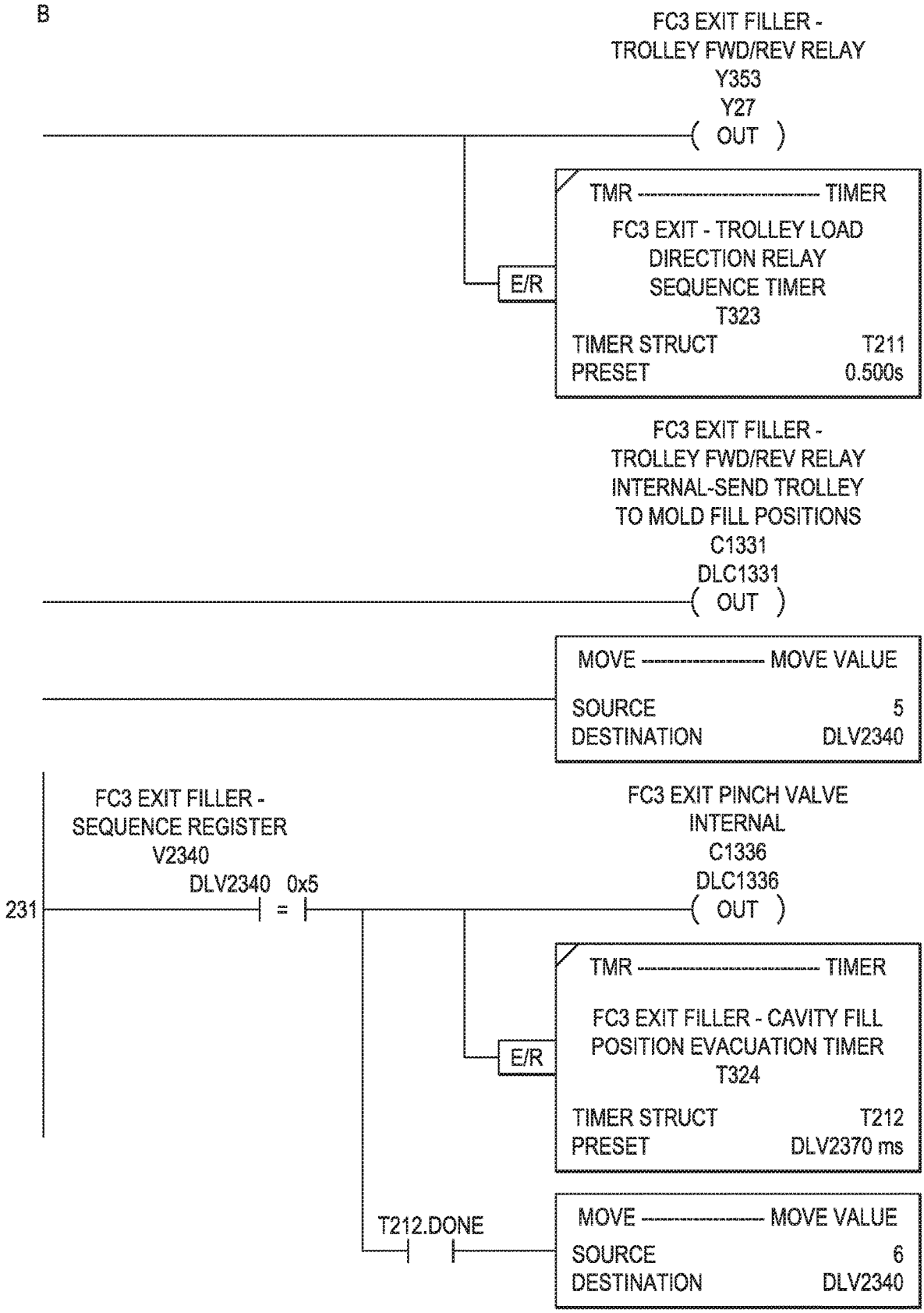
Figure 227:
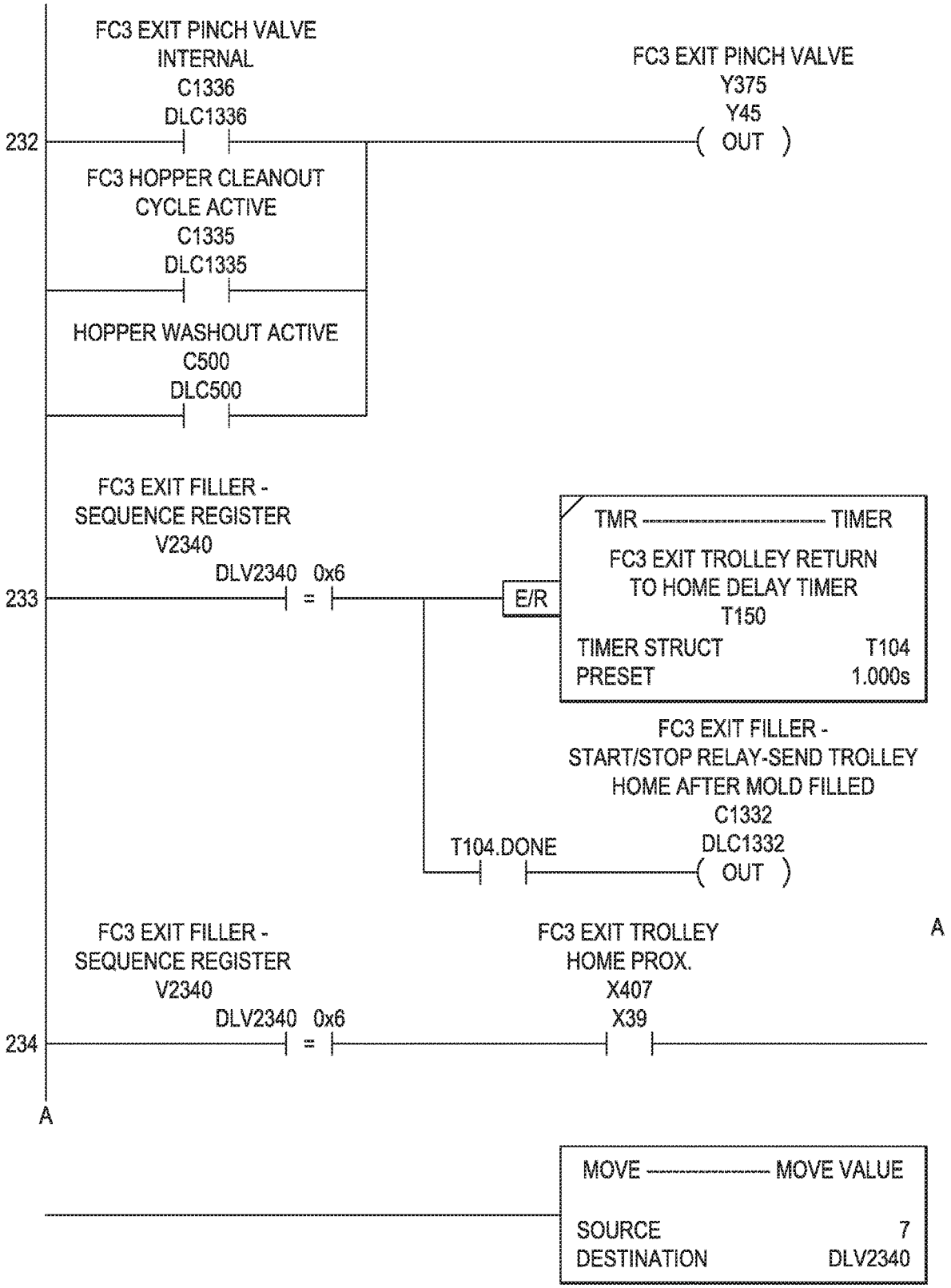
Figure 228:
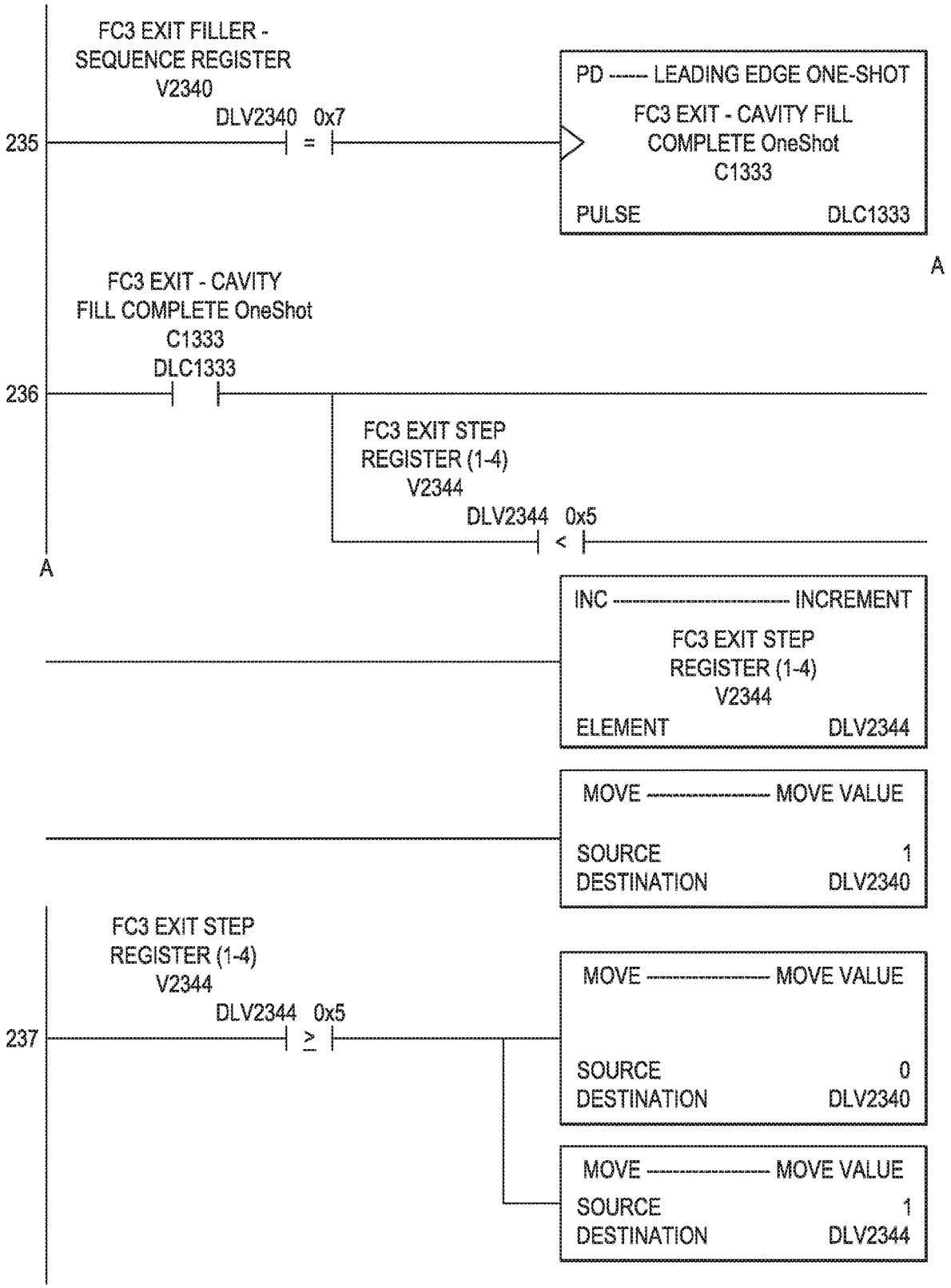
Figure 229:
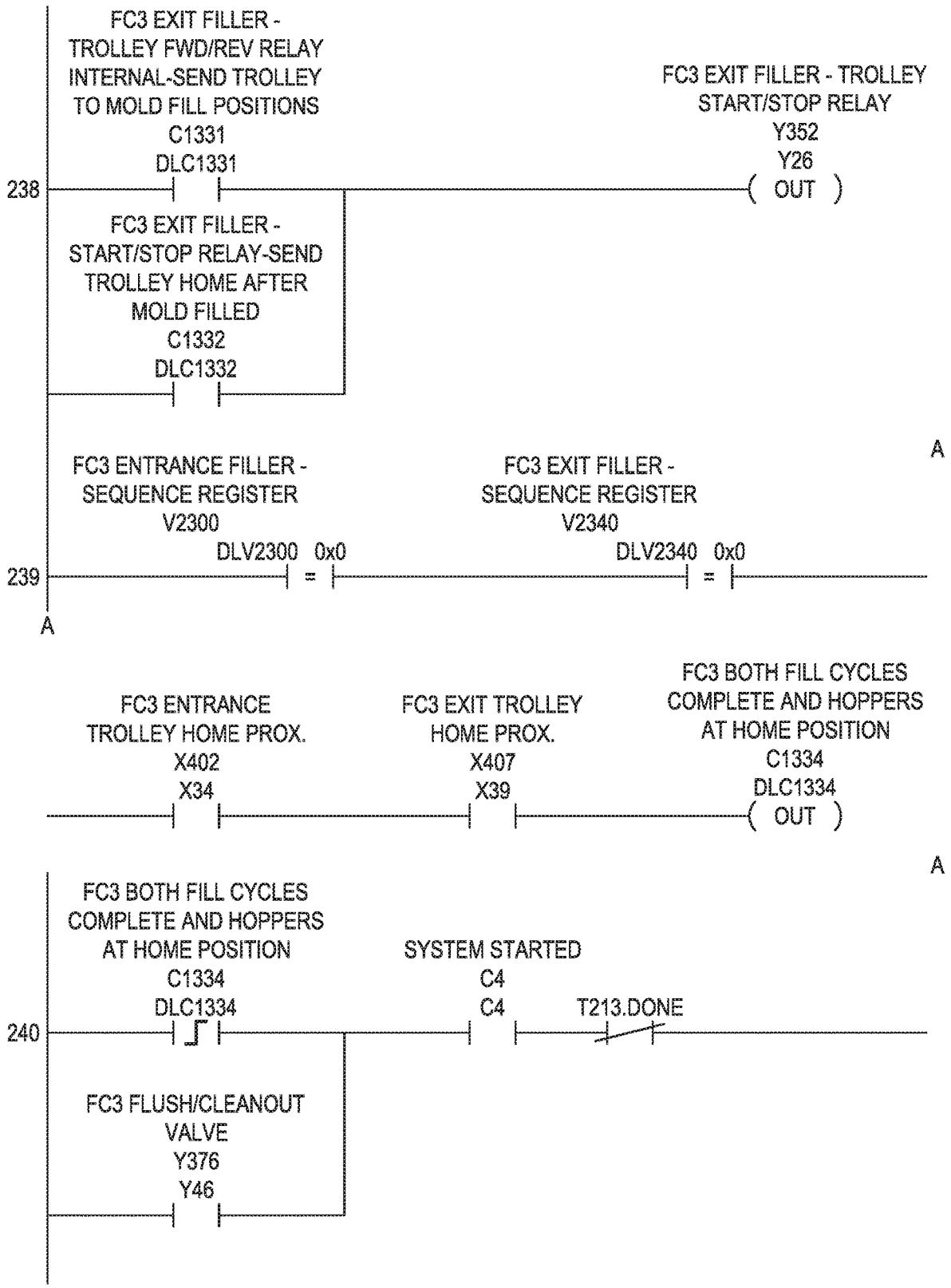
Figure 230:
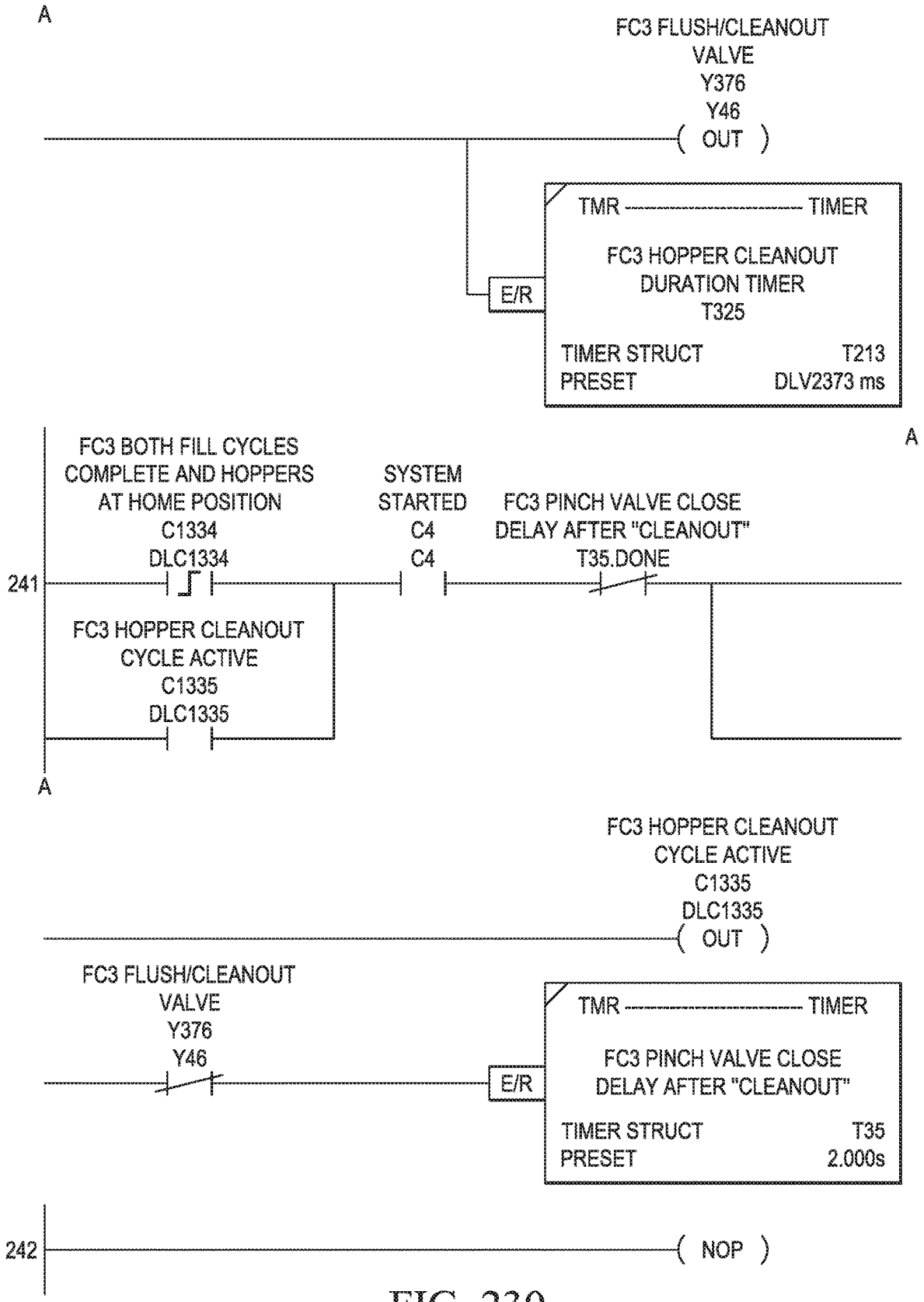
Figure 231:
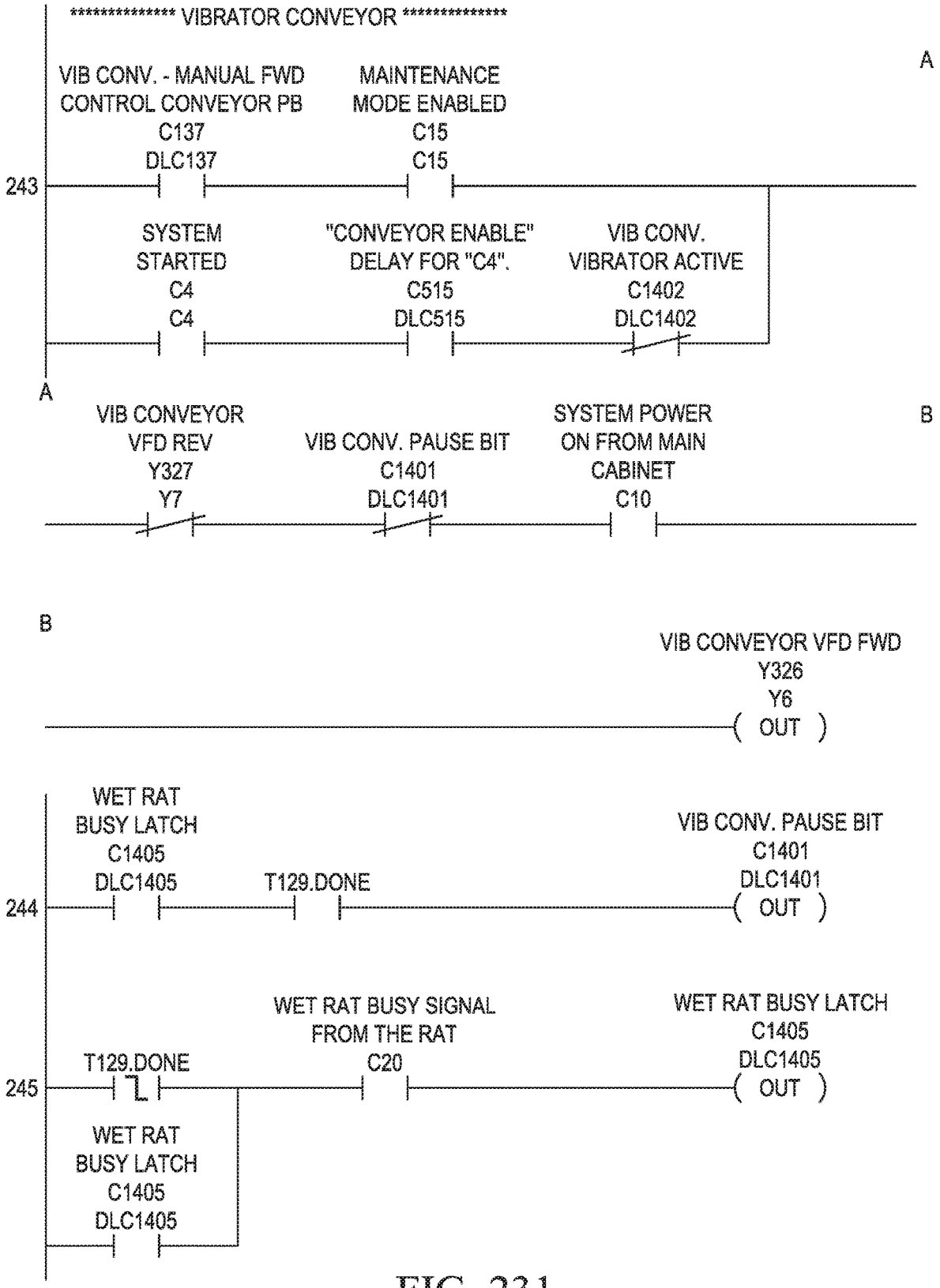
Figure 232:
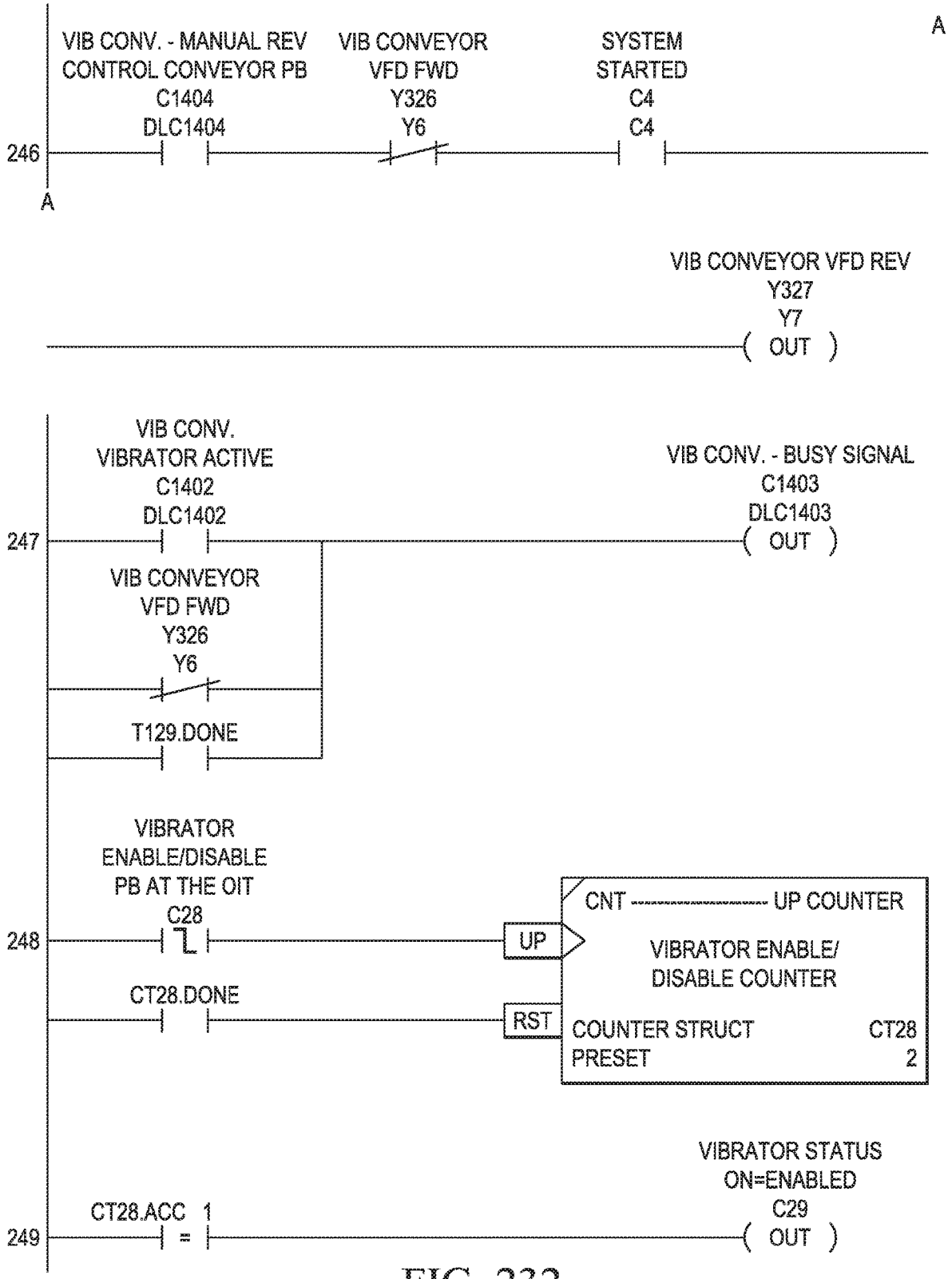
Figure 233:
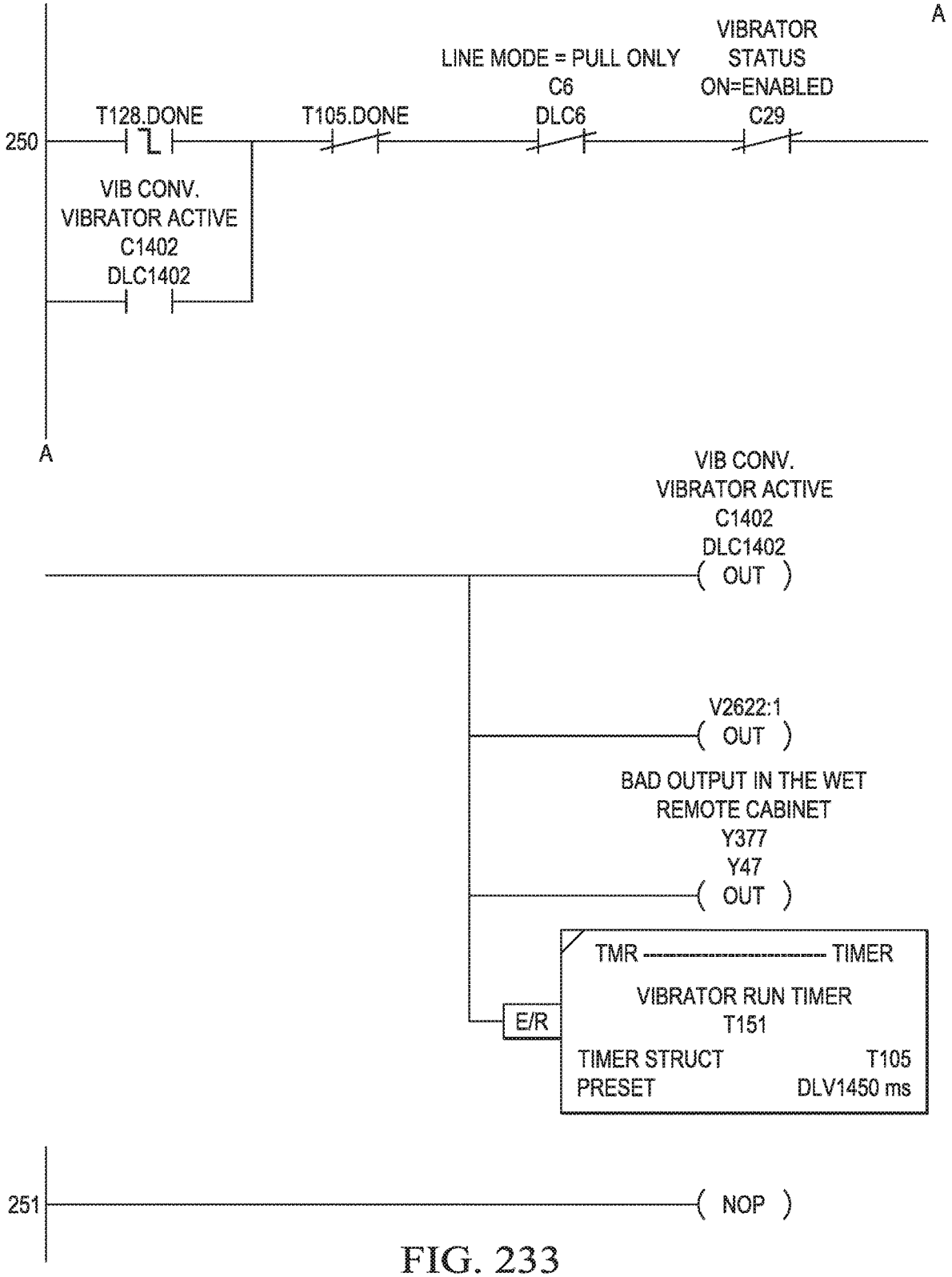
Figure 234:
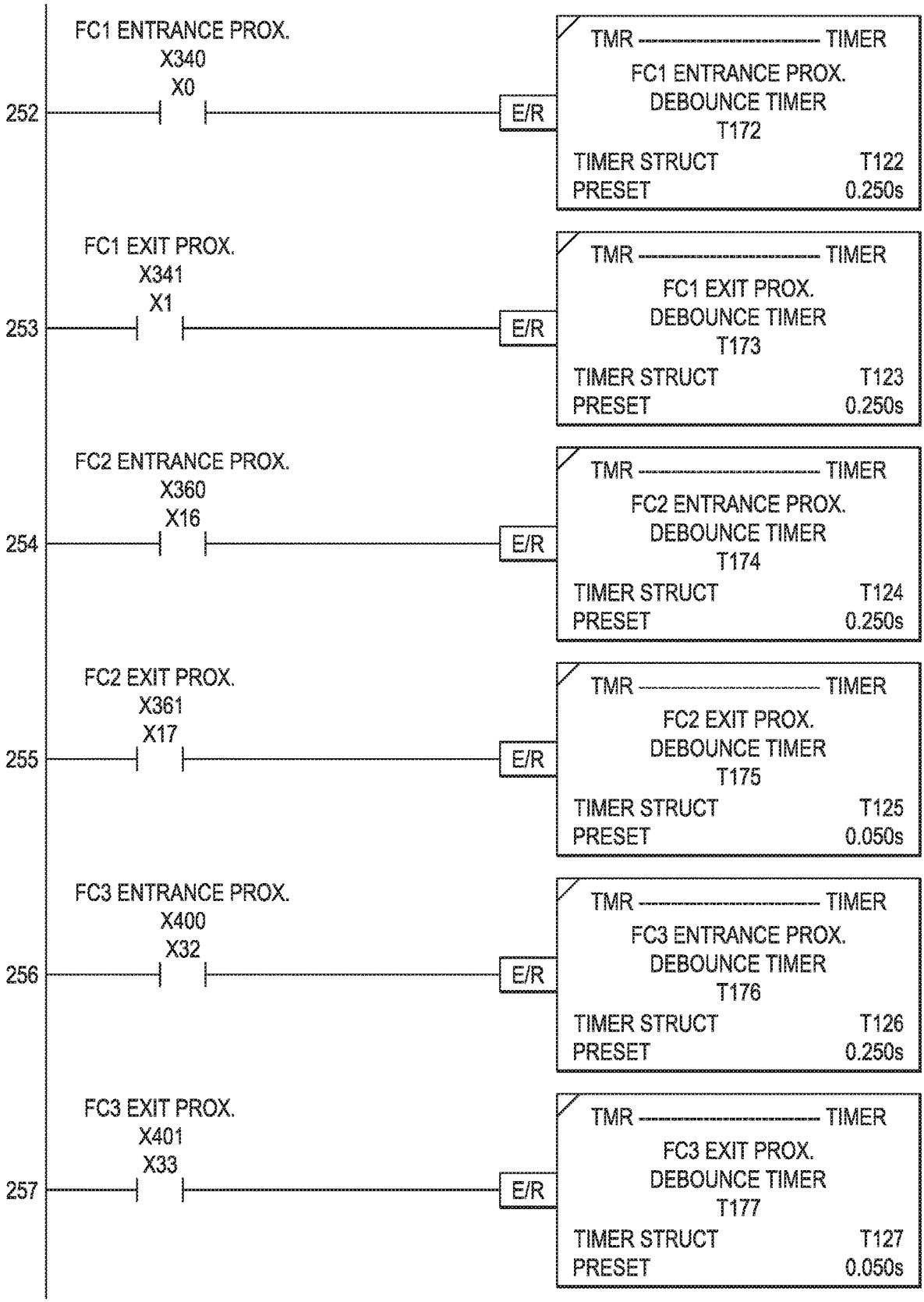
Figure 235:
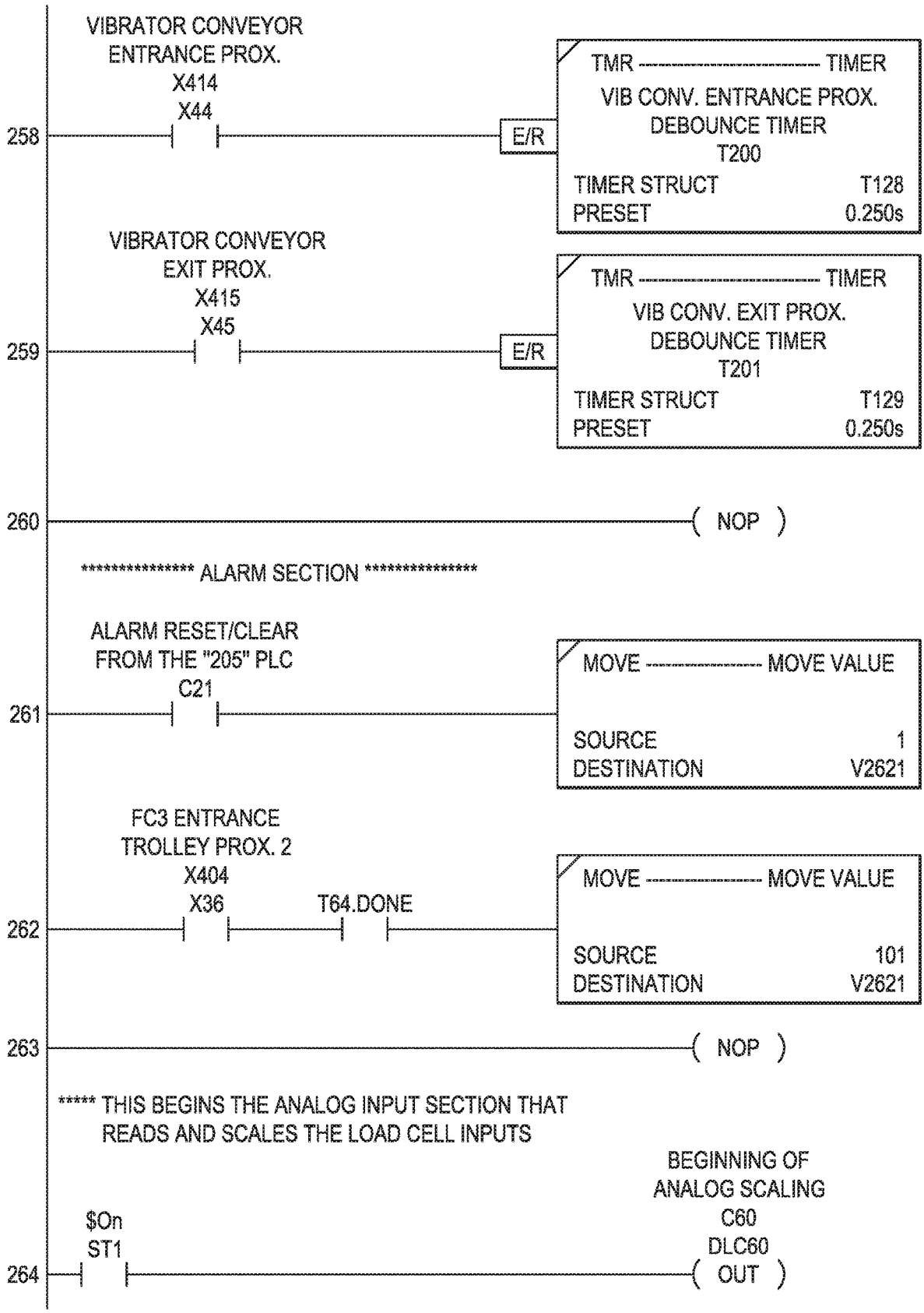
Figure 236:
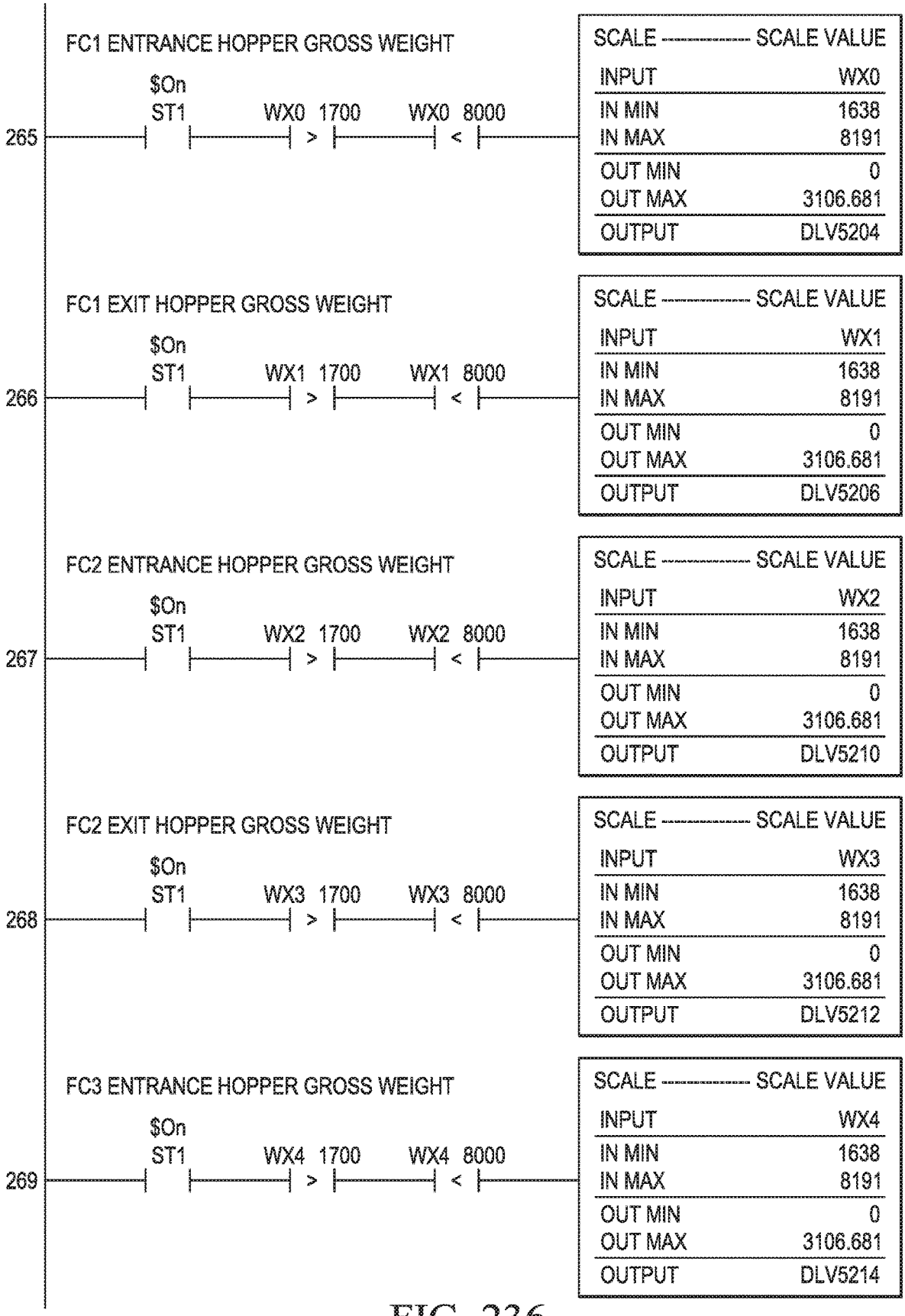
Figure 237:
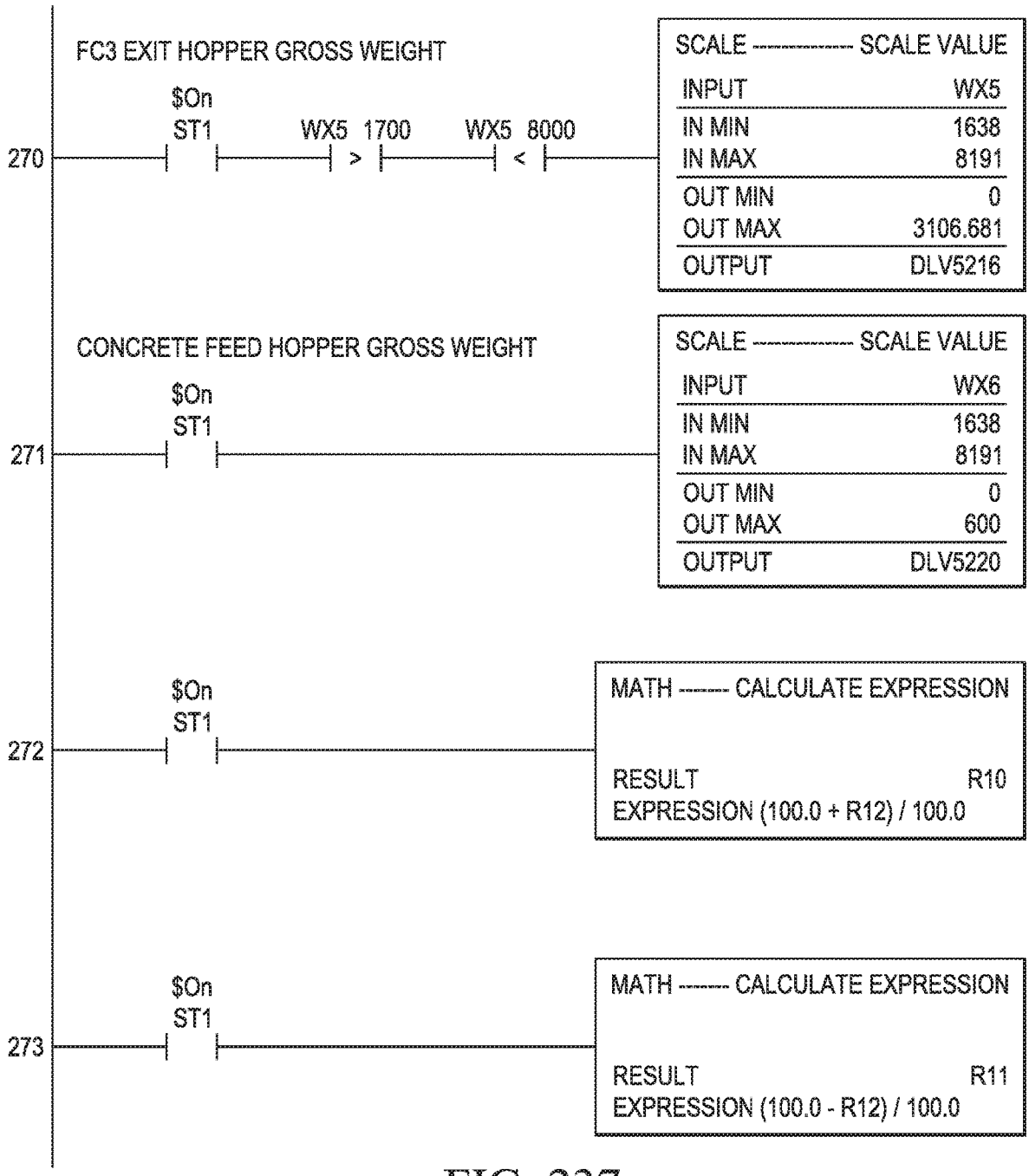
Figure 238:
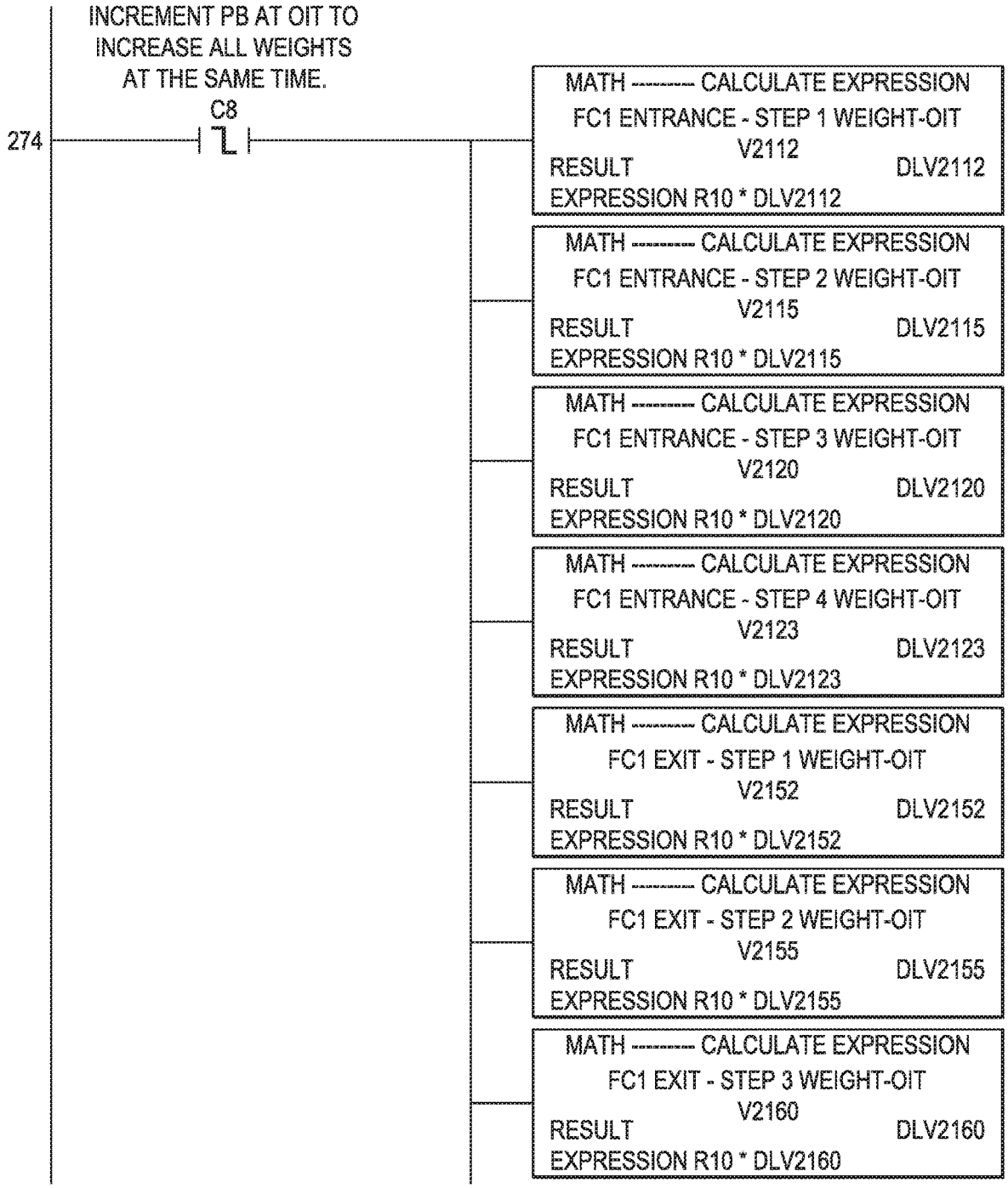
Figure 239:
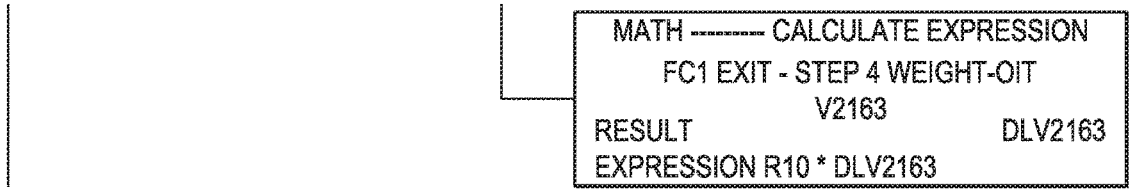
Figure 240:
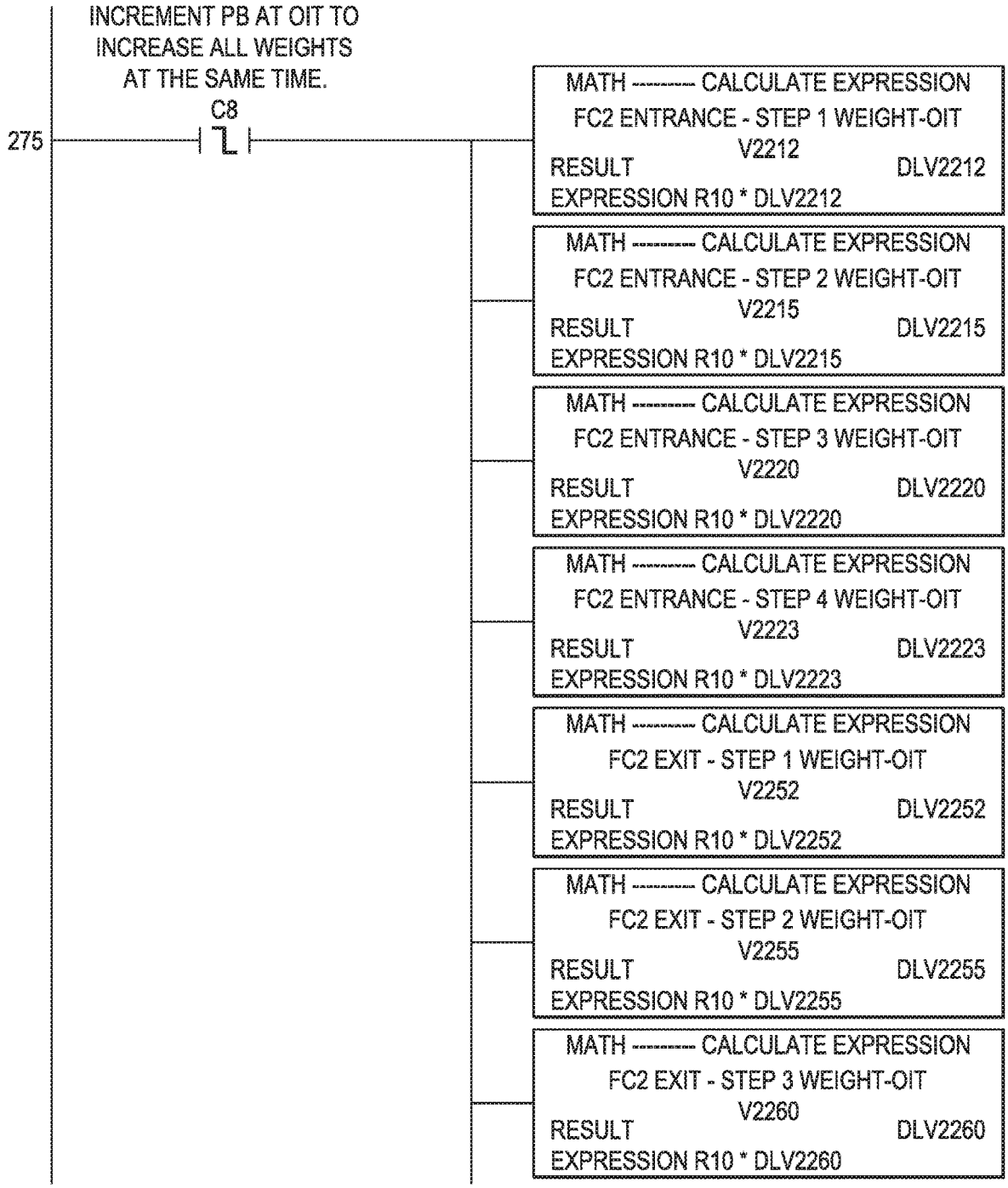
Figure 241:
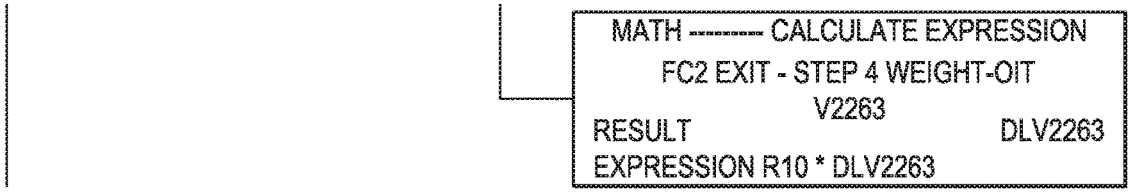
Figure 242:
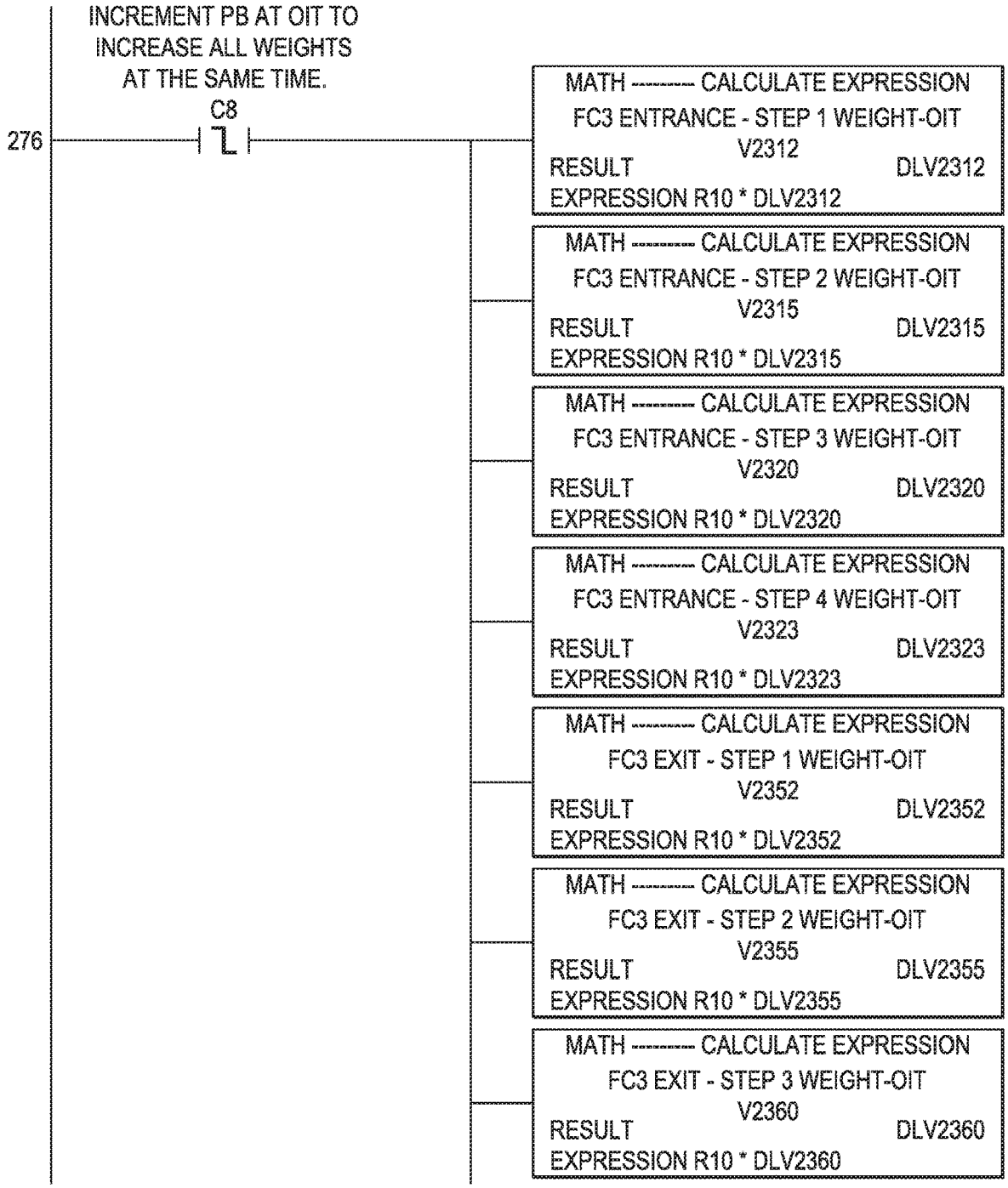
Figure 243:
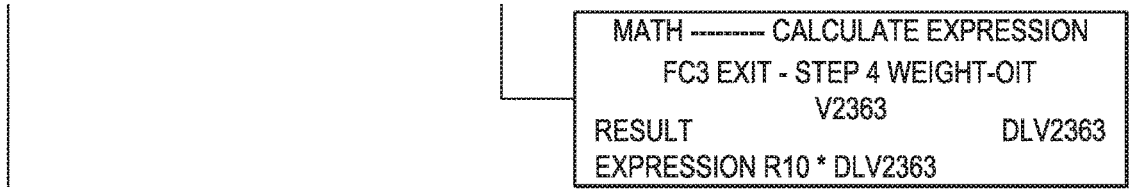
Figure 244:
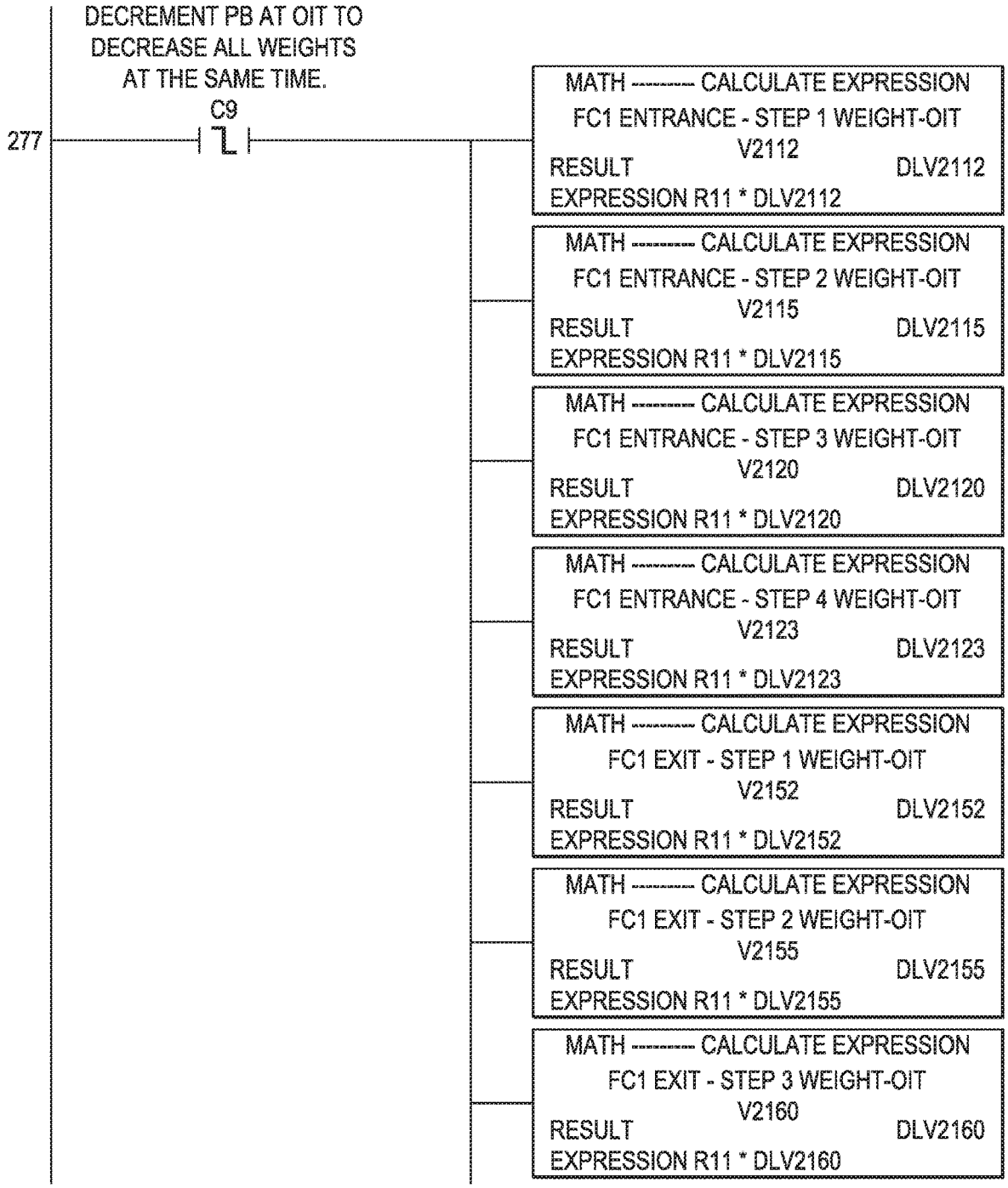
Figure 245:
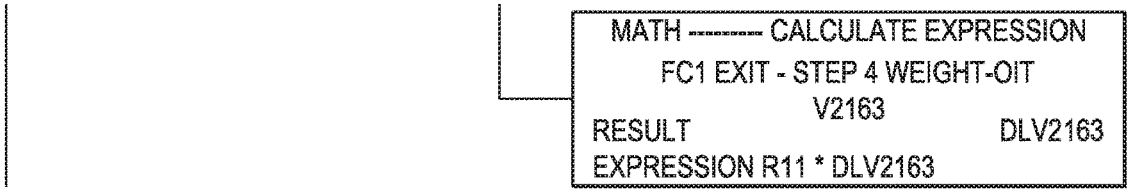
Figure 246:
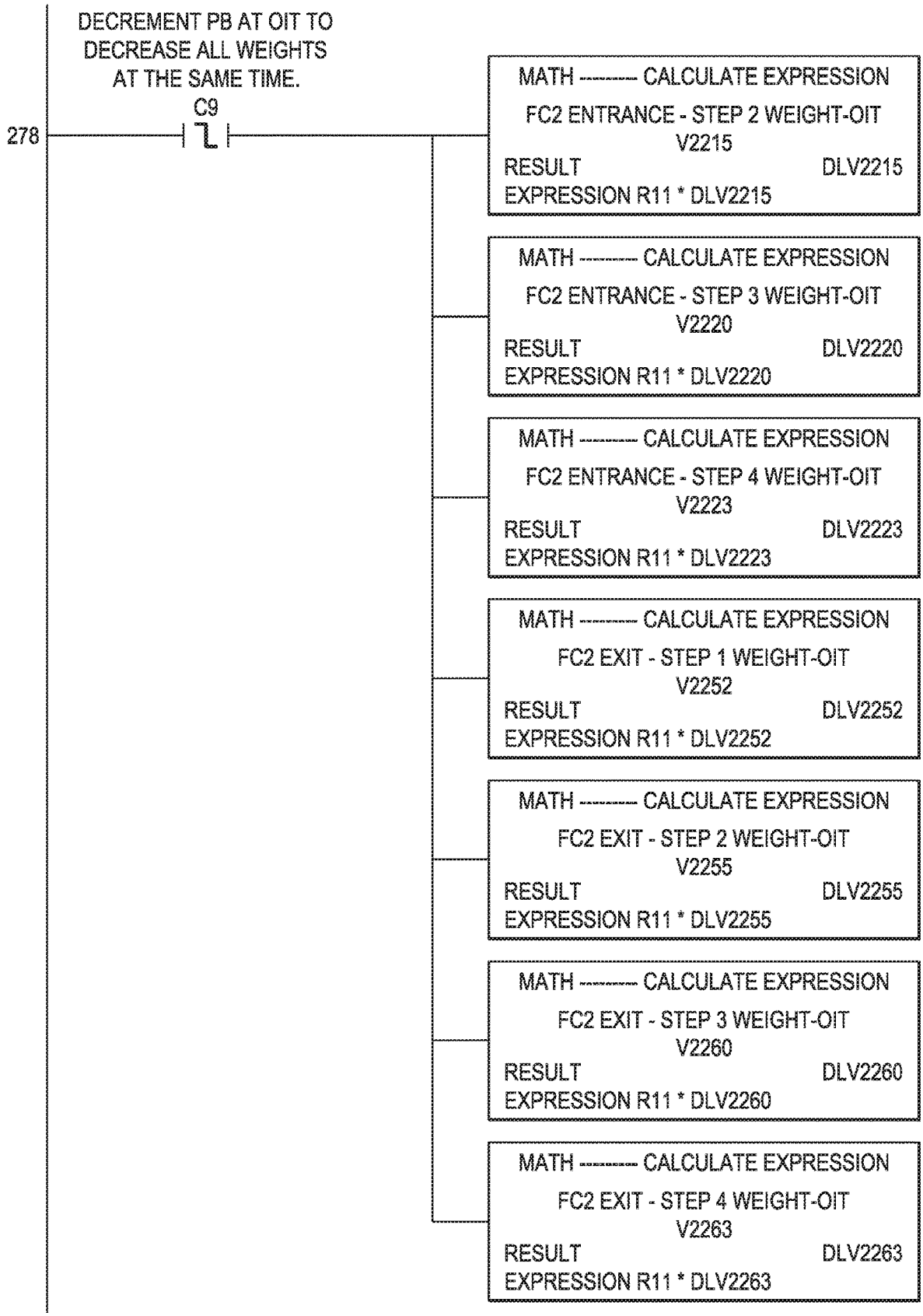
Figure 247:
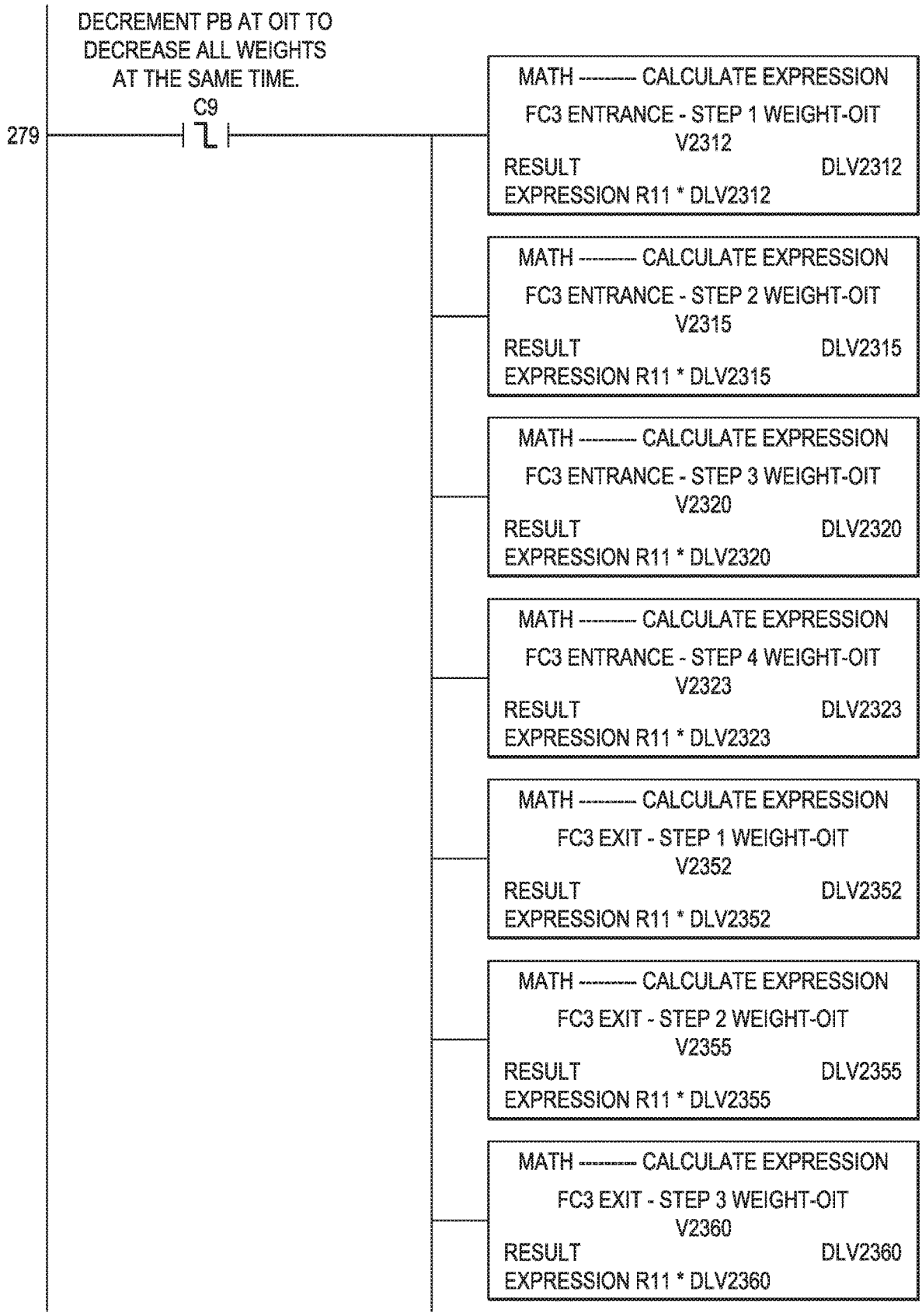
Figure 248:
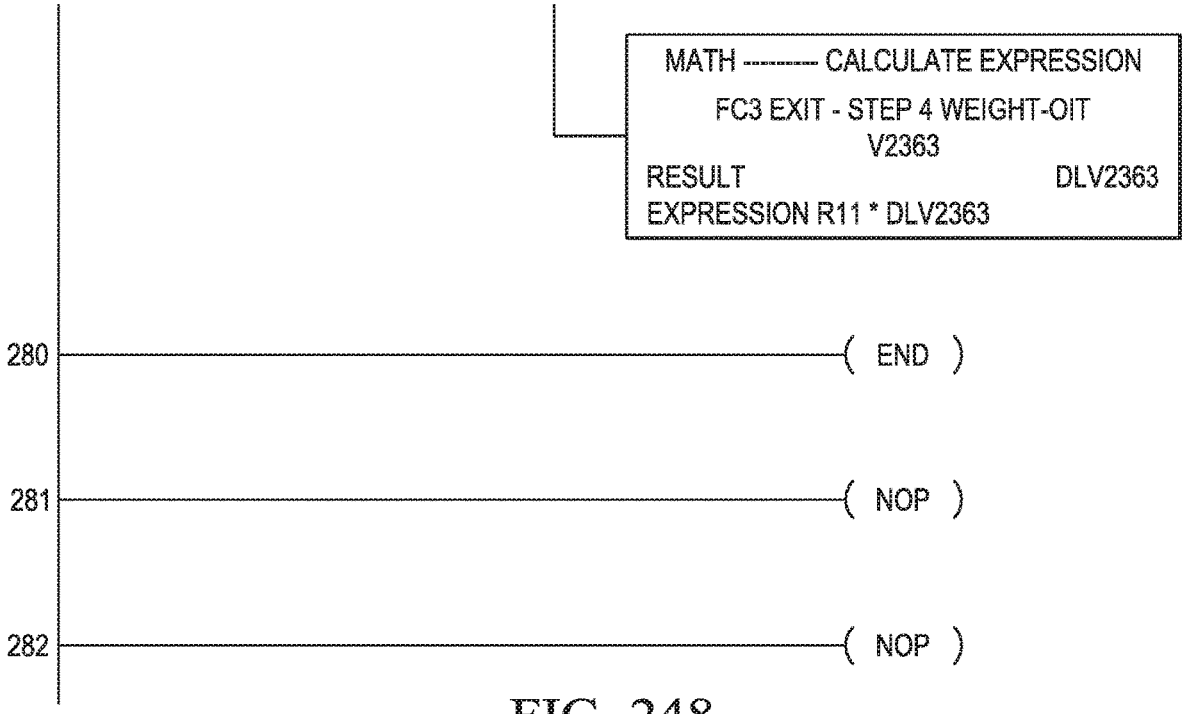

Referring to FIGS. 37-248, a program code is shown that carries out the methods as previously described. In a preferred embodiment, the program code is programmed in ladder logic code. Other suitable programming languages known in the art may be employed.

It will be appreciated by those skilled in the art that modifications can be made to the embodiments disclosed and remain within the inventive concept. For example, changes can be made to the dimensions, motor speeds, and arrangements of the disclosed embodiments. Therefore, this invention is not limited to the specific embodiments disclosed, but is intended to cover changes within the scope and spirit of the claims.

The invention claimed is:

1. A system for manufacturing precast stones comprising:

a controller;

a set of release stations connected to the controller;

a set of color stations connected to the set of release stations and to the controller;

a set of fill stations connected to the set of color stations and the controller;

a set of vibration tables connected to the set of fill stations and to the controller;

a first set of right angle transition tables connected to the set of vibration tables and to the controller;

a drying rack connected to the first set of right angle transition tables and to the controller;

a demolder connected to the drying rack and to the controller; and, a second set of right angle transition tables connected to the demolder, the set of release stations, and the controller.

2. The system of claim 1, wherein each release station of the set of release stations comprises:

a release conveyor;

a release frame connected to the release conveyor; and, a release spray trolley movably connected to the release frame.

3. The system of claim 1, wherein each color station of the set of color stations comprises:

a color conveyor;

a color frame connected to the color conveyor; and, a color spray trolley movably connected to the color frame.

4. The system of claim 1, wherein each fill station of the set of fill stations comprises:

a fill conveyor;

a fill station frame connected to the fill conveyor;

a set of weigh frames connected to the fill station frame;

a set of fill trolley assemblies movably connected to the fill station frame;

a supply hopper connected to each fill trolley assembly of the set of fill trolley assemblies; and, a variable trolley width between each trolley assembly of the set of trolley assemblies.

5. The system of claim 1, wherein the drying rack comprises:

a rack frame;

a set of racks attached to the frame;

an entry elevator connected to the rack frame;

an exit elevator connected to the rack frame opposite the entry elevator;

an entry elevator table connected to the rack frame adjacent to the entry elevator; and, an exit elevator table connected to the rack frame adjacent to the exit elevator table.

6. The system of claim 5, wherein the entry elevator comprises:

a set of entry elevator tines movably connected to the rack frame and removably integrated with the entry elevator table; and, a set of entry elevator sensors attached to the rack frame and connected to the controller, selectively activated by the set of entry elevator tines.

7. The system of claim 5, wherein the exit elevator comprises:

a set of exit elevator tines movably connected to the rack frame and removably integrated with the exit elevator table; and, a set of exit elevator sensors attached to the rack frame and connected to the controller, selectively activated by the set of exit elevator tines.

8. The system of claim 1, wherein the demolder comprises:

a demolder frame;

a set of sides attached to the demolder frame;

a set of belt rollers rotatably attached to the set of sides;

a belt engaged with the set of belt rollers;

a roller table attached to each side of the set of sides generally perpendicular to the set of belt rollers;

a pusher bar assembly movably connected to the set of sides adjacent to the roller table; and, a lip breaker assembly movably connected to the set of sides adjacent to the belt and the roller table.

9. The system of claim 8, wherein the demolder further comprises a set of guide rollers rotatably attached to the set of sides surrounding a portion of the belt.

* * * * *